US012053030B2

(12) United States Patent
Pauls et al.

(10) Patent No.: US 12,053,030 B2
(45) Date of Patent: Aug. 6, 2024

(54) DEVICES AND SYSTEMS FOR DELIVERY OF COMPOUNDS AND RELATED METHODS

(71) Applicant: RDFN FUM Natural Products Ltd., Calgary (CA)

(72) Inventors: Braeden Pauls, Calgary (CA); Josiah Pauls, Herbert (CA); Chad Gothong, Calgary (CA); Joel Braun, Chestermere (CA); Hannah Loewen, Calgary (CA); Janai Whelan, Calgary (CA); Daniel Ogden, Chestermere (CA); Patrick Williams, Ottawa (CA)

(73) Assignee: RDFN FUM NATURAL PRODUCTS LTD, Calgary (CA)

( * ) Notice: Subject to any disclaimer, the term of this patent is extended or adjusted under 35 U.S.C. 154(b) by 0 days.

(21) Appl. No.: 18/468,753

(22) Filed: Sep. 18, 2023

(65) Prior Publication Data

US 2024/0090591 A1 Mar. 21, 2024

Related U.S. Application Data

(63) Continuation-in-part of application No. 18/454,002, filed on Aug. 22, 2023.
(Continued)

(51) Int. Cl.
*A24F 42/20* (2020.01)
*A24F 42/60* (2020.01)

(52) U.S. Cl.
CPC ..... *A24F 42/20* (2020.01); *A24F 42/60* (2020.01)

(58) Field of Classification Search
CPC ..... A24F 42/20; A24F 42/60; A61M 11/04; A61M 15/003; A61M 15/06; A61M 15/0021
See application file for complete search history.

(56) References Cited

U.S. PATENT DOCUMENTS 968,757 A 8/1910 Ferguson
4,083,372 A 4/1978 Boden
(Continued)

FOREIGN PATENT DOCUMENTS

AT 522111 B1 12/2020
CN 106858721 A 6/2017
(Continued)

OTHER PUBLICATIONS

BreatheAura Etsy Canada website. Retrieved Sep. 18, 2023. https://www.etsy.com/ca/shop/BreatheAura?.
(Continued)

*Primary Examiner* — Hae Moon Hyeon
(74) *Attorney, Agent, or Firm* — Transformative Legal LLC; Len S. Smith

(57) ABSTRACT

Provided are devices for delivering volatile compound(s) to individuals. The delivery devices can be unpowered devices. The volatile compound(s) can be flavored. Delivery device can comprise engageable components releasably held together by a selectively releasable attachment mechanism. In aspects, the delivery devices further comprise an adjustable airflow control mechanism. In aspects, movement of delivery device components is associated with visual, audible, tactile, or audible and tactile indication of movement or position of device elements. In aspects, element(s) of a delivery device or a device in a system serve as a fidget movement element, being detectably moveable within a short period upon application of a small initiation force easily being returned to a position suitable for repeating the movement. Further provided are methods of using such delivery devices or systems for promoting user sensory experiences or for other beneficial effects, such as reducing habit-related behaviors or sensations.

30 Claims, 43 Drawing Sheets

Related U.S. Application Data

(60) Provisional application No. 63/407,701, filed on Sep. 18, 2022.

(56) References Cited

U.S. PATENT DOCUMENTS

| | | | | |
|---|---|---|---|---|
| 4,175,556 | A | 12/1979 | Freezer | |
| 4,284,089 | A | 8/1981 | Ray | |
| 4,429,703 | A | 2/1984 | Haber | |
| 4,800,903 | A | 1/1989 | Ray | |
| 9,700,691 | B2 | 7/2017 | Watanabe | |
| 10,492,526 | B2 | 12/2019 | Sampson | |
| 10,548,348 | B2 | 2/2020 | Levilev | |
| 2006/0130857 | A1 | 6/2006 | Roth | |
| 2008/0023003 | A1* | 1/2008 | Rosenthal | A61M 15/06 128/203.26 |
| 2011/0297166 | A1 | 12/2011 | Takeuchi | |
| 2014/0238421 | A1* | 8/2014 | Shapiro | A24F 40/40 131/328 |
| 2015/0122277 | A1 | 5/2015 | Frobisher | |
| 2016/0279358 | A1 | 9/2016 | Singer | |
| 2018/0207370 | A1 | 7/2018 | Rowland | |
| 2020/0171266 | A1 | 6/2020 | Trzecieski | |
| 2021/0052832 | A1 | 2/2021 | Spadaro | |

FOREIGN PATENT DOCUMENTS

| | | | |
|---|---|---|---|
| DE | 102018207543 | A | 11/2019 |
| EP | 2609822 | B1 | 4/2018 |
| FR | 2654002 | | 5/1991 |
| GB | 2412876 | A | 10/2005 |
| KR | 649552 | B1 | 11/2006 |
| KR | 20070020830 | A | 2/2007 |
| KR | 20160066851 | A | 6/2016 |
| RS | 20160590 | A1 | 1/2018 |
| WO | WO2016026094 | A1 | 2/2016 |
| WO | WO2020261540 | A1 | 12/2020 |

OTHER PUBLICATIONS

Breth4life Etsy Canada website. Retrieved Sep. 18, 2023. https://www.etsy.com/ca/shop/breTH4life?ref=simple-shop-header-name&listing_id=1165024855.

Emitto Styx Facebook website. Retrieved Sep. 18, 2023. https://www.facebook.com/emittostyx/.

Grandview Research, "E-cigarette And Vape Market Size, Share & Trends Analysis Report By Product, By Distribution Channel, By Region, And Segment Forecasts, 2023-2030." Mar. 2022. https://www.grandviewresearch.com/industry-analysis/e-liquid-market.

Holy Smokes Facebook website. Retrieved Sep. 18, 2023. https://www.facebook.com/manlyoiler/.

Kiff—Wooden Essential Oil Inhaler Kickstarter website. Retrieved Sep. 18, 2023. https://www.kickstarter.com/projects/kiff-story/kiff.

Lung Love Etsy Canada store website. Retrieved Sep. 18, 2023. https://www.etsy.com/shop/LungLove?ref=seller-platform-mcnav.

Miech et al., "Trends in Use and Perceptions of Nicotine Vaping Among US Youth From 2017 to 2020." JAMA Pediatr. 2021;175(2):185-190. doi:10.1001/jamapediatrics.2020.5667. Published online Dec. 15, 2020.

Monq—Organic Hand-Held Essential Oil Diffusers website. Retrieved Sep. 18, 2023. https://monq.com/.

Nicorette 15mg Inhalator Information page. EMC. Last updated on Sep. 1, 2021. https://www.medicines.org.uk/emc/product/4707/smpc#gref.

Oil and Bark Essential Oil Inhaler Website Home. Retrieved Sep. 18, 2023. https://oilandbark.com/.

Ripple+ zero nicotine plant powered puffs theripplestoreUSA website. Retrieved Sep. 18, 2023. https://www.theripplecco.com/.

Alivape. "Vape Fidget Spinner Toy 510 Spinner Premium—Alivape." Bing image search and product page. Image in public domain on or before Nov. 2017. https://www.alivape.com/products/vape-fidget-spinner-toy-510-spinner-premium.

Non Final Office Action on Nov. 8, 2023 for U.S. Appl. No. 18/454,002.

International Search Report on Jan. 24, 2024 for PCT/IB2023/059217.

Written Opinion on Jan. 24, 2024 for PCT/IB2023/059217.

* cited by examiner

DEVICES AND SYSTEMS FOR DELIVERY OF COMPOUNDS AND RELATED METHODS

RELATED APPLICATIONS/PRIORITY

This patent Application is a Continuation in Part of, and claims priority to, presently co-pending U.S. patent application Ser. No. 18/454,002, filed Aug. 22, 2023, entitled NON-ELECTRIC, NON-HEATED DEVICES FOR ORAL DELIVERY OF COMPOUNDS AND RELATED SYSTEMS AND METHODS, which claims priority to U.S. Provisional Patent Application No. 63/407,701 filed Sep. 18, 2022, entitled NON-ELECTRIC, NON-HEATING DEVICES FOR THE INHALATION OF NON-VOLATILE COMPOUNDS. This application claims the benefit of priority to, and incorporates by reference the entirety of, these above-referenced priority applications.

FIELD OF THE INVENTION

The invention primarily relates to the field of volatile compound delivery devices, specifically unpowered/unheated devices for the delivery of one or more volatile compounds to a device user.

BACKGROUND OF THE INVENTION

Devices or systems for delivering volatile compounds, such as essential oils, have been proposed and developed in recent years as a means of providing users a safe and pleasurable oral sensory experience. Many of these products can be distinguished from the significantly more common electronic cigarettes or "e-cigarette" devices which usually have been presented as an alternative to traditional tobacco products.

E-cigarettes typically comprise a mouthpiece allowing a user to inhale an aerosol, the aerosol being created by the atomization of a liquid housed within the device. The atomization is accomplished by the heating of the liquid, the heat generated by the incorporation of battery which powers the device. The term "vape" is often used synonymously with e-cigarette use (though vaping can also sometimes refer to administration of vaporized compounds via other means such as hookahs). The term "vape" refers to the vapor which is inhaled upon generation by the device. Such aerosolized compounds provided by e-cigarettes or other smokeless devices can include nicotine or other compounds, e.g., cannabinoid compounds, essential oils, and other volatile compounds. The liquid in an e-cigarette can include nicotine and when it does, such an e-cigarette is sometimes referred to as a "HANDS" device, HANDS being an acronym for "heated aerosolized nicotine delivery systems"; a handheld device that heat either nicotine-infused liquid or tobacco sticks, producing an aerosol that can be inhaled.

Some of the essential oil delivery systems/products that have actually been brought to market are non-electronic or "passive" (unpowered) diffusion devices, as heat is not required for volatilization of some non-nicotinic compounds and the devices may rely solely on diffusion or some amount of inhalation power of a user (though this does not mean that the user actually inhales such compounds in significant extent beyond taking the compounds into the mouth). Some of the proposed devices of this class are provided in patent disclosures that describe additional proposed features for modifying the experience of delivering volatile compounds to a person, such as disposable cartridges.

For example, U.S. Pat. No. 4,083,372 to Boden describes a non-electronic, cigarette-stimulating inhaler comprising a fluid-impermeable, resiliently flexible outer tubular sheath. The sheath is open at both ends. The device described in the '372 Boden Patent comprises a wick within the sheath at one end and a soft, puncturable, liquid-containing capsule at the other, with an air chamber separating the two. The inhaler is activated by puncturing the end of the capsule closest to the wick and pinching the outer sheath at the location of the capsule to force the liquid contained therein into the air chamber prior to being absorbed by the wick. The empty capsule is then discarded.

French Patent Publication Number FR2654002 to Laurens describes a delivery device in the general form of a cigarette, cigar, pipe, or cigarette holder, for applying aromatherapy by inhalation. The device comprises a support for a volatile substance positioned within the body of the device. The device further comprises a mechanism making it possible to control the loss of head, e.g., in an adjustable manner, to regulate the flow of the inhaled air through the delivery device. Such a mechanism is embodied as either a sliding ring or the ability for the user to physically squeeze the body of the device between their thumb and forefinger to restrict airflow. Temporary closure means are provided on each side of the support such that when there is no inhalation, the substance impregnating the support cannot escape via evaporation. The device is embodied as being either a refillable inhaler or a disposable inhaler and provides a mechanism for inhaling volatile substances via either the users nose or mouth.

Austrian Patent AT522111 to Kornhausl describes a passive inhaler for the delivery of volatile substances such as from natural essential oils from an exchangeable insert. The Kornausl device comprises an airflow channel in which the insert is positioned and held in place by an elastic seal, as well as a removable mouthpiece. The mouthpiece is made of vulcanite hard rubber or acryl and is held in place in an air-tight manner by means of an elastic seal. The main body of the device is made from solid wood or other wood-based material or from plastics.

Great Britain Patent GB2412876 to Jones describes a nicotine inhaler, suitable for use as a substitute for a cigarette for the inhalation of nicotine. The device is preferably disposable and constructed to visually mimic a cigarette, e.g., made of white, glossy cardboard. The Jones Patent device comprises an elongated tube having an inlet and an outlet with a nicotine delivery element mounted inside the tube between the respective ends. The tube is provided with an adjustable regulating means, capable of adjusting the airflow through the device. The regulating means comprises two abutting members, e.g., discs, each with apertures therein. The two members are movable relative to one another to provide varying degrees of overlap of the apertures thus providing adjustable airflow.

U.S. Pat. No. 9,700,691 to Watanabe describes a flavor inhalation pipe comprising a hollow, cylindrical pipe body, a mouthpiece, and a tobacco (flavor) cartridge maintained within the pipe body but attached to the mouthpiece, with a coupling device reversibly coupling the pipe body and the mouthpiece to one another. The flavor cartridge can be replaced by detaching the mouthpiece from the pipe body (e.g., uncoupling the coupling device) and pulling the mouthpiece with attached flavor cartridge away from and out of the pipe body by holding the mouthpiece. The mouthpiece can be covered with a cap to provide a hygienic way of removing and replacing the flavor generation cartridge.

United States Patent Publication Number 2016/012277 to Frobisher describes a smoking "article" (e.g., an inhaler-type device in the form of a flow delivery article) having a flow control component. The proposed device is configured to provide at least one flow during a draw on the flow delivery article and at least one flow comprising a respective plurality of flow peaks, e.g., the at least one flow comprising at least one of a smoke flow, an airflow, a flavored flow, and a mixed smoke/air/flavored flow. The flow control component is configured to cause a plurality of flow changes, providing a time-varying flow with each flow change comprising changing the relative amount of flow through the different flow pathways.

Other patent art describing passive, non-aerosolized, non-heated, cigarette-like delivery devices include the disclosures of, e.g., EP2609822; US Patent Nos. 968757, 4175556, 4284089, 4429703, and 4800903; US Patent Publication Nos. 20060130857, 20180207370, 20210052832; and PCT Publication Number WO2016026094.

Despite the number of proposed devices, the number of passive devices for the delivery of flavored or other non-pharmaceutical volatile compounds to a user that have been successfully developed remains markedly limited. Exemplary devices presently marketed include those by Emitto Styx (see emittostyx.com), Lung Love (see etsy.com/ca/listing/734302930/walnut-wood-lung-love-essential-oil?), Holy Smokes (see facebook.com/pg/manlyoiler/posts/), BreatheAura (see etsy.com/ca/shop/BreatheAura?), Kiff (see kickstarter.com/projects/kiff-story/kiff), monq aromatherapy (see monq.com/), Ripple+(see theripple.com/), Oil & Bark (see oilandbark.com/), and, e.g., breTH4life (see etsy.com/ca/shop/breTH4life?ref=simple-shop-header-name&listing_id=1165024855).

The Nicorette™ line of products from Johnson & Johnson, GlaxoSmithKline, is also present in this marketspace, providing a Nicorette™ inhaler device (see medicines.org.uk/emc/product/4707/smpc#gref); however, notably, as is the approach for the plurality of nicotine replacement product lines sold under the Nicorette brand (e.g., Nicorette gum, lozenges, and nasal spray), this simple delivery device delivers nicotine-associated products.

The Applicant also has developed and marketed a "first generation" essential oil delivery device marketed under the brand name FUM™. This original FUM device is a tobacco-free, vapor free, non-electronic inhaler made of 100% natural materials and marketed to aid in quitting smoking and vaping. The FUM device is a single-piece device made of wood, having a first open end for placing within a user's mouth to facilitate the inhalation of one or more volatile compounds via the mouth, and a second open end, with an air passageway directly connecting the two ends. A flexible, fibrous insert is designed to be used within the device, the fibrous insert capable of holding essential oils prior to use, placed within the device by inserting the fibrous insert into the device via the second open end of the device. The inserts comprise medical-grade polyester designed to hold essential oil(s). To operate the device, a user is instructed to (a) obtain an insert, (b) fray the end of the insert to activate it, (c) insert the non-frayed end of the insert into the end of the device, and (c) inhale through the device using their mouth and to exhale out of their nose.

Despite all of the above-described efforts present in the art to set forth non-electronic, cigarette-mimicking devices for use in smoking cessation efforts, pleasure, or both, the electronic device/vaping market continues to grow. This is especially true among adolescents. As reported by Miech, et. al., in JAMA Pediatrics, 2021; 175(2):185-190, doi:10.1001/jamapediatrics.2020.5667, published online Dec. 15, 2020, and corrected on Jan. 19, 2021, while increasing US adolescent nicotine vaping trends from 2017 to 2019 halted in 2020—due to decreases in perceived accessibility of some vaping products as well as increases in perceived risk of nicotine vaping between 2019 and 2020—adolescent nicotine vaping remains highly prevalent. 22% of $10^{th}$ and $12^{th}$ grade students in 2020 reported vaping within the previous 30-days of the time of the cited study and 41% reported vaping at least once in their lifetime. Worldwide, the global e-cigarette and vape market size was valued at 18.13 billion USD in 2021 and is estimated to balloon at a compound annual growth rate (CAGR) of 30.0% from 2022 to 2030 (See E-cigarette and Vape Market Size, Share & Trends Analysis Report by Product (Disposable, Rechargeable), By Distribution Channel (Online, Retail), By Region, And Segment Forecasts, 2022-2030) published March 2022). However, in stark contrast, the entire global aromatherapy market size was estimated to have a market size of less than $1/10^{th}$ that of e-cigarettes/vape products, with aromatherapy devices representing only a fraction of this total market. Thus, such products have historically demonstrated a very slow relative adoption of passive, non-nicotinic, vapor-free, non-electronic devices. In view of these facts, it is clear that the development of effective diffusion systems for delivery of volatile compounds, such as flavored essential oils, and similarly effective passive delivery/aromatherapy systems will require the application of inventive ingenuity.

Construction, Terms, and Acronyms

This section offers guidelines for reading this disclosure.

The intended audience for this disclosure ("readers") are persons having ordinary skill in the practice of technologies discussed or used herein. Readers may also be called "skilled persons," and such technologies and related publicly available prior knowledge are collectively referred to as "the art." Terms such as "understood," "known," and "ordinary meaning," refer to the general knowledge of skilled persons.

The term "uncontradicted" means not contradicted by this disclosure, logic, or plausibility based on knowledge of skilled persons.

Disclosed here are several different but related exemplary aspects of the invention (referred also to as, e.g., "cases," "facets," "respects," or "embodiments"). The invention encompasses all aspects as described individually and as can be arrived at by any combination of such individual aspects. In this respect, the breadth and scope of the invention should not be limited by any exemplary embodiment(s). No language in this disclosure should be construed as indicating any element/step is essential to the practice of the invention unless such a requirement is explicitly stated. Uncontradicted, any aspect(s) can be combined with any other aspect(s).

Uncontradicted, all technical/scientific terms used here, should be read, at least in one aspect, to have the same meanings as commonly understood by skilled persons, regardless of any narrower examples or descriptions provided here (including any term introduced initially in quotations). However, readers will also recognize that some aspects can characterized by the inclusion of elements, steps, features, characteristics etc., associated with specific descriptions provided here, and that such specific disclosures represent distinct embodiments of the invention apart from the corresponding aspect that is provided by interpreting the invention using any broader commonly used terminology or concept. Uncontradicted, disclosure of any aspect using known terms, which terms are narrowed by example or otherwise, implicitly discloses one or more related aspects in which the applicable terms are alternatively interpreted using the broadest reasonable interpretation of skilled persons.

Uncontradicted, the term "or" means "and/or" here, regardless of any occasional inclusion of the actual phrase "and/or" (e.g., phrases such as "A, B, or C" and "A, B, and/or C" each simultaneously disclose aspects including (1) all of A, B, and C; (2) A and C; (3) A and B; (4) B and C; (5) only A; (6) only B; and (7) only C (and also support sub-groupings, such as "A or B," "A or C," etc.)).

Uncontradicted, the term "also" means "also or alternatively." Uncontradicted, the terms "here" & "herein" mean "in this disclosure." The term "i.a." is an acronym standing for "inter alia" or meaning "(possibly) among other things." "Also known as" is abbreviated "aka" or "AKA." The term "elsewhere" means "elsewhere herein."

For conciseness, symbols are used where appropriate. E.g., "&" is used for "and," & "~" for "about." Symbols such as < and > are given their ordinary meaning (e.g., "≤" means "less than or equal to" & "≥" means "greater than or equal to"). A slash "/" between terms here can represent "or" ("A/B" means "A or B") or identify synonyms of an element, as will be clear from context. The inclusion of "(s)" after an element or a step indicates that ≥1 of such an element is present, step performed, and the like. E.g., "element(s)" refers to both 1 element and ≥2 elements, with the understanding that each thereof is an independent aspect of the invention.

Use of the abbreviation "etc." (or "et cetera") in association with a list of elements/steps means any or all suitable combinations of the recited elements/steps or any known equivalents of such recited elements/steps for achieving the function(s) of such elements/steps known in the art. Readers should interpret phrases like "and the like" similarly.

Uncontradicted, terms such as "and combinations," "combinations thereof," or "or combinations," and "combinations of any thereof" regarding listed elements/steps means any or all possible/suitable combinations of the associated elements/steps. Thus, e.g., uncontradicted, a phrase like "combination of any thereof" refers to any or all combinations.

Aspects may be described as suitable for use(s) disclosed herein. Uncontradicted, terms such as "suitability" means acceptable or appropriate for performing a particular function/achieving particular state(s)/outcome(s), and typically means effective, practical, and non-deleterious/harmful in the context the term is used. E.g., uncontradicted, the term "suitable" means appropriate, acceptable, or in contexts sufficient, or providing at least generally or substantially all an intended function, without causing or imparting significant negative/detrimental impact.

Uncontradicted, heading(s) (e.g., "Construction, Terms . . . ") and subheadings here are included for convenience and do not limit the scope of any aspect(s). Uncontradicted, aspect(s), step(s), or element(s) described under one heading can apply to other aspect(s) or step(s)/element(s) here.

Ranges of values are used to represent each value falling within such range that are within an order of magnitude of the smallest endpoint of the range without having to explicitly write each value of the range. E.g., a recited range of 1-2 implicitly discloses each of 1.0, 1.1, 1.2, . . . 1.9, and 2.0 and 10-100 implicitly discloses each of 10, 11, 12, . . . 98, 99, and 100). Uncontradicted, all ranges include the range's endpoints, regardless of how a range is described. E.g., "between 1-5" includes 1 and 5 in addition to 2, 3, and 4 (and all numbers between such numbers within an order of magnitude of such endpoints, e.g., 1.0, 1.1, . . . 4.9, and 5.0). For the avoidance of doubt, any number within a range, regardless of the order of magnitude of the number, is covered by the range (e.g., a range of 2-20 covers 18.593). Uncontradicted, readers will understand that any two values in a range provided as a list herein can be combined as endpoints to form a range defining a more particular aspect of the invention (e.g., if a list of values 1, 2, 3, 4, and 5 of element X is provided, readers will understand that the disclosure implicitly discloses an aspect comprising 2-4 X, 3-5 X, and 1-3 X, etc.

Terms of approximation (e.g., "about," "~," or "approximately") are used (1) to refer to a set of related values or (2) where a precise value is difficult to define (e.g., due to limits of measurement). Uncontradicted, all exact values provided here simultaneously/implicitly disclose corresponding approximate values and vice versa (e.g., disclosure of "about 10" provides explicit support for the use of 10 exactly in such aspect/description). Ranges described with approximate value(s) include all values encompassed by each approximate endpoint, regardless of presentation (e.g., "about 10-20" has the same meaning as "about 10-about 20"). The scope of value(s) encompassed by an approximate term typically depends on the context of the disclosure, criticality or operability, statistical significance, understanding in the art, etc. In the absence of guidance here or in the art for an element, terms such as "about" when used in connection with an element should be interpreted as ±10% of the indicated value(s) and implicitly disclosing ±5%, ±2%, ±1%, and ±0.5%.

Lists of aspects, elements, steps, and features are sometimes employed for conciseness. Unless indicated, each member of each list should be viewed as an independent aspect. Each aspect defined by any individual member of a list can have, and often will have, nonobvious properties vis-a-vis aspects characterized by other members of the list.

Uncontradicted, the terms "a" and "an" and "the" and similar referents encompass both the singular and the plural form of the referenced element, step, or aspect. Uncontradicted, terms in the singular implicitly convey the plural and vice versa herein (in other words, disclosure of an element/step implicitly discloses corresponding use of such/similar elements/steps and vice versa). Hence, e.g., a passage regarding an aspect including X step supports a corresponding aspect including several X steps. Uncontradicted, any mixed use of a referent such as "a" in respect of one element/step or characteristic and "one or more of" with respect to another element/step or characteristic in a paragraph, sentence, aspect, or claim, does not change the meaning of such referents. Thus, for example, if a paragraph describes a composition comprising "an X" and "one or more Ys," the paragraph should be understood as providing disclosure of "one or more Xs" and "one or more Ys."

"Significant" and "significantly" mean results/characteristics that are statistically significant using ≥1 appropriate test(s)/trial(s) in the given context (e.g., $p \leq 0.05/0.01$). "Detectable" means measurably present/different using known detection tools/techniques. The acronym "DOS" (or "DoS") means "detectable(ly) or significant(ly)."

Uncontradicted, any value provided here that is not accompanied by a unit of measurement (e.g., a weight of 50 or a length of 20), either any previously provided unit for the same element/step or the same type of element/step will apply, or, in cases where no such disclosure exists, the unit most commonly used in association with such an element/step in the art will apply.

Uncontradicted, the terms "including," "containing," "comprising," and "having" mean "including, but not limited to" or "including, without limitation." Uncontradicted, use of terms such as comprising and including regarding elements/steps means including any detectable number or amount of an element or including any detectable performance of a step/number of steps (with or without other elements/steps). Uncontradicted, "a" means one or more, even when terms such as "one or more" or "at least one" are used in association with the referent "a."

For conciseness, description of an aspect "comprising" or "including" an element, with respect to a collection/whole (e.g., a system, device, or composition), implicitly provides support for any detectable amount/number or ≥~1%, ≥~5%, ≥~10%, ≥~20%, ≥~25%, ≥~33%, ≥~50%, ≥~51%, ≥~66%, ≥~75%, ≥~90%, ≥~95%, ≥~99%, or ~100% of the whole/collection being made up of the element, or essentially all of the whole/collection being made up of the element (i.e., that the collection consists essentially of the referenced element). Similarly, a method described as including a step with respect to an effect/outcome implicitly provides support for the referenced step providing ≥~1%, ≥~5%, ≥~10%, ≥~20%, ≥~25%, ≥~33%, ≥~50%, ≥~51%, ≥~66%, ≥~75%, ≥~90%, ≥~95%, ≥~99%, or ~100% of the effect/outcome, representing ≥~1%, ≥~5%, ≥~10%, ≥~20%, ≥~25%, ≥~33%, ≥~50%, ≥~51%, ≥~66%, ≥~75%, ≥~90%, ≥~95%, ≥~99%, or ~100% of the steps/effort performed, or both. Explicit listing of percentages of elements/steps in connection with aspects does not limit or contradict such implicit disclosure.

Uncontradicted, terms such as "comprising" when used in connection with a step of a method provide implicit support for performing the step once, ≥2 times, or until an associated function/effect is achieved.

Uncontradicted, the term "one" means a single type, single iteration/copy/thing, of a recited element or step, or both, which will be clear from context. For example, the referent "one" used with a component of a composition/article or system can refer to one type of element (which may be present in numerous copies, as in the case of an ingredient in a composition), one unit of the element, or both. Similarly, "one" component, a "single" component, or the "only component" of a system typically means 1 type of element (which may be present in numerous copies), 1 instance/unit of the element, or both. Further, "one" step of a method typically means performing one type of action (step), one iteration of a step, or both. Uncontradicted, a disclosure of "one" element provides support for both, but uncontradicted, any claim to any "one" element means one type of such an element (e.g., a type of component of a composition/system/article).

Uncontradicted, the term "some" means ≥2 copies/instances or ≥5% of a listed collection/whole is, or is made up of, an element. Regarding methods, some means ≥5% of an effect, effort, or both, is made up of or is attributable to a step (e.g., as in "some of the method is performed by step Y") or indicates a step is performed ≥2 times (e.g., as in "step X is repeated some number of times"). Terms such as "predominately," "most," or "mostly," (and "primarily" when not used to refer to an order of events or "mainly") means detectably >50% (e.g., mostly comprises, predominately includes, etc., mean >50%) (e.g., a system that mostly includes element X is composed of >50% of element X). The term "generally" means ≥75% (e.g., generally consists of, generally associated with, generally comprises, etc., means ≥75%) (e.g., a method that generally consists of step X means that 75% of the effort or effect of the method is attributable to step X). "Substantially" or "nearly" means ≥95% (e.g., nearly all, substantially consists of, etc., mean ≥95%) (e.g., a collection that nearly entirely is made up of element X means that at least 95% of the elements in the collection are element X). Terms such as "generally free" of an element or "generally lacking" an element mean comprising ≤25~% of an element and terms such as "substantially free" of an element mean comprising ≤~5% of an element.

Uncontradicted, any aspect described with respect to an optionally present element(s)/step(s) also provides implicit support for corresponding aspect(s) in which one, some, most, generally all, nearly all, essentially all, or all of such element(s) are lacking/step(s) not performed, in respect of the relevant aspect. E.g., disclosure of a system comprising element X implicitly also supports a system lacking element X.

Uncontradicted, changes to tense or presentation of terms (e.g., using "comprises predominately" in place of "predominately comprises") do not change the meaning of the corresponding term/phrase.

Uncontradicted, all methods provided here can be performed in any suitable order regardless of presentation (e.g., a method comprising steps A, B, and C, can be performed in the order C, B, and A; B and A and C simultaneously, etc.). Uncontradicted, elements of a composition can be assembled in any suitable manner by any suitable method. In general, any methods and materials similar or equivalent to those described here can be used in the practice of embodiments in at least the broadest version of the relevant aspect. Uncontradicted, the use of ordinal numbers such as "first," "second," "third," and so on is to distinguish respective elements rather than to denote a particular order of those elements, importance, or configuration.

Uncontradicted, any elements, steps, components, or features of aspects and all variations thereof, etc., are within the scope of the invention and broadest version of any aspect.

Elements associated with a function can be described as "means for" performing a function in a composition/device/system or a "step for" performing a part of a method, and parts of this disclosure refer to "equivalents," which means equivalents known in the art for achieving a referenced function associated with disclosed mean(s)/step(s). However, no element of this disclosure or claim should be interpreted as limited to a "means-plus-function" construction unless such intent is clearly indicated using the terms "means for" or "step for." Terms such as "configured to" or "adapted to" do not indicate "means-plus-function" interpretation, but, rather, describe element(s)/step(s) configured to, designed to, selected to, or adapted to achieve a certain performance, characteristic, property, etc. using teachings provided here or in the art.

Uncontradicted, the term "part" refers to a portion of a device, component, system, or assembly that is characterized by a unique construction or composition, and which is separate from, is separable from, or was at least at one point in time (e.g., during manufacturing of the associated device) separable/separated from one or more other part(s) or component(s) (e.g., where the applicable part represents one of a plurality of parts of an assembly).

Uncontradicted, the term "component" describes a part or collection of associated parts which perform one or more defined functions. A function can, depending on context, be selectively performed, conditionally performed, or both, or can be performed at all times during operation or can be an inherent feature of a part or component.

Uncontradicted, the term "mechanism" describes feature(s), part(s), component(s), or combination(s) thereof, that cause(s) or promote(s) the interaction of two or more elements (parts, components, devices, or combinations thereof, etc.). Often, but not always, a mechanism may be composed of two parts, features, or a combination thereof, that perform the interaction (e.g., a hook part and a loop part in a hook-and-loop attachment mechanism). In certain aspects, a "mechanism" can be represented as a single part, feature, or component, as in, for example, a magnet.

Uncontradicted, the term "assembly" refers to a component formed by an assembly of previously separated parts.

Uncontradicted, the term "feature" is used to describe a portion of a part or component that is associated with a well-defined structure, composition/material(s), or function.

In certain contexts, herein, the term "element" may additionally be used to reference a part, component, or assembly simply for ease of presentation. For example, disclosure herein may use the phrase "the X component of an of a delivery device," "the X element of a delivery device," "the X component," or "the X element," wherein "X" is the same named part. In a specific example, the following language may be used: "The insert support component of a delivery device," wherein such an insert support component can comprise a "stabilizing component", wherein the stabilizing component can comprise a "compressible positioner," wherein the compressible positioner may be described as "a compressible component of a delivery device," "a compressible element of a delivery device," "the compressible component,", or, e.g., "the compressible element." Uncontradicted, the use of the term "element" can be interpreted as "part," "component," or "assembly," or even a device in a system, as applicable by context, though readers will also understand that "element" also can refer to any part of an aspect (e.g., a volatile compound composition can be an element of a device or system aspect). The term element when applied to an object or structure can be useful in representing an object or structure that can be embodied either as a feature of a part/component or a separate part/component, such as a moveable fidget element of a device, or as a separate device in a system. Uncontradicted, any disclosure of a structure/object as a part or component implicitly also discloses a corresponding aspect where the described part or component is substituted with the term "element" and vice versa. E.g., any aspect herein describing a VCOC provides support for a volatile compound outlet element, which may be, e.g., a part of a component that performs both volatile compound outlet and volatile compound storage component functions.

As a simple example, a rolling component of an automobile can comprise one or more axles and one or more wheels. Each wheel can, e.g., be a part of the rolling component, as can, e.g., each axel. Also, or alternatively, each wheel can be a component comprising its own parts, such as, e.g., a rubber tire and a wheel rim. A rolling mechanism can be, e.g., at least one axel and at least one wheel, wherein the mechanism facilitates the movement of the automobile. Further, an axel and, e.g., at least two wheels, may form an assembly. The particular design of the tread on the rubber tire of a wheel can be, e.g., a feature of the rubber tire. In describing the automobile, one may reference, for example, a/the "wheel element."

Terms related to orientation may be used here to describe the positioning of a part, component, or, e.g., an assembly in space (spatial positioning or spatial orientation) relative to one or more other part(s), component(s), or assembly(ies). For example, terms such as "longitudinal," "lateral," and "vertical" can be used herein to refer to a what would be understood by readers to correspond to an x-axis, y-axis, and z-axis, respectively, of a device or other element (the x-axis and y-axis being perpendicular in the relevant plane and the z-axis being oriented away from, above or below the plane). Such terminology can refer to the orientation of part(s), component(s), and, e.g., device(s), etc. The term "horizontal" can be used to mean either longitudinal or lateral, i.e., not vertical.

Readers will understand when other similar positional terms are also used. For example, the term "length" may be used in place of "longitude," the term "width" or "thickness" (or, where applicable, circumference) may be used in place of "lateral," and terms such as "height" or terms such as "up" and "down" (or upper and lower) may be used in place of "vertical."

Ordinarily, the vertical access in a description or a figure is oriented in the manner in which gravity acts and on a page ordinarily will correspond to the top and bottom of the page when viewed by a reader. Ordinarily, the longitudinal direction will refer to the direction of right-to-left in a figure or description, and the lateral direction refers to the direction perpendicular thereto (e.g., in the same plane) (but ordinarily representing objects towards the reader and away from the reader rather than to the right, left, or center of the reader). Often the lateral dimension can be considered to "come in and out of the page" (i.e., projecting towards or away from the reader).

Such terms can also describe how a device or element is oriented, consistent with the longest measurement/dimension of the element/device in ordinary use. For example, a device that is longitudinally oriented will have its longest dimension in the longitudinal coordinate (longest measurement along or parallel to the longitudinal axis). Ordinarily, a device or other element is displayed or described consistent with its orientation in ordinary or primary use (e.g., a device is typically described as positioned longitudinally if used longitudinally). For example, although an automobile might be shown as aligned vertically it is, consistent with these principles, ordinarily described and displayed as horizontally aligned because that is the way the automobile is ordinarily used and from rear bumper to front bumper because that is the largest horizontal dimension of the car).

Herein, uncontradicted, a delivery device of the invention is ordinarily described and displayed in a horizontal and longitudinal alignment as this reflects the typical alignment of use (i.e., when a user engages with the delivery device). Terms like "proximal" and "distal" or "near" and "far" can be used in relationship to objects, usually to two or more objects, to describe relative distances. Uncontradicted, such terms are not meant to imply any specific limitation on position, at least with respect to the broadest disclosed relevant aspect.

Despite the foregoing, uncontradicted, terms such as "longitudinal", "transversal", "orthogonal," "vertical," "on", "under", "in front of", "behind", "left", "right", "vertical", "horizontal", "top", "bottom", "inside", "outside", etc. that indicate the directions or positions based on the directions or positions shown in the drawings or in the description of the directions or positions in a device, component, or part commonly placed, are, at least in one aspect, only for the purpose of describing the present disclosure and simplifying the descriptions, but not intended to indicate or imply that a device or a component has a compulsory position or must be structured or operated in a specific position, hence not to be considered as limitations to the full scope of the present disclosure.

In view of the preceding paragraphs, terms such as "top" and "bottom" or "upper" and "lower" may be used to refer to the position of parts, components, etc., in this disclosure. Uncontradicted, readers should interpret such terms as merely terms of context (e.g., referring to a particular figure) or convenience. In certain embodiments where there is some functionality associated with the placement, terms such as "top" and "bottom" may have a more definite meaning in a particular context, at least in aspects (e.g., with respect to orientation to the horizon, another part/component, etc.). For example, if an, e.g., insert compartment mostly or entirely effects placement of an insert gravitationally (i.e., with little or no positional support), the insert compartment exposure will typically occur at the "top" of the device, because a bottom oriented insert compartment exposure (i.e., a downward facing, with respect to the horizon, exposure) would likely lead to the insert falling out of the insert compartment inadvertently (at least with increased frequency) if comprising little or no positional support.

Axes relating to the orientation of a device or element also can be used in the description of such a device or element. For example, an imaginary line drawn through the longest dimension of a device herein may be referred to as a "long axis" or "longitudinal axis" of the device. Other elements may be described as perpendicular, parallel, aligned with/overlapping, being the same (or substantially the same), or being non-overlapping, non-aligned, etc., with respect to such an axis.

In aspects, airflow through a device or component can be described as "upstream" or "downstream" of some reference element. Uncontradicted, "upstream" means airflow (or a location in an airflow element) located relatively more towards the airflow inlet of a device with respect to referenced element(s) and "downstream" means airflow (or a location in an airflow element) located relatively closer to the airflow outlet than the referenced element(s).

Uncontradicted, the term "impervious" means impervious to the volatile compound composition(s) (VCC(s)) that are intended to be used in a device. Uncontradicted, an "impervious" material does not permit the release of VCC(s) or volatile compound(s) ("VC(s)") contained therein. In aspects, an impervious material is unreactive with VCC(s)/VC(s). For example, a component composed of stainless steel will be impervious to most essential oil compositions and to the volatile compounds contained therein.

Herein, terms such as "interface," "engage," and, e.g., "cooperate" may be used to describe the interaction of two or more part(s), component(s), or assembly(ies) or combination(s) thereof. Uncontradicted, the term "interface" is used to describe physical contact, such as, e.g., part A interfacing with part B means that part A makes physical contact with part B. Uncontradicted, "engage" also means to affect activity detectably or significantly. Further, "engage" may be used to indicate an active interface, such as, e.g., a magnetic attraction between two parts, such that while activity of a part may not be visually perceivable, an attractive activity is present. For example, a part/component/feature called X engaging a part/component/feature called Y can mean that, e.g., activity of X detectably or significantly affects activity of part Y, or, also or alternatively, there is a non-visible activity occurring between X and Y, such as, e.g., the engagement between X and Y is a magnetic attraction. "Engage" may in aspects also mean to affect activity detectably or significantly but may not require a direct/touching (contacting) interface (e.g., may not involve direct attachment or other contact). Accordingly, a part/component/feature called X that "engages" a part/component/feature called Y can mean that, e.g., activity of X detectably or significantly affects the activity of (acts on, applies a detectable force on, etc.) part Y, or, also or alternatively, there is a non-visible activity occurring between X and Y, such as, e.g., the engagement between X and Y is a magnetic attraction, wherein X and Y do not make physical contact. In aspects a force between parts/components or features also can cause other parts, components, or features that make up part of a device or different devices to come into contact or remain in contact.

Terms such as "outlet" and "inlet," like other terms herein can represent multiple elements to provide the indicated structure/function. For example, an outlet can comprise many outlet channels/orifices or a single hole/opening, etc.

Herein the term "cooperate" can be used to describe two or more part(s), component(s), or assembly(ies) or combination(s) thereof which act together to perform a function, as in, for example, two or more airflow limiting parts which cooperate to establish and airflow control setting of a device.

Terms such as "selectively," "selectable," "releasably", "releasable" and, e.g., "controllable" may be used to describe the functionality of one or more part, component, or assembly (or combination(s) thereof), the state of interface(s) or engagement(s) of one or more part(s), component(s), or assembly(ies) (or combination(s) thereof), one or more operation status(s) or setting(s) of a delivery device, or the like.

Uncontradicted, terms such as "selectively" or "selectable" mean designed to be, able to be, or which otherwise are established/set by a device user (e.g., an airflow control setting could be "selectable" such that it can be "selectively" open or "selectively" closed (or, e.g., a feature could be, e.g., selectively on/off, active/inactive, functional/non-functional, etc.) or selectively more or selectively less).

Uncontradicted, the terms "releasably" and "releasable" mean that two or more referenced parts, components, assemblies, elements, features, or combinations thereof, which can be at least detectably or significantly engaged but which can be disengaged from one another. For example, part A and part B can be "selectively releasable," meaning that part A and part B are able to be engaged or disengaged from one another as established by a device user.

Uncontradicted a "secure" or "fixed" engagement or attachment means an engagement that is not intended to be releasable or that would not be releasable in ordinary intended operation or if released would reduce or eliminate or limit operability.

In aspects involving devices formed by releasable/engageable components, the ends of components can be described with reference to the "engagement ends" of the components. In aspects, the engagement ends are positioned toward the interior of a device. In such aspects, the other ends can be described as the inlet end (e.g., of a mating component) and the outlet end (e.g., of a mouthpiece/volatile compound outlet (VCO) component).

Uncontradicted, the term "controllable" (or "adjustable") means adjustable in degree, amount, timing, or other characteristic(s) of operation, according to user aim(s), desire(s), target use(s), or other user preference(s). For example, an airflow control setting could be "controllable" such that the user can select, adjust, or otherwise modulate airflow by selecting an airflow control setting from a plurality of airflow control setting options which each establish a different level of airflow restriction through a device. A controllable/adjustable component allows for ≥2 conditions or states (e.g., degree of airflow control) that can be selected by a user (e.g., ≥3, ≥5, ≥7, ≥10, ≥15, ≥20, ≥25, etc.). In other aspects, a device can also or alternatively comprise an airflow restrictor or modulator that is selectable, but not controllable. Such an element can change the airflow characteristics of the device when selected but may not afford the user the opportunity to change the degree of airflow modulation. In this respect, uncontradicted, a controllable element can be considered to be a particular type or example of a selectable element. A selectable element does not necessarily mean that entirely on or off, but, rather, can simply mean changed from one state/setting to another when a selection is made.

Readers will understand that any element, feature, step, or characteristic of any aspect of the invention recited herein as being present in an aspect also implicitly provides support for the element, feature, step, or characteristic as being excluded from a corresponding/similar aspect of the invention implicitly disclosed by the explicit positive disclosure. For example, if the disclosure states that in an aspect object A comprises element B, readers will understand that a corresponding aspect is implicitly disclosed which provides object A lacking element B.

Uncontradicted, the word "exemplary" means "serving as an example, instance, or illustration." Any specific embodiment or aspect described herein explicitly described as "exemplary" is not necessarily to be construed as preferred or advantageous over other embodiments or aspect of the inventive devices/compositions/methods described herein.

Uncontradicted, terms such as "improved" or "enhanced" herein means DOS increased or decreased according to the desired function, property, or effect. Thus, in aspects, "improved" means DOS increased and in other aspects "improved" means DOS reduced (e.g., when referring to a risk, harmful effect, minimal force/movement, etc.).

All references (e.g., publications, patent applications, and patents) cited herein are hereby incorporated by reference as if each reference were individually and specifically indicated to be incorporated by reference and set forth in its entirety herein. Uncontradicted, any suitable principles, methods, or elements of such references (collectively "teachings") can be combined with or adapted to aspects. However, citation/incorporation of patent documents is limited to the technical disclosure thereof and does not reflect any view regarding the validity, patentability, etc., thereof. In the event of any conflict between this disclosure and the teachings of such documents, the content of this disclosure controls regarding the interpretation of the aspects of the invention. Numerous references are cited here to concisely incorporate known information and aid skilled persons in putting aspects into practice. While efforts have been made to include the most relevant references for such purposes, readers will understand that not every aspect of every cited reference will apply to every aspect of the invention. The invention is, in some respects, intended to provide device(s), system(s), method(s), or composition(s) that are distinguishable from (inventive with respect to) the prior art. Accordingly, while all references herein are incorporated by reference readers will likewise understand that this disclosure provides for the explicit exclusion of any element disclosed in such prior art references that differs from the applicable elements of any aspect of the invention described herein.

Terms, Concepts, and Acronyms Specific to Certain Aspects.

Uncontradicted, any element described herein as "releasable" or "detachable" will mean that the element is re-releasable and re-detachable, being capable of being attached and detached or engaged and disengaged several times over a period or collection of times, which, in aspects, may define a shelf life of a part, component, or device, or which may define a period of use (as in, e.g., a period over which a user engages with a delivery device multiple times). Uncontradicted, this concept of repeated functionality can be applied to any similar functional description provided herein (e.g., selectiveness means, uncontradicted, repeatedly selectable and controllable means repeatedly controllable) and, thus, provides implicit support for an aspect where the releasable/detachable element is repeatedly releasable/detachable even if not explicitly stated.

In aspects, components or elements can be described as "rapidly" re-engageable or "rapidly," "readily," or "quickly" re-attachable, etc. Uncontradicted, the rapidity (the readiness or the quickness) relates to the amount of force that a user will need to apply to disengage or reengage the elements. Typically, a "rapid release" mechanism or function is associated with the application of a force of less than about 1 kg in order to cause the relevant release/disengagement, and often the force will be less than about 0.75 kg, less than about 0.5 kg, less than about 0.25 kg, less than about 0.15 kg, less than about 0.1 kg, or less than about 0.05 kg or even less than 0.025, 0.01, or 0.005 kg, such as about 0.005-2.5 kg, ~0.01-3 kg, about 0.01-1.5 kg, about 0.025-1.25 kg, about 0.05-1 kg, about 0.075-1 kg, about 0.1-1.25 kg, about 0.1-1 kg, about 0.1-0.5 kg, or ~ 0.1-0.25 kg. In aspects, the amount of force associated with a function characterized as rapid release will be about 0.05-0.6 kg, e.g., about 0.075-0.6 kg, about 0.075-0.3 kg, about 0.1-0.3 kg, about 0.15-0.45 kg, 0.15-0.75 kg, about 0.15-0.5 kg, about 0.08-0.4 kg, about 0.07-0.35 kg, about 0.02-0.8 kg, or about 0.025-0.75 kg of force. In aspects, the amount of force associated with a rapid release function is about 0.003-6 Newtons (N), such as about 0.004-4 N, about 0.004-2 N, about 0.003-3 N, about 0.0035-3.5 N, about 0.005 N-0.2 N, about 0.01 N-5 N, about 0.0075-3.5 N, about 0.002-0.5 N, about 0.001-3 N, or about 0.001-1 N. In other aspects, a rapid release force is about 0.05-5 N or about 0.5-7.5 N, or 0.5-5 N, or about 0.05-2.5 N, about 0.1 N to about 2.5 N, about 0.2-2 N, or about 0.5-3.5 N. Uncontradicted, any element (part, component, feature, or combination thereof) described as engageable, releasable, and the like, even if not described as rapidly releasable, etc., provides implicit support for a corresponding aspect in which the element is rapidly re-engageable/engageable, releasable, etc. Any engagement, release, etc., described herein can be associated with any such force described in this section.

A "fidget" or "fidgeting" function, mechanism, or activity of a feature or a component, or a device in a system that a significant number of users of the applicable device repeatedly perform within a short period of time for the primary purpose of the user modifying or maintaining a psychological state or sensory state, such as to experience pleasure, to increase or promote focus or concentration, to reduce or manage stress or anxiety (or promote calmness or relaxation), to distract attention from other matters, to provide sensory input(s), or to provide an extraneous object outlet for a tendency to fidget in the user. In aspects, such benefits are self-reported by a significant number of individuals that are typical users in a study or survey. In aspects, one or more of such benefits are demonstrated to take place by other objective measurements such as physiological changes in a significant number of individuals that engage in the fidgeting behavior. Often, the repeated motion of a fidget function, mechanism, or activity has no beneficial impact in terms of the performance or operability of a device. Examples of device fidgeting of such a nature with well-known objects includes repeatedly flipping a light switch on-and-off, repeatedly opening and closing a Zippo lighter, popping a pen cap off and pushing it back on the pen, repeatedly opening and closing a click ball point pen, simply twirling a pen or pencil, repeatedly spinning a fidget spinner toy, spinning or flipping coins, jangling or clicking keys, spinning rings, repeatedly squeezing and releasing a stress ball, repeatedly opening and closing a Velcro (hook-and-loop) attachment, repeatedly separating and binding magnets, repeatedly opening and releasing a binder clip, repeatedly stretching and releasing a rubber band, etc.

A fidget mechanism, component, element, activity, or feature (e.g., of a system) accordingly typically is adapted to allow for such repeated movements and is associated with a low level of force that is required initiate the motion of the feature/element/function (i.e., it has a low "minimum movement force" or "minimum initiation force"). The minimum movement force typically is a force that can be applied by one hand of an average user without any significant effort or exertion and often can be initiated by small movements of one or more fingers, light shaking, light tipping, and the like. In one aspect, a fidget activity/function or fidget element is initiated/triggered by the user applying a force that is described herein as also being suitable for the release of a rapidly releasable element/component (e.g., application of 0.003-3 Newtons (N), such as about 0.005-2 N, about 0.01-2, 1.5, or 1 N, about 0.025-1.5, 1.25, or 1 N, about 0.5-1.75, 1.5, or 1.25 N (e.g., ~0.25-2, 0.1-1, 0.1-2, 0.1-1.5, 0.25-1.5, 0.25-2.5 N, 0.5-3, 0.5-2.5, or ~0.5-~1.5 N). In aspects, a fidget function, mechanism, feature or other element is associated with a required force to repeat or sustain the movement (sustained or repeat movement force) that is about the same as (e.g., is within about 0.5-1.5× or about 0.75-1.25× of), is not significantly more than the minimum initiation force. In aspects, the sustained or repeat movement force of a fidget element is, if applied while the fidget element is already in motion, significantly less (e.g., at least 25%, 33%, 50% lesser) than the minimum initiation force.

In aspects, and commonly, once an initiation force is applied to a fidget element the fidget element the fidget element will move to a detectibly different position than the initial resting position, to a detectably different state than it was in the resting state at least temporarily, or both, within a period of less than 10 seconds (e.g., less than ~7, less than 5, less than 4, less than 3, less than about 2.5 seconds) (on average or in all cases—as is applicable to similar time measurements provided herein). The "detectibly different" position in this respect is a position that the user can detect differs from the initial resting position, even though the change in position can be very small, such as about 15 cm or less, about 10 cm or less, about 7.5 cm or less, or ≤~5, 4.5, 4, 3.5, 3, 2.5, 2.25, 2, 1.75, 1.5, or 1.25 cm prior a significant number, most, generally all, or substantially all users detecting the change in position. In aspects, the movement can be or can on average be detected by most, generally all, or substantially all users at about 0.001 cm, 0.002 cm, 0.005 cm, 0.01 cm, 0.05 cm, or about 0.1 cm of movement (e.g., about 0.05-0.2 cm, 0.025-0.1 cm, or 0.033-0.75 cm). In aspects, the movement changes the state of the fidget element, at least temporarily, such as by releasing it from another element to which it is normally attached/engaged (in the resting position), increasing or depressing the size of the element, or putting the element into a temporarily sustained motion.

In aspects, a fidget function, fidget activity, or fidget mechanism is composed of or comprises two or more elements that directly or indirectly engage or re-engage upon the application of a low minimum initiation force or greater force as described above for releasable elements in general. In aspects, a fidget element is a single part, component, or feature that operates without interaction with another element.

In aspects, a fidget element (feature, part, component, or device) remains in contact with another element throughout the fidget movement. E.g., where the VC delivery device is itself the fidget element in a system with a suitable support device, the support device and delivery device typically stay in contact while a user spins the delivery device on a surface of the support device. The fidgeting movement of binder clip teeth or a flip lighter lid also exemplify such fidgeting elements where the movable fidget element remains in contact with the rest of the associated device.

In aspects, a user must initiate the fidget movement of a fidget mechanism/element, return the fidget element(s) to a suitable starting position, and repeat the initiation of the fidget movement. A flip (e.g., Zippo-style) lighter is a good example of such a type of fidgeting element. In this disclosure, a releasable magnetic engagement is an example of such a fidgeting element. I.e., the magnet once released must be brought back into contact with a material that it engages with and then the user must once again pull the elements apart to overcome the magnetic attraction of the elements.

In aspects, the force required to repeat a fidget, or to sustain a fidget while still at least detectably in motion, is detectably or significantly less than the force required to initially initiate the fidget. Repeating a fidget while still detectably in motion may also be associated with less required force. In aspects, a fidget mechanism can be reinforced while still in motion by the user. Fidget elements are normally associated with weak force engagements (e.g., low/normal level magnetic engagements), low friction moving parts (e.g., ball bearings), weak force tension elements that cause a rapid return to a ready to use state, and the like.

In aspects, a fidget element/activity is configured/adapted to continue in motion once motion is initiated until the element comes to a resting position (e.g., as in the case of the flip lighter opening or the mating component/barrel turning in a device of the invention). In aspects, a fidget element/activity is configured adapted to continue in motion until it reaches a resting state that is the same as or is substantially or generally similar to, in at least some respect (e.g., in at least one dimension), the initial starting position (e.g., is in the same position in one or more dimensions as when it started the motion). For example, the "jaw" parts of a binder clip when released will return to a starting position. In the case of the devices and systems herein a fidget promoting system that permits a device to spin or otherwise move about a support device typically similarly entails the device remaining at least at the same distance from the user in one dimension due to the association with the base. In aspects, a fidget function motion ends automatically (as a feature of the mechanism's or element's design/construction and not due to user action) within a short period of time after movement initiation, such as within (on average, in generally all cases, etc.) about 10 seconds or less, about 5 seconds or less, about 2.5 seconds or less, etc., e.g., about 1-3 seconds, about 0.5-2.5 seconds, about 0.75-3 seconds, or about 1.25-2.75 seconds. In aspects, the movement of the fidget element will last from 10 milliseconds (msec.) to about 5 seconds (secs.), e.g., about 50 msec., about 75 msec., or about 100 msec. to about 3 secs, about 2 secs, or about 1 sec. In some respects, the motion of a fidget is completed on average, generally, substantially always, or always within about 100 msec., ~200 msec., or ~300 msec. (i.e., 0.3 secs.) to about 1.5, 1.2, 1, 0.75, 2.75, 3.5, or about 5 secs. Other exemplary time periods for completion of a fidget can include ~0.1-3 secs., ~0.2-2.2 secs., ~0.25-2 secs., ~0.2-1.8 secs., ~0.25-1.5 secs., ~0.25-2 secs., ~0.25-1 secs., ~0.3-1.2 secs., ~0.3-0.9 secs., ~0.5-2~, ~0.5-2.5 secs., ~0.5-5 secs., ~0.5-1.5 secs., or ~0.5-1 secs. In aspects, a fidget motion will last about 0.7 to about 7.5 secs., ~0.8 to ~6.4 secs., ~0.9 secs. to ~4.5 or 6.4 seconds, ~1-5 secs., ~1-10 secs., ~1.25-7.5 secs., or ~1.5-~9 secs. In aspects, a fidget motion can be associated with a longer time span, such as about 1 sec. to about 1 minute (min.), ~2 sec. to ~2 min., ~5 secs, to ~5 mins., ~10 secs to ~5 mins., ~5 secs. to ~2.5 mins., ~10 secs. to ~2.5 mins., ~10 secs. to ~3.5 mins. ~20 secs. to ~4 mins., ~20 secs. to ~2 mins., ~10 secs. to ~1 min., or ~5 secs. to ~1 min.

Any of the fidgeting functions, activities, motions, etc., described herein can, uncontradicted, be associated with such forces required to initiate such time(s) of motion before coming again to a resting position. Typically, a user can prolong a fidget motion, modulate a fidget motion (e.g., speed up a fidget motion), or terminate/lessen the duration or speed of a fidget motion by manual intervention.

In aspects, the fidget function movement is only attributable to movement of the user. For example, in the case of a magnetic association of a mating component and a VCOC, which can be considered both a rapid engagement association and a fidget element, the separation and rejoining of the components is solely due to motion of the user and the components will not return to the initial state or anything like the initial state (or any state in which the fidget movement is ready to be repeated) unless the user causes the relevant elements to reassociate/re-engage.

In aspects, a fidget element/function/activity is associated with one or more tactile, visual, or auditory feedback element(s) or feature(s) (stimulations). For example, a flip lighter or jangling key set provides an auditory stimulation to a user along with the sense of moving the fidget element. Devices of the present disclosure exemplify such a fidget mechanism in, e.g., devices that comprise a rotatable mating component that is associated with a "clicking" sound when moved (e.g., a clicking sound of about 10-150, 10-120, or 15-115 decibels (dB) per instance, such as ~20-100, ~20-90, ~20-80, or ~20-70 dB (e.g., 17.5-75, 16.5-90, 18-88, 20-85, or 20-75 dB)).

In aspects, a fidget function or fidget mechanism comprises a mechanism composed of two or more elements that re-engage with an application of a similar level of force as described above for releasable elements in general. In aspects, a fidget function/mechanism re-engages with the application of less force than required to initiate the fidget function.

In aspects, the duration of a sustaining fidget motion (a motion that continues automatically after initiation for a period due to element design rather than solely user application of force) is mostly, generally, substantially, or entirely within the control of the user (e.g., where a device includes a magnetic engagement mechanism/function, the user controls the timing of re-engagement by where they position the engageable part(s), component(s), feature(s), or device(s) that provide the fidget function) (e.g., the timing of re-engagement depending on the strength of magnetic attraction that causes the engageable elements to return to engagement). In aspects, the time of motion of a fidget, the force required to initiate a fidget, or both, will on average or generally vary significantly or detectably. In aspects, the time of motion of a fidget, force required to initiate a fidget, or both, will generally, substantially, essentially, or only be insignificantly different or undetectably different to a user.

In aspects, a device or system will be associated with both user-controlled timing fidget feature(s) (e.g., the above-described magnetic association of a mating component and a VCOC) and also features that automatically sustain movement for a period (e.g., where a device comprises a magnetic engagement fidget feature and is associated with a stand that allows the device to act as a fidget element).

In aspects, a fidget element or feature is associated with one or more characteristics or property that detectably or significantly promote returning of the element to a ready to use (ready for fidgeting) state (exert a force that promotes such reengagement, return movement, etc.). For example, a magnetic attracting of a fidget element promotes two parts of a magnetic engagement coming back together and can, in such a respect, attract a user to repeat the fidget activity.

Uncontradicted, the term "fully assembled" or "ready-to-use" (or "ready-for-use") may be used to describe the state of a delivery device or other element. The term "fully assembled" can mean, e.g., any or all separable part(s), component(s), or assembly(ies) of a delivery device are in a state in which they are no longer separated from one another; but are, rather, fully present in stable position(s) (e.g., in forming a delivery device). The term "fully assembled" in relation to a delivery device can apply whether, e.g., an insert, is present within the delivery device, or not. The term "ready to use" should be interpreted similarly. "Ready to use" can mean the device is in a state suitable for the delivery of volatile compound(s) maintained therein, is in a state to provide a sensory experience such as a fidget experience, or any combination thereof. Such a ready-to-use/ready-for-use state can, in aspects, mean an insert is present or also or alternatively can mean an insert is not present. An insert can contain, e.g., absorb, VCCs, typically amount of VCC(s)/VC(s) that can be considered an "effective amount," which typically means an amount that is able, on average, to deliver a desired amount/concentration of VCs to a user over a desired period of time (e.g., 1, 2, or 3 days). In aspects, an insert or insert compartment is described has having diameter(s), but readers will understand that the term diameter can be replaced with cross-section (sometimes referred to as thickness/width, height, or both), as such components are not necessarily circular/tubular.

The term "device" herein is used in many respects. Readers will understand that typically, uncontradicted, the term device means a "device of the invention" comprising elements for holding/storing volatile compounds and an outlet for delivering the same to a user, along with possibly one or more (e.g., possibly several) other inventive component(s), part(s), or feature(s) as will be described below. Method of use aspects of this disclosure (aka, uses) relate to several possible applications and benefits. For example, devices can be used for the pleasure of delivering flavor to a person. Users may find additional benefit(s) from use of certain combinations of volatile compounds, devices, and conditions. For example, users may find that devices can help with promoting a sense of calmness, focus, or even formation of habits or as a substitute for other habits. Uncontradicted, devices described herein are not intended to treat or prevent any disease or medical condition. Accordingly, in aspects devices are non-medical or non-regulated devices (as opposed to tobacco-related products or devices/drugs used to treat addiction or other medical conditions). Thus, while in certain aspects devices of the invention may be perceived as beneficial to users in breaking habits, such as reducing the desire to smoke cigarettes or tobacco products, this is only a limited possible aspect of the invention, and devices of the invention are typically intended for and useful in non-medical, pleasure-associated activities, rather than as therapeutic or prophylactic instruments or medical devices. In aspects, the devices are unheated (lack any heating element(s) or means or component(s)). In aspects, devices are unpowered. In aspects, devices are characterizable as "cold diffusion devices," relying on unheated evaporation/diffusion of volatile compounds to the user (e.g., to the mouth).

The term "device" herein can, as indicated by context, be used in reference to a solid material capable of maintaining, releasing, or maintaining and releasing volatile compound(s) (commonly referred to herein as an insert, e.g., a removable insert). Such a device can be designed to be used in delivery device(s) described in the preceding paragraph.

In aspects, methods are described herein with reference to a user "inhaling" or using an "inhalation" force (or sucking) to promote the delivery of volatile compounds from the device to the user. In aspects, a user applies an inhalation force to deliver volatiles to the mouth, but the user does not inhale some, most, generally all, substantially all, or essentially all the volatile compounds beyond the mouth, such as into the lungs. Such aspects distinguish such methods from, e.g., smoking and vaping, in which full lung inhalation of vaporized/volatile products is the norm. In aspects, method(s) comprise the user taking such a step or providing the user with the instruction to not take such a lung inhalation (e.g., by product insert, website instruction, social media instruction, associated mobile device application instruction, etc.).

The invention also provides system(s) comprising device(s) and other device(s)/component(s). In general, a "system" is a collection of devices. In some cases, the terms device and component may be used interchangeably. For example, a device might comprise an insert comprising volatile compounds. However, the invention can also be characterized as providing a system comprising a device for delivery of compounds and one or more inserts. Similarly, aspects can describe the relationship between a device and an accessory, such as, e.g., a support component, such as a stand, or such aspects can be described as a system comprising a volatile compound delivery device and a support device. In aspects, the invention also provides "kits," which are a collection of objects provided to a user with the intent of user assembly prior to an application thereof. Kits can be synonymous with systems (i.e., comprising components that make up a system) or can comprise components/parts for the assembly of device(s) (e.g., a device that can be configured two or more ways, such as when the kit comprises two or more mating components and a VCOC/body component).

As noted above, uncontradicted, the description of concepts, related terms, or concepts having a preexisting ordinary meaning in the art should not be, at least with respect to the broadest possible aspect provided by any disclosure herein, construed to exclude any aspect that also would be provided by the broadest ordinary construction of the concept or term, but, rather, as providing example(s) and also specific embodiment(s) within the scope of the broadest reasonable aspects that readers will derive from this disclosure. For example, if an object is described herein as being made of a material but is known in the art to also be made from other materials, the disclosure should be interpreted as providing an aspect where the object is made of any suitable material and a more specific aspect in which the object is specifically made of the explicitly recited material.

In several respects in this disclosure, a broad identification term is accompanied by language identifying a name or names for such a part/component/assembly (as applicable) provided in specific embodiment(s) or example(s). For example, the aspect element "engagement mechanism" (or, e.g., "selectively releasable attachment mechanism") may be associated herein with narrower term(s) such as, e.g., "a rapidly releasable [or rapid release] force mechanism" or, e.g., a "magnet." Where all such terms are not provided in a description of a particular component or mechanism, any singular reference should be interpreted as incorporating reference to the narrower or broader associated terms/elements as applicable. That is, for example, use of only the term, "engagement mechanism" should be interpreted as simultaneously providing support for disclosure of a "selectively releasable engagement mechanism," "rapidly releasable force [or rapid release force] mechanism," and "magnet." Further, for example, uncontradicted, reference to only "rapidly releasable [or rapid release] force mechanism," still should be interpreted as providing implicit/inherent support for a corresponding aspect in which the term is replaced "engagement mechanism," "selectively releasable engagement mechanism," or "magnet." Further, uncontradicted, any use of only the term "magnet" should be interpreted as providing implicit support for aspects that would be characterized by comprising, alternatively, a "selectively releasable engagement mechanism," "rapidly releasable [or rapid release] force mechanism," or "engagement mechanism."

As is understood in the art a "volatile compound" or "VC" is a compound that evaporates easily at room temperature. Typically, a volatile compound will also dissolve readily in and is provided in composition(s) ("volatile compound compositions" or "VCC"). A VCC typically is mostly or entirely in the form of a fluid, and typically is generally, essentially, or entirely liquid at room temperature. In aspects a VCC is a water/aqueous composition or an oil/hydrophobic liquid(s) composition, such as a hydrophobic essential oil. An example of a useful VCC is a composition comprising/of flavored essential oil(s) (e.g., a hydrophobic liquid containing volatile chemical compounds that are obtained from plants (e.g., by distillation) and provide a detectable flavor when tasted by a user).

Typically, volatile compound(s) in the context of the invention is/are volatile organic compound(s) (VOC(s)) that are, and a VCC is a composition comprising VOC(s) that is, safe (non-toxic) for delivery to its intended delivery target in the body of a user (e.g., in the mouth of a user). In aspects, most, generally all, or all the volatile compounds/VCC(s) of a device, method, kit, or system of the invention are flavored (have a flavor that can be detected by most, generally all, or all the typical population of users). In aspects the gas carrier for the VCs is mostly, generally, substantially, essentially, or entirely composed of air. As such, in aspects devices can be characterized as devices for delivering "flavored air" to a user. In aspects, most, generally all, or all volatile compound(s) have boiling points in the range of ~50 to ~260° C. (122 to 482° F.), e.g., about 100-250° C. In aspects, most, generally all, or all volatile compound(s) have a vapor pressure of about 0.01 kPa or greater at about 20° C./~ 70° F. Uncontradicted volatile compound compositions used in devices have a rate of evaporation at room temperature that permits a typical amount of the composition when contained in the device in a typical manner (e.g., in a suitable insert material) to continuously release a detectable flavored composition when a user engages the device over a period of time (e.g., ≥4, 6, 12, 18, 24, 30, 36, 48, 54, 60, 66, or 72 hours, such as 5-30 hrs., 6-24 hours, 12-24 hrs., 18-36 hours, 18-30 hours, or about 24 hours, of regular (e.g., every 10, 15, 30, 40, 60, 75, 90, or 120 minutes) or more regular, or near continuous waking use).

SUMMARY OF THE INVENTION

The invention(s) described here has/have many attributes and aspects, examples of which are provided in this section. Thus, readers will understand that this section ("Summary") is not intended to be all-inclusive, and the scope of the invention is not limited to or by the disclosure in this Summary, as such disclosure included for illustrative purposes only and not restriction. Any of the aspects described under this section can be combined with any other aspect described in this section or with any other aspect of this disclosure.

In one aspect, the invention provides a delivery device for the delivery of volatile compound(s), which is typically adapted for use by a mammal, and ordinarily a human. In aspects, volatile compound(s) comprise or are flavored volatile compound(s). In aspects, volatile compound(s) are provided as or comprise non-combustible oil(s). In aspects, volatile compound(s) are provided as or comprise essential oil(s). In aspects, the delivery device is a device suitable for or adapted to the delivery of volatile compound(s) to a mouth of a user, e.g., a human device user. In aspects, the invention provides volatile compound delivery devices, characterizable as, e.g., an unpowered or non-electronic delivery device, a non-heating delivery device, or both a non-electronic and non-heating delivery device. In aspects, deliver device(s) can be characterized as passive diffusion device(s).

Device(s) of the invention, often referred to as delivery device(s), can at least temporarily hold/store volatile compound substances and to release or deliver such substances to an intended user. In aspects, delivery device(s) comprise a first component comprising an outlet for the delivery of volatile compounds to a user (release from the device). As described below, such a component can be descried as a volatile compound outlet component or "VCOC." Because in aspects a VCOC can comprise a part or feature that is adapted for engaging the mouth of a user, a particular exemplary VCOC can be referred to as a mouthpiece component; however, in aspects, a VCOC may be adapted for engaging other parts of the body and may lack a dedicated mouthpiece. In aspects, a device can comprise ≥2 VCOCs. In aspects, a device comprises a single VCOC. Typically, device(s) comprise airflow channel(s) within the device that permit the flow of the stored volatile compound(s) to the outlet of the VCOC.

In aspects, device(s) comprise a VCOC and a/an (at least one) additional releasable component, a movable component, or both at least one releasable component (aka, a "mating component" or "second component') and at least one separate movable (moveable) component. In aspects, the VCOC makes up most of a device. In such aspects, a VCOC may be described as a "body component." As described above, readers will understand that uncontradicted, use of any of these terms implicitly provides support for corresponding aspect(s) in which the used term is replaced with such other related term(s).

In aspects, device(s) comprise a mating component. In aspects, a VCOC (aka a "first component") and the mating component ("MC" or "second component") are releasably engaged in at least some operational state/configuration of the device by a selectively releasable engagement/attachment mechanism. In aspects, first and second components can be completely disengaged from one another in one state/condition and securely or stably bound when re-engaged. In aspects, a delivery device comprises at least one VCOC and at least one MC which are at least in one state releasably bound together by a magnetic force. In aspects, the binding of a VCOC and MC is required for a device to be fully operational. In aspects, a device comprises one or more indicators that guide the user with respect to the assembly of the full device from engageable components (e.g., by indicating a correct alignment). In aspects, indicator(s) include auditory indicator(s), visual indicator(s), tactile indicator(s), or a combination thereof.

In aspects, device(s) of the invention comprise a VCOC and at least one second movable (moveable) component, which may or may not be releasable from the VCOC. In aspects, the second movable component is adapted for a user to engage in fidgeting activity(ies) as further described herein. Such activities might include spinning a component or the device, pulling apart and reattaching components or a device (in a system) from other elements in a rapid release manner, flicking element(s), pushing element(s), shaking element(s), etc.

In aspects, device(s) of the invention comprise a VCOC and an airflow modulation component. The airflow modulation component allows a user to selectively modify the airflow through the VCOC or at least in one respect (into the VCOC, out of the VCOC, or in at least one part of the VCOC). In aspects, the airflow modulation component is an airflow control component, which permits the user to selectively control the modulation of airflow in one or more ways with respect to the device (into, out of, or within at least part of).

In aspects, device(s) of the invention comprise a VCOC and a volatile compound composition storage compartment ("VCCSC"), such as a housing, compartment, or other component that is specifically adapted to maintain a store or reservoir of volatile compound(s), e.g., by retaining a media that contains volatile compound(s) that can be released into an airflow under conditions, such as when exposed to an airflow created by a user applying a breath or sucking on the VCOC or other part of the device. Volatile compound-containing media designed for temporary use before reloading/recharging or discarding can be referred to herein as an "insert." Sometimes the term "core," which is a trademark of Applicant's for such materials, also is used, to describe such inserts. In aspects, the VCCSC is a part of or is attached to the VCOC. In aspects, the VCCSC is a part of the device that is separate from the VCOC. In aspects, the VCCSC comprises (e.g., generally, substantially, or entirely consists of) a material that is impermeable to volatile compounds. In aspects, the VCCSC is adapted to allow for easy and rapid loading and unloading of the VCCSC with volatile compound material, such as an insert. In aspects, the VCCSC isolates/separates some, most, or generally all of the volatile compound(s) in the device from other parts of the device at any given time (although some amount of the volatile compound(s) may be released to airflow traveling to the user and may at such time be in contact or come in contact with other part(s) or component(s) of a device besides the VCCSC. In aspects, the VCCSC is contained in a component that is an attachment/extension of a part of the VCOC (e.g., an extension of a mouthpiece component). In aspects, the VCCSC is adapted to receive compound-containing media (an insert) and is called an insert compartment. As with other terms, uncontradicted, terms like insert compartment and VCCSC implicitly provide support for one another herein in any given described aspect. Terms such as volatile compound compartment, volatiles housing, or insert housing can be used to describe similar elements. In aspects, a volatile compound compartment may be a feature of a volatile compound outlet component extension and may be referred to as an insert compartment. A VCC can mostly, generally, substantially, or essentially or entirely comprise/consist of (be composed of) VCs, or a VCCSC can comprise, mostly comprise VCs but also contain other non-volatile substances in association therewith. A VCCSC typically maintains a VCC until the VCC is removed from the device. A VCC can be removed from a device by, e.g., release of all the VCs, evaporation, or other means, such as removal of some, most, or all of the VCC by a user.

In aspects, the invention provides device(s) that comprise a mating component that at least partially surrounds, protects, completes, or otherwise at least partially encompasses (and in certain embodiments wherein a device has a particular shape, encircles) one or more other device component(s), such as, e.g., a VCCSC/insert compartment (e.g., by enclosing an insert within the device).

In aspects, the mating component can be readily replaced with a different mating component of a different style, such that, e.g., the invention provides a system comprising a device comprising a VCOC and a VCCSC and two or more interchangeable mating components that differ in one or more respects (e.g., in color, in material, in shape, or a combination thereof).

Devices provided herein will comprise an "airflow pathway" or "airflow channel(s)" that permit air to flow into the device, through the device, including in contact with the VCCSC (e.g., an insert), and out of the device through an exit/outlet to the nose, mouth, or both, of a user (or in proximity thereto). The airflow channel is enclosed in most, generally all, or all parts. In certain aspects the airflow channel is airtight or substantially/generally airtight or at least enclosed, such that less than about 20%, less than about 15%, less than about 10%, less than about 7.5%, less than about 5%, less than about 2%, less than about 1%, less than about 0.5%, or less than about 0.1% of the airflow in the device is released from any part of the device except the inlet or outlet (or any part except the outlet when a user acts upon the device such as by application of a suction force such as oral suction), when the device is fully operational. Such aspects can also or alternatively be characterized in that no more than any such amount (e.g., 0.1-15%, 0.2-20%, 0.3-12%, 0.5-10%, etc.) of the volatile compounds in the VCC in the device are released anywhere from the device when the user applies a suction force (e.g., oral suction) to the device, other than from the outlet. As noted, devices herein may be characterized as unpowered. In aspects, any suction or inhalation force applied to the device is through "oral suction," suction applied by the user sucking on (applying a negative pressure to) the device, causing airflow to enter and flow through the device, capture (and in aspects release and capture) and deliver the VCs to the mouth, nose, or proximity of the user.

In aspects, the invention includes a system comprising a device having one or more of the features described above and one or more accessories, such as a support device/component, such as a stand. In aspects, the stand/support is adapted to provide the user with an opportunity to apply fidget forces (fidgeting forces) (or practice fidgeting) with the device when it engages the support. For example, a support and device can engage through a magnetic engagement that is adapted to permit the device to spin around the support, rapidly release and reattach to the support, or both.

In aspects, a mating component is, at least in part, mostly, generally, or only composed of a mating component material that is mostly, generally, substantially, or entirely different from the material that mostly, generally, substantially, or entirely makes up some, most, generally all, substantially all, or all the VCOC. In aspects, the VCOC is mostly composed of a material that is impervious to at least some volatile compound(s) (e.g., to essential oils) and the mating component comprises at least a section or portion that is mostly, generally, or entirely composed of a material that is susceptible of absorbing at least some of the applicable volatile compound(s). In aspects, the susceptible material is an organic material, such as a wooden material. In aspects, a mating component material that is more present in the mating component than the VCOC or is not present in the VCOC has a density that is less than half, less than $1/3^{rd}$, less than $1/4^{th}$, less than $1/5^{th}$, less than $1/8^{th}$, or about $1/10^{th}$ the density of the material(s) that make up most, generally all, or all of the VCOC. In aspects, a mating component material that is more present in the mating component than the VCOC or is not present in the VCOC also or alternatively capable of DOS calming prefrontal cortex activity, inducing parasympathetic nervous activity, or both, when held, as compared to a corresponding material, e.g., a steel structure (e.g., as discussed in Ikei H et al. Int J Environ Res Public Health. 2017 Jul. 18; 14(7):801. doi: 10.3390/ijerph14070801). In aspects, the VCOC is mostly, generally, or entirely made of a material that is dishwasher safe (adapted for repeated dishwasher cleaning without significant damage or visible wear and tear on the VCOC). In aspects, the VCOC primary material (the material that makes up most, generally all, or all the VCOC) is a metal or a plastic. In aspects, the VCOC primary material is stainless steel. In aspect, the VCOC is a polished, buffed, blasted, pickled, or brushed stainless steel.

The various components/features and materials described above can be combined in any suitable manner. For example, in aspects, delivery devices provided herein comprise a volatile compound outlet component, a volatile compound compartment, a mating component, and an airflow modulator component. In aspects, the airflow modulator component (airflow modulator) is an airflow restrictor (an airflow modulator that restricts airflow into, out of, or within some, most, or all the device). In aspects, the airflow modulator is selectable. In aspects, the airflow modulator is an airflow control component. In aspects, an airflow modulator, such as an airflow restrictor provides a selectively adjustable mechanism for use in the establishment of the amount of airflow passing through a delivery device during its use.

In one aspect, the invention provides a delivery device, e.g., a non-electronic delivery device, a non-heating delivery device, or both a non-electronic and non-heating delivery device, for the delivery of one or more volatile compound(s) (e.g., flavored compound(s), wherein the delivery device comprises at least one indicator, e.g., in aspects, at least one visual indicator, present on the exterior of the device. In aspects, the spatial orientation of at least one indicator indicates the spatial orientation of at least one component of the device which is not externally visible, such as, in aspects, an internally positioned volatile compound compartment. In one aspect, a delivery device comprises at least two visual indicators present on the exterior of the device. In aspects, the spatial orientation of at least one indicator, e.g., visual indicator, relative to at least one other indicator, e.g., at least a second indicator such as a second visual indicator, provides an indication of at least one operational status of the device. In one aspect, the delivery device comprises at least two indicators, e.g., visual indicators, present on the exterior of the device, and wherein (a) the spatial orientation of at least one indicator indicates the spatial orientation of at least one component of the device which is not externally visible (such as, in embodiments, a volatile compound compartment for, e.g., housing an insert) and (b) the spatial orientation of at least one indicator relative to at least one other indicator provides an indication of at least one operational status of the delivery device. In aspects, the at least one operational status can be, e.g., the airflow control setting established by an airflow control mechanism (airflow restrictor).

According to certain aspects, the invention provides a delivery device, e.g., a non-electronic device, a non-heating device, or both a non-electronic and non-heating delivery device, for the delivery of one or more volatile compounds, wherein the delivery device comprising an airflow control mechanism, often referred to as an airflow restrictor. Herein an airflow restrictor can be, e.g., selectable, controllable, or both. In aspects, selectability, controllability, or both is established by the presence of one or more airflow limiter(s) (limiter/restrictor components), each of which can be referred to as component(s) of an airflow control mechanism or airflow restrictor. In aspects, the delivery device comprises a selective, e.g., adjustable, airflow control mechanism controlled by the movement, e.g., rotation, of a first device component and a second device component relative to one another. In certain aspects, the rotation of a first airflow control component (i.e., a first airflow limiter) relative to a second airflow control component (i.e., a second airflow limiter) can comprise a rotation of 360 degrees or more (e.g., rotation can surpass one full rotation). In aspects, an airflow control mechanism present in device(s) provided herein is controllable, i.e., adjustable, in pre-defined increments. In aspects, delivery device(s) comprise(s) a total airflow path through the device and an adjustable airflow control mechanism, wherein the adjustable airflow control mechanism comprises a modulation or closure mechanism for the airflow path. In aspects, the modulation or closure mechanism comprises at least three distinct airflow control settings, wherein moving from any first airflow control setting to any second airflow control setting provides a pre-determined increase or pre-determined decrease in airflow through the device. In aspects, the invention provides a delivery device comprising an airflow control mechanism wherein the airflow control mechanism comprises a first part, e.g., a first airflow limiter, and a second part, e.g., a second airflow limiter completely separable from one another during normal use of the delivery device.

According to certain aspects, the invention provides a delivery device, e.g., a non-electronic, a non-heating, or both a non-electronic and non-heating delivery device, for the delivery of one or more volatile compounds, wherein the delivery device comprises an airflow control mechanism for establishing airflow control setting(s) comprising a plurality of airflow control parts, wherein at least a first airflow control part and a second airflow control part have an amount of interface at each selectable airflow control setting. In aspects, the amount of interface between the first component and the second component decreases between a (one), some, most, generally all, or all (any) first airflow control setting and a (one), some, most, generally all, or all (any) second airflow control setting compared to the amount of interface between the parts of the airflow control mechanism at any first or second airflow control setting. In aspects, the delivery device comprises a controllable, e.g., an adjustable, airflow control mechanism wherein a change between a (one), some, most, generally all, or all (any) first airflow control setting and a (one), some, most, generally all, or all (any) second airflow control setting is accompanied by a sensory experience, such as, e.g., an audible sensation or indicator, a tactile sensation or indicator, or both audible sensation and tactile sensation indicator(s). In aspects, the delivery device comprises an adjustable airflow control mechanism having two distinct sensory indicators, e.g., audible and tactile indicators, and, e.g., two distinct levels of each, differentiating between a maximally closed airflow control setting and a partially open airflow control setting.

In one aspect, the invention provides a delivery device, e.g., a non-electronic, a non-heating, or both a non-electronic and non-heating delivery device, for the delivery of one or more volatile compounds, wherein the device comprises, as described above, a volatile compound compartment designed to maintain volatile compound(s), composition(s) of volatile compound(s), or devices(s) such as ancillary device(s) designed to maintain, release, or maintain and release volatile compound(s), such as, e.g., a solid material device capable of maintaining or releasing one or more volatile compounds (i.e., an insert). In aspects, the volatile compound compartment has at least one dimension which is at least half as long as the longest dimension of the, e.g., solid material device (insert). In aspects, the volatile compound compartment completely surrounds at least a first portion of the, e.g., solid material device (insert). In aspects, the internal compartment only partially surrounds at least a second portion of the, e.g., solid material device (insert). In aspects, the volatile compound compartment is a feature of a volatile compound outlet component extension component.

According to aspects, the invention provides a solid material device capable of maintaining, releasing, or maintaining and releasing, or which has maintained or released volatile compound(s) or composition(s) thereof. In aspects, such a material can be adapted for insertion into a delivery/diffusion device as described above and can be characterized as an insert (e.g., by size, shape, or other features, which correspond to feature of the device, such as the size and shape of an insert compartment in the device). In aspects, the insert is removable from a delivery device and adapted for re-use or disposable use. In aspects, the invention provides a removable insert for use within a device of the invention, wherein the removable insert is designed to maintain, release, or both maintain and release one or more volatile compounds. According to one aspect, the invention provides a porous, non-fibrous, solid material device (removable insert) capable of holding, delivering, or holding and delivering one or more volatile compounds to a user when the device is inserted into a delivery device described above. In aspects, the solid material device (removable insert) comprises a first end, a second end, and a thickness. In aspects wherein an insert is, e.g., cylindrical, a thickness may be referred to as an outer diameter. In aspects, a solid material device comprises at least one non-circuitous passageway within its thickness between its first and second ends allowing the passage of air through the solid material device via the passageway. In one aspect, the invention provides a fibrous solid material device (removable insert) capable of holding, delivering, or holding and delivering one or more volatile compounds to a user when the device is inserted into a delivery device described above. In aspects, the fibrous device comprises a first end and a second end and a visible passageway through the device between the first and second ends.

According to certain aspects, the invention provides a delivery device system for the delivery of one or more volatile compounds to a user thereof, the device system comprising (a) a delivery device, e.g., a non-electronic, non-heating, or non-electronic and non-heating delivery device and (b) a removable insert designed to be removably maintained therein. In aspects, the delivery device of such a system comprises any one or more of the characteristics summarized here or described herein. In aspects, the removable insert comprises any one or more of the characteristics summarized here or described herein. In aspects, when in use, (a) at least one quarter of the removable insert's longest dimension is engaged with a component of the delivery device, e.g., a volatile compound outlet component or, e.g., extension thereof, and (b) the entirety of the removable insert is positioned within another component of the delivery device, such as, e.g., a mating component. In aspects, an insert is re-usable. In aspects, an insert is not removable. For example, in aspects, where a device is intended for limited use, such as use for only 1-7, 1-5, 1-3, or 1-2 days, such a readily disposable device can be provided with an integrated/non-removable insert. Such an insert can be described as "loaded" with an amount of the VCC that is sufficient, under normal conditions, to provide intended levels of VC delivery, over and intended period of use (e.g., the periods indicated above).

In aspects, the invention provides kit(s) comprising one or more device(s) summarized here or described herein or comprising one or more instances/copies of one or more of the various components or parts described herein (e.g., of a system of the invention), kit(s) providing one or more removable insert(s) summarized here or described herein, kit(s) providing one or more system(s) summarized here or described herein, or any combination of any thereof.

In aspects, the invention provides a method of creating pleasurable sensations or pleasurable/beneficial effects by the delivery of volatile compounds to a user.

In aspects, the invention provides a method that users may find helpful in aiding focus, aiding feelings of health, or in breaking certain habits. In respects, such uses are not related to the treatment or prevention of any disease or indication (e.g., in treating a medically diagnosed condition).

In aspects, methods of the invention may detectably or significantly reduce a habit, which may be, e.g., a smoking habit-related craving or a vaping-related habit craving in an individual, the method comprising providing to an individual suffering from a habit-related craving a delivery device and insert or a system summarized here or described herein.

In aspects, the method comprises instructing the individual to (i) apply suction via their mouth to a delivery device to induce an airflow through the delivery device such that a detectable amount of volatile compound(s) maintained by a removable insert comprising/releasing volatile compound(s) positioned within the device is delivered to the mouth of the individual and (ii) to repeat step (i) for as many times as is needed to detectably reduce the smoking habit-related craving as assessed by the individual. In aspects, the method comprises instructing the user to maintain some, most, generally all, or essentially/substantially all of the delivered VCs in the mouth or nose, as applicable. While most aspects are described herein with respect to delivery of VCs to the mouth, readers will recognize that many of such disclosures can be adapted to provide methods/devices/systems for delivery of VCs similarly to the nose or both to the nose and mouth.

According to certain aspects, the invention provides a method of detectably or significantly reducing a habit-related craving, habit-related behavior, or both, in an individual, the method comprising providing to an individual suffering from a smoking habit-related craving a delivery device or system summarized here or described herein. In aspects, the method comprises instructing the individual to (1) hold the device within their hand, between their fingers, between their lips, or any combination thereof, and (2) repeatedly manipulate one or more manipulatable component(s) or feature(s) of the device, such as, e.g., (a) to repeatedly rotate a first device component in relation to a second device component relative to one another in any direction or combination of directions, (b) repeatedly separate and allow reattachment of a first primary component and a second primary component relative to one another, or (c) a combination of (a) and (b), until the individual experiences a detectable or significant decrease in the smoking habit related craving as assessed by the individual or as assessed by an appropriately conducted and powered trial or survey administered or conducted by suitably trained individual(s) recognized as capable of identifying reduction in in the habit behavior or craving. In aspects, such improvements are in symptoms, perceptions, etc., ore are sufficient to provide a support to a therapy but are not associated with a claim of clinical/medical efficacy in the treatment or prevention of any disease or medical condition. In aspects, any of the other uses described herein can be similarly associated with significant or better results in studies, trials, etc. For example, in one aspect, methods provided herein can be associated with a significant increase in focus, a significant reduction in stress, significant change in mood or mental state, improvement in symptoms associated with allergy, headache, anxiety, or other conditions described herein.

In certain further aspects, the invention provides a method of controlling the delivery of volatile compound(s), e.g., flavored volatile compound(s), that are delivered to a user via a delivery device (e.g., to the mouth of a delivery device user), the method comprising moving at least two airflow control parts (e.g., airflow limiters) of an airflow control mechanism (airflow restrictor) provided within a delivery device in relation to one another such that the movement of the two airflow control parts (airflow limiters) occurs only in pre-defined increments wherein each movement of the two airflow control parts (airflow limiters) in a pre-defined increment provides a pre-determined increase or pre-determined decrease in airflow through the device. In aspects, the invention provides a method of controlling airflow in a delivery device designed to deliver volatile compound(s) to a user of the delivery device, the method comprising moving at least two airflow control parts (airflow limiters) of the delivery device in relation to one another such that the movement of the two airflow control parts (airflow limiters) occurs only in pre-defined increments and with each movement of the two airflow control parts (airflow limiters) in a pre-defined increment provides a pre-determined increase or pre-determined decrease in airflow through the delivery device. In aspects, method(s) of controlling volatile compound delivery or controlling airflow in a delivery device designed to deliver volatile compound(s) comprise moving at least two airflow control mechanism parts (airflow limiters) of a delivery device in relation to one another wherein, during normal operation of the device or airflow control mechanism thereof, at least two of the at least two airflow control parts (airflow limiters) of the delivery device are, selectively, at least partially or completely separable from one another.

In certain aspects, the invention provides accessories for use with delivery devices described herein, such as, for example, support units. In aspects, delivery device(s), insert(s) for use therein, accessories such as, e.g., support unit(s), or combination(s) thereof are provided as system(s) or as kit(s).

BRIEF DESCRIPTION OF THE DRAWINGS/FIGURES

The drawings/figures provided here, and the associated following brief description of figures, are intended to exemplify certain aspects and principles of the invention without limiting its scope. Except for data graphs or where indicated, all views are perspective views (some figures provide exploded perspective views, elevated views, plan views, or sectional views).

FIGS. 1A-1D (FIGS. 1A, 1B, 1C, and 1D) provide exploded-view perspectives of exemplary embodiment(s) of delivery device(s) provided by the invention.

FIGS. 1E-1G (FIGS. 1E, 1F, and 1G) provide an exemplary embodiment of a delivery device provided by the invention in fully assembled form as viewed from three slightly different perspectives.

FIG. 2A provides a perspective view of an exemplary embodiment of a delivery device provided by the invention in fully assembled form with the volatile compound outlet component, embodied as a body assembly, shaded for emphasis.

FIG. 2B provides a similar view of an exemplary embodiment of a delivery device provided by the invention in fully assembled form with the mating component, embodied as a tip assembly, shaded for emphasis.

FIG. 2C provides a perspective view of an exemplary embodiment of the components of a delivery device provided herein, including a mating component, embodied as a tip assembly, removed from a volatile compound outlet component, embodied as a body assembly, and further exemplifying the directionality of a total airflow during the device while in use.

FIG. 3A provides a perspective view of an exemplary embodiment of a volatile compound outlet component, embodied as a body assembly.

Figure 4A:
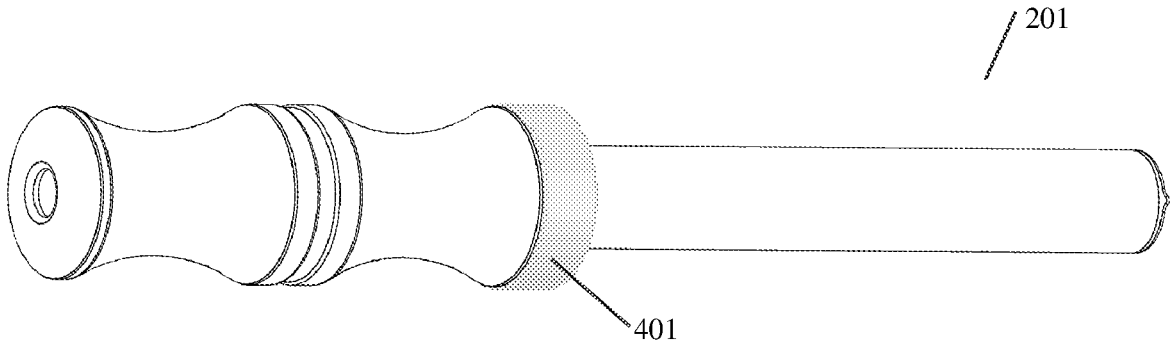
FIG. 4A depicts an exemplary embodiment of a volatile compound outlet component, embodied as a body assembly, with an engagement component positioning component, exemplified as a magnet cover, of a volatile compound outlet component extension, embodied as a body sub-assembly, with feature(s) shaded for emphasis.
Figure 4B:
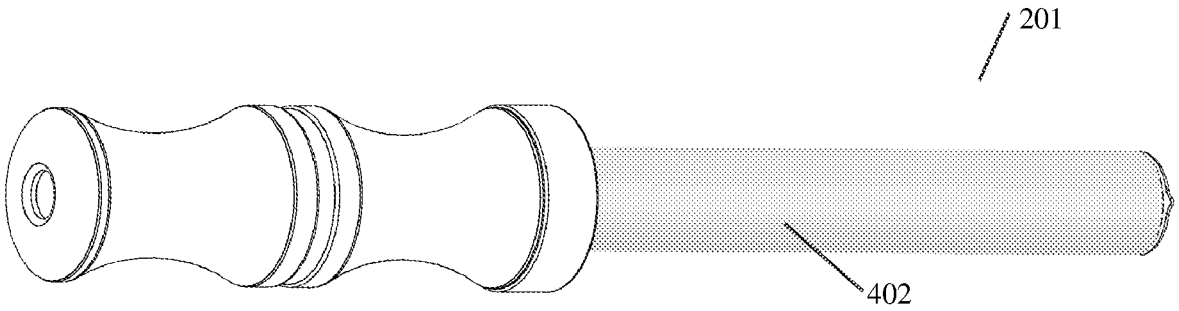
FIG. 4B shows an exemplary embodiment of a volatile compound outlet component, embodied as a body assembly, with a volatile compound compartment, embodied as a body tube, of the volatile compound outlet component extension, embodied as a body sub-assembly, shaded for emphasis.
Figure 4C:
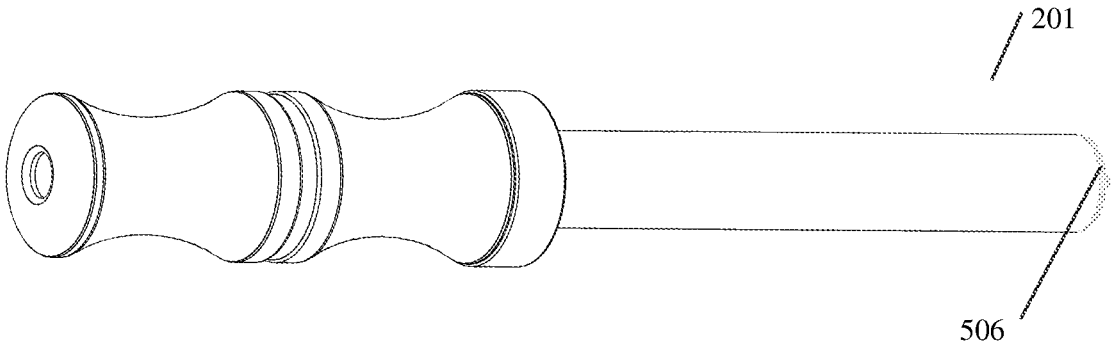

FIG. 4C provides a perspective view of an exemplary embodiment of a volatile compound outlet component, embodied as a body assembly, with an airflow limiter, embodied as a body crown, of a volatile compound outlet component extension, embodied as a body sub-assembly, with feature(s) shaded for emphasis.

Figure 5A:
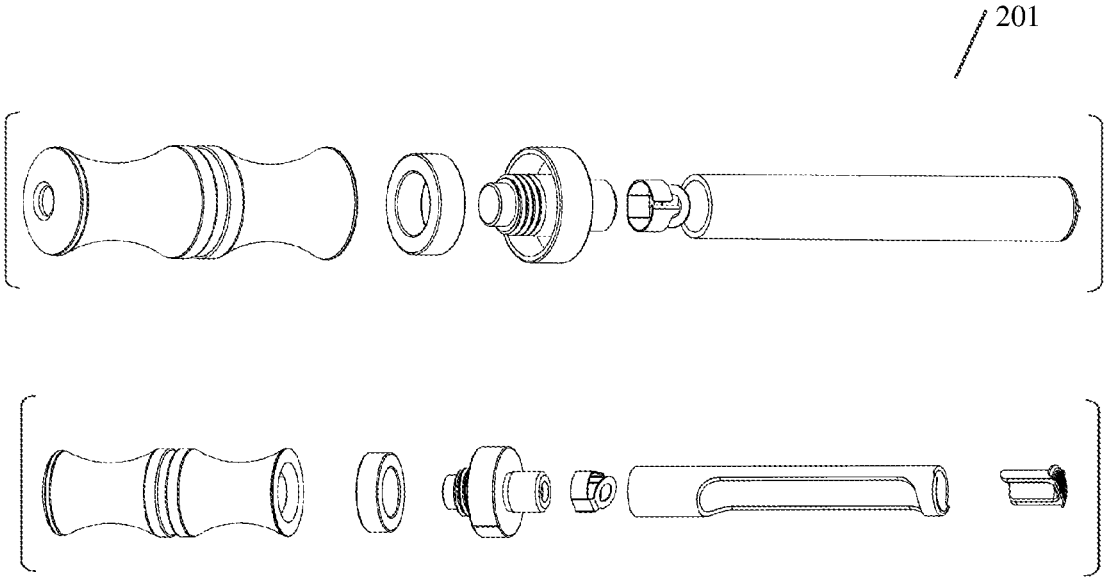

FIG. 5A provides an exploded-view perspective of an exemplary embodiment of a volatile compound outlet component, embodied as a body assembly.

Figure 5B:
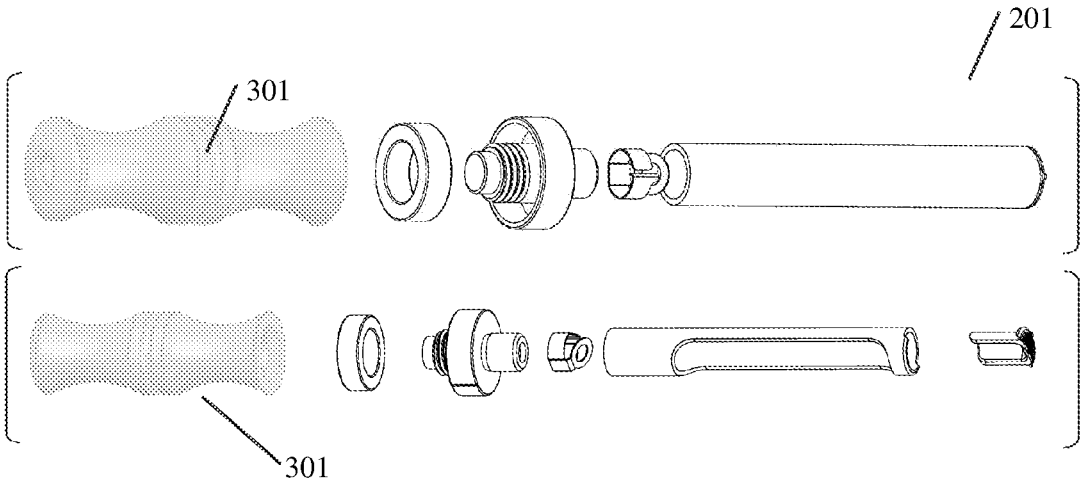
Figure 5C:
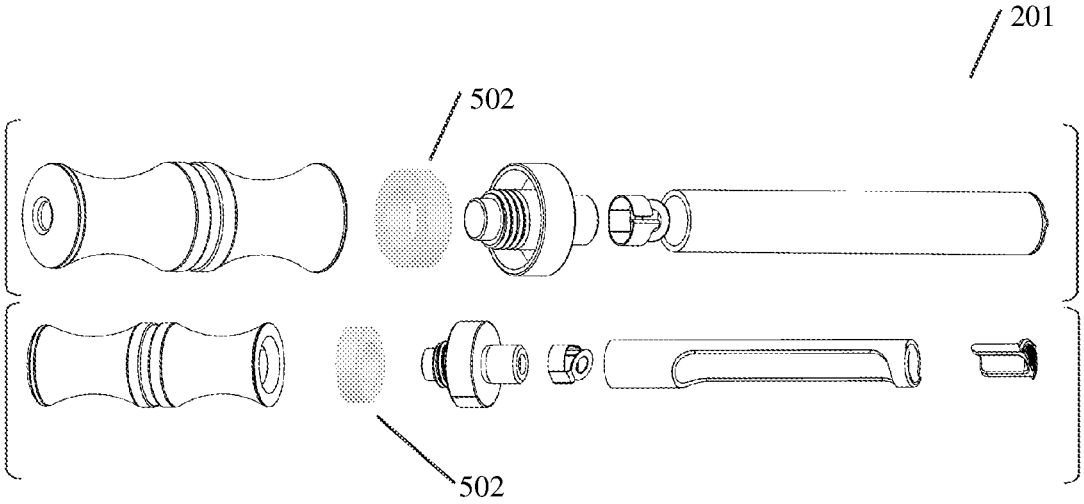
Figure 5D:
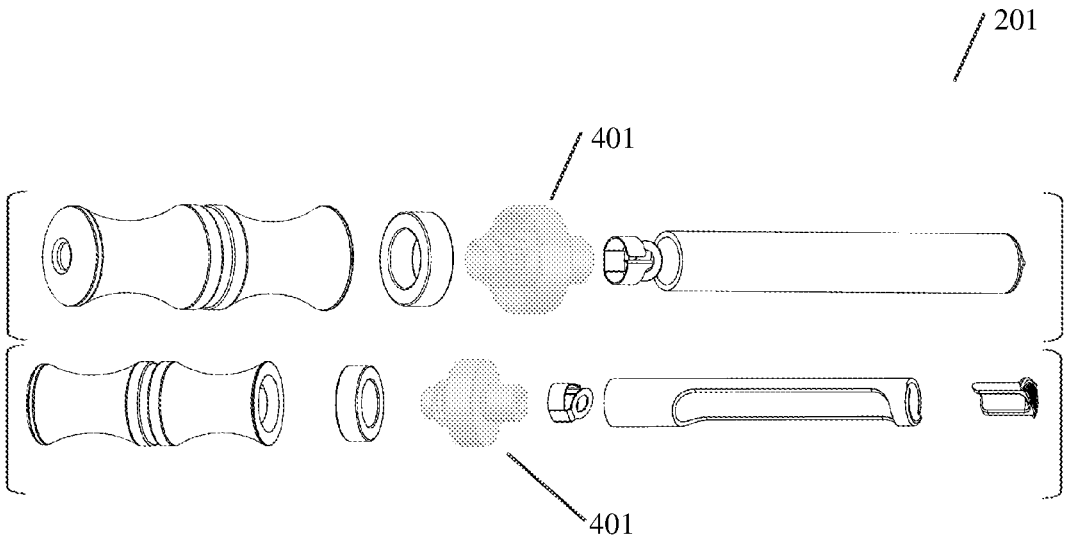
Figure 5E:
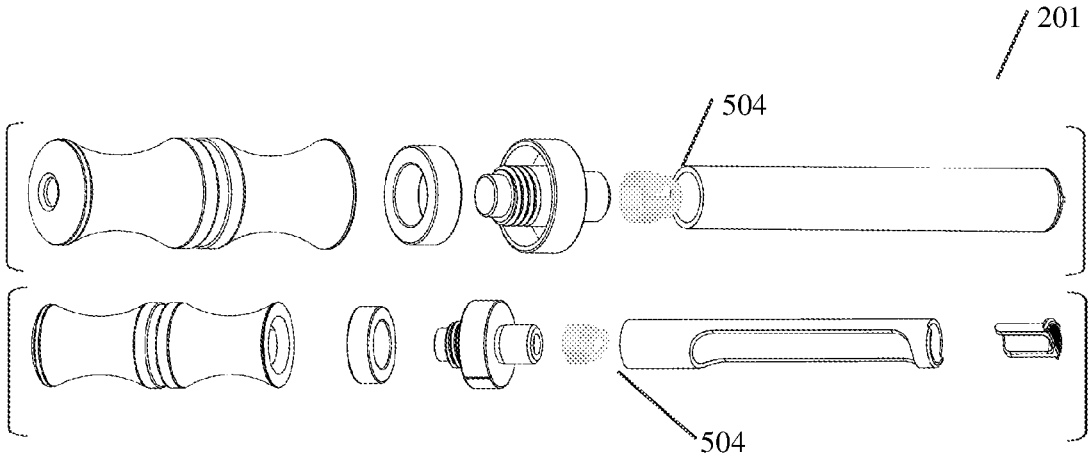
Figure 5F:
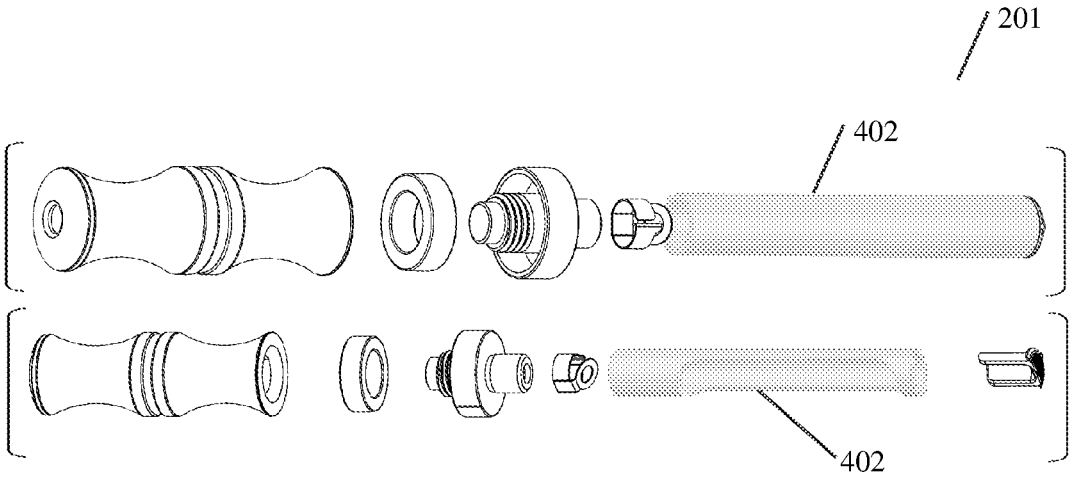
Figure 5G:
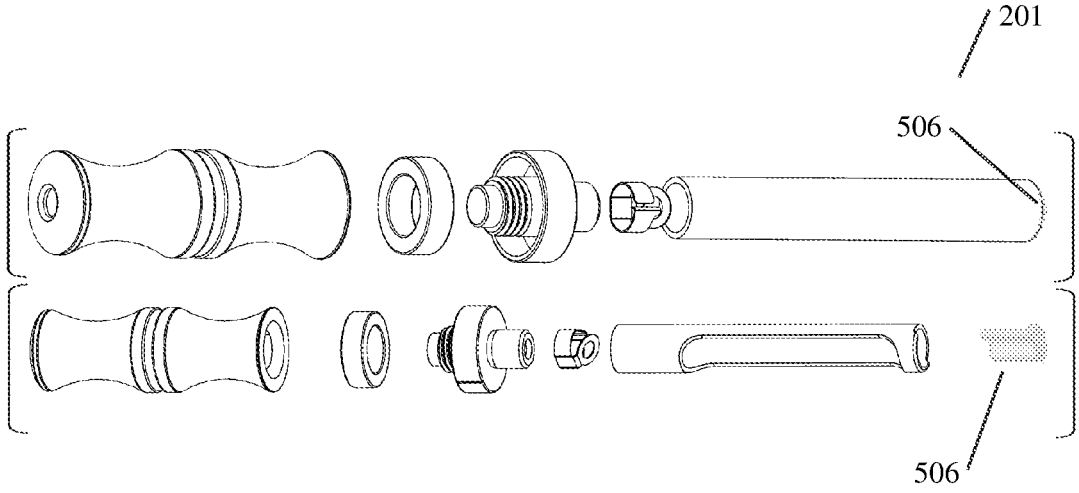

FIGS. 5B-5G, including FIGS. 5B, 5C, 5D, 5E, 5F, and 5G, provide an exploded-view perspective of the exemplary embodiment of a body assembly shown in FIG. 5A, with each component of the exemplary volatile compound outlet component, embodied as a body assembly, shaded for emphasis: mouthpiece component (FIG. 5B), engagement mechanism (embodied as a magnet) (FIG. 5C), engagement component positioning component (embodied as a magnet cover) (FIG. 5D), insert support (embodied as an insert spring) (FIG. 5E), volatile compound compartment/VCCSC, embodied as a body tube (FIG. 5F), and airflow limiter, embodied as a body crown (FIG. 5G).

Figure 6A:
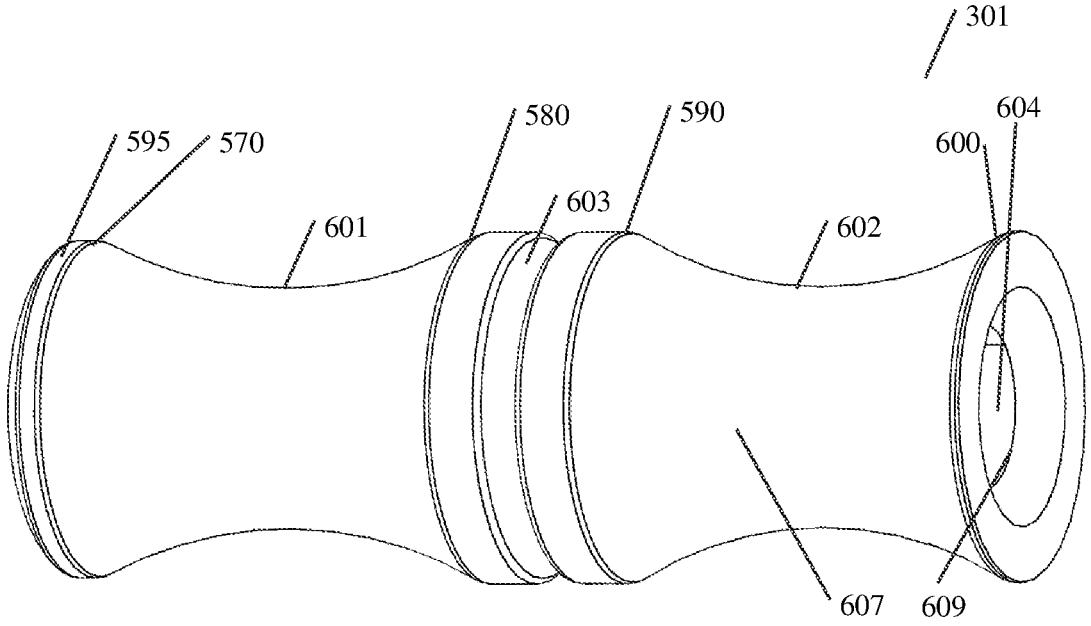
Figure 6B:
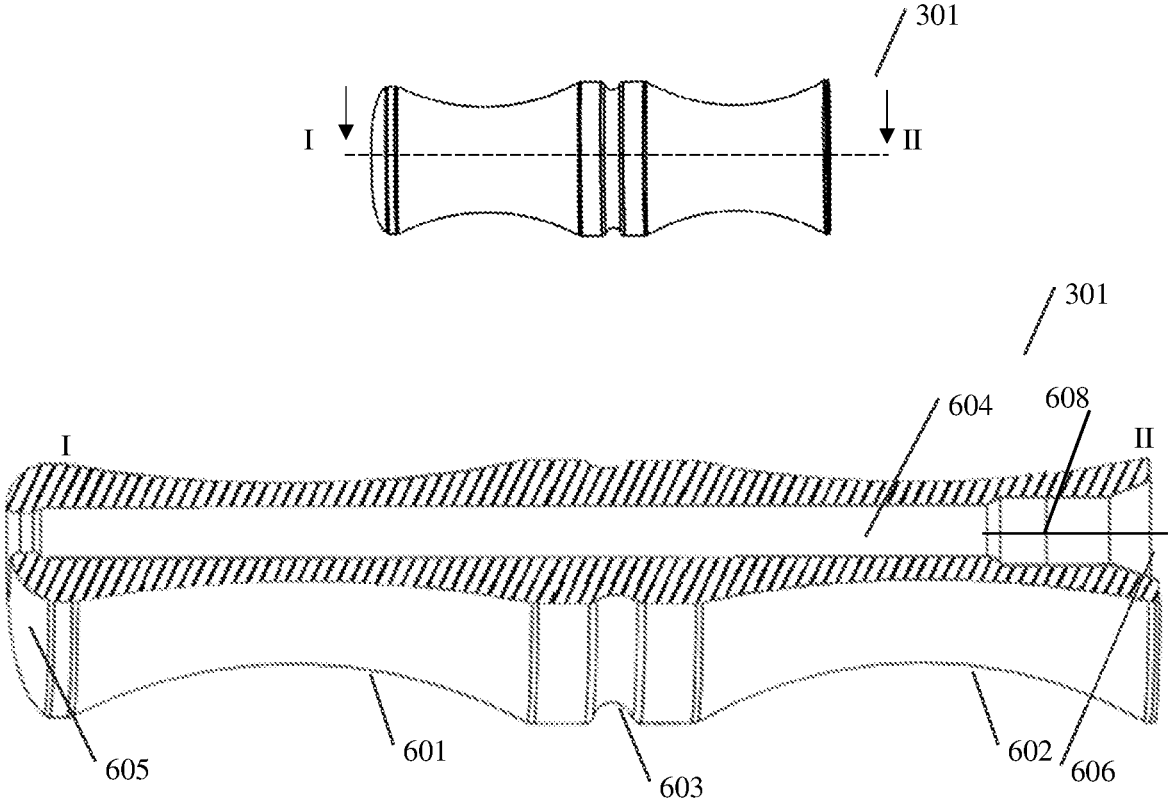

FIGS. 6A and 6B provide views of an exemplary embodiment of a volatile compound outlet component, embodied as a mouthpiece, with FIG. 6B providing a sectional-view of the mouthpiece of FIG. 6A (FIG. 6B including an orientation illustration to indicate the perspective of the sectional-view).

Figure 6C:
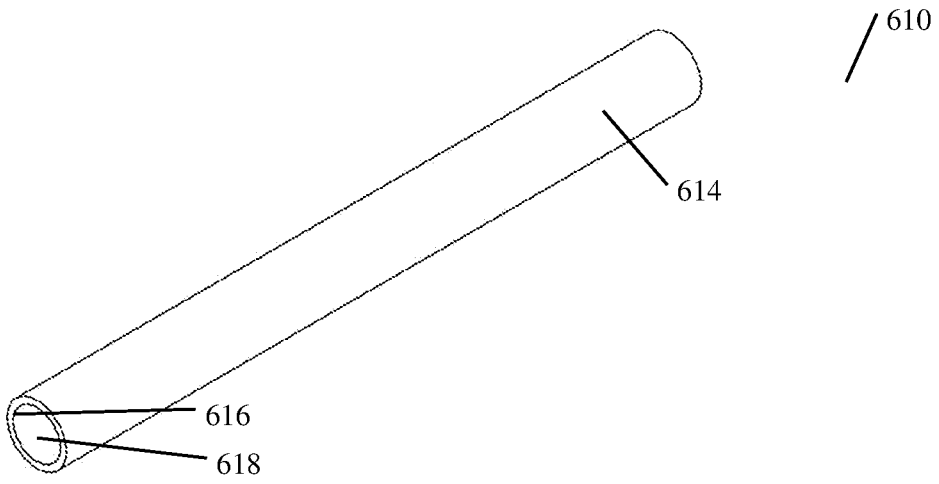

FIG. 6C provides a view of an exemplary embodiment of a volatile compound outlet component supplement, embodied as a mouthpiece tube, adapted for use with a volatile compound outlet component (e.g., mouthpiece) such as the mouthpiece of FIGS. 6A and 6B.

Figure 7:
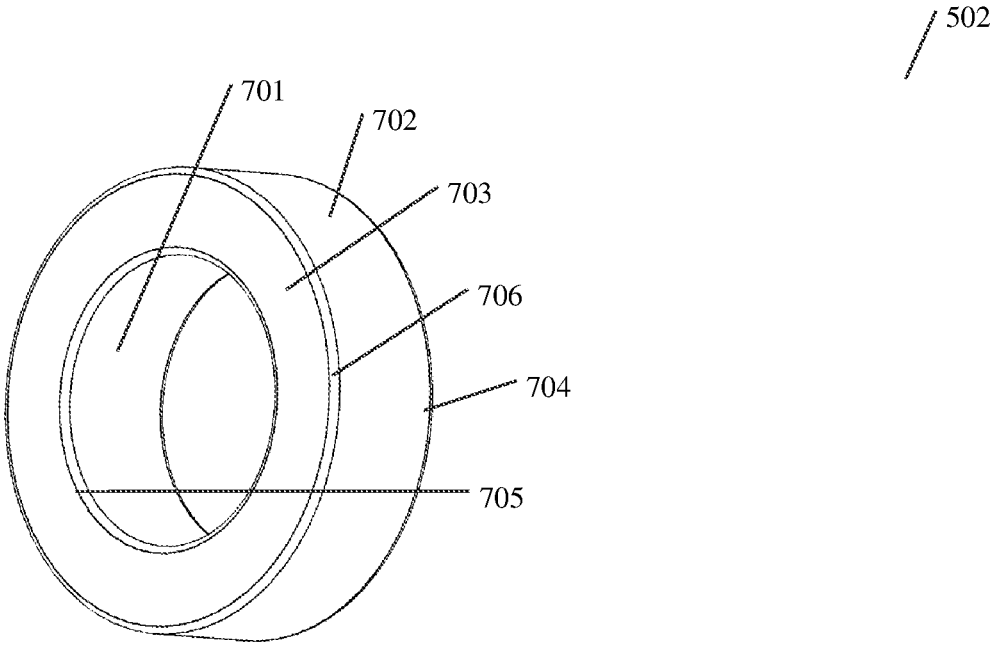

FIG. 7 provides a perspective view of an exemplary embodiment of an engagement mechanism, embodied as a magnet.

Figure 8A:
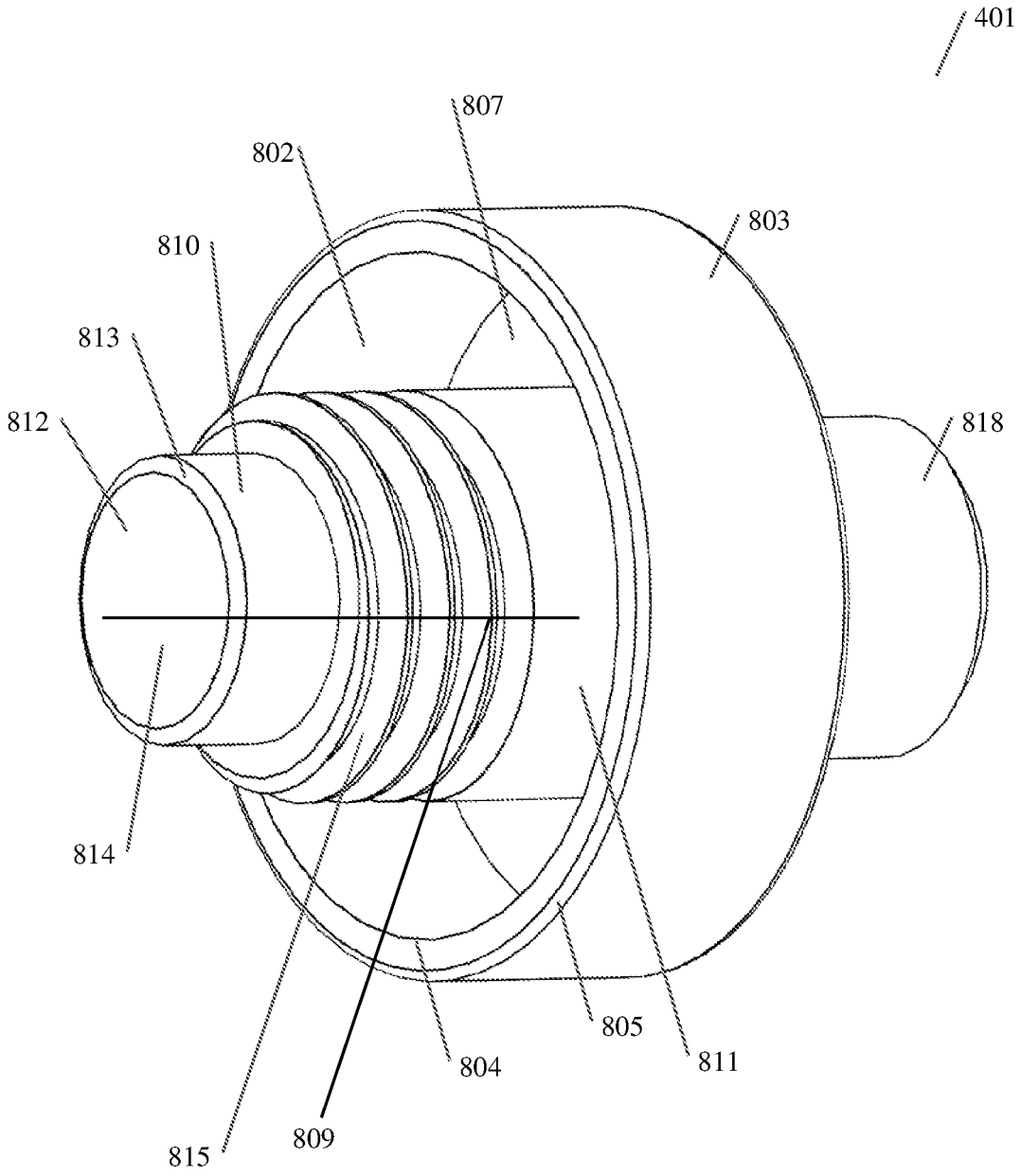
Figure 8B:
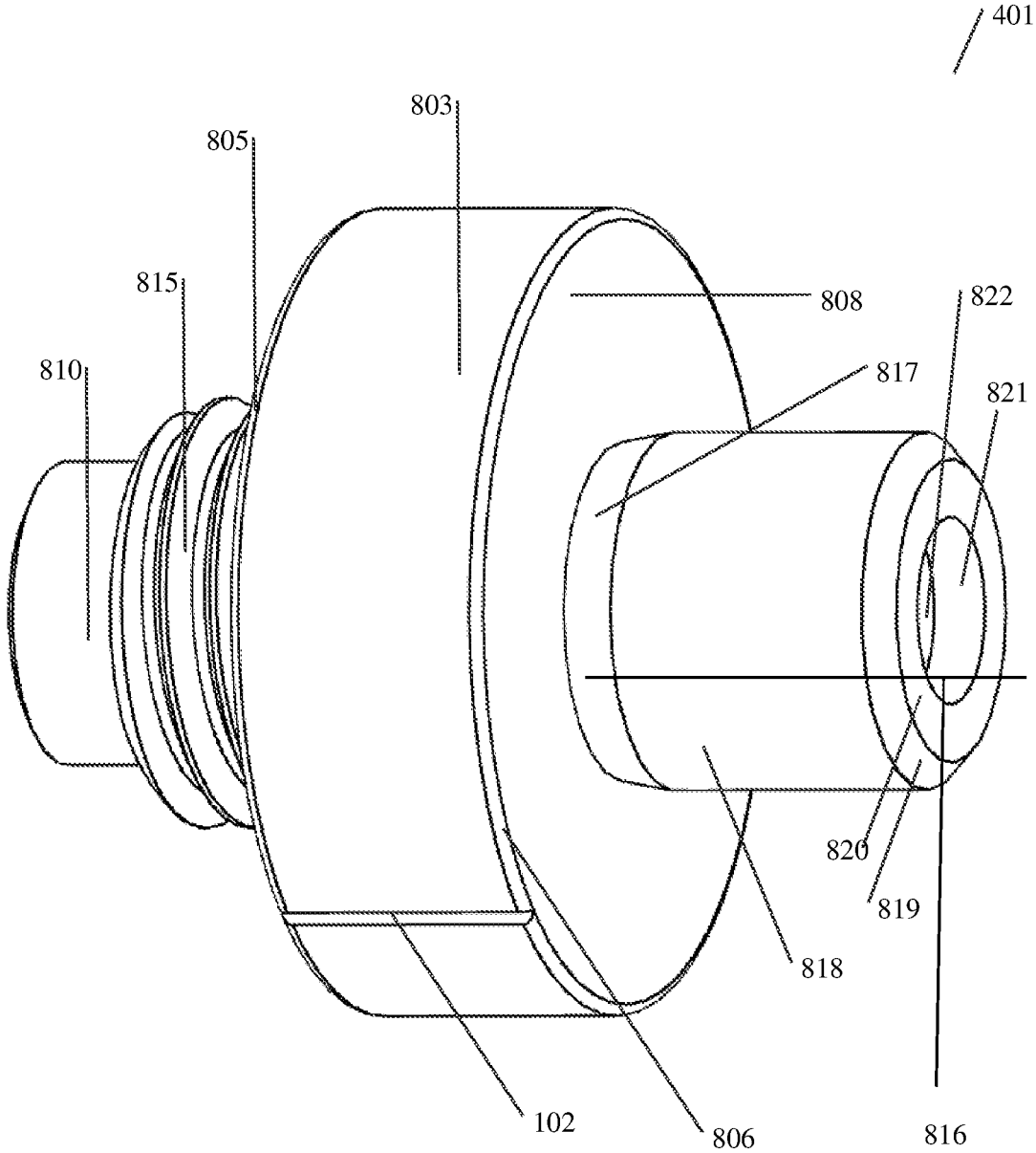

FIGS. 8A and 8B provide a view of an exemplary embodiment of an engagement component positioning component, embodied as a magnet cover, as viewed from two different perspectives.

Figure 9A:
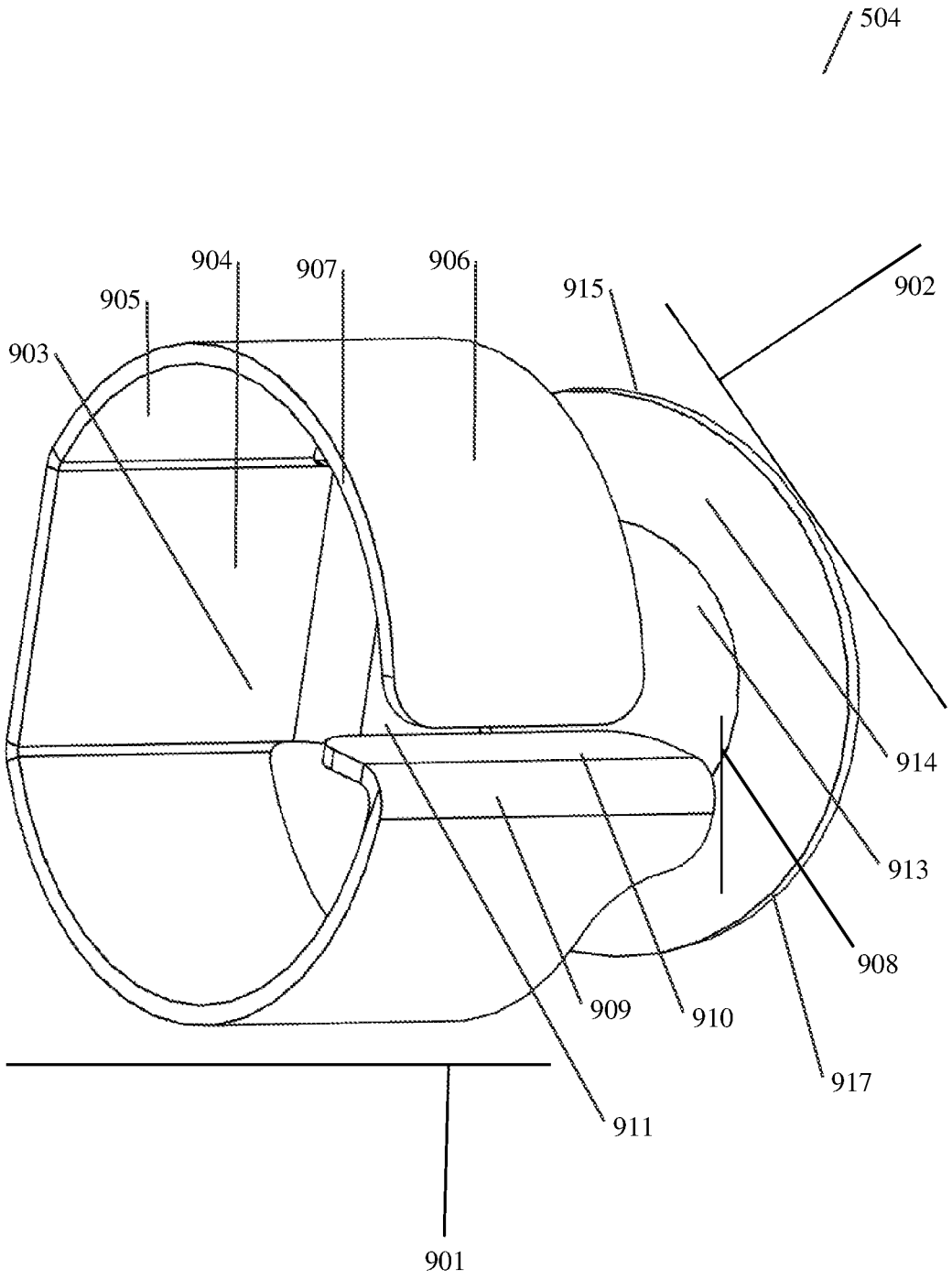
Figure 9B:
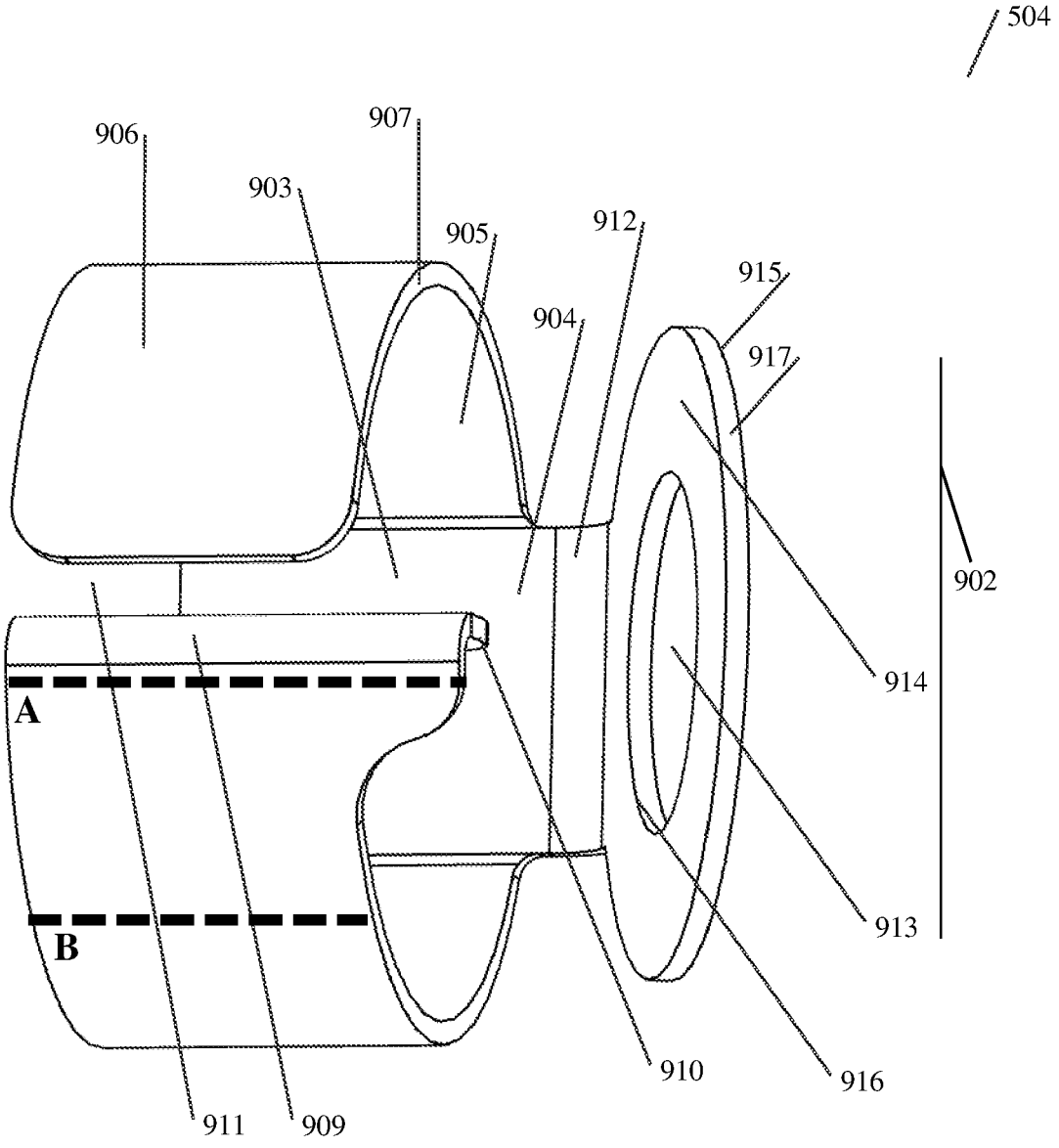

FIGS. 9A and 9B provide views of an exemplary embodiment of an insert support, embodied as an insert spring, as viewed from two different perspectives.

Figure 10A:
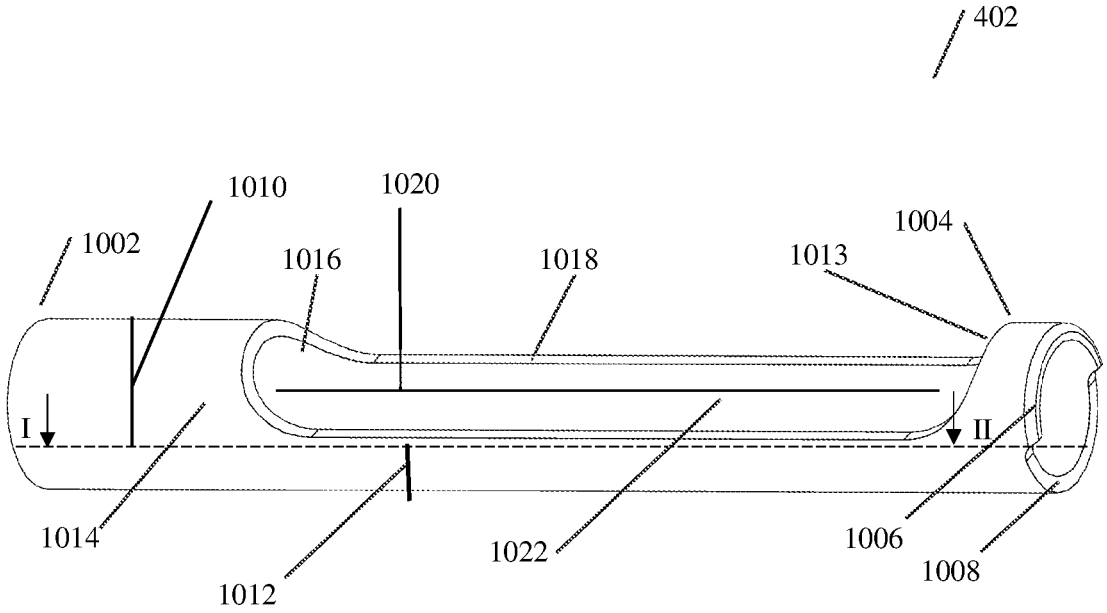
Figure 10B:
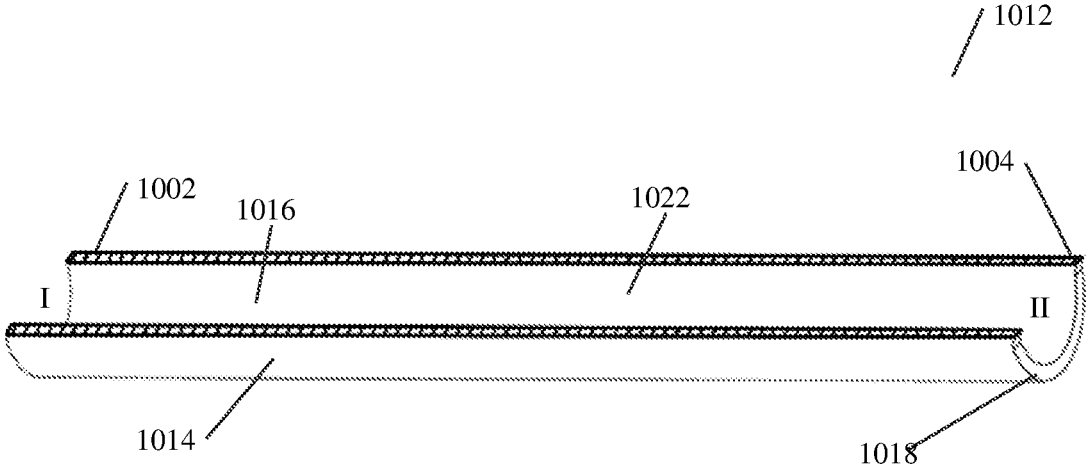

FIGS. 10A and 10B provide views of an exemplary embodiment of a volatile compound compartment, embodied as a body tube, as viewed from two different perspectives, with FIG. 10B showing a sectional view of the body tube of FIG. 10A.

Figure 11A:
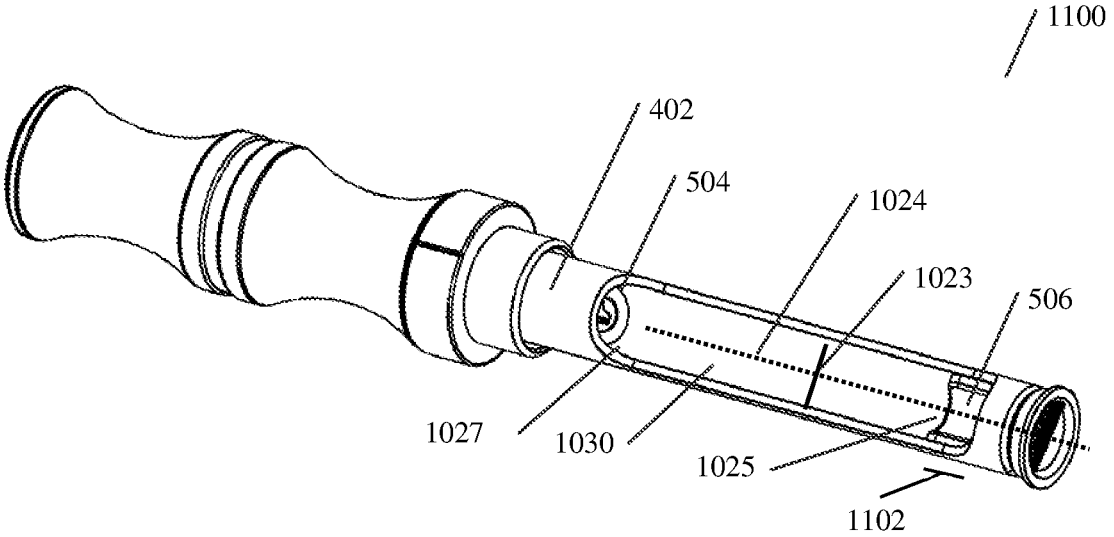
Figure 11B:
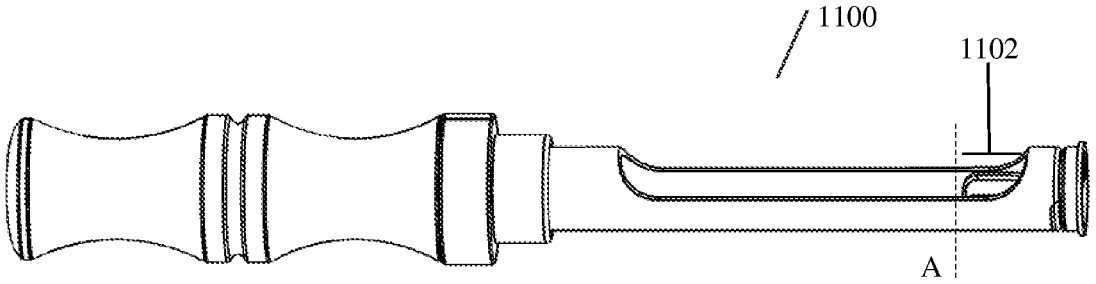

FIGS. 11A and 11B show an exemplary embodiment of a body assembly comprising an insert compartment and insert compartment access/access gap, exemplified as a finger recess, present to aid in the removal or insertion of a removable insert.

Figure 12A:
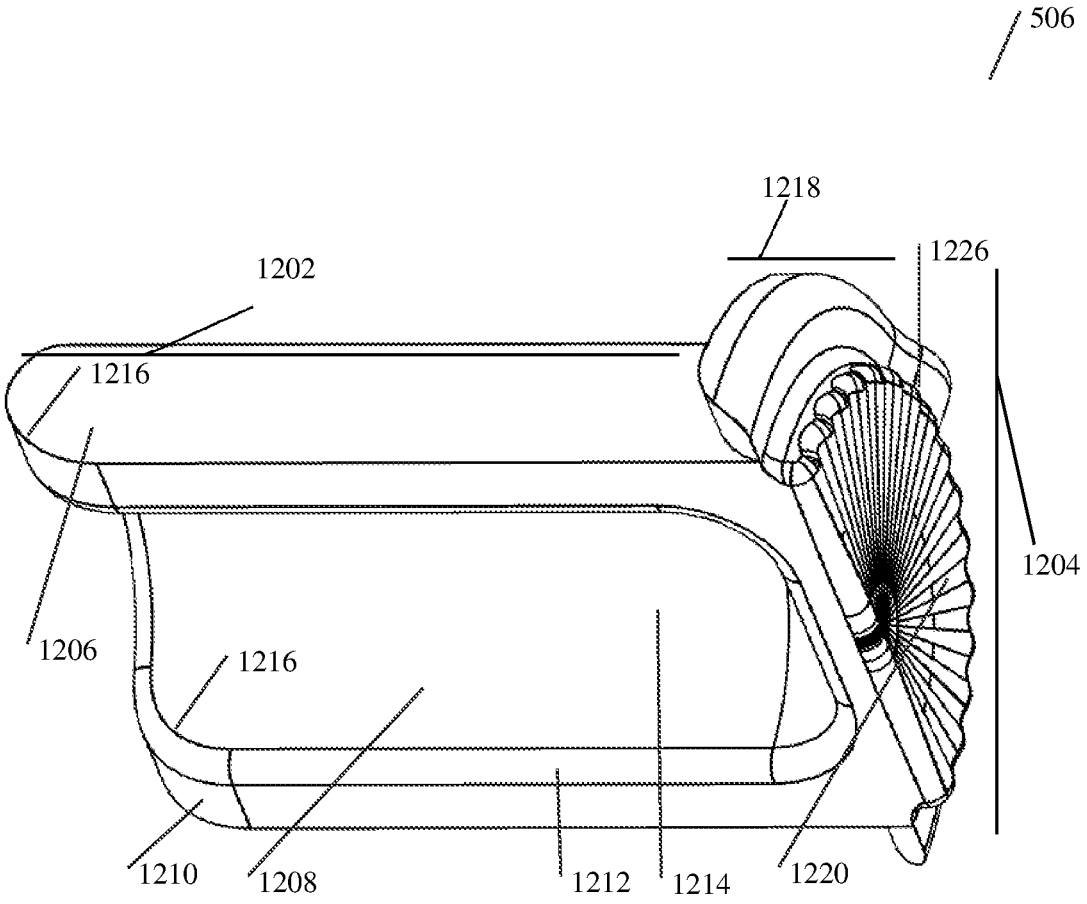
Figure 12B:
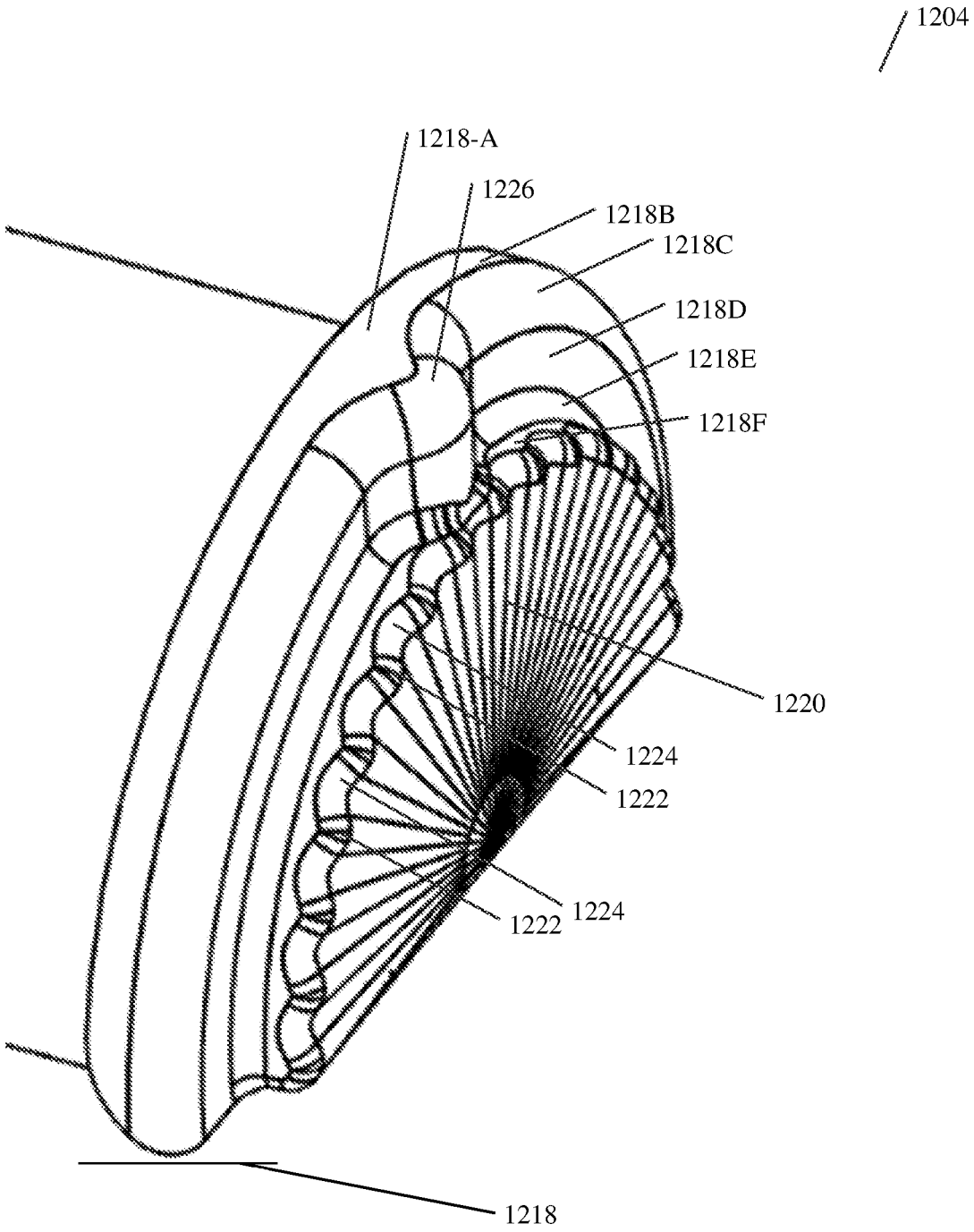
Figure 12C:
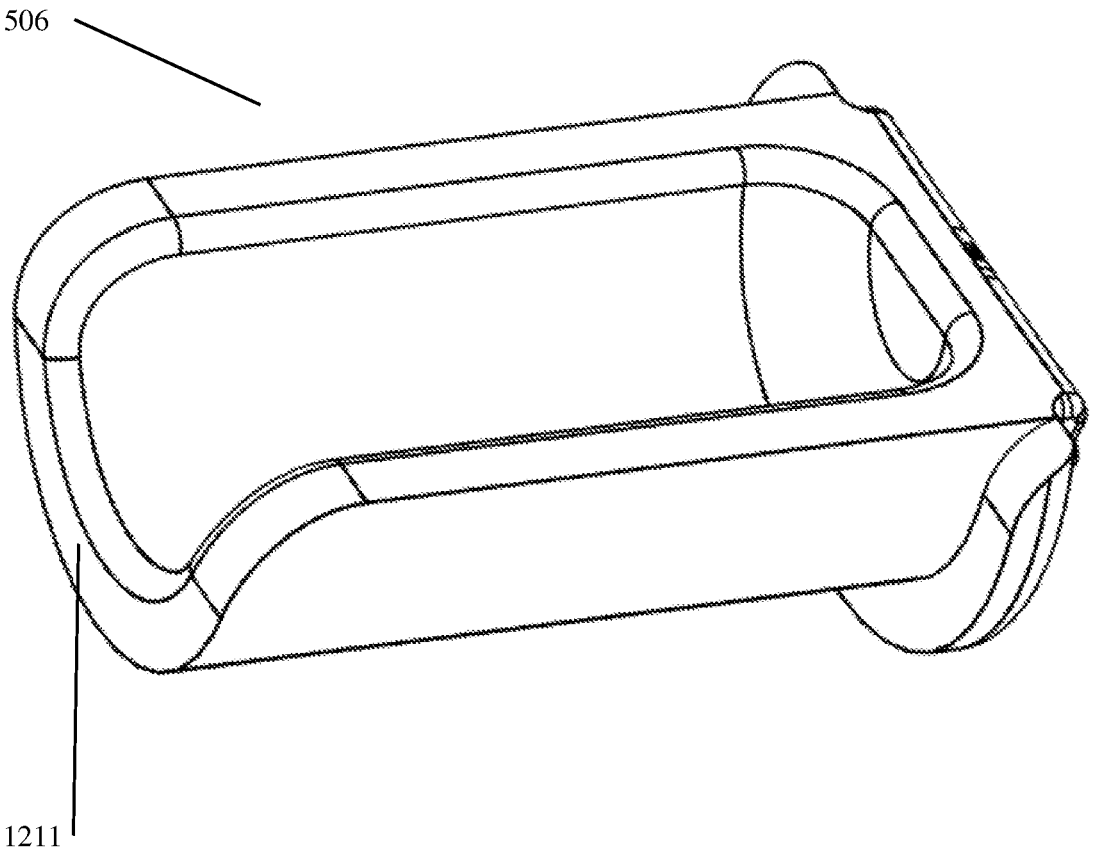

FIGS. 12A, 12B, and 12C provide views of an exemplary embodiment of an airflow limiter, embodied as a body crown, with FIG. 12B emphasizing one particular portion of the body crown of FIG. 12A and FIG. 12C emphasizing another particular portion of the body crown of FIG. 12A functioning as an insert support.

Figure 13A:
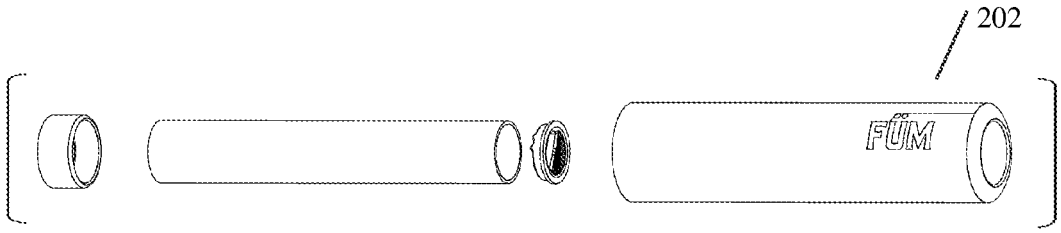

FIG. 13A provides an exploded view of an exemplary embodiment of a mating component, exemplified as a tip assembly.

Figure 13B:
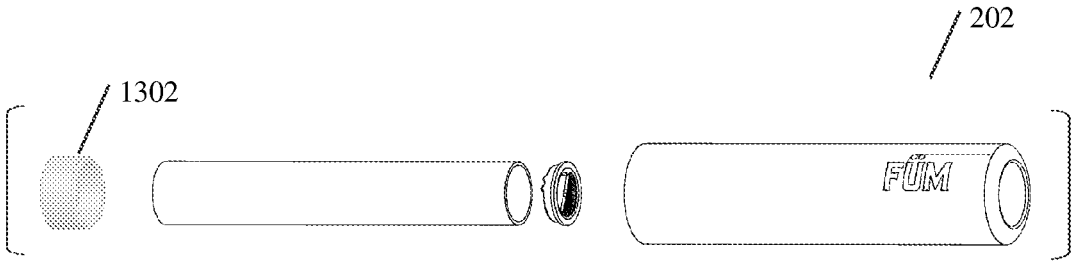
Figure 13C:
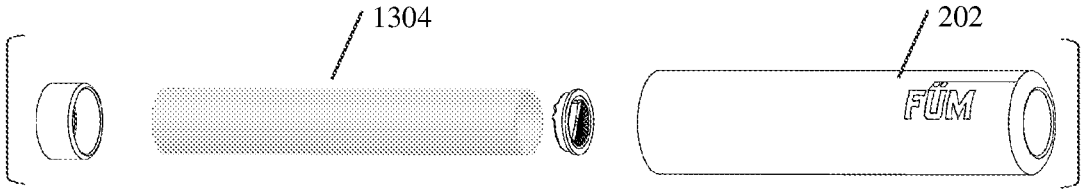
Figure 13D:
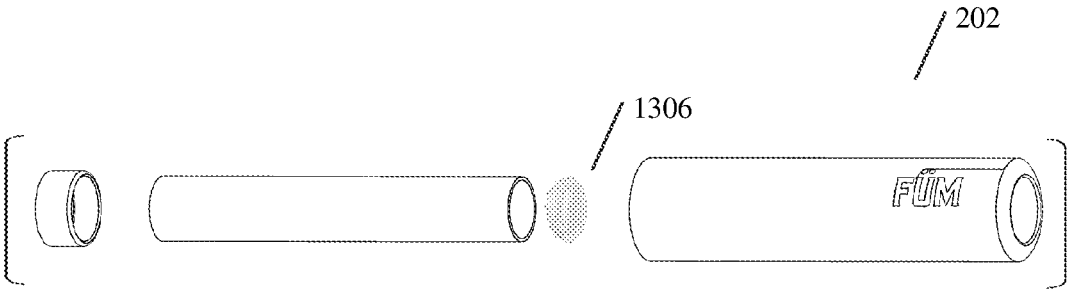
Figure 13E:
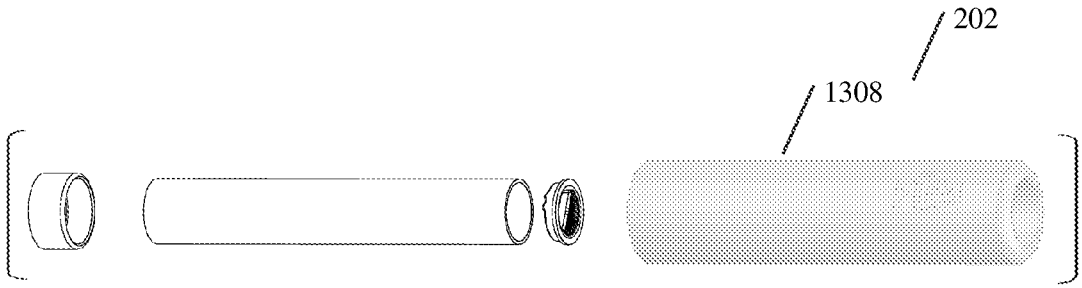

FIGS. 13B-13E provide an exploded views of the exemplary embodiment of a mating component (tip assembly) shown in FIG. 13A, with each component of focus shaded for emphasis: engagement mechanism counterpart, embodied as a barrel collar (FIG. 13B), mating component exterior part supplement, embodied as a barrel tube (FIG. 13C), airflow limiter embodied as a barrel crown (FIG. 13D), and mating component exterior part, embodied as a barrel/barrel component (FIG. 13E).

Figure 14:
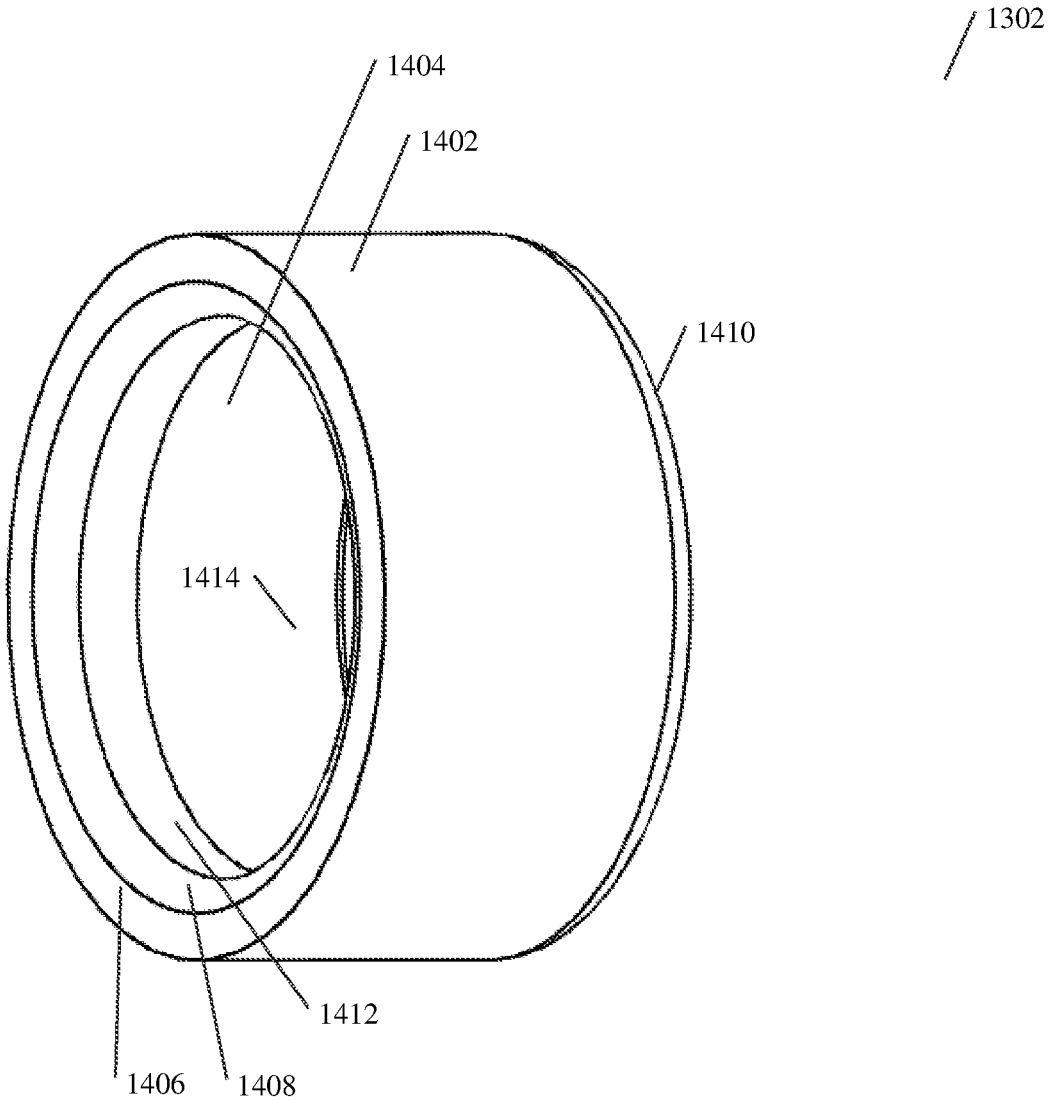

FIG. 14 provides a view of an exemplary embodiment of an engagement mechanism counterpart, embodied as a barrel collar.

Figure 15:
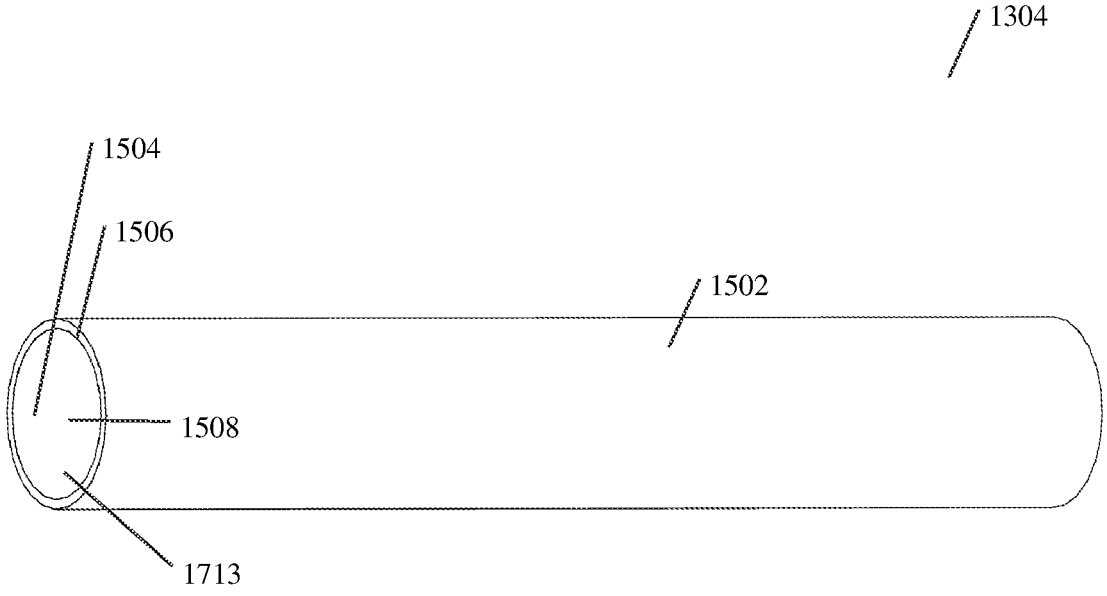

FIG. 15 provides a perspective view of an exemplary embodiment of a mating component exterior part supplement, embodied as a barrel tube.

Figure 16:
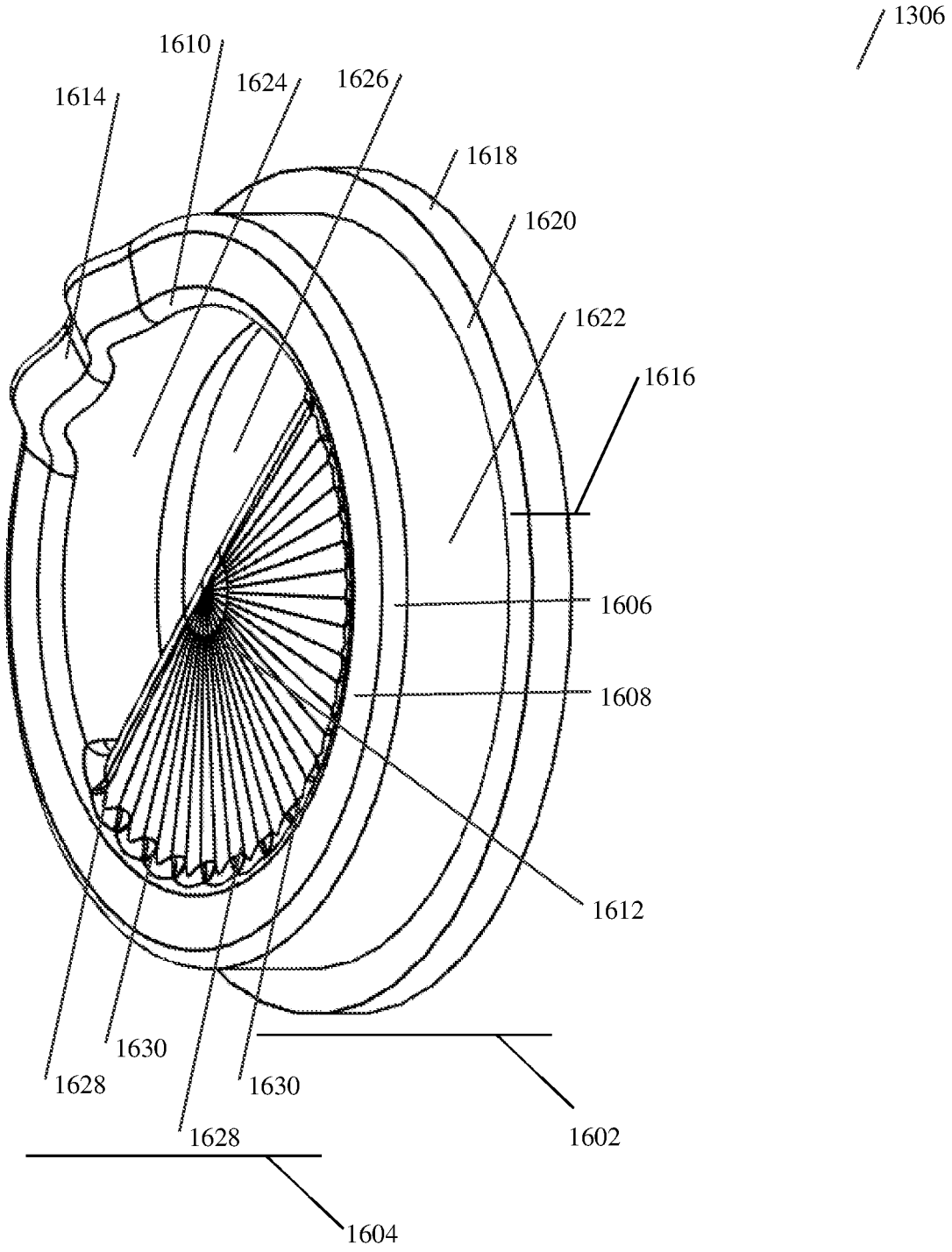

FIG. 16 depicts an exemplary embodiment of an airflow limiter, embodied as a barrel crown.

Figure 17A:
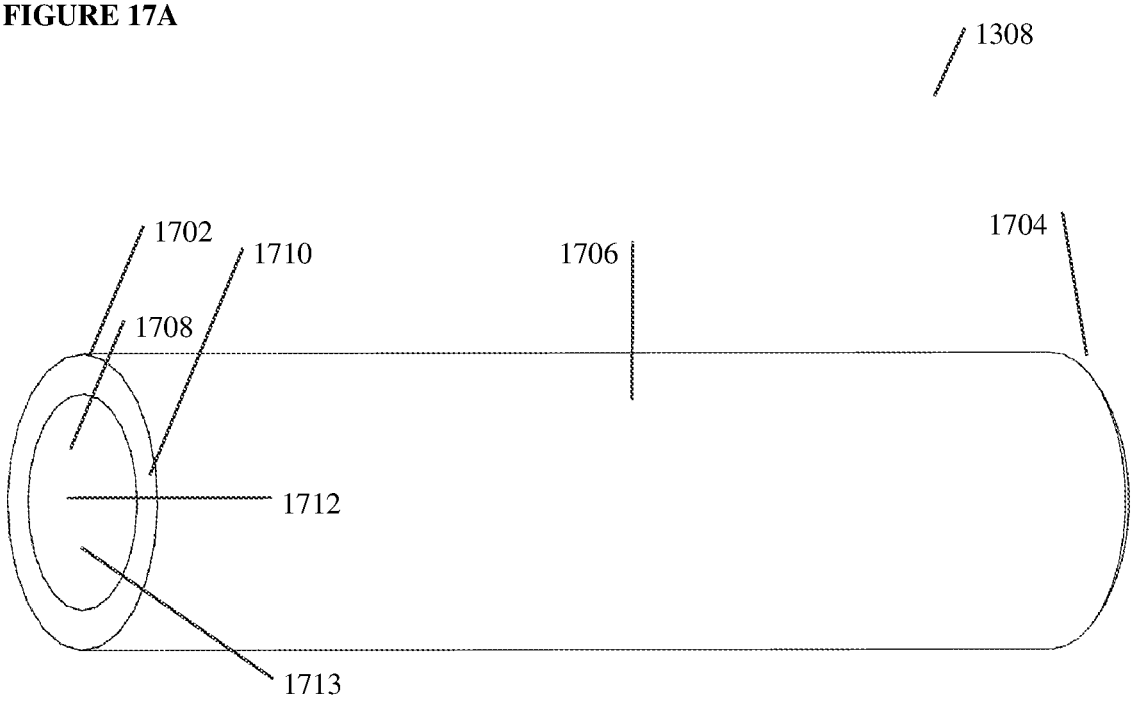

FIG. 17A shows a perspective view of exemplary mating component exterior part, embodied as a barrel.

Figure 17B:
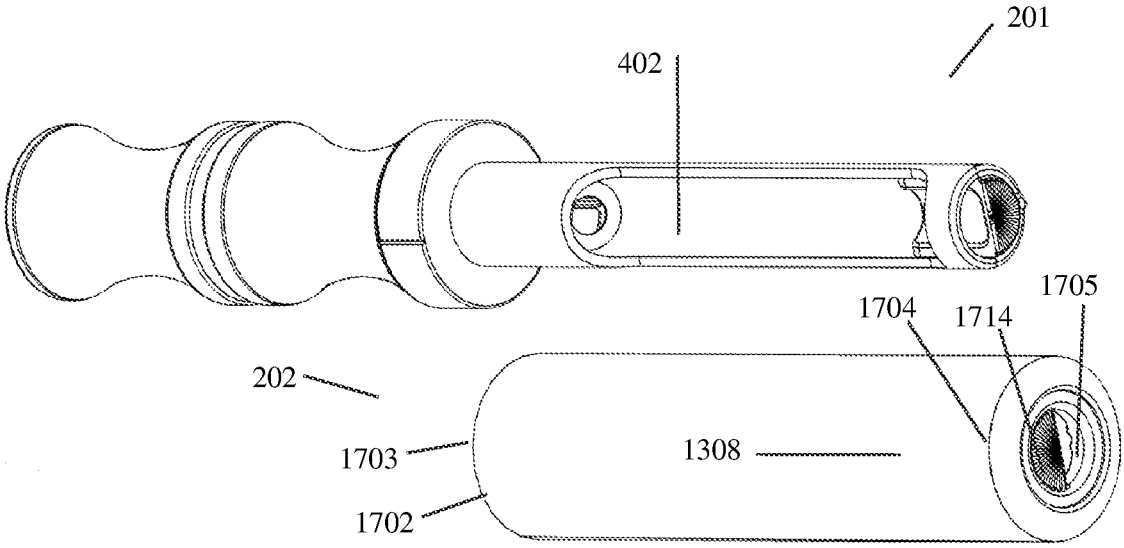

FIG. 17B shows an exemplary embodiment of a mating component exterior part, embodied as a barrel, as an element of a mating component (embodied as a tip assembly), in relation to an exemplary volatile compound outlet component, embodied as a body assembly.

Figure 18A:
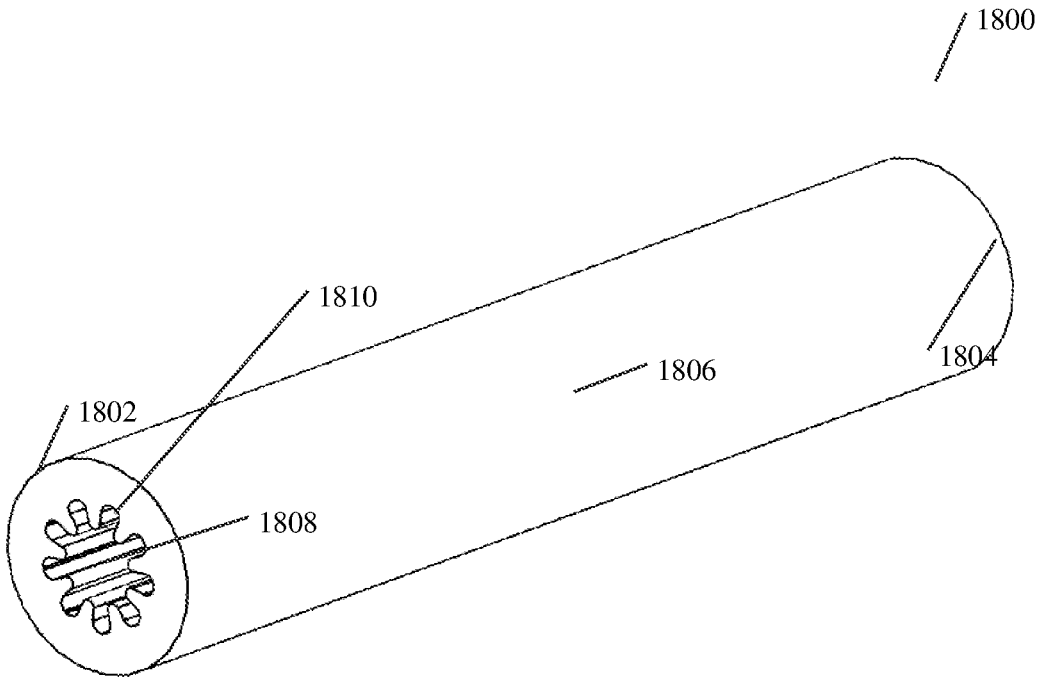
Figure 18B:
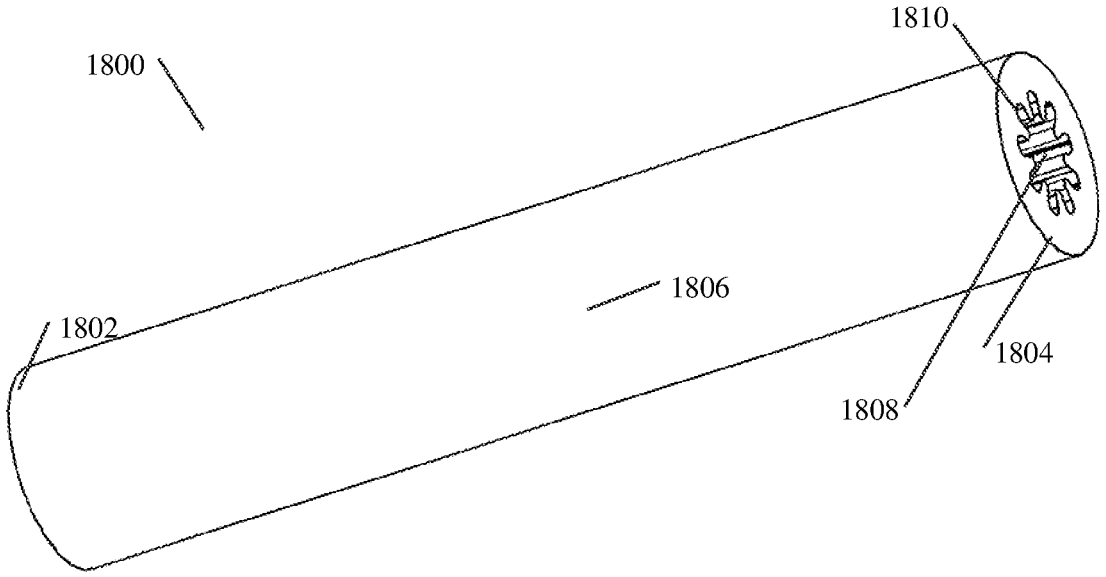
Figure 18C:
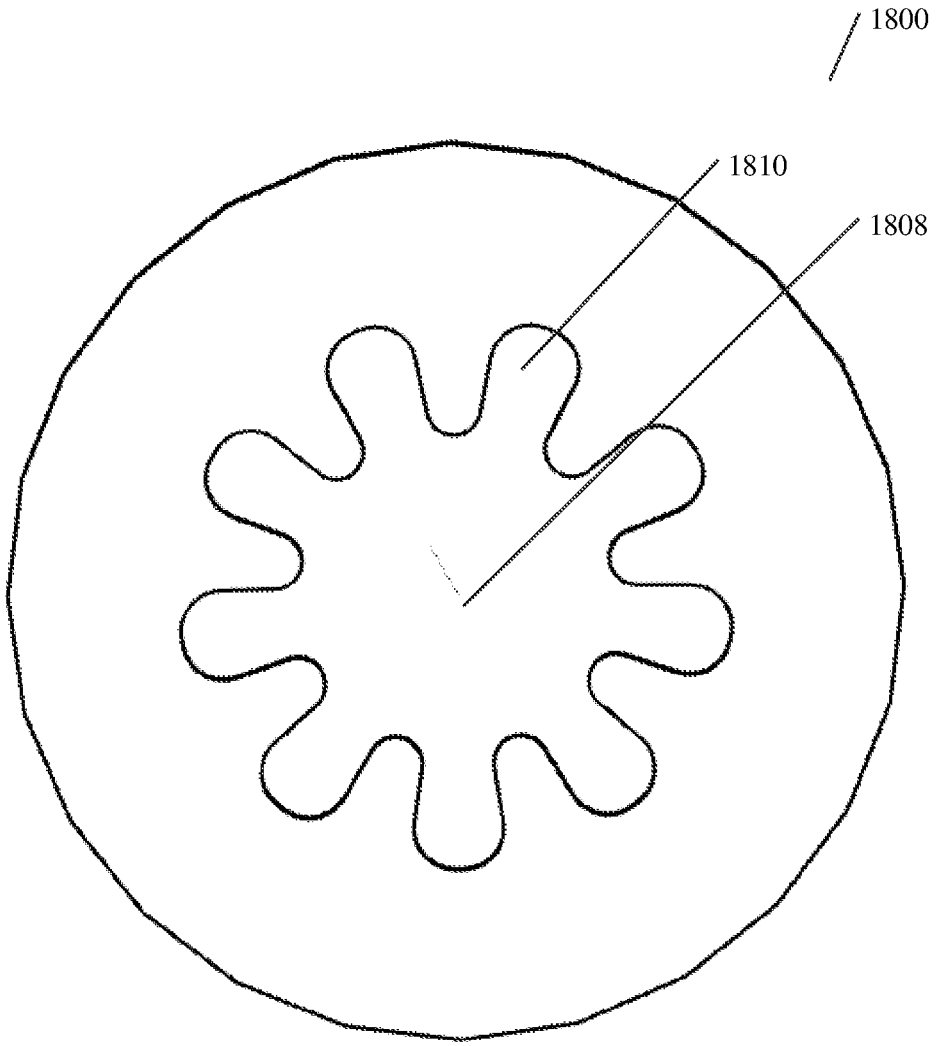

FIGS. 18A-18C, including FIGS. 18A, 18B, and 18C, provide views of an exemplary embodiment of a solid material device for maintaining, delivering, or maintaining and delivering volatile compound(s) (i.e., insert) viewed from different perspectives.

Figure 19:
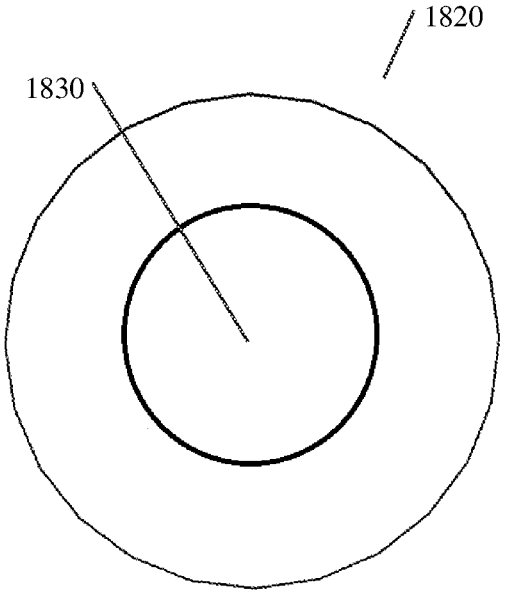

FIG. 19 provides a side/elevation view of an embodiment of a solid material device for maintaining, delivering, or maintaining and delivering, volatile compound(s) (i.e., insert) as viewed from an end of the insert.

Figure 20:
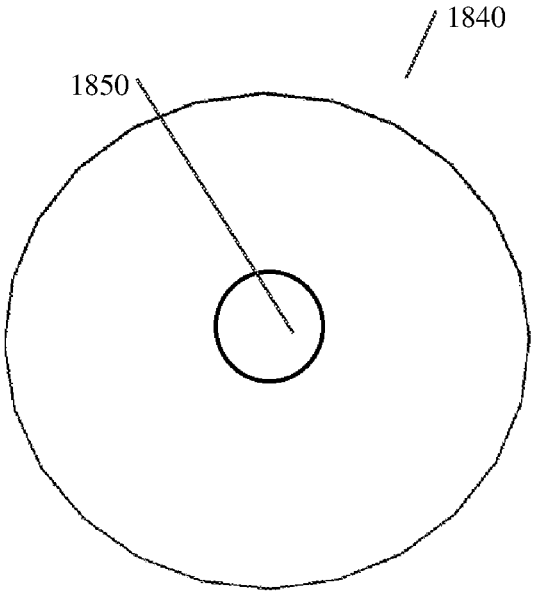

FIG. 20 provides a side/elevation view of an exemplary embodiment of a solid material device for maintaining, delivering, or maintaining and delivering, volatile compound(s) (i.e., insert) as viewed from an end of the insert.

Figure 21:
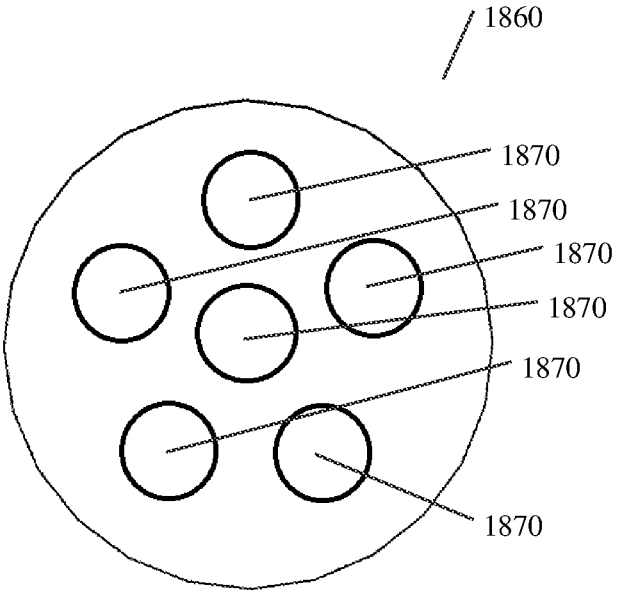

FIG. 21 provides a side/elevation view of an exemplary embodiment of a solid material device for maintaining, delivering, or maintaining and delivering volatile compound(s) (i.e., insert) as viewed from an end of the insert.

Figure 22A:
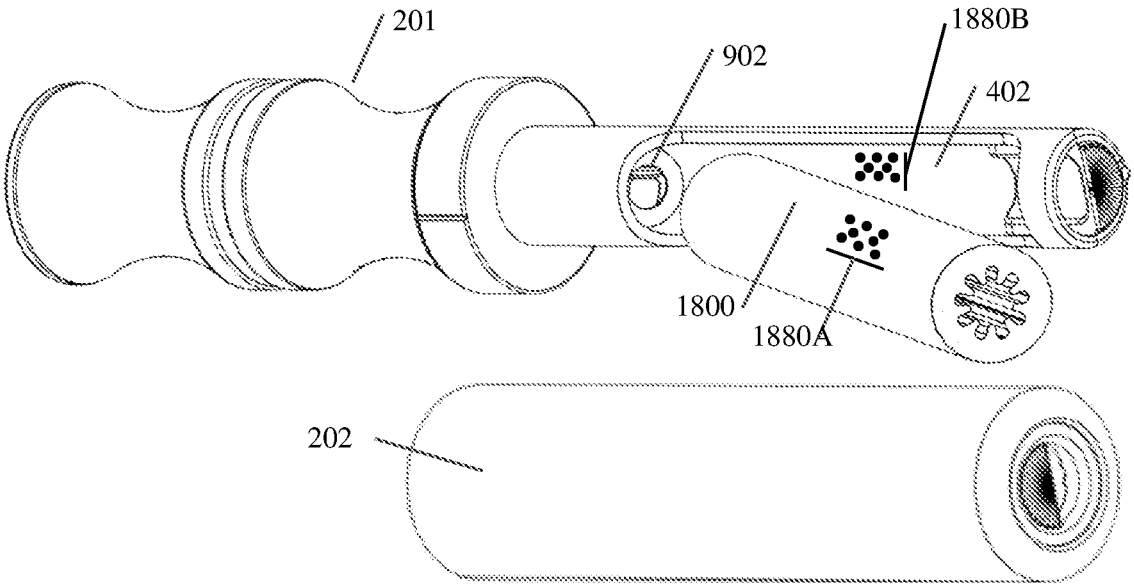
Figure 22B:
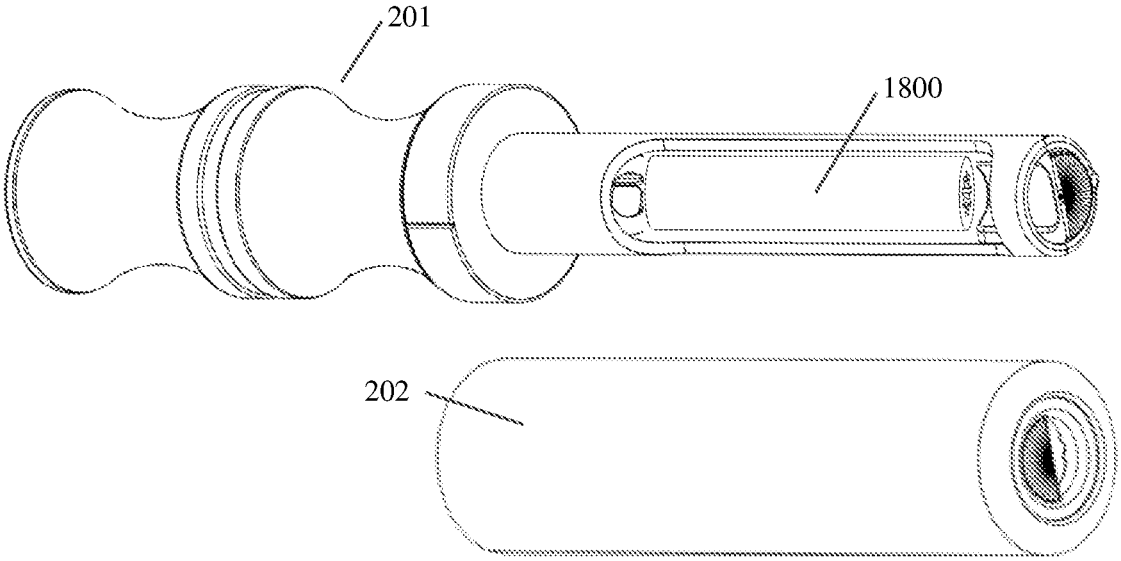

FIGS. 22A and 22B provide perspective views of the insertion of an exemplary solid material device for maintaining, delivering, or maintaining and delivering volatile compound(s) (i.e., insert) into an exemplary device/insert compartment.

Figure 23:
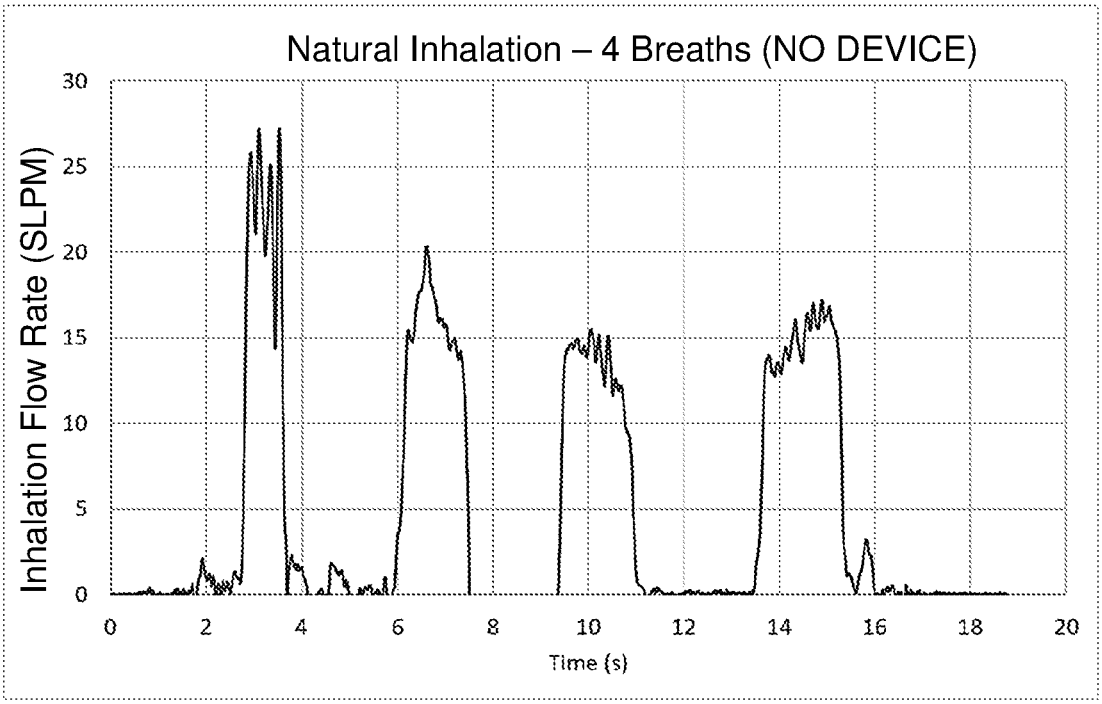

FIG. 23 is a graph of the results of an analysis of natural airflow delivery measured from an airflow control test illustrating typical inhalation measurements that are relevant to airflow force applied to passive cold diffusion devices of the invention.

Figure 24:
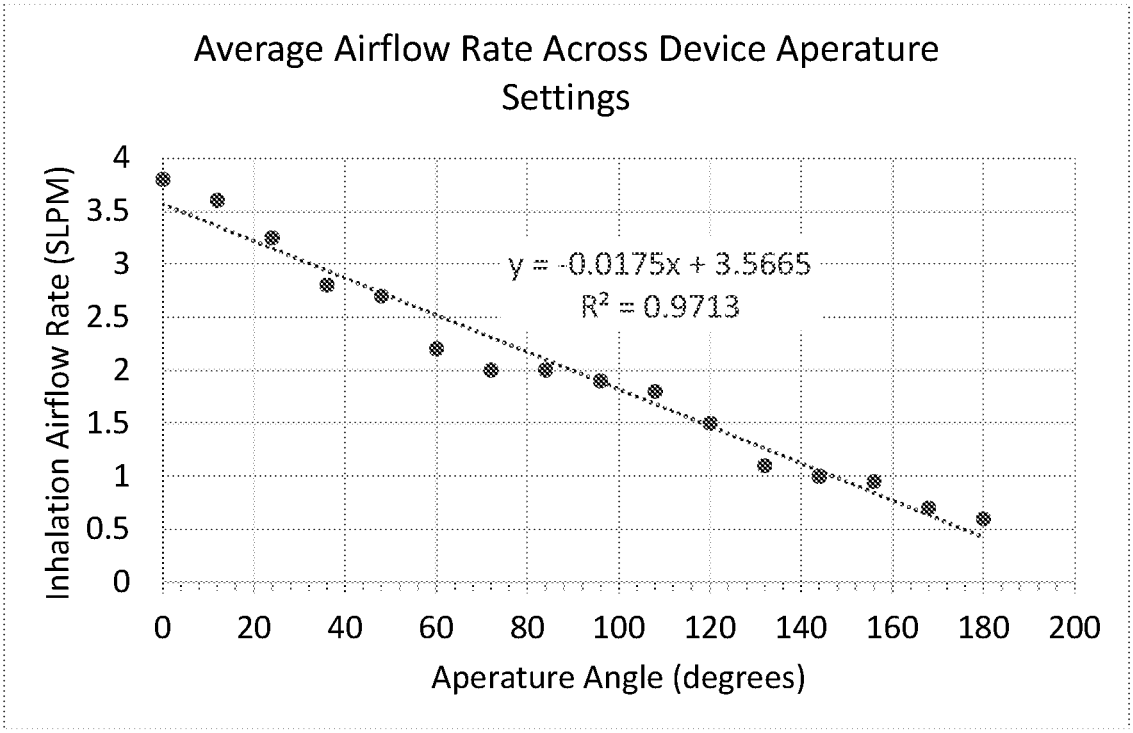

FIG. 24 is a graph illustrating the results of an analysis of average flow rates of air through a delivery device set across a spectrum of delivery device airflow control settings.

Figure 25A:
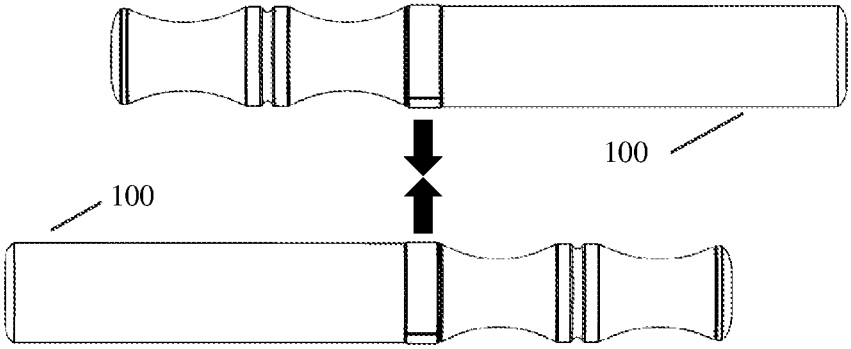

FIG. 25A provides a perspective view of an exemplary embodiment of a first exemplary delivery device (shown assembled) and a second exemplary delivery device (shown assembled), each comprising an engagement mechanism embodied as a magnet, wherein the delivery devices are oriented such that their internal magnets attract, demonstrating that the polar orientation of the magnet within each device is the same.

Figure 25B:
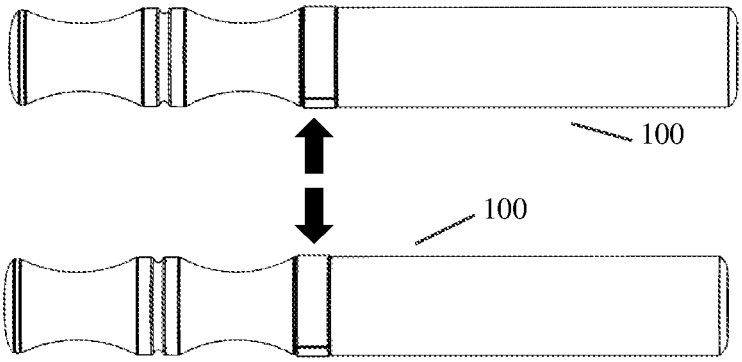

FIG. 25B provides an exemplary embodiment of a first exemplary delivery device (shown assembled) and a second exemplary delivery device (shown assembled), each comprising an engagement mechanism embodied as a magnet, wherein the delivery devices are oriented such that their internal magnets repel, demonstrating that the polar orientation of the magnet within each device is the same.

Figure 25C:
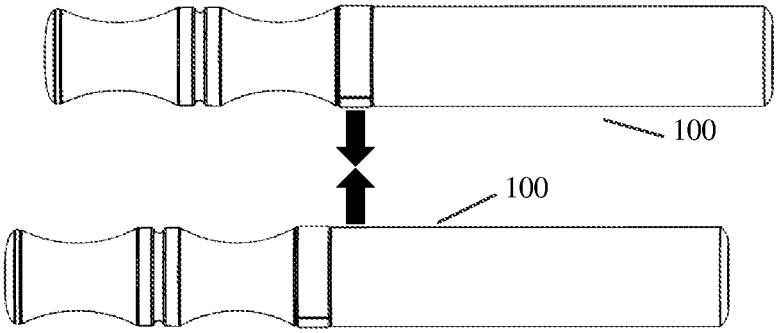

FIG. 25C provides a view of an exemplary embodiment of a first exemplary deliver device (shown assembled) and a second exemplary delivery device (shown assembled), each comprising an engagement mechanism embodied as a magnet, wherein the delivery devices are oriented such that their internal magnets attract, demonstrating that the polar orientation of the magnet within each device is the same.

Figure 26A:
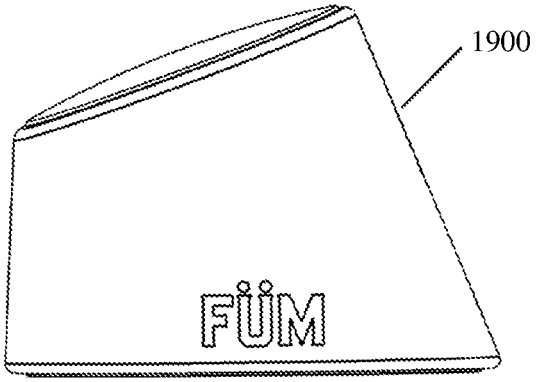

FIG. 26A provides a view of an exemplary embodiment of a delivery device support unit, exemplified as an exemplary device stand, viewed from a first perspective.

Figure 26B:
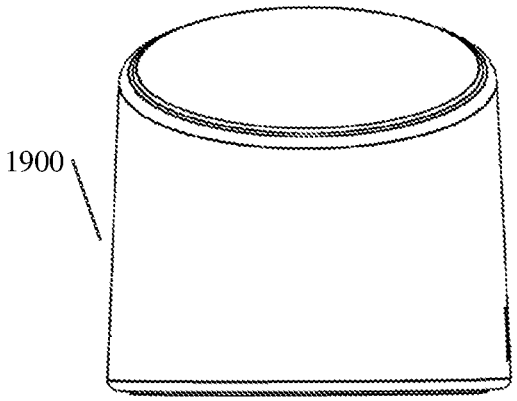

FIG. 26B provides a view of exemplary embodiment of a delivery device support unit, exemplified as an exemplary device stand, viewed from a second perspective.

Figure 26C:
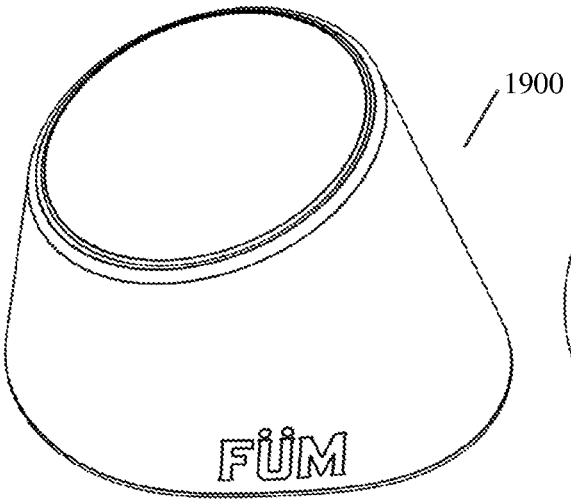

FIG. 26C provides a depiction of an exemplary embodiment of a delivery device support unit, exemplified as an exemplary device stand, viewed from a third perspective.

Figure 26D:
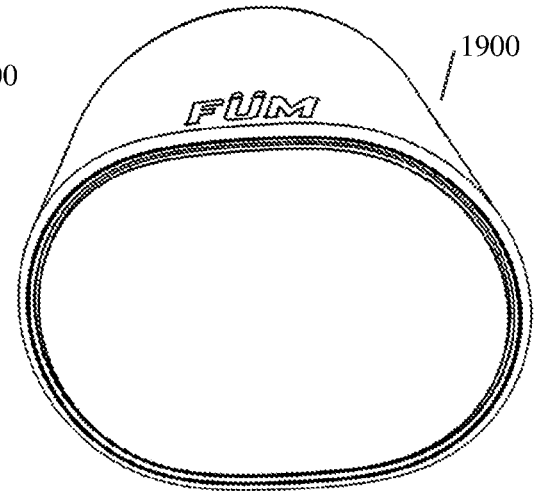

FIG. 26D illustrates an exemplary embodiment of a delivery device support unit, exemplified as an exemplary device stand, viewed from a fourth perspective.

Figure 27A:
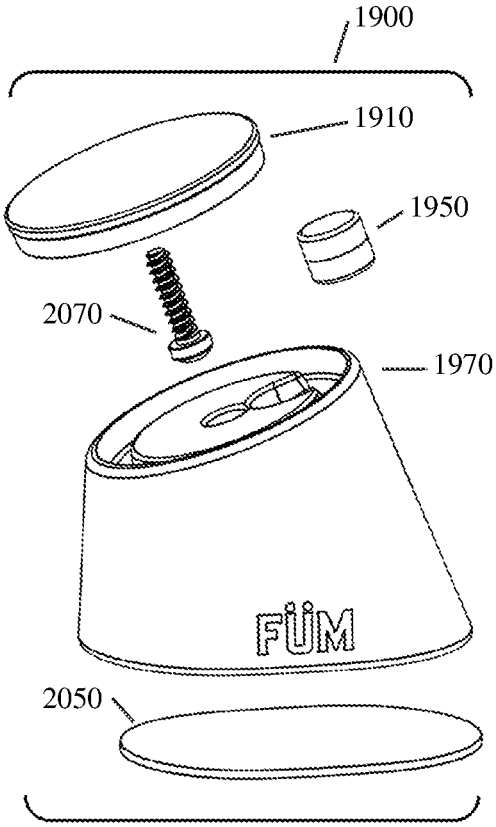

FIG. 27A provides an exploded view of an exemplary embodiment of a delivery device support unit, exemplified as an exemplary device stand, viewed from a first perspective.

Figure 27B:
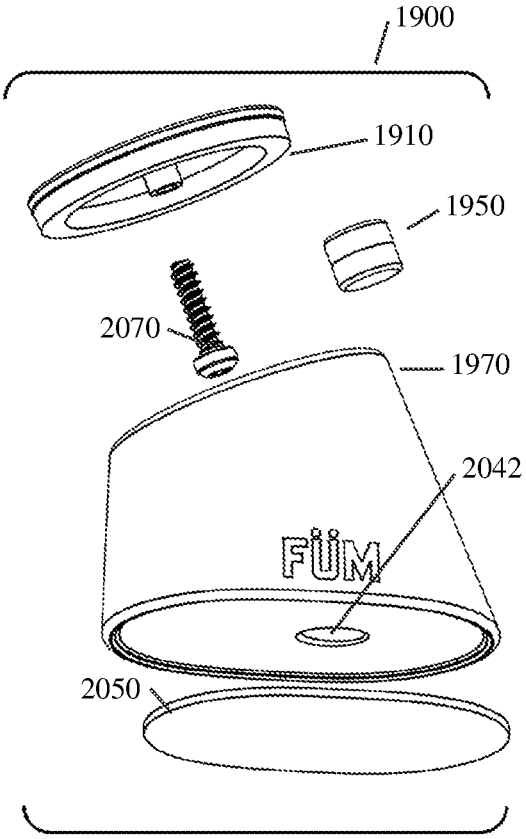

FIG. 27B provides an exploded view of an exemplary embodiment of a delivery device support unit, exemplified as an exemplary device stand, viewed from a second perspective.

Figure 28A:
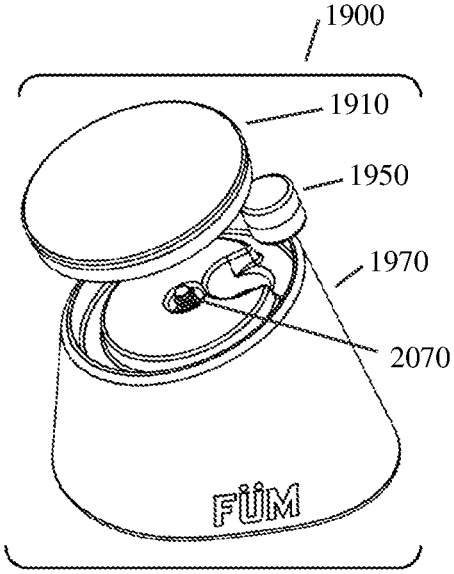

FIG. 28A provides an exploded view of an exemplary embodiment of a delivery device support unit, exemplified as an exemplary device stand, with components close to the position they can occupy when the device stand is fully assembled, viewed from a first perspective.

Figure 28B:
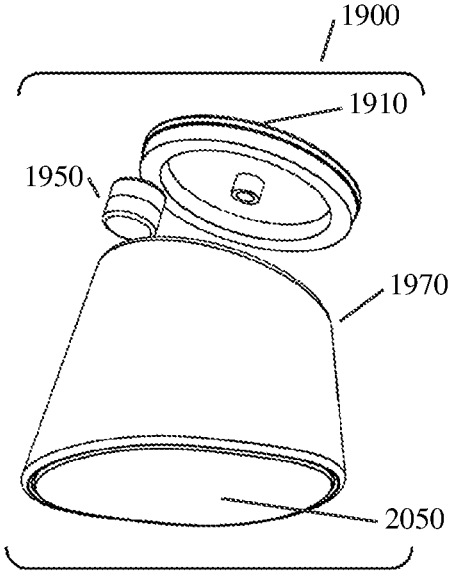

FIG. 28B provides an exploded view of an exemplary embodiment of a delivery device support unit, exemplified as an exemplary device stand, with components close to the position they can occupy when the device stand is fully assembled, viewed from a second perspective.

Figure 29A:
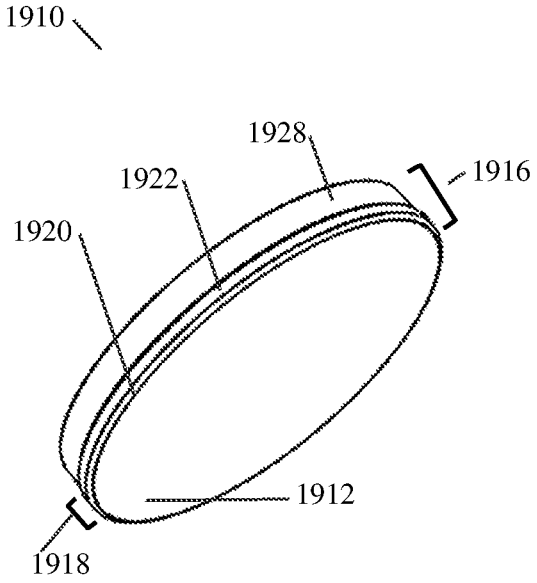

FIG. 29A provides an exemplary embodiment of a device stand device reception component according to a first view.

Figure 29B:
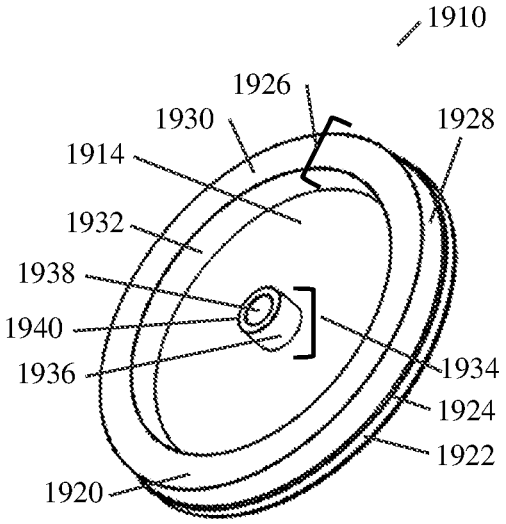

FIG. 29B provides an exemplary embodiment of a device stand device reception component according to a second view.

Figure 30:
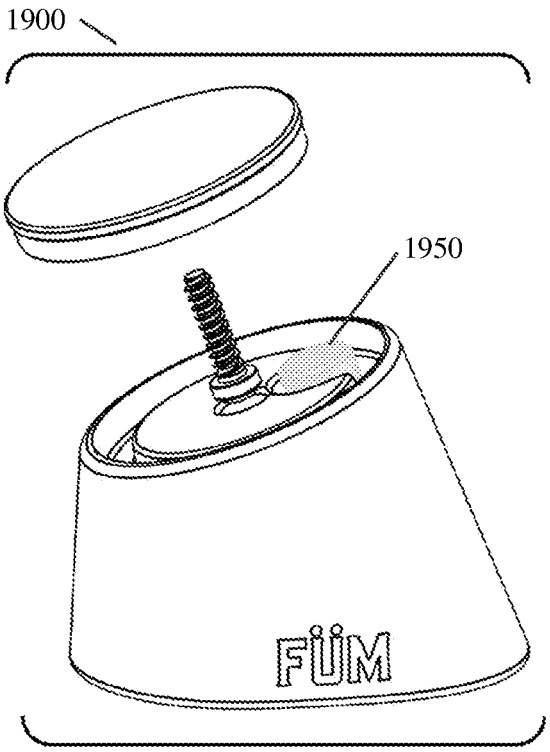

FIG. 30 provides an exploded view of an exemplary embodiment of a delivery device support unit, exemplified as an exemplary device stand, identifying an exemplary location of an exemplary device support unit-device engagement mechanism, exemplified as a magnet.

Figure 31A:
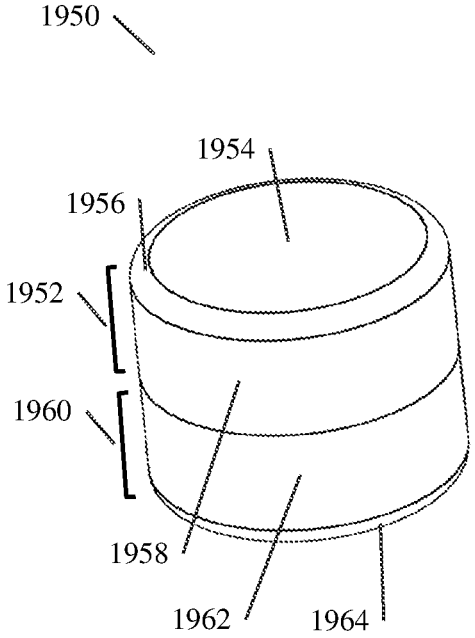

FIG. 31A provides an exemplary embodiment of a device support unit-device connection mechanism, exemplified as a magnet, according to a first view.

Figure 31B:
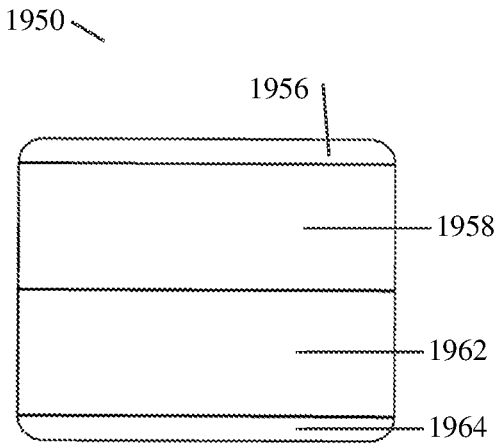

FIG. 31B provides an elevated view of exemplary embodiment of a device support unit-device connection mechanism, exemplified as a magnet.

Figure 31C:
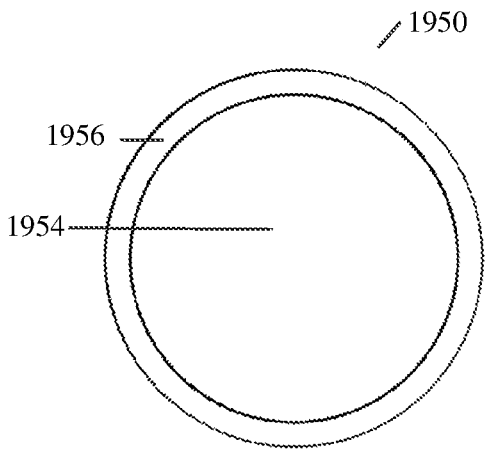

FIG. 31C provides a top view of exemplary embodiment of a device support unit-device connection mechanism, exemplified as a magnet.

Figure 32A:
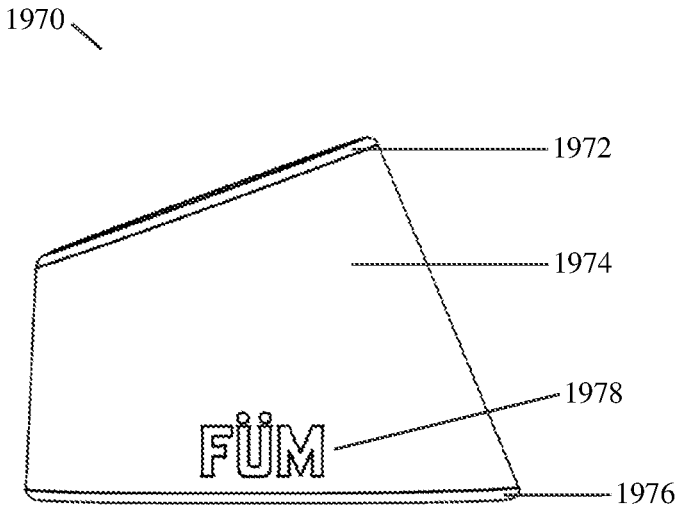

FIG. 32A shows an exemplary device stand base in a perspective view.

Figure 32B:
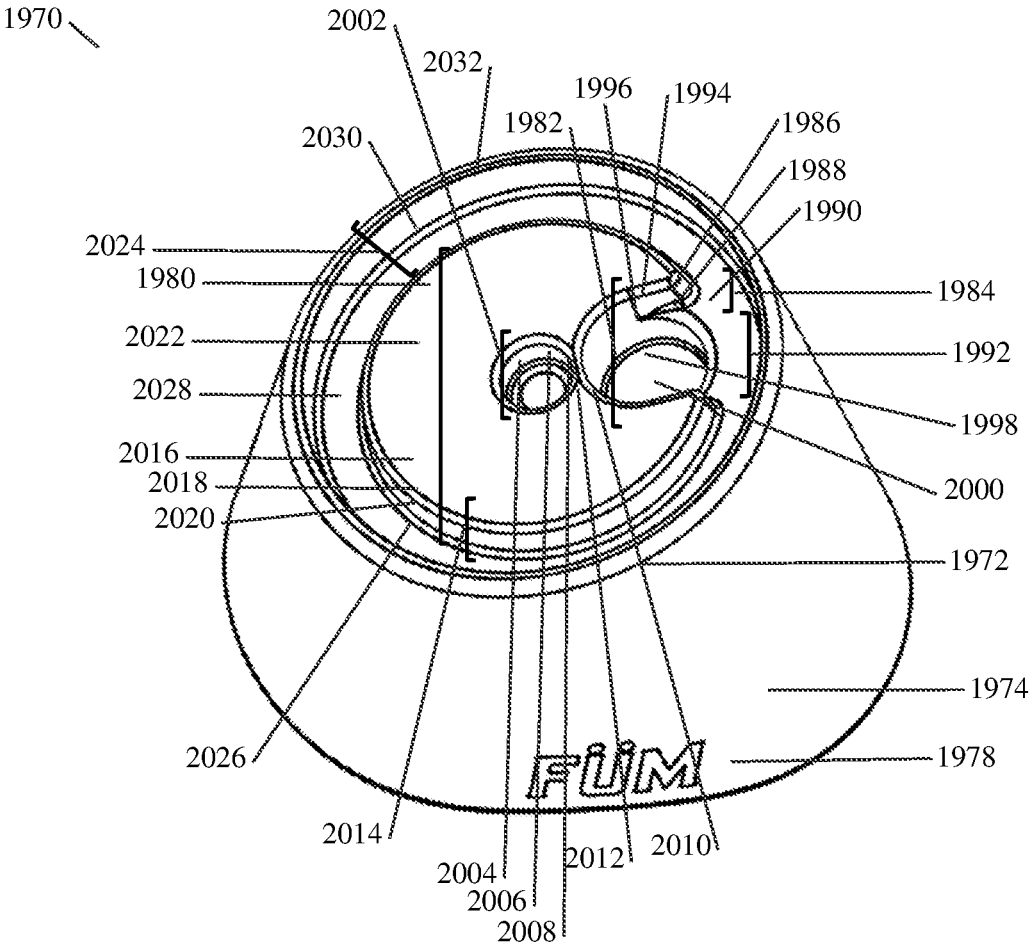

FIG. 32B provides an exemplary embodiment of a device stand base according to a different perspective view.

Figure 32C:
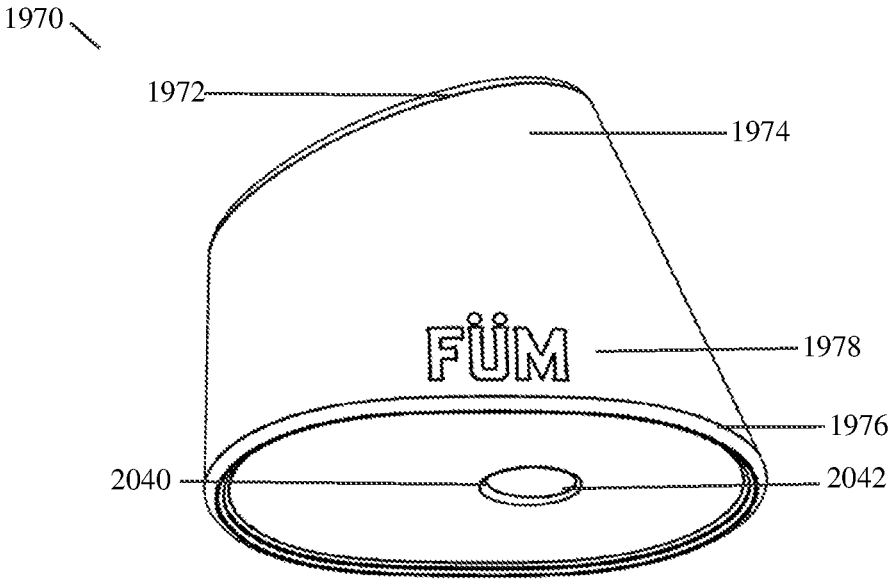

FIG. 32C provides an exemplary embodiment of a device stand base according to another perspective view.

Figure 33:
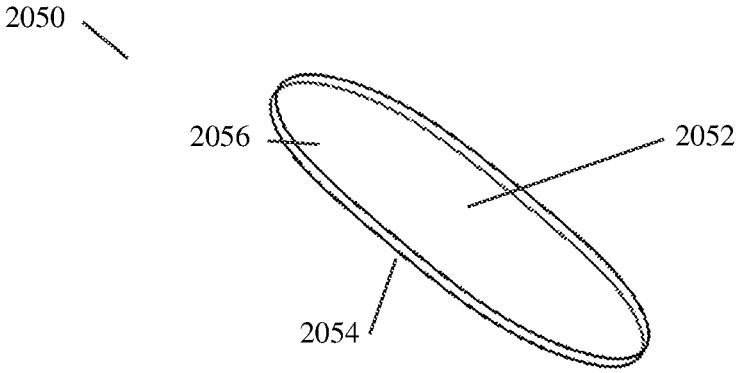

FIG. 33 illustrates an exemplary embodiment of a protection component of a device support unit, exemplified as a device stand pad.

Figure 34:
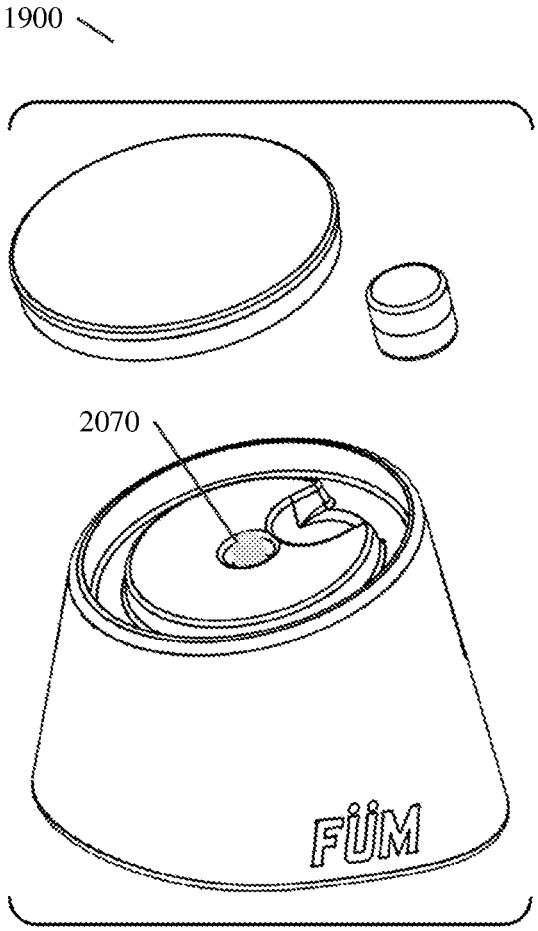

FIG. 34 provides an exploded view of an exemplary embodiment of a device support unit, exemplified as a device stand, identifying the placement of an exemplary device support unit (e.g., a device stand) connector component, exemplified as a screw.

Figure 35A:
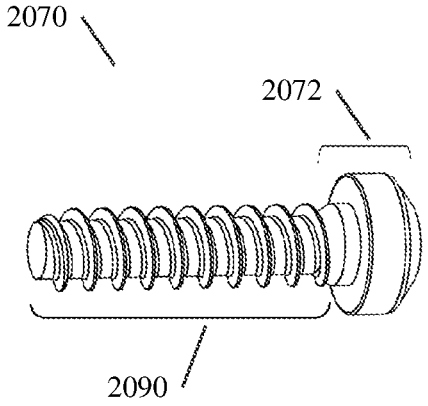

FIG. 35A provides an exemplary embodiment of a device support unit (e.g., a device stand) connector, exemplified as a screw, according to a first perspective.

Figure 35B:
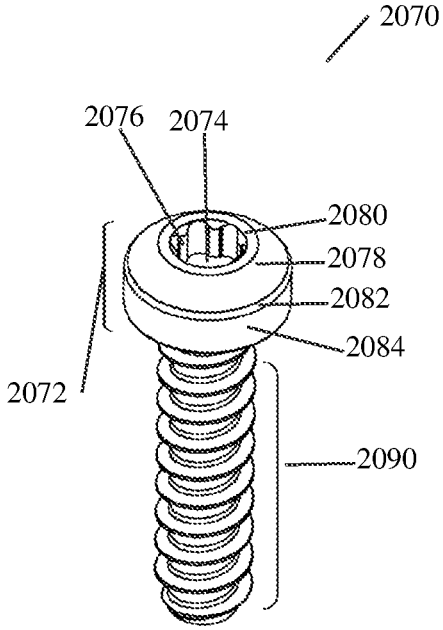

FIG. 35B provides an exemplary embodiment of a device support unit (e.g., a device stand) connector, exemplified as a screw, according to a second perspective.

Figure 35C:
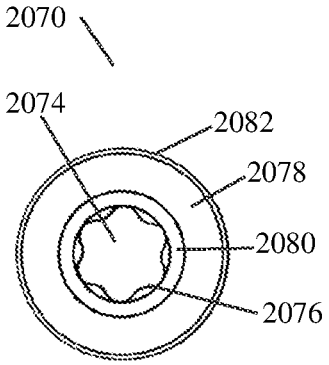

FIG. 35C provides an exemplary embodiment of a device storage unit (e.g., a device stand) connector, exemplified as a screw, according to a plan view.

Figure 35D:
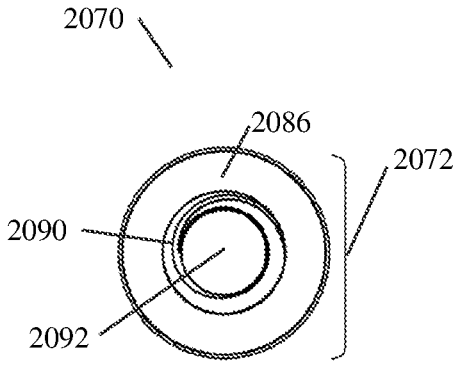

FIG. 35D provides an exemplary embodiment of a device storage unit (e.g., a device stand) connector, exemplified as a screw, according to a different plan view.

Figure 36:
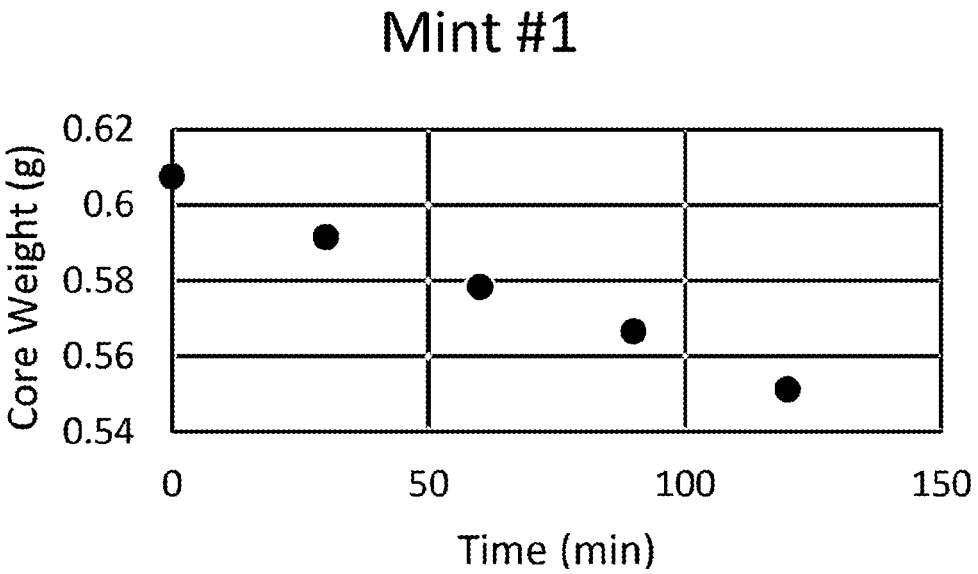

FIG. 36 is a graph exemplifying the weight over time of a volatile material maintaining/releasing component (insert) as volatilization of essential oil held therein occurred, according to trial 1 of the study described in Example 1.

Figure 37:
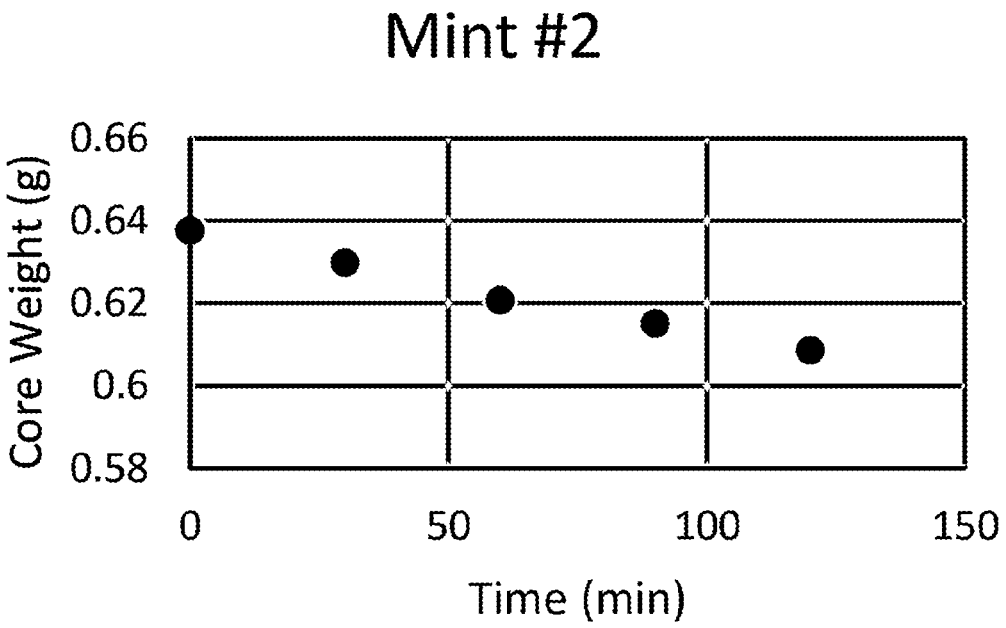

FIG. 37 is a graph exemplifying the weight over time of a volatile material maintaining/releasing component (insert) as volatilization of essential oil held therein occurred, according to trial 2 of the study described in Example 1.

Figure 38:
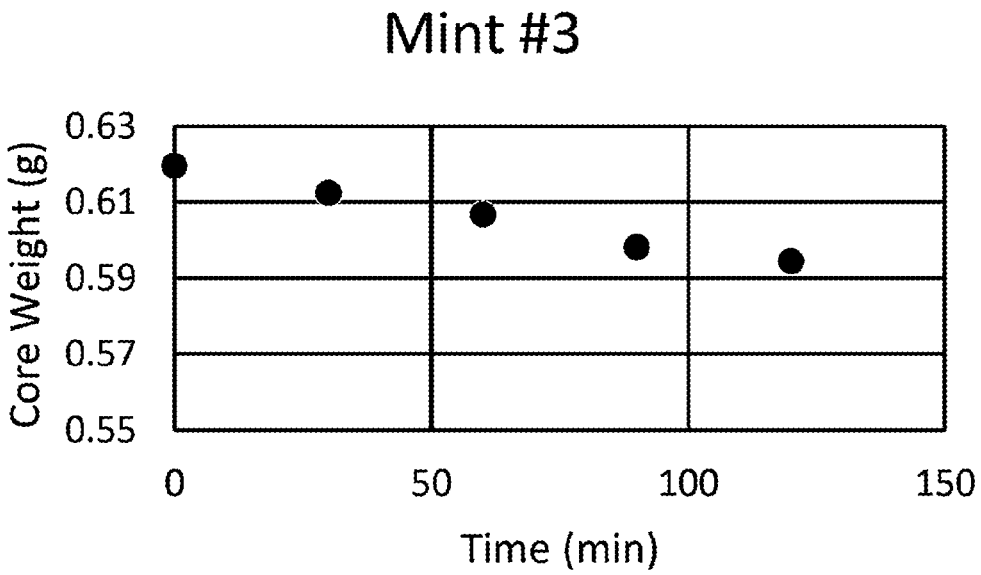

FIG. 38 is a graph exemplifying the weight over time of a volatile material maintaining/releasing component (insert) as volatilization of essential oil held therein occurred, according to trial 3 of the study described in Example 1.

Figure 39:
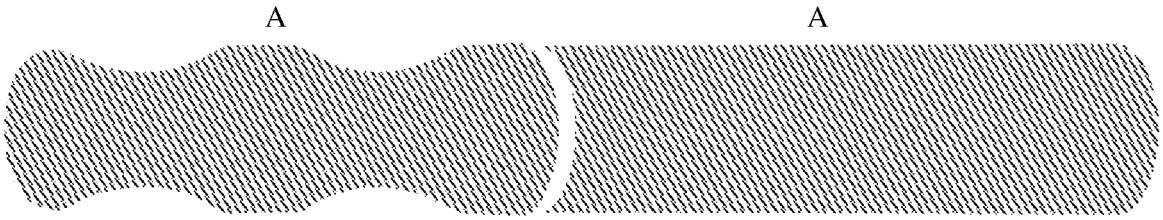

FIG. 39 is a representation that illustrates an example of the use of a single/uniform material use in an exemplary device of the invention.

Figure 40:
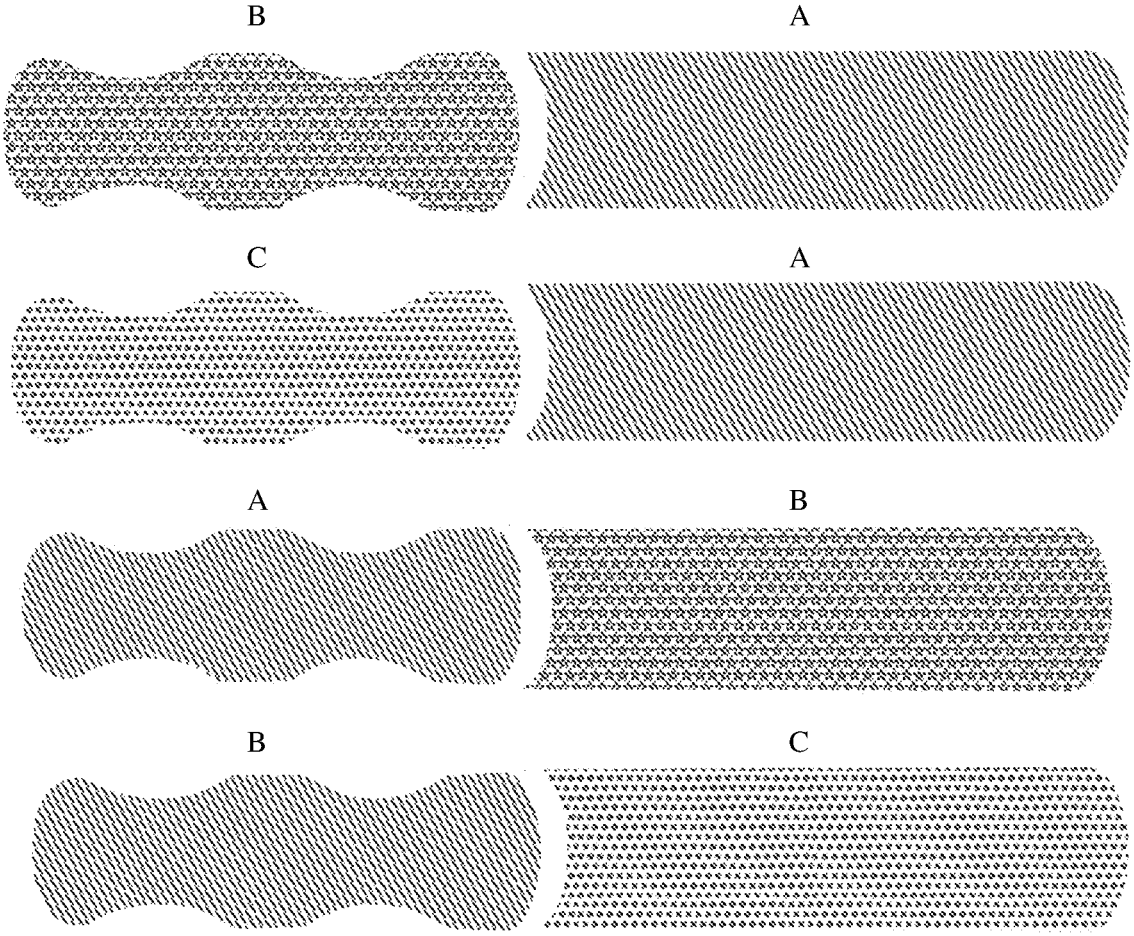

FIG. 40 is a representation that exemplifies the use of non-uniform materials in exemplary device(s) of the invention, wherein a single material is used for the same component across devices.

Figure 41:
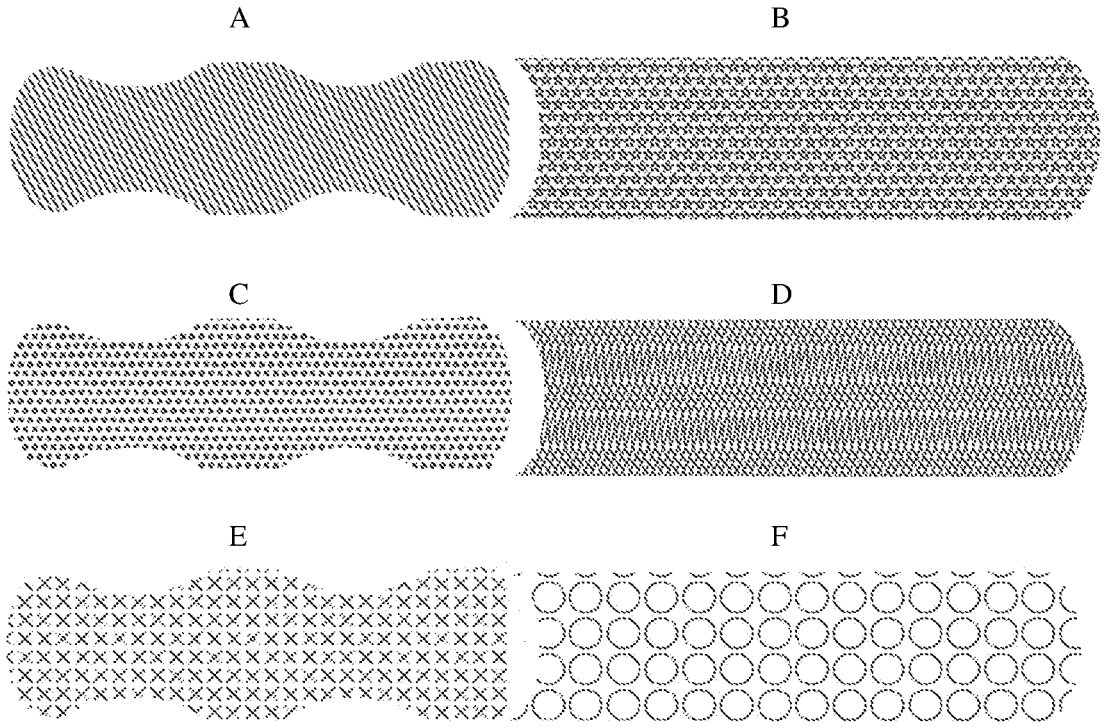

FIG. 41 is a representation that exemplifies non-uniform material use in exemplary device(s) of the invention, wherein material use in different components across the depicted devices varies.

EXEMPLARY ASPECTS OF THE INVENTION

The following is a non-limiting list of exemplary aspects of the invention, which illustrates embodiments of the invention in a summary form to aid readers in quickly understanding the overall scope of the invention. Presented in a manner somewhat like patent claims, the listed aspects described in the paragraphs of this section may refer to (depend on/from) one or more other paragraphs. Readers will understand that such references mean that the features/characteristics or steps of such referenced aspects are incorporated into/combined with the referring aspect. For example, if an aspect in a paragraph (e.g., a paragraph identified as aspect 4) refers to another aspect by one or more aspect numbers (e.g., aspect 1 or "any one of aspects 1-3"), it will be understood to include the elements, steps, or characteristics of such referenced aspects (e.g., aspect 1 or aspects 1-3) in addition to those of the aspect in which the reference is made (e.g., if aspect 4 refers to aspect 1, it provides a description of a composition, method, system, device, etc., including the features of both aspect 1 and aspect 4).

Lists of aspects describing specific exemplary embodiments of the invention are sometimes employed to aid the reader in understanding the invention. Such aspects can, within them, reference other exemplary aspects, either individually or as groups of aspects (e.g., via reference to a range within a list of numbered aspects when such aspects are provided as a numbered list). Reference to ranges of aspects should be interpreted as referencing all such aspects individually, each as unique embodiments of the invention, and in any combination with one another as unique embodiment(s) of the invention, according to the presentation provided of such aspects unless such an aspect within such a referenced range is either contradictory or non-sensical. Uncontradicted, elements described in any one or more aspects of a list of aspects of the invention can be combined with one or more elements of any one or more other aspects of the invention described herein.

Exemplary embodiments provided as illustrated figure(s)/drawing(s) provided herewith comprise numbered elements. Aspects(s) provided in an exemplary list of aspects provided herein can comprise numbered element(s) that can refer to certain part(s), component(s), device(s), or feature(s) thereof illustrated in the figures for sake of illuminating the scope of the invention by exemplification. Reference to such numbered element(s) should be interpreted as encompassing any embodiment(s) of such referenced element disclosed elsewhere herein but should not be interpreted as limited to the particular referenced element corresponding to the numbered element unless explicitly stated. For example, devices can comprise a volatile compound outlet component ("VCOC"), which may be exemplified in the figures as a "Body assembly," and the reference number of a particular illustrated Body assembly provided in an aspect, but the aspect should be interpreted as encompassing not only the depicted Body assembly, and not only any Body assembly, but any VCOC including all such Body assembly components.

In a first aspect, the invention provides a device for delivering one or more volatile compound(s), such as flavored volatile compound(s), the delivery device comprising a volatile compound outlet component and a volatile compound compartment, and optionally wherein the volatile compound compartment is a feature of an optional volatile compound outlet component extension. ASPECT 1.

In one aspect, the invention provides a device for delivering one or more volatile compound(s), the delivery device comprising a volatile compound outlet component, a volatile compound compartment, and a mating component, wherein optionally the volatile compound compartment is a feature of a volatile compound outlet component extension, and further wherein the mating component is designed to releasably engage with the volatile compound outlet component, volatile compound outlet component extension (when optionally present), volatile compound compartment, or any combination thereof. ASPECT 2.

In one aspect, the invention provides a device for delivering one or more volatile compound(s), the delivery device comprising (1) a volatile compound outlet component, (2) a volatile compound compartment, (3) a mating component, and (4) an airflow limiter, wherein (a) optionally the volatile compound compartment is a feature of a volatile compound outlet component extension; (b) wherein the mating component is designed to releasably engage with the volatile compound outlet component, volatile compound outlet component extension (when optionally present), volatile compound compartment, or any combination thereof; or (c) both (a) and (b). ASPECT 3.

In one aspect, the invention provides a device for delivering one or more volatile compound(s), the delivery device comprising a volatile compound outlet component and a mating component releasably held together by a selectively releasable attachment mechanism, such that the volatile compound outlet component and mating component can be completely disengaged from one another or, alternatively, can be securely bound to one another, the delivery device further comprising an airflow restrictor, wherein the airflow restrictor is a selectable airflow restrictor, a controllable airflow restrictor, or both, and wherein the airflow limitation is controlled by the rotation of the volatile compound outlet component and the mating component relative to one another. ASPECT 4.

In one aspect, the invention provides a device for the delivery of one or more volatile compound(s), the delivery device comprising at least a first component, e.g., a volatile compound outlet component, and at least a second component, e.g., a mating component releasably bound together by a magnetic force. ASPECT 5.

In one aspect, the invention provides a device for the delivery of one or more volatile compound(s), the delivery device comprising at least one indicator, e.g., a visual indicator, tactile indicator, or an indicator operating as both a visual indicator and a tactile indicator, present on the exterior of the delivery device wherein the spatial orientation of the at least one indicator, e.g., one visual, tactile, or both indicator, indicates the spatial orientation of at least one component of the device which is not otherwise externally visible. ASPECT 6.

In one aspect, the invention provides a device for the delivery of one or more volatile compound(s), the delivery device comprising at least two indicators, e.g., tactilely discernable indicator(s), visually discernable indicators, or a combination of both tactilely and visually discernable indicators, present on the exterior of the delivery device, wherein the spatial orientation of at least one indicator, relative to at least one other indicator, provides an indication of at least one operational status of the device. ASPECT 7.

In one aspect, the invention provides a device for the delivery of one or more volatile compound(s), the delivery device comprising at least two indicators, e.g., at least two visually discernable indicators, at least two tactilely discernable indicators, or a combination of visually and tactilely discernable indicators present on the exterior of the device, wherein (a) the spatial orientation of at least one indicator indicates the spatial orientation of at least one component of the device which is not externally visible and (b) the spatial orientation of at least one indicator relative to at least one other indicator provides an indication of at least one operational status of the device. ASPECT 8.

In one aspect, the invention provides a device for the delivery of one or more volatile compound(s), the delivery device comprising at least three indicators, wherein at least one indicator is a visual indicator, at least one indicator is a tactile indicator, and at least one indicator is an audible indicator, wherein (a) the spatial orientation of at least one visual indicator, tactile indicator, or indicator operating as both a visual and tactile indicator indicates the spatial orientation of at least one component of the device which is not externally visible; (b) the spatial orientation of at least one visual indicator, tactile indicator, or indicator operating as both a visual and tactile indicator, relative to at least one other visual indicator, tactile indicator, or indicator operating as both a visual and tactile indicator, provides an indication of at least one operational status of the inhalation device; and (c) an audible indicator, an additional tactile indicator, or both an audible indicator and an additional tactile indictor indicate at least one operational status of the device, indicate a change in an operational status of a device, or both. ASPECT 9.

In aspects, the invention provides a device for the delivery of one or more volatile compound(s), the delivery device comprising an airflow control restrictor (airflow channel restrictor, airflow restrictor) wherein the airflow control restrictor is non-selectable. ASPECT 10.

In aspects, the invention provides a device for the delivery of one or more volatile compound(s), the delivery device comprising an airflow control restrictor (airflow channel restrictor) wherein the airflow control restrictor is selectable. ASPECT 11.

In aspects, the invention provides a device for the delivery of one or more volatile compound(s), the delivery device comprising an airflow control restrictor (airflow channel restrictor, airflow restrictor) wherein the airflow control restrictor is selectable and controllable/adjustable. ASPECT 12.

In aspects, the invention provides a device for the delivery of one or more volatile compound(s), the delivery device comprising an airflow control mechanism (airflow restrictor) wherein the airflow control mechanism is controllable, e.g., adjustable according to pre-defined increments. ASPECT 13.

In aspects, the invention provides a device for the delivery of one or more volatile compound(s), the delivery device comprising a total airflow channel through the device and a controllable, i.e., an adjustable, airflow restrictor, wherein the adjustable airflow restrictor comprises a closure mechanism capable of at least substantially blocking the total airflow channel at least one location across its total length, the closure mechanism comprising at least three distinct airflow control settings, and wherein moving from any first airflow control setting to any second airflow control setting provides a pre-determined increase or pre-determined decrease in airflow through the device. ASPECT 14.

In aspects, the invention provides a device for the delivery of one or more volatile compound(s), the delivery device comprising an airflow restrictor wherein the airflow restrictor comprises a first airflow limiter and a second airflow limiter at least partially separable from one another during operation of the device. ASPECT 15.

In aspects, the invention provides a device for the delivery of one or more volatile compound(s), the delivery device comprising an airflow restrictor adjustable by the movement of a first airflow limiter relative to a second airflow limiter, wherein (a) the movement of the first airflow limiter relative to the second airflow limiter is a relational movement, (b) the movement of the first airflow limiter relative to the second airflow limiter is a concurrent or associated relational movement, (c) the movement of the first airflow limiter relative to the second airflow limiter is a rotational movement and, optionally, the rotation of the first airflow limiter relative to a second airflow limiter can comprise a rotation of 360 degrees, or (d) any one, combination of two or more, or all of (a)-(c) are true. ASPECT 16.

In aspects, the invention provides a device for the delivery of one or more volatile compound(s), the delivery device comprising an airflow restrictor for establishing airflow control setting(s), the airflow restrictor comprising a first airflow limiter and a second airflow limiter, each of the first airflow limiter and the second airflow limiter having an amount of interface with the other at each airflow control setting, and wherein the amount of interface between the first airflow limiter and the second airflow limiter decreases between any first airflow control setting and any second airflow control setting compared to the amount of interface between the first and second airflow limiters at any first or second airflow control setting. ASPECT 17.

In one aspect, the invention provides a device for the delivery of one or more volatile compound(s), the delivery device comprising a controllable, i.e., an adjustable, airflow restrictor wherein a change between any first airflow control setting and any second airflow control setting of the delivery device is accompanied by a tactile indicator (accompanied by a tactile indication of a change in the airflow control setting). ASPECT 18.

In one aspect, the invention provides a device for the delivery of one or more volatile compound(s), the delivery device comprising a controllable, i.e., an adjustable, airflow restrictor having two distinct tactile indicators differentiating between a maximally closed airflow control setting and a partially open airflow control setting. ASPECT 19.

In one aspect, the invention provides a device for the delivery of one or more volatile compound(s), the delivery device comprising an internal compartment designed to hold a solid, infusible, or solid and infusible material device (i.e., insert) comprising one or more volatile compound(s), wherein the internal compartment has at least one dimension which is at least half as long as the longest dimension of the solid material device. ASPECT 20.

In one aspect, the invention provides a device for the delivery of one or more volatile compound(s) comprising an internal compartment designed to hold an insert device capable of maintaining, releasing, or maintaining and releasing one or more of the volatile compound(s), wherein the internal compartment completely surrounds (or encompasses) at least a first portion of the insert device and wherein the internal compartment only partially surrounds (or encompasses) at least a second portion of the insert device. ASPECT 21.

In one aspect, the invention provides the device of one or more of aspects 1-21, wherein when fully assembled and ready for use, the device has a length of between about 90 mm and about 120 mm, such as between about 100 mm and about 110 mm. ASPECT 22.

In one aspect, the invention provides the device of one or more of aspects 1-22, wherein the device comprises a first component and a second component releasably engageable with one another, wherein the length of the first device component is between about X and about Y, the length of a second device component is between about X and about Y, and when the first component and second component are releasably engaged with one another, the device is ready for use and has a length of between about X and about Y. ASPECT 23.

In one aspect, the invention provides the device of one or more of aspects 1-23, wherein the device comprises a first component (volatile compound outlet component) and a second component (mating component), and further wherein the second (mating) component is designed to at least partially mate with the first component when the device is ready for operation. ASPECT 24.

In one aspect, the invention provides the device of one or more of aspects 1-24, wherein the device comprises a first component (volatile compound outlet component) and a second component (mating component) which are selectively separable from one another. ASPECT 25.

In one aspect the invention provides the device of aspect 25, wherein the selective separation can be a complete separation (a) under any device configuration or (b) when the device is in at least one specific configuration, such as, e.g., when a first component (volatile compound outlet component) and a second component (mating component) are positioned in a specific orientation relative to one another. ASPECT 26.

In one aspect, the invention provides the device of one or both of aspect 25 and aspect 26, wherein the selective separation is not a complete, 100% separation of the first component (volatile compound outlet component) and the second component (mating component), such that the selective separation is characterizable as a partial separation. ASPECT 27.

In one aspect, the invention provides the device of aspect 25, wherein the first component (volatile compound outlet component) and the second component (mating component) are movable, e.g., are slidable, relative to one another but wherein the first component (volatile compound outlet component) and the second component (mating component) are not completely (e.g., not 100%) separable from one another. ASPECT 28.

In one aspect, the invention provides the device of one or more of aspects 24-28, wherein the first and second components (volatile compound outlet component and mating component) are selectively attached to one another via a screw mechanism. ASPECT 29.

In one aspect, the invention provides the device of one or more of aspects 24-29, wherein the first and second components (volatile compound outlet component and mating component) are selectively attached to one another via magnetic attraction. ASPECT 30.

In one aspect, the invention provides the device of one or more of aspects 24-28, wherein the first and second components (volatile compound outlet component and mating component) are selectively attached to one another via a snap-fit mechanism (e.g., a mechanism similar to a pen and pen cap or a traditional snap, etc.). ASPECT 31.

In one aspect, the invention provides the device of one or more of aspects 1-31, wherein the device is non-electronic. ASPECT 32.

In one aspect, the invention provides the device of one or more of aspects 1-31, wherein the device is non-heating. ASPECT 33.

In one aspect, the invention provides the device of one or more of aspects 1-31, wherein the device is handheld. ASPECT 34.

In one aspect, the invention provides the device of one or more of aspects 1-31, wherein the device is any combination of any or all of non-electronic, non-heating, and handheld. ASPECT 35.

In one aspect, the invention provides the device of one or more of aspects 1-35, wherein the device comprises at least one component, feature, or portion which is not made of a metallic material and not made of a wood material. ASPECT 36.

In one aspect, the invention provides the device of aspect 36, wherein the device comprises at least one component, feature, or portion which is made of a disposable material. ASPECT 37.

In one aspect, the invention provides the device of one or both of aspect 36 and aspect 37, wherein the entirety of the device is made of a non-metallic, non-wood material. ASPECT 38.

In one aspect, the invention provides the device of aspect 38, wherein the entirety of the device is made of a disposable material. ASPECT 39.

In one aspect, the invention provides the device of one or more of aspects 36-39, wherein the non-metallic, non-wood, or disposable material is a plastic material; an organic material; a paper/dense paper material (e.g., a cardboard material); a biodegradable material; a recyclable material; a food grade material; a ceramic material; an acrylic material; or a combination of any or all thereof. ASPECT 40.

In one aspect, the invention provides the device of one or more of aspects 36-40, wherein at least one component, feature, or portion is made of a material which is at least detectably or significantly permeable to moisture. ASPECT 41.

In one aspect, the invention provides the device of one or more of aspects 36-41, wherein at least one of the at least one component, feature, or portion made of a material which is at least detectably or significantly permeable to moisture is lined, covered, or otherwise protected from moisture by a material which is not detectably or significantly permeable to moisture. ASPECT 42.

In one aspect, the invention provides the device of aspect 40, wherein the entirety of the device is made of a plastic material. ASPECT 43.

In one aspect, the invention provides the device of one or more of aspects 1-35, wherein the device comprises a first component (volatile compound outlet component) and a second component (mating component) which are at least generally, at least substantially, at least essentially, or which are made of the same material. ASPECT 44.

In one aspect, the invention provides the device of one or more of aspects 1-35, wherein the device comprises a first component (volatile compound outlet component) and a second component (mating component) which are made of a detectably or significantly different material. ASPECT 45.

In one aspect, the invention provides the device of aspect 45, wherein at least one first material is more or less permeable to moisture compared to at least one second material. ASPECT 46.

In one aspect, the invention provides the device of aspect 45 or aspect 46, wherein at least one first material is detectably or significantly denser (e.g., 1.5×, 2×, 3×, 5×, or more than 5× more dense) than at least one second material. ASPECT 47.

In one aspect, the invention provides the device of aspect 47, wherein at least one first material is at least about 5 times (5×), e.g., at least about 7 times (7×), at least about 10 times (10×), or at least about 11 times (11×) or 12 times (12×) denser than at least one second material. ASPECT 48.

In one aspect, the invention provides the device of one or more of aspects 44-48, wherein the first component, second component, or both the first and second components comprise a metallic material. ASPECT 49.

In one aspect, the invention provides the device of aspect 49, wherein the metallic material is stainless steel. ASPECT 50.

In one aspect, the invention provides the device of aspect 40 or aspect 50, wherein the stainless steel is polished stainless steel. ASPECT 51.

In one aspect, the invention provides the device of one or more of aspects 44-48, wherein the first component (volatile compound outlet component), second component (mating component), or both the first and second components (volatile compound outlet component and mating component) comprise an organic material, e.g., an organic material that is associated with measurably different stress reduction or other physiological changes than a metallic material, such as a mostly, generally only, essentially only, or entirely wood material. ASPECT 52.

In one aspect, the invention provides the device of one or more of aspects 45-52, wherein the first component (volatile compound outlet component) comprises, e.g., is made of or, e.g., comprises a component, feature, or portion made of stainless steel, and the second component (mating component) comprises, e.g., is made of or, e.g., comprises a component, feature, or portion made of wood. ASPECT 53.

In one aspect, the invention provides the device of one or more of aspects 1-53, wherein the device is designed for the delivery of one or more volatile compound(s) to the mouth of the device user. ASPECT 54.

In one aspect, the invention provides the device of one or more of aspects 1-54, wherein the device is designed for the delivery of one or more volatile compound(s) to the mouth of the device user by application of a suitable amount of suction force (a "suction force" such as an "oral suction") to a mouthpiece of the device. ASPECT 55.

In one aspect, the invention provides the device of one or more of aspects 1-55, wherein the device comprises at least a first component (volatile compound outlet component) and a second component (mating component) bound together by a selectively releasable engagement component. ASPECT 56.

In one aspect, the invention provides the device of aspect 56, wherein the selectively releasable engagement component is a rapidly releasable engagement component. ASPECT 57.

In one aspect, the invention provides the device of aspect 57, wherein the rapidly releasable engagement component is a rapidly releasable force component. ASPECT 58.

In one aspect, the invention provides the device of one or both of aspect 57 and aspect 58, wherein the rapidly releasable force component comprises a snap fit or magnetic attraction. ASPECT 59.

In one aspect, the invention provides the device of aspect 56, wherein the selectively releasable engagement component does not comprise a screw-fit mechanism. ASPECT 60.

In one aspect, the invention provides the device of one or more of aspects 56-60, wherein the first device component (volatile compound outlet component) comprises a mechanism, component, surface, or an embodiment of any or all thereof, comprising a portion, location, surface, component, or other element thereof that interfaces with a portion, location, surface, component or other element of a mechanism, component, surface or other such embodiment of the second device component (mating component) to maintain the first and second device components in selective, releasable engagement with one another. ASPECT 61.

In one aspect, the invention provides the device of one or more of aspects 58-61, wherein the selectively releasable force component is a magnetic force. ASPECT 62.

In one aspect, the invention provides the device of aspect 62, wherein the strength of the magnetic force is between about 1 gauss (0.0001 tesla) and about 2000 gauss (0.2 tesla). ASPECT 63.

In one aspect, the invention provides the device of aspect 63, wherein the strength of the magnetic force is between about 1 gauss (0.0001 tesla) and about 1000 gauss (0.1 tesla). ASPECT 64.

In one aspect, the invention provides the device of aspect 64, wherein the strength of the magnetic force is about 500 gauss (0.05 tesla). ASPECT 65.

In one aspect, the invention provides the device of aspect 62, wherein the strength of the magnetic force is sufficient to lift a weight of between Ig and about 500 g. ASPECT 66.

In one aspect, the invention provides the device of aspect 66, wherein the strength of the magnetic force is sufficient to lift a weight of between about 10 g and about 400 g. ASPECT 67.

In one aspect, the invention provides the device of aspect 67, wherein the strength of the magnetic force is sufficient to lift a weight of about 300 g. ASPECT 68.

In one aspect, the invention provides the device of one or more of aspects 62-68, wherein the magnetic force is provided by a magnet which is positioned within the device, e.g., the poles of the magnet are oriented within the device, such that the device interfaces in a predictable manner with one or more magnetic accessories. ASPECT 69.

In one aspect, the invention provides the device of one or more of aspects 56-68, wherein the selectively releasable engagement component is a rapidly releasable force mechanism operable with a single hand of a user, such that the first and second components of the device can be separated and re-attached repeatedly by the single hand (single hand movement(s)) of the user. ASPECT 70.

In one aspect, the invention provides the device of one or more of aspects 56-70, wherein the selectively releasable engagement component is a rapidly releasable force mechanism capable of providing an entertainment experience for the user separate from any volatile compound(s) delivery experience provided by the device. ASPECT 71.

In one aspect, the invention provides the device of one or more of aspects 1-71, wherein the device provides an experience, e.g., a manually-focused experience characterizable as a "fidget" experience, capable of detectably or significantly reducing one or more non-inhalation smoking habit-related craving(s) as measured or reported by the user or as measured by an appropriately conducted and powered trial or survey administered or conducted by suitably trained individual(s) recognized as capable of identifying reduction in addiction-related behavior. ASPECT 72.

In one aspect, the invention provides the device of aspect 72, wherein the manually-focused "fidget" experience is derived from (a) the rotation of the first component of the device (volatile compound outlet component) relative to the second component of the device (mating component), (b) the repeated disengagement and re-engagement of the first component of the device (volatile compound outlet component) relative to the second component of the device (mating component), or (c) any combination of (a) and (b). ASPECT 73.

In one aspect, the invention provides the device of one or more of aspects 1-73, wherein the device comprises a first component (volatile compound outlet component) and a second component (mating component) and wherein the first component (volatile compound outlet component) and the second component (mating component) are movable relative to one another. ASPECT 74.

In one aspect, the invention provides the device of aspect 74, wherein the first component of the device (volatile compound outlet component) comprises at least one visual indicator, tactile indicator, or an indicator discernable by both sight and touch, capable of indicating, alone or also or alternatively in combination with one or more additional visual indicator(s), tactile indicator(s), or indicator(s) discernable by both sight and touch, at least one operational characteristic of the device. ASPECT 75.

In one aspect, the invention provides the device of one or both of aspect 74 and aspect 75, wherein the second component of the device (mating component) comprises at least one visual indicator, tactile indicator, or an indicator discernable by both sight and touch, capable of indicating, alone or also or alternatively in combination with one or more additional visual indicator(s), tactile indicator(s), or indicator(s) discernable by both sight and touch, at least one operational characteristic of the device ASPECT 76.

In one aspect, the invention provides the device of one or more of aspects 74-76, wherein each of the first device component (volatile compound outlet component) and the second device component (mating component) comprise one or more visual indicator(s), tactile indicator(s), or indicator(s) discernable by both sight and touch. ASPECT 77.

In one aspect, the invention provides the inhalation device of one or more of aspects 74-77, wherein a visual indicator, tactile indicator, or an indicator discernable by both sight and touch, comprises a tick mark, intentional scratch, carving, engraved element, painted marking, stamped marking, protrusion, or any other type of visually observable, tactilely discernable, or observable and tactilely discernable marking such as, e.g., a line or other shape, detectably or significantly raised/elevated surface, number, letter, symbol, or collection of letters, numbers, or symbols (e.g., a word, name, or other product identifier), or image. ASPECT 78.

In one aspect, the invention provides the device of one or more of aspects 74-78, wherein at least one visual indicator, tactile indicator, or an indicator discernable by both sight and touch, of the device is detectably or significantly different from at least one other visual indicator, tactile indicator, or an indicator discernable by both sight and touch, of the device. ASPECT 79.

In one aspect, the invention provides the device of aspect 79, wherein at least one visual indicator, tactile indicator, or an indicator discernable by both sight and touch, is a depressed or elevated tick mark and at least one visual indicator, tactile indicator, or an indicator discernable by both sight and touch, is a product logo. ASPECT 80.

In one aspect, the invention provides the device of one or more of aspects 74-80, wherein the spatial orientation of one or more indicator(s) on the first component of the device (volatile compound outlet component), when interpreted alone, in relation to the positioning of one or more indicator(s) on the second component (mating component), or both, indicate(s) one or more operational characteristics of the device. ASPECT 81.

In one aspect, the invention provides the device of aspect 81, wherein the positioning of one or more indicator(s) on the first component of the device (volatile compound outlet component) indicate(s) the spatial orientation of one or more component(s) of the device which is/are not externally visible. ASPECT 82.

In one aspect, the invention provides the device of one or both of aspect 81 and aspect 82, wherein the positioning of one or more indicator(s) on the first component of the device (volatile compound outlet component), when interpreted in relationship to the positioning of one or more indicator(s) on the second component of the device (mating component), indicate the operational status of an airflow control mechanism present within the device, e.g., the degree to which the device is open to airflow therethrough. ASPECT 83.

In one aspect, the invention provides the device of one or more of aspects 74-83, wherein the device comprises at least two externally positioned indicators that, when the device is in a ready to use state, provide an indication of at least two operational characteristics of the device. ASPECT 84.

In one aspect, the invention provides the device of aspect 84, wherein at least one of the operational characteristics is the spatial orientation of a component of the device which is not externally visible. ASPECT 85.

In one aspect, the invention provides the device of aspect 85, wherein the component of the device which is not externally visible is a component that participates in maintaining a removable insert capable of maintaining, releasing, or maintaining and releasing one or more volatile compounds during use of the device. ASPECT 86.

In one aspect, the invention provides the device of one or more of aspects 84-86, wherein at least one of the operational characteristics is an indication of the status of an airflow control mechanism of the inhalation device. ASPECT 87.

In one aspect, the invention provides the device of any one or more of aspects 74-87, wherein the first device component (volatile compound outlet component) and second device component (mating component) are rotatable relative to one another, and wherein the device further comprises an airflow restrictor comprising at least two airflow limiters, and wherein rotation of the first device component (volatile compound outlet component) relative to the second device component (mating component), rotation of one airflow limiter relative to another airflow limiter, or both, is accompanied by a tactile indicator indicating such movement, an audible indicator indicating such movement, or both. ASPECT 88.

In one aspect, the invention provides the device of aspect 88, wherein there is one distinct tactile indicator, one distinct audible indicator, or both one distinct tactile indicator and one distinct audible indicator which is demonstrated within any single 360 degree rotation of the first device component (volatile compound outlet component) relative to the second device component (mating component), rotation of one airflow limiter relative to another airflow limiter, or both. ASPECT 89.

In one aspect, the invention provides the device of aspect 89, wherein the distinct tactile indicator, the distinct audible indicator, or both indicate a specific operational status of the device. ASPECT 90.

In one aspect, the invention provides the device of aspect 90, wherein the operational status is a fully closed airflow restrictor. ASPECT 91.

In one aspect, the invention provides the device of one or more of aspects 1-91, wherein the device comprises a device stabilization feature which aids in the maintenance of a device in a stable position when placed on a separate surface and not in use. ASPECT 92.

In one aspect, the invention provides the device of aspect 92, wherein the device stabilization feature is a surface which is detectably or significantly raised such that it is tactilely discernable by human touch over that of surrounding surface area of the device, an area which is detectably or significantly flatter than that of surrounding surface area of the device, or both. ASPECT 93.

In one aspect, the invention provides the device of one or both of aspects 92 and 93, wherein the device stabilization feature prevents the device from non-preferably moving, e.g., rolling, when placed on a surface which, without such a feature, the device could non-preferably move, e.g., roll. ASPECT 94.

In one aspect, the invention provides the device of one or more of aspects 92-94, wherein the device stabilization feature further operates as a visual indicator having one or more of the feature(s) of a visual indicator described in one or more of aspects 74-87. ASPECT 95.

In one aspect, the invention provides the device of aspect 95, wherein the device comprises a visual indicator having an elevated surface compared to immediately adjacent device surface area(s) such that it is tactilely discernable by human touch, wherein the visual indicator provides one or more of the visual indicator function(s) described in one or more of aspects 74-87 and further serves to aid in the stable maintenance of the device when the device is placed on a separate, external surface and is not in use. ASPECT 96.

In one aspect, the invention provides the device of one or more of aspects 1-96, wherein the device comprises a volatile compound compartment which participates in the stable maintenance of or maintains an insert, e.g., a removable insert, therein, the insert being an insert capable of holding, releasing, or holding and releasing one or more volatile compounds. ASPECT 97.

In one aspect, the invention provides the device of aspect 97, wherein the device comprises a first component (volatile compound outlet component) and a second component (mating component) releasably engageable to one another by a selectively releasable engagement component, and wherein the volatile compound compartment is a component of or is attached to, directly or indirectly, the first component (volatile compound outlet component) of the device but which resides at least predominantly (e.g., at least ≥50%), at least generally (e.g., at least ≥75%), or at least substantially (e.g., at least ≥95%) within the second component (mating component) of the device when the first device component (volatile compound outlet component) and the second device component (mating component) are releasably engaged to one another by the selectively releasable engagement component. ASPECT 98.

In one aspect, the invention provides the device of aspect 98, wherein at least about 60% of the volatile compound compartment resides within the second device component (mating component) when the first device component (volatile compound outlet component) and the second device component (mating component) are releasably bound to one another by the selectively releasable engagement component. ASPECT 99.

In one aspect, the invention provides the device of aspect 99, wherein at least about 70% of the volatile compound compartment resides within the second device component (mating component) when the first device component (volatile compound outlet component) and the second device component (mating component) are releasably bound to one another by the selectively releasable engagement component. ASPECT 100.

In one aspect, the invention provides the device of aspect 100, wherein at least about 80% of the volatile compound compartment resides within the second device component (mating component) when the first device component (volatile compound outlet component) and the second device component (mating component) are releasably bound to one another by the selectively releasable engagement component. ASPECT 101.

In one aspect, the invention provides the device of aspect 101, wherein at least about 90% of the volatile compound compartment resides within the second device component (mating component) when the first device component (volatile compound outlet component) and the second device component (mating component) are releasably bound to one another by the selectively releasable engagement component. ASPECT 102.

In one aspect, the invention provides the device of aspect 102, wherein about 100% of the volatile compound compartment resides within the second device component (mating component) when the first device component (volatile compound outlet component) and the second device component (mating component) are releasably bound to one another by the selectively releasable engagement component. ASPECT 103.

In one aspect, the invention provides the device of one or more of aspects 97-103, wherein the component participating in the stable maintenance of, or which maintains, the insert is an internal component comprising at least one dimension which is at least half as long as the longest dimension of the insert. ASPECT 104.

In one aspect, the invention provides the device of aspect 104, wherein the volatile compound compartment comprises at least one dimension which is at least as long as the longest dimension of the insert. ASPECT 105.

In one aspect, the invention provides the device of aspect 105, wherein the volatile compound compartment comprises at least one dimension which is longer than the longest dimension of the insert. ASPECT 106.

In one aspect, the invention provides the device of one or more of aspects 97-106, wherein the volatile compound compartment comprises a compressible positioner capable of being both compressed by a force and applying an opposing force to such compression. ASPECT 107.

In one aspect, the invention provides the device of aspect 107, wherein the volatile compound compartment is an internal compartment, and the compressible positioner of or within the internal compartment aids in the stable maintenance of the insert within the internal compartment. ASPECT 108.

In one aspect, the invention provides the device of one or more of aspects 97-108, wherein the volatile compound compartment is an internal component characterizable as an internal compartment, and wherein the internal compartment maintains the insert having a first end and a second end within it by the application of opposing first and second forces to first and second ends of the insert. ASPECT 109.

In one aspect, the invention provides the device of aspect 109, wherein at least one of the opposing first and second forces is applied as a restoring force. ASPECT 110.

In one aspect, the invention provides the device of aspect 110, wherein at least one of the opposing first and second forces is induced only upon the application of a first opposing force. ASPECT 111.

In one aspect, the invention provides the device of one of aspects 109-111, wherein the first force applied to the first end of the insert is a restoring force and the second force is applied to the second end of the insert by a fixed positioner preventing movement of the insert in the direction of the applied restoring force. ASPECT 112.

In one aspect, the invention provides the device of aspect 112, wherein the fixed positioner comprises a thickness (e.g., depth) which is less than 100% of the depth of the internal component, e.g., internal compartment, participating in or maintaining the insert, less than 100% of the depth of the insert, or both. ASPECT 113.

In one aspect, the invention provides the device of aspect 113, wherein the fixed positioner comprises a thickness (e.g., depth) which is less than 75% of the depth of the volatile compound compartment (internal component, e.g., internal compartment), participating in or maintaining the insert, less than 75% of the depth of the insert, or both. ASPECT 114.

In one aspect, the invention provides the device of aspect 114, wherein the fixed positioner comprises a thickness (e.g., depth) which is less than 50% of the depth of the volatile compound compartment (internal component, e.g., internal compartment), participating in or maintaining the insert, less than 50% of the depth of the insert, or both. ASPECT 115.

In one aspect, the invention provides the device of aspect 115, wherein the fixed positioner comprises a thickness (e.g., depth) which is less than 25% of the depth of the volatile compound compartment (internal component, e.g., internal compartment), participating in or maintaining the insert, less than 25% of the depth of the insert, or both. ASPECT 116.

In one aspect, the invention provides the device of one or more of aspects 112-116, wherein the fixed positioner extends into an interior portion of the volatile compound compartment (internal component, e.g., internal compartment), which is not enclosed by a wall, e.g., a circumferentially disposed wall, of the volatile compound compartment (internal component (e.g., internal compartment)). ASPECT 117.

In one aspect, the invention provides the device of aspect 117, wherein the wall at least partially encloses the volatile compound compartment (internal component, e.g., internal compartment), and wherein exposed edges of the wall are sufficiently smoothed, rounded, or otherwise buffed or polished such that if such portions of the wall encounter one or more other component(s) of the device during user or operation of the device, no detectable or significant change to the wall occurs; e.g., no detectable or significant amount of material is removed from the wall due to the interface of the wall with one or more other component(s) of the device. ASPECT 118.

In one aspect, the invention provides the device of one or more of aspects 112-118, wherein the fixed positioner has at least two dimensions which join together in an orientation which is not 90 degrees. ASPECT 119.

In one aspect, the invention provides the device of aspect 119, wherein the non-90-degree orientation of the two dimensions facilitates the ease of entry, the smoothness of entry, or both the ease and smoothness of entry of an insert into the volatile compound compartment (internal component (i.e., internal compartment)). ASPECT 120.

In one aspect, the invention provides the device of one or more of aspects 98-120, wherein the volatile compound compartment (internal component (i.e., internal compartment)) is a component of the first component of the device (a volatile compound outlet component) and wherein, when the first component of the device (volatile compound outlet component) and second component of the device (mating component) are sufficiently separated from one another, an insert capable of holding, releasing, or holding and releasing one or more volatile compounds can be laterally inserted into and stably held by the exposed volatile compound compartment (internal component (i.e., exposed internal compartment)). ASPECT 121.

In one aspect, the invention provides the device of one or more of aspects 98-121, wherein the volatile compound compartment (internal component, e.g., internal compartment), stably maintains an insert therein when both the first device component (volatile compound outlet component) and the second device component (mating component) are separated from one another and when the first device component (volatile compound outlet component) and the second device component (mating component) are bound to one another by a releasable force mechanism. ASPECT 122.

In one aspect, the invention provides the device of one or more of aspects 1-122, wherein the device receives the insertion of an insert, the insert being capable of maintaining, releasing, or maintaining and releasing one or more volatile compounds, from a direction which does not correspond to, is not parallel to, or does not correspond to the long axis of the device. ASPECT 123.

In one aspect, the invention provides the device of one or more of aspects 1-123, wherein the device receives the insertion of an insert, the insert being capable of maintaining, releasing, or maintaining and releasing one or more volatile compounds, from a direction which is lateral to the long axis of the device. ASPECT 124.

In one aspect, the invention provides the device of one or more of aspects 97-124, wherein the volatile compound compartment is an internal compartment having a width, a depth, and a length, the length being the longest dimension of the volatile compound compartment, and wherein the volatile compound compartment receives an insert from a position lateral to its length via an opening in a wall defining the length of the volatile compound compartment which does not completely surround, i.e., does not completely circumferentially surround, the volatile compound compartment. ASPECT 125.

In one aspect, the invention provides the device of one or more of aspects 97-125, wherein the volatile compound compartment is an internal compartment comprising an interior defined by a wall, e.g., a circumferentially disposed wall, between a first end and a second end of the volatile compound compartment (internal compartment), wherein the wall is at least partially opened along at least one portion of the length between the first and second ends of the compartment exposing a portion of the interior of the volatile compound compartment (internal compartment) and which is complete, i.e., which fully encloses the volatile compound compartment (internal compartment), along at least one portion of the length between the first and second ends of the volatile compound compartment (compartment). ASPECT 126.

In one aspect, the invention provides the device of one or more of aspects 97-126, wherein the volatile compound compartment is a partially enclosed internal compartment such that when an insert is present in the compartment, at least a portion of the insert is completely surrounded by a wall, e.g., a circumferentially disposed wall, of the compartment and at least a portion of the insert is only partially surrounded by the wall of the compartment. ASPECT 127.

In one aspect, the invention provides the device of one or more of aspects 97-127, wherein the volatile compound compartment is an internal component, i.e., internal compartment, comprising a wall, e.g., a circumferentially disposed wall, defining a compartment interior, wherein the wall at least partially surrounds the insert when the insert is present within the compartment. ASPECT 128.

In one aspect, the invention provides the device of aspect 128, wherein the wall, i.e., circumferentially disposed wall, defining the volatile compound compartment (internal compartment) interior at least partially surrounds the removable insert along at least one portion of the insert but does not surround the entirety of the length of the insert. ASPECT 129.

In one aspect, the invention provides the device of aspect 129, wherein the positioning of a fixed positioner within the volatile compound compartment (internal compartment) provides for the positioning of an insert having a first end and a second end, when present within the volatile compound compartment (internal compartment), to be positioned such that at least one of the first and second ends of the insert is accessible via a portion of the volatile compound compartment (internal compartment) which is not fully enclosed by a wall, i.e., a circumferentially disposed wall, defining the interior of the volatile compound compartment (internal compartment). ASPECT 130.

In one aspect, the invention provides the device of aspect 129, wherein a fixed positioner within the volatile compound compartment (internal compartment) has a dimension, i.e., thickness or depth, which is sufficiently less than the depth of the volatile compound compartment (internal compartment) and the thickness of an insert such that when the insert is present in the volatile compound compartment (internal compartment) and is stably maintained in the volatile compound compartment (internal compartment) by a compressible positioner and the fixed positioner making contact with first end and second ends of the insert, respectively, a user of the device can access at least a portion of the second end of the insert. ASPECT 131.

In one aspect, the invention provides the device of aspect 129, wherein a fixed positioner within the volatile compound compartment (internal compartment) is positioned such that a detectable or significant space exists between an end of an insert, when present in the volatile compound compartment (internal compartment), and an edge of a partial opening in the volatile compound compartment (internal compartment) formed by the only partial surrounding of the removable insert by a wall, e.g., a circumferential wall defining the interior of the volatile compound compartment (internal compartment), such that at least a portion of the end of the removable insert contacting the fixed positioner can be accessed. ASPECT 132.

In one aspect, the invention provides the device of one or more of aspects 97-132, wherein the device comprises a volatile compound compartment (an internal compartment) having a width, a depth, and a length, the volatile compound compartment (internal compartment) further comprising (a) a compressible positioner capable of being both compressed by a force and applying an opposing force to such compression, and (b) a fixed positioner positioned opposite the compressible positioner of (a) within the volatile compound compartment (internal compartment), wherein (a) and (b) stably maintain an insert comprising or being capable of maintaining one or more volatile compounds and having a width, a depth (or, i.e., a thickness), a first end, and a second end when such an insert is inserted therebetween, wherein the fixed positioner of (b) has a dimension, e.g., thickness, which is sufficiently less than the depth of the volatile compound compartment (internal compartment) and the depth or thickness of the removable insert such that when an insert is present in the volatile compound compartment (internal compartment) and is stably maintained in the volatile compound compartment (internal compartment) by the compressible positioner (a) and the fixed positioner (b) making contact with the first end and second end of the insert respectively, a user of the device can access at least a portion of the second end of the insert with their finger to facilitate removal of the insert. ASPECT 133.

In one aspect, the invention provides the device of one or more of aspects 97-133, wherein the volatile compound compartment is an internal component not visible from the exterior of the device when the device is in a configuration ready for use, and wherein the spatial orientation of the volatile compound compartment is discernable by the spatial orientation of at least one visual indicator present on an external surface of the device. ASPECT 134.

In one aspect, the invention provides the device of one or more of aspects 97-134, wherein the volatile compound compartment (internal compartment) has a length and a width and height (or a diameter in embodiments wherein the volatile compound compartment is circular; in this list of aspects, "diameter" used to encompass width and height in embodiments where the compartment, a mouthpiece, or both, is non-circular), and wherein the diameter of the compartment is less than about 95% of the diameter of a volatile compound outlet component, e.g., a mouthpiece component, of the device at its narrowest dimension. ASPECT 135.

In one aspect, the invention provides the device of aspect 135, wherein the diameter of the volatile compound compartment (internal compartment) is less than about 90% of the diameter of a volatile compound outlet component, e.g., a mouthpiece component, of the device at its narrowest dimension. ASPECT 136.

In one aspect, the invention provides the device of aspect 136, wherein the diameter of the internal compartment is less than about 85% of the diameter of a volatile compound outlet component, e.g., a mouthpiece component, of the device at its narrowest dimension. ASPECT 137.

In one aspect, the invention provides the device of aspect 137, wherein the diameter of the internal compartment is less than about 80% of the diameter of a volatile compound outlet component, e.g., a mouthpiece component, of the device at its narrowest dimension. ASPECT 138.

In one aspect, the invention provides the device of aspect 138, wherein the diameter of the internal compartment is less than about 75% of the diameter of a volatile compound outlet component, e.g., a mouthpiece component, of the device at its narrowest dimension. ASPECT 139.

In one aspect, the invention provides the device of one or more of aspects 1-139, wherein the device comprises an adjustable airflow control mechanism (an airflow restrictor) comprising a first airflow limiter and a second airflow limiter and wherein the first and second airflow limiters are in releasable contact with one another during normal operation of the device. ASPECT 140.

In one aspect, the invention provides the device of aspect 140, wherein the airflow control mechanism (airflow restrictor) detectably or significantly establishes the flow of air, i.e., the amount of air, capable of flowing through an airflow path existing between an opening in the distal end of the device, opposite the proximal end identified by a mouthpiece component, and an opening in the proximal end of the device, i.e., an opening in the mouthpiece component, opposite the distal end of the device. ASPECT 141.

In one aspect, the invention provides the device of aspect 141, wherein the degree of interface between the first and second airflow limiters is modifiable in three or more discrete (non-gradual) increments. ASPECT 142.

In one aspect, the invention provides the device of one or more of aspects 140-142, wherein the amount of contact between the first airflow limiter and the second airflow limiter is reduced between any first and second airflow control setting compared to the amount of contact between the two airflow limiters when in any first and second airflow control setting(s). ASPECT 143.

In one aspect, the invention provides the device of one or more of aspects 140-143, wherein the first and second airflow limiters of the device can be completely separated from one another during operation of one or more features of the device. ASPECT 144.

In one aspect, the invention provides the device of one or more of aspects 140-144, wherein the device comprises a first component (volatile compound outlet component) and a second component (mating component) movable in relation to one another, and the adjustable airflow control mechanism (airflow restrictor) is controlled by the rotation of the first component (volatile compound outlet component) and the second component (mating component) relative to one another. ASPECT 145.

In one aspect, the invention provides the device of one or more of aspects 140-145, wherein the first airflow limiter and second airflow limiter of the airflow restrictor (airflow control mechanism) are rotatable in relation to one another, and further wherein the first component of the airflow control mechanism (first airflow limiter) comprises at least one element which alternatingly closely interfaces with, e.g., nests within, at least one element of the second component of the airflow control mechanism (second airflow limiter) and similarly the second component of the airflow control mechanism (second airflow limiter) comprises at least one element which alternatingly closely interfaces with, e.g., nests within, at least one element of the first component of the airflow control mechanism (first airflow limiter) as the first airflow limiter and the second airflow limiter of the airflow control mechanism (airflow restrictor) are rotated in relation to one another. ASPECT 146.

In one aspect, the invention provides the device of one or more of aspects 140-146, wherein the adjustable airflow restrictor (adjustable airflow control mechanism) comprises a first part and a second part (a first airflow limiter and a second airflow limiter) capable of rotating at least a full 360 degrees (e.g., at least one full rotation) in relation to one another. ASPECT 147.

In one aspect, the invention provides the device of aspect 147, wherein the at least 360-degree rotation includes within it three or more pre-determined, selectable, and distinct airflow control settings wherein moving from any first distinct airflow control setting to any second distinct airflow control setting provides a predetermined increase or decrease in airflow. ASPECT 148.

In one aspect, the invention provides the device of aspect 148, wherein the at least 360-degree rotation includes within it five or more pre-determined, selectable, and distinct airflow control settings wherein moving from any first distinct airflow control setting to any second distinct airflow control setting provides a predetermined increase or decrease in airflow. ASPECT 149.

In one aspect, the invention provides the device of aspect 149, wherein the at least 360-degree rotation includes within it ten (10) or more pre-determined, selectable, and distinct airflow control settings wherein moving from any first distinct airflow control setting to any second distinct airflow control setting provides a predetermined increase or decrease in airflow. ASPECT 150.

In one aspect, the invention provides the device of aspect 150, wherein the at least 360-degree rotation includes within it fifteen (15) or more pre-determined, selectable, and distinct airflow control settings wherein moving from any first distinct airflow control setting to any second distinct airflow control setting provides a predetermined increase or decrease in airflow. ASPECT 151.

In one aspect, the invention provides the device of one or more of aspects 147-151, wherein the at least 360-degree rotation includes within it a single distinct airflow control setting indicating full closure of the airflow control mechanism (airflow restrictor). ASPECT 152.

In one aspect, the invention provides the device of one or more of aspects 147-152, wherein the at least 360-degree rotation comprises within it (a) three or more distinct airflow control settings wherein moving from any first distinct airflow control setting to any second distinct airflow control setting provides a predetermined increase or decrease in airflow and (b) a single airflow control setting indicating full closure of the airflow control mechanism (airflow restrictor). ASPECT 153.

In one aspect, the invention provides the device of one or more of aspects 142-153, wherein the airflow rate is decreased by between about 0.01-1 standard liters per minute (SLPM) on average with each single airflow control setting adjustment increment. ASPECT 154.

In one aspect, the invention provides the device of aspect 154, wherein the airflow rate is decreased by between about 0.01-0.8 standard liters per minute (SLPM) on average with each single airflow control setting adjustment increment. ASPECT 155.

In one aspect, the invention provides the device of aspect 155, wherein the airflow rate is decreased by between about 0.05-0.6 standard liters per minute (SLPM) on average with each single airflow control setting adjustment increment. ASPECT 156.

In one aspect, the invention provides the device of aspect 156, wherein the airflow rate is decreased by between about 0.1-0.4 standard liters per minute (SLPM) on average with each single airflow control setting adjustment increment. ASPECT 157.

In one aspect, the invention provides the device of aspect 157, wherein the airflow rate is decreased by about 0.2 standard liters per minute (SLPM) on average with each single airflow control setting adjustment increment. ASPECT 158.

In one aspect, the invention provides the device of one or more of aspects 142-158, wherein the airflow rate is modified, e.g., either increased or decreased, by an amount of between about 1% and about 20% on average with each single airflow control setting adjustment increment. ASPECT 159.

In one aspect, the invention provides the device of aspect 159, wherein the airflow rate is modified, e.g., either increased or decreased, by an amount of between about 2% and about 18% on average with each single airflow control setting adjustment increment. ASPECT 160.

In one aspect, the invention provides the device of aspect 160, wherein the airflow rate is modified, e.g., either increased or decreased, by an amount of between about 5% and about 15% on average with each single airflow control setting adjustment increment. ASPECT 161.

In one aspect, the invention provides the device of aspect 161, wherein the airflow rate is modified, e.g., either increased or decreased, by an amount of between about 8% and about 13% on average with each single airflow control setting adjustment increment. ASPECT 162.

In one aspect, the invention provides the device of aspect 162, wherein the airflow rate is modified, e.g., either increased or decreased, by an amount of between about 10% and about 12% on average with each single airflow control setting adjustment increment. ASPECT 163.

In one aspect, the invention provides the device of aspect 163, wherein the airflow rate is modified, e.g., either increased or decreased, by an amount of about 11% on average with each single airflow control setting adjustment increment. ASPECT 164.

In one aspect, the invention provides the device of one or more of aspects 142-164, wherein with each single airflow control setting adjustment increment, the airflow rate is modified, e.g., either increased or decreased, by an amount of representing between about 1% and about 10% on average of the average maximum airflow through the device present when the airflow control mechanism (airflow restrictor) is in a maximally open configuration. ASPECT 165.

In one aspect, the invention provides the device of one or more of aspects 142-165, wherein with each single airflow control setting adjustment increment, the airflow rate is modified, e.g., either increased or decreased, by an amount of representing between about 2% and about 8% on average of the average maximum airflow through the device present when the airflow control mechanism (airflow restrictor) is in a maximally open configuration. ASPECT 166.

In one aspect, the invention provides the device of one or more of aspects 142-166, wherein with each single airflow control setting adjustment increment, the airflow rate is modified, e.g., either increased or decreased, by an amount of representing between about 3% and about 7% on average of the average maximum airflow through the device present when the airflow control mechanism (airflow restrictor) is in a maximally open configuration. ASPECT 167.

In one aspect, the invention provides the device of one or more of aspects 142-167, wherein with each single airflow control setting adjustment increment, the airflow rate is modified, e.g., either increased or decreased, by an amount of representing between about 4% and about 6% on average of the average maximum airflow through the device present when the airflow control mechanism (airflow restrictor) is in a maximally open configuration. ASPECT 168.

In one aspect, the invention provides the device of one or more of aspects 142-168, wherein with each single airflow control setting adjustment increment, the airflow rate is modified, e.g., either increased or decreased, by an amount of representing about 5% on average of the average maximum airflow through the device present when the airflow control mechanism (airflow restrictor) is in a maximally open configuration. ASPECT 169.

In one aspect, the invention provides the device of one or more of aspects 140-169, wherein the airflow control mechanism (airflow restrictor) is capable of decreasing the airflow through the device by between about 20% and about 100% on average when modified from its maximum airflow configuration (maximally open position) to its minimum airflow configuration (maximally closed position). ASPECT 170.

In one aspect, the invention provides the device of one or more of aspects 140-170, wherein the airflow control mechanism (airflow restrictor) is capable of decreasing the airflow through the device by between about 40% and about 95% on average when modified from its maximum airflow configuration (maximally open position) to its minimum airflow configuration (maximally closed position). ASPECT 171.

In one aspect, the invention provides the device of one or more of aspects 140-171, wherein the airflow control mechanism (airflow restrictor) is capable of decreasing the airflow through the device by between about 60% and about 90% on average when modified from its maximum airflow configuration (maximally open position) to its minimum airflow configuration (maximally closed position). ASPECT 172.

In one aspect, the invention provides the device of one or more of aspects 140-172, wherein the airflow control mechanism (airflow restrictor) is capable of decreasing the airflow through the device by between about 70% and about 85% on average when modified from its maximum airflow configuration (maximally open position) to its minimum airflow configuration (maximally closed position). ASPECT 173.

In one aspect, the invention provides the device of one or more of aspects 140-173, wherein the airflow control mechanism (airflow restrictor) is capable of decreasing the airflow through the device by between about 80% and about 85% on average when modified from its maximum airflow configuration (maximally open position) to its minimum airflow configuration (maximally closed position). ASPECT 174.

In one aspect, the invention provides the device of one or more of aspects 140-174, wherein the airflow control mechanism (airflow restrictor) is capable of decreasing the airflow through the device by about 84% on average when modified from its maximum airflow configuration (maximally open position) to its minimum airflow configuration (maximally closed position). ASPECT 175.

In one aspect, the invention provides the device of one or more of aspects 140-175, wherein modification of the airflow control mechanism (airflow restrictor) from any first airflow setting to any second airflow setting is accompanied by a tactile indicator of such a modification. ASPECT 176.

In one aspect, the invention provides the device of aspect 176, wherein the modification of the airflow control mechanism (airflow restrictor) from any first airflow setting to any second airflow setting is accompanied by one of two differentiable tactile indicators, one of two differentiable audible indicators, or both one of two differentiable tactile indicators and one of two differentiable audible indicators of such a modification. ASPECT 177.

In one aspect, the invention provides the device of aspect 177, wherein the device comprises a first airflow limiter and a second airflow limiter capable of rotating at least 360 degrees (e.g., at least one full rotation) in relation to one another, and further wherein one of the two differentiable tactile indicators, audible indicators, or both, accompanying the modification of the airflow control mechanism (airflow restrictor) from a first airflow setting to a second airflow setting is only experienced once in any 360 degree rotation of the first airflow limiter relative to the second airflow limiter. ASPECT 178.

In one aspect, the invention provides the device of aspect 178, wherein the tactile indication, audible indication, or both, occurring only once in any 360-degree rotation of the first airflow limiter relative to the second airflow limit occurs when the airflow control mechanism (airflow restrictor) is in a maximally closed position (e.g., allowing for minimum airflow through the device. ASPECT 179.

In one aspect, the invention provides the device of one or more of aspects 177-179, wherein the two differentiable tactile indicators, audible indicators, or both, are clicks, snaps, or other similar indicator of varying magnitude (e.g., a "large click" and a "small click" having a difference in decibels of between about 1 decibel and about 60 decibels) or a detectable or significant difference in the scale of movement or vibration. ASPECT 180.

In one aspect, the invention provides the device of one or more of aspects 140-180, wherein the device comprises a first component (volatile compound outlet component) and a second component (mating component) rotatable in relation to one another and each of the first and second components (volatile compound outlet component and mating component) comprise at least a portion visible on the exterior of the device, wherein the status of the airflow control mechanism (airflow restrictor) is indicated by (a) the positioning of one or more visual, tactile, or both visual and tactile indicators on the first component of the device (volatile compound outlet component) when interpreted in relationship to the positioning of one or more visual, tactile, or visual and tactile indicators on the second component of the device (mating component), (b) a tactile indicator, an auditory indicator, or both when the first component of the device (volatile compound outlet component) and the second component (mating component) of the device are rotated relative to one another, or (c) both (a) and (b). ASPECT 181.

In one aspect, the invention provides the device of one or more of aspects 140-181, wherein when the airflow control mechanism (airflow restrictor) is in a configuration representing its most open position, the airflow control mechanism (airflow restrictor) provides an airflow channel through at least one portion of the device having a cross sectional area which is about 40% to about 60% of the cross-sectional area of the airflow channel otherwise present in the device. ASPECT 182.

In one aspect, the invention provides the device of aspect 182, wherein when the airflow control mechanism (airflow restrictor) is in a configuration representing its most open position, the airflow control mechanism (airflow restrictor) provides an airflow channel through the device having a cross sectional area which is about 50% of the cross-sectional area of the airflow channel otherwise present in the device. ASPECT 183.

In one aspect, the invention provides the device of one or both of aspect 182 and aspect 183, wherein when the airflow control mechanism (airflow restrictor) is in a configuration representing its most open position, the airflow control mechanism (airflow restrictor) provides an airflow channel through the device providing for the flow of a volume of air which is about one half of the volume of air which would otherwise be able to flow through the device if the airflow control mechanism (airflow restrictor) were not present in the device. ASPECT 184.

In one aspect, the invention provides the device of one or more of aspects 128-184, wherein the control of airflow by the airflow control mechanism (airflow restrictor) through the device occurs distally from an insert maintaining volatile compound(s). ASPECT 185.

In one aspect, the invention provides the device of one or more of aspects 128-184, wherein the airflow control mechanism (airflow restrictor) is located at a position within a path of airflow through the device which is earlier than/prior to the encounter of air following the airflow path with volatiles released from an insert maintaining the volatile compound(s). ASPECT 186.

In one aspect, the invention provides the device of one or both of aspect 185 and aspect 186, wherein the airflow control mechanism (airflow restrictor) is positioned along an airflow path passing through the entirety of the device such that it establishes a reduced air pressure within the airflow path at the point where air of the airflow path encounters volatile compound(s) released by an insert maintained within the device compared to the air pressure of air prior to encountering the airflow control mechanism (airflow restrictor). ASPECT 187.

In one aspect, the invention provides the device of aspect 187, wherein the amount of volatile compound(s), e.g., flavored volatile compound(s), delivered to a user is increased compared to the amount of volatile compound(s), e.g., flavored volatile compound(s), delivered to a user by a similar device wherein the airflow control mechanism (airflow restrictor) is positioned within an airflow path such that the air of the airflow path first encounters the volatile compound(s) of an insert comprising such volatile compound(s) and subsequently encounters the airflow control mechanism. ASPECT 188.

In one aspect, the invention provides the device of one or more of aspects 1-139, wherein the device comprises an adjustable airflow control mechanism (airflow restrictor) comprising a first airflow limiter and a second airflow limiter and wherein the first and second airflow limiters move axially in relation to one another, e.g., move into and out of one another, during normal operation of the airflow control mechanism (airflow restrictor) of the device. ASPECT 189.

In one aspect, the invention provides the device of one or more of aspects 1-189, wherein the device comprises a first device component (volatile compound outlet component) and a second device component (mating component) releasably bound to one another by a releasable engagement component, and wherein the total length of the device when the first and second device components (volatile compound outlet component and mating component) are bound to one another is no more than about 80% of the total length of each of the first component and the second component independently added together. ASPECT 190.

In one aspect, the invention provides the device of aspect 190, wherein the device comprises a first device component (volatile compound outlet component) and a second device component (mating component) releasably bound to one another by a releasable engagement component, and wherein the total length of the device when the first and second device components (volatile compound outlet component and mating component) are bound to one another is no more than about 75% of the total length of each of the first component and the second component independently added together. ASPECT 191.

In one aspect, the invention provides the device of aspect 191, wherein the device comprises a first device component (volatile compound outlet component) and a second device component (mating component) releasably bound to one another by a releasable engagement component, and wherein the total length of the device when the first and second device components (volatile compound outlet component and mating component) are bound to one another is no more than about 70% of the total length of each of the first component and the second component independently added together. ASPECT 192.

In one aspect, the invention provides the device of aspect 192, wherein the device comprises a first device component (volatile compound outlet component) and a second device component (mating component) releasably bound to one another by a releasable engagement component, and wherein the total length of the device when the first and second device components (volatile compound outlet component and mating component) are bound to one another is no more than about 60% of the total length of each of the first component and the second component independently added together. ASPECT 193.

In one aspect, the invention provides the device of aspect 193, wherein the device comprises a first device component (volatile compound outlet component) and a second device component (mating component) releasably bound to one another by a releasable engagement component, and wherein the total length of the device when the first and second device components (volatile compound outlet component and mating component) are bound to one another is no more than about 50% of the total length of each of the first component and the second component independently added together. ASPECT 194.

In one aspect, the invention provides the device of any one or more of aspects 190-194, wherein at least about 25% of the length of the first device component (volatile compound outlet component) resides within the second device component (mating component) when the first device component and second device component (volatile compound outlet component and mating component) are bound together by the releasable engagement component. ASPECT 195.

In one aspect, the invention provides the device of aspect 195, wherein at least about 30% of the length of the first device component (volatile compound outlet component) resides within the second device component (mating component) when the first device component and second device component (volatile compound outlet component and mating component) are bound together by the releasable engagement component. ASPECT 196.

In one aspect, the invention provides the device of aspect 196, wherein at least about 35% of the length of the first device component (volatile compound outlet component) resides within the second device component (mating component) when the first device component and second device component (volatile compound outlet component and mating component) are bound together by the releasable engagement component. ASPECT 197.

In one aspect, the invention provides the device of aspect 197, wherein at least about 40% of the length of the first device component (volatile compound outlet component) resides within the second device component (mating component) when the first device component and second device component (volatile compound outlet component and mating component) are bound together by the releasable engagement component. ASPECT 198.

In one aspect, the invention provides the device of aspect 198, wherein at least about 45% of the length of the first device component (volatile compound outlet component) resides within the second device component (mating component) when the first device component and second device component (volatile compound outlet component and mating component) are bound together by the releasable engagement component. ASPECT 199.

In one aspect, the invention provides the device of aspect 199, wherein at least about 50% of the length of the first device component (volatile compound outlet component) resides within the second device component (mating component) when the first device component and second device component (volatile compound outlet component and mating component) are bound together by the releasable engagement component. ASPECT 200.

In one aspect, the invention provides the device of one or more of aspects 190-200, wherein the device has a length of between about 90 mm and about 120 mm when the device is in an operable state. ASPECT 201.

In one aspect, the invention provides the device of aspect 201, wherein the device has a length of between about 100 mm and about 110 mm when the device is in an operable state. ASPECT 202.

In one aspect, the invention provides the device of aspect 202, wherein the device has a length of between about 105 mm and about 110 mm when the device is in an operable state. ASPECT 203.

In one aspect, the invention provides the device of one or more of aspects 190-203, wherein the device has a widest diameter of between about 5 mm and about 25 mm. ASPECT 204.

In one aspect, the invention provides the device of aspect 204, wherein the device has a widest diameter of between about 10 mm and about 20 mm. ASPECT 205.

In one aspect, the invention provides the device of aspect 205, wherein the device has a widest diameter of between about 12 mm and about 17 mm. ASPECT 206.

In one aspect, the invention provides the device of one or more of aspects 190-206, wherein the device weighs between about 30 g and about 80 g. ASPECT 207.

In one aspect, the invention provides the device of aspect 207, wherein the device weighs between about 40 g and about 70 g. ASPECT 208.

In one aspect, the invention provides the device of aspect 208, wherein the device weighs between about 50 g and about 60 g. ASPECT 209.

In one aspect, the invention provides the device of aspect 209, wherein the device weighs between about 53 g and about 58 g. ASPECT 210.

In one aspect, the invention provides the device of any one or more of aspects 190-210, wherein the device has at least a widest thickness (in aspects, diameter) and a narrowest thickness (in aspects, diameter), and further wherein the narrowest thickness (in aspects, diameter) of the device represents a thickness (in aspects, diameter) which is between about 50% and about 95% of that of the widest thickness (in aspects, diameter) of the device. ASPECT 211.

In one aspect, the invention provides the device of one or more of aspects 190-211, wherein the narrowest thickness (in aspects, diameter) of the device represents a thickness (in aspects, diameter) which is between about 55% and about 90% of that of the widest thickness (in aspects, diameter) of the device. ASPECT 212.

In one aspect, the invention provides the device of one or more of aspects 212, wherein the narrowest thickness (in aspects, diameter) of the device represents a thickness (in aspects, diameter) which is between about 60% and about 85% of that of the widest thickness (in aspects, diameter) of the device. ASPECT 213.

In one aspect, the invention provides the device of aspect 213, wherein the narrowest thickness (in aspects, diameter) of the device represents a thickness (in aspects, diameter) which is between about 65% and about 80% of that of the widest thickness (in aspects, diameter) of the device. ASPECT 214.

In one aspect, the invention provides the device of aspect 214, wherein the narrowest thickness (in aspects, diameter) of the device represents a thickness (in aspects, diameter) which is between about 70% and about 75% of that of the widest thickness (in aspects, diameter) of the device. ASPECT 215.

In one aspect, the invention provides the device of any one or more of aspects 190-215, wherein the device has a length, and the device comprises at least two separate portions along its length comprising a thickness (in aspects, diameter) which is less than the widest thickness (in aspects, diameter) of the device. ASPECT 216.

In one aspect, the invention provides the device of any one or more of aspects 201-216, wherein the device has a length, and wherein the device comprises two separate portions of its length comprising a thickness (in aspects, diameter) which is between about 50% and about 95% of the widest thickness (in aspects, diameter) of the device. ASPECT 217.

In one aspect, the invention provides the device of aspect 217, wherein the device has a length, and wherein the device comprises two separate portions of its length comprising a thickness (in aspects, diameter) which is between about 55% and about 90% of the widest thickness (in aspects, diameter) of the device. ASPECT 218.

In one aspect, the invention provides the device of aspect 218, wherein the device has a length, and wherein the device comprises two separate portions of its length comprising a thickness (in aspects, diameter) which is between about 60% and about 85% of the widest thickness (in aspects, diameter) of the device. ASPECT 219.

In one aspect, the invention provides the device of aspect 219, wherein the device has a length, and wherein the device comprises two separate portions of its length comprising a thickness (in aspects, diameter) which is between about 65% and about 80% of the widest thickness (in aspects, diameter) of the device. ASPECT 220.

In one aspect, the invention provides the device of aspect 220, wherein the device has a length, and wherein the device comprises two separate portions of its length comprising a thickness (in aspects, diameter) which is between about 70% and about 75% of the widest thickness (in aspects, diameter) of the device. ASPECT 221.

In one aspect, the invention provides the device of any one or more of aspects 190-221, wherein the device has a length and wherein at least one portion of the device along its length has a thickness (in aspects, diameter) which is less than the widest thickness (in aspects, diameter) of the device, and further wherein the center of gravity of the device is positioned at a location along the length of the device corresponding to a portion of the device having a thickness (in aspects, diameter) which is less than the widest thickness (in aspects, diameter) of the device. ASPECT 222.

In one aspect, the invention provides the device of any one or more of aspects 190-221, wherein the device has a length and wherein at least one portion of the device along its length has a thickness (in aspects, diameter) which is less than the widest thickness (in aspects, diameter) of the device, and further wherein the center of gravity of the device is positioned at a location along the length of the device corresponding to a portion of the device having a thickness (in aspects, diameter) representing a thickness (in aspects, diameter) which is at least essentially the widest thickness (in aspects, diameter) of the device. ASPECT 223.

In one aspect, the invention provides the device of any one or more of aspects 190-221, wherein the device has a length and wherein at least one portion of the device along its length has a thickness (in aspects, diameter) which is less than the widest thickness (in aspects, diameter) of the device, and further wherein the center of gravity of the device is positioned at a location along the length of the device corresponding to a portion of the device having a thickness (in aspects, diameter) representing a thickness (in aspects, diameter) which is at least essentially the widest thickness (in aspects, diameter) of the device, and which is adjacent to a portion of the device having a reduced thickness (in aspects, diameter). ASPECT 224.

In one aspect, the invention provides the device of any one or more of aspects 190-221, wherein the device comprises a first component (volatile compound outlet component) and a second component (mating component), wherein the first component and second component (volatile compound component and mating component) are releasably engaged when the device is in an operable state and wherein the device has a length when in such an operable state, and wherein the center of gravity of the device is positioned at a location along the device length associated with the first component (volatile compound outlet component) of the device. ASPECT 225.

In one aspect, the invention provides the device of any one or more of aspects 190-221, wherein the device has a length when in an operable state and wherein the center of gravity of the device is located in a position within the first ½ of the length of the device, starting at the proximal end (i.e., mouthpiece-associated end) of the device. ASPECT 226.

In one aspect, the invention provides the device of any one or more of aspects 190-221, wherein the device has a length when in an operable state and wherein the center of gravity of the device is located in a position within the second ⅓ of the length of the device, starting at the proximal end (i.e., mouthpiece-associated end) of the device. ASPECT 227.

In one aspect, the invention provides the device of any one or more of aspects 190-227, wherein the device comprises a first component (volatile compound outlet component) and a second component (mating component), and wherein the device has a length when the first component (volatile compound outlet component) and the second component (mating component) are releasably engaged such that the device is in a state ready for use, wherein the center of gravity is positioned within a distance from the intersection of the first component (volatile compound outlet component) with the proximal end of the second component (mating component) along the device length which represents no more than about 10% of the total length of the device. ASPECT 228.

In one aspect, the invention provides the device of any one or more of aspects 190-228, wherein the use of more dense or lighter material(s) in one or more component(s) of a device can detectably or significantly shift the location of the center of gravity of the device. ASPECT 229.

In one aspect, the invention provides the device of any one or more of aspects 190-229, wherein the device comprises at least two separate portions along its length having a thickness (in aspects, a diameter) which is less than the widest thickness (in aspects, a diameter) of the device, and wherein one portion having a thickness (in aspects, a diameter) less than the widest thickness (in aspects, a diameter) of the device is positioned to facilitate placement of the users lips and at least a second portion is positioned to facilitate placement of a user's finger(s), wherein, e.g., the reduction in thickness (in aspects, a diameter) is such that the reduced thickness (in aspects, a diameter) section(s) have a thickness (in aspects, a diameter) which is between about 25% and about 95% of the widest thickness (in aspects, a diameter) of the device, such as, e.g., the reduced thickness (in aspects, a diameter) section(s) having a thickness (in aspects, a diameter) which is between about 40% and about 90%, between about 50% and about 80%, or, e.g., ~65%, ~70%, ~75%, ~80%, or, e.g., ~85% of that of the widest thickness (in aspects, a diameter) of the device. ASPECT 230.

In one aspect, the invention provides the device of aspect 230, wherein at least one portion positioned to facilitate placement of a user's fingers is positioned along the length of the device in a location corresponding with or adjacent to the center of gravity of the device such that when holding the device with one finger, between two fingers, or with one finger and between two fingers at such location, the device is essentially weight balanced. ASPECT 231.

In one aspect, the invention provides the device of any one or more of aspects 1-21, wherein the device comprises one or any combination of aspects described in aspects 22-231 that is not contradictory or non-sensical, such as, e.g., a device for use in the delivery of one or more volatile compounds, e.g., flavored volatile compound(s) to the mouth, comprising, e.g., any combination of one or more characteristics described in aspect 22 and aspect 23, any combination of one or more characteristics described in aspects 24-31, any combination of one or more characteristics described in aspects 32-35, any combination of one or more characteristics described in aspects 36-43, any combination of one or more characteristics described in aspects 44-53, any combination of one or more characteristics in aspect 54 and aspect 55, any combination of one or more characteristics described in aspects 56-73, any combination of one or more characteristics described in aspects 74-91, any combination of one or more characteristics described in aspects 92-96, any combination of one or more characteristics described in aspects 97-139, any combination of one or more characteristics described in aspects 140-189, any combination of any or more characteristics described in aspects 190-231, or any combination of any or all thereof. ASPECT 232.

In one aspect, the invention provides the device of one or more of aspects 1-21, wherein the device comprises a first component (volatile compound outlet component) comprising a mouthpiece and a second component designed to mate with the first component (mating component), wherein the first component (volatile compound outlet component) comprises a volatile compound compartment for participating in the stable maintenance of an insert, and further wherein the volatile compound compartment is designed to receive an insert from a position corresponding to the long axis of the first and second components (volatile compound outlet component and mating component), the long axis of the first and second components (volatile compound outlet component and mating component) corresponding to the long axis of the device. ASPECT 233.

In one aspect, the invention provides the device of one or more of aspects 1-21 and aspect 233, wherein the device comprises a first component (volatile compound outlet component) comprising a mouthpiece and a second component designed to mate with the first component (mating component), wherein the second component (mating component) comprises a volatile compound compartment for participating in the stable maintenance of an insert, and further wherein the volatile compound compartment is designed to receive an insert from a position corresponding to the long axis of the first and second components (volatile compound outlet component and mating component), the long axis of the first and second components (volatile compound outlet component and mating component) corresponding to the long axis of the device. ASPECT 234.

In one aspect, the invention provides the device of one or more of aspects 1-21, aspect 233, and aspect 234, wherein device is designed to receive the insert from an opening in its first end, from an opening in its second end, or both. ASPECT 235.

In one aspect, the invention provides the device of aspect 235, wherein an opening is selectively open, e.g., the opening can be accessible via the change in position of or the removal of a device component designed to cover or close the opening. ASPECT 236.

In one aspect, the invention provides the device of one or more of aspects 1-21 and aspect 233, wherein the first component (volatile compound outlet component) comprises an opening in a first end, an opening in a second end, or both, and wherein the first component (volatile compound outlet component) is designed to receive the insert from the opening in its first end, the opening in its second end, or both. ASPECT 237.

In one aspect, the invention provides the device of one or more of aspects 1-21 and aspect 234, wherein the second component (mating component) comprises an opening in a first end, an opening in a second end, or both, and wherein the second component (mating component) is designed to receive the insert from the opening in its first end, the opening in its second end, or both. ASPECT 238.

In one aspect, the invention provides the device of one or both of aspect 237 and 238, wherein an opening is selectively open, e.g., the opening can be accessible via the change in position of or the removal of a device component designed to cover or close the opening. ASPECT 239.

In one aspect, the invention provides a solid material device, e.g., a porous, non-fibrous, solid material device capable of holding, delivering, or holding and delivering one or more volatile compound(s) to the mouth of a user when the device is inserted into a device, e.g., a non-electronic, non-heating, device designed for the delivery of volatile compound(s) to the mouth of a user. ASPECT 240.

In one aspect, the invention provides a solid material device for use within a non-electronic, non-heating, or both non-electronic and non-heating inhalation device, the solid material device being capable of holding, delivering, or holding and delivering one or more volatile compounds, the solid material device comprising a first end, a second end, and an outer diameter, and wherein the solid material device comprises at least one non-circuitous passageway within its outer diameter between its first and second ends allowing the passage of air through the solid material device via the passageway. ASPECT 241.

In one aspect, the invention provides a fibrous, solid material device capable of holding, delivering, or holding and delivering one or more volatile compounds, the fibrous device comprising a first end, a second end, and a visible passageway through the device between the first and second ends. ASPECT 242.

In one aspect, the invention provides the solid material device of one or more of aspects 240-242, wherein the solid material device is the insert described or referenced in any applicable aspect of aspects 1-239. ASPECT 243.

In one aspect, the invention provides the solid material device of any one or more of aspects 240-243, wherein the solid material device is a removable device, insert (also referred to herein as a removable insert) capable of being inserted into and removed from a device designed for the delivery of volatile compound(s) to the mouth of the device user. ASPECT 244.

In one aspect, the invention provides the removable insert of aspect 244, wherein the removable insert is a fibrous, flexible or semi-flexible material for holding, delivering, or holding and delivering one or more volatile compounds. ASPECT 245.

In one aspect, the invention provides the removable insert of aspect 245, wherein the removable insert at least generally, at least substantially, at least essentially, essentially, or is composed of a polyester fiber. ASPECT 246.

In one aspect, the invention provides the removable insert of aspect 244, wherein the removable insert is a porous, non-fibrous, at least essentially inflexible, solid material device for holding, delivering, or holding and delivering one or more volatile compounds. ASPECT 247.

In one aspect, the invention provides the removable insert of aspect 245, wherein the removable insert at least generally, at least substantially, at least essentially, essentially, or is composed of ceramic. ASPECT 248.

In one aspect, the invention provides the solid material device of any one or more of aspects 240-248, wherein the solid material device is a removable insert designed for use within a non-electronic, non-heating inhalation device. ASPECT 249.

In one aspect, the invention provides the solid material device of any one or more of aspects 240-249, wherein the solid material device is a removable insert having a length defined by a distance between a first end of the removable insert and a second end of the removable insert, wherein the removable insert is capable of resisting a detectable or significant bending across its length when a force of between about 10 g to about 500 g is applied to one or both ends of the removable insert. ASPECT 250.

In one aspect, the invention provides the removable insert of aspect 250, wherein the removable insert is capable of resisting a detectable or significant bending across its length when a force of between about 100 g to about 450 g is applied to one or both ends of the removable insert. ASPECT 251.

In one aspect, the invention provides the removable insert of aspect 251, wherein the removable insert is capable of resisting a detectable or significant bending across its length when a force of between about 200 g to about 400 g is applied to one or both ends of the removable insert. ASPECT 252.

In one aspect, the invention provides the removable insert of any one or more of aspects 240-252, wherein when a force of about 350 g is applied to one or both ends of the removable insert, the removable insert defines a minor arc subtending an angle of no less than 170 degrees or the removable insert does not exhibit any detectable or significant bend across its length. ASPECT 253.

In one aspect, the invention provides the solid material device of any one or more of aspects 240-253, wherein the solid material device is a removable insert, and wherein the removable insert maintains a stable position within a component or feature of a device, e.g., a compartment, described in any one or more of aspects 97-139. ASPECT 254.

In one aspect, the invention provides the solid material device of aspect 254, wherein the removable insert is stably maintained within a compartment of the device when the device is dropped from a distance of between about 1" to about 5". ASPECT 255.

In one aspect, the invention provides the solid material device of aspect 255, wherein the removable insert is stably maintained within the compartment of the device when the device is dropped from a distance of between about 1" to about 10". ASPECT 256.

In one aspect, the invention provides the solid material device of aspect 256, wherein the removable insert is stably maintained within the compartment of the device when the device is dropped from a distance of between about 1" to about 30". ASPECT 257.

In one aspect, the invention provides the solid material device of aspect 257, wherein the removable insert is stably maintained within the compartment of the device when the device is dropped from a distance of between about 1" to about 30". ASPECT 258.

In one aspect, the invention provides the solid material device of aspect 258, wherein the removable insert is stably maintained within the compartment of the device when the device is dropped from a distance of between about 1" to about 40". ASPECT 259.

In one aspect, the invention provides the solid material device of aspect 259, wherein the removable insert is stably maintained within the compartment of the device when the device is dropped from a distance of between about 1" to about 50". ASPECT 260.

In one aspect, the invention provides the solid material device of aspect 260, wherein the removable insert is stably maintained within the compartment of the device when the device is dropped from a distance of 60" or more. ASPECT 261.

In one aspect, the invention provides the solid material device of any one or more of aspects 254-261, wherein the removable insert requires a pull force of between about −0.02 N-about −2 N to manually remove the removable element from the component or feature of a device, e.g., a compartment, designed to maintain it during operation of the device. ASPECT 262.

In one aspect, the invention provides the solid material device of aspect 262, wherein the removable insert requires a pull force of between about −0.02 N-about −1 N to manually remove the removable element from the compartment. ASPECT 263.

In one aspect, the invention provides the solid material device of aspect 263, wherein the removable insert requires a pull force of between about −0.02 N-about −0.5 N to manually remove the removable element from the compartment. ASPECT 264.

In one aspect, the invention provides the solid material device of any one or more of aspects 254-264, wherein the removable insert is stably maintained within the component or feature of the device, e.g., the compartment, designed to maintain it during operation of the device, such that when the compartment maintaining the removable insert is exposed to the outside environment, the insert is stably maintained within the container when the compartment is rotated 360 degrees in any direction. ASPECT 265.

In one aspect, the invention provides the solid material device of any one or more of aspects 240-265, wherein the solid material insert comprises at least one non-circuitous passageway, e.g., a direct path, through at least one dimension of the solid material device. ASPECT 266.

In one aspect, the invention provides the solid material device of aspect 266, wherein the solid material device comprises a first end and a second end, the distance between the first and second ends of the solid material device defining the longest dimension of the solid material device, wherein at least one of the at least one non-circuitous passageways pass(es) from the first end of the solid material device to the second end of the solid material device. ASPECT 267.

In one aspect, the invention provides the solid material device of any one or both of aspect 266 and aspect 267, wherein the at least one non-circuitous passageway increases the surface area of the device compared to the same device lacking the at least one non-circuitous passageway. ASPECT 268.

In one aspect, the invention provides the solid material device of any one or more of aspects 266-268, wherein at least one of the at least one non-circuitous passageways, e.g., direct paths, through the solid material device has a shape characterizable as a circular shape, a squircle, a quadrilateral or other polygon, or a multilobed (multi-petaled) flower shape, e.g., zygomorphic flower shape, or actinomorphic flower shape. ASPECT 269.

In one aspect, the invention provides the solid material device of aspect 269, wherein the solid material device comprises a plurality of non-circuitous passageways through the solid material device. ASPECT 270.

In one aspect, the invention provides the solid material device of aspect 270, wherein each of the plurality of non-circuitous passageways through the solid material device are at least generally, at least substantially, at least essentially, essentially, or are the same shape. ASPECT 271.

In one aspect, the invention provides the solid material device of aspect 270, wherein at least one of the non-circuitous passageways through the solid material device has a shape which is different from one or more other non-circuitous passageways through the solid material device. ASPECT 272.

In one aspect, the invention provides the solid material device of any one or more of aspects 244-272, wherein the removable insert has a shape having a first end and a second end, the shape characterizable as a cylinder, triangular prism, rectangular prism (cuboid), pentagonal prism, hexagonal prism, octagonal prism, or other multi-sided prism. ASPECT 273.

In one aspect, the invention provides the solid material device of any one or more of aspects 244-273, wherein the removable insert has a depth (e.g., thickness/diameter) which is detectably or significantly less than the depth of a component of a device designed to hold it, e.g., a compartment of a device, in which it resides during operation of the device with the removable insert present. ASPECT 274.

In one aspect, the invention provides the solid material device, i.e., insert, e.g., removable insert, of one or more of aspects 240-274, wherein (a) the insert contacts a single, limited portion of a first component of an airflow control mechanism present in the device designed to receive the insert and within which an at least 2-component airflow control mechanism is present, (b) the single, limited portion of the one component of an airflow control mechanism with which the insert makes contact is not a portion of the airflow control component that interfaces with any second airflow control component present as part of the airflow control mechanism. ASPECT 275.

In one aspect, the invention provides the solid material device, i.e., insert, e.g., removable insert, of one or more of aspects 240-275, wherein the device designed to receive or otherwise utilize the insert comprises at least one component positioned between the insert and the proximal end of the device, at least one component positioned between the insert and the distal end of the device, or both, such that the insert cannot be directly removed from the proximal end of the device, the distal end of the device, or cannot be directly removed from either end of the device. ASPECT 276.

In one aspect, the invention provides the solid material device, i.e., insert, e.g., removable insert, of aspect 276, wherein the at least one component positioned between the insert and the distal end of the device is a component of an airflow control mechanism. ASPECT 277.

In one aspect, the invention provides the solid material device, i.e., insert, e.g., removable insert, of one or more of aspects 240-277, wherein the insert is highly porous, e.g., wherein at least about 5% of its total volume, ≥~10%, ≥~15%, ≥~20%, ≥~25%, ≥~30%, ≥~35%, ≥~40%, ≥~45%, ≥~50%, ≥~55%, ≥~60%, ≥~65%, ≥~70%, ≥~75% of the volume of the insert is open space, e.g., capable of maintaining volatile compound(s) or composition(s) comprising volatile compound(s) such as, e.g., essential oil(s). ASPECT 278.

In one aspect, the invention provides the solid material device, i.e., insert, e.g., removable insert, of one or more of aspects 240-278, wherein the insert placed directly into a device designed to receive it intact and unmodified, i.e., without any required manipulation or material handling (such as, e.g., shredding). ASPECT 279.

In one aspect, the invention provides the solid material device, i.e., insert, e.g., removable insert, of one or more of aspects 240-279, wherein (1) the variation in surface area of the insert(s), (2) the variation in the volume of volatile compound(s) composition(s) the insert(s) can maintain, (3) the variation in airflow through the insert(s) when insert(s) are placed into a device designed to receive them when the device is set at any specific airflow control setting, or any or all thereof, from insert-to-insert within a manufactured lot (batch) of inserts is less than about 50%, such as, e.g., ≤~45%, ≤~40%, ≤~35%, ≤~30%, ≤~25%, ≤~20%, ≤~15%, ≤~10%, or ≤~5%. ASPECT 280.

In one aspect, the invention provides the solid material device, i.e., insert, e.g., removable insert, of one or more of aspects 240-280, wherein the insert has an initial weight upon completion of loading the insert with a composition comprising volatile compound(s) and packaging post-manufacture, and wherein upon unpackaging the insert and allowing it to rest undisturbed at about room temperature in open air, the insert demonstrates a change in weight of between about 5 mg/hour and about 45 mg/hour. ASPECT 281.

In one aspect, the invention provides the solid material device, i.e., insert, e.g., removable insert, of aspect 281, wherein the standard deviation of the change in weight of a population of such insert(s) is less than about 20 mg/hour. ASPECT 282.

In one aspect, the invention provides the solid material device, i.e., insert, e.g., removable insert, of one or more of aspects 240-282, wherein the insert comprises an initial volume of a composition comprising volatile compound(s) upon packaging post-manufacture, and wherein upon unpackaging the insert and allowing it to rest undisturbed at about room temperature in open air, the insert demonstrates a rate of loss in the volume of composition contained therein of between about 8 μL/hour and about 60 μL/hour. ASPECT 283.

In one aspect, the invention provides the solid material device, i.e., insert, e.g., removable insert, of aspect 283, wherein the standard deviation of the loss of composition(s) comprising volatile compound(s) within a population of insert(s) comprising such composition(s) is less than about 20 μL/hour. ASPECT 284.

In one aspect, the invention provides the solid material device, i.e., insert, e.g., removable insert, of one or more of aspects 240-284, wherein (1) the device comprises a composition comprising volatile compound(s) and (2) the device is positioned within a delivery device designed to maintain the insert for the delivery of volatile compound(s) maintained therein to the mouth of a user of the delivery device, and further wherein the insert releases between about 0.1 μL and about 10 μL of composition upon each use of the delivery device by a delivery device user, a single use being a single "draw" by a user from the delivery device. ASPECT 285.

In one aspect, the invention provides the solid material device, i.e., insert, e.g., removable insert, of one or more of aspects 240-285, wherein the insert comprises an initial amount of composition comprising volatile compound(s) upon initial packaging post-manufacture, and upon unpackaging the insert the insert loses less than about 20% of the total amount of composition when the insert is utilized in a delivery device designed to maintain the insert and deliver volatile compounds therefrom to a device user, after a total of about 30 uses, a single use being a single "draw" by a user from the delivery device. ASPECT 286.

In one aspect, the invention provides the solid material device, i.e., insert, e.g., removable insert, of one or more of aspects 240-286, wherein the longest dimension of the insert is less than about 50% of the total length of a delivery device designed to maintain it therein for the delivery of volatile compound(s) to a delivery device user. ASPECT 287.

In one aspect, the invention provides the solid material device, i.e., insert, e.g., removable insert, of aspect 287, wherein the longest dimension of the insert is less than about 45% of the total length of a delivery device designed to maintain it therein for the delivery of volatile compound(s) to a delivery device user. ASPECT 288.

In one aspect, the invention provides the solid material device, i.e., insert, e.g., removable insert, of aspect 288, wherein the longest dimension of the insert is less than about 40% of the total length of a delivery device designed to maintain it therein for the delivery of volatile compound(s) to a delivery device user. ASPECT 289.

In one aspect, the invention provides the solid material device, i.e., insert, e.g., removable insert, of aspect 289, wherein the longest dimension of the insert is less than about 35% of the total length of a delivery device designed to maintain it therein for the delivery of volatile compound(s) to a delivery device user. ASPECT 290.

In one aspect, the invention provides the solid material device, i.e., insert, e.g., removable insert, of aspect 290, wherein the longest dimension of the insert is less than about 30% of the total length of a delivery device designed to maintain it therein for the delivery of volatile compound(s) to a delivery device user. ASPECT 291.

In one aspect, the invention provides the solid material device, i.e., insert, e.g., removable insert, of one or more of aspects 240-291, wherein the insert has a longest dimension, i.e., length, and the longest dimension, i.e., length, of the delivery device designed to maintain the insert therein is at least 100% greater than the length of the insert. ASPECT 292.

In one aspect, the invention provides the solid material device, i.e., insert, e.g., removable insert, of aspect 292, wherein the insert has a longest dimension, i.e., length, and the longest dimension, i.e., length, of the delivery device designed to maintain the insert therein is at least 150% greater than the length of the insert. ASPECT 293.

In one aspect, the invention provides the solid material device, i.e., insert, e.g., removable insert, of aspect 293, wherein the insert has a longest dimension, i.e., length, and the longest dimension, i.e., length, of the delivery device designed to maintain the insert therein is at least 200% greater than the length of the insert. ASPECT 294.

In one aspect, the invention provides the solid material device (i.e., insert) of one or more of aspects 240-294, wherein the solid material device is a solid material device capable of maintaining, releasing, or maintaining or releasing one or more volatile compounds, wherein the one or more volatile compounds are safe for mammalian exposure thereto. ASPECT 295.

In one aspect, the invention provides the solid material device of aspect 295, wherein the volatile compound(s) are flavored compound(s). ASPECT 296.

In one aspect, the invention provides the solid material device of aspect 296, wherein the one or more volatile compounds is/are volatile compound(s) maintained within a composition such as an oil, is/are provided to the solid material device within a composition such as in an oil, or both. ASPECT 297.

In one aspect, the invention provides the solid material device of aspect 297, wherein the composition is a non-combustible oil. ASPECT 298.

In one aspect, the invention provides the solid material device of one or more of aspects 295-298, wherein at least one of the volatile compounds is a non-nicotinic compound. ASPECT 299.

In one aspect, the invention provides the solid material device of one or more of aspects 295-299, wherein none of the one or more volatile compounds is a tobacco-related compound, nicotine-related compound, or any combination thereof. ASPECT 300.

In one aspect, the invention provides the solid material device of one or more of aspects 295-300, wherein the one or more volatile compounds are derived from, provided in, or both derived from and provided in one or more botanicals or extracted oils of such botanicals including botanicals from, e.g., the botanical family Lamiaceae, e.g., *Mentha piperita* (peppermint), *Mentha spicata* (spearmint), *Lavandula* (lavender), *Salvia rosmarinus* (rosemary), *Origanum vulgare* (oregano), *Thymus vulgaris* (thyme), etc.; the botanical family Piperaceas, e.g., *Piper nigrum* (black pepper); the botanical family Myrtaceae, e.g., *Eucalyptus radiata* (eucalyptus), *Eucalyptus globulus* (eucalyptus), *Syzygium aromaticum* (clove), *Melaleuca alternifolia* (tea tree); the botanical family Rutaceae, e.g., *Citrus limon* (lemon), *Citrus* x *sinensis* (orange), *Aurantifolia* (lime) (or, e.g., *Citrus aurantifolia, Citrus latifolia, Citrus glauca*, and *Citrus hystrix*), *Citrus paradisi* (grapefruit), *Citrus bergamia* (bergamot orange); the botanical family Annonacea, e.g., *Cananga* adorate (ylang-ylang); the botanical family Lauraceae, e.g., *Cinnamomum verum* (cinnamon), *Ocotea*

*quixos* (*Ocotea* or Ishpingo); the botanical family Myristicaceae, e.g., *Myristica fragrans* (nutmeg); the botanical family Pine, e.g., *Cedrus* (cedarwood), *Picea mariana* (black spruce); the botanical family Fabaceae, e.g., Genus *Copaifera* (copaiba); the botanical family Orchidaceae, e.g., *Vanilla planifolia* (vanilla); the botanical family Poaceae, e.g., *Cymbopogon* species (including, e.g., lemongrass); the botanical family Malvaceae, e.g., *Theobroma cacao* (cocoa); the botanical family Ericaceae, e.g., *Vaccinium macrocarpon* (cranberry); the botanical family Asteraceae, e.g., *Artemisia pallens* (davana), the botanical family Cupressaceae, e.g., *Juniperus communis* (juniper), *Cupressus* (cypress), the botanical family Burseraceae, e.g., Boswellia sacra (frankincense); and, e.g., the botanical family Geraniaceae, e.g., *Pelargonium graveolens* (geranium), etc. and any combination of any or all thereof. ASPECT 301.

In one aspect, the invention provides the device having one or more of the characteristics described in any one or more of aspects 1-239, wherein the device is capable of receiving a solid material device, e.g., insert, e.g., removable insert, therein, wherein the solid material device is capable of maintaining, releasing, or maintaining and releasing one or more volatile compounds, and wherein the solid material device has one or more of the characteristics described in any one or more of aspects 240-294. ASPECT 302.

In one aspect, the invention provides the inhalation device of aspect 302, wherein the one or more volatile compounds has/have one or more of the characteristics described in any one or more of aspects 295-301. ASPECT 303.

In one aspect, the invention provides the device having one or more of the characteristics described in any one or more of aspects 1-239, wherein the device comprises at least one component which is machine washable, e.g., which is dishwasher safe. ASPECT 304.

In one aspect, the invention provides the solid material device of one or more of aspects 240-294, wherein the solid material device is a removable insert capable of being inserted into, used in coordination with, or both, a device having one more of the characteristics described in any one or more of aspects 1-239. ASPECT 305.

In one aspect, the invention provides the device of aspect 305, wherein the solid material device is capable of maintaining, releasing, or maintaining and releasing one or more volatile compounds having any one or more of the characteristics described in any one or more of aspects 295-301. ASPECT 306.

In aspects, the invention can comprise device(s), component(s), or any combination thereof having any combination of characteristic(s) described in one or more of aspects 1-306, which are not contradictory or non-sensical; e.g., the invention can provide, in one embodiment, a non-electronic, non-heating device designed for the delivery of one or more volatile compounds described in to the mouth of a user, the device having any one or more characteristics of, or capable of being used with any additional device described in, one or more of aspects 1-239, or, e.g., in an embodiment the invention can provide a solid material device, e.g., an insert, e.g., a removable insert, capable of maintaining, releasing, or maintaining or releasing one or more volatile compounds, the solid material device being described in or having any one or more of the characteristics of, one or more of aspects 240-294 or which is suitable for use in a device having any one or more of the characteristics in one or more of aspects 1-239, and wherein such a disclosed delivery device, solid material device, or both, can deliver to a user one or more volatile compounds described in one or more of aspects 295-301. ASPECT 307.

In one aspect, the invention provides a system for the delivery of one or more volatile compound(s), the system comprising (a) a delivery device and (b) an insert designed to be removably maintained therein, wherein the delivery device comprises a first component (volatile compound outlet component) and a second component (mating component) releasably bound to one another by a selectively releasable engagement component, e.g., a rapidly releasable force mechanism, such that the first component and second component (volatile compound outlet component and mating component) can be completely disengaged from one another or, alternatively, can be securely bound to one another, the delivery device further optionally comprising an adjustable airflow restrictor (airflow control mechanism) controlled by the rotation of the first component and the second component (volatile compound outlet component and mating component) relative to one another, and the insert is designed to maintain, release, or maintain and release the one or more volatile compound(s) for delivery. ASPECT 308.

In one aspect, the invention provides a system for the delivery of one or more volatile compound(s), the system comprising (a) a first delivery device component comprising a mouthpiece, (b) a second delivery device component comprising a means for maintaining a device for maintaining, releasing, or maintaining and releasing volatile compound(s), and (c) a solid material device for maintaining, releasing, or maintaining and releasing volatile compound(s), wherein (a) and (b) are designed to be fixedly attached or alternatively selectively releasable, i.e., releasably engageable, e.g., by a rapid release mechanism, with/to one another. ASPECT 309.

In one aspect, the invention provides a system for the delivery of one or more volatile compounds, the system comprising a delivery device and a solid material device capable of being inserted therein, the solid material device capable of maintaining, releasing, or maintaining and releasing the one or more volatile compounds for delivery to the mouth of the delivery device user, wherein, in use, (a) at least one quarter of the solid material device's longest dimension is engaged with a first component of the delivery device (volatile compound outlet component), and (b) the entirety of the solid material device is positioned within a second component (mating component) of the delivery device when the delivery device is in a ready to use state, and wherein the first and second components (volatile compound outlet component and mating component) of the delivery device are selectively engageable/dis-engageable from one another. ASPECT 310.

In one aspect, the invention provides a system for the delivery of one or more volatile compounds to a recipient, the system comprising a delivery device and a solid material device capable of maintaining, releasing, or maintaining and releasing one or more volatile compounds, wherein the solid material device comprises a first end, a second end, and at least one non-circuitous passageway passing through the solid material device from its first end to its second end. ASPECT 311.

In one aspect, the invention provides a system for the delivery of one or more volatile compounds to a recipient, the device system comprising a delivery device comprising a first component and a second component capable of rotating relative to one another and a removable solid material device capable of maintaining, releasing, or maintaining and releasing the one or more volatile compounds for delivery to the recipient by the delivery device user, wherein the delivery device comprises an airflow restrictor (airflow control mechanism) adjustable in discrete increments by the rotation of the first component and the second component (volatile compound outlet component and mating component) of the delivery device in relation to one another. ASPECT 312.

In one aspect, the invention provides a system for the delivery of one or more volatile compounds to a recipient, the system comprising a delivery device described in one or more of aspects 1-239 and 302-304, and a removable insert described in one or more of aspects 240-294, 305, and 306. ASPECT 313.

In aspects, the invention provides a kit comprising (a) one or more of the inhalation devices described in one or more of aspects 1-239 and 302-304, and (b) one or more of the solid material devices capable of maintaining, releasing, or maintaining and releasing one or more volatile compounds described in any one or more of aspects 240-294, 305, and 306. ASPECT 314.

In aspects, the invention provides a kit providing two or solid material devices capable of maintaining, releasing, or maintaining and releasing one or more volatile compounds described in any one or more of aspects 240-294, 305, and 306. ASPECT 315.

In aspects, the invention provides the kit of aspect 315, wherein all solid material devices of the kit comprise at least generally the same, at least substantially the same, at least essentially the same, essentially the same, or the same one or more volatile compounds. ASPECT 316.

In aspects, the invention provides the kit of aspect 315, wherein at least one of the solid material devices of the kit comprises at least generally different, at least substantially different, or different one or more volatile compounds than at least one other solid material device in the kit. ASPECT 317.

In aspects, the invention provides a method of providing volatile compound(s) to a recipient, the method comprising providing to an individual a delivery device of one or more of aspects 1-239 and 302-304 with or containing an insert, e.g., a removable insert, of one or more of aspects 240-294, 305, and 306; a system of one or more of aspects 308-313, or a kit of one or more of aspects 314-317, wherein the individual applies a sufficient suction force to the delivery device such that a detectable amount of volatile compound(s), e.g., flavored compounds, maintained in/by the insert is delivered to the individual. ASPECT 318.

In aspects, the invention provides the method of aspect 318, wherein the suction force is a suction force applied by the mouth of the user and the detectable amount of volatile compound(s) is delivered to the mouth of the individual. ASPECT 319.

In aspects, the invention provides a method of providing volatile compound(s) for delivery to an individual, the method comprising (a) providing to an individual a delivery device of one or more of aspects 1-239 and 302-304 with or containing a removable insert of one or more of aspects 240-294, 305, and 306, a system of one or more of aspects 308-313, or a kit of one or more of aspects 314-317, (b) instructing the individual to (i) apply suction via their mouth ("oral suction") (e.g., to apply at least one partial or full breath through the inhalation device) such that a detectable amount of volatile compound(s) maintained by the removable insert is delivered to the individual and (ii) to repeat step (i) for as many times as is desired by the individual to obtain a satisfactory olfactory experience as judged by the individual. ASPECT 320.

In aspects, the invention provides a method of providing an olfactory experience comprising the inhalation of volatile compound(s) to an individual, the method comprising providing to an individual an inhalation device of one or more of aspects 1-239 and 302-304, with or containing a removable insert of one or more of aspects 240-294, 305, and 306, a system of one or more of aspects 308-313, or a kit of one or more of aspects 314-317, wherein the individual applies a sufficient amount of suction force (oral suction) to the device using their mouth or intakes via their mouth at least one partial or full breath through the delivery device such that a detectable amount of volatile compound(s) (e.g., an amount conferring a detectable amount of flavor for a typical user, most users, or significant number of users or an amount at least 1.5×, at least 2×, at least 3×, at least 4×, at least 5×, at least 10×, at least 20×, at least 50×, or at least 100× such minimum flavor detectable amount) maintained by the removable insert is delivered to the individual. ASPECT 321.

In aspects, the invention provides a method of providing an olfactory experience comprising the delivery of volatile compound(s), e.g., flavored compound(s), to an individual, the method comprising (a) providing to an individual delivery device of one or more of aspects 1-239 and 302-304, with or containing a removable insert of one or more of aspects 240-294, 305, and 306, a system of one or more of aspects 308-313, or a kit of one or more of aspects 314-317, (b) instructing the individual to (i) provide suction via their mouth, introducing an amount of air into the delivery device such that a detectable amount of volatile compound(s) maintained by the removable insert positioned within the delivery device is delivered to the individual (e.g., a flavor associated amount as described above) and (ii) to repeat step (i) for as many times as is desired by the individual to obtain a satisfactory olfactory experience as judged by the individual. ASPECT 322.

In aspects, the invention provides a method of detectably or significantly reducing one or more smoking habit-related cravings(s) in an individual, the method comprising providing to an individual suffering from a smoking habit-related craving delivery device of one or more of aspects 1-239 and 302-304 with or containing an insert, e.g., a removable insert, of one or more of aspects 240-294, 305, and 306, a system of one or more of aspects 308-313, or a kit of one or more of aspects 314-317, wherein the individual introduces, via application of suction (e.g., using their mouth), an amount of air into the delivery device such that a detectable amount of volatile compounds maintained by the removable insert positioned within the delivery device is delivered to the individual. ASPECT 323.

In aspects, the invention provides a method of detectably or significantly reducing one or more habit-related craving(s) in a significant number of individuals comprising providing to each individual in the population of individuals a delivery device of one or more of aspects 1-239 and 302-304 with or containing an insert, e.g., a removable insert, of one or more of aspects 240-294, 305, and 306, a system of one or more of aspects 308-313, or a kit of one or more of aspects 314-317, wherein the individual(s) introduces, via application of suction (e.g., using their mouth(s)) an amount of air into the delivery device such that a detectable amount of volatile compound(s) maintained by the insert is delivered to the individual(s) (e.g., an amount associated with a beneficial effect in a significant number of users, most users of a population, etc.). ASPECT 324.

In aspects, the invention provides a method of detectably or significantly reducing one or more habit-related cravings (where cravings in these aspects can be sensation of cravings, craving-associated behaviors, craving-associated physiological measurements, or a combination thereof) in an individual, the method comprising (a) providing to the individual undergoing/experiencing the habit-related craving(s) a delivery device of one or more of aspects 1-239 and 302-304 with or containing a removable insert of one or more of aspects 240-294, 305, and 306, a system of one or more of aspects 308-313, or a kit of one or more of aspects 314-317, (b) instructing the individual to (i) apply a sufficient suction force to the delivery device, e.g., via their mouth, to introduce an amount of air into the delivery device such that a detectable amount of volatile compound(s) maintained by the removable insert maintained therein is delivered to the individual and (ii) to repeat step (i) at least one additional time. ASPECT 325.

In aspects, the invention provides a method of detectably or significantly reducing one or more habit-related craving(s) (habit related cravings in these aspects, including, in aspects, smoking or vaping-related cravings) in a significant number of individuals in an adequately powered population of individuals, the method comprising (a) providing to each of the individual(s) experiencing one or more habit-related craving(s) a delivery device of one or more of aspects 1-239 and 302-304 with or containing a removable insert of one or more of aspects 240-294, 305, and 306, a system of one or more of aspects 308-313, or a kit of one or more of aspects 314-317, (b) instructing the individual(s) to (i) apply a sufficient suction force to the delivery device, e.g., via their mouth(s), to introduce an amount of air into the delivery device such that a detectable amount of volatile compound(s) maintained by the removable insert housed within the delivery device is delivered to the individual(s) and (ii) to repeat step (i) at least one additional time. ASPECT 326.

In aspects, the invention provides a method of detectably or significantly reducing one or more habit-related craving(s) in an individual, the method comprising providing to an individual experiencing a habit-related craving a delivery device of one or more of aspects 1-239 and 302-304, optionally with or optionally containing a removable insert of one or more of aspects 240-294, 305, and 306, providing a system of one or more of aspects 308-313, or providing a kit of one or more of aspects 314-317, wherein the individual (i) holds the delivery device within their hand, between their fingers, between their lips, or any combination thereof, (ii) repeatedly, e.g., at least two or more times, rotates a first component of the device (volatile compound outlet component) in relation to a second component (mating component) of the device relative to one another in any direction or combination of directions, (iii) repeatedly, e.g., at least two or more times, separates and allows reattachment of a first component (volatile compound outlet component) and a second component (mating component) relative to one another, or (iv) any combination of (i)-(iii). ASPECT 327.

In aspects, the invention provides a method of detectably or significantly reducing one or more habit-related craving(s) (as noted above, this can also or alternatively include modulating craving-associated symptoms, conditions, behaviors, etc.) in a significant number of individuals, the method comprising providing to each of the individual(s) experiencing such cravings (in all cases in these aspects being replaceable with susceptible of experiencing such cravings) a delivery device of one or more of aspects 1-239 and 302-304, optionally with or optionally containing a removable insert of one or more of aspects 240-294, 305, and 306, providing a system of one or more of aspects 308-313, or providing a kit of one or more of aspects 314-317, wherein the individual(s) (i) hold(s) the device within their hand(s), between their fingers, between their lips, or any combination thereof, (ii) repeatedly, e.g., at least two or more times, rotate(s) a first component of the device (volatile compound outlet component) in relation to a second component of the device (mating component) relative to one another in any direction or combination of directions, (iii) repeatedly, e.g., at least two or more times, separate(s) and allow(s) reattachment of the first device component (volatile compound outlet component) and the second device component (mating component) relative to one another, or (iv) any combination of (i)-(iii). ASPECT 328.

In aspects, the invention provides a method of detectably or significantly reducing one or more habit-related craving(s) in an individual, the method comprising (a) providing to an individual experiencing or that may experience a habit-related craving (or related condition or behavior) an inhalation device of one or more of aspects 1-239 and 302-304, optionally with or optionally containing a removable insert of one or more of aspects 240-294, 305, and 306, a system of one or more of aspects 308-313, or a kit of one or more of aspects 314-317, and (b) instructing the individual to (i) hold the device within their hand, between their fingers, between their lips, or any combination thereof, (ii) repeatedly, e.g., at least two or more times, rotate a first component of the device (volatile compound outlet component) in relation to a second component of the device (mating component) relative to one another in any direction or combination of directions, (iii) repeatedly, e.g., at least two or more times, separate and allow reattachment of the first component (volatile compound outlet component) and the second component (mating component) relative to one another, or (iv) any combination of (i)-(iii). ASPECT 329.

In aspects, the invention provides a method of detectably or significantly reducing one or more habit-related craving(s) in a significant number of individuals in an adequately powered population of individuals, the method comprising (a) providing to each individual(s) suffering from a habit-related craving a delivery device of one or more of aspects 1-239 and 302-304, optionally with or optionally containing a removable insert of one or more of aspects 240-294, 305, and 306, a system of any one or more of aspects 308-313, or a kit of one or more of aspects 314-317, and (b) instructing the individual(s) to (i) hold the device(s) within their hand(s), between their fingers, between their lips, or any combination thereof, (ii) repeatedly, e.g., two or more times, rotate a first component of the device (volatile compound outlet component) in relation to a second component of the device (mating component) relative to one another in any direction or combination of directions, (iii) repeatedly, e.g., two or more times, separate and allow reattachment of the first component (volatile compound outlet component) and the second component (mating component) relative to one another, or (iv) any combination of (i)-(iii). ASPECT 330.

In aspects, the invention provides the method of one or more of aspects 323-330, wherein one or more steps of the method(s) is/are applied for or over a sufficient period of time or repeated a sufficient number of times such that the individual experiences a detectable or significant decrease in the habit-related craving as assessed by the individual, a suitably trained individual recognized as capable of identifying reduction in addiction-related behavior, or both. ASPECT 331.

In aspects, the invention provides the method of aspect 331, wherein a detectable or significant reduction in habit-related craving(s) is reduced in the population of individuals receiving, applying, or otherwise using the method within a period of at least about 1 year, such as, e.g., within at least about 11 months (mos.), ~10 mos., ~9 mos., ~8 mos., ~7 mos., ~6 mos., ~5 mos., ~4 mos., ~3 mos., ~2 mos., or, e.g., within about 1 month. ASPECT 332.

In aspects, the invention provides a method of controlling the delivery of volatile compound(s), e.g., flavored volatile compound(s), via a device to the mouth of the device user, the method comprising moving at least two airflow limiters of the device in relation to one another such that the movement of the two airflow limiters occurs only in pre-defined increments and with each movement of the two airflow limiters in a pre-defined increment provides a pre-determined increase or pre-determined decrease in airflow through the device. ASPECT 333.

In aspects, the invention provides a method of controlling the delivery of volatile compound(s), e.g., flavored volatile compound(s), via a device to the mouth of the device user, the method comprising moving a first device component (volatile compound outlet component) and a second device component (mating component) relative to one another, wherein the first device component and the second device component (volatile compound outlet component and mating component) each comprise at least one part or component of a multi-component airflow control system designed to establish a plurality of discrete airflow control settings for the device (airflow limiter(s), and wherein a movement of the first device component (volatile compound outlet component) and the second device component (mating component) changes the airflow control setting from a first discrete airflow control setting to a second airflow control setting, and between the first and second discrete airflow control settings, the amount of interface between the airflow control system parts or components (airflow limiters) decreases compared to the amount of interface between the airflow control components (airflow limiters) when the device is in either the first or second airflow control setting. ASPECT 334.

In aspects, the invention provides a method of controlling airflow in a delivery device designed to deliver volatile compound(s) to a user of the delivery device, the method comprising moving at least two airflow limiters of the delivery device in relation to one another such that the movement of the two airflow limiters occurs only in pre-defined increments and with each movement of the two airflow limiters in a pre-defined increment provides a pre-determined increase or pre-determined decrease in airflow through the delivery device. ASPECT 335.

In aspects, the invention provides a method of controlling airflow in a delivery device designed to deliver volatile compound(s) to a user of the delivery device, the method comprising moving at least two airflow limiters of the delivery device in relation to one another and wherein, during normal operation of the device, at least two of the at least two airflow limiters of the delivery device are, selectively, completely separable from one another. ASPECT 336.

In aspects, the invention provides a method of controlling airflow in a delivery device designed to deliver volatile compound(s) to a user of the delivery device, the method comprising moving at least two airflow limiters of the delivery device in relation to one another, wherein movement of a first airflow limiter relative to a second airflow limiter comprises a rotational movement, and the rotational movement comprises movement capable of an at least 360-degree rotation. ASPECT 337.

In aspects, the invention provides the methods of one or more of aspects 333-337, wherein the delivery device is a delivery device of any one or more of aspects 1-239 and 302-304 and wherein the device comprises an airflow control mechanism (airflow restrictor) having one or more of the characteristics described in one or more of aspects 140-189. ASPECT 338.

In aspects, the invention provides a method of visually identifying an airflow control setting of delivery device designed to deliver volatile compound(s) to a user of the delivery device, the method comprising evaluating the positioning of at least one first visual or tactile (or both visual and tactile) indicator present on an external surface of the delivery device relative to at least one second visual or tactile (or both visual and tactile) indicator present on an external surface of the delivery device, wherein the relative positioning of one visual or tactile (or both visual and tactile indicator to another indicates the status of the airflow control mechanism (airflow restrictor) present as a component of the delivery device. ASPECT 339.

In aspects, the invention provides a method of determining the spatial positioning of an internal component, not externally visible, of a delivery device designed to deliver volatile compound(s) to a user of the delivery device, the method comprising evaluating the positioning of at least one first visual, tactile, or both visual and tactile indicator present on an external surface of the delivery device, wherein the spatial positioning of at least one visual, tactile, or both visual and tactile indicator indicates the spatial positioning of an otherwise externally invisible internal component of the delivery device. ASPECT 340.

In aspects, the invention provides a method of audibly, tacitly, visually, or audibly tactily and visually (or sub-combination(s) thereof as suitable) determining the status of an airflow control setting of a delivery device designed to deliver volatile compound(s) to a user of the delivery device, the method comprising moving at least two airflow control components (airflow limiters) present as component(s) of the delivery device in relation to one another, wherein movement of a first airflow control component (airflow limiter) relative to a second airflow control component (airflow limiter) is accompanied by an audible sound, a tactile indicator, or both, such audible sound, tactile indicator, or both, providing an indication (to the user of the delivery device) of the status of the delivery device airflow control setting, and, optionally wherein externally discernable tactile, visual, or both tactile and visual indicator(s) indicate the status of the delivery device airflow control setting. ASPECT 341.

In aspects, the invention provides one or more of the method(s) of aspects 339-341, wherein the delivery device is a delivery device of any one or more of aspects 1-239 and 302-304 and wherein the device comprises one or more indicator(s) described in this list of aspects. ASPECT 342.

In aspects, the invention provides a delivery device for delivering one or more volatile compounds to a user of the delivery device, wherein the delivery device comprises (1) a means for selective engagement of two or more components of the delivery device; (2) a means for delivering the volatile compound(s) to the mouth of the user (e.g., a means for suctioning air into the delivery device, such as, e.g., a means for inhalation facilitation) (user delivery means); (3)

a means for protecting a user delivery means (e.g., a means for protecting a suction or an inhalation facilitation means); (4) a means for housing a means for delivering/providing volatile compounds, e.g., a means for housing an insert, e.g., means for housing a removable insert; (5) a means for stabilizing a means for delivering volatile compounds (e.g., a means for stabilizing an insert, e.g., a removable insert); (6); a means for airflow control through the delivery device; (7) a means for protecting an outer surface of the delivery device (e.g., outer shell); (8) a means for visual indicator(s) of one or more characteristic(s) of the device; (9) a means for providing a tactile indication of movement, control setting, or both; (10) a means for providing an audible indication of a movement, control setting, or both; (11) a means for delivering/providing volatile compound(s); or (12) any one, more, or all of (1)-(11). ASPECT 343.

In aspects, the invention provides the delivery device of aspect 343, wherein the delivery device has one or more of the characteristics described in one or more of aspects 1-239 and 302-304. ASPECT 344.

In aspects, the invention provides the delivery device of aspect 344, wherein the means for delivering/providing volatile compound(s) (number 11 of aspect 344) comprises one or more characteristics of one or more of aspects 240-294, 305, and 306. ASPECT 345.

In aspects, the invention provides the delivery device of one or more of aspects 343-345, wherein the device is used in any one or more of the methods described in any one or more of aspects 318-342. ASPECT 346.

In aspects, the invention provides a delivery device for delivering one or more volatile compounds to a user of the delivery device, wherein the delivery device comprises at least one or more means of fidgeting (fidgeting means). ASPECT 347.

In aspects, the invention provides the delivery device of aspect 347, wherein at least one of the one or more means of fidgeting is also a means of airflow control through the delivery device. ASPECT 348.

In aspects, the invention provides the delivery device of aspect 347, wherein at least one of the one or more means of fidgeting is also a means for selective engagement of two or more components of the delivery device. ASPECT 349.

In aspects, the invention provides the delivery device of aspect 347, wherein at least one of the one or more means of fidgeting is also a means of supporting the delivery device in combination with a device support accessory. ASPECT 350.

In one aspect, the invention provides the device of one or more of aspects 1-239, 302-304, and aspects 343-350, wherein the device is designed to cooperatively engage with, i.e., is designed for compatible use with, one or more accessories. ASPECT 351.

In one aspect, the invention provides the device of one or more of aspects 1-239, 302-304, and aspects 343-350, wherein the device is designed to cooperatively engage with, i.e., is designed for compatible use with, a device support unit. ASPECT 352.

In one aspect, the invention provides a device support unit suitable for supporting, e.g., storing a delivery device designed for the delivery of volatile compound(s) to a user thereof, wherein the support unit maintains the delivery device in an at least partially open (e.g., at least partially exposed) environment for quick access thereto by a user of the delivery device. ASPECT 353.

In one aspect, the invention provides the device storage/support unit of aspect 353, wherein the device support unit comprises at least one component designed to cooperatively engage with, i.e., designed for compatible use with, a delivery device capable of delivering volatile compound(s), e.g., flavored volatile compound(s), to a user of the delivery device. ASPECT 354.

In one aspect, the invention provides the device storage unit of one or more of aspects 353-354, wherein the device support unit is designed to be compatible with a delivery device having one or more characteristics described in one or more of aspects 1-239, 302-304, and aspects 343-350. ASPECT 355.

In one aspect, the invention provides the device storage/support unit of one or more of aspects 353-355, wherein the device support unit comprises a first part of an at least two part support connection mechanism, and wherein the delivery device comprises a second part of the at least two part support connection mechanism, and wherein the first and second parts of the at least two part support connection mechanism are capable of maintaining the delivery device and the device support unit in physical contact with one another. ASPECT 356.

In one aspect, the invention provides the device storage unit of aspect 356, wherein the first and second parts of the device support unit connection mechanism are releasably engageable, either directly or indirectly, with one another. ASPECT 357.

In one aspect, the invention provides the device support unit of one or both of aspect 356 and aspect 357, wherein the orientation of the first and second parts of the support connection mechanism within the device support unit and the delivery device, respectively, are configured, e.g., oriented, such that the spatial orientation of the delivery device on, within, about, or otherwise relative to the device support unit when the first and second parts of the support connection mechanism are engaged is at least essentially the same during any period(s) of storage or placement of the delivery device using the device support unit. ASPECT 358.

In one aspect, the invention provides the device support unit of one or more of aspects 353-358, wherein the device support unit does not comprise a component which (1) attracts the delivery device to the device support unit; (2) physically connects or attaches the delivery device to the device support unit; or which otherwise (3) engages the delivery device in a manner requiring a significant force for detaching the delivery device from the device support unit. ASPECT 359.

In one aspect, the invention provides the device of aspect 359, wherein the device support unit provides a non-attractive mating component for one or more component(s) or feature(s) of a delivery device. ASPECT 360.

In one aspect, the invention provides the device of one or both of aspect 359 and aspect 360, wherein the delivery device is maintained on, in, or otherwise about the device support unit during a storage or placement period by force of gravity. ASPECT 361.

In one aspect, the invention provides the device of one or more of aspects 359-361, wherein the device support unit is characterizable as a cradle or plate. ASPECT 362.

In one aspect, the invention provides the device support unit of one or more of aspects 353-358, wherein the device support unit comprises a component of a multi-component support connection mechanism, which (1) attracts the delivery device to the device support unit; (2) physically connects or attaches the delivery device to the device support unit; or which otherwise (3) engages the delivery device in a manner requiring detectably or significantly more force for removing the delivery device from the device support unit than would be required to simply lift the delivery device from the device support unit if such a component were absent. ASPECT 363.

In one aspect, the invention provides the device support unit of aspect 363, wherein the device support unit is characterizable as a stand suitable for placement upon a shelf, table, counter, or other common household or commercial surface and which is designed to maintain the delivery device it stores off of/away from the shelf, table, counter, or other common household or commercial surface upon which the device support unit is placed. ASPECT 364.

In one aspect, the invention provides the device support unit of one or both of aspect 363 and aspect 364, wherein the engagement of the delivery device to the device support unit is a magnetic engagement. ASPECT 365.

In one aspect, the invention provides the device support unit of aspect 365, wherein the device support unit is designed to store a delivery device having one or more of the characteristics described in one or more of aspects 1-239, 302-304, and aspects 343-350, and further having one or more of the characteristics described in one or more of aspects 61-73. ASPECT 366.

In one aspect, the invention provides the device support unit of one or both of aspect 365 and aspect 366, wherein the device support unit and the delivery device to be maintained by the device support unit each comprise a magnet, and wherein the magnet orientation (e.g., with regard to polar orientation) within the device support unit and the magnet orientation (e.g., with regard to polar orientation) within the delivery device are such that the spatial orientation of the delivery device when stored by the device stage unit is predictable. ASPECT 367.

In one aspect, the invention provides the device support unit of one or more of aspects 365-367, wherein the device support unit comprises a delivery device reception component, wherein the surface of the delivery device reception component for receiving the delivery device is not flat. ASPECT 368.

In one aspect, the invention provides the device support unit of aspect 368, wherein the surface of the delivery device reception component is arced (e.g., comprises a detectably or significantly domed shape). ASPECT 369.

In one aspect, the invention provides the device support unit of one or both of aspect 368 and aspect 369, wherein the delivery device reception component of the device support unit is positioned at an angle relative to the surface upon which the device support unit is placed. ASPECT 370.

In one aspect, the invention provides the device support unit of one or both of aspect 369 and aspect 370, wherein the center of gravity of the delivery device, when the delivery device is placed on the delivery device reception component of the device support unit, forces the device to assume a position wherein the end of the delivery device to which the center of gravity is the closest points downward, e.g., points toward the lower end of the angled delivery device reception component of the device support unit. ASPECT 371.

In one aspect, the invention provides the device support unit of one or more of aspects 363-371, wherein the device support unit comprises a device reception component which has a circular shape or an elliptical shape, and wherein the device reception component comprises a surface for receiving a delivery device which is curved, i.e., domed. ASPECT 372.

In one aspect, the invention provides the device support unit of one or more of aspects 363-372, wherein the device support unit comprises a device reception component comprising a natural material such as, e.g., wood or a wood veneer. ASPECT 373.

In one aspect, the invention provides the device support unit of one or more of aspects 363-372, wherein the device support unit comprises a device reception component comprising a synthetic material such as, e.g., a plastic. ASPECT 373.

In one aspect, the invention provides the device support unit of one or more of aspects 363-374, wherein the device support unit comprises a device support unit base. ASPECT 375.

In one aspect, the invention provides the device support unit of aspect 375, wherein the device support unit base which is circular or elliptical in shape (e.g., has a circular or elliptical footprint). ASPECT 376.

In one aspect, the invention provides the device support unit of one or both of aspect 375 and aspect 376, wherein the device support unit base of the device support unit comprises a natural material such as, e.g., wood, a metallic material such as, e.g., stainless steel, or both. ASPECT 377.

In one aspect, the invention provides the device support unit of one or more of aspects 375-377, wherein the device support unit comprises a connection component for connecting the device reception component to the device support unit base. ASPECT 378.

In one aspect, the invention provides the device support unit of aspect 378, wherein the device support unit base comprises an access component, e.g., a hole or opening, designed for accessing the connection component. ASPECT 379.

In one aspect, the invention provides the device support unit of one or more of aspects 375-379, wherein the device support unit base comprises a reception component for maintaining a component participating in the connection of the device support unit to a delivery device. ASPECT 380.

In one aspect, the invention provides the device support unit of aspect 380, wherein the reception component is a component configured to hold a magnet. ASPECT 381.

In one aspect, the invention provides the device support unit of one or more of aspects 375-381, wherein the device support unit comprises a component interfacing with the surface upon which the device support unit is placed, wherein the component detectable or significantly protects the device support unit from scratching the surface upon which the device support unit is placed, detectably or significantly prevents the device support unit from unintentionally moving, e.g., sliding, upon the surface on which the device support unit is placed, or both. ASPECT 382.

In one aspect, the invention provides the device support unit of one or more of aspects 352-382, wherein the device support unit comprises any one or more of the features visible in FIGS. 26A-26D, 27A, 27B, 28A, 28B, 29A, 29B, 30, 31A-31C, 32A-32C, 33, 34, and 35A-35D or any one or more features interpretable by one of skill in the art as being present according to FIGS. 26A-26D, 27A, 27B, 28A, 28B, 29A, 29B, 30, 31A-31C, 32A-32C, 33, 34, and 35A-35D. ASPECT 383.

In one aspect, the invention provides the device support unit of one or more of aspects 353-383, wherein the device support unit weighs between about 100 g and about 200 g. ASPECT 384.

In one aspect, the invention provides the device support unit of aspect 384, wherein the device support unit weighs between about 125 g and about 150 g. ASPECT 385.

In one aspect, the invention provides the device support unit of aspect 385, wherein the device support unit weighs between about 140 g and about 160 g. ASPECT 386.

In one aspect, the invention provides the device support unit of one or more of aspects 353-386, wherein the weight of the device support unit is between about 150% and about 200% greater than that of the delivery device which it stores (e.g., than that of the delivery device comprising a cooperating connection component to a connection component present on or within the device support unit). ASPECT 387.

In one aspect, the invention provides the device support unit of one or more of aspects 353-387, wherein the weight of the device support unit is between about 160% and about 195% greater than that of the delivery device which it stores (e.g., than that of the delivery device comprising a cooperating connection component to a connection component present on or within the device support unit). ASPECT 388.

In one aspect, the invention provides the device support unit of one or more of aspects 353-388, wherein the ratio of the weight of the device support unit to the delivery device which it stores (e.g., to the delivery device comprising a cooperating connection component to a connection component present on or within the device support unit) is between about 1:1 and about 7:1. ASPECT 389.

In one aspect, the invention provides the device support unit of one or more of aspects 353-389, wherein the ratio of the weight of the device support unit to the delivery device which it stores (e.g., to the delivery device comprising a cooperating connection component to a connection component present on or within the device support unit) is between about 1.2:1 and about 3.3:1. ASPECT 390.

In one aspect, the invention provides the device support unit of one or more of aspects 353-390, wherein the ratio of the weight of the device support unit to the delivery device which it stores (e.g., to the delivery device comprising a cooperating connection component to a connection component present on or within the device support unit) is between about 2:1 and about 3:1. ASPECT 391.

In aspects, the invention provides an unpowered, handheld device (commonly referred to herein as a delivery device), (e.g., (20), (100)) for delivering volatile flavored compounds to the mouth of an individual, the device comprising: (1) a body component (commonly referred to herein as a volatile compound outlet component (e.g., (201)) comprising (a) a mouthpiece component (e.g., (301)) comprising (I) a mouthpiece component outer surface (e.g., (607)) that is mostly or entirely composed of a metallic material, (II) a mouthpiece component inner surface (e.g., (609)) that is mostly or entirely composed of a metallic material, (III) a mouthpiece component outlet (e.g., (14)), (IV) a mouthpiece component inlet (e.g., within mouthpiece component second end (606)), and (V) a mouthpiece component airflow channel (e.g., (604)) positioned between the mouthpiece component inlet and mouthpiece component outlet, and (b) a body tube component (e.g., (402)) comprising (I) a tube-forming wall (e.g., (1013)), that is composed of a metallic material, (II) a body tube inlet (e.g., (1004)), (III) a body tube outlet (e.g., (1002)), (IV) a body tube airflow channel (e.g., (1024)) positioned between the body tube inlet and the body tube outlet, wherein the body tube airflow channel is in airflow communication with the mouthpiece component airflow channel, and (V) an insert compartment (e.g., (1022)) comprising (A) an insert compartment first end (e.g., (1025)) positioned proximally to the body tube inlet where the tube-forming wall forms a complete tubular structure around the insert compartment first end, (B) an insert compartment second end (e.g., (1027)) positioned proximally to the body tube outlet where the tube-forming wall forms a complete tubular structure around the insert compartment second end, and (C) a central area (e.g., (1030)) positioned between the insert compartment first end and second end, wherein the central area of the insert compartment is positioned within a portion of the body tube wherein the body tube wall does not form a complete tubular structure so as to form an insert compartment opening in the body tube wall, (2) a barrel component (commonly referred to herein as a mating component) (e.g., (202), (1308)) that selectively releasably engages the body component to form the device, the barrel component comprising (a) a barrel component outer surface (commonly referred to herein as an exterior or outer shell) that is composed of wood or other porous organic material, (b) an engagement end (e.g., (1702)) that comprises a barrel component engagement end opening (e.g., (1703)), (c) a barrel component inlet end (e.g., (1704)) that comprises a barrel component inlet end opening (e.g., (1705)), and (d) a barrel component channel (e.g., (1713)) which is positioned between barrel component engagement end opening and the barrel component inlet end opening, wherein when the barrel component and the body component are engaged, the body tube component is positioned within the barrel component channel, the body tube inlet is positioned within the barrel component inlet end opening, and the barrel component covers the insert compartment opening forming an enclosed continuous interior airflow channel (e.g., a total air channel (e.g., (203)) that is positioned between and permits airflow between the body tube inlet and the mouthpiece component outlet. ASPECT 392.

In aspects, the invention provides the device of aspect 392, wherein the opening to the enclosed continuous interior airflow channel is at least about 25% blocked by one or more components of the device. ASPECT 393.

In aspects, the invention provides the device of one or both of aspect 392 and aspect 393, wherein the engagement of the barrel component and the body component allows for the rotation of the barrel component and the body component relative to one another while the barrel component and body component are in contact. ASPECT 394.

In aspects, the invention provides the device of one or more of aspects 392-394, wherein the outer surface of the barrel component is longer than the outer surface of the mouthpiece component. ASPECT 395.

In aspects, the invention provides the device of one or more of aspects 392-395, wherein the mouthpiece component comprises two separate reduced diameter areas (e.g., (601), (602)), each reduced diameter area having a first end and a second end (e.g., (570) and (580), ((590) and (600)), that are each positioned between the mouthpiece component inlet and the mouthpiece component outlet, each of the reduced diameter areas having an outer diameter at their narrowest point that is between about 45% and about 85% of that of the maximum outer diameter of the mouthpiece component. ASPECT 396.

In aspects, the invention provides the device of one or more of aspects 392-396, wherein the outer surface of the mouthpiece component comprises a grooved area (e.g., (603)) located near an end of one of the two reduced diameter areas. ASPECT 397.

In aspects, the invention provides the device of one or more of aspects 392-397, wherein the metallic material of the mouthpiece component is stainless steel. ASPECT 398.

In aspects, the invention provides the device of one or more of aspects 392-398, wherein between about 40% and about 75% of the perimeter of the tube-forming wall is missing at the insert compartment opening. ASPECT 399.

In aspects, the invention provides the device of one or more of aspects 392-398, wherein the body tube component comprises a body tube airflow channel component (e.g., which as exemplified herein could be, e.g., an insert positioner (e.g., (504), (506)), which comprises a reduced inner diameter compared to the diameter of the insert compartment and allows airflow communication between the insert compartment and the mouthpiece component airflow channel. ASPECT 400.

In aspects, the invention provides a system comprising (1) the device of any device aspect described herein, e.g., one or more of aspects 392-400, and (2) a solid material device capable of maintaining, releasing, or maintaining and releasing volatile compound(s), e.g., a removable insert, e.g., a removable insert described herein (e.g., (1800)) that (a) is sized to fit within the insert compartment and (b) comprises flavored volatile compounds. ASPECT 401.

In aspects, the invention provides an unpowered, handheld device for delivering one or more volatile flavored compounds to the mouth of an individual comprising: (1) an airflow inlet that permits air to flow into the device, (2) a volatile compound outlet component that comprises a mouthpiece comprising an airflow outlet (or a mouthpiece component outlet) that allows air containing one or more volatile compounds released from the device to be delivered to the mouth of the individual, (3) a volatile compound composition storage component that, when a volatile compound composition is inserted into the device, stores the volatile compound composition until the volatile compound composition is removed from the device, (4) an enclosed airflow pathway positioned within the interior of the device that permits air to flow between the airflow inlet, the volatile compound composition storage component, and the volatile compound outlet component without permitting the release of more than 10% of the volatile compounds from the device before reaching the outlet while a user applies oral suction to the device, and (5) a selectable airflow restriction component, wherein when the individual selects an airflow restriction component setting, such selection reduces or increases airflow into, out of, or within the device. ASPECT 402.

In aspects, the invention provides the device of aspect 402, wherein the volatile compound storage component is at least partially composed of a material that is impervious to the volatile compound composition. ASPECT 403.

In aspects, the invention provides the device of aspect 403, wherein the airflow restriction component is positioned at or downstream of the airflow inlet and upstream of the volatile compound composition storage component. ASPECT 404.

In aspects, the invention provides the device of aspect 402, wherein the airflow restriction component is positioned at or downstream of the airflow inlet and upstream of the volatile compound composition storage component. ASPECT 405.

In aspects, the invention provides the device of aspect 404, wherein the airflow restriction component is placed at the airflow inlet and controls the amount of air entering the device. ASPECT 406.

In aspects, the invention provides the device of aspect 402, wherein the airflow restriction component is placed at the airflow inlet and controls the amount of air entering the device. ASPECT 407.

In aspects, the invention provides the device of aspect 406, wherein the selectable airflow restriction component is a controllable airflow restriction component by which the individual can control the amount of airflow restriction applied by the airflow restriction component. ASPECT 408.

In aspects, the invention provides the device of aspect 402, wherein the selectable airflow restriction component is a controllable airflow restriction component by which the individual can control the amount of airflow restriction applied by the airflow restriction component. ASPECT 409.

In aspects, the invention provides the device of aspect 408, wherein adjustment of the controllable airflow restriction component is associated with a tactile position indicator, an auditory motion indicator, a visual position indicator, or a combination of any or all thereof. ASPECT 410.

In aspects, the invention provides a device or system for delivering one or more volatile flavored compounds to the mouth of an individual, the device or system comprising: (1) an unpowered, handheld volatile compound delivery device that comprises (a) an airflow inlet that permits air to flow into the device, (b) a volatile compound outlet component that comprises a mouthpiece comprising an airflow outlet that allows air containing one or more volatile compounds released from the device to be delivered to the mouth of the individual, (c) a volatile compound composition storage component that, when a volatile compound composition is inserted into the device, stores the volatile compound composition until the volatile compound composition is removed from the device, and (d) an enclosed airflow pathway positioned within the interior of the device that permits air to flow between the airflow inlet, the volatile compound composition storage component, and the volatile compound outlet component without permitting the release of more than 10% of the volatile compounds from the device before reaching the outlet while a user applies oral suction to the device, and (2) one or more movable fidget elements, wherein at least one of the one or more fidget elements is (a) a component of the volatile compound delivery device, (b) a device or component of a device in a system comprising two or more devices including the volatile compound delivery device, or (c) a component of the volatile compound delivery device and is a device or a component of a device in a system comprising two or more devices including the volatile compound delivery device, wherein, in each applicable case, the movable fidget element is positioned in an initial resting position prior to the user using the device or the system, and wherein the movement of the movable fidget component is initiated when the user applies a minimum initiation force of at least 0.2-3 Newtons to the movable fidget element, thereby causing the movable fidget element to move to a detectibly different position than the initial resting position, at least temporarily, within a period of less than 10 seconds. ASPECT 411.

In aspects, the invention provides the system or device of claim 411, wherein the movement of at least one of the one or more movable fidget elements is a rotating motion, a spinning motion, a swinging motion, or a push/pull motion. ASPECT 412.

In aspects, the invention provides the system or device of aspect 412, wherein at least one of the one or more movable fidget elements releasably engages the volatile compound outlet component. ASPECT 413.

In aspects, the invention provides the system or device of aspect 411, wherein at least one of the one or more movable fidget elements releasably engages the volatile compound outlet component. ASPECT 414.

In aspects, the invention provides the system or device of aspect 412, wherein at least one of the one or more movable fidget elements releasably engages the volatile compound outlet component by a magnetic attraction. ASPECT 415.

In aspects, the invention provides the system or device of aspect 411, wherein at least one of the one or more movable fidget elements is adapted to come to rest in a position that is the same as or about the same as the initial resting position in at least one dimension. ASPECT 416.

In aspects, the invention provides the system or device of aspect 415, wherein at least one of the one or more movable fidget elements also encloses a part of the volatile compound composition storage component when at rest and engaged with the volatile compound outlet component. ASPECT 417.

In aspects, the invention provides the system or device of aspect 411, wherein at least one of the one or more movable fidget elements, once set in motion by the minimum initiation force, automatically continues movement for a period of about 3.5 seconds or less. ASPECT 418.

In aspects, the invention provides the system or device of aspect 411, at least one of the one or more movable fidget elements comprises a releasable engagement mechanism composed of two components, wherein the user must reengage the components to re-set the releasable engagement mechanism prior to repeating the movement of the at least one movable fidget element, and wherein the minimum force required to reengage the components is about the same or less than the minimum initiation force. ASPECT 419.

In aspects, the invention provides the system or device of aspect 411, wherein the system or device comprises at least two movable fidget elements. ASPECT 420.

In aspects, the invention provides the system or device of aspect 417, wherein the device or system is a system that comprises a support device that releasably engages the volatile compound delivery device, wherein the volatile compound delivery device serves as the fidget element, the volatile compound delivery device moving when the user applies the initiation force to the volatile compound delivery device while it is engaged with the support device. ASPECT 421.

In aspects, the invention provides the system or device of aspect 411, wherein the device or system is a system that comprises a support device that releasably engages the volatile compound delivery device, wherein the volatile compound delivery device serves as the fidget element, the volatile compound delivery device moving when the user applies the initiation force to the volatile compound delivery device while it is engaged with the support device. ASPECT 422.

In aspects, the invention provides an unpowered, handheld device for delivering one or more volatile flavored compounds to the mouth of an individual comprising: (1) an airflow inlet that permits air to flow into the device, (2) a volatile compound outlet element that comprises a mouthpiece comprising an airflow outlet that allows air containing one or more volatile compounds released from the device to be delivered to the mouth of the individual, wherein at least most of the volatile compound outlet element is composed of a first material that is impervious to one or more volatile compound compositions, (3) a volatile compound composition storage element that, when a volatile compound composition is inserted into the device, stores the volatile compound composition until the volatile compound composition is removed from the device, wherein at least most of the volatile compound composition storage element is composed of the first material or a second material that is impervious to the one or more volatile compound compositions, (4) an enclosed airflow pathway positioned within the interior of the device that permits air to flow between the airflow inlet, the volatile compound composition storage element, and the volatile compound outlet element without permitting release of more than 10% of the volatile compounds from the device before reaching the outlet when the user applies an oral suction force to the device, and (5) a mating element that releasably engages the volatile compound outlet element, wherein the mating element is composed of a third material that is different from the first material and the second material, if applicable, wherein the third material is either at least 50% less dense than the first material, is associated with a detectably different tactile physiological response than the first material, or both. ASPECT 423.

In aspects, the invention provides the device of aspect 423, wherein the first material is dishwasher safe. ASPECT 424.

In aspects, the invention provides the device of aspect 424, wherein the first material is metallic, and the third material is wood. ASPECT 425.

In aspects, the invention provides the device of aspect 425, wherein the user can manually rotate the mating element relative to the volatile compound output element while the volatile compound output element and mating element remain in contact. ASPECT 426.

In aspects, the invention provides the device of aspect 426, wherein the device comprises a single body component in which the volatile compound storage element is securely attached to the volatile compound outlet element, wherein the volatile compound storage element is an insert compartment comprising an insert opening that is adapted to receive, and the insert compartment is adapted to support, an insert made of a porous material that absorbs one or more volatile compound compositions. ASPECT 427

In aspects, the invention provides the device of aspect 427, wherein the center of balance of the device is located within about +/−15% of the length of the device from where the volatile compound outlet element engages the mating element. ASPECT 428.

In aspects, the invention provides a system comprising (1) the device of aspect 428 and (2) a removable insert that (a) is sized to fit within the insert compartment, (b) comprises one or more flavored volatile compounds, and (c) comprises one or more structural features that increase the surface area of the insert as compared to a uniform solid insert of substantially the same shape and size. ASPECT 429.

In aspects, the invention provides the system of aspect 429, wherein the volatile compound composition storage element is an insert compartment adapted to receive the insert and comprises an insert support element that promotes the insert remaining in position within the insert compartment. ASPECT 430.

In aspects, the invention provides the system of aspect 430, wherein a section of the enclosed airflow pathway is positioned between the insert compartment and the airflow outlet and comprises a reduced inner diameter compared to the inner diameter in at least one location of the insert compartment, the inner diameter in at least one location of the airflow channel upstream of the insert compartment, or the inner diameter in at least one location of each of the insert compartment and the airflow channel upstream of the insert compartment. ASPECT 431.

In aspects, devices are provided that combine any of the above-described device-related aspects.

In aspects, systems are provided that combine any of the above-described system-related aspects or that otherwise comprise device(s) according to any of the above-described related aspects.

In aspects, any of the disclosure herein is combined with any element of the figures of this disclosure or description thereof provided herein.

DETAILED DESCRIPTION OF THE INVENTION

Uncontradicted, the following detailed description is merely exemplary in nature and is not intended to limit this disclosure or any aspect thereof (e.g., to any particular material, construction, characteristic, or use).

In this section, both combinations of elements/steps of aspects and individual elements/steps are described. Despite the inclusion of sections/passages focused on specific elements/steps, readers will understand that any aspect, facet, embodiment, or other description of a particular step or element can be applied to or combined with any suitable general description of composition, device, system or method aspects, or any other recited element(s)/step(s) thereof, which are provided in any part of this disclosure. For example, a number of elements, functions, and characteristics described in the Summary of this disclosure or the Exemplary Aspects section can be combined with aspects provided herein (e.g., the amount of air or VCs released from the device at any point other than the outlet when a user applies an oral suction force to the device, which may be better described in such other section(s) of the disclosure).

Overview of Basic Exemplary Aspects

Described here are new device(s) and system(s) for the delivery of volatile compound(s) to users, and related method(s) of their use.

Further to the description provided above, readers will recognize that typically the word "volatile" in relation to compound(s) refers to a compound that is volatilizable under ordinary environmental/room conditions. A composition in which volatile compound(s) are present can be described as a volatile compound composition or a volatile compound media (or volatile compound-associated media) (the latter terms are more often used in connection with solid material comprising volatile compounds, such as an insert). In aspects, a volatile compound herein is a compound that detectably or significantly evaporates at normal temperatures. In aspects, a volatile compound herein is a compound that can become volatilized under certain condition(s). In aspects, such a condition is the application of a detectable or significant amount of heat. In aspects, such a condition is a normal condition of use. In aspects, a normal condition of use is the application of suction by a device or system user, causing air to pass over a part, component, or assembly of a delivery device, maintaining the compound(s). In aspects, a normal condition of use is any condition by which no electronic source of heat is used to release the compound(s) from a, e.g., compartment, housing, or device in which they are maintained. In aspects, such a condition is a condition that does not include a change in the average temperature of the volatile compound composition by an amount of more than about, e.g., ~2%, ~4%, ~5%, ~10%, ~15%, ~20%, ~25%, ~50%, ~75%, ~100%, ~150%, ~200%, ~250%, ~300%, ~350%, ~400%, or ≥~450%, or, e.g., by an amount of more than about 500% or more of the composition's starting temperature. In aspects, most, generally all, substantially all, essentially all, or all of the volatile compounds of a volatile compounds composition described/used herein can be delivered from a device without requiring a change in temperature by an amount of more than about 5° Celsius (° C.), such as, e.g., by an amount of more than ~10° C., ~15° C., ~20° C., ~25° C., ~30° C., ~40° C., ~50° C., ~60° C., ~70° C., ~80° C., ~90° C., ~100° C., ~120° C., ~140° C., ~160° C., ~180° C., or, e.g., by more than ~200° C. or more. Readers will understand that in a complex disclosure such as this, different styles of presentation of temperatures or other units do not signify differences in the referenced measurements.

In aspects, device(s), e.g., the delivery device(s) and system(s) disclosed herein can be used for the pleasure of a user. Device(s) and system(s) herein can be used simply for entertainment and enjoyment, e.g., as a hobby or pleasurable activity. In aspects, entertainment (enjoyment or pleasure) is obtained from the delivery of one or more volatile compounds by a device or system described herein to the mouth of a delivery device user.

In aspects, entertainment (enjoyment or pleasure) can also be provided by manual manipulation of certain device(s) provided herein, such as, e.g., by a user playing with one or more parts, components, mechanisms, features, etc. of a device with their hand(s) or finger(s), e.g., such as play characterizable as fondling or fidgeting.

In aspects, the use of devices, systems, etc., may be associated with one or more perceived user benefits, e.g., enhancement of focus, enhancement of relaxation, reduction of stress, or prevention of engaging in undesirable habit behavior(s). In aspects, such uses are not uses that arise to the level of treatment or prevention of a disease or medical condition. In aspects, device(s) and system(s) can be used for reducing, preventing, or assuaging one or more smoking habit-related cravings or vaping habit-related cravings, such as one or more smoking habit-related or vaping habit-related cravings experienced by a subject attempting to quit or having quit a smoking or vaping habit. In aspects such a craving may be an oral craving, e.g., having something in their mouth, suctioning into the mouth one or more compounds (e.g., inhaling a flavored compound or, e.g., a drug such as, e.g., nicotine), holding an object, e.g., a device to their lips, feeling the device on or between their lips, or similar such oral-fixation-related craving.

In certain aspects, the invention provides a customizable flavor delivery experience, by, e.g., in embodiments providing a device for the delivery of one or more volatile compounds wherein the device comprises a selectable, e.g., a controllable (i.e., an adjustable) airflow restrictor (airflow control mechanism). In aspects a smoking-habit related craving may be a manual manipulation-related craving, e.g., having something to manipulate via a user's hand(s), such as, e.g., holding an object, e.g. device, in their hand, e.g., between two or more fingers, playing with a device with their hand(s) or fingers(s), e.g., such play characterizable as fondling, or, e.g., fidgeting, keeping their hands and or fingers occupied with such an object or device, or similar such manual manipulation-related craving. In aspects, device(s) and system(s) herein can provide both entertainment value and assistance in reducing or eliminating one or more smoking habit-related cravings.

In certain aspects, device(s) provided by the invention can comprise one or more electronic part(s), component(s), or assembly(ies). In aspects, device(s) provided by the invention can comprise one or more heating or heatable part(s), component(s), or assembly(ies). In certain aspects, devices provided by the invention can comprise an electronic heating component (or, e.g., an electronic heating mechanism). In aspects, uncontradicted, any one or more characteristics of the device described herein, e.g., any one or more aspects of the invention provided herein, can be applied to a device which comprises one or more electronic part(s), component(s), assembly(ies), or mechanism(s) providing such a functionality. In aspects, uncontradicted, any one or more of the characteristics of the device described herein, e.g., any one or more aspects of the invention provided herein, can be applied to a device which comprises one or more heating part(s), component(s), assembly(ies), or mechanism(s) providing such a functionality. In aspects, uncontradicted, any one or more characteristics of the device(s) described herein, e.g., any one or more aspects of the invention provided herein, can be applied to device(s) which comprises one or more electronic heating part(s), component(s), assembly(ies), or mechanism(s) providing such a functionality.

In certain aspects device(s), e.g., delivery device(s) (e.g., any volatile compound delivery device) of the invention does/do not comprise one or more electronic part(s), component(s), assembly(ies), or mechanism(s) providing such a functionality (e.g., the device(s) is/are characterizable as non-electronic). In aspects, device(s) of the invention does/do not comprise one or more heating part(s), component(s), assembly(ies), or mechanism(s) providing such a functionality (e.g., the device(s) is/are characterizable as non-heating). In aspects, device(s) of the invention does/do not comprise electronic or heating part(s), component(s), assembly(ies), or mechanism(s) providing such a functionality (e.g., the device is characterizable as non-electronic and non-heating.) In aspects, uncontradicted, any one or more of the characteristics of the device described herein, e.g., any one or more aspects of the invention provided herein, can be applied to device(s) which lack(s) a part, component, assembly, or mechanism characterizable as electronic, heating, or both.

In aspects, in operation, e.g., in a ready-to-use state, device(s) provided by the invention can comprise a first non-electronic, non-heating device for the delivery of one or more volatile compounds (a delivery device) and further a solid material device capable of maintaining, releasing, or maintaining and releasing the one or more volatile compounds (i.e., insert). In aspects, such a combination, e.g., a delivery device (e.g., a non-electronic or more generally unpowered/passive, non-heating device for the delivery of one or more volatile compounds (e.g., diffusion of essential oil(s)) in combination with a solid material device capable of providing such one or more volatile compounds (i.e., insert) is characterizable as a system, e.g., a system for delivering one or more volatile compound(s) by inhalation. In aspects, such a system can further provide one or more part(s), component(s), assembly(ies), or mechanism(s) which provide entertainment, or detectable or significant smoking habit-related craving reduction separate from volatile compound delivery or oral interaction, such as, e.g., by providing a manually manipulatable mechanical mechanism.

Delivery Devices

In one aspect, the invention provides novel devices designed for the delivery of one or more volatile compounds. Herein, uncontradicted the term "delivery device" is used to describe this aspect of the invention. A reader will accordingly understand that the term delivery device refers to a device that a user uses to deliver volatile compound(s) to a user.

In aspects, the delivery device facilitates the delivery of one or more volatile compounds via the nose, the mouth, or both the nose and the mouth. In certain aspects, the delivery device facilitates the delivery of one or more volatile compounds at least generally, at least substantially, at least essentially, essentially, or completely by mouth. In aspects, the delivery comprises delivery to the mouth, the device is adapted, at least in part, to deliver compounds to the mouth, or both. In aspects, a delivery device comprises the delivery of diffused volatile compounds, e.g., flavored volatile compounds (e.g., delivery is via diffusion, such that, in aspects, a delivery device can be characterized as a device for the delivery of volatile compound(s) by diffusion).

In aspects, delivery device(s) described herein can be characterized as diffusive devices(s). That is, in aspects, delivery device(s) provide delivery of volatile compound(s), e.g., flavored volatile compound(s), by diffusion or evaporation of VCs in a VCC in a device (e.g., in an insert or other composition/media), which may be, in aspects, aided by user-generated airflow. Accordingly, in aspects, delivery device(s) deliver scent and flavor (e.g., flavor to the mouth of a device user) through the application of a sufficient amount of negative/vacuum pressure, e.g., suction, to a device by, e.g., the action of a user. In aspects, as is described herein, the process is characterizable as an aromatherapy-based process. In aspects, the process of compound delivery does not comprise the application of heat or the vaporization of oil(s) comprising volatile compound(s). In aspects, volatile compound delivery is to the mouth and olfactory tract. In aspects, delivery device(s) herein are not intended to deliver volatile compounds by inhalation of compound(s) into the lung(s) of a user, or generally, substantially, or essentially all of the VCs delivered to a user are maintained in the mouth, nose, or mouth and nose of the user, rather than being ingested into the lungs. According to aspects, device(s) herein may be found useful for users in replacing devices used in similar ways (e.g., vaping devices, cigarettes, and the like) by providing a similar experience but replacing such arguably dangerous habit(s) with habits not detrimental to health, although typically the devices of this disclosure are not intended to treat or prevent any disease or condition such as addition. In such respects, the use of devices can ordinarily be considered to provide a benefit similar to other non-regulated aids in habit reformation such as exercise, liquid ingestion (e.g., drinking tea to help with the symptoms associated with smoking/vaping cessation) and the like. In aspects, methods may be associated with health or health-related promoting effects or metabolic/physiologic impacts, which may be akin to or comparable in degree to, e.g., dietary supplement usage or beneficial food usage. Such effects have been described in the art (see, e.g., Fung et al. Int J Mol Sci. 2021 May 3; 22(9):4844. doi: 10.3390/ijms22094844 and Wu et al. PLoS One. 2012; 7(9):e44830. doi: 10.1371/journal.pone.0044830).

According to aspects, delivery device(s) herein comprise a total airflow channel, wherein the total airflow channel begins at a device inlet and ends at a device outlet. In aspects, a device inlet is distal from a portion of the delivery device designed to engage with the user during use of the device, e.g., is distal from a portion of the delivery device designed to engage with the lips of the user during use of the device. In aspects, a device outlet is proximal to the user, and is, e.g., associated with a portion of the device designed to engage with the user of the delivery device during use. In aspects, a device outlet is an opening in a volatile compound outlet component (VCOC), and a device inlet is an opening in a mating component or in both a mating component and a part of the VCOC (e.g., in a VCOC extension) (or, alternatively, simply in a VCOC). In aspects, the total airflow channel passes through a plurality of delivery device part(s), component(s), assembly(ies), or combination(s)

thereof as it passes from a device inlet to a device outlet. In aspects, each such device part, component, or assembly can comprise its own airflow channel or path, such airflow channel(s)/path(s) combining to form the total airflow channel (e.g., path or passageway) through a delivery device.

Herein, in aspects device(s) are provided in a "ready-to-use state." In general, a "ready to use" state means that the device is in a configuration suitable for the delivery of one or more volatile compounds to a user as ordinarily intended (e.g., consistent with device instructions/labeling). In aspects, a device is a multi-part device (e.g., a device comprising distinct VCOC and mating component elements) and the device is in a "ready-to-use" (or simply "ready") state when the device is fully assembled, e.g., all part(s), component(s), or assembly(ies) are present and properly attached/engaged. In aspects, such a configuration is a configuration wherein a delivery device first component, e.g., a volatile compound outlet component, and a delivery device second component, e.g., mating component, are engaged to one another via a releasable attachment mechanism, e.g., a selectively releasable attachment mechanism (also referred to herein as a selectively releasable engagement mechanism), e.g., rapidly releasable attachment mechanism.

In certain aspects, a delivery device is a device capable of delivering, e.g., designed to deliver or which delivers, one or more volatile compounds without the intentional application of heat, such as heat provided by a dedicated heating element of the device or associated with the device. In aspects, a device is a non-electronic, non-heating device, comprising no electronic component and, e.g., no heating element. In aspects, a delivery device is characterizable as a "passive" device, wherein "passive" is used to describe the ability to release or provide one or more volatile compound(s) without the application of heat. In aspects, one or more volatile compounds are released by a component of a device, a complementary device designed for use with the delivery device (such as, e.g., an insert), or both. In aspects, the release of the one or more volatile compound(s) occurs simply due to their volatile nature and not due to the application of any external force(s), such as, for example, by diffusion. In certain aspects, a delivery device provided by the invention provides non-electronic volatilization/vaporization of one or more volatile compound(s). In aspects, a delivery device provided by the invention provides non-heat-directed volatilization/vaporization of one or more volatile compounds. In aspects, a delivery device can comprise one or more electronic components which are not directly related to the release of volatile compound(s). As an example, in aspects, a delivery device provided by the invention can comprise, e.g., an electronic component capable of generating a location signal such that such a feature can be used by a user to locate the delivery device. However, such an electronic component or feature is not directly related to, e.g., is not present to cause, the release of one or more volatile compound(s).

For convenience, while multiple embodiments of exemplary of device(s) are illustrated in the figures, all of which are handheld, unpowered, diffusion device(s) for delivery of compounds to the mouth. Illustrated in the figures is an exemplary delivery device having certain features associated with a highly refined and particular embodiment of the invention. Readers will understand from elsewhere in this disclosure that device(s) of the invention can vary, i.a., lacking one or more of such features, comprising alternative features (e.g., additional elements for promotion of "fidgeting" habits), or may vary in terms of comprising powered elements, being not readily detachable (or being composed of a single volatile compound outlet component), etc. As is reiterated elsewhere herein, uncontradicted any reference to a specific embodiment or a name assigned thereto should be interpreted as encompassing reference to a less specific embodiment of such element and vice versa (e.g., reference to a "body assembly" should be interpreted as also encompassing reference to a "volatile compound outlet component."

Delivery Device Primary Component(s)

In aspects, a delivery device provided by the invention comprises a single component. In aspects, a delivery device provided herein comprises at least two parts, components, or assemblies. In aspects, a delivery device provided by the invention comprises at least two parts, components, or assemblies which are selectively disengaged from one another. In aspects, a delivery device is characterizable as having at least two "primary" components. Herein, a "primary component" is a component which is not a subcomponent of a larger component. While a primary component itself can comprise one or more part(s), subcomponent(s), subassembly(ies), mechanism(s), etc., it itself is not a part, subcomponent, or subassembly of another device component. Typically, the primary components of a device account for most, generally all, substantially all, essentially all, or all of the mass of a device, functionality of a device, or both. For example, in aspects, devices comprise a VCOC and a mating component that make up substantially all, essentially all, or all of the parts, mass, and functions of the device.

In certain aspects, a primary component, e.g., first component, e.g., volatile compound outlet component (VCOC), can comprise one or more other parts, subcomponent(s), or even assembly(ies)/subassembly(ies) of part(s)/subcomponent(s). In certain aspects, one or more part(s), subcomponent(s), or subassembly(ies) of a primary component cannot be selectively disassembled or disengaged from one another during normal operation of the device. In certain aspects, one or more part(s), subcomponent(s), assembly(ies), or, e.g., subassembly(ies) of a primary component do not require disassembly, disengagement, or movability relative to any other part, component, or assembly to facilitate the full range of uses of the delivery device. In aspects, a primary component is selectively dis-engageable from another primary component. In aspects, the delivery device comprises only two components which can be selectively disengaged from one another, each being a primary component, such as, e.g., a volatile compound outlet component and a mating component. In other aspects, the delivery device comprises a first (e.g., first primary) component and a second (e.g., second primary) component movable in relation to one another. In aspects, a first (e.g., first primary) component and a second (e.g., second primary) component are selectively dis-engageable from one another. In some respects, one or more other part(s), component(s), or assembly(ies) of the delivery device are also selectively dis-engageable from one or more other element(s) of the device, however because such part(s), component(s), or assembly(ies) is/are a subcomponent of a larger component, such a component is not characterizable herein as a "primary component."

Herein, and as exemplified in the figures, a first component (e.g., a first primary component) can be, e.g., a volatile compound outlet component (VCOC), often exemplified, embodied, or otherwise described/referenced herein as a "body component" or "body assembly," in recognition that in aspects this component makes up most of the body of the device when assembled in mass, in largest dimension, or both. As noted elsewhere, readers will understand that reference to the more specific term body component or body assembly (a body component that is assembled from distinct parts as exemplified in the figures), provides implicit support for VCOCs that are not body components/body assemblies. For example, in aspects, a mating component may form most of the body of the device when assembled.

In certain embodiments, and as exemplified in the figures, a second component can be, e.g., a volatile compound compartment Herein, as exemplified in detail in the figures, a second component (e.g., a second primary component) can be, e.g., a mating component, often exemplified, embodied, or otherwise described/referenced herein as a "tip component" or "tip assembly" where this component makes up a smaller portion of the device or attaches to the VCOC near the inlet end of the device. Again, reference to a tip assembly implicitly discloses corresponding aspects in which the mating component is not a tip assembly (either by not being an assembly, not being positioned at the tip of the device, or otherwise). In general, in broadly provided aspects (provided implicitly or explicitly) the VCOC and mating component (if present) can be positioned in any suitable configurations, can have any suitable sizes and shapes, etc., so long as these elements carrying out their respective intended functions.

In aspects, a volatile compound outlet component (e.g., body assembly) and a mating component (e.g., tip assembly) in embodiments herein can rotate in relation to one another. In aspects, such rotation can be considered a "fidget activity" or fidget motion (aspects of which are described elsewhere).

Further, a volatile compound outlet component (e.g., a body assembly) and a mating component (e.g., a tip assembly) are capable, in aspects, of being selectively disengaged from one another. In certain aspects, a volatile compound outlet component (e.g., body assembly) and a tip assembly are the only two selectively dis-engageable components of a delivery device.

In aspects, each is referred to as a primary component because at the highest level, they represent the two components of the system, which are not subcomponents of larger components, make up most of the device, or both.

In some respects, for example, a primary component, such as, e.g., a volatile compound outlet component (e.g., body assembly), can have one or more further dis-engageable components. For example, a volatile compound outlet component (e.g., body assembly) can comprise a mouthpiece as a subcomponent and in embodiments the mouthpiece can be disengaged from the remainder of the body assembly to facilitate exchange with a different mouthpiece, e.g., a mouthpiece comprising a different material, a different aesthetic design (e.g., shape, color, etc.), etc. However, because the mouthpiece is a subcomponent of the volatile compound outlet component (e.g., body assembly), it would ordinarily/commonly not be referred to as a primary component.

Uncontradicted, the use of the term "primary component" is not intendent to convey a particular hierarchy of value for such a component. Use of the term "primary component" should not be interpreted as disclosing a particular requirement for such a component. However, use of such a term to distinguish components of the delivery device described herein having particular characteristic(s), such as described above, facilitates the ability to describe the device clearly to the reader.

According to aspects, a delivery device provided by the invention comprises a first component, e.g., a first primary component, and a second component, e.g., a second primary component which are movable in relation to one another. In aspects, movement of a first (e.g., first primary) component relative to a second (e.g., second primary) component (or vice versa) is characterizable as a relational movement. In aspects, a relational movement is a movement wherein one component remains static while the second component moves in relation to the first component (or vice versa). In other aspects, a relational movement is a movement where two components move simultaneously in relation to one another. In aspects, such a simultaneous movement of a first (e.g., first primary) component relative to a second (e.g., second primary) component (or vice versa) is characterizable as a concurrent or associated relational movement. For example, a first (e.g., first primary) component such as a volatile compound outlet component can, e.g., move in a first direction while a second (e.g., second primary) component such as a mating component moves in a second direction. In certain aspects, the movement of a first (e.g., first primary) component such as a volatile compound outlet component relative to a second (e.g., second primary) component such as a mating component (or vice versa) is characterizable as a rotational movement. According to certain further aspects, as is described in detail elsewhere herein, a first (e.g., first primary) component such as a volatile compound outlet component can comprise a first airflow control part or component (airflow limiter) and a second (e.g., second primary) component can comprise a second airflow part or control component (airflow limiter). In aspects, when a first (e.g., first primary) component comprises a first airflow control part or component (airflow limiter) and a second (e.g., second primary) component (airflow limiter) comprises a second airflow control part or component, movement of the two airflow control parts or components (limiters) relative to one another can be similarly described (e.g., can have any one or more of the movement characteristics described in this paragraph.)

Delivery Device(s)—Application(s)

In aspects, the delivery device(s) described herein is/are device(s) intended for use by a mammalian user, e.g., a human.

In aspects, a device can be used by a human of any age, so long as the human user is capable of (a) sufficient manual dexterity to hold and/or manipulate the device, (b) independently suction or inhale a suitable volume of air through the device, or both (a) and (b). Therefore, in general, delivery device(s) is/are intended for use by adult human subjects or, e.g., at least human subjects having an age of at least 2 years. In specific aspects, delivery device(s) is/are used by, e.g., teen-aged human or adult human subjects. In aspects, devices are associated with instructions that the device be only used by adults or persons within a certain age range or health condition (e.g., users that are at least 16, 18, or 21 years of age).

In aspects, delivery device(s) described herein is/are intended for use in delivering one or more volatile compound(s) to a user. In aspects, delivery of one or more volatile compounds can be for pure entertainment (pleasure) purpose(s). In aspects, a user does not use a delivery device in association with any defined need or craving, but simply for enjoyment purposes.

In other aspects, use of a delivery device is in response to a need or craving, such as a craving associated with a habit, e.g., a vaping or smoking habit. In aspects, device(s) herein can be used by human subjects attempting to quit a vaping habit or smoking habit or to maintain a non-smoking/non-vaping status. In aspects, use of device(s) herein can be in response to one or more smoking/vaping habit-related craving(s), and use of device(s) is designed to detectably or significantly assuage one or more such smoking habit-related cravings.

Thus, in one specific aspect, one application of delivery device(s) described herein is the provision of entertainment, e.g., pleasure. In another specific aspect, one application of delivery device(s) described herein is to aid a user having a current smoking habit, e.g., tobacco-product smoking habit, nicotine drug-related smoking habit, or both in reducing or eliminating such a habit. In another specific aspect, one application of delivery device(s) described herein is to aid a former smoker maintain a smoke-free (e.g., tobacco-, nicotine-, or tobacco- and nicotine-free) status. In certain aspects, delivery device(s) herein mimics characteristics of a smoking device, e.g., a cigarette, a cigar, a pipe, an e-cigarette, a vaping device, etc. Thus, in aspects, one application of delivery device(s) is to serve as a replacement for, e.g., an alternative to, any one or more such devices. However, in other aspects, devices different significantly from such device(s) in one or more respects, such as in not including an enclosed cartridge of a VCC, not including a heating element, not including any power components, etc.

Delivery Device—Size/Shape/Dimensions/Appearance

According to certain aspects, delivery device(s) provided by the invention are characterizable in at least two primary dimensions: a length and a width. Herein, uncontradicted, the length of a delivery device generally describes the distance between an outlet end of a device, that is, the proximal end of the device (portion of the device through which the user receives volatile compound(s)), and an inlet end of a device, that is the distal end of the device (opposing portion of the device through which air initially enters the device upon inhalation by a user.) Herein, width of a delivery device generally describes a thickness of a device, sometimes referred to, in embodiments, as the diameter of the device, e.g., a dimension perpendicular to the length.

In certain aspects, the length of a device when fully assembled is less than the sum of the length of the device part(s), component(s), or both when not fully assembled.

In certain aspects, the width of a delivery device can vary across the length of a device, such as, e.g., a delivery device can have a maximum width and a minimum width. In aspects, at least one, e.g., at least a first, portion of the device has a width which is different from at least one other, e.g., at least a second, portion of the device.

In aspects, a delivery device has at least one portion along its length, closer to its proximal (outlet) end than its distal (inlet) end, having a width which is detectably or significantly less than the width of at least one portion of the delivery device located closer to its distal end. According to certain aspects, the delivery device provided by the invention is between about 2 inches and about 10 inches (between about 50 mm and about 254 mm) in length, such as, e.g., ~2"-~9" (~50 mm-~229 mm), ~2"-~8" (~50 mm-~203 mm), ~2"-~7" (~50 mm-~178 mm), ~2"-~6" (~50 mm-~152 mm), or ~2"-~5" (~50 mm-~127 mm), such as, e.g., ~3"-~10" (~76 mm-~254 mm), ~4"-~10" (~102 mm-~254 mm), ~5"-~10" (~127 mm-~254 mm), or, e.g., ~6"-~10" (~152 mm-~254 mm), such as, for example, ~3"-~9" (~76 mm-~229 mm), ~4"-~8" (~102 mm-~203 mm), or, e.g., ~5"-~7" (~127 mm-178 mm), as in ~90 mm-~120 mm, ~100 mm-~115 mm, or, e.g., ~105 mm-~110 mm. In certain aspects, a delivery device can be about 108 mm in length when fully assembled, e.g., in a ready-to-use state.

According to certain aspects, a delivery device provided by the invention is between about 0.25 inches (about 6.3 mm) and about 1.5 inches (about 38 mm) wide, or, stated alternatively, a delivery device in aspects comprises a widest width which is between about 0.25" and about 1.5" (about 6.3 mm and about 38 mm). In aspects, a delivery device can take on any shape, such as, e.g., the shape of a cylinder, triangular prism, rectangular prism (cuboid), pentagonal prism, hexagonal prism, octagonal prism, or other multi-sided prism. In common aspects, a delivery device is presented with a general cylindrical shape, however wherein one or more portions of its cylindrical shape have a diameter which is less than one or more other portions of its cylindrical shape. This is illustrated in exemplary figures provided herein.

In aspects, a delivery device comprises a widest width (thickness) of between about 0.25" and about 1.5" (about 6.3 mm and about 38 mm), e.g., ~0.25"-~1.25" (~6.3 mm-~31.8 mm), ~0.25"-~1" (~6.3 mm-~25.4 mm), ~0.25"-~0.75" (~6.3 mm-~19.1 mm), or, e.g., ~0.25"-~0.5" (~6.3 mm-~12.7 mm), such as ~0.5"-~1.5" (~12.7 mm-~38.1 mm), ~0.75"-~1.5" (~19.1 mm-~38.1 mm), ~1"-~1.5" (~25.4 mm-~38.1 mm), or ~1.25"-~1.5" (31.8 mm-~38.1 mm), as in, for example, ~0.5"-~1.25" (~12.7 mm-~31.8 mm), or, e.g., ~0.75"-~1" (~19.1 mm-~25.4 mm), as in, e.g., ~5 mm-~20 mm, ~10 mm-~20 mm, ~12 mm-~18 mm. In certain aspects, a delivery device can have a maximum thickness or width of about 12 mm, about 15 mm, about 18 mm, or about 22 mm when fully assembled, e.g., in a ready-to-use state.

In aspects wherein a delivery device comprises one or more portions, e.g. one or more portions along its length, having a thickness which is less than the widest thickness described above, a delivery device can comprise a narrowest thickness of between about 0.25" and about 1.25" (~6.3 mm-~31.8 mm), e.g., ~0.25"-~1" (~6.3 mm-~25.4 mm), ~0.25"-~0.75" (~6.3 mm-~19.1 mm), or ~0.25"-~0.5" (~6.3 mm-~12.7 mm), such as ~0.5"-~1.25" (~12.7 mm-~31.8 mm), ~0.75"-~1.25" (~19.1 mm-~31.8 mm), or ~1"-~1.25" (~25.4 mm-~31.8 mm), as in, for example, ~0.5"-~1" (~12.7 mm-~25.4 mm), or, e.g., ~0.75" (~19.1 mm), or, e.g., ~0.4" (~10.2 mm) or, e.g., ~0.6" (~15.2 mm), such as ~5 mm-~20 mm, or, e.g., ~8 mm-~15 mm. In aspects, the delivery device can have a narrowest diameter of about 0.6" (~15 mm), or ~8 mm, ~9 mm, ~10 mm when fully assembled, e.g., in a ready-to-use state.

In embodiments wherein the cross-sectional shape of a delivery device is not circular, e.g., a delivery device is presented in a shape not characterizable generally as a cylindrical (even if having one or more narrower dimensions skewing the shape from a true cylinder), a delivery device can have a first non-length dimension, e.g., width, and a second non-length dimension, e.g., height, which do not vary by more than about 50% from one another, such as, e.g., they do not vary by more than ~45%, ~40%, ~35%, ~30%, ~25%, ~20%, ~15%, ~10%, or, e.g., which do not vary by more than ~5% relative to one another. In aspects, a maximum width or a maximum height is about 1.5," e.g., ~1.25" or, e.g., ~1".

According to some aspects, a delivery device can comprise a length and a thickness or diameter (such terms referring to the thickness or width (or, e.g., height as applicable to orientation) of the device or applicable component or feature in certain embodiments). In certain aspects, the thickness (or diameter as applicable) is uniform across the length of a delivery device. In aspects, as provided above, the thickness (or diameter as applicable) is non-uniform across the length of a delivery device. In aspects, the device has at least a widest thickness and a narrowest thickness, and further the narrowest thickness of the device represents a thickness which is between about 20% and about 95% of that of the widest thickness of the device, such as, e.g., a narrowest thickness which is ~20%-~90%, ~20%-~85%, ~20%-~80%, ~20%-~75%, ~20%-~70%, ~20%-~65%, ~20%-~60%, ~20%-~55%, ~20%-~50%, ~20%-~45%, ~20%-~40%, ~20%-~35%, ~20%-~30%, or ~20%-~25% of that of the widest thickness of the device. In aspects, the narrowest thickness of the device represents a diameter which is between about ~25%-~95% of the widest diameter of the device, such as, e.g., ~30%-~95%, ~35%-~95%, ~40%-~95%, ~45%-~95%, ~50%-~95%, ~55%-~95%, ~60%-~95%, ~65%-~95%, ~70%-~95%, ~75%-~95%, ~80%-~95%, or ~85%-~95%, as in, for example, ~25%-~90%, ~30%-~85%, ~35%-~80%, ~40%-~75%, ~45%-~70%, ~50%-~65%, or, e.g., ~55%-~60% of that of the widest thickness of the device.

In one aspect, a delivery device has a length, and the device comprises at least two separate portions, e.g., sections, along its length having a thickness (e.g., diameter where applicable) that is less than the widest thickness of the device. In such embodiments either, both, or all such diameter-reduced portions can comprise, e.g., any of the dimensions described for a single diameter-reduced portion of a delivery device above. For example, in aspects, a delivery device comprises at least two separate portions of its length having a thickness which is less than its widest thickness, for example, either, both, or all such portions comprising a narrowest device thickness which is between about 20% and about 95% of that of the widest thickness of the device, such as, e.g., a narrowest thickness which is ~20%-~90%, ~20%-~85%, ~20%-~80%, ~20%-~75%, ~20%-~70%, ~20%-~65%, ~20%-~60%, ~20%-~55%, ~20%-~50%, ~20%-~45%, ~20%-~40%, ~20%-~35%, ~20%-~30%, or ~20%-~25% of the widest thickness. In aspects, either, both, or all such portions comprise a narrowest device thickness which is between about, e.g., ~25%-~95%, ~30%-~95%, ~35%-~95%, ~40%-~95%, ~45%-~95%, ~50%-~95%, ~55%-~95%, ~60%-~95%, ~65%-~95%, ~70%-~95%, ~75%-~95%, ~80%-~95%, or ~85%-~95% of that of the widest thickness of the device. In aspects, either, both, or all such portions comprise a narrowest device thickness, which is between about, for example, ~25%-~90%, ~30%-~85%, ~35%-~80%, ~40%-~75%, ~45%-~70%, ~50%-~65%, or, e.g., ~55%-~60% of that of the widest diameter of the device.

According to certain aspects, a delivery device comprises at portion along its length having a thickness which is less than the widest thickness of the device, wherein the portion is positioned to facilitate placement of the user's lips about the device. In such aspects, such a thickness-reduced (or diameter-reduced as applicable) portion, e.g., a "lip groove", of a delivery device is positioned near a first (e.g., proximal or outlet) end of a delivery device, e.g., within the first 50% of the length of the device from a first (proximal or outlet) end, or, e.g., within the first about 45%, ~40%, ~35%, ~30%, ~25%, or, e.g., within the first about 20% of the length of the device from a first (proximal or outlet) end.

According to some aspects, a delivery device comprises a portion along its length having a thickness that is less than the widest thickness of the device, wherein the portion is positioned to, i.a., facilitate placement of the user's fingers, e.g., for placement of the device between e.g., two fingers, such as positioning the device between two fingers in the manner commonly applied to hold a cigarette (e.g., between a forefinger and a middle finger). In such aspects, such a thickness-reduced (or diameter-reduced, as applicable) portion, e.g., a "finger groove," of a delivery device is positioned within, e.g., the central 70%, 75%, 80%, 85%, or 90% of the length of a delivery device. That is, such a finger groove can be positioned outside of the first 10%, 15%, or 20% of the length of the device from either end. In certain aspects, a finger groove can be positioned within the central ~80%, ~75%, ~70%, ~65%, ~60%, ~55%, or, e.g., within about the central ~50% of the length of a delivery device. Again, e.g., the central 50% of the length of the device being a portion of the device beginning at a point located at 25% of a delivery device's length from a first (e.g., proximal, outlet) end of the device and ending at a point which is located at 75% of a delivery device's length from that same end of the device, or, e.g., ending at a position which is located at 25% of the length of the device from the second (distal or inlet) end of the device. In aspects, a finger groove is positioned along the length of a delivery device in a position outside of the first 10% of a delivery device's length from a first (proximal, outlet) end but within the first 60% of the device's length from the same proximal, outlet end, such as at a position located at about 15%, ~20%, ~25%, ~30%, ~35%, ~40%, ~45%, or about 50% of the delivery device's length from the proximal, outlet end. In aspects, a proximal, outlet end of the device can be the end comprising the portion of the device intended to be placed onto the lips or into the mouth of the user (end comprising a volatile compound outlet component), and a distal, inlet end of the device can be the end opposite that which is engaged by a user's lips, e.g., comprising a mating component.

In one aspect, device(s) described herein comprise(s) at least two separate portions along its/their length having a thickness which is less than the widest thickness of the device, and wherein one portion having a thickness less than the widest thickness of the device is positioned to facilitate placement of the user's lips and at least a second portion is positioned to facilitate placement of a user's finger(s).

In aspects, portion(s) of a delivery device having a reduced thickness (e.g., reduced diameter) provide(s) functionality, e.g., facilitating comfortably holding a delivery device within the mouth of the user (e.g., using a "lip groove"), holding a delivery device with or between fingers (e.g., using a "finger groove") or both. In aspects, portion(s) of a delivery device having a reduced thickness provide(s) an enhanced user experience in using the delivery device, making it pleasurable to hold, manipulate, utilize, etc.

According to certain aspects, as described above, a delivery device can comprise a first (e.g., first primary) component and a second (e.g., second primary) component (also simply referred to herein, as first and second device components), e.g., a volatile compound outlet component and a mating component. In some respects, the two components are releasably bound to one another, such as by, e.g., a rapidly releasable force mechanism described elsewhere herein. In aspects, the total length of the device when the first (e.g., first primary) component, e.g., the volatile compound outlet component, and second (e.g., second primary) component, e.g., mating component, are bound to one another is less than total length of each of the components independently added together. That is, in aspects, the first (e.g., first primary) component, e.g., volatile compound outlet component, has a length A; the second (e.g., second primary) component, e.g., mating component, has a length B; and the delivery device, when the first and second components (e.g., volatile compound outlet component and mating component) are bound together, has a length C, with length C being a length which is less than the sum of lengths A and B. To facilitate this, a first (e.g., first primary) component, e.g., a volatile compound outlet component, can have part(s) or subcomponent(s) which reside(s) at least partially within the second (e.g., second primary) component, e.g., mating component, when the two components are engaged. Also, or alternatively, a second (e.g., second primary) component, e.g., mating component, can have part(s) or subcomponent(s) which reside(s) at least partially within the first (e.g., first primary) component, e.g., volatile compound outlet component, when the two components are bound together.

In certain embodiments, the delivery device comprises a first device component (e.g., a first primary component, e.g., a volatile compound outlet component) and a second device component (e.g., a second primary component, e.g., a mating component) releasably bound to (engaged with) one another, wherein the total length of the device when the first and second device components (e.g., volatile compound outlet component and mating component) are bound to (engaged with) one another is no more than about 90%, such as no more than ~70%, ~60%, ~50%, ~40% or, e.g., no more than ~30% of the total length of each of the first component (e.g., volatile compound outlet component) and the second component (e.g., mating component) independently added together. In aspects, the total length of a delivery device when the first and second device components (e.g., first and second primary components of the device, e.g., a volatile compound delivery component and a mating component) are bound to one another is between about 30% and about 90%, such as, e.g., ~30%-~80%, ~30%-~70%, ~30%-~60%, ~30%-~50%, ~30%-~40%, or, e.g., ~40%-~90%, ~50%-~90%, ~60%-~90%, ~70%-~90%, or ~80%-~90%, such as, for example, about 40%-~80%, or, e.g., ~50%-~70% of the total length of the first and second device components (first and second primary components, e.g., volatile compound delivery component and mating component) individually added together.

According to certain aspects, at least a portion of a first (e.g., first primary) component, e.g., a volatile compound outlet component, resides within a second (e.g., second primary) component, e.g., mating component (at least a portion of a first device component resides within the second device component) when the first and second components are bound together, e.g., engaged with one another via a selectively releasable attachment component (e.g., comprising two or more parts or components, such as, e.g., an engagement mechanism and an engagement mechanism counterpart). In certain aspects, at least about 25% the length of a first (e.g., first primary) component, e.g., volatile compound outlet component, of a delivery device resides within a second (e.g., second primary) component, e.g., mating component, of a delivery device when the first and second components of the delivery device are engaged, e.g., bound together by a selectively releasable engagement component.

In aspects, between about 25% and about 75% of the full length of a first (e.g., first primary) component, e.g., volatile compound outlet component, of a delivery device resides within a second (e.g., second primary) component, e.g., mating component of a delivery device, e.g., ~30%-~75%, ~35%-~75%, ~40%-~75%, ~45%-~75%, ~50%-~75%, ~55%-~75%, ~60%-~75%, ~65%-~75%, or ~70%-~75%, such as, e.g., ~25%-~70%, ~25%-~65%, ~25%-~60%, ~25%-~55%, ~25%-~50%, ~25%-~45%, ~25%-~40%, ~25%-~35%, or ~25%-~30%, such as for example ~30%-~70%, ~35%-~65%, ~40%-~60%, or, e.g., ~45%-~55% of the first (e.g., first primary) component, e.g., volatile compound outlet component of a delivery device resides within the second (e.g., second primary) component, e.g., mating component, of the delivery device when the first and second components of the delivery device are engaged, e.g., bound together by a selectively releasable engagement component. In certain aspects, more than 75% of the full length of a first (e.g., first primary) component, e.g., volatile compound outlet component of a delivery device resides within a second (e.g., second primary) component of a delivery device when the first and second components of the delivery device are engaged with one another, e.g., are releasably bound to one another by a selectively releasable engagement component.

The delivery device can weigh, e.g., between about 10 g and about 100 g when not comprising any auxiliary component, device, or when not maintaining a means of providing volatile compound(s) (e.g., when not comprising a solid material device for the delivery of one or more volatile compounds, e.g., an insert). Such as, for example, an "empty" delivery device (lacking a removable insert) can weigh between about, e.g., 10 g-about 90 g, e.g., ~10 g-~80 g, ~10 g-~70 g, ~10 g-~60 g, or ~10 g-~50 g, as in ~20 g-~90 g, ~30 g-~90 g, ~40 g-~90 g, or ~50 g-~90 g, such as for example between ~20 g-~80 g, ~30 g-~70 g, ~40 g-~60 g, ~50 g-~60 g, or, e.g., in aspects ~55 g or ~56 g.

In aspects, a delivery device does not comprise a means for refilling or recharging an existing removable insert present in the device with additional volatile compound(s). That is, for example, in aspects, delivery device(s) herein does/do not comprise an opening, part, or component designed to facilitate the entry of a liquid composition, such as, e.g., an essential oil, which re-fill or otherwise recharge a solid material device present within the delivery device capable of maintaining, releasing, or maintaining or releasing one or more volatile compounds, e.g., a removable insert. This is discussed further elsewhere herein.

In aspects, the delivery device comprises at least a mouthpiece component (a VCOC comprising a mouthpiece) and a body tube/channel component (a component that forms a part of the airflow channel of a device), wherein the body tube component comprises a compartment for holding a volatile compound comprising insert (an insert compartment/housing). In aspects, the thickness of the body tube component is between about 50% and about 95%, such as, e.g., about ~50%, ~55%, ~60%, ~65%, ~70%, ~75%, ~80%, ~85%, ~90%, or about ~95% of the thickness of the mouthpiece component.

Delivery Device—Materials & Manufacturing

In aspects, one or more part(s), component(s), or assembly(ies) thereof of delivery device(s) provided herein can be at least substantially composed of or composed of any material safe for placement in the mouth of a human device user.

According to aspects, delivery device(s) provided herein can be comprised of a substantially moisture-impervious, an essentially moisture-impervious, or moisture-impervious material. The material also can be more generally impervious to VCC(s). In aspects, such a moisture impervious material is a material wherein less than 1%, such as, e.g., ≤~0.01%, ≤~0.001%, ≤~0.0001%, or ≤~0.00001% of an amount of moisture to which the material is exposed is absorbable by the material. In aspects, one or more material(s) of a device can be a material which is more permeable to/by moisture than one or more other at least substantially moisture-impervious, at least essentially moisture-impervious, or moisture impervious material(s) present in a device. In aspects, moisture permeability of a material may be a function of the density of a material. In aspects, a material used in part(s), component(s), or assembly(ies) thereof in a device can comprise a density which renders the material at least generally impervious, at least substantially impervious, at least essentially impervious, essentially impervious, or impervious to moisture. In aspects, device(s) can comprise a material having a density which allows for a detectable amount of moisture to be absorbed during typical device use. In aspects, delivery device(s) can comprise a material having a density which allows for a detectably or significantly greater amount of moisture to be absorbed during typical device use than that of another material present in the same device(s). In aspects, device(s) comprise a material having a density of at least about 5 times (5×), such as, e.g., ≥~6×, ≥~7×, ≥~8×, ≥~9×, ≥~10×, ≥~11×, ≥~12×, ≥~13×, ≥~14×, or, e.g., ≥~12× that of another material present in the device. As one example, device(s) provided herein can comprise, e.g., part(s), component(s), or assembly(ies) made of stainless steel, e.g., a polished stainless steel, which also comprises part(s), component(s), or assembly(ies) made of wood. In a more specific example, a delivery device provided herein can comprise, e.g., a volatile compound outlet component comprising (e.g., at least comprising some of, at least generally comprising, at least mostly comprising, at least substantially comprising, least essentially comprising, or comprising only) a first material, e.g., stainless steel, e.g., polished stainless steel, while the device further comprises a mating component comprising (e.g., at least comprising some of, at least generally comprising, at least mostly comprising, at least substantially comprising, least essentially comprising, or comprising only) a second material, such as wood.

In aspects wherein one or more material(s) of a delivery device may be detectably or significantly exposed to moisture, such as being present in a part, component, or assembly exposed to an airflow channel, such part(s), component(s), or assembly(ies) thereof can comprise a device supplement, e.g., a separate part, made of a detectably or significantly moisture-impervious material. Also or alternatively, in aspects wherein one or more material(s) of a delivery device may be detectably or significantly exposed to moisture, such as being present in a part, component, or assembly exposed to an airflow channel, such part(s), component(s), or assembly(ies) thereof can be detectably or significantly glazed, sealed, or otherwise lined (not requiring a separate part or component) to detectably or significantly reduce moisture absorption by the material, or, e.g., comprise a suitable amount of a glaze, a sealant, or other liner (not requiring a separate part or component) which detectably or significantly reduces moisture absorption by the material.

In aspects, one or more components of a delivery device can be at least substantially composed of or composed of any material having a sufficient hardness, density, moisture resistance, scratch resistance, or any combination thereof appropriate for its long-term function in a delivery device (e.g., is suitable to perform the function of the component comprising the material for a period of at least about 1 month, ~2 months, ~4 months, ~6 months, ~12 months, ~18 months, ~24 months, ~30 months, ~36 months, ~42 months, ~48 months, ~54 months, or ~60 months or longer, such as, e.g., ~1-~60 months, ~2-~60 months, ~4-~60 months, ~6-~60 months, ~12-~60 months, ~18-~60 months, ~24-~60 months, ~30-~60 months, ~36-~60 months, ~42-~60 months, ~48-~60 months, or ~54-~60 months, or, e.g., for a period of at least about 60 months.) In aspects, one or more part(s), component(s), or assembly(ies) thereof of a delivery device can be composed of a metal, such as, e.g., a metal alloy (e.g., comprising a combination of, e.g., two or more of iron, chromium, nickel, etc.) such as, e.g., stainless steel, or, e.g., a precious metal or precious metal alloy, e.g., gold (including, e.g., find gold, gold alloy, yellow gold, rose gold, or white gold), silver, platinum, palladium, titanium, etc.

In aspects wherein one or more part(s), component(s), or assembly(ies) thereof of a delivery device is made of stainless steel, in aspects any grade stainless steel can be used. In certain aspects, the stainless steel used for one or more part(s), component(s), or assembly(ies) thereof of a delivery device can be, e.g., 434 or 416 grade stainless steel. In some aspects, the stainless steel can be ferritic. In some respects (aspects), a high magnetism stainless steel is used for one or more part(s), component(s), or assembly(ies) thereof of a delivery device. In some respects, the stainless steel used for one or more part(s), component(s), or assembly(ies) thereof can be, e.g., 316 or 304 grade stainless steel. In certain aspects, a non-magnetic stainless steel is used for one or more part(s), component(s) or assembly(ies) of a delivery device. In aspects, one or more part(s), component(s), or assembly(ies) thereof of a delivery device is made of a polished stainless steel. In aspects, one or more part(s), component(s), or assembly(ies) thereof of a delivery device can be composed of a polymeric material such as a plastic. In aspects, a plastic can be a polyethylene terephthalate (PET or PETE), high-density polyethylene (HDPE), polyvinyl chloride (PVC or vinyl), low-density polyethylene (LDPE), polypropylene (PP), polystyrene (PS or Styrofoam, as long as such plastics are sufficiently hard, e.g., durable, for use in the application. In aspects, one or more part(s), component(s), or assembly(ies) thereof of a delivery device can be composed of an organic material, such as bamboo, cellulose, clay, diamond, nacre, or, wood, e.g., such as maple, rosewood, or olive wood, or, e.g., a ceramic material, e.g., an alumina or zirconia ceramic. In aspects one or more part(s), component(s), or assembly(ies) thereof of a delivery device can be composed of a stone or shell. In aspects, one or more part(s), component(s), or assembly(ies) thereof can be composed of glass, paper (e.g., hard paper like a cardboard), recyclable material, biodegradable material, or disposable material (e.g., a material designed for limited use, such as, e.g., material suitable for use in a device delivering no more than about 10 days, no more than about 8 days, no more than about 6 days, no more than about 4 days, no more than about 2 days, or, e.g., no more than about 1 day of operability, such as, e.g., a material suitably durable to provide no more than about 50 user draws (application of suction), <~40 user draws, <~30 user draws, <~20 user draws, <~10 user draws, or, e.g., <~5 user draws). In certain aspects, one or more part(s), component(s), or assembly(ies) of a device can comprise a disposable material while one or more other device part(s), component(s), or assembly(ies) comprise a more permanent material. Such combinations of materials are described elsewhere herein. In some respects, one or more part(s), component(s), or assembly(ies) thereof can comprise or be composed of any food grade material, such as, e.g., polyoxymethylene (POM), sometimes referred to as acetal, polyacetyl, and polyformaldehyde. In aspects, one or more part(s), component(s), or assembly(ies) thereof can comprise or be composed of a material providing or known in the art of materials to provide a high stiffness, low friction, dimensional stability, or any combination thereof. In certain aspects, two or more part(s), component(s), or assembly(ies) thereof can be composed of at least substantially the same material and have at least substantially the same appearance, such as, e.g., two part(s), component(s), or assembly(ies) thereof made of, e.g., stainless steel having at least substantially the same coloration, reflectivity, and the like. In certain aspects, two or more part(s), component(s), or assembly(ies) thereof can be composed of at least substantially the same type of material and have at least substantially the same appearance or have detectably or significantly different appearances. As one example, two part(s), component(s), or assembly(ies) thereof can each be made of a metal, however one may be made of titanium and one may be made of platinum and thus each may have a detectably or significantly different color, reflectivity, or the like. Another example is two part(s), component(s), or assembly(ies) thereof made of a plastic, wherein one plastic has a first color, and the second plastic has a second color. A further example is two part(s), component(s), or assembly(ies) thereof both made of wood however a first part(s), component(s), or assembly(ies) thereof is made of a first wood, e.g., maple, and a second part(s), component(s), or assembly(ies) thereof is made of a second wood, e.g., rosewood, and thus each part(s), component(s), or assembly(ies) thereof has/have a distinguishably different visual appearance.

In certain aspects, part(s), component(s) or assembly(ies) thereof can be made of a particular material to which a coating or finishing is added, such as, e.g., a shellac, wax coating, sealant, or colored or reflective finish. In aspects, finish is a physical vapor deposition (PVD) finish. In aspects, a finish or coating can have a color, e.g., a metallic color (e.g., gold, silver, bronze, rose gold and the like). In aspects, a finish or coating can have a reflective finish. In aspects, a finish or coating can have, e.g., a rainbow appearance. According to certain aspects, exemplary finishes can comprise, e.g., a PVD finish in a gold color, or, e.g., a PVD finish in a rainbow color. In aspects, a material can comprise stainless steel, which, as described elsewhere, can be brushed, polished, or otherwise treated according to known methods (e.g., pickled).

According to certain aspects, all part(s), component(s), or assembly(ies) thereof of a delivery device can be made of the at least generally the same, at least substantially the same, at least essentially the same, essentially the same, or the same material. In some respects, one or more part(s), component(s), or assembly(ies) thereof of a delivery device can be made of a different material from one or more other part(s), component(s), or assembly(ies) thereof of a device. For example, in aspects, one or more part(s), component(s), or assembly(ies) thereof of a device can be made of stainless steel and one or more part(s), component(s), or assembly(ies) thereof of a device can be made of wood. In certain aspects, three or more materials may be present in a delivery device, such as, e.g., one or more part(s), component(s), or assembly(ies) thereof made of ceramic, one or more part(s), component(s), or assembly(ies) thereof made of stainless steel or precious metal, and one or more part(s), component(s), or assembly(ies) thereof made of wood.

In certain aspects, it can be desirable, beneficial, or otherwise advantageous for one or more part(s), component(s), or assembly(ies) thereof to be made of a particular material or particular type of a material. As the device is designed for the delivery of one or more compounds, moisture from, e.g., a user's mouth or breath may affect the performance, longevity, or both of one or more part(s), component(s), or assembly(ies) thereof. In aspects, it may be desirable, beneficial, or otherwise advantageous for a part(s), component(s), or assembly(ies) thereof which comes into contact with such moisture to be made of a more durable material, e.g., a metal as opposed to a wood material. In aspects, it may be desirable, beneficial, or otherwise advantageous for part(s), component(s), or assembly(ies) thereof which could come into contact with such moisture to be protected from such moisture by the placement of one or more other part(s), component(s), or assembly(ies) thereof in a position to offer protection. As one example, in aspects, a Barrel of a device or a portion thereof (such as the exterior thereof or a portion thereof) (or other mating component) can be made of (can comprise, mostly comprise, generally consist of, or consist of) an organic material, e.g., a wood material, providing an aesthetically pleasing, visually appealing appearance, providing a lighter density material in aspects, and providing a material that is associated with certain physiological responses in at least a significant number of users as described above due to the tactile response to the organic material. In aspects, such a wood can be a hard wood, such as, e.g., maple, rosewood, or, e.g., olive wood, as opposed to a softwood, such as pine, balsam, or other wood which can be more prone to denting, scratching, or other malformation(s). However, regardless of the wood, because such a Barrel could come into contact with moisture within the device, the Barrel may be positioned over a tube or other type of structure, e.g., a Barrel Tube, made of an even more durable material, such as, e.g., stainless steel, or a metal such as titanium or platinum, the Barrel Tube or corresponding element protecting the Barrel/mating component from an amount of moisture which may be detrimental to the longevity or performance of the Barrel. In certain other aspects, one or more part(s), component(s), or assembly(ies) thereof can be designed for selective disengagement from one or more other part(s), component(s), or assembly(ies) thereof s of a delivery device. In such aspects, the ability of the interfacing part(s), component(s), or assembly(ies) thereof to be repeatedly engaged and disengaged from one another is critical, and a part(s), component(s), or assembly(ies) thereof made of a non-durable material may present challenges to functionality, durability, or both. As an example, a delivery device can be designed to have a dis-engageable, e.g., replaceable, Mouthpiece/mouthpiece component (a type of VCOC). In aspects, a Mouthpiece made of, e.g., ceramic or, e.g., an organic material such as wood, may not comprise sufficient durability to be repeatedly engaged and disengaged from one or more other part(s), component(s), or assembly(ies) thereof of a delivery device by a mechanism such as, e.g., screwing the mouthpiece onto and off of one or more other part(s), component(s), or assembly(ies) thereof. Therefore, e.g., a component of a second, more durable material may be necessary to provide durable repeated engageability/disengageability of an e.g., organic material-based or otherwise non-durable Mouthpiece. In such an aspect, a Mouthpiece attachment mechanism or, e.g., a Mouthpiece Tube, can be placed at least partially inside of the mouthpiece to facilitate its repeated engagement/disengagement. Such an attachment mechanism can be made of, e.g., a durable material such as stainless steel, and can comprise, e.g., threading compatible with threading with a second part, component, or assembly thereof of the device to which the Mouthpiece can releasably attach. In aspects, a Mouthpiece may be made of a relatively less durable or porous material (as compared to, e.g., a component that is made of a stainless steel, titanium, or other relatively more durable material), e.g., ceramic or wood, and a Mouthpiece insert made of a more durable or non-porous material, e.g., a metal, is placed inside the Mouthpiece to help prevent cracks or shattering of the Mouthpiece. Accordingly, part(s), component(s), or assembly(ies) thereof or device(s) that are adapted to receive such durable material insert(s) are another aspect of the invention. In aspects, such an insert detectably or significantly prevents an associated, relatively more porous material from absorbing oil(s), e.g., essential oil(s) that may be contained in a delivery device, such as when the delivery device is in use or is ready for use. In such aspects, a Mouthpiece made from a porous material which does not comprise the Mouthpiece insert would be susceptible to absorption of an oil or flavoring, thus compromising the delivery device and altering the taste of different flavored oil inserts.

In certain aspects, all externally visible part(s), component(s), or assembly(ies) thereof are made of at least generally the same, at least substantially the same, at least essentially the same, essentially the same, or the same material and have at least generally the same, at least substantially the same, at least essentially the same, essentially the same, or the same visual appearance. In certain aspects, at least one externally visible part, component, or assembly thereof is made of a material which is different from at least one other externally visible part, component, or assembly thereof. In certain aspects, at least three externally visible part(s), component(s), or assembly(ies) thereof are each comprised of a different material.

According to certain embodiments, one or more functionality(ies) of delivery device(s) provided herein can be provided by part(s), component(s), or assembly(ies) thereof, such as one, a plurality of, or all functionality(ies) of delivery device(s) provided by the invention, can be provided by parts made of a paper material. According to certain embodiments, one or more functionality(ies) of delivery device(s) provided herein can be provided by part(s), component(s), or assembly(ies) thereof, such as one, a plurality of, or all functionality(ies) of delivery device(s) provided by the invention, can be provided by parts made of a plastic material. According to certain embodiments, one or more functionality(ies) of delivery device(s) provided herein can be provided by part(s), component(s), or assembly(ies) thereof, such as one, a plurality of, or all functionality(ies) of delivery device(s) provided by the invention, can be provided by parts made of a hard plastic material.

According to certain aspects, one or more part(s) or component(s) of a delivery device are customized parts, e.g., a part or component which is custom made for use in the device and is not otherwise available as used in the delivery device on the mass market. In aspects, a customization can be a custom molding or machining of the part or component. In aspects, a part or component can be custom machined, carved, or die cast. In aspects, a delivery device comprises less than 5, such as less than ~4, ~3, ~2, or only 1 or no part which is not custom made for specific use within the delivery device.

In aspects, two or more part(s), component(s), or assembly(ies) thereof can be fixedly attached to one another, such as by welding. In aspects two or more part(s), component(s), or assembly(ies) thereof can be fixedly attached to one another by, e.g., brazing. In aspects, brazing is accompanied by the removal of some, most, generally all, or all (any) resulting debris so as to leave an at least substantially clean, essentially clean, or clean joint between the two part(s), component(s), or assembly(ies) thereof such that no detectable or significant amount of material remains which detectably or significantly interferes with the operation of the delivery device. In other aspects two or more part(s), component(s), or assembly(ies) thereof can be fixedly attached to one another by, e.g., gluing the two parts(s), component(s), or assembly(ies) thereof to one another, such as by using a glue such as an epoxy glue. In aspects, no detectable or significant amount of adhesive residue is visible during normal operation of a delivery device or when viewing a completely assembled device upon the completion of manufacturing.

Weight Balancing

In certain aspects, a delivery device has a length and a center of gravity, also referred to herein as a center of mass. In aspects, at least one portion of a delivery device along its length has a thickness which is less than the widest thickness of the device. In certain facets, the center of gravity of the device is positioned at a location along the length of the device corresponding to, near, or adjacent to a portion of the device having a thickness which is detectably or significantly less than the widest thickness of the device. A portion of a delivery device along its length having a reduced thickness (e.g., in aspects, a reduced diameter) relative to the widest thickness (e.g., diameter) of the device can be positioned, in aspects, at a location corresponding to, associated with, or near, e.g., adjacent to, the center of gravity of the device. In facets, a reduced thickness portion of the length of a delivery device can be a portion facilitating placement of a user's fingers to hold the device, and such a reduced thickness portion (e.g., finger groove) is in a location corresponding to, near, or adjacent to the center of gravity of the device such that when holding the delivery device between two fingers at such location, the delivery device is at least generally, at least substantially, is at least essentially, is essentially, or is weight balanced.

According to certain aspects, the center of gravity of a delivery device is located at a position corresponding to locations marking between about 10% to about 90% of the total length of the delivery device as measured from a first (proximal, outlet) end, such as between a location marking ~10%-~85%, ~10%-~80%, ~10%-~75%, ~10%-~70%, ~10%-~65%, ~10%-~60%, ~10%-~55%, or ~10%-~50%, such as, e.g., ~15%-~90%, ~20%-~90%, ~25%-~90%, ~30%-~90%, ~35%-~90%, ~40%-~90%, ~45%-~90%, or, e.g., ~50%-~90% of the total length of the delivery device as measured from the first (proximal, outlet) end. In aspects, the center of gravity of the delivery device is located within the first ½ of the total length of the delivery device as measured from the delivery device's first end (e.g., the end intended for placement onto the lips of or into the mouth of the user; proximal or outlet end). In aspects, the center of gravity of the device is located within the first $\frac{2}{5}^{ths}$ of the total length of the device or within the first $\frac{1}{3}^{rd}$ of the total length of the device as measured from the delivery device's proximal or outlet end.

According to aspects, the center of gravity of a device is positioned such that its location along the length of the device when fully assembled is within a distance representing no more than about 20% of the total length of a fully assembled device, e.g., with ~18%, ~16%, ~14%, ~12%, ~10%, ~8%, ~6%, or ~4% of the total length of a fully assembled device from the external location at which two component(s) of the delivery device engage, such as the external location at which a volatile compound outlet component and the proximal end of the mating component engage.

According to certain aspects, material(s) used for one or more part(s), component(s), or assembly(ies) thereof detectably or significantly affect the location of the center of gravity of device(s) provided herein. In aspects, use of a denser material, a less dense material, or both for one or more part(s), component(s), or assembly(ies) can reposition the center of gravity of a device. In aspects, consideration material(s), consideration of part, component, or assembly size, shape, weight, positioning, or any combination(s) thereof and their impact on the center of gravity of a device is at least a part of device design and manufacture.

In aspects, the device is designed with its center of gravity in mind, such that the positioning of the center of gravity, positioned to provide the device in a balanced position when held via an, e.g., finger groove, adds to a user's enjoyment, comfort, or both in using the device, enhances the user experience of the device. In aspects, the location of the center of gravity provides a detectably or significantly more comfortable user experience in using the device by evenly distributing the weight of the delivery device. For example, in aspects, if the center of gravity is too close to the opening in a volatile compound outlet component (or, e.g., specific mouthpiece thereof), a user may feel detectably or significantly more weight pressing down on their mouth when using the device. Conversely, if the center of gravity is too far from the opening in a volatile compound outlet component (or, e.g., specific mouthpiece thereof), a user may have to apply detectably or significantly more force to hold the delivery device upright while the device is in use.

First and Second Component Embodiments (2 Primary Component Embodiments)

In certain aspects, delivery device(s) provided herein are made of a single part, single component, or single assembly.

In aspects, delivery device(s) provided herein are made of a plurality of part(s), component(s), or assembly(s) or combination(s) thereof.

In certain aspects, device(s) provided herein are characterizable by their functionality, such as, e.g., in aspects, device(s) provided herein comprise a volatile compound outlet component for allowing volatile compound(s) available within the device to exit to the device for delivery to a user. In aspects, device(s) provided herein comprise a volatile compound compartment (aka a volatile compound composition storage compartment or VCCSC), for maintaining volatile compound(s) for their release and subsequent availability to a device user. Thus, in aspects, such device(s) can comprise two part(s), component(s), or assembly(ies) to accomplish such functions. In further aspects, a delivery device can comprise a volatile compound outlet component (VCOC) for allowing volatile compound(s) available within the device to exit to the device for delivery to a user, a volatile compound compartment for maintaining volatile compound(s) for their release and subsequent availability to a device user, and a mating component, designed to mate with the volatile compound outlet component, volatile compound compartment (which, in aspects, can be provided as a part or component of a volatile compound outlet component extension), or both. In aspects, as is described elsewhere herein, such a mating component can participate in the protection or completion of a volatile compound compartment and content(s) maintained therein. In still further aspects, a delivery device can comprise a volatile compound outlet component for allowing volatile compound(s) available within the device to exit to the device for delivery to a user, a volatile compound compartment for maintaining volatile compound(s) for their release and subsequent availability to a device user, a mating component which mate(s) with the volatile compound outlet component, volatile compound compartment (which may be provided as a part or component of a volatile compound outlet component extension), or both, and an airflow limiter, wherein the airflow limiter may be static (e.g., non-selectable, non-controllable), selectable, controllable, or selectable and controllable. Such feature(s) of exemplary and embodied part(s), component(s), and assembly(ies) which may be provided in such device(s) are described in detail herein, along with other part(s), component(s), assembly(ies) thereof, mechanism(s), function(s) and, e.g., feature(s) which may also or alternatively make up a delivery device. In certain cases, delivery device(s) may be characterized herein as comprising many specific exemplary part(s), component(s), assembly(ies) thereof, mechanism(s), function(s), and e.g., feature(s), however the reader is reminded that device(s) provided by the invention can comprise one, some, most, generally all, or all such element(s).

As described above, in aspects, a delivery device provided by the invention comprises at least two part(s) or component(s) which are not parts or subcomponents of at least one other component. Accordingly, herein these two part(s)/component(s), as provided above, may be referred to as first and second primary components. In one aspect, one component is referred to herein as a volatile compound outlet component or, e.g., as one specific embodiment, a Body Assembly. In one aspect, one component is referred to herein as a mating component, or, e.g., as one specific embodiment, a Tip Assembly. Each is further described elsewhere herein. The reader is again reminded that reference to a "Body Assembly" should be interpreted as encompassing a volatile compound outlet component generally, and reference to a "Tip Assembly" should be interpreted as encompassing a mating component generally.

Selective Releasable Engagement of Elements

According to certain aspects, two or more elements (e.g., part(s), component(s), or assembly(ies)) of a delivery device (or devices in a system) are, at least in one state, in physical contact with one another. According to certain aspects, two or more part(s), component(s), or assembly(ies) of a delivery device interface with one another in at least one state of device configuration, such as when the device is operable or optimally operable. According to aspects, delivery device(s) herein can comprise two parts, e.g., in aspects a volatile compound outlet component and, e.g., a mating component, that each comprise a part, component, feature, portion, location, or feature which contact one another. In aspects, such contact provides for the two component(s) to be held together (to be stably engaged) with one another.

In aspects, two components, e.g., two primary components) of a delivery device are engaged with one another via an engagement component. In aspects, the engagement component is a selective engagement component. In aspects, two components of delivery device(s) are selectively attached to one another by a selectively releasable attachment component. That is, the first and second components can be connected to one another or, alternatively, not connected to one another over a course of operating the delivery device.

In aspects, a re-engageable delivery device comprises an engagement component that facilitates engagement of two or more parts of the re-engageable device. In aspects, the engagement component is composed of two or more parts.

In aspects, at least one of the parts can be characterized as an engagement mechanism. An engagement mechanism can be a part that is responsible for initiating engagement, is essential for engagement to take place, or is primarily responsible for engagement. In cases, the term is arbitrarily selected where both parts are fairly equal in such contributions to engagement. For example, an engagement mechanism in a magnetic engagement component can be or comprise a magnet. In aspects, one or more other parts can be described as engagement mechanism counterpart(s). E.g., a part of the re-engageable device that binds to a magnet engagement mechanism can be characterized as an engagement mechanism counterpart.

In aspects, an engagement component comprises at least one engagement mechanism and at least one engagement mechanism counterpart. In aspects, an engagement component can further comprise an engagement component support part (or positioning part) or functionally related/similar component. As is discussed further elsewhere herein, an engagement mechanism of an engagement component can be, e.g., any part or component participating in the engagement of two or more part(s), component(s), or assembly(ies), or combination(s) thereof. As is discussed further elsewhere herein, an exemplary engagement mechanism of an engagement component can be, e.g., a Magnet. As is discussed further elsewhere herein, an engagement mechanism counterpart can be, e.g., any part or component participating in the engagement mechanism of an engagement component along with an engagement mechanism. As is discussed further elsewhere herein, an exemplary engagement mechanism counterpart can be, e.g., a Barrel Collar. As is discussed further elsewhere herein, an exemplary engagement component support, i.e., positioning component or part can be, e.g., any part or component participating in the support of, or positioning of, an engagement mechanism. As is discussed further elsewhere herein, an exemplary engagement component support can be, e.g., a Magnet Cover. In certain cases, as in this section, elements of a disclosure may be capitalized for convenience of reading or to bring attention to the element and in other portions of this disclosure such terms or similar/related terms are not capitalized. Readers will understand that such differences in presentation/treatment of terms do not change or limit the scope or meaning of such terms. In certain cases, disclosure relating to a term or concept may appear to be contradictory in scope from disclosure provided elsewhere. In such cases, this disclosure will be interpreted to provide aspects consistent with the broadest possible resolution of such conflict and concurrently provide particular embodiments consistent with any other interpretation of such apparently conflicting disclosures, including the narrowest/most specific aspect provided by such disclosures.

The status of the attachment can in aspects be determined by the user, in that the user can engage or disengage the two components. Further, first and second components, e.g., first and second primary components, e.g., in aspects as described herein, a volatile compound outlet component and a mating component) of a delivery device are movable in relation to one another. In aspects, the two components, e.g., two primary components, e.g., a volatile compound outlet component and a mating component, can maintain some degree of contact between one another when the two components are rotated in relation to one another.

In certain aspects, a delivery device can, for example, begin in a state wherein a first component (e.g., a first primary component) and second component (e.g., a second primary component) are in a first configuration and are selectively connected to one another. The user can, e.g., rotate the first and second (e.g., first and second primary) delivery device components in relation to one another in a way that maintains some degree of contact between the two components during such rotation, wherein at the end of the rotation the first and second (e.g., first and second primary) components are in a second configuration and are still selectively connected to one another. During such an example, the degree of contact between the two components can change over the course of such rotation. For example, the degree of interface between the two components, e.g., volatile compound outlet component and mating component) can drop, e.g., be reduced, before increasing again once reaching the second configuration. In certain aspects, the degree of interface between the two components drops between any two configurations established by the positioning of the first (e.g., primary) component relative to the second (e.g., second primary) component (e.g., volatile compound outlet component and mating component). In certain aspects, the degree of interface between the two components does not detectably or significantly increase between any two configurations established by the positioning of the first (e.g., first primary) component, e.g., volatile compound outlet component, relative to the second (e.g., second primary) component, e.g., mating component.

In aspects, from a first configuration, the user alternatively, e.g., can disengage the first and second (e.g., first and second primary) delivery device components, rotate them (or otherwise move them) in relation to one another while the two components are at least partially disengaged from one another, and reengage the two components such that they result in having a second configuration and then are again selectively connected to one another. For example, rotation of a mating component can occur around a VCOC extension when the mating component is at least partially disengaged from the mouthpiece or outlet of a VCOC or other portion of a VCOC, such as by moving the parts far enough that an engagement mechanism, such as magnetic attraction, does not keep them completely attached/engaged. In aspects, such or other elements may move in relation to each other even when fully attached.

In certain aspects, a selective engagement component can be any reversible attachment component, such as a snap fit mechanism, including an annular snap-fit, a cantilever snap-fit (e.g., a multiple-use cantilever snap-fit), or, e.g., a torsional snap-fit, or, e.g., a screw fit (e.g., using threading), a push-and-turn release mechanism (similar to or the same as the type of mechanism used commonly for child-proofing a medicinal container), a push-and-release attachment mechanism (sometimes referred to as a push-latch (or push latch) mechanism), an attachment via a clip, pin, lock, latch, attractive force mechanism such as a magnetic force, or any other type of reversible, non-permanent connection component or mechanism known in the art. In aspects, a first selectively engageable connection component constituent can reside in a first (e.g., first primary) device component, e.g., volatile compound outlet component, while a second selectively engageable connection component constituent can reside in a second (e.g., second primary) device component, the two selectively engageable connection components constituents each being constituents of a reversible attachment component described in this paragraph. In aspects, such part(s) or component(s) cooperate to provide a selectively releasable connection between two part(s), component(s), or assembly(ies) of a delivery device.

According to certain specific aspects, the selectively releasable connection component is not a snap fit component or does not provide a snap fit mechanism (including, e.g., an annular snap-fit, a cantilever snap-fit (e.g., a multiple-use cantilever snap-fit), or, e.g., a torsional snap-fit). In aspects, the selectively releasable connection component is not a screw fit component or does not provide a screw fit (e.g., using threading) mechanism. In aspects, the selectively releasable connection component is not a push-and-turn release component or does not provide a push-and-turn release mechanism (similar to or the same as the type of mechanism used commonly for child-proofing a medicinal container). In aspects, the selectively releasable connection component is not a push-and-release component or does not provide a push-and-release attachment mechanism. In aspects, the selectively releasable connection component is not an attachment component or mechanism utilizing part(s) or component(s) recognizable as clip(s), pin(s), lock(s), or, e.g., latch(es).

In certain aspects, the engagement component, e.g., the selective engagement component, is a rapidly releasable engagement component, also referred to as a rapidly releasable connection mechanism or a rapidly releasable force mechanism. Herein, a rapidly releasable connection mechanism and rapidly releasable force mechanism should be considered interchangeable and should encompass engagement component. Herein, "rapidly releasable" should be interpreted as meaning essentially immediate, direct, or capable of unidirectional (the two components can be rapidly released from one another by moving in a single direction, e.g., away from each other) disengagement. As an example, a screw fit utilizing threading would not be considered a rapidly releasable connection mechanism, as at least some rotation in a direction of, e.g., a first (e.g., first primary) component and a second (e.g., second primary) component (e.g., volatile compound outlet and mating components) of a device would need to occur before the two components disengage, such rotation further accompanied by, upon completion of the disengagement of the threading, pulling the first and second components apart. As another example, a component or mechanism comprising a latch, pin, or lock which require the user to manipulate them prior to separating the two components from one another would not be considered a rapidly releasable engagement component, i.e., rapidly releasable connection mechanism, as the disengagement is not immediate—a step of manipulating the mechanism is required before separating the components—nor is it direct for the same reason. Alternatively, examples of rapidly releasable connection mechanisms can include, e.g., a snap fit or, e.g., a connection by an attractive force mechanism such as magnetic force. In such examples, the two components can be pulled directly away from one another effectively immediately without additional manipulation.

In aspects, the engagement component, i.e., rapidly releasable connection mechanism or rapidly releasable force mechanism, is an attractive force component or mechanism. In certain aspects, the engagement component, i.e., rapidly releasable connection mechanism or rapidly releasable force mechanism, is a magnetic attraction. In aspects, the magnetic attraction is accomplished by the positioning of an engagement mechanism, e.g., a magnet, in a first component and positioning an engagement mechanism counterpart, e.g., at least one component attractive to the engagement mechanism (e.g., magnet) in a second component. In such aspects, two separate components, e.g., a first (e.g., first primary) component, e.g., a volatile compound outlet component) and a second (e.g., second primary) component, of a delivery device can be selectively and releasable bound to (engaged with) one another by the magnetic attraction. In aspects, the magnetic attraction allows the two components to be completely pulled apart rapidly as desired by the user; however, the two components can also detectably or significantly move or rotate in relation to one another while still maintaining at least a degree or some detectable or significant amount of interface, e.g., a connection, to one another as the magnet does not force a fixed positional relationship between the two primary components. In certain aspects, a first (e.g., first primary) component, e.g., volatile compound outlet component, and a second (e.g., second primary) component, are connected to one another by a selectively releasable engagement component (selectively releasable attachment mechanism), wherein the selectively releasable attachment mechanism provides for complete disengagement of the two components and also allows for the two components to continue to interface with one another while being rotatable a full 360 degrees or more relative to one another. In certain aspects, a connection component, e.g., a selective connection component, i.e., a selectively releasable attachment mechanism, is a rapidly releasable attachment. In aspects, the rapidly releasable attachment mechanism is a magnetic force.

In certain aspects, engagement of two or more part(s), component(s) or assembly(ies) provided herein can be, e.g., selective, in that a user can elect to have such part(s), component(s), or assembly(ies) engaged or disengaged. In aspects, engagement or also or alternatively disengagement may only be feasible or possible when the device is in a particular configuration. For example, in aspects, two part(s), component(s), assembly(ies), or combination(s) thereof can be e.g., separable under one configuration of a device but not another configuration of a device, such as, e.g., when two elements (e.g., a volatile compound outlet component and a mating component) are aligned in one particular way compared to another. In aspects, two part(s), component(s), assembly(ies), or combination(s) thereof can be partially separable, in that they can, at least in some scenario(s), move apart from one another but may not be completely releasable/disengageable from one another, In aspects, for example, a mating component could move, or, e.g., be "slid," away from a volatile compound outlet component but may not be completely disengageable therefrom, in aspects, for example, being prevented from being completely disengageable by one or more part(s), component(s), assembly(ies), or feature(s) thereof, present in a delivery device. In certain aspects, part(s), component(s), or assembly(ies) may, e.g., be partially or completely separable under one or more particular configuration(s) but not detectably or significantly separable or not completely separable under one or more other particular configuration(s). As such, in aspects, engagement component(s) provided herein can provide any one or more such functionality(ies) described here.

According to certain aspects, an engagement component, e.g., selective attachment mechanism is a rapidly releasable connection mechanism (or, as stated above, a rapidly releasable force mechanism) which is operable with a single hand of a user, e.g., a single hand of the average (e.g., typical) adult. In such aspect, two parts or components of a delivery device, e.g., the first (e.g., first primary) component and the second (e.g., second primary) component (e.g., a volatile compound outlet component and a mating component) can be separated and re-attached repeatedly from one another quickly and easily by a user, such as by, e.g., single hand movement(s) of the user. In aspects, such rapid release and reconnection provides one aspect of an entertainment embodiment of a delivery device, such as, e.g., by providing a fidget experience through manual manipulation of the device. In certain respects, a rapid dis-engageability and re-attachability of a first (e.g., first primary) component and second (e.g., second primary), e.g., a volatile compound outlet component and a mating component by a rapid release force mechanism provided by a magnet is one aspect of the invention. In certain respects, such an embodiment provides detectable or significant entertainment pleasure to a user, provides a mechanism for assuaging a smoking habit-related craving such as a craving to hold, fondle, or otherwise play with or manually manipulate a smoking device, or any combination thereof. In certain aspects, an ability to provide an entertainment experience or assuage a smoking habit-related craving which is separate from any volatile compound(s) inhalation experience is an inventive element of the delivery device provided herein. In aspects, the device(s) herein provide an experience, e.g., a manually-focused experience characterizable as a "fidget" experience, capable of detectably or significantly reducing one or more non-inhalation smoking habit-related craving(s) as measured or reported by the user, as measured by an appropriately conducted and powered trial or survey administered or conducted by suitably trained individual(s) recognized as capable of identifying reduction in addiction-related behavior, or both. In certain aspects, a suitably trained individual recognized as capable of identifying reduction in addiction-related behavior can be, e.g., an addiction counselor, therapist, psychologist, medical physician, or other medical or non-medical personnel trained in identifying or suitably familiar with addiction related habit(s).

In this and other part, component, assembly, mechanism, function, feature, or operational aspect(s) of the invention, the invention also can be characterized as comprising a "means" for selectively and releasably attaching one part, component, assembly, or combination thereof of a delivery device, e.g., a first component, e.g., a first primary component, e.g., a volatile compound outlet component, to another component of a delivery device, e.g., a second component, e.g., a second primary component, e.g., a mating component. In such a respect, any known equivalents of such named releasable, non-permanent attachment components or mechanisms can also be, e.g., are, incorporated into devices or methods of the invention. As with other sections similarly described herein, any of the parts, components, or assemblies of the invention can be, where suitable, described as means (e.g., the above-described connection component, e.g., releasable (e.g., selectively releasable) connection mechanisms, can be described as selectively engagement means, releasable attachment means or means for providing releasable engagement, e.g., rapidly releasable engagement, of part(s), component(s), or assembly(ies), for example, a first component and a second primary component).

Characteristics of exemplary components, e.g., first (e.g., first primary) and second (e.g., second primary) components which may be engaged via an engagement component are described in further detail here.

Volatile Compound Outlet Component (First Primary Component)

In aspects, a component of a delivery device provided herein is referred to as a first component, or, e.g., a first primary component, for ease in providing description(s) of device(s) provided by the invention. In aspects, a first component, e.g., a first primary component, can be provided as a single unit, e.g., comprise a single device component. In aspects, a first (e.g., first primary) component is characterizable as a volatile compound outlet component (VCOC). In aspects a first component can be a first primary component. In aspects a first component/VCOC can be comprised of a plurality of device part(s), component(s), or assembly(ies). In aspects, a first component, e.g., a first primary component, can comprise a sub-component characterizable as a single device component or a sub-assembly of multiple components. Herein, the term subassembly may be used to describe a group of components of a device which begin as individual components however during the manufacturing process are assembled into a collection of components which are not intentionally dis-engageable from one another during normal (e.g., standard or routine) operation of the device. However, such a description or any similar description using such terms should not be interpreted as limiting, and, thus components described as being a part of any assembly or subassembly should be considered in alternative embodiments to be able to be provided as a single unit, e.g., a single, or an individual, component.

Volatile Compound Outlet Component (Body Assembly)

In aspects, device(s) herein comprise a component, e.g., a first component, e.g., a first primary component, referred to a volatile compound outlet component.

Herein, a volatile compound outlet component can also often be referred to as a body component, in reference to "the body," or, e.g., mouthpiece body component of a device.

In aspects, a volatile compound outlet component is a component of a delivery device with which a user engages to deliver volatile compound(s) to the user (e.g., by operating as or comprising a mouthpiece).

In aspects, a volatile compound outlet component provides the functionality of mouthpiece, a mouthpiece specifically being described elsewhere herein. In aspects, a volatile compound outlet component can comprise a part or component which is a mouthpiece and one or more other part(s), component(s), or assembly(ies) which further facilitate the delivery of volatile compounds via a volatile compound outlet area, e.g., hole, in the device. In aspects, a volatile compound outlet component can comprise, e.g., a volatile compound outlet component extension. In aspects, a volatile compound outlet component can interface with, engage with, or, e.g., in aspects, connect to, such as via a connection component, one or more other part(s), component(s), or assembly(ies) of a delivery device.

In aspects, a volatile compound outlet component comprises a mouthpiece and a volatile compound compartment (aka a VCCSC). In aspects, a first component, e.g., first primary component, e.g., volatile compound outlet component, can be referred to as a Body Assembly (which is a type of VCOC). In aspects, a Body Assembly comprises at least one component of the device which is an externally visible component(s).

In aspects, a function of the volatile compound outlet component, e.g., a Body Assembly, can be to provide a volatile compound facilitation component, or a user engagement component, by which the user receives volatile compound(s) exiting the device, e.g., a Mouthpiece (described below). Thus herein, "user engagement component" may be used to describe a volatile compound outlet component or a volatile compound facilitation component (referenced in Figures as (301)). In aspects, therefore, at least one component of a volatile compound outlet component, e.g., Body Assembly, can establish a first portion of the full length of the device starting at a device first end, the first end being the end of the device being that which is designed for placement onto a user's lips or into a user's mouth.

In aspects, a function of a volatile compound outlet component, e.g., a Body Assembly, can be to maintain a volatile compound maintenance and delivery element (such a volatile compound maintenance and delivery element referred to herein as a solid material device capable of maintaining, releasing, or maintaining and releasing one or more volatile compounds, or, e.g., an "insert" or a "removable insert".) In aspects, a function of a volatile compound outlet component, e.g., a Body Assembly, can be to maintain a removable insert stably within the delivery device during operation of the device and during device movement or storage. In aspects, a function of a volatile compound outlet component, e.g., a Body Assembly, can be to facilitate the ease of insertion, removal, or insertion and removal of an insert, e.g., a removable insert.

In aspects, a volatile compound outlet component comprises a portion of, some of, most of, generally all, or all of the total airflow channel of a delivery device.

Volatile Compound Delivery Facilitation Component (Mouthpiece)/User Engagement

According to embodiments, delivery devices provided by the invention comprise one or more component(s) facilitating the delivery of one or more volatile compounds.

In aspects, such one or more component(s) can facilitate the delivery of one or more volatile compounds via the nose of a user. In alternative aspects, one or more component(s) is/are not designed to specifically facilitate the delivery of one or more volatile compounds via the nose of a user. In common embodiments, the one or more components facilitating delivery of one or more volatile compounds is designed to facilitate the delivery of the one or more volatile compounds via the mouth.

In certain aspects, a component facilitating the delivery of one or more volatile compounds ("volatile compound delivery facilitation component," or, e.g., component designed to engage with the user for the receipt of volatile compound(s) exiting a device, the portion of a device making contact with a device user, e.g., the lips of the device user) can be or comprise, e.g., one or more openings, e.g., holes or apertures in a device. In aspects such one or more openings can be selectively openable and closable hole(s) or opening(s). In aspects, a user engagement component for receiving volatile compound(s) from a device, e.g., a volatile compound delivery facilitation component can be, e.g., a short tube, cannula, or other component designed with the shape of the nose in mind, e.g., with one or more elements for placement into one or more nostrils of a user. In aspects, such a component facilitating delivery of one or more volatile compounds is designed to facilitate the placement of the delivery device upon or about the user's lips, between the user's lips, into the mouth of the user, or a combination thereof.

In aspects, a user engagement component for receiving volatile compound(s) from a delivery device, e.g., a volatile compound facilitation component facilitating the exit of one or more volatile compounds from a device for receipt by a user can be, e.g., embodied as a Mouthpiece. In aspects, such a component is a volatile compound outlet component as described herein. In aspects, such a component is a Mouthpiece of a volatile compound outlet component. In aspects, a user engagement component for receiving volatile compound(s) from a delivery device, e.g., a component designed to contact a user's lips or mouth, e.g., a volatile compound delivery facilitation component, can comprise one or more of the characteristics of a Mouthpiece described in the figures or detailed description of figures provided herein (or elsewhere herein). In aspects, a user engagement component for receiving volatile compound(s) from a delivery device, e.g., lip- or mouth-engageable part or component of a device, e.g., Mouthpiece, can facilitate the delivery of one or more volatile compounds via a delivery device, can facilitate holding the delivery device within the mouth of the individual/user, or both. In aspects, the lip- or mouth-engageable part or component of a device, e.g., e.g., Mouthpiece, can comprise one or more features which detectably or significantly increase the ease by which a user can hold or stably maintain the delivery device during use. For example, in aspects, a lip- or mouth-engageable part or component of a device, e.g., as embodied as a mouthpiece can comprise one or more portions along its length comprising a diameter, or, e.g., width or height or thickness in a device not having a circular cross-sectional shape, which is detectably or significantly less than the maximum diameter, or, e.g., maximum width or height, of the mouthpiece, of the delivery device itself, or both. Such a portion of narrowed diameter (thickness) can be characterizable as a "lip groove" as described above, wherein the narrowed section aids the user in maintaining the delivery device between their lips or, e.g., within their mouth.

A lip- or mouth-engageable part or component of a device, e.g., Mouthpiece can, in embodiments, comprise two or more portions along its length having a diameter, or, e.g., width or height or thickness in a device not having a circular cross-sectional shape, which is less than the maximum diameter, or, e.g., maximum width or height or thickness, of the mouthpiece, of the delivery device itself, or both. In such aspects, one such narrowed portion can aid, facilitate, or otherwise improve upon the ability of the user to maintain the delivery device between their lips or, e.g., within their mouth. Such a narrowed portion providing such functionality can also or alternatively improve upon the comfort experienced by the user in maintaining the delivery device between their lips or within their mouth. Further, a second narrowed portion can facilitate holding the device, such as a narrowed portion characterizable as a "finger groove" as described above. In certain aspects, a lip- or mouth-engageable part or component of a device, e.g., Mouthpiece, can comprise a reduced diameter (e.g., reduced thickness or width) portion in a location which corresponds with or is positioned near or adjacent to the center of gravity for the device when the device is fully assembled and in a ready-to-use state.

According to aspects, one or more reduced thickness (e.g., reduced diameter in particular embodiments) area(s) of a lip- or mouth-engageable part or component of a device, e.g., mouthpiece can comprise an hourglass shape or which may be characterizable as a scalloping or scalloped shape. In certain aspects, at least one portion of a lip- or mouth-engageable part or component of a device, e.g., Mouthpiece, can comprise an hourglass or scalloped shape (such is exemplified in figure(s) provided herein.

According to certain embodiments, a lip- or mouth-engageable part or component of a device, e.g., mouthpiece, can comprise one or more detectable or significant depression(s) on its exterior surface. In aspects, such depression(s) may, in aspects, be characterizable as "grooves", or portions having a detectably or significantly recessed surface. In aspects, one or more such recession(s) provide a feature within which a user may place their teeth to aid in maintaining or holding a delivery device within their mouth. In aspects, such groove(s) or recession(s) can be referred to as "tooth (or teeth) groove(s)" or "bite groove(s)." In aspects, one or more tooth/teeth groove(s) are located adjacent to one or more areas of a device, e.g., portions of a volatile compound outlet component, mouthpiece (or both) having a reduced width (such reduced width area(s) described elsewhere herein.)

According to certain embodiments, a lip- or mouth-engageable part or component of delivery device(s) provided herein can be detectably or significantly reduced, or also or alternatively detectably or significantly extended, in length, e.g., by the inclusion or exclusion of one or more reduced thickness or recessed areas, such as e.g., by the inclusion or exclusion of a lip groove, the inclusion or exclusion of a finger groove, the inclusion or exclusion of a bite groove, or, e.g., inclusion or exclusion of any combination thereof.

In aspects, a lip- or mouth-engageable part or component of a device, e.g., Mouthpiece, can be made of any material safe for use in the mouth of a user. In aspects, such a material can be an organic material, such as, e.g., a wood material, such as, e.g., maple, rosewood, or olive wood. In aspects, such a material can be a metal or metal alloy material, such as, e.g., those described elsewhere herein, e.g., stainless steel, gold, titanium, platinum, etc. In aspects, such a material can be (comprise, mostly comprise, or consist of) a plastic material ("a plastic") such as those described elsewhere herein. In aspects, a lip- or mouth-engageable part or component of a device, e.g., part or component (or, e.g., portion) of a volatile compound outlet component comprises an outer (exterior) surface that is at least generally, at least mostly, at least substantially, at least essentially, essentially, or is made up of a material which differs from one or more other material(s) of any one or more part(s), component(s), or assembly(ies) of the delivery device.

In certain aspects, a lip- or mouth-engageable part or component of a device, e.g., Mouthpiece, can be releasably attached to one or more components of a delivery device. In aspects, a lip- or mouth-engageable part or component of a device, e.g., Mouthpiece, (or, e.g., feature(s) of a Mouthpiece described herein) can be, in and of itself, or can be a part or component of (or provide such feature(s) to) a device component, e.g., a first device component, e.g., a first primary component, e.g., a volatile compound outlet component, which is releasably attached to a second device component, e.g., second device primary component, e.g., mating component. In aspects, such a second device component can be a component designed to mate with the first device component. In certain aspects, for example, a Mouthpiece, or, e.g., a component comprising feature(s) of a Mouthpiece described herein (e.g., a volatile compound outlet component), can be removed from a second component of a device so as to facilitate insertion or removal of a solid material device maintaining, releasing, or maintaining and releasing volatile compound(s) (i.e., an insert) for delivery by the device via the mouthpiece or its corresponding feature(s) as appropriate.

According to certain aspects, a Mouthpiece is selectively engaged with, e.g., selectively removable from, one or more component(s) of a delivery device, either being separable alone from such other component(s) or, e.g., separable as a constituent of a group of device components. According to certain embodiments, the selective disengagement of the mouthpiece from one or more other component(s) of a device allows for the insertion (incorporation), removal, or both, of an insert. In aspects, removal of, e.g., a mouthpiece, facilitates the insertion or removal of an insert (to the device) via a location along or parallel to the long axis of the device of which the mouthpiece is a component.

In aspects, a lip- or mouth-engageable part or component of a device, e.g., Mouthpiece, can be a first device component or part of a first device component or, also or alternatively, can be releasably attached to, e.g., one or more components of a first device component, e.g., first primary component (e.g., a volatile compound outlet component or Body Assembly) such as, for example, attached to a component of an engagement component, e.g., a selectively releasable attachment mechanism (comprising, e.g., in embodiments, a magnet, a magnet Cover, and a Barrel Collar). In aspects for example, a lip- or mouth-engageable part or component of a device, e.g., Mouthpiece, can be releasably attached to an engagement component positioning component or part, e.g., a Magnet Cover. In certain specific embodiments, wherein a connection mechanism, e.g., a magnet and a connection mechanism support (positioning) component, e.g., magnet cover, components of a connection component (e.g., selectively releasable attachment mechanism) reside in a volatile compound outlet component (e.g., Body Assembly), along with a lip- or mouth-engageable part or component of a device (e.g., Mouthpiece), and an engagement mechanism counterpart, e.g., Barrel Collar component of an engagement component, e.g., selectively releasable attachment mechanism, resides in a second (e.g., second primary) component of a delivery device (e.g., mating component or Tip Assembly), the, e.g., Mouthpiece is not releasably attached to an, e.g., Barrel Collar. In aspects, a lip- or mouth-engageable part or component of a device, e.g., Mouthpiece, can be releasably attached to the delivery device and therefore can be replaced or is characterizable as interchangeable. One embodiment of a delivery device provided herein therefore is a delivery device comprising an interchangeable, e.g., replaceable mouthpiece, such that a user can customize the mouthpiece according to user preferences directed to visual appearance (e.g., color), material, weight, or shape, etc.

According to certain aspects, volatile compound delivery component, e.g., a mouthpiece, can comprise an interior which forms an airflow channel. In aspects, a portion of this interior can comprise an attachment mechanism feature allowing for the volatile compound delivery component, e.g., a mouthpiece, to be fixedly engaged with, selectively engaged with, or either fixedly or selectively engaged with one or more other part(s) or component(s) of a device, such as, e.g., an engagement component support. In aspects, an attachment feature can be threading. In aspects, an attachment feature can be a connection mechanism such as a clipping or snapping mechanism. In aspects, an attachment feature can be one or more surfaces capable of being brazed or welded to one or more other surface(s), part(s), or component(s) of a delivery device.

In aspects, a volatile compound delivery facilitation component, e.g., mouthpiece, comprises a portion of, some of, most of, generally all of, or all of the total airflow channel of a delivery device. In aspects, a volatile compound delivery facilitation component, e.g., mouthpiece, comprises a mouthpiece airflow channel and the airflow through the mouthpiece airflow channel represents a portion of a total airflow channel through a delivery device.

In aspects, a volatile compound delivery facilitation component is a custom machined component, designed specifically for use in a delivery device described herein. According to certain aspects, a lip- or mouth-engageable part or component of a device, e.g., designed to engage with a user for the user to receive volatile compound(s) exiting therefrom (e.g., a mouthpiece) comprises a raised, curved, or rounded surface. In aspects, this surface surrounds the opening in the delivery device through which volatile compound(s) exit the device. In aspects, such a surface is characterizable as "domed" or comprising a dome shape. In aspects, such a surface aids in the user in receiving volatile compound(s) delivered by a delivery device, aids in the comfort experienced by a user in receiving volatile compound(s) delivered by a delivery device, or both.

In this and other part, component, assembly, mechanism, function, feature, or operational aspect(s) of the invention, the invention also can be characterized as comprising a "means" for receiving volatile compound(s) exiting a delivery device by a user, e.g., a means for facilitating the delivery of one or more volatile compounds, or, e.g., a means for a user to engage with a delivery device so as to receive volatile compound(s) exiting therefrom. In such a respect, any known equivalents of such named delivery facilitation mechanisms can also be, e.g., are, incorporated into devices or methods of the invention. As with other sections similarly described herein, any of the components of the invention can be, where suitable, described as means (e.g., the above-described user engagement component, volatile compound receipt component, or component for a user to engage with a device for receiving volatile compounds delivered therefrom can be described as user engagement means, volatile compound receipt means, means for user engagement for the receipt of volatile compound(s), volatile compound delivery facilitation means, or means for providing or facilitating the delivery of one or more volatile compounds directly to a user, e.g., to a user's lips or mouth).

User Engagement Component for Receiving Volatile Compounds—Supplement (Mouthpiece Tube)

According to aspects, a user engagement component for receiving volatile compound(s) from a delivery device, e.g., a mouthpiece, can be composed of a material which may, under certain conditions, be at risk of damage. In aspects, a user engagement component for receiving volatile compound(s) from a delivery device, e.g., a mouthpiece, may be composed of a structurally weak material; a brittle or weak material or, e.g., a material detectably or significantly susceptible to breaking. Further, according to aspects, delivery device may comprise a component with which a user engages to receive volatile compound(s) from a delivery device or component thereof (e.g., a Mouthpiece), made at least substantially of a material which is (a) at risk of being compromised due to exposure to excessive moisture, (b) not sufficiently durable to facilitate attachment to at least one additional part, component, or assembly of the delivery device, (c) not sufficiently durable to facilitate repeated engagement and disengagement to/from at least one additional part, component, or assembly of the delivery device, or (d) any combination of (a)-(c). In aspects, a delivery device, e.g., a volatile compound outlet component of a delivery device, or, e.g., a mouthpiece, thereof, can comprise as an additional component a delivery facilitation component (user engagement component for receipt of volatile compound(s) supplement. In certain aspects, such a supplement can be, e.g., a Mouthpiece Tube. In aspects, a user engagement component for receipt of volatile compound(s), that is, the part, component, feature, or portion of a device with which a user makes contact with a device with their lip(s) or mouth, (i.e., delivery facilitation component) supplement can comprise one or more of the characteristics of the Mouthpiece Tube described in the figures or detailed description of figures provided herein.

In aspects, such supplement(s) can be, e.g., any part or component which operates to protect a component of a device (e.g., Mouthpiece) from damage, such as by, e.g., exposure to excessive moisture or, e.g., wear and tear associated with repeated engagement/disengagement from another delivery device component, or also or alternatively provides detectable or significant structural integrity. In aspects, such component supplement can be any part or component accomplishing this purpose, such as, e.g., a liner, a coating, an inserted component, such as, an insert made of, e.g., a plastic, metal, or, e.g., metal alloy, etc. In aspects, such a component supplement can be made of, e.g., stainless steel. In aspects, a user engagement component (e.g., mouthpiece) supplement is a stainless-steel tube, e.g., a Mouthpiece Tube.

In certain aspects, a component supplement described in this section, e.g., Mouthpiece Tube, can be positioned within an interior of a volatile compound outlet component, e.g., a user engagement portion or part/component thereof designed to allow receipt of volatile compound(s) by a user upon their exit from the device, e.g., Mouthpiece. In such aspects, the component supplement, e.g., Mouthpiece Tube, is not obviously externally visible under normal delivery device operating conditions. In aspects, the mouthpiece component supplement (e.g., Mouthpiece Tube) detectably or significantly reduces the exposure of the Mouthpiece to moisture. In aspects, the supplement is at least generally, at least substantially, at least essentially is, essentially is, or is the same length as the component in which it resides or which it is designed to detectably or significantly protect, e.g., a mouthpiece. In aspects, a component supplement described here has a length which is shorter than that of the component in which it resides or which it is designed to detectably or significantly protect, e.g., a mouthpiece, such that, e.g., it does not encompass the full length of an airflow path or channel through the user engagement component (mouthpiece airflow channel).

In aspects, a volatile compound delivery facilitation component supplement, e.g., Mouthpiece Tube, comprises a portion of, some of, most of, generally all of, or all of the total airflow channel of a delivery device. In aspects, a volatile compound delivery facilitation component supplement, e.g., Mouthpiece Tube, comprises a mouthpiece supplement airflow channel and the airflow through the mouthpiece supplement airflow channel represents a portion of a total airflow channel through a delivery device. In aspects, the portions of a total airflow through a delivery device represented by a volatile compound delivery facilitation component (user engagement component for receipt of volatile compound(s) exiting a device) and a supplement part or component thereof are at least generally, at least mostly, at least substantially, at least essentially, essentially, or are the same.

In aspects, the length of a volatile compound delivery facilitation component supplement, e.g., Mouthpiece Tube, is, e.g., at least about 10%, ≥~15%, ≥~20%, ≥~25%, ≥~30%, ≥~35%, ≥~40%, ≥~45%, ≥~50%, ≥~55%, ≥~60%, ≥~65%, ≥~70%, ≥~75%, ≥~80%, ≥~85%, ≥~90%, ≥~95%, or, e.g., is at least about 97.5%, ~98%, ~99%, or, e.g., is about 100% of the length of the volatile compound delivery facilitation component (user engagement component for receipt of volatile compound(s) exiting a device), e.g., Mouthpiece. In aspects, the supplement is designed with an attachment mechanism facilitating the durable, repeatable, selective engagement/disengagement of the volatile compound delivery facilitation component (user engagement component for receipt of volatile compound(s) exiting a device) (e.g., mouthpiece) with at least one other part or component of the device. In aspects, the supplement to the volatile compound delivery facilitation component (user engagement component for receipt of volatile compound(s) exiting a device) detectably or significantly extends the usable lifespan of a volatile compound delivery facilitation component (user engagement component for receipt of volatile compound(s) exiting a device), e.g., mouthpiece, such as by at least ~2×, ~5×, ~10×, ~20×, ~50×, ~100×, ~1000×, or ~2000× or more over a mouthpiece component lacking such a supplement part.

In aspects, such an attachment mechanism described above can be, e.g., any connection component or mechanism, e.g., selectively releasable attachment mechanism, described elsewhere herein, such as, e.g., a threading connection mechanism to allow for a volatile compound delivery facilitation component (user engagement component for receipt of volatile compound(s) exiting a device), e.g., mouthpiece, to be selectively screwed onto or off of one or more other part(s), component(s), or assembly(ies) of a delivery device. In certain specific aspects, a Mouthpiece can comprise a Mouthpiece Tube, the Mouthpiece Tube comprising threading to facilitate the attachment of the Mouthpiece to another component of a first primary device component, e.g., a Magnet Holder. In certain aspects, a volatile compound delivery facilitation component (user engagement component for receipt of volatile compound(s) exiting a device) supplement (e.g., Mouthpiece Tube) can be press-fit into/onto a volatile compound compartment, e.g., removable insert housing component (described or referred to herein as a Body Tube).

In aspects, a volatile compound delivery facilitation component (user engagement component for receipt of volatile compound(s) exiting a device) supplement, e.g., Mouthpiece Tube, can be custom made, e.g., custom cast, machined, or otherwise custom manufactured for use with the delivery device(s) herein. In aspects, a volatile compound delivery facilitation component (user engagement component for receipt of volatile compound(s) exiting a device) supplement, e.g., Mouthpiece Tube, can be purchased as a typical on-market machine part.

In this and other part, component, assembly, mechanism, function, feature, or operational aspect(s) of the invention, the invention also can be characterized as comprising a "means" for protecting the volatile compound delivery facilitation component (user engagement component for receipt of volatile compound(s) exiting a device). In such a respect, any known equivalents of such named volatile compound delivery facilitation component (user engagement component for receipt of volatile compound(s) exiting a device) supplement elements can also be, e.g., are, incorporated into devices or methods of the invention. As with other sections similarly described herein, any of the part(s), component(s), or assembly(ies) of the invention can be, where suitable, described as means (e.g., the above-described volatile compound delivery facilitation component (user engagement component for receipt of volatile compound(s) exiting a device) supplements can be described as volatile compound delivery facilitation component (user engagement component for receipt of volatile compound(s) exiting a device) supplement means or means for providing or facilitating protection of a volatile compound delivery facilitation component (user engagement component for receipt of volatile compound(s) exiting a device); means of protecting a mouthpiece).

Mouthpiece Component Attachment Insert (Mouthpiece Attachment Insert)

According to certain aspects, similar to the volatile compound delivery facilitation (user engagement component for receipt of volatile compound(s) exiting a device) component supplement component, a modified version of such a component can be provided to facilitate the attachment of the volatile compound delivery facilitation component (user engagement component for receipt of volatile compound(s) exiting a device), e.g., mouthpiece, to another component of the delivery device without, e.g., providing full protection of the mouthpiece, from excessive moisture, etc. This could be helpful, for example, in embodiments wherein the mouthpiece is made of, e.g., a material not detectably or significantly impacted by contact with excessive moisture, e.g., a ceramic material, but which may not be sufficiently durable to withstand repeated engagement/disengagement from another component of a delivery device, such as may be accomplished by, e.g., screwing the mouthpiece onto or off of another component. In such embodiments, a volatile compound delivery facilitation component (user engagement component for receipt of volatile compound(s) exiting a device) attachment insert, e.g., a Mouthpiece Attachment Insert, can be beneficial.

In aspects, a mouthpiece attachment insert (or part/component as described above having such feature(s) and functionality(ies)) can be, e.g., any part or component which operates to protect user engagement component for receipt of volatile compound(s) exiting a device (e.g., Mouthpiece) from damage, e.g., wear and tear, associated with repeated engagement/disengagement from another delivery device component. In aspects, such user engagement component for receipt of volatile compound(s) exiting a device (e.g., mouthpiece) attachment insert can be any part or component accomplishing this purpose, such as, e.g., a liner, a coating, an inserted component, such as, an insert made of, e.g., a plastic, metal, or, e.g., metal alloy, etc. In aspects, such an attachment insert can be made of, e.g., stainless steel. In aspects, a user engagement component for receipt of volatile compound(s) exiting a device (e.g., mouthpiece) attachment insert is a stainless-steel component, e.g., a Mouthpiece Attachment Insert.

In certain aspects, an attachment insert component/part, as described above, e.g., a Mouthpiece Attachment Insert, can be positioned within an interior of a user engagement component for receipt of volatile compound(s) exiting a device, e.g., Mouthpiece. In such aspects, the attachment insert (e.g., mouthpiece attachment insert) is not obviously externally visible under normal delivery device operating conditions. In aspects, an attachment insert detectably or significantly reduces damage to the user engagement component for receipt of volatile compound(s) exiting a device (e.g., mouthpiece) over time, such that the number of times an, e.g., mouthpiece, can be attached to and removed from another device component increases by at least 2 times ("2×"), or, e.g., increases by at least ~5×, ~10×, ~20×, ~50×, ~100×, ~1000×, or ~2000× or more over a, e.g., mouthpiece, lacking such a component.

In aspects, the user engagement component for receipt of volatile compound(s) exiting a device (e.g., mouthpiece) attachment insert is designed with an attachment mechanism facilitating the durable, repeatable, selective engagement/disengagement of the, e.g., mouthpiece, with at least one other part or component of the device. In aspects, such an attachment mechanism can be, e.g., any engagement component, or, e.g., a selectively releasable attachment mechanism described elsewhere herein, such as, e.g., a threading connection mechanism to allow for a volatile compound delivery facilitation component (user engagement component for receipt of volatile compound(s) exiting a device), e.g., mouthpiece, to be selectively screwed onto or off of one or more other components of a delivery device. In certain specific aspects, a Mouthpiece can comprise a Mouthpiece Attachment Insert, the Mouthpiece Attachment Insert comprising threading to facilitate the attachment of the Mouthpiece to another component of a first primary device component, e.g., a Magnet Holder.

In aspects, a Mouthpiece Attachment Insert (or equivalent such part or component having one or more feature(s) and functionality(ies) of a mouthpiece attachment insert described herein), can be custom made, e.g., custom cast, machined, or otherwise custom manufactured for use with the delivery device(s) herein. In aspects, an attachment insert, e.g., Mouthpiece Attachment Insert, can be purchased as a typical on-market machine part. In certain aspects, an attachment insert, e.g., Mouthpiece Attachment Insert, is designed to conform with a shape defined by the, e.g., mouthpiece, e.g., a contour within the interior of the user engagement component for receipt of volatile compound(s) exiting a device (e.g., Mouthpiece).

In aspects, a mouthpiece attachment insert of a delivery device is positioned, designed, or both such that it does not interfere with the flow of air through the device (does not detectably or significantly interfere with the total airflow channel of a device) and thus does not detectably or significantly interfere with the delivery of one or more volatile compounds. In certain aspects, the mouthpiece attachment insert comprises an opening therethrough. In aspects, the center of the mouthpiece attachment insert of a delivery device provides a passageway for airflow through the device and, e.g., through the mouthpiece attachment insert.

In this and other part, component, assembly, mechanism, function, feature, or operational aspect(s) of the invention, the invention also can be characterized as comprising a "means" for protecting the user engagement component for receipt of volatile compound(s) exiting a device (e.g., mouthpiece) or supplement or other protection mechanism thereof. In such a respect, any known equivalents of such named mouthpiece protection component attachment insert elements can also be, e.g., are, incorporated into devices or methods of the invention. As with other sections similarly described herein, any of the part(s), component(s), and assembly(ies) of the invention can be, where suitable, described as means (e.g., the above-described user engagement component for receipt of volatile compound(s) exiting a device attachment insert can be described as user engagement component for receipt of volatile compound(s) exiting a device attachment means or means for providing or facilitating protection of a user engagement component for receipt of volatile compound(s) exiting a device, e.g., mouthpiece).

Volatile Compound Outlet Component Extension (Body Subassembly)

In aspects, a first (e.g., first primary) device component, e.g., a volatile compound outlet component, e.g., a Body Assembly, can comprise, e.g., user engagement component for receipt of volatile compound(s) exiting a device, e.g., Mouthpiece, optionally a supplemental protection and/or connection mechanism thereof, e.g., a Mouthpiece Tube, Mouthpiece Attachment Insert, or both, and at least one other delivery device part or component. In aspects, such an at least one other delivery device part or component is referred to herein as a volatile component outlet component extension.

In certain aspects, the at least one other delivery device part or component, e.g., volatile component outlet component extension, can be, e.g., a single part or component. In aspects, a volatile component outlet component extension at least generally consists of, mostly consists of, generally consists of, at least substantially consists of, or consists of a volatile compound compartment. Possible features/characteristic(s) of a volatile compound compartment are described elsewhere herein.

In certain aspects, the at least one other delivery device part or component, e.g., volatile component outlet component extension, can be, e.g., a plurality of parts, components, or both. In certain aspects, the plurality of additional parts, components, or both of a volatile component outlet component extension can be provided during manufacturing as an assembly, such as, e.g., in aspects a subassembly, e.g., referred to herein as a Body Subassembly.

In aspects, a volatile component outlet component extension, e.g., Body Subassembly can comprise, e.g., one or more constituents of an engagement component, e.g., an engagement mechanism, e.g., a selectively releasable engagement mechanism or a component thereof, e.g., a Magnet; an engagement component support (positioning) part or component, e.g., a Magnet Cover; a volatile compound compartment, e.g., a removable insert housing component, e.g., a Body Tube, one or more insert support part(s) such as, e.g., a stabilizing part or component, e.g., a compressible positioner, e.g., an Insert Spring, or, e.g., a fixed positioner which may be a feature of one or more other part(s) or component(s); or one or more constituents of an airflow control mechanism or airflow control limitation mechanism (airflow restrictor), e.g., a first airflow control limiter, e.g., a Body Crown. Such part(s) and component(s) are described in detail herein.

Selectively Releasable Engagement Mechanism (Magnet)

In aspects, delivery device(s) described herein comprise an engagement component. In aspects, an engagement component comprises at least one engagement mechanism and at least one engagement mechanism counterpart. In aspects, an engagement component can further comprise an engagement component support (or positioning) part or component. An engagement mechanism of an engagement component can be, e.g., any part or component participating in the engagement of two or more part(s), component(s), or assembly(ies), or combination(s) thereof. In aspects, an engagement mechanism is a part of an engagement component essential to or otherwise responsible for performing most, generally all, substantially all, or all of the work or initiating most, generally all, substantially all, or all of the work associated with the engagement. In aspects, an exemplary engagement mechanism of an engagement component can be, e.g., a magnet.

According to aspects, delivery device(s) provided by the invention can comprise an engagement component, e.g., a selectively releasable engagement mechanism (as described elsewhere herein). In aspects, the selectively releasable engagement mechanism, also referred to as a selectively releasable attachment mechanism, is a rapidly releasable force mechanism. In some respects, the rapidly releasable force mechanism is a magnetic force. In such aspects, a delivery device can comprise, e.g., an engagement component, a selectively releasable engagement mechanism comprising a magnet. In aspects, an engagement component mechanism, e.g., a selectively releasable engagement mechanism component can comprise one or more of the characteristics of the magnet described in the figures or detailed description of figures provided herein. In aspects, a magnet is, e.g., one component (an engagement mechanism) of an engagement component, e.g., a selectively releasable engagement mechanism, or, one component of a rapidly releasable force mechanism, or both.

In some respects, a delivery device can comprise a magnet in a first, e.g., a first primary, component of the device, e.g., volatile compound outlet component, e.g., Body Assembly, while one or more components attractive to or attracted by the magnet (e.g., an engagement mechanism counterpart) is positioned in a second, e.g., second primary, component of the device, e.g., a mating component, e.g. Tip Assembly. In such an embodiment, the first (volatile compound outlet component) and second (mating) components of the delivery device are releasably bound to one another by the magnetic attraction. In aspects, the purpose of a magnet present in the delivery device is at a minimum, but in aspects among other things, to provide a selectively releasable engagement mechanism between ≥2 components of the device.

In aspects, a magnet of a delivery device is positioned, designed, or both such that it does not interfere with the flow of air through the device (does not detectably or significantly interfere with the total airflow channel of a device) and thus does not detectably or significantly interfere with the delivery of one or more volatile compounds. In certain aspects, the magnet is annular in shape. In aspects, the center of the annular shape provides a passageway for airflow through the device and, e.g., through the magnet.

In aspects, a magnet of a delivery device is oriented such that its magnetic poles are aligned in the same direction across all delivery devices, allowing for consistent compatibility with various magnetic accessories and magnetic attachments, e.g., a device stand, such as, for example, consistent positioning of a delivery device when associated with a magnetic accessory, such as, for example a device support unit such as a device stand.

In aspects, two delivery devices, when placed side-by-side while oriented in the same direction, will magnetically attract to one another when one device is shifted slightly off-center from that of the other; that is, when the magnet of one device is slightly off-center from that of the magnet in the other device. In this position, a pole of the magnet in the first device will align with the opposite pole of the magnet in the second device. In aspects, if the two delivery devices are placed in complete alignment side-by-side while oriented in the same direction, the two delivery devices will repel one another, as each of the corresponding poles of the magnet(s) in each device are aligned. In aspects, two delivery devices, when placed side-by-side while oriented in opposite direction will magnetically attract to one another with their respective magnets fully aligned, as the poles of each magnet in the devices will be positioned in reverse direction.

In aspects, the force of the magnet should be as strong as possible given the size of the device, but not so strong as to be difficult to disengage by hand. Further, in aspects, the force of the magnet should be as strong as possible given the size of the delivery device and sufficiently strong to maintain the device in association with an accessory, e.g., a device support unit, however not so strong as to make it difficult to remove the device from such an accessory or so strong that attempting to remove the device from the accessory leads to undesirable movement of the accessory (e.g., attempting to lift the device off of a support accessory such as a device stand also lifts the device stand itself). In aspects, the force required may be achieved by increasing the magnet's size, increasing the size of the mating component, decreasing the distance to the mating component, selecting a stronger or weaker grade of magnetic material, or selecting a mating component with different magnetic properties. In certain aspects, one or more accessories are available which are designed to cooperatively engage with an engagement component constituent, e.g., engagement mechanism, e.g., magnet of a delivery device. In aspects, such cooperative engagement between a delivery device and an accessory (such as, e.g., a device support unit) expands upon feature(s) of device(s) present when such accessory(ies) are absent, such as for example fidget experience(s) provided by device (s) provided herein. This is described elsewhere herein.

According to certain aspects, the strength of an engagement between an engagement mechanism and, e.g., an engagement mechanism counterpart, e.g., the magnetic force providing the engagement is between about 1 gauss (0.0001 tesla) and about 2000 gauss (0.2 tesla), such as, e.g., ~10 gauss-~2000 gauss, ~10 gauss-~1500 gauss, ~10 gauss-~1000 gauss, ~10 gauss-~750 gauss, or ~10 gauss-~500 gauss, or, e.g., ~50 gauss-~2000 gauss, ~100 gauss-~2000 gauss, ~200 gauss-~2000 gauss, ~300 gauss-~2000 gauss, ~400 gauss-~2000 gauss, or, e.g., ~500 gauss-~2000 gauss, as in, for example, ~50 gauss-~1500 gauss, ~100 gauss-~1000 gauss, ~200 gauss-~800 gauss, ~300 gauss-~700 gauss, or, e.g., ~400 gauss (0.04 tesla)-~600 gauss (0.06 tesla) or a force equivalent to such a force as provided in a different form or unit(s) of measure.

According to certain aspects, the magnet has a size and attractive force (strength) sufficient to lift a weight of up to about 5 g, ~10 g, ~20 g, ~40 g, ~60 g, ~80 g, ~100 g, ~120 g, ~140 g, ~160 g, ~180 g, or, e.g., up to about 200 g or more.

According to certain aspects, the magnet has a size and attractive force (strength) sufficient to lift a weight of up to about 200 g, 250 g, 300 g, 350 g, 400 g, or more. According to certain aspects, the magnet is a 10 g-force (gf) to about 1000 g-force (gf) magnet, such as, e.g., ~10 gf-~900 gf, ~10 gf-~800 gf, ~10 gf-~700 gf, ~10 gf-~600 gf, ~10 gf-~500 gf, or ~10 gf-~400 gf magnet, e.g., ~50 gf-~1000 gf, ~100 gf-~1000 gf, ~150 gf-~1000 gf, ~200 gf-~1000 gf, ~250 gf-~1000 gf, ~300 gf-~1000 gf, or ~350 gf-~1000 gf magnet, such as, e.g., ~100 gf-~900 gf, ~200 gf-~700 gf, ~300 gf-~500 gf, or, e.g., ~300 gf-~400 gf magnet. In certain aspects, the magnet is characterizable as a 350 gram-force (0.8 lbf) magnet.

In aspects, the force required to separate part(s), component(s), or assembly(ies) of delivery device(s) provided herein engaged via an engagement component is equivalent to the amount of force required to counteract, e.g., oppose, a magnetic force described above.

In aspects, the force of the connection provided by an engagement component, or, e.g., constituent(s) thereof, e.g., a connection mechanism such as a magnet, should be as strong as possible given the size of the delivery device; yet, should also be not so strong as to be difficult to disengage by hand, such as by a single hand, e.g. in aspects by two or more fingers of a single human hand. A suitable force required may, in aspects, be achieved by increasing or decreasing, as appropriate, a connection component connection mechanism's size (e.g., a magnet's size), increasing or decreasing as appropriate the size of the connection component connection mechanism counterpart, increasing or decreasing the distance between a connection component connection mechanism and a corresponding connection component connection mechanism counterpart, selecting a stronger or weaker grade of material(s), e.g., magnetic material(s), or e.g., selecting a connection component connection mechanism counterpart with differing properties, e.g., detectably different (e.g., stronger or weaker magnetic properties.

In aspects, a connection component connection mechanism, e.g., magnet described herein can be custom made for use within the device. In certain aspects, a standard stock connection component connection mechanism, e.g., magnet, having the appropriate strength and shape can be utilized.

In aspects, the magnet of the delivery device comprises a bearing element, e.g., ball bearing. In such aspects, the bearing element allows the delivery device to spin freely or by force from the user while the user holds the delivery device by gripping only the magnet component of the device. In aspects, the delivery device and the magnet of the delivery device can move independently from one another by way of the bearing element.

In this and other part, component, assembly, mechanism, function, feature, or operational aspect(s) of the invention, the invention also can be characterized as comprising a "means" for engagement, e.g., a means for selectively releasable engagement, of two or more device part(s) or component(s) or combination thereof. In such a respect, any known equivalents of such named engagement component or constituent(s) thereof, e.g., such named selectively releasable engagement components or mechanisms can also be, e.g., are, incorporated into devices or methods of the invention. As with other sections similarly described herein, any of the part(s), component(s), or assembly(ies) of the invention can be, where suitable, described as means (e.g., the above-described engagement mechanism, e.g., selectively releasable engagement mechanism component can be described as an engagement means, selectively releasable engagement means, or means for providing or facilitating the engagement, e.g., selectively releasable engagement, of two or more delivery device part(s), component(s), or assembly(ies)).

Magnetic materials used in magnet-related embodiments can be of any suitable composition. In aspects, magnetic materials are permanent magnets. In aspects, the magnets are not electromagnets. Materials for permanent magnets are known (e.g., iron, nickel, cobalt, and rare-earth metals, etc.). Exemplary types of magnets include neodymium magnets (NdFeB magnets), ceramic magnets, samarium cobalt magnets, Alnico magnets, and ferrite magnets. Magnetic engagement mechanisms, components, etc. often comprise other ferromagnetic materials. Other types of similar materials can be used in place of magnets that provide similar engagement. E.g., spinel-type high entropy oxides (HEOs) and silicone cling systems have been described as possible replacements or improvements to current state of the art magnet engagement systems/materials.

Engagement Component Support Component (Magnet Cover)

In aspects, an engagement component comprises at least one engagement mechanism and at least one engagement mechanism counterpart. In aspects, an engagement component can further comprise an engagement component support (or positioning) part or component. In aspects, an exemplary engagement component support component, i.e., positioning component or part, can be, e.g., any part or component participating in the support of, or positioning of, an engagement mechanism. In aspects, an exemplary engagement component support can be, e.g., a Magnet Cover.

According to certain aspects, a delivery device provided by the invention can comprise, e.g., a part or component for supporting or maintaining suitable positioning of an engagement component engagement mechanism, e.g., a Magnet, within a delivery device. In some facets, such an engagement component support further provides the ability to connect an engagement mechanism of an engagement component, e.g., a magnet, to at least one other component of the device, e.g., one other component of a first (e.g., first primary) component of a device, e.g., a volatile compound outlet component (e.g., Body Assembly). In other facets, such an engagement component support further provides an ability to connect an engagement component constituent, e.g., an engagement component mechanism, e.g., a magnet, to at least a second other component of a first component, e.g., a first primary component of a device, e.g., a volatile compound outlet component, (e.g., Body Assembly).

In aspects, an engagement component support part or component can be any part or component (or assembly, as applicable) suitable for the stable positioning of an engagement component constituent, e.g., engagement mechanism, e.g., selectively releasable engagement mechanism component, e.g., a Magnet, which is suitable for connecting an engagement mechanism, e.g., magnet (that is, indirectly connecting the engagement mechanism, e.g., magnet by holding the magnet therein and further connecting) to one or more other components of a delivery device; suitable for connecting to one or more further components of the device such as, e.g., a volatile compound compartment (e.g., removable insert housing) component (e.g., Body Tube), or both. In aspects, an engagement component support can be, e.g., a single part or component or a plurality of part(s), component(s), acting together, e.g., in aspects provided as an assembly. In aspects, an engagement component support can be, e.g., a series of two or more ridges within the interior wall(s) of one or more components of a device to maintain an engagement mechanism, e.g., Magnet, in a single position; snap-fit, threaded bar, or other connection mechanism(s) provided separately from such other securing mechanisms such as, e.g., ridges, or any other suitable mechanism for attaining such aims.

In aspects, an engagement component support connects to two or more first device (e.g., first primary) component(s) (e.g., volatile compound outlet component, e.g., Body Assembly) components while, e.g., maintaining the stable positioning of an engagement mechanism, e.g., a selectively releasable engagement mechanism, (e.g., Magnet). In aspects, an engagement component support part or component provides or at a minimum participates in (a) the stable positioning of an engagement component constituent, e.g., an engagement mechanism, e.g., a selectively releasable engagement mechanism component, e.g., a Magnet, (b) a mechanism for attaching the engagement component support (and, e.g., an engagement mechanism, e.g., selectively releasable engagement mechanism, e.g., Magnet, stably held therein) to a first part or component of a device, e.g., to the or to a first part of the volatile compound outlet component (e.g., Mouthpiece), and (c) a mechanism for attaching the engagement component support part/component (and, e.g., an engagement mechanism, e.g., selectively releasable engagement mechanism, e.g., Magnet, stably held therein) to a second device part or component of a device, e.g., to a second part or component of a volatile compound outlet component, such as, e.g., a part or component embodied herein as a body tube. In certain aspects, an engagement component support connects to both a volatile compound delivery (user engaged) component or part of a delivery device, e.g., Mouthpiece (either directly or indirectly via mouthpiece component supplement or attachment insert (Mouthpiece Tube or Mouthpiece Attachment Insert)) and an internal compartment, e.g., internal compartment for maintaining volatile compounds or which stably maintains a removable insert (volatile compound compartment/insert housing, or, e.g., Body Tube).

In certain aspects, an engagement component support is, e.g., a Magnet Cover. In aspects, an engagement component support can comprise one or more of the characteristics of the Magnet Cover described in the figures or detailed description provided herein. In aspects, an engagement component support provides a holder for an engagement mechanism, e.g., a Magnet. In aspects, an engagement mechanism, e.g., a selectively releasable engagement mechanism, e.g., a Magnet, is stably maintained by, and in aspects at least partially maintained within, an engagement component support. In aspects, an engagement component support, e.g., Magnet Cover, detectably or significantly protects an engagement mechanism, e.g., a selectively releasable engagement mechanism, e.g., Magnet, from the exterior environment, e.g., protecting the, e.g., Magnet, from scratching or other damage. In aspects, an engagement mechanism, e.g., Magnet, is attached to the Magnet Cover by, e.g., the application of a glue or epoxy, or, e.g., is held in place by an, e.g., separate element, such as, for example an O-ring to maintain the position of the engagement mechanism, e.g., magnet, without undesirable movement or shifting during manufacturing, use, or both.

In certain aspects, an engagement component support, e.g., Magnet Cover, comprises one or more specific features facilitating the connection of the part/component to one or more other part(s), component(s), or, e.g., assembly(ies) of a device. For example, an engagement component support can comprise, e.g., an extension comprising, e.g., threading to mate with a corresponding feature of a part or component of a device, e.g., an attachment mechanism of a volatile compound delivery facilitation component (user engageable component for the receipt of volatile compound(s) delivered by a delivery device (Mouthpiece). An engagement component support can further comprise, e.g., an extension for suitably mating with, e.g., a component forming an internal compartment, e.g., an internal compartment which stably maintains a removable insert (e.g., volatile compound compartment, insert housing, or, e.g., Body Tube). In aspects, an engagement component support component, e.g., Magnet Cover, comprises both an area for holding or otherwise stably maintaining an engagement component constituent, e.g., engagement component mechanism, e.g., selectively releasable engagement mechanism (e.g., Magnet), as well as two or more features facilitating the attachment to two or more other part(s), component(s), or assembly(ies) of the delivery device, e.g., two or more other components of a first, e.g., a first primary, device component (e.g., volatile compound outlet component, e.g., Body Assembly).

According to certain aspects, an engagement component support, e.g., Magnet Cover, comprises a passageway therethrough to allow for a continuous air passage to flow from a distal, inlet end to a proximal, outlet end of the device upon application of suction to (e.g., inhalation through) the device by the delivery device user. In aspects, a portion of the total airflow channel described herein passes through an engagement component support, such that the engagement component support comprises an airflow channel contributing to the total airflow channel. Therefore, a feature of the engagement component support can in aspects be a generally open space or internal area or portion located at least substantially in the middle of the component. In aspects, such an opening operates as a portion of the full (total) airflow passageway (channel) through a delivery device when the delivery device is in a fully assembled state.

In aspects, an engagement component support, e.g., Magnet Cover, can be made of any one or more of the materials described elsewhere herein. In certain aspects, the engagement component support, e.g., Magnet Cover, is not made of a magnetic or magnetically attractive material. In certain aspects, the engagement component support, e.g., Magnet Cover, is made of a metal or metal alloy, such as, e.g., titanium, platinum, gold, or stainless steel. In certain specific aspects, the engagement component support, e.g., Magnet Cover, is made of stainless steel.

In aspects, the engagement component support, e.g., Magnet Cover, described herein can be custom made for use within the device. In certain aspects, a standard stock component having a non-magnetic make-up and having the appropriate shape and functionality requirements can be utilized.

In this and other part, component, assembly, mechanism, function, feature, or operational aspect(s) of the invention, the invention also can be characterized as comprising a "means" for stably positioning and engagement component constituent, e.g., engagement mechanism, e.g., a selectively releasable engagement mechanism. In such a respect, any known equivalents of such named engagement component support part(s) or component(s) can also be, e.g., they are, incorporated into devices or methods of the invention. As with other sections similarly described herein, any of the part(s), component(s), or assembly(ies) of the invention can be, where suitable, described as means (e.g., the above-described engagement component support can be described as engagement mechanism support means, engagement mechanism positioning means, or means for supporting or providing or facilitating the stable positioning of an engagement component constituent such as an engagement mechanism, e.g., selectively releasable engagement mechanism).

Volatile Compound Compartment Component (Body Tube)

In aspects, a delivery device provided by the invention comprises a component for housing or otherwise storing/maintaining volatile compound(s) (or an associated composition (a VCC)) until the VCs are delivered to the user or otherwise released from the device. In aspects, a delivery device provided herein comprises a component for holding, housing or otherwise stably maintaining a means for maintaining, releasing, or maintaining and releasing one or more volatile compounds, such as, e.g., a solid material device capable of maintaining, releasing, or maintaining and releasing one or more volatile compound(s) (i.e., insert or removable insert). In aspects, delivery device(s) provided herein comprise a volatile compound compartment, e.g., a component for housing an insert/removable insert. In aspects, as such a component, e.g., such a compartment, operates to store a volatile compound composition, it may be referred to as a volatile compound composition storage component. A solid material device capable of maintaining, releasing, or maintaining and releasing one or more volatile compound(s) is sometimes herein simply referred to as an insert or a removable insert. Uncontradicted, when any such identifiers are used, e.g., "solid material device," "insert," or "removable insert," the reader should interpret the disclosure as encompassing a device/component capable of maintaining, releasing, or maintaining and releasing or having maintained, released, or having both maintained and released volatile compound(s) which may not be removable from a delivery device in some, most, generally all, substantially all, essentially all, or all circumstances.

In certain facets, a volatile compound compartment, often referred to herein as a volatile compound housing, VCSC, or volatiles housing, e.g., typically provided as an insert housing, (e.g., a removable insert housing component) is provided alone, e.g., as an independent part of component of a delivery device. In aspects, a volatile compound housing, e.g., insert housing, is a constituent of a volatile compound outlet component, e.g., mouthpiece.

In aspects, a volatile compound housing, e.g., insert housing, and a volatile compound outlet component, e.g., mouthpiece, together comprise most, generally all, substantially all, or all (e.g., are the only) part(s) or component(s) of a delivery device. In aspects, a volatile compound housing, e.g., insert housing, and a volatile compound outlet component, e.g., mouthpiece, together provide most, generally all, substantially all, or all of the functionality of a delivery device. Such components also may account for most, generally all, substantially all, or all of the mass of a device (except for the VCC/insert).

In aspects, a volatile compound compartment (or volatiles housing/volatile compound housing), e.g., insert housing, is a component of a first device component (i.e., a primary device component), e.g., volatile compound outlet component, wherein the first device component may, in aspects, be designed to cooperate, engage, or mate with a second device component (e.g., a second primary component or other mating component).

In certain alternative facets, a volatile compound housing, e.g., removable insert housing, is a constituent of a first device component (i.e., a primary device component, e.g., a volatile compound outlet component) and is provided as a constituent of an assembly, wherein the assembly comprises one or more part(s), component(s), sub-assembly(ies), or combination(s) thereof which provide one or more additional feature(s) or function(s) of a delivery device.

In some respects, a volatile compound housing, e.g., removable insert housing, is a constituent of a volatile compound outlet component extension, described elsewhere herein.

According to embodiments, a volatile compound compartment (volatiles housing/volatile compound housing), e.g., an insert, e.g., removable insert housing is a part or component capable of at least partially maintaining, or, e.g., at least contributing to the stable maintenance of, an insert, e.g., a removable insert, positioned therein. That is, in aspects, a volatile compound housing, e.g., an insert housing is designed to at least partially stably maintain, or stably maintain, a removable insert within ta delivery device. In aspects, a volatile compound compartment (volatile compound housing/volatiles housing) can be any component capable of stably maintaining, releasing, maintaining and releasing, volatile compounds positioned therein, e.g., composition(s) of volatile compound(s) positioned therein (e.g., oil(s) comprising such compound(s)) or, e.g., solid material device(s) comprising volatile compound(s) (e.g., removable insert(s)) therein.

In aspects, a volatile compound compartment (volatile compound housing/volatiles housing) is an insert housing present in a delivery device capable of participating in maintaining, e.g., a removable insert in a suitable position for delivery device operation.

In aspects, a volatile compound compartment (or volatile compound housing/volatiles housing) is an insert housing present in a delivery device capable of participating in maintaining, e.g., a removable insert in a suitable position for delivery device operation when such a device has re-engageable parts, such as, e.g., when first and second device components, e.g., first and second primary device components (e.g., volatile compound outlet component and mating component), are at least partially separated from (disengaged from) one another, or, also or alternatively when first and second device components (e.g., first and second primary device components, e.g., volatile compound outlet component and mating component) are selectively bound together by an engagement component, e.g., selectively releasable attachment mechanism.

In aspects, a volatile compound compartment (volatile compound housing/volatiles housing) is an insert housing present in a delivery device capable of participating in DOS maintaining e.g., a removable insert in a suitable and set position within a delivery device, even when the delivery device is jostled, shook, turned, manipulated, or otherwise moved, during normal use or operation.

In aspects, a volatile compound compartment (or volatile compound housing/volatiles housing) or, e.g., an insert housing, can be, e.g., a clamp capable of releasably attaching to at least a portion of an insert or removable insert, a hollowed compartment capable of suitably securing at least a portion of an insert, e.g., removable insert, within it (e.g., by positioning an end of an insert or removable insert within it), ridges, spikes, partial walls, tubes, partial tubes, part(s) component(s) designed to apply pressure or compression/compressive force to an insert, straps, clips, a container, e.g., a sealable container, or other such element(s), feature(s), or mechanism(s) capable of preventing significant movement of or, e.g., preventing the expulsion of a composition comprising volatile compound(s) or solid material device comprising volatile compound(s), e.g., an insert, upon its insertion into or addition to a delivery device.

In aspects, a volatile compound compartment (volatile compound housing/volatiles housing), e.g., removable insert housing, can be any other element(s) or mechanism(s) capable of maintaining positioning of, e.g., a removable insert such that it can suitably release one or more volatile compounds to a user of a delivery device when provided therein, without detectably or significantly interfering with, e.g., blocking or otherwise disturbing or causing a redirection of, an air passageway through the delivery device (e.g., the total airflow channel of a delivery device). In aspects, a volatile compound compartment (volatile compound housing/volatiles housing), e.g., removable insert housing, comprises an airflow channel, wherein the airflow channel of the volatile compound housing, e.g., removable insert housing, represents a portion of the total airflow channel through the device.

In certain aspects, a volatile compound compartment (volatile compound housing/volatiles housing), e.g., an insert housing or removable insert housing component, is characterizable as an insert an internal compartment. In aspects, a volatile compound compartment (volatile compound housing/volatiles housing) designed to maintain an insertable device for maintaining, releasing, or maintaining and releasing volatile compound(s) which, in aspects, is disposable (an insert), is characterizable as an insert compartment.

In certain aspects, a volatile compound compartment (volatile compound housing/volatiles housing, e.g., insert housing, e.g., insert compartment, is an internal compartment embodied as a Body Tube. In aspects, a volatile compound compartment, e.g., insert compartment component can comprise one or more of the characteristics of the Body Tube described in the detailed description provided herein, described in the description of figures provided herein or which is visible in figures provided herewith.

In certain aspects, a volatile compound compartment (volatiles housing), e.g., insert compartment, provide herein, e.g., body tube, comprises at least one dimension which is at least half as long as the longest dimension of a removable insert, such as, e.g., a dimension which is at least about 50%, ~55%, ~60%, ~65%, ~70%, ~75%, ~80%, ~85%, ~90%, ~95%, or, e.g., is at least as long as, the longest dimension of a removable insert. For example, a volatile compound compartment (volatiles housing), e.g., insert compartment, can comprise at least one dimension having a length which is between about 50% and 200%, ~60%-~200%, ~70%-~200%, ~80%-~200%, or ~90%-~200% as long as the longest dimension of the removable insert, such as, e.g., ~50% as long as, ~60%, ~70%, ~80%, ~90%, ~100%, ~110%, ~120%, ~130%, ~140%, ~150%, ~160%, ~170%, ~180%, ~190%, or, e.g., ~200% as long as the longest dimension of a removable insert. In aspects, a volatile compound compartment (volatiles housing), e.g., insert compartment, e.g., Body Tube, is detectably or significantly longer than the longest dimension of a removable insert. In aspects, a volatile compound compartment (volatiles housing), e.g., insert compartment, e.g., Body Tube, is at least as long as or longer than the longest dimension of a removable insert.

In certain aspects, a volatile compound compartment (volatiles housing), e.g., insert compartment, e.g., Body Tube, comprises at least one dimension, e.g., width, which detectably or significantly wider than a removable insert such that the removable insert can be positioned within such a dimension, e.g., width; that is, in aspects, the width of a removable insert housing component, e.g., insert compartment, e.g., Body Tube, is detectably or significantly wider than the width of an insert. In aspects, a volatile compound compartment (volatiles housing), e.g., insert compartment, e.g., Body Tube, is detectably or significantly wider than the widest dimension of the removable insert. In aspects, a volatile compound compartment (volatiles housing), e.g., insert compartment, e.g., internal compartment, e.g., Body Tube, is at least as wide as or wider than the widest dimension of a removable insert.

According to aspects, some, most, generally all, substantially all, or all of an insert's, e.g., removable insert's length, some most, generally all, substantially all, or all of an insert's, e.g., removable insert's width, or some, most, generally all, substantially all, or all of both an insert's, e.g., removable insert's length and width, such as all dimensions of an insert/removable insert, fall within the dimensions (e.g., one or more dimension(s) defining a volatile compound compartment (volatiles housing), e.g., insert compartment, e.g., Body Tube. In aspects, all dimensions of an insert/removable insert fall within the dimensions defining a volatile compound compartment (volatiles housing), e.g., insert compartment, e.g., Body Tube even if such a housing component, or compartment or Body Tube does not fully encompass or fully enclose an insert in an least one direction, such as, e.g., even when at least a portion of a removable insert is exposed when positioned within the general boundaries (e.g., existing structure where present) of a volatile compound compartment (volatiles housing), e.g., insert compartment, e.g., Body Tube (such as, e.g., is described elsewhere herein).

As provided elsewhere herein, in aspects, a volatile compound compartment (volatiles(s) housing), e.g., insert compartment, is a part or component not provided as an assembly and which can, in aspects, be present independent of any other component described as a constituent of a volatile compound outlet extension.

According to certain embodiments, a volatile compound compartment (volatiles housing), e.g., insert compartment, e.g., Body Tube, is a component of a first device component, i.e., a device first primary component designed to mate with a second device component, i.e., second primary device component, also referred to herein as a component comprising a barrel or, e.g., a mating component. According to certain embodiments, a volatile compound compartment (volatiles housing), e.g., insert compartment, e.g., Body Tube, is a component of a first device component, i.e., device first primary component, such that when the first primary component is separated from the second device component of the delivery device, a volatile compound compartment (volatiles housing), e.g., insert compartment, e.g., Body Tube, is separated from the second primary component. According to certain embodiments, as is described elsewhere herein, when a delivery device is in a ready-to-use state, a volatile compound compartment (volatiles housing), e.g., insert compartment, Body Tube, is positioned at least partially inside of, at least generally inside of, at least mostly inside of, at least substantially inside of, at least essentially inside of, essentially inside of, or completely inside of, a second device component (e.g., mating component), however is not physically attached to the second device component.

In aspects, a volatile compound compartment (e.g., a volatiles housing), e.g., an insert compartment, e.g., a Body Tube, is attached to, directly or indirectly, to a first device component, e.g., a first primary component of the device, e.g., volatile compound outlet component, but resides at least substantially within the second device component, e.g., a second primary component of the device, e.g., mating component when, e.g., a volatile compound outlet component and a mating component are bound to one another by a connection component, e.g., by a releasable attachment mechanism. In one aspect, at least about 60%, such as, e.g., at least ~70%, ~80%, ~90%, or ~100%, such as, e.g., ~60%-~100%, ~70%-~100%, ~80%-~90%, or, e.g., ~90%-~100% or 100% of a volatile compound compartment (volatiles housing), e.g., insert compartment, e.g., Body Tube, resides within another component of a device, e.g., a second primary device component (e.g., mating component) when a first primary device component, e.g., volatile compound outlet component and a second primary device component, e.g., mating component, are bound to one another by a connection component, e.g., releasable attachment mechanism.

In aspects, a volatile compound compartment (volatiles housing), e.g., insert compartment, e.g., Body Tube, has a width, a depth, in aspects, a diameter when comprising a circular shape, a length, a first end, a second end, and a central area between the first and second ends. In aspects, such a central area can be referred to an insert compartment central area, however such an area should be understood to be present in, e.g., a volatile compound compartment (volatiles housing), e.g., insert compartment, e.g., Body Tube. In aspects, the length is the longest dimension of a volatile compound compartment (volatiles housing), e.g., insert compartment, e.g., Body Tube. In facets, a volatile compound compartment (volatiles housing), e.g., insert compartment, e.g., Body Tube, comprises an interior defined by a wall. In facets, a volatile compound compartment (volatiles housing), e.g., insert compartment, comprises an interior defined by an at least partially circumferentially disposed wall between the first end and a second end of a volatile compound compartment (volatiles housing), e.g., insert compartment, e.g., Body Tube.

In aspects, an at least partially circumferentially disposed wall is at least partially opened along at least one portion of the length between the first and second ends of the a volatile compound compartment (volatiles housing), e.g., insert compartment, e.g., Body Tube, and fully surrounds in at least one direction, e.g., fully circumferentially encloses, a volatile compound compartment (volatiles housing), e.g., insert compartment, e.g., Body Tube along at least one portion of the length between the first and second ends of a volatile compound compartment (volatiles housing), e.g., insert compartment, e.g., Body Tube. According to certain aspects, the circumferentially disposed wall defining a volatile compound compartment (volatiles housing), e.g., insert compartment, e.g., Body Tube, interior at least partially surrounds in at least one direction (e.g., encircles when such a space is circular in at least one direction) an insert, e.g., a removable insert when present therein along at least one portion of the insert but does not surround the entirety of the removable insert.

In aspects, the portion of a volatile compound compartment (volatiles housing), e.g., insert compartment, e.g., Body Tube, which only partially circumferentially encloses an insert, e.g., a removable insert when positioned therein encloses, greater than about 10%, >~15%, >~20%, >~25%, >~30%, >~35%, >~40%, or >~45% of the perimeter, e.g., circumference as applicable, of the insert.

In certain aspects, the portion of a volatile compound compartment (volatiles housing), e.g., insert compartment, e.g., Body Tube, which only partially circumferentially encloses an insert when positioned therein encloses, less than about 50%, <~45%, <~40%, <~35%, <~30%, <~25%, <~20%, or >~15% of the perimeter, e.g., circumference of the removable insert.

In aspects where a volatile compound compartment (volatiles housing), e.g., insert compartment, e.g., Body Tube is not cylindrical, or, e.g., in aspects where such a removable insert is not cylindrical, such enclosure may be more appropriately simply referred to as enclosure (vs. "circumferentially" enclosed) as would be understood by the reader. Herein, any description of "circumferentially disposed" with regard to the wall of a volatile compound compartment (volatiles housing), e.g., insert compartment, e.g., Body Tube, should be interpreted as a wall forming an interior space, regardless of whether the space defined by such a "circumferentially disposed" wall has a circular dimension. For example, "an at least partially circumferentially disposed wall" should be interpreted as any type of wall (having, e.g., rounded or, e.g., squared or angled side(s)), which at least partially encloses an interior space. A "fully circumferentially disposed wall" should be interpreted as any type of wall (having, e.g., rounded or, e.g., squared or angled side(s)) which fully encloses an interior space in at least one direction. Herein, any reference to "circumference" of an insert, e.g., a removable insert or other solid material device for maintaining, releasing, or maintaining and releasing volatile compound(s) should be interpreted as "perimeter" in embodiments wherein such an insert/solid material device does not comprise a circular characteristic.

In aspects where a volatile compound compartment (volatiles housing), e.g., insert compartment, e.g., Body Tube, the insert (e.g., removable insert, also referred to herein as an insert device or removable device), or both, are not cylindrical, the portion of the a volatile compound compartment (volatiles housing), e.g., insert compartment, e.g., Body Tube, which only partially encloses an insert when positioned therein can enclose between, e.g., about 10%-about 75% of the perimeter of the insert, such as, e.g., ~10%-~70%, ~10%-~65%, ~10%-~60%, ~10%-~55%, or, e.g., ~10%-~50%, such as, e.g., ~20%-~75%, ~25%-~75%, ~30%-~75%, ~35%-~75%, ~40%-~75%, ~45%-~75%, or, e.g., ~50%-~75% of the perimeter of the removable device. In aspects, the portion of a volatile compound compartment (volatiles housing), e.g., insert compartment, e.g., Body Tube, which does not fully enclose (in at least one direction) or circumferentially surround the interior of the same has a detectable or significant gap (or opening) in its perimeter or circumference which is at least detectably wider than that of the removable device (insert) such that the removable device (insert) can be suitably inserted therethrough.

Stated differently, in aspects, when an insert, e.g., removable insert, is present in the partially enclosed volatile compound compartment (volatiles housing), e.g., insert compartment, e.g., Body Tube, at least a portion of the insert is completely surrounded by (or, e.g., encircled by), in at least one direction, a wall, e.g., a circumferentially disposed wall, of the volatile compound compartment (volatiles housing), e.g., insert compartment, e.g., Body Tube and at least a portion of the insert is only partially surrounded by the wall of the volatile compound compartment (volatiles housing), e.g., insert compartment, e.g., Body Tube.

According to certain aspects, when an insert is present within a volatile compound compartment (volatiles housing), e.g., insert compartment, e.g., Body Tube, a fully circumferentially disposed wall surrounds at least about 0.5% of the length of the insert, such as at least about 1%, ≥~1.5%, ≥~2%, ≥~2.5%, ≥~3%, ≥~3.5%, ≥~4%, ≥~4.5%, or, e.g., ≥~5%, of the length of the insert. In aspects, when an insert, e.g., removable insert, is present within a volatile compound compartment (volatiles housing), e.g., insert compartment, e.g., Body Tube, a fully circumferentially disposed wall surrounds no more than about 10% of the length of the insert, such as, e.g., ≤~9%, ≤~8%, ≤~7%, ≤~6%, ≤~5%, ≤~4%, ≤~3%, ≤~2%, or ≤~1% of the length of the insert. In certain embodiments, when an insert is present within the volatile compound compartment (volatiles housing), e.g., insert compartment, e.g., Body Tube, a fully circumferentially disposed wall surrounds between about 0.5% and about 5% of the length of the insert, such as, e.g., ~1%-~5%, ~1.5%-~5%, ~2%-~5, ~2.5%-~5, or ~3%-~5%, e.g., ~0.5%-~4.5%, ~0.5%-~4%, ~0.5%-~3.5%, or ~0.5%-~3%, as in, for example, between about 1% and about 5% or ~1.5%-~4.5%, ~2%-~4%, ~2.5%-~3.5%, or, e.g., ~3% of the length of the insert.

In certain embodiments, when an insert is present within a volatile compound compartment (volatiles housing), e.g., insert compartment, e.g., Body Tube, a fully circumferentially disposed wall surrounds between about 0.5 mm and about 3 mm of the length of the removable insert, such as, e.g., ~0.5 mm-~2.5 mm, ~0.5 mm-~2 mm, ~0.5 mm-~1.5 mm, or, e.g., ~0.5 mm-~1 mm, or ~1 mm-~3 mm, such as, e.g., about 1 mm of the length of the insert.

In aspects, features of a volatile compound compartment (volatiles housing), e.g., insert compartment, e.g., Body Tube, having the characteristic of comprising at least one opening in a wall allowing for access to the interior of the insert housing component (such that, e.g., when a solid material device capable of maintaining, releasing, or maintaining and releasing one or more of volatile compound(s) (insert) is housed within the part or component, at least one portion of the insert is not completely surrounded or encircled by the removable insert housing component), detectably or significantly increases ease of insertion of a volatile compound-comprising device (insert). In aspects, such feature(s) detectably or significantly increase ease of removal of a volatile compound-comprising device (insert). In aspects, such feature(s) improve upon or facilitate airflow through the device such that a suitable amount, concentration, or number of volatile compound(s) are provided to the user upon application of a suitable amount of suction (e.g., upon inhalation). In aspects, such feature(s) detectably or significantly improve upon the user experience of the delivery device. For example, in aspects, a user may be able to insert or remove a volatile compound-comprising device (insert) while minimizing contact with the carrier(s) of the volatile compound(s), e.g., oil(s), present in the volatile compound-comprising device.

In aspects, a volatile compound compartment (volatiles housing), e.g., insert compartment, e.g., Body Tube, is designed to receive an insert, e.g., a removable insert, from a position lateral to its long access; e.g., from a position along its length, via an opening in the wall, e.g., circumferentially disposed wall, defining the length of the volatile compound compartment (volatiles housing), e.g., insert compartment, e.g., Body Tube. Such insertion can be, e.g., through the partial opening in the circumferentially disposed wall of the, e.g., volatile compound compartment (volatiles housing), e.g., insert compartment, e.g., Body Tube. In facets, a delivery device, or, e.g., a first component (e.g., first primary component) of a delivery device (such as, for example, a volatile compound outlet component), or, e.g., a volatile compound compartment (volatiles housing), e.g., insert compartment, e.g., Body Tube, can in aspects be capable of receiving or be designed to receive the insertion of an insert (e.g., removable insert) from a direction which is lateral to the long axis of the device, e.g., from a direction which does not correspond to, is not parallel to, or does not correspond to the long axis of the device. In aspects, a delivery device, or, e.g., a first component (e.g., a first primary component) of a delivery device (such as, for example, a volatile compound outlet component), or, e.g., a volatile compound compartment (volatiles housing), e.g., insert compartment, e.g., Body Tube, can in aspects be capable of receiving or be designed to receive the insertion of an insert (e.g., removable insert) from a position along the length via an opening in a wall. In aspects, an insert, e.g., removable insert, can be inserted into a delivery device from a position lateral to the delivery device as opposed to from a position at one or more end(s) of the long axis of the delivery device.

In aspects, an insert (e.g., removable insert) can be laterally inserted into a volatile compound compartment (volatiles housing), e.g., insert compartment, e.g., Body Tube, such that at least a portion of the insert is circumferentially encompassed by a completely circumferentially disposed wall of the volatile compound compartment (volatiles housing), e.g., insert compartment, e.g., Body Tube, In aspects the insert is inserted at an angle which is between about 5 degrees and about 20 degrees, such as, e.g., ~6 degrees-~20 degrees, ~7 degrees-~20 degrees, ~8 degrees-~20 degrees, ~9 degrees-~20 degrees, or, e.g., ~10 degrees-~20 degrees, e.g., ~5 degrees-~19 degrees, ~5 degrees-~18 degrees, ~5 degrees-~17 degrees, ~5 degrees-~16 degrees, ~5 degrees-~15 degrees, ~5 degrees-~14 degrees, ~5 degrees-~13 degrees, ~5 degrees-~12 degrees, or ~5 degrees-~11 degrees, as in, for example, ~6 degrees-~18 degrees, ~7 degrees-~16 degrees, ~8 degrees-~14 degrees, ~8 degrees-~12 degrees, or, e.g., about 10 degrees to about 11 degrees relative to the long axis of the delivery device. In aspects, once fully inserted, an insert is positioned such that its long axis is at least generally, at least substantially, at least essentially, essentially, or is aligned with, parallel to, or coaxial with the long axis of the delivery device.

In one specific aspect, volatile compound compartment (volatiles housing), e.g., insert compartment, e.g., Body Tube, is a component of a first component, e.g., a first primary component, of a delivery device and when the first component of the device and a second component, e.g., second primary component, of the delivery device are sufficiently separated from one another, an insert capable of holding, releasing, or holding and releasing one or more volatile compounds can be laterally inserted into and, in aspects, at least partially supported or stably held by, the exposed volatile compound compartment (volatiles housing), e.g., insert compartment, e.g., Body Tube,).

In aspects, the volatile compound compartment (volatiles housing), e.g., insert compartment, e.g., Body Tube, is suitably shaped so as to detectably or significantly reduce friction, e.g., scraping, of/between the component with one or more other part(s) or component(s) of the delivery device, wherein such friction or, e.g., scraping, could cause e.g., premature wear and tear, unsafe or otherwise undesirable flaking, shredding, or slivering, or other detectable modification of one or more other components of the device, e.g., the mating component or a part or sub-component thereof (such as, e.g., an outer shell (e.g., Barrel), an outer shell protection mechanism (e.g., Barrel Tube), engagement component engagement mechanism counterpart (e.g., Barrel Collar), etc. In aspects, a smooth, rounded surface of the volatile compound compartment (volatiles housing), e.g., insert compartment, e.g., Body Tube, detectably or significantly reduces premature or undesirable damage to one or more device part(s) or component(s) by detectably or significantly reducing friction between the volatile compound compartment (volatiles housing), e.g., insert compartment, e.g., Body Tube, and one or more other device component(s) with which the volatile compound compartment (volatiles housing), e.g., insert compartment, e.g., Body Tube, cooperates.

According to certain aspects, volatile compound compartment (volatiles housing), e.g., insert compartment, e.g., Body Tube, is not visible from the exterior of the delivery device when the delivery device is in a configuration ready for use. In certain aspects, the orientation of a volatile compound compartment (volatiles housing), e.g., insert compartment, e.g., Body Tube, may be advantageous to know, such that, e.g., a user can selectively orient the delivery device such that the opening in the wall (e.g., circumferentially disposed wall) of the volatile compound compartment (volatiles housing), e.g., insert compartment, e.g., Body Tube, faces upward prior to exposing the volatile compound compartment (volatiles housing), e.g., insert compartment, e.g., Body Tube, by, e.g., selectively disengaging it or any part or component to which it is connected (e.g., by selectively disengaging a first primary component (volatile compound outlet component comprising the volatile compound compartment (volatiles housing), e.g., insert compartment, e.g., Body Tube) from a second primary component (e.g., mating component), or, e.g., any part or component which may hide the volatile compound compartment (volatiles housing), e.g., insert compartment, e.g., Body Tube, from being externally visible. This can, in aspects, further ensure that, for example, an insert within the volatile compound compartment (volatiles housing), e.g., insert compartment, e.g., Body Tube, does not inadvertently fall out upon the selective disengagement of delivery device components. In aspects, the spatial orientation of the volatile compound compartment (volatiles housing), e.g., insert compartment, e.g., Body Tube, is discernable by at least one indicator (indicator(s) being described elsewhere herein), e.g., the spatial orientation or positioning of at least one visual indicator present on an external surface of the delivery device. In aspects, an indicator can be any visual or tactilely discernable indicator described herein. In aspects, the at least one indicator is present on, e.g., a part or component of a delivery device fixedly attached to (e.g., not intentionally dis-engageable from), either directly or indirectly, the volatile compound compartment (volatiles housing), e.g., insert compartment, e.g., Body Tube. In certain aspects, such an indicator can be, e.g., present on an engagement component support component (e.g., Magnet Cover). In one aspect, such an indicator can be, e.g., a visible or tactilely discernable line or scratch, such as, e.g., is described elsewhere herein. Therefore, in one aspect, a delivery device can comprise a volatile compound compartment (volatiles housing), e.g., insert compartment, e.g., Body Tube, which is not externally visible when the delivery device is in a ready-to-use state, but its orientation e.g., the orientation of an opening therein, is discernable by the orientation of the at least one indicator located on an outside (external) surface of the delivery device.

According to certain embodiments, the interior of a volatile compound compartment (volatiles housing), e.g., insert compartment, e.g., Body Tube, comprises, e.g., at least a portion of at least 1, e.g., at least 2, additional parts or components. In aspects, the interior of a volatile compound compartment (volatiles housing), e.g., insert compartment, e.g., Body Tube, comprises at least a portion of, e.g., an insert support (positioner) component, e.g., a stabilizer, e.g., a compressible positioner, e.g., spring, e.g., an Insert spring. In aspects, the interior of a volatile compound compartment (volatiles housing), e.g., insert compartment, e.g., Body Tube, comprises at least a portion of, an insert support (positioner) component, e.g., a stabilizer, e.g., a fixed positioner. In aspects, one or more insert support(s) (positioner(s)) can be features of a part or component providing one or more addition function(s) (such as, for example, a fixed positioner can be a feature of, e.g., can represent a portion of, an airflow control part or component such as an airflow limiter. In aspects, two insert supports (positioners), e.g., stabilizers, positioned on opposing ends of the interior of a volatile compound compartment (volatiles housing), e.g., insert compartment, e.g., Body Tube. For example, e.g., a fixed positioner can be positioned opposite a compressible positioner or element (Insert spring) within a volatile compound compartment (volatiles housing), e.g., insert compartment, e.g., Body Tube. In aspects, such two components cooperate to stably maintain an insert within the volatile compound compartment (volatiles housing), e.g., insert compartment, e.g., Body Tube. In aspects, a volatile compound compartment (volatiles housing), e.g., insert compartment, e.g., Body Tube, is designed to maintain an insert between a plurality of insert supports (positioners), such as, e.g., including a compressible positioner and a fixed positioner. In aspects, a fixed positioner is capable of resisting, e.g., is designed to resist, or resists or impedes the movement of an insert when a compressible positioner applies a force to the end of the insert opposite the fixed positioner.

In certain facets, a volatile compound compartment (volatiles housing), e.g., insert compartment, e.g., Body Tube, comprises one or more part(s) or component(s), such as e.g., one or more insert support(s), within it or, e.g., comprise one or more features within wall(s) that define an interior space therein which detectably or significantly reduce the cross sectional area of an airflow channel passing through the volatile compound compartment (volatiles housing), e.g., insert compartment, e.g., Body Tube, at least one location. In aspects, any such part, component, or feature is characterizable as an airflow limiter, with specific embodiments of airflow limiter(s) described elsewhere herein. For example, an insert support, e.g., a compressible insert support, e.g., an insert spring, can be positioned within a volatile compound compartment (volatiles housing), e.g., insert compartment, e.g., Body Tube. In aspects, the insert support can detectably or significantly reduce the cross-sectional area of the airflow channel passing through the volatile compound compartment (volatiles housing), e.g., insert compartment, e.g., Body Tube, at the location of the insert support. While the insert support functions as a positioner of an insert, it may also be characterized as, e.g., an airflow limiter. Accordingly, in aspects, the total airflow channel can have one or more locations across its length wherein the cross-sectional area of the total airflow channel is reduced compared to one or more other locations across its length. As one example, in aspects, a total airflow channel can have an area of reduced cross-sectional area located toward the outlet end of a volatile compound compartment (volatiles housing), e.g., insert compartment, e.g., Body Tube, also describable as being located toward the inlet end of a volatile compound outlet component (e.g., mouthpiece).

In certain aspects, as a volatile compound compartment (volatiles housing), e.g., insert compartment, e.g., Body Tube detectably or significantly participates in the positioning, stabilization, or both, of an insert positioned therein, detectably or significantly facilitating the placement of an insert. Therefore, in aspects, a volatile compound compartment (volatiles housing), e.g., insert compartment, e.g., Body Tube can also be characterized as an insert support (positioner), e.g., a stabilizer, or both.

With regard to the characteristics of the interior of a volatile compound compartment (volatiles housing), e.g., insert compartment, e.g., Body Tube, the positioning of an insert support (positioner), e.g., a stabilizer, e.g., a fixed positioner aids in defining characteristic(s) of the interior of the volatile compound compartment (volatiles housing), e.g., insert compartment, e.g., Body Tube when an insert is present therein. In aspects, the positioning of a fixed positioner within the internal space of a volatile compound compartment (volatiles housing), e.g., insert compartment, e.g., Body Tube provides for the positioning of an insert having a first end and a second end, when present within the compartment, to be positioned such that at least one of the first and second ends of the insert is accessible via a portion of the internal compartment which is not fully enclosed by the wall, e.g., circumferentially disposed wall defining the interior of the volatile compound compartment (volatiles housing), e.g., insert compartment, e.g., Body Tube. This creates a gap or space which, e.g., allows for a user to insert their finger at least partially into the interior of the removable insert housing component at the end of a removable insert present therein to then remove the removable insert therefrom.

In aspects, a volatile compound compartment (volatiles housing), e.g., insert compartment, e.g., Body Tube can be made of any material described herein. In aspects, a suitable material is a material which does not detectably or significantly absorb any of the one or more compounds present therein, e.g., one or more compound(s) present in composition(s) maintained therein. In aspects, a suitable material is a material which does not detectably or significantly absorb any one or more compounds released by an insert positioned therein. In aspects, a suitable material is a plastic or a metal or metal alloy, such as, e.g., titanium, platinum, gold, or, e.g., stainless steel. In aspects, a suitable material is a material which does not detectably or significantly absorb any one or more compounds and is mostly, generally, essentially entirely, or entirely composed of stainless steel.

According to aspects, a volatile compound compartment (volatiles housing), e.g., insert compartment, e.g., Body Tube, can be a custom fabricated component, e.g., made by machining, casting, or other suitable manufacturing process.

In this and other part, component, assembly, mechanism, function, feature, or operational aspect(s) of the invention, the invention also can be characterized as comprising a "means" for stably maintaining, holding, or otherwise housing a volatile compound(s) or composition(s) thereof, e.g., an insert, e.g., removable insert present to maintain, release, or maintain and release one or more volatile compounds. In such a respect, any known equivalents of such named housing mechanisms can also be, e.g., are, incorporated into devices or methods of the invention. As with other sections similarly described herein, any of the part(s), component(s), or assembly(ies) of the invention can be, where suitable, described as means (e.g., the above-described volatile compound compartment (volatiles housing), e.g., insert compartment, e.g., Body Tube, can be described as compartment means, housing means, or means for holding or housing volatile compound(s), composition(s) comprising volatile compound(s), or solid material device(s) comprising such compound(s).

Compressible Positioner (Insert Spring) and Other Insert Supports

According to one aspect of the invention, delivery device (s) provided by the invention can comprise one or more part(s) or component(s) which participate(s) in the stable maintenance of a means of maintaining, delivering, or maintaining and delivering one or more volatile compounds, e.g., an insert or removable insert, within the delivery device. Such an element can be described as an insert support, insert positioner, etc. In aspects, an insert positioner can be, e.g., a compressible insert positioner, such as, e.g., an insert spring.

In specific aspects, the delivery device can comprise one or more part(s) or component(s) which participate(s) in the stable maintenance of an insert within a volatile compound compartment (volatiles housing), e.g., insert compartment, e.g., Body Tube. This may be described as a support component or support mechanism.

In aspects, two or more such part(s) or component(s), herein referred to as insert support(s) (positioner(s)) cooperate to achieve the stable maintenance of an insert.

In aspects, one such component participating in the stable maintenance of an insert is, e.g., a stabilizer, aiding in maintaining the position of an insert within two or more directions. In aspects, the insert support (positioner) is a compressible support. In aspects, the compressible support cooperates with one or more other insert support(s) (positioner(s)), e.g., a fixed positioner, to stably maintain an insert in a suitable position within a delivery device.

In certain aspects, a compressible positioner can be any element capable of comprising and applying a restoring force when a compression element of a compressible positioner is compressed. In aspects, a compressible positioner is capable of being both compressed by a force and applying an opposing force to such compression. In aspects, such a compressible positioner can be any part, component, or mechanism capable of applying such a restoring force upon being compressed, such as, e.g., a spring, a flexed element such as a tab, or an element made of a compressive material such as, e.g., a rubber, a foam, etc. In certain aspects, the compressible positioner is a spring-like element, e.g., a spring or, e.g., a component comprising a compressible tab. In aspects, the compressible positioner is a spring-like element embodied an insert spring. In aspects, the compressible positioner can comprise one or more of the characteristics of an insert spring described in the figures or the detailed description of figures provided herein.

In aspects, a fixed positioner is positioned in a location opposite that of the compressible positioner such that the fixed positioner is capable of resisting or resists the movement of any object to which the restoring force of the compressible positioner is applied, e.g., resisting the movement of an insert when the compressible positioner applies a force to an end of the insert opposite the fixed positioner.

According to a specific embodiment, a compressible positioner participates in the stable maintenance of a means for maintaining, delivering, or maintaining and delivering one or more volatile compounds, e.g., an insert by the application of a first force, e.g., a restoring force, to a first end of the insert. In aspects, the insert has previously compressed the compressible positioner. In aspects, stable maintenance of the volatile compound delivery means, e.g., insert is achieved by the further application of a second force, or at a minimum a resistance, to a second end of the volatile compound delivery means, e.g., insert by a fixed positioner preventing movement of the insert in the direction of the applied restoring force applied by the compressible positioner.

In certain aspects, a compressible positioner applies a force which is between an about 0.1 pound force (lbf) and an about 1.5 pound force (lbf), such as, e.g., a force which is ~0.2 lbf-~1.5 lbf, ~0.3 lbf-~1.5 lbf, ~0.4 lbf-~1.5 lbf, ~0.5 lbf-~1.5 lbf, ~0.6 lbf-~1.5 lbf, ~0.7 lbf-~1.5 lbf, or ~0.8 lbf-~1.5 lbf, such as, e.g., ~0.1 lbf-~1.4 lbf, ~0.1 lbf-~1.3 lbf, ~0.1 lbf-~1.2 lbf, ~0.1 lbf-~1.1 lbf, ~0.1 lbf-~1 lbf, ~0.1 lbf-~0.9 lbf, or, e.g., ~0.1 lbf-~0.8 lbf, as in, for example, ~0.2 lbf-~1.4 lbf, ~0.3 lbf-~1.3 lbf, ~0.4 lbf-~1.2 lbf, ~0.5 lbf-~1.1 lbf, ~0.6 lbf-~0.9 lbf, or ~0.7 lbf-~0.9 lbf, such as, e.g., a force which is an about 0.8 lbf.

In certain aspects, a compressible positioner applies a force which is a force of between about a 50 gram-force (gf) to about 500 gram-force (gf), such as, e.g., ~50 gf-~450 gf, ~50 gf-~400 gf, or ~50 gf-~350 gf, as in, e.g., ~100 gf-~500 gf, ~150 gf-~500 gf, ~200 gf-~500 gf, ~250 gf-~500 gf, ~300 gf-~500 gf, or, e.g., ~350 gf-~500 gf, as in, for example, ~100 gf-~450 gf, ~150 gf-~400 gf, ~200 gf-~400 gf, ~300 gf-~400 gf, or, e.g., an about 350 gf.

According to aspects, the compressible positioner, e.g., Insert spring, working in cooperation with one or more additional components of a delivery device, e.g., a volatile compound compartment (volatiles housing), e.g., insert compartment, e.g., Body Tube, e.g., a fixed positioner (wherein, e.g., the function of a fixed positioner may be functionally accomplished by, e.g., a portion of a Body Crown), stably maintains an insert in a suitable position for delivery device operation when the delivery device, or, e.g., in specific aspects when the volatile compound compartment (volatiles housing), e.g., insert compartment, e.g., Body Tube is oriented in any spatial orientation.

According to certain embodiments, a compressible positioner is positioned within a first component, e.g., a first primary component of a device (e.g., a volatile compound outlet component or, e.g., an extension of a volatile compound outlet component). In aspects, a compressible positioner is positioned within a volatile compound compartment (volatiles housing), e.g., insert compartment, e.g., Body Tube. In aspects, a compressible positioner maintains its positioning within a deliver device via its own restoring force, e.g., spring-like force, e.g., spring tension, whereby in its relaxed state (e.g., manufactured "open" state), the compressible positioner has a width or diameter which is greater than the width or diameter of a part or component into which it is positioned, e.g., a volatile compound compartment (volatiles housing), e.g., insert compartment, e.g., Body Tube. In aspects, when the compressible positioner is compressed and fed or placed into the interior of such a component, e.g., a volatile compound compartment (volatiles housing), e.g., insert compartment, e.g., Body Tube, the natural desire of the compressible positioner is to expand to its relaxed state, creating a spring tension which maintains the compressible component in place within the delivery device, e.g., within the primary component of the delivery device, e.g., within a volatile compound outlet component, e.g., within a volatile compound outlet component extension, e.g., within a volatile compound compartment (volatiles housing), e.g., insert compartment, e.g., Body Tube.

A compressible positioner can be made of any suitable material, such as, e.g., any compressible material capable of providing the characteristics and operational capabilities described relative to this component here, such as, e.g., a suitable rubber, a suitable foam, or the like, or, e.g., can be made of a material such as a metal, e.g., a metal or metal alloy described herein. In aspects, a compressible positioner is provided in the form of a metallic or metal alloy component comprising sufficient durability to withstand repeated compression and expansion over the lifespan of the device. In aspects, a suitable material is a material which can withstand, e.g., more than about 25, ≥~50, ≥~100, ≥~200, ≥~400, ≥~600, ≥~800, ≥~1000, ≥~1200, ≥~1400, ≥~1600, ≥~1800, or ≥~2000 or more compression/expansion cycles without breaking or without at least substantially impacting the ability of the compressible positioner to maintain a volatile compound releasing means, e.g., an insert stably in place during operation of the delivery device.

According to aspects, the compressible positioner can be a component provided as a standard stock component. In aspects, the compressible positioner is an element which is custom made. In aspects, the compressible positioner is an element customized for use in delivery device(s) described herein. In aspects, such a compressible positioner can be machined, cast, or otherwise manufactured specifically for used in a delivery device described herein.

In this and other part, component, assembly, mechanism, function, feature, or operational aspect(s) of the invention, the invention also can be characterized as comprising a "means" for supporting, or, e.g., stabilizing, an insert present to maintain, release, or maintain and release one or more volatile compounds. In such a respect, any known equivalents of such insert support or stabilization parts/components can also be, e.g., are, incorporated into devices or methods of the invention. As with other sections similarly described herein, any of the part(s), component(s), or assembly(ies) of the invention can be, where suitable, described as means (e.g., the above-described compressible positioner can be described as insert support means, insert stabilization means, or means for stably maintaining, e.g., supporting or stabilizing, an insert).

Airflow Control Limiter Element(s) (Body Crown)

In aspects, delivery device(s) provided by the invention comprise an airflow control part, component, system, or mechanism which detectably or significantly limits the amount of airflow passing into, through, or out of a delivery device.

Herein an airflow control mechanism is often described as an airflow restrictor or limiter. Airflow control is described in various context(s) herein. In aspect, a delivery device provided herein comprises at least one part or component which detectably or significantly limits the amount of airflow passing through a delivery device. In aspects, a part or component which detectably or significantly limits the amount of airflow passing through a delivery device is an airflow limiter. In aspects, an airflow limiter is a part or component of an airflow restrictor.

In aspects, a delivery device provided herein comprises a single airflow limiter. In aspects, such an airflow limiter is a static airflow limiter. In aspects, a delivery device provided herein comprises a plurality of airflow limiters, e.g., at least two airflow limiters, movable in relation to one another, which cooperate to provide airflow control functionality to the device. In aspects, at least one of the at least two airflow limiters, e.g., first airflow limiter, reside(s) in a first component, e.g., first primary component, e.g., component comprising a mouthpiece (e.g., volatile compound outlet component), of the delivery device. In aspects, the function of an airflow limiter is to participate in the management of airflow, e.g., airflow control, of a delivery device. Such airflow control can also be referred to as drag control.

Herein, uncontradicted, "drag" refers to the strength of force/suction required to draw air by application of a detectable or significant suction force by a user through a delivery device, wherein the airflow control or drag control impacts the amount of air passing through the device upon application of an amount of suction by a user. Herein, uncontradicted, "increased drag" occurs when airflow is more restricted, while "decreased drag" occurs when airflow is less restricted. Restriction is, as provided above, established by one or more airflow limiter(s). In aspects, a first airflow limiter provides a static means of establishing a single airflow setting of a deliver device. In aspects, a first airflow limiter provides, at least in part, a mechanism for customizing the airflow through a device, by facilitating selectable airflow control setting(s).

According to aspects, a first airflow limiter is designed to cooperatively engage with a second airflow limiter to selectively control the amount of air which is drawn through a device upon application of suction, e.g., by inhalation, by the device user. In aspects, a first airflow limiter selectively repeatedly engages with, at least partially disengages from, and reengages with, a second airflow limiter during normal operation of the device. In certain aspects, a first airflow limiter can completely disengage from a second airflow limiter during certain period(s) of use of a device, such as, e.g., during the loading or removal of a solid material device maintaining, releasing, or maintaining and releasing volatile compounds (i.e., loading or removing an insert into or from a delivery device).

According to certain aspects, a first airflow limiter can be any part or component suitable for, at a minimum, statically establishing the amount of air allowed to pass through at least one portion of an airflow channel through a device. In aspects a first airflow limiter can be any part or component suitable for interfacing with a second airflow limiter to control airflow, such as, e.g., a shutter, a disc-shaped device comprising, e.g., one or more apertures, a device comprising a mechanism for modifying an opening by selectively expanding outward to form a larger opening or converging inward to form a smaller opening, a solid device capable of blocking at least a portion of but not all of an airflow passageway through a device, or any other such mechanism or component capable of cooperatively participating in airflow control through a delivery device.

In certain aspects, a first airflow limiter is a component which alone is capable of blocking, is designed to block, or which blocks at least about, e.g., 25% of an airflow passageway through a delivery device at least one location of the airflow passageway (e.g., an airflow passageway in at least a portion of the device), such as, e.g., ≥~30%, ≥~35%, ≥~40%, ≥~45%, ≥~50%, ≥~55%, ≥~60%, ≥~65%, ≥~70%, ≥~75%, ≥~80%, ≥~85%, ≥~90%, ≥~95%, or more, but, e.g., in aspects, not 100% of, an airflow passageway through a device or, e.g., at least one location of an airflow channel. In aspects, the amount of an airflow passageway through a device which is blocked by a first airflow limiter of a delivery device at the location of the first airflow limiter, i.e., the cross-sectional area of an airflow passageway blocked by the first airflow limiter at the location of the first airflow limiter, is no more than about 75%, such as no more than ~75%, ~70%, ~65%, ~60%, ~55%, or no more than ~50% of the airflow passageway.

According to certain aspects, an airflow limiter can comprise any suitable shape. In aspects, a first limiter is a semi-circular-shaped component. In aspects, the semi-circular shaped component is capable of blocking, is designed to block, or blocks about 50% of the airflow passageway, e.g., about 50% of the cross-sectional area of the airflow passageway, otherwise present at the location of the first airflow limiter, such that due to its presence, a maximally open airflow passageway through a device has, in at least one location of the air passageway through the device, a dimension which is no more than about half of the diameter (or, e.g., width or height) of the air passageway which would otherwise be present in the absence of the first airflow limiter. In aspects, an interior passageway would have at the location of the first airflow limiter, absent the presence of at least the first airflow limiter at that location, a cross sectional area which is about twice that of the cross-sectional area which is present when the at least first airflow limiter is present.

In aspects, the first airflow limiter is movable in relation to a second airflow limiter. In aspects, the degree of interface between the first and second airflow limiters is established by the rotation of a first device component, e.g., first primary device component (e.g., volatile compound outlet component, e.g., mouthpiece or device component comprising a Mouthpiece) and a second device component, e.g., second primary device component (e.g., mating component) relative to one another.

In aspects, a first airflow limiter is provided as a Body Crown. In aspects, a first airflow limiter can comprise any one or more of the characteristics of the Body Crown described in the detailed description of figures provided herein or which is/are visible in the Figures provided herewith.

In aspects, a first airflow limiter, e.g., Body Crown, can comprise a feature or element, e.g., a body feature, facilitating its attachment, e.g., fixed attachment, to one or more additional part(s) or component(s) of a delivery device. In aspects, one or more elements of such a body feature can provide one or more additional functional or operational characteristics of a delivery device, such as, e.g., serving as an insert support (positioner), e.g., insert stabilizer, e.g., fixed positioner. aiding in the maintenance of an insert, e.g., a removable insert, stably in position within a delivery device, e.g., within a first (or first primary) component of a device, e.g., within a volatile compound compartment (volatiles housing), e.g., insert compartment, e.g., Body Tube. This is described further below.

In aspects, in a fully assembled device, and with first and second components (first and second primary, e.g., volatile compound outlet component and mating component) of such a device fully engaged with one another, a second airflow limiter, e.g., Barrel Crown as described herein, is in contact with a first airflow limiter, e.g., Body Crown. In aspects, a first airflow limiter, e.g., Body Crown, can comprise a plurality of features which, in aspects, can be describable as belonging to a fan feature, of the first airflow limiter, e.g., Body Crown. Such features can, in aspects, repeatedly engage with and at least partially disengage from compatible or otherwise cooperating feature(s) present on a second airflow limiter, e.g., Barrel Crown. A second airflow limiter can, in aspects, comprise any one or more characteristics of a Barrel Crown described in the detailed description of figures provided herein or which is/are visible in the Figures provided herewith. In aspects, such repeated engagement and disengagement of such fan features can occur upon the movement, e.g., rotation, of the first airflow limiter (e.g., Body Crown) relative to the second airflow limiter (e.g., Barrel Crown).

In aspects, a first airflow limiter can comprise a fan-like feature comprising a series of ridges and recessions such as, e.g., a series of alternating ridges and recessions. In aspects, the alternating ridges and recessions of a first airflow limiter selectively repeatedly alternatingly engage with and disengage from a coordinating series of ridges and recessions present on a second airflow limiter (e.g., Barrel Crown) which in aspects comprises a complementary, e.g., coordinating/cooperating, fan-like feature comprising a complementary set of ridges and recessions. In aspects, the degree of interface between the first and second airflow limiter, e.g., the degree of overlap between the two components, provides for controllable airflow to be provided by the airflow restrictor (airflow control mechanism) of the device and at least in part determines the amount of airflow passing through the device during use. In aspects, the more the first airflow limiter, e.g., the Body Crown, overlaps with, e.g., interfaces with, the second airflow limiter, e.g., the Barrel Crown, the more airflow through the device is blocked. In aspects, the less the first airflow limiter, e.g., the Body Crown, overlaps with, e.g., interfaces with, the second airflow limiter, the more airflow through the device is allowed (the less the airflow through the device is blocked.)

In aspects, the interaction between the first and second airflow limiters and their ability to cooperatively control the airflow through a delivery device is further described elsewhere herein.

In aspects, a first airflow limiter can comprise a component or feature which operates as an indicator, e.g., participates in an, e.g., tactile indication of an operational status of a delivery device. In aspects, such a feature intermittently interfaces with one or more features of a second airflow limiter, e.g., Barrel Crown. In aspects, a first airflow limiter can comprise one or more protrusions which intermittently interface with one or more protrusion component(s) on a second airflow limiter. In aspects, the interface between the two distinct protrusions on the first and second airflow limiters, respectively, provide a distinguishable indicator, e.g., a distinguishably different tactile sensation compared to the interaction between the ridge(s)/recession(s) of each of the first and second airflow limiters. This is further described or exemplified elsewhere herein. In aspects, such intermittently interfacing feature(s) providing a distinctly different, e.g., detectably or significantly different, indication, e.g., tactile indication, can be any feature providing such an indication. Herein, this/these intermittently interfacing feature(s) is/are described as protrusion(s).

In aspects, the distinguishably (detectably or significantly) indicator(s), e.g., different tactile sensation, indicates a specific airflow control setting of the device. In aspects, a distinguishably different indicator, e.g., tactile sensation, indicates that the airflow restrictor is in a maximally closed position. In aspects, any other, e.g., any other similar, e.g., any other similar but distinguishably different indicator, e.g., tactile sensation, provided by alternating interface of ridges/recessions on the first and second airflow limiters indicate some degree of opening of the airflow restrictor (airflow control mechanism).

According to certain embodiments, a first airflow limiter, e.g., Body Crown, can comprise, e.g., between about 2 and about 30 ridges (or, e.g., peaks) and recessions. In aspects, a first airflow limiter can comprise the same number of ridges as recessions. In alternative aspects, a first airflow limiter can comprise a different number of ridges and recessions. In some respects, a first airflow limiter can comprise, e.g., one or two more ridges than recessions. In some respects, a first airflow limiter can comprise, e.g., one or two more recessions than ridges. In certain aspects, a first airflow control component can comprise, e.g., ~4-~30, ~6-~30, ~8-~30, ~10-~30, ~12-~30, ~14-~30, ~16-~30, ~18-~30, ~20-~30, ~22-~30, ~24-~30, ~26-~30, or ~28-~30 ridges, recessions, or both ridges and recessions (e.g., such values representing the number of each of ridges and recessions), such as, e.g., ~2-~28, ~2-~26, ~2-~24, ~2-~22, ~2-~20, ~2-~18, ~2-~16, ~2-~14, ~2-~12, ~2-~10, ~2-~8, ~2-~6, or ~2-~4 ridges, recessions or both ridges and recessions (e.g., such values representing the number of each of ridges and recessions), as in, for example, ~4-~28, ~6-~26, ~8-~24, ~10-~22, ~12-~20, ~14-~18, or, e.g., about 16 ridges, recessions, or both ridges and recessions (e.g., such values representing the number of each of ridges and recessions).

According to certain embodiments, an angle of between about 6 and about 60 degrees, such as, e.g., an angle of ~7-~60, ~8-~60, ~9-~60, ~10-~60, ~11-~60, ~12-~60, or ~13-~60 degrees, such as, e.g., ~6-~50, ~6-~40, ~6-~30, ~6-~20, or, e.g., ~6-~10 degrees, as in, for example, ~8-~50, ~8-~40, ~8-~30, ~8-~20, or ~8-~25 degrees, such as, e.g., between about 11 and about 13 degrees, e.g., an angle of about 12 degrees separates each recession, separates each ridge, or separates each recession and each ridge from the next (e.g., adjacent) respective recession or ridge.

In aspects, the number of recessions and peaks (ridges) present in a first airflow limiter (e.g., Body Crown) contributes to the specificity with which airflow through the device can be controlled. For example, an increased number of such features recessions and peaks/ridges of a first airflow limiter can increase the level of fine tuning a user can accomplish to control airflow (e.g., drag control) when using the delivery device, while a decreased number of such features can decrease the level of fine tuning a user can accomplish to control airflow during device use.

As previously stated, an airflow limiter, e.g., a first airflow limiter, e.g., a Body Crown, can comprise a body feature facilitating its attachment to one or more additional part(s), component(s), or assembly(ies) of delivery device. In aspects, an element (e.g., feature) of such a body feature can provide an additional functional or operational characteristic of a delivery device, different or separate from, e.g., airflow control. In aspects, a feature of a first airflow limiter can operate as a fixed positioner aiding in the maintenance of an insert, e.g., removable insert, stably in position within a delivery, e.g., a first primary component (e.g., a volatile compound outlet component, or, e.g., a volatile compound outlet extension, or, e.g., a volatile compound compartment) of a delivery device, e.g., an insert housing (within a removable insert housing component), e.g., a Body Tube. In aspects, at least a portion of the first airflow limiter is positioned within a volatile compound compartment (volatiles housing), e.g., insert compartment, e.g., Body Tube. In aspects, a first airflow limiter can be fixedly attached to, e.g., brazed onto, a volatile compound outlet compartment (e.g., Body Tube). In certain aspects, the first airflow limiter and one or more element(s) thereof, e.g., element(s) participating in airflow control and element(s) participating in the stable positioning of an insert, can be a feature of the volatile compound compartment (volatiles housing), e.g., insert compartment, e.g., Body Tube. In aspects, a first airflow limiter can be a single piece/single part/component (e.g., manufactured as a single part/component). In aspects, the portion of the first airflow limiter positioned within the volatile compound compartment (volatiles housing), e.g., insert compartment, e.g., Body Tube can be the fixed positioner described above which participates in the stable maintenance of an insert, e.g., a removable insert, within the delivery device, or, e.g., within the volatile compound compartment (volatiles housing), e.g., insert compartment, e.g., Body Tube, of the device. In aspects, the first airflow limiter comprises a feature which works cooperatively with the, e.g., an insert support, e.g., insert stabilizer, e.g., compressible positioner, to stably maintain a removable insert within the volatile compound compartment (volatiles housing), e.g., insert compartment, e.g., Body Tube as is described above, as the first airflow limiter serves as the fixed positioner of the above-described stability maintenance mechanism. Accordingly, the first airflow limiter can withstand the application of restoring forces applied by an insert support, e.g., insert stabilizer, e.g., compressible positioner, e.g., an insert spring, to an insert, e.g., removable insert, and therefore, applied by the insert to the fixed positioner, e.g., the first airflow limiter. Such restoring forces are described elsewhere herein.

Further, an element (feature) of such a first airflow limiter, e.g., body feature thereof, can be designed to facilitate the entry, removal, or entry and removal of an insert, e.g., removable insert, into the delivery device. Such a feature can, in aspects, be provided as a separate part or component, independent of an airflow limiter. Description of this feature of an airflow limiter should be interpreted as encompassing features of such a part or component if such a part or component were to be provided independent of an airflow limiter. In aspects, one or more surfaces of a first airflow limiter can form a non-right angle. In aspects, such a shape feature allows for the ease of positioning or placement of the first airflow limiter into or within one or more other components of the device during assembly. For example, in aspects, a first airflow limiter rounded (non-90 degree) shape feature facilitates the fitting of the first airflow limiter into a volatile compound compartment (volatiles housing), e.g., insert compartment, e.g., Body Tube, when such component(s) are initially manufactured separately. In aspects, a rounded shape of one or more first airflow limiter shape features allows for the first airflow limiter to be "slid" or easily guided into place within a volatile compound compartment (volatiles housing), e.g., insert compartment, e.g., Body Tube, such that it can, in aspects, slide, fall, or follow contour(s) of a volatile compound compartment (volatiles housing), e.g., insert compartment, e.g., Body Tube into place with limited guidance required. In further aspects, one or more of the first airflow control shape features, e.g., rounded interface between two surfaces, or, also or alternatively, rounding of one or more edge(s) present in an airflow limiter, provide for limiting detectable or significant damage to an insert, e.g., removable insert, when placed into a volatile compound compartment (volatiles housing), e.g., insert compartment, e.g., Body Tube. In aspects, one or more of shape features of a first airflow limiter limits detectable or significant damage to an insert when such an insert, e.g., removable insert, is made of a fragile material, e.g., a material capable of being caught on, or, e.g., scratched by, or, e.g., potentially at risk of experiencing flaking when, contacted by a suitably shaped or sharp surface, such as a fibrous insert or an insert comprising a ceramic material. In aspects, a rounded edge of a first airflow limiter detectably or significantly reduces friction, e.g., scraping, of one or more other part(s) or component(s) of the device causing e.g., premature wear and tear, unsafe or otherwise undesirable flaking, shredding, or slivering, or other detectable modification of one or more other parts or components of the device or the part/component itself. In aspects, a rounded edge of a first airflow limiter detectably or significantly reduces premature or undesirable damage to an insert, e.g., removable insert.

According to aspects, at least a portion of a first airflow limiter positioned within the volatile compound compartment (volatiles housing), e.g., insert compartment, e.g., Body Tube extends to an area of the volatile compound compartment (volatiles housing), e.g., insert compartment, e.g., Body Tube which is not completely encompassed in at least one direction by a wall, e.g., is not completely circumferentially enclosed by a wall of a volatile compound compartment (volatiles housing), e.g., insert compartment, e.g., Body Tube, e.g., a circumferentially disposed wall e.g., body tube wall. In aspects, at least a portion of the first airflow limiter extends into the portion of the volatile compound compartment (volatiles housing), e.g., insert compartment, e.g., Body Tube which is at least partially open on one side. In aspects, such a portion of a first airflow limiter comprises a thickness, e.g., depth, which is less than 100%, such as, e.g., ≤~90%, ≤80%, ≤70%, ≤60%, ≤50%, ≤40%, ≤30%, ≤20%, or, e.g., ≤10% of the diameter, e.g., depth, of volatile compound compartment (volatiles housing), e.g., insert compartment, e.g., Body Tube as described herein.

In aspects, a first airflow limiter, (a) extending at least partially into area of a volatile compound compartment (volatiles housing), e.g., insert compartment, e.g., Body Tube which is at least partially open (not fully enclosed by a wall, e.g., not completely circumferentially disposed wall), and (b) operating as a fixed positioner participating in the stable maintenance of an insert (e.g., removable insert), establishes a detectable or significant gap between the end of an insert, e.g., an insertable (removable) insert, which can abut the first airflow limiter (e.g., as it operates as a fixed positioner described herein) and the complete(d) wall (e.g., body tube wall) or circumferential enclosure of the internal compartment (established by/as the volatile compound compartment (volatiles housing), e.g., insert compartment, e.g., Body Tube). This gap can be referred to as an access space, access gap, or finger recess, and can in aspects allow a user to insert their finger at least partially into the gap to facilitate the removal of an insert (e.g., removable insert).

In aspects, a first airflow limiter can be made of any material described herein. In certain aspects, the first airflow limiter is made of a metal or metal alloy, such as, e.g., gold, titanium, platinum, or, e.g., stainless steel. In particular aspects, the first airflow limiter is made of stainless steel.

In aspects, the first airflow limiter is a custom-made component. In aspects, the first airflow limiter is machined, cast, or otherwise custom manufactured for use in device(s) described herein. In certain aspects, a first airflow limiter is a feature of a larger component, such that it does not represent a physically separate part or component and its function(s) and feature(s) are elements of a device component further providing other feature(s) and functionality(ies) described herein. For example, in one aspect, the first airflow limiter, e.g., its feature(s) and functionality(ies) as described herein, is a part of a volatile outlet component, volatile outlet component extension, body assembly, volatile compound delivery facilitation component (mouthpiece), body subassembly, volatile compound compartment (volatiles housing), e.g., insert compartment, e.g., Body Tube, engagement component, engagement mechanism positioning component, or combination(s) thereof, optionally further including one or more part(s), component(s), or other element(s) participating in the stabilization of an insert.

In this respect and concerning any other part, component, assembly, mechanism, function, feature, or operational aspect(s) of the invention, the invention also can be characterized as comprising a "means" for controlling airflow. In such a respect, any known equivalents of such airflow control components (limiters) or mechanisms can also be, e.g., are, incorporated into devices or methods of the invention. As with other sections similarly described herein, any of the part(s), component(s), or assembly(ies) of the invention can be, where suitable, described as means (e.g., the above-described first airflow limiter can be described as airflow control means or means for controlling airflow).

Access Gap/Finger Recess

In aspects, a device can comprise one or more structures or elements/features that facilitate positioning (e.g., placement, removal, support, etc.) of a VCC or associated solid material device for maintaining, releasing, or maintaining and releasing volatile compound(s) (e.g., an insert). In an exemplary aspect, an access space (also referred to herein as access gap or finger recess) which in aspects is present in a delivery device, e.g., a first component, e.g., a first primary component, e.g., a volatile compound outlet, e.g., a volatile compound outlet extension, e.g., a volatile compound compartment (volatiles housing), e.g., insert compartment, e.g., Body Tube, is provided as exemplified/described elsewhere herein. See, e.g., the sections of this disclosure describing a volatile compound compartment (volatiles housing), e.g., insert compartment, e.g., Body Tube, airflow control limiter(s), specifically those herein described as optionally being associated with a volatile compound compartment (volatiles housing), e.g., insert compartment, e.g., Body Tube, and, e.g., the figures and detailed description thereof.

In aspects, such an access gap can facilitate user access, e.g., finger access and accordingly can be referred to in such aspects as a "finger recess." In aspects, an access gap, e.g., finger recess, is established, at least in part, by a feature of an airflow control mechanism component. The access gap, e.g., finger recess, is established, in aspects, by the presence of an insert support, e.g., fixed positioner, within the volatile compound compartment (volatiles housing), e.g., insert compartment, e.g., Body Tube or, e.g., the interior defined therein, having a dimension, e.g., thickness or depth, which is (a) detectably or significantly less than the depth of the volatile compound compartment (volatiles housing), e.g., insert compartment, e.g., Body Tube and (b) detectably or significantly less than the thickness of an insert, e.g., removable insert. In aspects, when an insert, e.g., removable insert is present in the volatile compound compartment (e.g., volatiles housing), e.g., an insert compartment, e.g., a Body Tube and is stably maintained in the internal compartment by one or more insert positioners, e.g., a compressible positioner and a fixed positioner contacting first end and second ends of the insert respectively, a dimension of the fixed positioner and a dimension of a volatile compound compartment (volatiles housing), e.g., insert compartment, e.g., Body Tube (or, e.g., interior defined therein) are sufficiently different such that the user of the device can access at least a portion of an end, e.g., the second end of the insert. In a specific aspect, a fixed positioner within the volatile compound compartment (volatiles housing), e.g., insert compartment, e.g., Body Tube has a dimension, e.g., thickness or depth, which is sufficiently less than the depth of the volatile compound compartment (volatiles housing), e.g., insert compartment, e.g., Body Tube and the thickness of an insert, e.g., removable insert, such that when the insert is present in the volatile compound compartment (volatiles housing), e.g., insert compartment, e.g., Body Tube and is stably maintained in the volatile compound compartment (volatiles housing), e.g., insert compartment, e.g., Body Tube by at least one insert positioner, e.g., compressible positioner and fixed positioner each making contact with opposing ends of the insert respectively, a user of the delivery device can access at least a portion of an end, e.g., the second end, of the insert. In aspects, a sufficient difference can be, e.g., a difference in thickness or depth between the two elements can be an difference of at least about 1%, >~2%, >~4%, >~6%, >~8%, >~10%, >~15%, >~20%, >~25%, >~30%, >~40%, >~45%, >~50%, >~55%, >~60%, >~70%, >~75%, >~80%, >~85%, >~90%, or, e.g., >~95% or more. In aspects, a difference between the depth of the volatile compound compartment (volatiles housing), e.g., insert compartment, e.g., Body Tube and the thickness of the fixed positioner is sufficient to expose at least a portion of an insert, e.g., removable insert, which the user can access to selectively remove the insert when desired.

Therefore, in one specific aspect, the invention provides a delivery device, wherein the device comprises an internal compartment (e.g., a volatile compound compartment (volatiles housing), e.g., insert compartment, e.g., Body Tube, and the internal space defined thereby) having a width, a depth, and a length, the volatile compound compartment (volatiles housing), e.g., insert compartment, e.g., Body Tube further comprising (a) a first insert support, e.g., a compressible positioner capable of being, designed to be, or which is both compressed by a force and applying/applies an opposing force to such compression, and (b) a second insert support, e.g., a fixed positioner positioned opposite the compressible element of (a) within the volatile compound compartment (volatiles housing), e.g., insert compartment, e.g., Body Tube. In aspects, the two insert supports, e.g., the compressible positioner and the fixed positioner stably maintain an insert, e.g., removable insert, comprising one or more volatile compounds and having a width, a depth (or, e.g., a thickness), a first end, and a second end, when such an insert is inserted therebetween. In aspects, at least one insert support, e.g., the fixed positioner has a dimension, e.g., thickness, which is detectably or significantly less than the depth of the volatile compound compartment (volatiles housing), e.g., insert compartment, e.g., Body Tube and the depth or thickness of the insert. Accordingly, in aspects, when an insert is present in the volatile compound compartment (volatiles housing), e.g., insert compartment, e.g., Body Tube and is stably maintained in the volatile compound compartment (volatiles housing), e.g., insert compartment, e.g., Body Tube by the insert support(s), e.g., compressible positioner and the fixed positioner contacting the first end and second end of the insert respectively, a user of the device can access at least a portion of an end, e.g., the second end, of the removable insert with their finger to facilitate removal of the insert.

In certain aspects, a fixed positioner described above comprises at least two dimensions which join in an orientation which is not a "sharp" 90-degree angle, such that the two dimensions meet at a curve (e.g., such that two otherwise discernable faces or surfaces meet in a rounded edge). In aspects, the presence of a curved edge where the two dimensions meet facilitates the ease of insertion of the fixed positioner into the device, the insertion or removal of a removable insert, or a combination thereof as is described elsewhere herein.

Mating Component (E.g., Second Primary Component or Tip Assembly)

According to aspects, a delivery device provided by the invention comprises a separate, second component, which engages with the VCOC (which, as noted, is often a primary component and is variously embodied/described above as a primary component or first component). In aspects, the second component is a second primary component. In aspects, such a component, e.g., such a second (second primary) component cooperatively engages with a first component, e.g., first primary component, e.g., a volatile compound outlet component. In aspects, the engagement/attachment of these components makes up most, generally all, or all a fully assembled device. In aspects, such engagement is necessary for full operability of the device. In aspects, a device can comprise mating component(s) that are not primary component(s), but still engage with a VCOC.

In aspects, a second, e.g., second primary, component, or other mating component, comprises, e.g., at least one engagement component or engagement part/feature. In aspects, the engagement component part or component is an engagement mechanism. In aspects, the engagement component part is an engagement mechanism counterpart. In aspects, an engagement component present in device(s) herein is a releasable engagement component, e.g., a selectively releasable engagement component, e.g., a controllable engagement component, and the second, e.g., second primary, component comprises an engagement mechanism or engagement mechanism counterpart which is, e.g., a rapidly releasable force mechanism or counterpart thereto, e.g., a part or component that is attractive to a magnet/magnetic force, such as, e.g., a Barrel Collar exemplified in the figures and associated description.

In aspects, a second, e.g., second primary, component can comprise, e.g., an exterior part or component, sometimes referred to as an outer shell, barrel component, or a "Barrel." In aspects, a Barrel can comprise one or more features described in this section (e.g., feature(s) associated with a connection component, feature(s) associated with a Barrel Tube supplement, feature(s) associated with airflow control/airflow limiter(s), etc. and thus in aspects a Barrel can be a mating component as described here.

In aspects, a second, e.g., second primary, component can comprise part or component operating as a supplement to an exterior part or component (e.g., outer shell or Barrel) which detectably or significantly protects such an outer shell or Barrel, herein referred to as a Barrel Tube.

In aspects, a second, e.g., a second primary, component can comprise one or more components of an airflow restrictor, e.g., an airflow limiter, which can, in aspects, be one of a plurality of airflow limiters (e.g., a second airflow limiter) present in a device, which can be referred to herein as, e.g., a Barrel Crown.

In certain aspects, such a collection of part(s) or component(s) described above in this section can be referred to herein as the second component, second primary component, e.g., the mating component. In aspects, a mating component is a Tip Assembly, as exemplified in the figures and related description herein.

As alluded to above, in aspects, one or more part(s) or component(s) described here can comprise one or more functionality(ies) of one or more part(s) or component(s) described here such that it, alone or in combination with one or more other part(s) or feature(s) operate as a mating component.

According to certain aspects, the mating component, e.g., a Tip Assembly, is positioned over at least a portion of one or more other part(s), component(s), or assembly(ies). In aspects, the mating component, e.g., Tip Assembly, is positioned over at least a portion of a volatile compound outlet component. In aspects, the mating component, e.g., Tip Assembly, is positioned over at least a portion of a volatile compound outlet component extension. In aspects, the mating component, e.g., Tip Assembly, is positioned over at least a portion of a volatile compound compartment (volatiles housing), e.g., insert compartment, e.g., Body Tube. In aspects, a mating component, e.g., Tip Assembly, is positioned over at least a portion of any or all such part(s), component(s), or assembly(ies) when the delivery device is fully assembled. In aspects, at least a portion of a volatile compound outlet component (which, as is described elsewhere herein, can comprise a volatile compound outlet component extension including, e.g., a volatile compound compartment (volatiles housing), e.g., insert compartment, e.g., Body Tube) is positioned inside of at least a portion of the mating component, e.g., Tip Assembly, when the delivery device is fully assembled.

In certain aspects, the mating component, e.g., a Tip Assembly, has a smooth, sliding fit with, e.g., over, a volatile compound outlet component, e.g., Body Assembly. In aspects, upon such fit, a connection component, e.g., a selectively releasable engagement component (or mechanism), e.g., rapidly releasable force engagement component (or mechanism), e.g., a magnetic attraction, maintains the connection of the volatile compound outlet component, e.g., Body Assembly, to the mating component, e.g., Tip Assembly, unless or until otherwise intentionally disengaged. In certain aspects, when a volatile compound outlet component, e.g., Body Assembly, and mating component, e.g., Tip Assembly, are engaged or sufficiently partially engaged, two or more constituents of an airflow restrictor, e.g., two or more airflow limiters contact one another; e.g., a first airflow limiter, e.g., Body Crown (wherein, in aspects, such an airflow limiter, e.g., a Body Crown, can be present in a volatile compound outlet component, e.g., Body Assembly) contacts a second airflow limiter, e.g., Barrel Crown (wherein, in aspects such an airflow limiter, e.g., Barrel Crown, can be present in a mating component, e.g., Tip Assembly), providing operability, e.g., selectivity, controllability, or both, of an airflow restrictor.

Engagement Mechanism Counterpart (Barrel Collar)

In aspects, an engagement component comprises at least one engagement mechanism and at least one engagement mechanism counterpart.

In aspects, an engagement component can further comprise an engagement component support (or positioning) part or component.

As is discussed further elsewhere herein, an engagement mechanism of an engagement component can be, e.g., any part or component participating in the engagement of two or more part(s), component(s), or assembly(ies), or combination(s) thereof. As is discussed further elsewhere herein, an exemplary engagement mechanism of an engagement component can be, e.g., a Magnet. In aspects, an engagement mechanism counterpart can be, e.g., any part or component participating in the engagement mechanism of an engagement component along with an engagement mechanism. In aspects, an engagement mechanism counterpart can be, e.g., any part or component (or, e.g., assembly(ies) thereof) which cooperate with an engagement mechanism to arrive at the function of engagement. In aspects, an exemplary engagement mechanism counterpart can be, e.g., a Barrel Collar.

According to certain aspects, a mating component, e.g., a Tip Assembly, can comprise, e.g., a constituent of an engagement component (e.g., a selectable, controllable, or both, engagement component, such as, for example, e.g., a rapidly releasable force mechanism. In aspects, the constituent of the engagement component present in, e.g., a mating component, e.g., Tip Assembly, is a part or component complementary to another constituent of the engagement component present in the device, e.g., a selectively releasable engagement mechanism. In aspects, the part or component of the engagement component (e.g., selectively releasable engagement mechanism, e.g., a rapidly releasable force mechanism) present in, e.g., a mating component, e.g., Tip Assembly, is a component complementary to a part or component of an engagement component present in a volatile compound outlet component, e.g., Body Assembly, of a device such that the two engagement component constituents cooperate to provide a selectively releasable, e.g., rapidly releasable, engagement component of a deliver device. In aspects, one of a plurality of, e.g., a second, engagement component constituents, e.g., a selectively releasable engagement component constituent, can be any part or component capable of cooperating with another of the plurality of engagement component constituents, e.g., an engagement mechanism component, to provide a reversible engagement of two delivery device components, e.g., a volatile compound outlet component and a mating component. In aspects, a constituent of an engagement component, e.g., a second constituent of an engagement component, e.g., a selectively releasable engagement component constituent, can be, e.g., a part or component of an annular snap-fit mechanism, a cantilever snap-fit mechanism (e.g., a multiple-use cantilever snap-fit), or, e.g., a torsional snap-fit mechanism, or, e.g., a screw fit mechanism (e.g., using threading), a push-and-turn release mechanism (similar to or the same as the type of mechanism used commonly for child-proofing a medicinal container), a push-and-release attachment mechanism, an attachment mechanism comprising a clip, pin, lock, or latch, or, e.g., a part or component associated with an attractive force mechanism such as a magnetic force mechanism. In aspects, devices, e.g., mating components, herein comprise an engagement component counterpart, wherein the engagement component counterpart is designed to cooperate with an engagement mechanism.

In aspects, an engagement component constituent, e.g., one of a plurality of engagement component constituents present in a delivery device, e.g., a second selectively releasable engagement component constituent, is a component of a magnetic force connection component. In aspects, the engagement component constituent is a component which is magnetic (that is, magnetically attracted by/to a magnet). In aspects, a mating component, e.g., Tip Assembly, can comprise more than one part or component which is magnetic. In aspects, a delivery device, or, e.g., a mating component, e.g., Tip Assembly, thereof, can comprise a single part or component which is magnetic. In aspects, a magnetic part or component is an engagement mechanism counterpart embodied as Barrel Collar. In aspects, a constituent of a connection selectively releasable engagement mechanism can comprise one or more characteristics of an engagement component counterpart, e.g., Barrel Collar, described in the figures or detailed description of figures provided herein.

According to certain aspects, an engagement mechanism counterpart, e.g., Barrel Collar, is configured so as to allow for an airflow passageway therethrough. In aspects, an engagement mechanism counterpart, e.g., a second selectively releasable engagement component constituent, e.g., a second rapidly releasable force engagement component constituent, e.g., Barrel Collar, is an annularly shaped, e.g., ring-shaped, component. In aspects, the engagement mechanism counterpart, e.g., Barrel Collar, is positioned around (e.g., to surround in at least one direction) one or more other part(s), component(s), or both, of a second primary device component. In aspects, one or more other components of a mating component, e.g., Tip Assembly, is positioned at least partially inside of or at least partially within the engagement mechanism counterpart, e.g., Barrel Collar. In aspects, an exterior part or component of a mating component (e.g., outer shell or Barrel) supplement, e.g., protection element thereof, e.g., a barrel protection mechanism, e.g., Barrel Tube, is positioned at least partially within the interior of the engagement mechanism counterpart, e.g., Barrel Collar.

According to certain aspects, an engagement mechanism counterpart, e.g., Barrel Collar, is made of a magnetic material. That is, in aspects, an engagement mechanism counterpart, e.g., Barrel Collar, is made of a material which is capable of being magnetized. In aspects, a first component of a first primary component, e.g., a volatile compound outlet component, e.g., a Body Assembly, comprising a first constituent of a selectively releasable engagement component, e.g., an engagement mechanism, e.g., a Magnet, is magnetically attracted to a second selectively releasable engagement component constituent, e.g., Barrel Collar, positioned within a mating component, e.g., Tip Assembly. In certain aspects, an engagement mechanism counterpart, e.g., Barrel Collar, is the only part or component of a delivery device capable of being detectably or significantly connected to, or, e.g., in aspects attracted by, connected by force to, an engagement mechanism of the delivery device. In aspects, an engagement mechanism counterpart, e.g., Barrel Collar, is the only part or component of a delivery device capable of being connected to a rapidly releasable engagement component constituent, e.g., an engagement mechanism of such an engagement component. In aspects, it is, e.g., a magnetic attraction between a volatile compound outlet component, e.g., a Body Assembly part or component, e.g., engagement mechanism, e.g., Magnet, and a mating component, e.g., Tip Assembly part or component, e.g., engagement mechanism counterpart, e.g., Barrel Collar, which facilitates the engagement of, e.g., the selective engagement of, a first device primary component, e.g., volatile compound outlet component, e.g., Body assembly, and second device primary component, e.g., mating component, e.g., Tip Assembly. In aspects, it is the selective and, e.g., rapid engagement and disengagement of these two delivery device components which facilitates the ability to rotate them relative to one another. In aspects, it is the selective and, e.g., rapid engagement and disengagement of an engagement mechanism and an engagement mechanism counterpart (e.g., Magnet and Barrel Collar) or, e.g., the selective and, e.g., rapid engagement and disengagement of a volatile compound outlet component and a mating component which facilitates the ability to rotate them relative to one another. In aspects, it is the rotation described here that provides a controllable airflow restrictor, e.g., controls the status or modification of the airflow restrictor.

According to certain aspects, the engagement mechanism counterpart, e.g., Barrel Collar, can be a standardly available stock part or component. In aspects, the engagement mechanism counterpart, e.g., Barrel Collar, is a custom-made part or component. In aspects, the second selectively releasable engagement mechanism component, e.g., Barrel Collar, is custom machined, cast, or otherwise manufactured specifically for use within the delivery device described herein.

In this and other part, component, assembly, mechanism, function, feature, or operational aspect(s) of the invention, the invention also can be characterized as comprising a "means" for engagement, or, e.g., means for selectively releasable engagement, of two or more parts or components. In such a respect, any known equivalents of such named engagement parts or components, selectively releasable engagement parts or components, or connection mechanisms can also be, e.g., are, incorporated into device(s) or method(s) of the invention. As with other sections similarly described herein, any of the part(s), component(s), or assembly(ies) of the invention can be, where suitable, described as means (e.g., the above-described connection mechanism counterpart (selectively releasable engagement component constituent) can be described as connection mechanism counterpart means or selectively releasable engagement means or means for providing or facilitating the engagement, e.g., selectively releasable engagement, of two or more delivery device parts or components).

Mating Component Exterior/Outer Shell (Barrel)

In some respects, a second device component, e.g., second primary component or component designed to mate with a first device component (mating component) of a delivery device can comprise, e.g., a part or component which is externally visible. In aspects, such a part or component can be, e.g., characterizable as an outer cover or shell of the mating component, e.g., Tip Assembly. In aspects, such an exterior or, e.g., outer shell, is referred to herein as a Barrel. In aspects, outer shell or exterior of a mating component, e.g., a Barrel, is an exterior device part or component which a delivery device user contacts (with which a device user makes contact or holds) to remove a mating component, e.g., Tip Assembly, from another delivery device component, e.g., volatile compound outlet component, e.g., Body Assembly. In aspects, such removal may be desirable when, e.g., a delivery device user wishes to access the interior of the volatile compound outlet component, e.g., Body Assembly, to, for example, insert or remove a component comprising (or having comprised) compounds for inhalation, such as, e.g., an insert, e.g., removable insert. In aspects, an exterior or outer shell of a mating component, e.g., Barrel, is an exterior device component through which air flows, either directly or indirectly (e.g., indirectly can be, in aspects, when an outer shell protection mechanism, e.g., Barrel Tube, is present within the outer shell, e.g., Barrel), via a channel therein, e.g., a barrel component channel. In aspects, a barrel component channel represents a portion of a total airflow channel through a delivery device.

Like other part(s) and component(s) described herein, a mating component exterior or outer shell, e.g., Barrel, can comprise any one or characteristic(s) of a mating component described herein. Accordingly, in certain aspects, a mating component can at least generally, at least mostly, at least substantially, at least essentially, essentially, or be entirely composed of a component described here as a mating component exterior or outer shell, e.g., Barrel.

According to certain aspects, at least one portion of an outer cover/shell, e.g., Barrel, interfaces with, engages (e.g., selectively engages), or otherwise cooperatively interacts with one or more other device component(s). In certain aspects, an outer cover/shell, e.g., Barrel, can comprise at least one end portion designed to engage with one or more other component(s) of a delivery device. In certain aspects, an outer shell is at least partially disengageable from a delivery device. In certain aspects, an outer shell is completely removable from a delivery device.

In aspects, a mating component exterior or outer shell, e.g., a Barrel, can be any type of exterior part or component, e.g., any type of outer cover or shell, taking on any type of size, shape, or appearance, which is suitable, e.g., compatible, with any one or more other delivery device part(s), component(s), or assembly(s) which it mates with, engages with, or otherwise cooperatively interacts with during operation of the delivery device.

In aspects, a mating component exterior or outer shell, e.g., a Barrel, can comprise any shape, such as, e.g., cylinder, triangular prism, rectangular prism (cuboid), pentagonal prism, hexagonal prism, octagonal prism, or other multi-sided prism. In aspects, an outer cover or shell can be made of any material described herein, such as, e.g., a metal, metal alloy, wood, plastic, ceramic, stone, shell, etc. In aspects, a mating component exterior or outer shell, e.g., a Barrel can be interchangeable, so as to, e.g., provide a customizable delivery device to a device user. In aspects, a mating component exterior or outer shell, e.g., a Barrel is not interchangeable. According to certain aspects, the outer cover or shell is cylindrical in shape.

In aspects, a mating component exterior or outer shell, e.g., a Barrel can have one or more features suitable for maintaining the device of which is it a component in a stable position upon placement on a surface when not in use. For example, in aspects, a mating component exterior or outer shell, e.g., a Barrel can be at least generally, at least substantially, at least essentially, or is essentially cylindrically shaped, however at least one portion of the mating component exterior or outer shell, e.g., a Barrel comprises a detectable or significant protrusion from its surface, or, e.g., a portion of its surface removed (so as, e.g., to form a detectable or significant groove or a slit, or flattened surface) which is sufficient to keep the delivery device from rolling when placed on a surface upon which it would roll were such feature(s) not present.

In aspects, a mating component exterior or outer shell, e.g., a Barrel is made of a wood material. In aspects, a mating component exterior or outer shell, e.g., a Barrel is a cylindrical body made of wood, such as, e.g., is embodied by a Barrel. In aspects, a mating component exterior or outer shell, e.g., a Barrel can comprise one or more characteristics of a Barrel described in the figures, or the detailed description of figures provided herein.

According to aspects, a mating component exterior or outer shell, e.g., a Barrel, is capable of housing, is designed to house, or houses within it one or more other components of a delivery device. In aspects, a mating component exterior or outer shell, e.g., a Barrel can be a cylinder within which at least a portion of one or more of connection component counterpart, e.g., Barrel Collar, a mating component exterior or outer shell, e.g., a Barrel protection mechanism (Barrel Tube), and, e.g., a constituent of an airflow restrictor, e.g., an airflow limiter (, e.g., a Barrel Crown), is/are housed therein. In aspects, any one or more function(s) or feature(s) thereof can be, e.g., a function or feature of a mating component exterior or outer shell, e.g., a Barrel.

In certain embodiments, a mating component exterior or outer shell, e.g., a Barrel can directly receive a solid material device maintaining, releasing, or maintaining and releasing (or having maintained, released, or maintained and released) volatile compound(s), i.e., an insert (e.g., a removable insert). In aspects, a mating component exterior or outer shell, e.g., a Barrel can indirectly receive a solid material device maintaining, releasing, or maintaining and releasing (or having maintained, released, or maintained and released) volatile compound(s), i.e., an insert (e.g., a removable insert), such indirect receipt being when one or more other part(s) or component(s), e.g., a mating component exterior or outer shell, e.g., a Barrel protection mechanism, e.g., Barrel Tube, is present between the mating component exterior or outer shell, e.g., a Barrel (e.g., Barrel) and the insert.

In aspects, a mating component exterior or outer shell, e.g., a Barrel, can maintain a component on, in, or otherwise in association with it which is removed in order to receive an insert either directly or indirectly. According to certain specific aspects, a mating component exterior or outer shell, e.g., a Barrel, is capable of directly receiving an insert, e.g., a removable insert. In aspects, one or more part(s) or component(s) must be detectably or significantly moved relative to, or removed from, a mating component exterior or outer shell, e.g., a Barrel, to facilitate its receipt of an insert. For example, in an exemplary embodiment, a mating component exterior or outer shell, e.g., a Barrel can comprise an airflow limiter, and the airflow limiter can be moved relative to or removed from the mating component exterior or outer shell, e.g., a Barrel in order to facilitate insertion of an insert into the mating component exterior or outer shell, e.g., a Barrel.

In certain aspects, in a fully assembled delivery device, an engagement mechanism counterpart, e.g., Barrel Collar, can be positioned around a mating component exterior or outer shell, e.g., a Barrel protection mechanism (e.g., Barrel Tube). In aspects, both the engagement mechanism counterpart, e.g., Barrel Collar, and mating component exterior or outer shell, e.g., a Barrel protection mechanism (e.g., Barrel Tube) are positioned within the mating component exterior or outer shell, e.g., a Barrel. In aspects, a mating component exterior or outer shell, e.g., a Barrel protection mechanism, e.g., Barrel Tube, can detectably or significantly limit the exposure of a mating component exterior or outer shell, e.g., a Barrel, to a condition which may detectably or significantly impact the performance of or detectably or significantly limit the longevity of, the mating component exterior or outer shell, e.g., a Barrel. In aspects, such a condition can be, e.g., exposure to excess amount of moisture, sufficient exposure to one or more volatile compound(s) to cause the detectable or significant absorption of one or more volatile compound(s), or both. According to certain alternative embodiments, a mating component exterior or outer shell, e.g., a Barrel, can be made of an at least substantially moisture impervious material. Further, in aspects, an a mating component exterior or outer shell, e.g., a Barrel, can comprise a portion (e.g., an interior portion) which is sealed, coated, or otherwise lined with an at least substantially moisture impervious material so as to at least mostly, at least generally, at least substantially, at least essentially, essentially, or completely eliminate detectable or significant moisture absorption by one or more other portions of a mating component exterior or outer shell, e.g., a Barrel.

In aspects, a mating component exterior or outer shell, e.g., a Barrel, is provided as a cylinder which is open on both its first and second ends, e.g., opposing ends. In aspects, one or more components of an airflow restrictor is/are visible to a delivery device user when a delivery device user views an end of the mating component exterior or outer shell, e.g., a Barrel (e.g., the inlet end of a mating component exterior or outer shell, e.g., a Barrel, distal from a mating component exterior or outer shell, e.g., a Barrel outlet which in aspects is nearer to e.g., a Mouthpiece) than the inlet end of a mating component exterior or outer shell, e.g., a Barrel. In aspects, by viewing a delivery device from its inlet end, a user can see one or more, e.g., all relevant airflow restrictor parts or components, e.g., one, two, or more airflow limiter(s), to discern the airflow control status of the delivery device (e.g., a user can discern the degree of openness or closure of the airflow restrictor.)

In aspects, a mating component exterior or outer shell, e.g., a Barrel exterior surface can comprise one or more indicators. In aspects, such an indicator can be a visual indicator, a tactile indicator, or both. In aspects, a mating component exterior or outer shell, e.g., a Barrel, can comprise one or more visual indicators. In aspects, such one or more indicator(s) is/are visible to the user when using the device. In aspects, a mating component exterior or outer shell, e.g., a Barrel, can comprise at least one indicator which can, in aspects, participate in communicating the spatial orientation of the device, one or more operational status(es) of the device, or both. In aspects, such an indicator can be any indicator, e.g., visual indicator, described herein. In certain specific aspects, the visual indicator is, e.g., a product logo.

According to certain aspects, a mating component exterior or outer shell, e.g., a Barrel, can be a standardly available stock component. In aspects, a mating component exterior or outer shell, e.g., a Barrel, is a custom-made part or component. In aspects, a mating component exterior or outer shell, e.g., a Barrel, is custom machined, cast, carved, molded, or otherwise manufactured specifically for use within a delivery device described herein.

In this and other part, component, assembly, mechanism, function, feature, or operational aspect(s) of the invention, the invention also can be characterized as comprising a "means" for providing a user engageable portion of a mating component, an aesthetically pleasing delivery device, or both, while, in aspects, comprising or housing one or more device part(s), component(s), or assembly(ies) required for expected use or operation of the device or feature(s) or function(s) thereof. In such a respect, any known equivalents of such named mating component exterior or outer shell, e.g., a Barrel component(s) or mechanisms can also be, e.g., are, incorporated into device(s) or method(s) of the invention. As with other sections similarly described herein, any of the part(s), component(s), or assembly(ies) of the invention can be, where suitable, described as means (e.g., the above-described a mating component exterior or outer shell, e.g., a Barrel can be described as a user engagement means, an outer shell means, or means for providing an outer shell or facilitating the housing of one or more device part(s) or component(s) required for suitable delivery device use or operation while further, optionally, providing an aesthetically pleasing device).

Mating Component Exterior/Outer Shell Protection Mechanism (Barrel Tube)

According to aspects, a delivery device can comprise a mating component exterior element or outer shell, e.g., a Barrel, made at least substantially of a material which is (a) at risk of being compromised due to exposure to excessive moisture, or (b) made at least substantially of a material at risk of absorbing or, e.g., allowing entry of, one or more volatile compounds released from a means of maintaining, releasing, or maintaining and releasing one or more volatile compounds, such as, e.g., an insert, e.g., a removable insert. In aspects, a delivery device, e.g., a mating component exterior or outer shell, e.g., a Barrel of a delivery device, can comprise as an additional part or component a mating component exterior or outer shell protection component. In certain aspects, a mating component exterior or outer shell protection component can be, e.g., a Barrel Tube as exemplified in the figures and related description herein. In aspects, a mating component exterior or outer shell protection component can comprise one or more of the characteristics of a Barrel Tube described in the figures or detailed description of figures provided herein.

In aspects, a mating component exterior or outer shell protection component can be, e.g., any component which operates to protect a mating component exterior or outer shell part or component (e.g., Barrel) from (a) detectable or significant damage or degradation, such as by, e.g., exposure to excessive moisture, (b) detectable or significant contamination with a detectable or significant amount of one or more volatile compounds, or (c) both (a) and (b). A detectable or significant amount of one or more compound(s) can be, e.g., an amount which is detectable by a user of a delivery device to an extent that the user can taste the one or more volatile compound(s) during a time period in which the delivery device no longer contains an insert, e.g., a removable insert comprising such one or more volatile compound(s). In aspects, a detectable or significant amount of one or more compound(s) can be, e.g., an amount which, while an insert comprising such compound(s) is no longer present in a device, at least substantially changes, or, e.g., which negatively affects, the taste experience of one or more volatile compound(s) provided by, e.g., an insert which is present in the delivery device, such a determination being a determination made by a device user or a group of device users, such as, e.g., may be determined by a collective study of device users.

In aspects, a mating component exterior or outer shell protection component can be any component accomplishing this purpose, such as, e.g., a liner, a coating, a sealant, or an inserted component, such as, an insert made of, e.g., a plastic, metal, or, e.g., metal alloy, etc. In aspects, such a mating component exterior or outer shell protection component can be made of, e.g., stainless steel. In aspects, a mating component exterior or outer shell protection component is a stainless-steel tube, e.g., a Barrel Tube.

In certain aspects, a mating component exterior or outer shell protection component, e.g., Barrel Tube, can be positioned within an interior of a mating component exterior or outer shell, e.g., Barrel. In aspects, an epoxy glue is used on an outer surface of a mating component exterior or outer shell protection component, e.g., Barrel Tube, to bond the mating component exterior or outer shell protection component, e.g., Barrel Tube, to the interior of a mating component exterior or outer shell, e.g., Barrel. In such aspects, a mating component exterior or outer shell protection component is not obviously externally visible under normal delivery device operating conditions. In aspects, a mating component exterior or outer shell protection component detectably or significantly reduces the exposure of a mating component exterior or outer shell, e.g., Barrel, to moisture. In aspects, a mating component exterior or outer shell protection component, e.g., Barrel Tube, detectably or significantly extends the usable lifespan of a mating component exterior or outer shell, such as by at least ~2×, ~5×, ~10×, ~20×, ~50×, ~100×, ~1000×, or ~2000× or more over mating component exterior or outer shell lacking such a component.

According to certain aspects, at least one portion of a mating component exterior or outer shell protection component, e.g., Barrel Tube, interfaces with, engages (e.g., selectively engages), or otherwise cooperatively interacts with one or more other device part(s) or component(s). In certain aspects, a mating component exterior or outer shell protection component, e.g., Barrel Tube, can comprise at least one end portion designed to engage with one or more other component(s) of a delivery device.

In aspects, a mating component exterior or outer shell, e.g., Barrel, is positioned around at least a portion of a volatile compound outlet component, e.g., Body Assembly. In aspects, a mating component exterior or outer shell, e.g., Barrel, is positioned around at least a portion of a volatile compound compartment (volatiles housing), e.g., insert compartment, e.g., Body Tube In aspects, one or more volatile compound(s) provided by a means of providing such compounds, e.g., an insert or removable insert, can seep into and therefore become detectably or significantly present in a mating component exterior or outer shell if such a mating component exterior or outer shell, e.g., Barrel, comprises a sufficiently soft or porous material allowing detectable or significant entry of one or more such volatile compound(s). In such scenarios, the mating component exterior or outer shell, e.g. Barrel, can later release such one or more volatile compound(s), detectably or significantly impacting, e.g., in aspects detectably or significantly negatively impacting, the experience of the delivery device user (such as by, for example, releasing volatile compound(s) having a first flavor obtained from a first removable insert which has since been removed and, e.g., replaced by a second removable insert comprising different volatile compound(s)). Therefore, in aspects, a mating component exterior or outer shell protection component, e.g., Barrel Tube, when present within the interior of an outer shell, e.g., Barrel, can detectably or significantly reduce the volume or amount of volatile compound(s) released by an insert, e.g., removable insert which make their way into, or which detectably or significantly become absorbed by, the mating component exterior or outer shell, e.g., Barrel. In aspects, a mating component exterior or outer shell protection component, e.g., Barrel Tube, prevents a detectable or significant volume of one or more volatile compound(s) from entering a material of which a mating component exterior or outer shell, e.g., Barrel, is composed. In aspects, a mating component exterior or outer shell protection component, e.g., a Barrel Tube, detectably or significantly reduces or prevents a sufficient volume of one or more volatile compound(s), released from one removable insert, from entering a mating component exterior or outer shell (e.g., Barrel) to be detectable by a user when the user replaces the Insert with a different removable insert delivering different volatile compound(s).

In aspects, a mating component exterior or outer shell protection component, e.g., Barrel Tube, can directly receive a solid material device maintaining, releasing, or maintaining and releasing (or having maintained, released, or maintained and released) volatile compound(s), i.e., an insert (e.g., a removable insert). In aspects, a mating component exterior or outer shell protection component, e.g., Barrel Tube, can maintain a part, feature, or component on, in, or otherwise in association with it, which is, in use, detectably moved, or which is removed completely, in order that the insert compartment can receive an insert either directly or indirectly. For example, in one aspect, a mating component exterior or outer shell protection component can comprise, e.g., an airflow limiter, and, e.g., the airflow limiter is detectably or significantly moved or is removed completely from the mating component exterior or outer shell protection component to facilitate insertion into the mating component exterior or outer shell protection component.

In aspects, a mating component exterior or outer shell protection component, e.g., Barrel Tube, can be custom made, e.g., custom cast, machined, or otherwise custom manufactured for use with the delivery device(s) herein. In aspects, a mating component exterior or outer shell protection component, e.g., Barrel Tube, can be purchased as a typical on-market (stock) machine part. In aspects, a Barrel Tube, or, e.g., feature(s)/function(s) thereof as described here, is not a separate device component, but rather feature(s)/function(s) thereof are incorporated into one or more other component(s) described herein. In aspects, a corresponding element that is not tubular can be used/incorporated.

In this respect and regarding any other part, component, assembly, mechanism, function, feature, or operational aspect(s) of the invention, the invention also can be characterized as comprising a "means" for protecting a mating component exterior or outer shell component. In such a respect, any known equivalents of such named mating component exterior or outer shell protection component elements can also be, e.g., they are, incorporated into devices or methods of the invention. As with other sections similarly described herein, any of the part(s), component(s), or assembly(ies) of the invention can be, where suitable, described as means (e.g., the above-described outer shell protection component can be described as outer shell protection component/mechanism means, exterior protection means, mating component exterior or outer shell protection means, or means for providing or facilitating protection of an outer shell, e.g., a mating component exterior or outer shell, of a delivery device).

Airflow Control Second Component (Barrel Crown)

As stated previously, in aspects, delivery device(s) described herein can comprise an airflow control element, such as an airflow restrictor.

In aspects, an airflow restrictor can comprise at least two components (in aspects forming a mechanism), movable in relation to one another, which cooperate to provide airflow control functionality to the device.

In aspects, at least one of the at least two components, e.g., an airflow limiter, e.g., a second of at least two airflow limiter(s) present in a delivery device, reside(s) in a second component, e.g., a second primary component, e.g., a mating component, of a delivery device.

In aspects, the function of an airflow limiter, e.g., one airflow limiter of a plurality of airflow limiters, is to participate in the airflow control of delivery device. As provided elsewhere, such airflow control can also be referred to as, e.g., drag control. In aspects, an airflow limiter provides a means of customizing the airflow through a delivery device, providing a selectable, controllable, or both selectable and controllable airflow restriction, e.g., selectable, controllable, or both selectable and controllable airflow control setting(s).

According to aspects, an airflow limiter (also referred to herein as a second airflow limiter, as in some embodiments such an airflow limiter cooperates with at least one other airflow limiter of a delivery device) is designed to cooperatively engage with another airflow limiter (also referred to herein as a first airflow limiter) to selectively control the amount of air which is drawn through the device upon the application of a detectable or significant suction force to the device by a device user. In aspects, a second airflow limiter selectively repeatedly engages with, at least partially disengages from, and reengages with, a first airflow limiter during normal operation of a delivery device.

According to certain aspects, an airflow limiter, e.g., a second airflow limiter, can be any part or component suitable for interfacing with a first airflow limiter to detectably or significantly modulate, establish, or otherwise control airflow, such as, e.g., a shutter, a disc-shaped part, component, or assembly comprising, e.g., one or more apertures, a part, component, or assembly comprising a mechanism for modifying an opening by selectively expanding outward to form a larger opening or converging inward to form a smaller opening, a solid part, component, or assembly capable of blocking at least a portion of but not all of an airflow passageway or channel through a device (e.g., at or in at least one location of such an airflow channel), or any other such part, component, or mechanism capable of participating in or cooperatively participating in airflow control through a delivery device (or e.g., capable of being a constituent of an airflow restrictor).

In certain aspects, a second airflow limiter is a component which alone is capable of blocking at least about, e.g., 25% of an airflow passageway through a delivery device in at least one location of such an airflow channel, such as, e.g., ≥~30%, ≥~35%, ≥~40%, ≥~45%, ≥~50%, ≥~55%, ≥~60%, ≥~65%, ≥~70%, ≥~75%, ≥~80%, ≥~85%, ≥~90%, ≥~95%, or more, but not 100% of, an airflow passageway, or, e.g., at least a portion of an airflow passageway, e.g., at one location thereof, through deliver device. In aspects, the amount of an airflow passageway through a device which is blocked by a second airflow limiter of a delivery device described herein is no more than about 75%, such as no more than ~75%, ~70%, ~65%, ~60%, ~55%, or no more than ~50% of the airflow passageway through a delivery device. According to certain aspects, the second airflow limiter is a semi-circular-shaped component. In aspects, the semi-circular shaped component is capable of blocking, is designed to block or blocks about 50% of the airflow passageway through a delivery device at the location along an airflow passageway/airflow channel at which the second airflow limiter is positioned, such that due to its presence, a maximally open airflow passageway through a device has at least one dimension which is no more than about half of the diameter (or, e.g., width or height) of an interior passageway passing from a first end of a delivery device to a second end of a delivery device at the location of the second airflow control component which would otherwise be present if the airflow limiter, e.g., second airflow limiter were not present. In aspects, such an interior passageway would have, absent the presence of at least the second airflow limiter, a cross sectional area across its length or at a minimum in a single location along its length (e.g., at the location/position of the second airflow control component) which is about twice that of the cross-sectional area across its length or at a minimum in a single location along its length which is present when the at least second airflow limiter is present.

As previously stated, in aspects, a second airflow limiter is movable in relation to a first airflow limiter. In aspects, the degree of interface between first and second airflow restrictor constituents (e.g., limiter) is established by the rotation of a first device component, e.g., first primary device component, e.g., component comprising a Mouthpiece, e.g., a volatile compound outlet component, and a second device component, e.g., second primary device component, e.g., mating component/component designed to mate with a first device component, relative to one another.

In aspects, a second airflow limiter is provided as a Barrel Crown. In aspects, a second airflow limiter can comprise any one or more of the characteristics of the Barrel Crown described in figures or the detailed description of figures provided herein, or which is visible in Figures provided herewith.

In aspects, an airflow limiter, e.g., a second airflow limiter, e.g., Barrel Crown, can comprise a feature, e.g., a body feature, facilitating its fixed attachment to one or more additional part(s) or component(s) of a delivery device. In aspects, at least a portion of an airflow limiter, e.g., second airflow limiter, e.g., Barrel Crown, is positioned within a mating component exterior or outer shell protection component, e.g., Barrel Tube. In aspects, at least a portion of an airflow limiter, e.g., second airflow limiter, e.g., Barrel Crown, is positioned within a mating component exterior or outer shell, e.g., Barrel. According to certain aspects, an airflow limiter, e.g., second airflow limiter, e.g., Barrel Crown, or, e.g., the features thereof, can be provided as element(s) of another component such that the airflow limiter, e.g., second airflow limiter is not a separately manufactured component. In aspects, for example, an airflow limiter, e.g., second airflow limiter, e.g., Barrel Crown, or feature(s)/element(s) functionality(ies) thereof, are part of an, e.g., a mating component exterior or outer shell, e.g., Barrel, a mating component exterior or outer shell protection component, e.g., Barrel Tube, or other part(s) or component(s) of device(s) described herein.

In aspects, an airflow limiter, e.g., second airflow limiter, e.g., Barrel Crown, can comprise a plurality of features which, in aspects, can be describable as belonging to a fan feature of the airflow limiter, e.g., second airflow limiter, e.g., Barrel Crown. Such features can, in aspects, repeatedly engage with and at least partially disengage from compatible feature(s) present on another airflow limiter of a delivery device, e.g., a first airflow limiter, e.g., Body Crown. A first airflow limiter can, in aspects, comprise any one or more characteristics of a Body Crown described in the detailed description of figures provided herein (or which are visible in Figures provided herewith). A second airflow limiter can, in aspects, comprise any one or more characteristics of a Barrel Crown described in the detailed description of figures provided herein (or which are visible in Figures provided herewith). In aspects, such repeated engagement and disengagement of such fan feature(s) can occur upon the movement, e.g., rotation, of one, e.g., the second airflow limiter (e.g., Barrel Crown) relative to another, e.g., the first airflow limiter (e.g., Body Crown). In aspects, in a fully assembled delivery device, and with first and second primary components (volatile compound outlet component and mating component) of such a delivery device maximally engaged with one another, at least one airflow limiter, e.g., a first airflow, e.g., a Body Crown, is in contact with at least one other airflow limiter, e.g., a second airflow limiter, e.g., a Barrel Crown.

In aspects, an airflow limiter, e.g., a second airflow limiter, can comprise a fan-like feature comprising a series of ridges (or peaks) and recessions such as, e.g., a series of alternating ridges and recessions. In aspects, the alternating ridges and recessions of an airflow limiter, e.g., second airflow limiter selectively repeatedly alternatingly engages with and disengages from a coordinating series of ridges and recessions present on a another, e.g., a first airflow limiter (e.g., a Body Crown) which in aspects comprises a complementary fan-like feature comprising the complementary set of ridges and recessions. In aspects, the degree of interface between the airflow limiters, e.g., second and first airflow limiters, e.g., the degree of overlap between the two components, provides an airflow control mechanism of/for the device. In aspects, the degree of interface between a plurality of airflow limiters, e.g., the degree of overlap between a plurality of airflow limiters, provides establishes the state of an airflow restrictor. In aspects, the more one, e.g., a second, airflow limiter, e.g., the Barrel Crown, overlaps with another, e.g., a first airflow limiter, e.g., the Body Crown, that is, the greater the degree of interface between the first and second airflow restrictors, the more airflow through the device is blocked; that is, the greater the degree of airflow impedance, or, e.g., as is described herein, the higher the drag. In aspects, the less the one airflow limiter, e.g., second airflow limiter, e.g., the Barrel Crown, overlaps with or interfaces with another airflow limiter, e.g., first airflow limiter, e.g., the Body Crown, the more airflow through the device is allowed (the less the airflow through the device is blocked; that is, the less airflow through the device is impeded, or, e.g., as is described herein, the lower the drag.)

The interaction between the plurality of airflow limiters (e.g., first and second airflow limiters) and their ability to cooperatively control the amount of airflow through a delivery device is further described elsewhere herein.

In aspects, an airflow limiter, e.g., a second airflow limiter, e.g., a Barrel Crown, can comprise a portion or feature which operates as an indicator. In aspects, an airflow limiter, e.g., a second airflow limiter, can comprise a portion or feature which participates in an audible indication, tactile indication, or both, of an operational status of a delivery device. In aspects, such a feature intermittently interfaces with one or more portions or features of another airflow limiter, e.g., a first airflow limiter, e.g., Body Crown. In aspects, an airflow limiter, e.g., second airflow limiter can comprise one or more protrusions which intermittently interfaces with one or more protruded portion(s) or protrusion feature(s) on another airflow limiter, e.g., first airflow limiter. As previously described in relation to other airflow control limiter(s), e.g., a first airflow limiter, e.g., Body Crown, in aspects, the interface between two distinct features, e.g., protrusions wherein at least one of the two features is present on one airflow limiter and at least one of the two features is present on another airflow limiter, provide a distinguishably different audible indicator, tactile indicator, or both, compared to the interaction between the ridge(s)/recession(s) of each of such airflow limiters which are distinguishable different from the distinct feature (e.g., differentiable protrusion(s)). This is further described or exemplified elsewhere herein. In aspects, such intermittently interfacing features providing a distinctly different audible indication, tactile indication, or both audible and tactile indication, can be any feature providing such indication(s). Herein, this/these intermittently interfacing feature(s) is/are described as protrusion(s). In aspects, the distinguishably different audible, tactile, or both sensation(s) indicates a specific airflow control setting of the device. In aspects, the distinguishably different audible, tactile, or both sensation(s) indicates that the airflow restrictor is in a maximally closed position. In aspects, any other audible, tactile, or both audible and tactile sensation(s) provided by alternating interface of ridges/recessions on first and second airflow limiters indicate some degree of opening of the airflow control mechanism (airflow restrictor).

According to certain embodiments, an airflow limiter, e.g., a second airflow limiter, e.g., a Barrel Crown, can comprise, e.g., between about 2 and about 30 ridges (or, e.g., peaks) and recessions (or structurally or functionally similar structures, e.g., that provide for incremental blockage/closure of an airflow passageway element/section). In aspects, an airflow limiter, e.g., second airflow limiter, e.g., a Barrel Crown, can comprise the same number of ridges as recessions. In alternative aspects, an airflow limiter, e.g., a second airflow limiter, e.g., a Barrel Crown, can comprise a different number of ridges and recessions. In some respects, an airflow limiter, e.g., a second airflow limiter, e.g., Barrel Crown, can comprise, e.g., one or two more ridges than recessions. In some respects, an airflow limiter, e.g., a second airflow limiter, e.g., Barrel Crown can comprise, e.g., one or two more recessions than ridges. In certain aspects, an airflow limiter, e.g., a second airflow limiter, e.g., Barrel Crown, can comprise, e.g., ~4-~30, ~6-~30, ~8-~30, ~10-~30, ~12-~30, ~14-~30, ~16-~30, ~18-~30, ~20-~30, ~22-~30, ~24-~30, ~26-~30, or ~28-~30 ridges, recessions, or both ridges and recessions (e.g., such values representing the number of each of ridges and recessions), such as, e.g., ~2-~28, ~2-~26, ~2-~24, ~2-~22, ~2-~20, ~2-~18, ~2-~16, ~2-~14, ~2-~12, ~2-~10, ~2-~8, ~2-~6, or ~2-~4 ridges, recessions or both ridges and recessions (e.g., such values representing the number of each of ridges and recessions), as in, for example, ~4-~28, ~6-~26, ~8-~24, ~10-~22, ~12-~20, ~14-~18, or, e.g., about 16 ridges, recessions, or both ridges and recessions (e.g., such values representing the number of each of ridges and recessions).

According to certain embodiments, an angle of between about 6 and about 60 degrees, such as, e.g., an angle of ~7-~60, ~8-~60, ~9-~60, ~10-~60, ~11-~60, ~12-~60, or ~13-~60 degrees, such as, e.g., ~6-~50, ~6-~40, ~6-~30, ~6-~20, or, e.g., ~6-~10 degrees, as in, for example, ~8-~50, ~8-~40, ~8-~30, ~8-~20, or ~8-~25 degrees, such as, e.g., between about 11 and about 13 degrees, e.g., an angle of about 12 degrees separates each recession of a Barrel Crown component, separates each ridge, or separate each recession and each ridge from the next (e.g., adjacent) respective recession or ridge.

In aspects, the number of airflow limiter (e.g., a Barrel Crown) fan ridge recessions and peaks (ridges) present in an airflow limiter, e.g., second airflow limiter (e.g., Barrel Crown), contributes to the specificity with which airflow through the device can be controlled. For example, an increased number of such features recessions and peaks/ridges of an airflow limiter, e.g., second airflow limiter, e.g., Barrel Crown, can increase the level of fine tuning a user can accomplish to control airflow (e.g., drag control) when using the delivery device, while a decreased number of such features can decrease the level of fine tuning a user can accomplish to control airflow during delivery device use.

In aspects, an airflow limiter, e.g., a second airflow limiter, e.g., Barrel Crown, can be made of any material described herein. In certain aspects, an airflow limiter, e.g., a second airflow limiter, e.g., Barrel Crown, is made of a metal or metal alloy, such as, e.g., gold, titanium, platinum, or, e.g., stainless steel. In particular aspects, an airflow limiter, e.g., a second airflow limiter, e.g., Barrel Crown, is made of stainless steel.

In aspects, an airflow limiter, e.g., a second airflow limiter, e.g., a Barrel Crown, is a custom-made component. In aspects, an airflow limiter, e.g., a second airflow limiter, e.g., Barrel crown is machined, cast, or otherwise custom manufactured for use in delivery devices described herein. In certain aspects, an airflow limiter, e.g., a second airflow limiter, e.g., Barrel Crown, is a feature of a larger component, such that it does not represent a physically separate component and its function(s) and feature(s) are elements of a device component further providing other feature(s) and functionality(ies) described herein. For example, in one aspect, an airflow limiter, e.g., a second airflow limiter, e.g., a Barrel Crown, e.g., its feature(s) and functionality(ies) as described herein, is a part of the mating component (e.g., tip assembly), mating component exterior or outer shell (e.g., Barrel) component, mating component exterior or outer shell protection component (e.g., Barrel Tube), or combination(s) thereof, optionally further including one or more element(s) participating in one or more other functionality(ies) of a delivery device.

In this respect and concerning any other applicable part, component, assembly, mechanism, function, feature, or operational aspect(s) of the invention, the invention also can be characterized as comprising a "means" for controlling airflow. In such a respect, any known equivalents of such airflow control part(s), component(s), or mechanism(s) can also be, e.g., are, incorporated into devices or methods of the invention. As with other sections similarly described herein, any of the part(s), component(s), or assembly(ies) of the invention can be, where suitable, described as means (e.g., the above-described airflow restrictor constituent, airflow limiter, second airflow limiter can be described as airflow control means or means for controlling or limiting airflow).

Movement of Volatile Compound Outlet Component (First Primary Component) Relative to Mating Component (Second Primary Component)

According to certain embodiments, a delivery device comprises at least two part(s), component(s), or assembly(ies) movable in relation to one another (e.g., a VCOC and mating component that are movable in relation to one another), such as movable around one or more axes with respect to each other, such as by rotating one about the other.

In aspects, a delivery device comprises a volatile compound outlet component (embodied/exemplified in aspects herein, as, e.g., a Body Assembly), and a mating component (embodied/exemplified in aspects herein, as, e.g., a Tip Assembly), capable of rotating, designed to rotate, or which rotate 360 degrees or more in relation to one another.

In aspects, a delivery device comprises a volatile compound outlet component and a mating component capable of rotating, designed to rotate, or which rotate 360 degrees or more in relation to one another in either direction. In aspects, delivery device comprises a volatile compound outlet component and a mating component capable of continuous rotation, e.g., multiple 360-degree rotations, in relation to one another in either direction.

In aspects, movement of, e.g., a volatile compound outlet component, and, e.g., a mating component (or one relative to the other) is accompanied by one or more indicator(s), e.g., visual indicator(s), tactile indicator(s), or both. In aspects, movement of, e.g., a volatile compound outlet component and, e.g., a mating component (or one relative to the other), is accompanied by a tactile indication of such movement. In aspects, movement of, e.g., a volatile compound outlet component and, e.g., a mating component (or one relative to the other) is accompanied by an audible indication of such movement.

In aspects, the audible indication, tactile indication, or both, of the movement two components as described above is provided by the interface of components of the airflow restrictor (the airflow control mechanism), e.g., first and second airflow limiters, e.g., the Body Crown and the Barrel Crown, rotating about or in relation to one another according to the rotation of the volatile compound outlet component and mating component about or in relation to one another. In aspects, the audible indicator, tactile indicator, or both the audible and tactile indicator(s) is/are caused by the changing interface between first and second components of the airflow control mechanism, e.g., airflow restrictor (airflow limiters). In aspects, the audible indicator, tactile indicator, or both the audible indicator and the tactile indicator, is/are caused by, e.g., the changing interface between fan-like features of the first and second airflow limiters (such fan-like features of airflow limiters being described herein). In aspects, the audible indicator, tactile indicator, or both the audible and tactile indicators is/are caused by, e.g., the alternating separation and reattachment of the volatile compound outlet component and the mating component as they rotate relative to one another.

In aspects, movement, e.g., rotation, of a first component, e.g., first primary component, relative to a second component, e.g., a second primary component (e.g., movement of a volatile compound outlet component relative to a mating component) yields an alternating at least partial separation and reuniting of the two components. In aspects, an engagement component, e.g., a selectable engagement component, e.g., a selectively releasable engagement component, e.g., the rapidly releasable force mechanism, e.g., the magnetic attraction, which selectively engages the two components maintains at least a detectable amount of contact between the two components as they rotate in relation to one another. However, in aspects the amount of contact between the two components alternatingly increases and decreases as the two components are rotated in relation to one another.

In aspects, the amount of interface between one, e.g., a first, airflow limiter and another, e.g., a second, airflow limiter decreases between one, some, most, generally all, substantially all, essentially all, or all (any) first airflow control setting(s) and one, some, most, generally all, substantially all, essentially all, or all (any) subsequent airflow control setting compared to the amount of interface between the airflow limiters at any first or second (starting and subsequent) airflow control setting as rotation occurs, and as, e.g., the volatile compound outlet component, comprising a first airflow limiter, e.g., Body Crown, and the mating component, comprising a second airflow limiter, e.g., Barrel Crown, alternatingly at least partially separate and reunite.

In aspects, the amount of surface area of a first airflow limiter making contact with a second airflow limiter decreases between one, some most, generally all, substantially all, essentially all, or all (any) first airflow control setting and one, some, most, generally all, substantially all, essentially all, or all (any) second airflow control setting compared to the amount of surface area of a first airflow limiter making contact with a second airflow limiter at any first or second (starting and subsequent) airflow control setting as rotation occurs. In aspects, the amount of surface area of a second airflow limiter making contact with a first airflow limiter decreases between one, some, most, generally all, substantially all, essentially all, or all (any) first airflow control setting and any second airflow control setting compared to the amount of surface area of a second airflow limiter making contact with a first airflow limiter at any first or second (starting and subsequent) airflow control setting as rotation occurs. This is also discussed elsewhere herein.

Airflow Restrictor (Airflow Control Mechanism)

According to certain embodiments, a delivery device comprises a means for airflow control (or drag control).

Such possible means have been described elsewhere herein. In aspects, such means are provided as airflow restrictor element(s).

In aspects, during normal operation of the delivery device described herein, air passes through the device according to an airflow path. In aspects, the airflow path begins at an entry point of the device located at the distal end of the device (away from where the device engages a user) and ends at an exit or outlet point of the device located at the proximal end of the device (the ends defining the length of the device).

In aspects, a delivery device comprises a passageway, also referred to as an airflow channel, allowing for air to pass from a distal end of the delivery device to a proximal end of the delivery device, wherein, e.g., the proximal end is the end of a delivery device nearest the device user and comprising a volatile compound outlet component (which may also be referred to herein as an volatile compound delivery facilitation component, e.g., a Mouthpiece), and the distal end being an end opposite from or distanced from the proximal end of the delivery device and comprising a mating component (which may be characterized as the "barrel end" or end of the device comprising a mating component).

In aspects, the airflow path or passageway beginning at the inlet and ending at the outlet of a delivery device is referred to herein as the "total airflow channel" or complete/entire airflow channel. In aspects, during operation, air enters the distal end of a delivery device and follows an airflow path through e.g., a mating component, through a volatile compound compartment (volatiles housing), e.g., insert compartment, e.g., Body Tube, or, e.g., through a mating component via a volatile compound compartment (volatiles housing), e.g., insert compartment, e.g., Body Tube; wherein, in embodiments, a volatile compound compartment (volatiles housing), e.g., insert compartment, e.g., Body Tube, can comprise one or more insert support(s) such as a compressible positioner, a fixed positioner, or both, and wherein the air passes through one or both of such insert supports; through one or more constituent(s) of an engagement component, such as, e.g., through an engagement mechanism, an engagement mechanism support component, or both; through, e.g., a component with which a user engages to receive volatile compound(s) exiting a device, e.g., a mouthpiece, or, e.g., any combination(s) of any or all thereof, in any suitable order. (See, for example, FIG. 2C of the figures provided herewith.)

According to certain aspects, the amount of air passing through the total airflow channel during operation of the device is at least partially regulated or controlled, e.g., is detectably or significantly impacted by, by an airflow restrictor (airflow control mechanism) present within the device which detectably or significantly reduces (relatively, compared to a maximum or adjacent section) the airflow channel, or at least partially blocks an inlet or outlet to the airflow channel as compared to an inner width or diameter.

In aspects, an airflow restrictor of a device herein can be any airflow restrictor (airflow control mechanism) capable of detectably or significantly impacting, modulating, or otherwise establishing the amount of air passing through a device. In aspects, an airflow control mechanism of device(s) herein, e.g., airflow restrictor, is any part, component, or mechanism which detectably or significantly reduces (relatively, compared to a maximum or adjacent section), the airflow channel, or at least partially blocks an inlet or outlet to the airflow channel as compared to an inner width or diameter. In aspects an airflow restrictor is any part, component, or mechanism allowing a user of a device to select, determine, or otherwise establish the amount of air passing through a device.

In aspects, delivery device(s) provided by the invention comprise an airflow restrictor which detectably or significantly limits the amount of airflow passing through a delivery device. In aspect, a delivery device provided herein comprises an airflow restrictor comprising at least one part or component which detectably or significantly limits the amount of airflow passing through a delivery device, referred to as an airflow limiter. In aspects, a/any part, component, or assembly which detectably or significantly limits the amount of airflow passing through a delivery device in one or more location(s) of an airflow channel can be, in aspects, considered a constituent of an airflow restrictor, e.g., be characterizable as an airflow limiter.

In aspects an airflow limiter may be present solely to function to limit or reduce the amount of airflow through a delivery device, such as, for example, by reducing the cross-sectional area of an airflow channel at the location of the airflow limiter. In aspects, an airflow limiter can be, e.g., a part or component present in a device which provide(s) one or more additional functionality(ies) to the delivery device, such as, e.g., insert support.

According to aspects, airflow limiter(s) can be static. In aspects, a static airflow limiter is a part, component, or portion of either thereof, that is not selectable by a user. In aspects, a static airflow limiter is a part, component, or portion of either thereof, that is not controllable by a user. In alternative aspects, an airflow limiter can be a part or component which provides a selectable airflow restriction, e.g., a selectable airflow control mechanism, such as, for example, establishing an "on/off", "open/closed," or, e.g., "first state/second state" of airflow control. In other aspects, the selectable airflow control changes the condition of airflow rather than turning airflow on or off. In still further aspects, an airflow limiter can be a part or component which provides controllable airflow, such that the degree of airflow control is establish-able by a user. In aspects, an airflow limiter can cooperate with one or more other/additional airflow limiter(s) to provide a controllable airflow restriction, e.g., a controllable control mechanism, such that the degree of airflow control is establish-able by a user. In aspects, a device also or alternative includes one or more features that modify airflow in a part of the device in an unselectable/uncontrollable manner, such as, e.g., by blocking one or more parts of the airflow pathway/channel, reducing the airflow channel diameter, etc.

In certain aspects, an airflow restrictor, e.g., airflow control mechanism, can be, e.g., a part, component, assembly, or mechanism that detectably or significantly modulates (adjusts) airflow by allowing at least a first and second delivery device part, component, or assembly (e.g., first primary and second primary components; i.e., volatile compound outlet component and corresponding mating component) to selectively move toward and away from one another, e.g., to move into and out of one another. In aspects, such an airflow restriction, e.g., airflow control mechanism, is characterizable as a mechanism similar to a needle valve mechanism. In aspects, an airflow restrictor, e.g., airflow control mechanism, can be, e.g., a part, component, assembly, or mechanism that detectably or significantly modulates (adjusts) airflow by dilation, e.g., one or more part(s), component(s), or assembly(ies) which, can, e.g., when acted upon (such as, e.g., by rotation or other mechanism), selectively enlarge or make smaller an opening having a size established by the positioning of such components. In aspects, such a mechanism can comprise one or more part(s), component(s), or assembly(ies) which selectively open or close a passageway or affect the size of a passageway therethrough at least generally the same way, at least substantially the same way, at least essentially the same way, or the same way in/from all directions. For sake of clarity, this type of mechanism can be exemplified by, e.g., the dilation of a pupil.

In aspects, an airflow restrictor or an airflow control mechanism of a delivery device provided herein provides a plurality of selectable airflow control settings and, when positioned along the airflow path through the device can selectively modulate how open or how closed the airflow path passageway is at its established position; thus, at least in part, controlling the amount of air passing through the device.

In one example, a delivery device can comprise an air passage (e.g., a portion of a total airflow channel) which passes through, e.g., the airflow restrictor (airflow control mechanism), e.g., first and second airflow limiters, e.g., a Body Crown and a Barrel Crown; through a mating component exterior or outer shell (e.g., a Barrel) or, e.g., in aspects, through a mating component exterior or outer shell protection mechanism (e.g., Barrel Tube); through a volatile compound compartment (volatiles housing), e.g., insert compartment, e.g., Body Tube; through a means for maintaining, delivering, or maintaining and delivering one or more volatile compounds (e.g., insert), wherein, in aspects, at least in part the air passes through a volatile compound compartment (volatiles housing), e.g., insert compartment, e.g., Body Tube, via an opening in an insert; through an insert support, e.g., compressible positioner (e.g., Insert spring); through an engagement component support (e.g., a Magnet Cover); through one or more components of an engagement component, e.g., one or more components of a selectively releasable engagement component (e.g., an engagement mechanism such as a Magnet, an engagement mechanism counterpart such as a Barrel Collar, or both); and through a component with which a user engages to receive air exiting a delivery device which typically comprises volatile compound(s), e.g., flavored compound(s) (e.g., a Mouthpiece which can include, e.g., in aspects, a supplement thereof (e.g., a Mouthpiece Tube)). In aspects, an airflow restrictor or an airflow restriction, (an airflow control mechanism) positioned within this pathway can selectively modulate how open or how closed this passageway is.

Characteristics of components of an airflow control mechanism (airflow restrictor) provided by the invention are described elsewhere herein. However, for sake of aiding the reader in understanding the airflow control mechanism, the following specific examples of an exemplary mechanism are provided.

In aspects, a delivery device comprises an airflow restrictor comprised of two or more, such as, e.g., three or more or four or more airflow limiters which cooperate with one another or, also or alternatively, with one or more other component(s) of a delivery device, to control or adjust the amount of air flowing or able to flow through a delivery device during its use. According to aspects, delivery device(s) described herein comprise an airflow restrictor adjustable by the movement of a first airflow limiter relative to a second airflow limiter. In aspects, the movement of the first airflow limiter relative to the second airflow limiter is a relational movement (as described elsewhere herein). In aspects, the movement of a first airflow limiter relative to a second airflow limiter is a concurrent or associated relational movement (as described elsewhere herein). In aspects, the movement of a first airflow limiter relative to a second airflow limiter is a rotational movement and, optionally, the rotation of a first airflow limiter relative to a second airflow limiter can comprise a rotation of between about 1 degree and about 360 degrees, such as, e.g., ~1 degree-~330 degrees, ~1 degree-~300 degrees, ~1 degree-~270 degrees, ~1 degree-~240 degrees, ~1 degree-~210 degrees, or, e.g., ~1 degree-~180 degrees, such as, e.g., ~30 degrees-~360 degrees, ~60 degrees-~360 degrees, ~90 degrees-~360 degrees, ~120 degrees-~360 degrees, ~150 degrees-~360 degrees, or, e.g., ~180 degrees-~360 degrees. In aspects, the movement of a first airflow limiter relative to a second airflow limiter can have any one or more of the movement characteristics described in this paragraph.

In one aspect, an airflow restrictor is a selectable, e.g., a controllable (or adjustable) airflow restrictor comprising a first airflow limiter and a second airflow limiter, wherein the first and second airflow limiters are in releasable contact with one another during normal operation of a delivery device. In aspects, first and second airflow limiters are capable of rotating, are designed to rotate, or can rotate, up to or more than 360 degrees relative to one another. In aspects, first and second airflow limiters are capable of rotating at least 360 degrees in either direction relative to one another. In aspects, first and second airflow limiters are capable of rotating, are designed to rotate, or can rotate, more than 360 degrees in either direction relative to one another, such as, e.g., capable of multiple full or more than full (e.g., rotation surpassing an initial starting position) rotations relative to one another in either direction. In aspects, first and second airflow limiters can be completely disengaged and reengaged from one another during normal operation of a delivery device. For example, such a complete disengagement can in aspects occur when, e.g., a means of maintaining, delivering, or maintaining and delivering one or more volatile compounds, e.g., an insert, e.g., a removable insert, is inserted or removed from the delivery device.

In certain aspects, the degree of overlap or interface between two or more airflow limiters establishes an airflow control setting. In aspects, the degree of overlap or interface between two or more, e.g., a first and a second, airflow limiters establish the degree of "openness" or "closure" of an airflow restrictor (and, similarly, the degree of openness or closure of an airflow passageway). In aspects, maximum overlap, e.g., maximum interface, of a first airflow limiter and second airflow limiter establishes the device in a "maximally open" position, such that the delivery device is in a configuration providing the lowest amount of drag and the highest level of possible airflow. Further, the smallest possible overlap or the lowest degree of overlap, e.g., in aspects, a lack of any significant overlap, e.g., a lack of significant interface, of first and second airflow limiters establishes the device in a "maximally closed" position, such that the device is in a configuration providing the highest amount of drag and the lowest level of possible airflow. An overlap of two airflow limiters between these two extreme positions detectably or significantly modulates the airflow (and, e.g., drag), accordingly. In certain aspects, a sufficient amount of air can still be drawn through a delivery device upon application of a suitable amount of suction by a user to render the device operable when the delivery device is in a maximally closed position.

In one aspect, when an airflow restrictor is in a state or configuration representing its most open position, an airflow restrictor provides an airflow channel through the device having a cross sectional area which is about 40% to about 60%, such as, e.g., ~42%-~60%, ~44%-~60%, ~46%-~60%, ~48%-~60%, or, e.g., ~50%-~60%, or, e.g., ~40%-~58%, ~40%-~56%, ~40%-~54%, ~40%-~52%, or ~40%-~50%, as in, for example, ~42%-~58%, ~44%-~56%, ~46%-~54%, ~48%-~52%, or, e.g., ~50% of a cross-sectional area of at least one portion of an airflow channel otherwise present in, e.g., at least a portion of, the device.

In aspects, when an airflow restrictor is in a state or configuration representing its most open position, the airflow restrictor provides an airflow channel through the device providing for the flow of a volume of air which is about 40% to about 60%, such as, e.g., ~42%-~60%, ~44%-~60%, ~46%-~60%, ~48%-~60%, or, e.g., ~50%-~60%, or, e.g., ~40%-~58%, ~40%-~56%, ~40%-~54%, ~40%-~52%, or ~40%-~50%, as in, for example, ~42%-~58%, ~44%-~56%, ~46%-~54%, ~48%-~52%, or, e.g., ~50% of the volume of air which would otherwise be able to flow through the device if the airflow restrictor were not present in the device.

In aspects, an airflow restrictor blocks at least about 25%, ≥~30%, ≥~35%, ≥~40%, ≥~45%, ≥~50%, ≥~55%, ≥~60%, ≥~65%, ≥~70%, ≥~75%, ≥~80%, ≥~85%, or, e.g., ≥~90%, of the cross-sectional area of at least one portion of an airflow channel through the device otherwise present at the location of the airflow restrictor along the airflow channel, while at one or more other locations or portions of the airflow channel passing through the device, the airflow channel has a cross sectional area which is blocked or limited by one or more components of the delivery device or, e.g., is blocked by an ancillary product designed for use therewith (e.g., an insert maintaining, releasing, or maintaining and releasing volatile compound(s) for delivery by the device), to a greater degree than the blockage established by the airflow restrictor. Also or alternatively, in aspects, an airflow restrictor blocks at least about 25%, ≥~30%, ≥~35%, ≥~40%, ≥~45%, ≥~50%, ≥~55%, ≥~60%, ≥~65%, ≥~70%, ≥~75%, ≥~80%, ≥~85%, or, e.g., ≥~90%, of the cross-sectional area of at least one portion of an airflow channel otherwise present at the location of the airflow control mechanism along the airflow channel, while at one or more other locations or portions of the airflow channel passing through the device, the airflow control channel has a cross sectional area which is blocked by one or more components of the delivery device or an ancillary product designed for use therewith to a lesser degree than the blockage established by the airflow restrictor, such as, for example, limitations to an airflow channel which may be present due to an insert support, such as, e.g., a compressible positioner, e.g., Insert spring.

In aspects, adjustment of an airflow restrictor, e.g., by moving, e.g., rotating two airflow limiters in relation to one another (which, e.g., in aspects is accomplished by the rotation of a volatile compound outlet component and a mating component relative to one another) is accompanied by an indicator, such as, e.g., one or more indicators. Exemplary indicator(s) and example(s) thereof are provided elsewhere herein. In aspects, for example, a tactile indication is accompanied by an audible indication of such movement. In aspects, modification of the airflow restrictor from one, a plurality of, or all, e.g., any, first airflow setting(s) to one, a plurality of, or all, e.g., any, second airflow setting(s) is accompanied by one of two differentiable tactile indicators, one of two differentiable audible indicators, or by both one of two differentiable tactile indicators and one of two differentiable audible indicators of such a modification. In aspects, one of the two differentiable tactile indicators, audible indicators or both, accompanying the modification of the airflow control mechanism from a first airflow setting to a second airflow setting is only experienced once in a 360-degree rotation of a first airflow control component relative to a second airflow control component. In aspects, they occur at least substantially simultaneously, e.g., at the same airflow control setting. In aspects, the tactile indication, audible indication, or both of the status of an airflow control mechanism being completely closed is detectably different (differentiable) from the tactile indication, audible indication, or both received upon movement between a, a plurality of, or all, e.g., any, first airflow setting and e.g., a plurality of, or all, e.g., any, other second or subsequent airflow setting where the second airflow setting does not place the status of the airflow control mechanism in a completely closed position. In aspects, this differentiable tactile indication, audible indication, or both, is experienced only once in a 360-degree rotation of a first airflow limiter relative to a second airflow limiter.

In aspects, a maximally closed configuration of a delivery device is indicated by a detectably or significantly larger indicator (e.g., an indicator having a greater magnitude, such as an audible indicator having a distinguishably higher decibel value) than that of any other airflow control setting. In aspects, such distinguishable indication(s) is only received once in a 360-degree rotation of a first airflow limiter relative to a second airflow limiter (e.g., Body Crown relative to a Barrel Crown), or, e.g., once in a 360-degree rotation of a volatile compound outlet component relative to a mating component. As stated elsewhere, this operational status can also be accompanied by, e.g., a visual indication of such status (e.g., as indicated by the spatial orientation between two visual indicators).

In aspects, indicators, e.g., tactile indication(s), audible indication(s), or both, of the modification of an airflow control mechanism (airflow restrictor) is derived from the changing degree of contact between a first airflow limiter and a second airflow limiter as first and second airflow limiters are rotated in relation to (relative to) one another. In aspects, the degree of contact between first and second airflow limiters is reduced between a, a plurality of, or all, e.g., any, first and second airflow control setting compared to the amount of contact between the first airflow limiter and the second airflow limiter in a, a plurality of, or all, e.g., any, first airflow control setting or second airflow control setting. This can occur, e.g., as the two airflow limiters detectably separate from one another as they are rotated in relation to one another. In aspects, separation occurs by the alternating interface of feature(s) on each of the first and second airflow limiters which do not mate, nest, or otherwise interface to the same degree as other feature(s) on/of each of the first and second airflow limiters. For example, in embodiments wherein each of a first and second airflow limiter comprise alternating peaks/ridges and recessions, when peak(s) of each of the first and second airflow limiter interface, the two components are pushed apart and degree of interface between the first and second airflow limiters decreases. When peaks(s) of one airflow limiter interface with recession(s) of another airflow limiter, the two components are brought closer together and their degree of interface increases. This alternating separation and reunification can yield a tactile indication, an audible indication, or both. In aspects, a distinguishably different tactile indicator, audible indicator, or both is received when a single, unique (relative to other) elements of each of the first and second airflow control components meet during a rotation, causing, e.g., a larger separation of the two components.

According to aspects, an airflow restrictor is adjustable via a gradual mechanism, such that, e.g., airflow control can be adjusted over a continuous gradient. In alternative aspects, an airflow restrictor is not adjustable via a gradual mechanism, e.g., cannot be adjusted over a continuous gradient.

In aspects, the airflow restrictor of a delivery device is adjustable in pre-defined increments. In aspects, each pre-defined incremental adjustment of the airflow restrictor provides a pre-determined increase or pre-determined decrease in airflow through the device or, e.g., increased or decreases the amount, volume, rate, or any combination thereof, of airflow passing through the device upon application of a given amount of suction pressure by a pre-determined amount.

In aspects, an airflow restrictor provided herein is adjustable/controllable in pre-defined increments, such as, e.g., at least about 3, ≥4, ≥5, ≥6, ≥7, ≥8, ≥9, ≥10, ≥11, ≥12, ≥13, ≥14, ≥15, ≥16, ≥17, ≥18, ≥19, ≥20, ≥21, ≥22, ≥23, ≥24, ≥25, ≥26, ≥27, ≥28, ≥29, or, e.g., ≥30 or more, such as, e.g., ~3-~30, ~3-~25, ~3-~20, or ~3-~15, e.g., ~5-~30, ~10-~30, or ~15-~30 (e.g., 5-100, 5-50, or 5-40 increments), such as, e.g., ~4-~28, ~6-~24, ~8-~20, or, e.g., ~10-~18 pre-defined increments.

In certain aspects, an airflow restrictor decreases or increases the average airflow rate through a delivery device by between about 0.01-about 1 standard liter(s) per minute (SLPM), on average, per each single airflow control setting defined adjustment increment, such as, e.g., ~0.02 SLPM-~1 SLPM, ~0.04 SLPM-~1 SLPM, ~0.06 SLPM-~1 SLPM, ~0.08 SLPM-~1 SLPM, ~0.1 SLPM-~1 SLPM, ~0.12 SLPM-~1 SLPM, ~0.14 SLPM-~1 SLPM, ~0.16 SLPM-~1 SLPM, ~0.18 SLPM-~1 SLPM, or ~0.2 SLPM-~1 SLPM, e.g., ~0.01 SLPM-~0.9 SLPM, ~0.01 SLPM-~0.8 SLPM, ~0.01 SLPM-~0.7 SLPM, ~0.01 SLPM-~0.6 SLPM, ~0.01 SLPM-~0.5 SLPM, ~0.01 SLPM-~0.4 SLPM, ~0.01 SLPM-~0.3 SLPM, or ~0.01 SLPM-~0.2 SLPM, as in, for example, ~0.02 SLPM-~0.9 SLPM, ~0.04 SLPM-~0.8 SLPM, ~0.06 SLPM-~0.7 SLPM, ~0.08 SLPM-~0.6 SLPM, ~0.08 SLPM-~0.5 SLPM, ~0.1 SLPM-~0.4 SLPM, ~0.12 SLPM-~0.4 SLPM, ~0.14 SLPM-~0.4 SLPM, ~0.16 SLPM-~0.4 SLPM, ~0.18 SLPM-~0.3 SLPM, or, e.g., ~0.2 SLPM, on average, per each single airflow control setting adjustment increment. In aspects, such values represent an exemplary device user, e.g., an average device user. In aspects, such rates can vary based upon suction application characteristic(s), e.g., inhalation characteristics, of a user (e.g., speed and depth of suction). In aspects, the flow rate through a delivery device is at least generally, at least substantially, at least essentially, is essentially, or is linear across a series of sequential airflow control settings. In aspects, airflow control settings can be characterized by their aperture angle (e.g., the angle of one or more airflow device limiters or element(s)/feature(s) thereof, e.g., fan(s), peak(s) or ridge(s) thereof). In aspects, the flow rate through a delivery device is decreased in an at least generally, at least substantially, at least essentially, essentially, or completely linear manner as a user incrementally adjusts the airflow control mechanism (airflow restrictor) from a first, completely open, state to a second, completely closed state. In aspects, the flow rate through the delivery device is increased in an at least generally, at least substantially, at least essentially, essentially, or completely linear manner as a user incrementally adjusts the airflow control mechanism (airflow restrictor) from a first, completely closed, state to a second, completely open state. In aspects, such a pattern is present for an average user or, e.g., any user of the device. In aspects, while the specific average flow rate through the device may vary from user to user across specific airflow control settings, the average pattern of average airflow flow rate through a delivery device, e.g., increasing or decreasing in an at least generally, at least substantially, at least essentially, essentially, or completely linear pattern, is observed across at least generally all, at least substantially all, at least essentially all, essentially all, or all device users. In aspects, plotting airflow device control mechanism aperture angle vs. inhalation airflow rate in SLPM yields a line having an R-squared value of at least about 0.7, such as, e.g., at least about 0.75, at least about 0.8, at least about 0.85, at least about 0.9, or, e.g., at least about 0.95.

In aspects, the average airflow rate through a delivery device either increases or decreases, depending on how the airflow restrictor (airflow control mechanism) is manipulated, by an amount of between about 1% and about 20% with each single airflow control setting adjustment. That is, in aspects, with each incremental increase or incremental decrease of the airflow control setting, the average airflow rate is increased or decreased by ~2%-~20%, ~3%-~20%, ~4%-~20%, ~5%-~20%, ~6%-~20%, ~7%-~20%, ~8%-~20%, ~9%-~20%, or, e.g., ~10%-~20%, e.g., ~1%-~19%, ~1%-~18%, ~1%-~17%, ~1%-~16%, ~1%-~15%, ~1%-~14%, ~1%-~13%, ~1%-~12%, ~1%-~11%, or, e.g., ~1%-~10%, such as, for example, ~2%-~19%, ~3%-~18%, ~4%-~17%, ~5%-~16%, ~6%-~15%, ~7%-~14%, ~8%-~13%, ~9%-~12%, or, e.g., ~10%-~12%, such as, e.g., by about 11%.

In aspects, with each single airflow control setting incremental adjustment, the average airflow rate is modified, e.g., either increased or decreased, by an amount representing between about 1% and about 10% (on average) of the average maximum airflow rate through the device when the airflow restrictor (airflow control mechanism) is in a maximally open configuration. That is, in aspects, with each single airflow control setting incremental adjustment, the average airflow rate is either increased or decreased (depending on how the airflow control mechanism is manipulated) by an amount representing ~1%-~9%, ~1%-~8%, ~1%-~7%, ~1%-~6%, or, e.g., ~1%-~5%, such as, e.g., ~2%-~10%, ~3%-~10%, ~4%-~10%, or ~5%-~10%, such as, for example, ~2%-~9%, ~3%-~8%, ~4%-~7%, ~4%-~6%, or, e.g., in aspects, by an amount of about 5% on average.

In another aspect, the airflow restrictor (airflow control mechanism) decreases the average airflow through the device by between about 20% and about 100%, on average, when modified from its maximum airflow configuration (e.g., maximally open position) to its minimum airflow configuration (maximally closed position), such as, e.g., by ~20%-~98%, ~20%-~96%, ~20%-~94%, ~20%-~92%, ~20%-~90%, ~20%-~88%, ~20%-~86%, or ~20%-~84%, e.g., ~25%-~100%, ~30%-~100%, ~35%-~100%, ~40%-~100%, ~45%-~100%, ~50%-~100%, ~55%-~100%, ~60%-~100%, ~65%-~100%, ~70%-~100%, ~75%-~100%, ~80%-~100%, or ~85%-~100%, such as, e.g., ~25%-~98%, ~30%-~96%, ~40%-~94%, ~45%-~92%, ~50%-~90%, ~55%-~90%, ~60%-~90%, ~70%-~90%, ~80%-~90%, ~82%-~88%, ~82%-~86%, or, e.g., by about 84%.

In aspects, airflow customization/control provides for a delivery device user to modify the amount/concentration/volume of one or more compound(s) received by the user, e.g., received by the mouth of the user, upon application of suction to the device. In aspects, over the course of use of a single insert, e.g., removable insert, as (or if) the amount of compound(s) available from the insert decreases, the airflow restrictor provided by the airflow control mechanism can be adjusted. In aspects, such adjustment can provide for an at least generally consistent amount of compound(s) being delivered over at least portion of the lifespan of the insert, e.g., removable insert, such as, e.g., in aspects over the course of a majority of the lifespan of the insert if the insert is disposable (one-time use, as in one time charge or fill with composition(s) comprising volatile compound(s)) or e.g., over the course of a single charge with or fill of compound(s) of an insert if such an insert is reusable (reusable here meaning having the ability to be re-filled or re-charged with composition(s) comprising volatile compound(s)).

According to aspects, one or more part(s), component(s), or assembly(ies) of an airflow control mechanism (e.g., airflow restrictor), or, e.g., feature(s) thereof, can provide two or more discernably separate functions. In one aspect, an airflow control mechanism described herein comprises a component wherein one feature of the component participates in the control of the amount of airflow through a delivery device, e.g., blocking a portion of the cross-sectional area of an airflow path at one location or portion of an airflow path through a device. In certain aspects, the same airflow component participating in airflow control (airflow limiter) can comprise at least a second feature providing a distinctly different, e.g., additional functionality. In aspects, such a distinctly different functionality can be, e.g., participation in the positioning, e.g., stable positioning, of a solid material device maintaining, releasing, or maintaining or releasing volatile compound(s) (i.e., insert, e.g., removable insert) for delivery by the delivery device. In certain aspects, a component of an airflow control mechanism can comprise a feature participating in the stable maintenance of a solid material device maintaining/releasing volatile compound(s) (e.g., insert or removable insert). In certain aspects, such a feature is a fixed positioner. In aspects, such a feature cooperates with one or more other components of a device to provide the stable maintenance of an insert, such as, e.g., cooperating with a compressible positioner to provide stable maintenance of an insert. In further aspects, a feature of an airflow control mechanism component (airflow limiter) can provide a functionality or characteristic of a device which detectably or significantly impacts the ease of use of the device. In aspects, an airflow restrictor component can provide, by participating in the establishment of an insert in a particular position, a physical characteristic such as a recess or gap to allow for finger access to a portion of the device, e.g., to facilitate removal of an insert. Such functionality is further described elsewhere herein. Accordingly, in aspects, airflow control mechanism(s) (airflow restrictor(s)) described herein can comprise one or more component(s) (limiter(s)) providing detectably or significantly different functionality, such as, e.g., airflow control, stable positioning of an insert, and, e.g., access to an insert facilitating its insertion into a device, removal from a device, or both.

In certain aspects, the positioning, e.g., location of the airflow restrictor (airflow control mechanism) within the device provides a detectably or significantly different experience using, or detectably or significantly different functionality of, the delivery device compared to that provided when the airflow restrictor is positioned at a different location within the device. In certain aspects, the positioning of the airflow control mechanism (airflow restrictor) within the device provides a detectably or significantly different flavor delivery, longevity of flavor delivery, or both to the device user compared to that provided by a similar or the same device wherein the airflow control mechanism is located in a different position within the device.

According to certain aspects, wherein the proximal end of the device is the outlet end, and the distal end of the device is the inlet end, the airflow control mechanism, e.g., at least one part, component, or portion of an airflow restrictor is positioned distally from a volatile compound compartment (volatiles housing), e.g., insert compartment, e.g., Body Tube or, e.g., is positioned at the distal end thereof. In aspects, a solid material device maintaining, releasing, or maintaining and releasing volatile compound(s), e.g., insert, e.g., removable insert, is positioned within a device proximally to an airflow control mechanism. In aspects, an airflow through a device first encounters an airflow control mechanism, then later or subsequently encounters an insert.

In certain aspects, positioning an airflow control mechanism (airflow restrictor) described herein in front of, e.g., ahead of, or prior to, an insert comprising volatile compound(s) within an airflow path/passageway (airflow channel) of a delivery device described herein, detectably or significantly increases volatile compound volatility compared to positioning the airflow control mechanism behind, after, or later within an airflow path/passageway of a device than an insert comprising volatile compound(s). In certain aspects, positioning an airflow control mechanism (airflow restrictor; e.g., one or more airflow limiter(s)) described herein in front of, e.g., ahead of, or prior to, an insert comprising volatile compound(s) within an airflow path/passageway (airflow channel) of a delivery device described herein, detectably or significantly reduces air pressure about the insert, allowing, in aspects, volatile compound(s) present therein to evaporate or, e.g., diffuse, from the insert at a faster rate compared to the rate of release of such volatile compound(s) when the airflow control mechanism (airflow restrictor; e.g., one or more airflow limiter(s)) is positioned behind, after, or later within an airflow path/passageway of a device than an insert comprising volatile compound(s). In aspects, positioning an airflow control mechanism (airflow restrictor; e.g., one or more airflow limiter(s)) described herein in front of, e.g., ahead of, or prior to, an insert (e.g., more distal from a user than an insert) comprising volatile compound(s), e.g., flavored volatile compound(s) within an airflow path passageway (airflow channel) of a delivery device described herein, detectably or significantly increases the amount of (or provides a detectably or significantly increased amount of) volatile compound(s) to a user of the device, or, e.g., provides a user of a device more flavor, than is provided when the airflow restrictor (airflow control mechanism; e.g., one or more airflow limiter(s)) is positioned behind, after, or later than an insert comprising volatile/flavored volatile compound(s) within an airflow path/passageway (airflow channel) of such a device (e.g., when the airflow control mechanism or airflow restrictor is positioned more proximal to a user than an insert).

In aspects, an airflow restrictor described herein is a device for controlling volatile compound delivery, e.g., flavored compound delivery, to a user of a delivery device comprising such an airflow control mechanism. In aspects, delivery devices described herein comprise a mechanism for controlling volatile compound delivery, e.g., flavored compound delivery, to a user of the delivery device, the mechanism comprising one or more characteristic(s) of airflow restrictor(s), e.g., airflow control mechanism(s), or component(s)/feature(s) thereof described herein.

In one specific aspect, the invention provides a delivery device wherein the device comprises a first component (e.g., a first primary component, e.g., volatile compound outlet component) and a second component (e.g., second primary component, e.g., mating component) rotatable in relation to one another, wherein each of the first and second components have at least a portion visible on the exterior of the device, and wherein the device further comprises an airflow restrictor, and sill further wherein the status of the airflow restrictor (e.g., degree to which the device is open to airflow therethrough) is indicated by (a) the positioning of one or more indicators, e.g., one or more visually discernable indicator(s), tactilely discernable indicator(s), or one or more indicator(s) which is/are both visually and tactilely discernable, present on an external surface of the first component of the device, e.g., volatile compound outlet component, when interpreted in relationship to the positioning of one or more indicators, e.g., one or more visually discernable indicator(s), tactilely discernable indicator(s), or one or more indicator(s) which is/are both visually and tactilely discernable, present on the external surface of the second component of the device, e.g., mating component, (b) a tactile indication when the first component of the device and the second component of the device are rotated relative to one another, (c) an audible indication when the first component of the device and second component of the device are rotated relative to one another, or (d) any combination of any or all of (a), (b), and (c).

In this and other part, component, assembly, mechanism, function, feature, or operational aspect(s) of the invention, the invention also can be characterized as comprising a "means" for controlling airflow through a device used in the delivery of volatile compound(s), e.g., flavored volatile compound(s), to the device user, or, e.g., a "means" for controlling the delivery of volatile compound(s), e.g., flavored volatile compound(s), to a delivery device user. In such a respect, any known equivalents of such airflow control or controlled volatile compound delivery mechanisms can also be, e.g., are, incorporated into device(s) or method(s) of the invention. As with other sections similarly described herein, any of the part(s), component(s), or assembly(ies) of the invention can be, where suitable, described as means (e.g., the above-described airflow control mechanism, volatile compound delivery control mechanism or mechanism accomplishing both, can be described as airflow control means, volatile compound delivery control means, or means for controlling airflow or means for controlling volatile compound delivery).

Indicator(s)

According to certain aspects, delivery device(s) herein can comprise one or more indicator element(s) ("indicator(s)"). In aspects, an indicator can be any discernable characteristic which may change during use of a delivery device. In aspects, an indicator can be discernable by any human sense, such as sound, sight, smell, taste, or touch.

According to certain aspects, an indicator can be a functional indicator. In aspects, a "functional indicator" is an indicator which provides information. In aspects, such information can be, e.g., information concerning the operability of the delivery device or the operative state of one or more part(s), component(s), assembly(s), or mechanism(s) of a device; information concerning the position, e.g., spatial orientation, of one or more part(s), component(s), or assembly(ies) of a delivery device; or both. Accordingly, in aspects, a functional indicator is characterizable as an operational indicator. In other aspects, a functional indicator is a "positional indicator." In certain aspects, an indicator provides information to a delivery device user regarding both the functional or operational state of the delivery device and the position or spatial orientation of one or more part(s), component(s), or assembly(ies) or, e.g., the relational status between two or more part(s), component(s), or assembly(ies). Functional indicator(s) can provide information through any suitable indication mechanism or means, such as, e.g., by any means discernable by a human sense (e.g., sound, sight, smell, taste, or touch). In certain aspects, the indicator is a visual indicator, e.g., in aspects, an indicator provides a visual indication. In aspects, the indicator is an auditory indicator, e.g., in aspects an indicator provides an auditory indication. In certain aspects, the indicator is a tactile indicator, e.g., in aspects, an indicator provides a tactile indication.

According to certain embodiments, delivery device(s) herein comprise two or more indicators. In aspects, two or more indicators(s) can be of the same type (e.g., two or more visual indicators). In aspects, two or more indicator(s) can be of different types (e.g., one indicator can be, e.g., a visual indicator while another can be, e.g., an auditory indicator). In aspects, three or more indicators can be, comprise some overlap, such as, e.g., one indicator may be a tactile indicator while two or more other indicator(s) can be, e.g., visual indicators. In certain aspects, delivery device(s) provided herein comprise indicators of at least two different types in terms of indication (e.g., visual and auditory) or nature (e.g., operational or positional).

In certain aspects, an indicator can be classified as belonging to multiple types (e.g., auditory and tactile) and, e.g., nature (e.g., operational or positional). In aspects, an indicator can be classified as belonging to at least one indicator type classification and at least one indicator nature classification. Stated alternatively, this exemplifies that indicator(s) can be classified into multiple categories. For example, a delivery device provided herein can comprise, e.g., indicator(s) that can be classified as two or more of tactile, auditory, and visual. In aspects, an indicator of one type may also co-occur with or be otherwise associated with an indicator of another type. E.g., a tactile indicator can occur under some or all conditions as an auditory indicator, and, e.g., in aspects, and indicate position, status, or both, of one or more feature(s) of a delivery device. In one particular example, a groove element (e.g., #102 in FIG. 1C) can be provided that can both seen (e.g., operating as a visual indicator) and felt (e.g., operating as a tactile indicator). In aspects, the orientation of the groove indicator indicates the spatial orientation of one or more device parts(s), component(s), or assembly(ies) which cannot otherwise be discerned by observing the device when the device is in a ready-to-use state (e.g., such part(s), component(s), or assembly(ies) are internal and not externally visible). Further, such a groove can be associated with an audible indication (e.g., a "click") or a further tactile indication (e.g., a "vibration" or "snap") when such a groove is oriented in a particular arrangement with one or more other indicators, e.g., when a part, component, or assembly in fixed association with the groove is positioned in a particular configuration relative to another device part, component, or assembly, though such auditory or additional tactile indication(s) is/are not caused directly by, e.g., the groove element.

As alluded to the in above example, an indicator can, in aspects, be characterized as a relational indicator. A relational indicator is, e.g., an indicator which provides information based on its relationship to another indicator. Continuing the example above, the groove element, when aligned with one or more other indicator(s) of a device, e.g., another visual or tactile indicator on a delivery device, can indicate an operational status of a device, a positional status of one or more, e.g., two or more part(s), component(s), or assembly(ies), or both.

Tactile Indicator(s)—Touch-Discernable Indicators

In aspects, a tactile indicator can simply be an indicator discernable by touch. Notably, while the term "tactile indicator" is used, such an indicator can, in aspects, also be detectable by sight. In some aspects, a tactile indicator may be useful by a user with impaired vision In aspects, a tactile indicator is a raised surface or feature relative to adjacent surface(s) or a depressed surface or feature relative to adjacent surface(s) wherein the difference in elevation is discernable by touch, a surface or feature made of a different material, having a different feel (e.g., rough vs. smooth) wherein the difference in material is discernable by touch, having a different contour (e.g., rounded vs. flat) wherein the difference in contour is discernable by touch, and the like.

In aspects, a tactile indicator can represent a change in elevation or, e.g., contour (e.g., as provided by a raised or protruded element, a recessed element such as a groove or gap, or, e.g., a flattened element). In such aspects, when an otherwise rounded delivery device is placed on a flat surface such as a desk or table, such a tactile indicator can act as a stopping mechanism to prevent the device from rolling, thus such a feature is further characterizable as a device stabilizer.

In aspects, delivery device(s) provided herein comprise at least one tactile indicator discernable by touch. In aspects, delivery device(s) provided herein comprise at least one tactile indicator discernable by touch present on an external surface of a volatile compound outlet component. In aspects, delivery device(s) provided herein comprise at least one tactile indicator discernable by touch present on an external surface of a mating component. In aspects, delivery device(s) provided herein comprise at least one tactile indicator discernable by touch present on an external surface of a volatile compound outlet component and at least one tactile indicator discernable by touch present on a mating component. In aspects, delivery device(s) provided herein comprise at least one tactile indicator discernable by touch on a volatile compound outlet component, at least one tactile indicator discernable by touch on a mating component, or both, wherein (a) at least one of the tactile indicator(s) discernable by touch indicate(s) a positional status, e.g., spatial orientation, of at least one internal (non-externally visible) part, component, or assembly, such as, e.g., a volatile compound compartment, e.g., insert compartment, e.g., a Body Tube, (b) when two indicator(s) are present, the orientation of one relative to the other indicates an operational status of the device, such as, e.g., a specific airflow control setting.

Visual Indicator(s)—Sight Discernable Indicators

According to certain aspects, delivery device(s) provided by the invention can comprise at least one, such as, e.g., ≥2, ≥3, ≥4, or ≥5 visual indicators, e.g., indicators which are detectable by a user of the device through visual inspection/observation (e.g., exist on an exterior surface of the device or are otherwise able to be detected by a user by sight), e.g., when the device is in a ready to use state. Notably, while the term "visual indicator" is used, such an indicator can, in aspects, also or alternatively be detectable by touch (e.g., a groove or protrusion that functions as an indicator can be both seen and felt by a user).

In aspects, visual indicator(s), when viewed independently, in conjunction with visual indicator(s) provide an indication of one or more characteristics of the device, such as, e.g., the spatial orientation of a non-visible (e.g., internal) delivery device component, the operational status of one or more delivery device mechanisms, e.g., an airflow control setting, or both. In aspects, one or more visual indicator(s) can be present external surface(s) of a volatile compound outlet component, mating component, or both.

In aspects, visual indicator(s) can comprise or be any distinguishable, e.g., externally distinguishable, mark, shape, feature, or otherwise distinguishable element. In aspects, visual indicator(s) comprise(s) a raised element (e.g., an elevated element which is detectable by both sight and touch), or a recessed element (e.g., a carving or indentation which is detectable by both sight and touch), a tick mark, intentional scratch, carving, engraved element, painted marking, stamped marking, or any other type of observable marking such as, e.g., a line or other shape, number, letter, symbol, or collection of letters, numbers, or symbols (e.g., a word, name, or other product identifier such as a logo), or image.

In aspects, a visual indicator can comprise a raised or protruded element. In such aspects, when an otherwise rounded delivery device is placed on a flat surface such as a desk or table the visual indicator can act as a stopping mechanism to prevent the device from rolling, thus such a feature is further characterizable as a device stabilizer.

In one aspect, a delivery device can comprise at least two visual indicators. In aspects, a delivery device can comprise at least two visual indicators wherein at least one visual indicator is different from at least one other visual indicator in one or more ways, such as, e.g., by size, shape, color, feel (e.g., feel to the touch, such as, e.g., one being raised and one being recessed), position (e.g., placement on the device or across device part(s), component(s), or assembly(ies)), or any other visually differentiable characteristic. In other aspects, a delivery device can comprise at least two visual indicators, wherein at least two of the visual indicators are at least generally the same, at least substantially the same, at least essentially the same, essentially the same, or are the same as one another.

In an aspect, a delivery device comprises at least two visual indicators wherein at least one visual indicator is a tick mark and at least one visual indicator is a symbol/product logo.

In one aspect, the invention provides a delivery device comprising a volatile compound outlet component and a mating component movable relative to one another. In one aspect, the volatile compound outlet component of the delivery device comprises at least one visual indicator, e.g., on an external surface. In aspects, the delivery device comprises at least one visual indicator present on the exterior of the device positioned on a device part, component, or assembly which is fixedly attached to, either directly or indirectly, an internal component, e.g., a volatile compound compartment, e.g., an insert compartment, e.g., a Body Tube. For example, a visual indicator can be present on an external surface of a volatile compound outlet component, e.g., mouthpiece, or an extension thereof, e.g., on an external surface of, for example, an engagement component support (e.g., Magnet Cover). In aspects, the spatial orientation of the at least one visual indicator indicates the spatial orientation of at least one component of the device which is not externally visible. In aspects, the internal component is a volatile compound compartment, e.g., insert compartment, e.g., Body Tube. Thus, in aspects, the spatial orientation of the visual indicator can indicate the spatial orientation of the volatile compound compartment, e.g., insert compartment, e.g., Body Tube, indicating, for example, the orientation of the portion of volatile compound compartment, e.g., insert compartment, e.g., Body Tube, which is not completely enclosed in at least one direction, e.g., which is not circumferentially enclosed (in at least one direction), by a wall, e.g., a circumferentially disposed wall (e.g., the orientation of the at least partially open portion of the volatile compound compartment, e.g., insert compartment, e.g., Body Tube.)

In aspects, at least one visual indicator present on the volatile compound outlet component is positioned such that it is on the opposite side of a delivery device from the position of an airflow limiter (e.g., a Body Crown). In aspects, the fan-like feature of an airflow limiter, e.g., a first airflow limiter (e.g., Body Crown), is positioned on the opposite side of the device from a visual indicator on a volatile component outlet component. In aspects, the spatial orientation of the at least one visual indicator positioned on the volatile compound outlet can indicate the position of a first airflow limiter (Body Crown).

In a specific example, in aspects, when a visual indicator on a volatile compound outlet component is spatially oriented upward, the opening within a volatile compound compartment, e.g., insert compartment, e.g., Body Tube, is oriented upward; and the fan-like feature of a first airflow limiter, e.g., Body Crown, is positioned on the lower half of the delivery device relative to the opening within the volatile compound compartment, e.g., insert compartment, e.g., Body Tube.

In a further aspect, the mating component of a delivery device comprises at least one visual indicator. In aspects, the at least one visual indicator present on the mating component is positioned such that it corresponds to the positioning of an airflow limiter, e.g., second airflow limiter, (e.g., Barrel Crown). In aspects, the positioning of the visual indicator on the mating component, e.g., the mating component exterior or outer shell (e.g., Barrel) corresponds with the fan-feature of an airflow limiter, e.g., a second airflow limiter (e.g., Barrel Crown) such that both are positioned on the same side of the device. In aspects, the spatial orientation of a visual indicator on a mating component can indicate the position of an airflow limiter, e.g., second airflow limiter (e.g., Barrel Crown).

In a specific example, in aspects, when a visual indicator on a mating component is spatially oriented upward, the fan-like feature of an airflow limiter, e.g., a second airflow limiter (e.g., Barrel Crown), is positioned on the upper half of the delivery device.

In aspects, a delivery device comprises at least two visual indicators present on the exterior (e.g., externally visible) of the delivery device. In aspects, at least one of the at least two visual indicators are present on a volatile compound outlet component. In aspects, at least one of the at least two visual indicators are present on a mating component. In aspects, wherein the volatile compound outlet component and the mating component are movable relative to one another, the spatial orientation of at least one visual indicator relative to at least one other visual indicator provides an indication of at least one functional status, e.g., an operational status, of the delivery device.

In certain aspects, the delivery device comprises at least one visual indicator on a volatile compound outlet component and at least one visual indicator on a mating component wherein the orientation of the two visual indicators relative to one another indicates the status of an airflow restrictor (airflow control mechanism). In aspects, the orientation of the two visual indicators relative to one another indicates the airflow control, (or, e.g., drag control) setting of the delivery device.

In aspects, when a one visual indicator, e.g., a visual indicator that is present on a component/part, e.g., a mating component, is aligned with another visual indicator, e.g., a visual indicator that is present on a volatile compound outlet component, the alignment indicates that the airflow restrictor (airflow control mechanism) is completely closed. For example, in such an orientation, there is minimal overlap between the fan features of first and second airflow limiters (e.g., Body Crown and Barrel Crown).

In aspects, when one visual indicator, e.g., a visual indicator that is present on, e.g., a mating component, is positioned opposite that of another visual indicator, e.g., a visual indicator that is present on a volatile compound outlet component, the opposite positioning indicates that the airflow restrictor or airflow control mechanism is completely open. For example, in such an orientation, there is maximum overlap between the fan features of first and second airflow limiters (e.g., Body Crown and Barrel Crown).

According to certain aspects, at least one particular alignment between at least one visual indicator and at least one other visual indicator is accompanied by a distinctly different, e.g., distinguishable, tactile indicator. In aspects, when a volatile compound outlet component and a mating component are rotated 360 degrees relative to one another, the particular alignment between the at least one visual indicator and the at least one other visual indicator only occurs one time, and such a distinguishable tactile indication is sensed only once when such alignment is attained. This is described elsewhere herein.

In this and other part, component, assembly, mechanism, function, feature, or operational aspect(s) of the invention, the invention also can be characterized as comprising a "means" for indicating the spatial orientation/position of one or more internal components, an operational status of the delivery device, or both, through user sensory perception. In such a respect, any known equivalents of such indicators can also be, e.g., are, incorporated into devices or methods of the invention. As with other sections similarly described herein, any of the components of the invention can be, where suitable, described as means (e.g., the above-described visual indicators, tactile indicators, or, e.g., indicators which are characterizable as both visual and tactile, can be described as spatial orientation or operational status indicator means or means for indicating spatial orientation or operational status).

Tactile/Audible Indicator(s) Associated with an Airflow Control Mechanism

According to certain aspects, delivery devices provided by the invention comprise an airflow restrictor (airflow control mechanism) which is accompanied by an auditory indicator, tactile indicator, or both auditory and tactile indicator associated with the modification of airflow control. In aspects, such auditory, tactile, or both auditory and tactile (or auditory and tactile indicator(s) associated with one another, e.g., associated with a single event) can indicate one or more settings of the airflow restrictor (airflow control mechanism).

In aspects, a change between one, some, most, generally all, substantially all, essentially all, or all (any) first airflow control setting and one, some, most, generally all, substantially all, essentially all, or all (any) second airflow control setting is accompanied by an audible indicator, a tactile indicator, or both. Stated another way, in aspects, a change between any first airflow control setting and any second airflow control setting is accompanied by an audible indication of such a change, a tactile indication of such a change, or both.

Many elements of tactile indication(s)/indicator(s) are described elsewhere herein, such as, e.g., in the detailed description of the figures and associated with the descriptions of airflow limiter(s) and airflow restrictor provided herein.

In certain aspects, a tactile indicator is a vibrational indicator or indicator associated with the movement of one part, component, or assembly relative to another part, component, or assembly. In this sense, such a tactile indicator is differentiated from other types of tactile indicator(s) provided herein which are discernable by touch.

In certain aspects, one or more tactile indicators can be provided by any suitable mechanism capable of providing a tactilely detectable indication of a movement of at least two part, components, or assembly(ies) relative to one another, such as, e.g., two components of an airflow restrictor (airflow control mechanism), such as, for example, a first airflow limiter and a second airflow limiter. In aspects, such a tactile indicator can be, e.g., generated by the changing interaction between two part, components, or assemblies interfacing with one another during a rotation, e.g., over the course of at least a portion of a 360-degree rotation (or more) in relation to one another; a single element on a first component interacting with or interfacing with a series of components on a second component (e.g., a flexible element, tab, or other suitable pointer interacting with a series of pegs or other suitable elements spaced apart over the course of 360 degrees), similar to a traditional game spinning wheel); a gear mechanism comprising two or more interfacing gears capable of providing, designed to provide, or which provide a tactile indication when a tooth of one gear interfaces with a space between teeth of a second gear; or other similar or suitable mechanism.

In specific embodiments, e.g., the degree of interface between (a) an airflow limiter, e.g., a Barrel Crown, such as, e.g., specific features of such a component such as, e.g., a fan-like feature comprising alternating ridges/recessions, and (b) another airflow limiter, e.g., Body Crown, such as, e.g., specific features of such a component such as, e.g., a fan-like feature comprising alternating ridges/recessions, is established by the rotation of a volatile compound outlet component (e.g., a Body Assembly (201)), comprising a first airflow limiter, e.g., Body Crown which can comprise, e.g., a Body Crown fan feature and associated alternating ridges/recessions, relative to a mating component (e.g., a Tip Assembly (202)), comprising a second airflow limiter, e.g., Barrel Crown which can comprise a fan feature and associated alternating ridges/recessions. In aspects, because the first and second (e.g., first and second primary) components of the device, (e.g., volatile compound outlet component, e.g., a Body Assembly and mating component, e.g., a Tip Assembly) can in aspects be releasably engaged with one another via a selectively releasable engagement component, e.g., a rapidly releasable engagement component, e.g., a magnetic force, in a fully assembled exemplary device, the alternating ridges/recessions of a fan-like feature of one airflow limiter, e.g., Body Crown fan ridge/recession set, can be drawn to the alternating ridges/recessions of a fan-like feature of another airflow limiter, e.g., Barrel Crown fan ridge/recession set by virtue of the fact that each of such components reside in the first and second primary components, respectively, which are releasably engaged by, e.g., magnetic force. In aspects, when a first airflow limiter, e.g., a Body Crown, e.g., one or more features of a Body Crown such as, e.g., alternating ridges/recessions of a fan feature, are rotated in relation to a second airflow limiter, e.g., a Barrel Crown, e.g., one or more features of a Barrel Crown such as, e.g., alternating ridges/recessions of a fan feature, there are positions in which one or more Body Crown features, e.g., fan ridge recession(s) are positioned around or on one or more Barrel Crown features, e.g., fan ridge peak(s). In such aspects, such a positioning provides a fit or mating between the two components wherein the two components are as physically close to one another as they can be. In aspects there are further positions during such rotation in which one or more first airflow limiter features, e.g., Body Crown fan-like feature recession(s) are positioned in line with one or more second airflow limiter, e.g., Barrel Crown features, e.g., fan-like feature recession(s). In aspects, similarly or simultaneously, one or more first airflow limiter, e.g., Body Crown features, e.g., fan-like ridge peak(s) are positioned in line with one or more second airflow limiter, e.g., Barrel Crown fan ridge peak(s). In such position(s), there is a poor fit between the two components and the two components are not as physically close to one another as they could be. In such a position, the device is somewhat unstable, and the magnetic force drawing the first primary component, e.g., volatile compound outlet component, e.g., Body Assembly, and the second primary component, e.g., mating component, e.g., Tip Assembly together can act upon the two separated airflow limiters. In aspects, the force acts to pull the two airflow limiters together such that the fan-like feature ridge peak(s) of one airflow limiter fit within the fan-like feature ridge recession(s) of the other airflow limiter, and vice versa. Accordingly, when a user rotates the mating component, e.g., Tip Assembly, in relation to the volatile compound outlet component, e.g., Body Assembly, the two components slightly separate from one another as the components of the fan-like feature ridge sets of the first and second airflow limiters alternatingly "fit" together and alternatingly "do not fit" together, e.g., "misalign" (in terms of fit). Shifting from a position of non-fit to a position of fit, of an e.g., first airflow limiter, e.g., Body Crown, and a second airflow limiter, e.g., Barrel Crown, "snaps", or "clicks," them back together (e.g., as they are pulled back together by the magnetic force of the device). Thus, rotation of a mating component, e.g., Tip Assembly, relative to a volatile compound outlet component, e.g., Body Assembly, (or vice versa) can provide an audible "clicking" sound and, e.g., a tactile indication, e.g., a vibration or a "snap" sensation, of the movement as features of each of the first and second airflow limiters, e.g., ridges and recessions of each, interface with one another, e.g., ride over and about each other. That is, the alternating separation and reunification of airflow limiters can yield a tactile indication, an audible indication, or both. In aspects, a distinguishably different tactile indicator, audible indicator, or both is received when a single, unique (relative to other) elements of each of the first and second airflow control components meet during a rotation, causing, e.g., a larger separation of the two components.

In aspects, an audible indicator is characterizable as a "click," "snap," or other short but distinct sound. In aspects, a tactile indicator is also characterizable as a "snap" or, e.g., a vibration or, e.g., a short distinct movement. The exact sound and exact tactile sensation can change, e.g., according to the materials making up the components participating in the sound (e.g., the material(s) of which the first airflow component, e.g., Body Crown, and second airflow component, e.g., Barrel Crown, are at least substantially composed). Aspects of suitable click sounds, for example, are described elsewhere herein, and in the following paragraph. In aspects, an audible indicator, or a tactile indicator, which is detectably different from other audible or tactile indicator(s), e.g., a distinguishable audible indication, tactile indication, or both, can indicate that the device is in a maximally closed state.

In certain aspects, two distinguishable audible indications, e.g., a "large click" and a "small click", can differ from one another by at least about 1 decibel, such as, e.g., at least about 2 decibels, ~3, ~4, ~5, ~6, ~7, ~8, ~9, or, e.g., at least about 10 decibels. In certain aspects, two distinguishable audible indications (two distinguishably, e.g., detectably or significantly, different audible indications) can differ from one another by between about 1 decibel and about 80 decibels, such as, e.g., between ~1 decibel-~70 decibels, ~1 decibel-~60 decibels, ~1 decibel-~50 decibels, ~1 decibel-~40 decibels, ~1 decibel-~30 decibels, ~1 decibel-~20 decibels, or, e.g., ~1 decibel-~100 decibels, such as, e.g., ~5 decibels-~80 decibels, ~10 decibels-~80 decibels, ~20 decibels-~80 decibels, ~30 decibels-~80 decibels, ~40 decibels-~80 decibels, ~50 decibels-~80 decibels, ~60 decibels-~80 decibels, or, e.g., ~70 decibels-~80 decibels, as in, e.g., between about 5 decibels-about 70 decibels, or, e.g., about 10-about 60 decibels. In aspects, a maximally closed configuration of a delivery device is indicated by a larger indicator (e.g., an indicator having a greater magnitude, such as an audible indicator having a distinguishably higher decibel value) than that of any other airflow control setting. In aspects, such distinguishable indication(s) is only received once in any 360-degree rotation of a first airflow limiter relative to a second airflow limiter (e.g., Body Crown relative to a Barrel Crown), or, e.g., once in a 360-degree rotation of a first component, e.g., first primary component, e.g., volatile compound outlet component, relative to a second component, e.g., a second primary component, e.g., a mating component. As stated elsewhere, this operational status can also be accompanied by, e.g., a visual indication of such status (e.g., as indicated by the spatial orientation between two visual indicators).

In this and other part, component, assembly, mechanism, function, feature, or operational aspect(s) of the invention, the invention also can be characterized as comprising a "means" for providing an audible, tactile, or audible and tactile indication of one or more device operational statuses, such as, e.g., the status of the airflow control mechanism (e.g., the degree to which the device is open to airflow therethrough; e.g., how "open" or how "closed" the device is.) In such a respect, any known equivalents of such named tactile or audible indicators can also be, e.g., are, incorporated into device(s) or method(s) of the invention. As with other sections similarly described herein, any of the part(s), component(s), or assembly(ies) of the invention can be, where suitable, be described as means (e.g., the above-described tactile/audible indicators can be described as tactile/audible indicator means or means for providing tactile and/or audible indication of one or more component operational statuses, e.g., the operational status of an airflow control mechanism).

Device Stabilizer(s)

As is described elsewhere herein, in aspects, one or more device stabilizer(s) can be present on, within, or can otherwise be associated with a delivery device, which at least detectably or significantly promotes or participates in maintaining a delivery device in place when the delivery device is placed upon a surface upon which, without such a stabilizer, the device may more likely, more detectably, or both more likely and more detectably undesirably move or change position (such as, e.g., roll in embodiments wherein the device has a detectably or significantly rounded surface).

In aspects, one or more surfaces of a volatile compound outlet component, or, e.g., in another more specific aspect, a volatile compound outlet component extension, comprise(s) an elevated feature, a recessed feature, a flattened or otherwise differentiated surface (differentiated from adjacent surface(s) which detectably or significantly prevent a delivery device from inadvertently moving when the delivery device is placed on a surface. In aspects, a delivery device is generally characterizable as having a rounded exterior and, in aspects, a volatile compound outlet component, or, e.g., in another more specific aspect, a volatile compound outlet component extension comprises an elevated feature, a recessed feature, a flattened or otherwise differentiated surface (differentiated from adjacent surface(s) which detectably or significantly prevent a delivery device from rolling when the delivery device is placed on a surface wherein the device would roll if such stabilizing feature(s) were not present.

In aspects, one or more surfaces of a mating component comprise(s) an elevated feature, a recessed feature, a flattened or otherwise differentiated surface (differentiated from adjacent surface(s) which detectably or significantly prevent a delivery device from inadvertently moving when the delivery device is placed on a surface. In aspects, a delivery device is generally characterizable as having a rounded exterior and, in aspects, a mating component comprises an elevated feature, a recessed feature, a flattened or otherwise differentiated surface (differentiated from adjacent surface(s) which detectably or significantly prevent a delivery device from rolling when the delivery device is placed on a surface wherein the device would roll if such stabilizing feature(s) were not present.

In one specific exemplary embodiment, an engagement component support, e.g., Magnet Cover, of a delivery device comprises a recession or an elevation, e.g., a "scratch" (recession) or a "raised" line or feature (elevation) which prevents the delivery device from inadvertently moving, e.g., rolling, when placed upon one or more surface(s) upon which the device would roll absent such feature(s). In aspects, such feature(s) can further operate as visual indicator(s), tactile indicator(s), or both of, e.g., one or more functional status(es) of the device.

Fidgetability

In aspects, delivery devices herein provide a manually focused experience characterizable as a "fidget" experience, e.g., an entertainment experience or, e.g., an experience which alleviates a craving, negative mental state. Such functionality is provided by the inclusion of one or more "fidget elements." A fidget element, as described elsewhere, is an element that allows for easy, repeat movement, by a user, wherein such repeated movement's primary or only purpose is to modulate the psychological or physiological state of the user, rather than to carry out some function relating to the delivery of VCs. Fidget elements are elements that move in one or more dimensions with the application of a low/light minimum initiation force. Fidget elements also are typically re-set easily and in aspects will exhibit movement once initiated for a short period of time. Fidget elements also or alternatively can be associated with indicators or elements that promote reengagement/repeat application of the fidget movement. The fidget movement/motion can be any suitable motion, such as a rotation motion, spinning motion, push/pull motion, etc. These concepts and examples thereof are described further below and elsewhere in this disclosure.

In aspects, manual manipulation of a fidget element of a device or system of the invention detectably or significantly reduces one or more habit-related craving(s).

In an exemplary aspect, a rotation of a first primary component of the device, e.g., a Body Assembly, relative to a second primary component, e.g., a Tip Assembly (or, e.g., vice versa—herein any described rotation of a first component relative to a second component but which should be interpreted as also referring to a rotation of the second component relative to the first component), provides a detectable audible, detectable tactile, or both detectable audible and detectable indication of such movement, such as, e.g., snapping or clicking sound(s).

In aspects, selective disengagement and reengagement of first and second primary components of the device can provide, e.g., similar sound(s) or tactile sensations(s). This is described elsewhere herein.

In aspects, such manipulation of the device provides a playful or toy-like nature to the device. Thus, in aspects, the typical use of such elements by a significant number of users induces the same psychological or physiological effects as are associated with similar type of devices that are associated with fidgeting in persons, examples of which are provided elsewhere.

As also described elsewhere, the inclusion and use of a fidget element can provide benefits to a significant number or most users of a device or system comprising fidgeting element(s). In exemplary aspects, rotation of a first primary component of the device, e.g., a Body Assembly, relative to a second primary component, e.g., a Tip Assembly, selective disengagement and reengagement of first and second primary components of the device (a) provides entertainment to a device user; (b) detectably or significantly increases the ability of a user to tolerate anxiety; (c) detectably or significantly increases the ability of a user to tolerate frustration; (d) detectably or significantly increases the ability of a user to tolerate agitation; (e) detectably or significantly increases the ability of a user to tolerate stress; (f) detectably or significantly increases the ability of a user to tolerate boredom; (g) detectably or significantly increases the ability of a user to tolerate excitement; (h) detectably or significantly increased the ability of a user to tolerate sensory challenges such as sensory overload or sensitivity to a particular sensory input, (i) detectably or significantly reduces a vaping-related/smoking-habit related craving (such as, e.g., to hold, manipulate, or smoke a cigarette, vaping device, etc.) or (i) achieves any combination of any or all of (a)-(h).

Additional Characterization(s) of Delivery Device(s)

In certain aspects, device(s), e.g., delivery device(s), described herein are characterizable according to part(s), component(s), assembly(ies), mechanism(s), or feature(s) of any thereof which are absent in such device(s), or, e.g., which comprise particular characteristic(s) or which operate in particular manner(s).

In aspects, delivery device(s) provided herein do/does not comprise a cover for a portion of a device with which the user engages their lips or mouth for receiving compound(s) delivered from the device. Here a "cover" means a cap or other part or component designed to protect a user engageable portion of device(s) designed to make contact with a device user's lips or mouth.

In aspects, device(s) do not comprise more than 2 selectively detachable part(s), component(s), or assembly(ies). In aspects, a volatile compound compartment cannot be refilled other than by removing one removable insert from within the volatile compound compartment and replacing it with another removable insert (removable insert(s) being described elsewhere herein).

In aspects, a volatile compound outlet component (in aspects being or comprising a mouthpiece) is not detachable together with, e.g., as a single detachable unit comprising, a mating component (mating component(s) described being described elsewhere herein) from one or more other part(s), component(s), or assembly(ies). In aspects, a volatile compound outlet component cannot receive a removable insert from at least position associated with its long axis. In aspects, a volatile compound outlet component cannot receive a removable insert from a distal or inlet end, from a proximal or outlet end, or cannot receive a removable insert from both its distal (inlet) end and its proximal (outlet end). In aspects, a volatile compound compartment comprises at least one opening along a wall connecting its distal (inlet) and proximal (outlet) ends which has a length which represents at least about 10%, ≥~20%, ≥~30%, ≥~40%, ≥~50%, ≥~60%, ≥~70%, ≥~80%, or, e.g., ≥~90%, of the total length of the wall connecting its distal (inlet) and proximal (outlet) ends.

In aspects, an engagement component responsible for the engagement of a volatile compound outlet component and a mating component of device(s) herein can comprise two part(s), component(s), or assembly(ies), wherein the engagement of the volatile compound outlet component and the mating component via the engagement component does not comprise a detectable or significant coupling of the two part(s), component(s), or assembly(ies) of the engagement component forming the engagement. In aspects, an engagement component responsible for the engagement of a volatile compound outlet component and a mating component of device(s) herein can comprise two part(s), component(s), or assembly(ies), wherein the engagement of the volatile compound outlet component and the mating component via the engagement component does not comprise a detectable or significant overlap of the two part(s), component(s), or assembly(ies) of the engagement component forming the engagement. In aspects, an engagement component responsible for the engagement of a volatile compound outlet component and a mating component of device(s) herein can comprise two part(s), component(s), or assembly(ies), wherein the engagement of the volatile compound outlet component and the mating component via the engagement component does not comprise a detectable or significant envelopment by one of the two part(s), component(s), or assembly(ies) of the other of the two part(s), component(s), or assembly(ies) of the engagement component forming the engagement.

In certain aspects, an engagement component responsible for the engagement of a volatile compound outlet component and a mating component of device(s) herein can comprise two part(s), component(s), or assembly(ies), wherein the engagement of the volatile compound outlet component and the mating component via the engagement component does not comprise a detectable or significant direct, physical interface, e.g., the direct physical contact between, the two part(s), component(s), or assembly(ies) of the engagement component forming the engagement.

In aspects, an engagement component capable of engaging a volatile compound outlet component and a mating component of device(s) herein does not comprise an elastic compression and an associated release of such elastic compression between any two components making up the engagement component. In aspects, disengagement of a part, component, or assembly of device(s) herein does not require movement of such a part, component, or assembly of a device toward, or closer in proximity to, a part, component, or assembly from which disengagement is desired, prior to effecting such disengagement (such as, e.g., may be facilitated by the presence of an elastic element being present between two part(s), component(s), or assembly(ies) requiring disengagement or between which disengagement is desired.

In aspects, an engagement component capable of engaging a volatile compound outlet component and a mating component of device(s) herein does not require the rotation of one part, component, or assembly of the engagement component relative to another part, component, or assembly of the engagement component, in order to facilitate disengagement of the volatile compound outlet component from the mating component (or vice versa).

In aspects delivery device(s) provided herein do not comprise more than one (e.g., more than a single) engagement component associated with a mating component, associated with a volatile compound outlet component, or both, intended to engage or disengage one or more other part(s), component(s), or assembly(ies) of the device.

In certain aspects, delivery device(s) provided herein do not comprise an elastic part or component. In aspects, delivery device(s) provided herein can comprise one or more detectably or significantly compressible part(s) or component(s) such as a compressible positioner, however such a compressible positioner is not, in aspects, made of an elastic material.

According to aspects, a volatile compound outlet component is positioned within a mating component, as is described elsewhere herein, even in circumstances wherein the volatile compound outlet component does not comprise a removable insert. In aspects, the length of a fully assembled delivery device does not detectably or significantly change when a solid material device for the maintenance, release, or maintenance and release of volatile compound(s), e.g., a removable insert, is present therein compared to its length when such a solid material device, e.g., removable insert, is absent.

In certain aspects, device(s) herein comprise at least two disengageable part(s), component(s), or assembly(ies). In aspects, each disengageable part, component, or assembly has a length, wherein the sum of the lengths of each disengageable part, component, or assembly provides a total length of the device constituents when the device is not fully assembled and ready for use. For sake of simplicity in this particular embodiment, the term "length A" is used here to describe the sum of the lengths of each disengageable part, component, or assembly of a delivery device. In aspects, a fully assembled device in a ready to use state, with all disengageable parts in an engaged state, the fully assembled device has a length, in this particular embodiment referred to for ease of reference as "length B." In aspects, "length A" of delivery device(s) provided herein when a solid material device for the maintenance, release, or maintenance and release of volatile compound(s), e.g., a removable insert, is present within the device is at least generally the same, at least substantially the same, at least essentially the same, or is the same as "length A" when a solid material device for the maintenance, release, or maintenance and release of volatile compound(s), e.g., a removable insert, is absent. Similarly, in aspects, "length B" of delivery device(s) provided herein when a solid material device for the maintenance, release, or maintenance and release of volatile compound(s), e.g., a removable insert, is present within the device is at least generally the same, at least substantially the same, at least essentially the same, or is the same as "length B" when a solid material device for the maintenance, release, or maintenance and release of volatile compound(s), e.g., a removable insert, is absent.

In some respects, a solid material device for the maintenance of, release of, or both the maintenance of and the release of volatile compound(s), e.g., a removable insert, is not stably attachable to a mouthpiece via a connection component. In aspects, a solid material device for the maintenance of, release of, or both the maintenance of and the release of volatile compound(s), e.g., a removable insert, does not comprise an engagement mechanism, an engagement component counterpart, or both. In aspects, the distal end of a mouthpiece herein or, in aspects, any component along the long axis of a volatile compound outlet component, lacks any part, component, or assembly which can directly engage a proximally positioned end of a solid material device for the maintenance of, release of, or both the maintenance of and the release of volatile compound(s), e.g., a removable insert to sufficiently maintain the e.g., removable insert, in a stable position relative to the mouthpiece without other part(s), component(s), or assembly(ies) (or feature(s)) thereof, being present to participate in holding the e.g., a removable insert, in place.

In aspects, delivery device(s), nor solid material device(s) for the maintenance of, release of, or both the maintenance of and the release of volatile compound(s), e.g., removable insert(s) designed for use therewith, are not designed to deliver tobacco-related compounds. In aspects, delivery device(s) herein do not comprise one or more constituent(s) characterizable as: a tobacco cartridge; a coupling device; a flange; an elastic member such as an O-ring; engaging lug; lug rest; or any combination of any or all thereof.

Solid Material Device Maintaining/Releasing Compound(s) (Insert)

In aspects, the invention provides a means of maintaining, delivering, or maintaining or delivering one or more volatile compounds for delivery to a user. In aspects, the invention provides a means of maintaining, delivering, or maintaining or delivering one or more volatile compounds via a delivery device such as delivery device described herein, e.g., a device having any one or more of the characteristics of delivery device(s) described herein.

In aspects, the volatile compound delivery means (means of delivering volatile compound(s)) can be any means capable of maintaining, designed to maintain, or which maintain(s), e.g., until a suitable environment is presented for the release of one or more volatile compounds contained therein (then releasing when such a suitable environment is presented) one or more volatile compounds. In aspects, such a volatile compound deliver means can be, e.g., any suitable volatile compound delivery means known in the art, such as e.g., a container, compartment, housing, or other holding device/component or element capable of containing a fluid (e.g., a liquid or a gas or mixture thereof); or a solid or semi-solid media that can contain and release such a fluid/liquid, such as a porous/fibrous component capable of holding within its structure a fluid containing one or more volatile compounds; or an at least partially porous material capable of holding within its structure a fluid containing one or more volatile compounds, etc.

In aspects the means can be characterized as a spongy material (a material having compressibility and porosity similar to a sponge or better than a sponge or sponge-like liquid containing articles known in the art). In aspects, the means can be characterized as an infusible material. In aspects the means can be an absorbent material (e.g., a material capable of, on average or generally always or always, absorbing and maintaining an effective amount of VCC(s) under normal environmental or indoor temperature and pressure conditions). In aspects, a fibrous material can used, which can be a synthetic or natural material, an organic or an inorganic material, capable of holding an effective amount of a fluid or a solid such as an oil, liquid, gas, or powder. In aspects a fibrous material can comprise woven fibers, non-woven fibers, or both. In aspects, the fibrous material can comprise an organic mousse having open cells. In aspects, a fibrous material can be a natural pulp, cotton, vegetable sponge, or spongy wood. In aspects, the fibrous material serves as a volatile substance support allowing for the retention, preservation, and release of volatile compound(s). In aspects, a porous material can also serve as a volatile substance support, allowing for the retention, preservation, and release of volatile compound(s). In aspects, a porous material can be a semi-solid or solid material. In aspects, a porous material can be a synthetic or natural material, an organic or an inorganic porous material, capable of holding or designed to hold a fluid or a solid such as an oil, liquid, gas, or powder. In certain aspects, a fibrous material can be a cellulose-based material, an acetate material, or a polyester material, such as, e.g., a medical grade polyester material. In aspects a porous material can be a ceramic material, such as, e.g., an alumina ceramic or a zirconia ceramic. In aspects, the insert or other solid/semi-solid media can absorb on average or always about 30-about 100% of its weight in VCC(s), e.g., about 33%-100% of its weight, e.g., about 25-90% of its weight, about 40-90% of its weight, about 30-85% of its weight, etc.

In aspects, the means can be characterized as a "reservoir" or a carrier or a media that holds the VCC(s). In aspects, a reservoir is provided as an "insert," or a "removable insert," wherein such a means, e.g., such a device, can be inserted into a delivery device. Uncontradicted, herein, use of the term "insert" should be interpreted to encompass any means described in this section. For example, herein use of the term "insert" should be interpreted as encompassing any solid material device described above or, e.g., in aspects any "reservoir" capable of accomplishing one or more means described above. Any such means should be interpreted as, in aspects, being removable. Such that, for example, use of the term "insert" should be interpreted as encompassing "removable insert."

In aspects, an insert, e.g., a removable insert is characterizable as at least partially solid, at least mostly solid, or solid material device which can comprise or incorporate any solid material described above, such as, e.g., a fibrous material, a ceramic material, etc. In certain aspects herein, use of the word "solid" in reference to a solid material device for maintaining, releasing, delivering, etc. one or more volatile compound(s) can be interpreted to incorporate, e.g., a more flexible or porous device, such as, e.g., a fibrous device and can be interpreted to further incorporate a more semi-solid or solid material device, such as, e.g., a ceramic device.

In aspects, a means of maintaining, delivering, or maintaining and delivering one or more volatile compounds is capable of being inserted or is designed suitably for insertion into and removed from a delivery device. In aspects, the means is characterizable as a removable insert. In aspects, the means is embodied as an insert as illustrated in figure(s) provided herewith. In aspects, the means of maintaining, delivering, or maintaining and delivering one or more volatile compounds (volatile compound delivery means) is a removable insert having any one or more of the characteristics of an Insert described in the figures or the detailed description of figures provided herein.

In aspects, the invention provides an insert, e.g., removable insert which is fibrous. In aspects, the fibrous insert is made of a polyester material, such as, e.g., a medical grade polyester. In aspects, the insert is a semi-solid or solid material. In aspects, a semi-solid or solid material is at least partially porous. In aspects, the porous material is a ceramic material. In aspects, the ceramic is an alumina ceramic, a zirconia ceramic, or a combination thereof.

In certain aspects, the insert, e.g., removable insert, is an insert suitable for use in, e.g., capable of being used in, or, e.g., which can be used in conjunction with (is compatible with), an electronic volatile compound delivery device. In aspects, the insert is an insert suitable for use in, e.g., capable of being used in, or, e.g., which can be used in conjunction with (is compatible with), a delivery device comprising a heating mechanism. In aspects, an insert is an insert suitable for use in, e.g., capable of being used in or, e.g., which can be used in conjunction with (is compatible with), a device which does not comprise an electronic component, does not comprise a heating component, or does not comprise either an electronic component or a heating component.

In certain aspects, an insert, e.g., removable insert, is a disposable insert. In aspects, the insert is designed for a single use (which may comprise a plurality of uses or compound delivery instances via a delivery device), after which the insert is discarded. In aspects, with respect to an insert, e.g., removable insert, a "single use" can be, e.g., a use of the removable insert until an insufficient amount of volatile compounds are released during a use session (a use session being a single interface between a user and a delivery device wherein the user applies a sufficient amount of suction pressure to a device to draw a suitable amount of air into the delivery device to deliver a detectable or significant amount of compound(s) housed there in to their mouth), such that the user is unsatisfied with the experience provided, e.g., is unsatisfied with the flavor experience provided by the insert (e.g., removable insert). In aspects, such a single use can be a period of more than 1 hour, e.g., ≥~1 day, ≥~2 days, ≥~3 days, ≥~4 days, ≥~5 days, ≥~6 days, ≥~1 week, ≥~2 weeks, ≥~1 month, ≥~6 weeks, ≥~2 months, ≥~10 weeks, ≥~3 months, ≥~14 weeks, ≥~4 months, ≥~18 weeks, ≥~5 months, ≥~22 weeks, or ≥~6 months. In aspects, such a single use can comprise a number of use sessions, e.g., be a number of user/device interfaces for delivering compound(s) to the user via the delivery device such as, e.g., at least about 2 use sessions, ≥~4 use sessions, ≥~6 use sessions, ≥~8 use sessions, ≥~10 use sessions, ≥~12 use sessions, ≥~14 use sessions, ≥~16 use sessions, ≥~18 use sessions, ≥~20 use sessions, ≥~25 use sessions, ≥~30 use sessions, ≥~35 use sessions, ≥~40 use sessions, ≥~45 use sessions, ≥~50 use sessions, ≥~75 use sessions, ≥~100 use sessions, ≥~125 use sessions, ≥~150 use sessions, ≥~175 use sessions, ≥~200 use sessions, ≥~300 use sessions, ≥~400 use sessions, ≥~500 use sessions, ≥~600 use sessions, ≥~700 use sessions, ≥~800 use sessions, ≥~900 use sessions, or, e.g., ≥~1000 use sessions.

In alternative aspects, the insert, e.g., removable insert is a reusable insert. In aspects, the insert is designed to be refilled or recharged after a single use (which again can comprise a plurality of use sessions via a delivery device). In aspects, the insert can be refilled or recharged with one or more volatile compounds such as by, e.g., being exposed to an oil, e.g., an essential oil, comprising such one or more compounds. In aspects, exposure can occur while the removable insert is maintained with a delivery device. In aspects, the exposure can occur while the insert is outside of a delivery device.

In aspects, an insert, e.g., a removable insert, e.g., reservoir, maintains a suitable amount of one or more volatile compounds for use within a delivery device for a period of time after manufacturing when stored in airtight packaging to allow the insert to be stored for a period of at least about 1 week after manufacturing and prior to use (e.g., prior to the opening of its packaging and placement into a delivery device. In aspects, an insert can be stored in airtight packaging for a period of at least about 2 weeks, ≥~3 weeks, ≥~1 month, ≥~6 weeks, ≥~2 months, ≥~10 weeks, ≥~3 months, ≥~14 weeks, ≥~4 months, ≥~18 weeks, ≥~5 months, ≥~22 weeks, or ≥~6 months, such as ≥~7 months, ≥~8 months, ≥~9 months, ≥~10 months, ≥~11 months, or even ≥~12 months (such as at least 18 months, at least 2 years, or longer).

In aspects, an insert, e.g., a removable insert, is a solid material device comprising a first end, a second end, and an outer thickness (e.g., width, height, or, e.g., in aspects, diameter) and wherein the solid material device comprises at least one non-circuitous passageway within its outer perimeter between its first and second ends allowing the passage of air through the solid material device via the passageway. In aspects, a non-circuitous passageway is a passageway which a user can visibly see through. In aspects, the solid material device comprises ≥~2, ≥~3, ≥~4, ≥~5, ≥~6, ≥~7, ≥~8, ≥~9, or ≥~10 non-circuitous passageways within its outer perimeter (e.g., across its length, between opposing ends), each of which allowing the passage of a detectable or significant amount of air therethrough. In aspects, a non-circuitous passageway is an at least generally, at least substantially, at least essentially, essentially, or is a direct passageway through the solid material device between two opposing ends.

In aspects, a non-circuitous passageway of a solid material device (i.e., insert), or each non-circuitous passageway in embodiments where a plurality of non-circuitous passageways is present, detectably or significantly increases the surface area of the solid material device. In aspects, one or more non-circuitous passageways, alone or in combination with one or more other non-circuitous passageways, can increase the surface area of a solid material device by at least about 0.5%, ≥~1%, ≥~3%, ≥~5%, ≥~10%, ≥~15%, ≥~20%, ≥~25%, ≥~30%, ≥~35%, ≥~40%, ≥~45%, ≥~50%, ≥~55%, ≥~60%, ≥~65%, ≥~70%, ≥~75%, ≥~80%, ≥~85%, ≥~90%, ≥~95%, or, e.g., by ≥~100% over that of a similar or the same solid material device lacking such non-circuitous passageway(s).

According to certain aspects, a solid material device (i.e., insert or reservoir) comprises one or more passageways therethrough allowing for air to pass from a first end to a second end, e.g., from a distal end to a proximal end (e.g., the proximal end being nearest a delivery device user's lip(s) when the solid material device is positioned within a delivery device, wherein the one or more passageways are each circuitous. That is, in aspects, any passage of air through a solid material device (i.e., insert or reservoir) is an indirect passageway, a passageway which one cannot visibly see directly through from a first end to a second way, or both.

In one aspect, the solid material device, e.g., removable insert, e.g., Insert, comprises at least one non-circuitous passageway. In aspects, at least one of the at least one non-circuitous passageways comprise a shape. In aspects, the shape of the passageway can be any shape. In aspects, the shape of the passageway is characterizable as a circular shape, a squircle, a multilobed (multi-petaled) flower shape, e.g., zygomorphic flower shape, or actinomorphic flower shape, or other geometrical shape, such as, e.g., a quadrilateral (e.g., square, rectangle) or other polygonal shape (e.g., a triangle, pentagon, hexagon, octagon, etc.), a star-like shape (having any number of points), etc. In aspects, the solid material device, e.g., removable insert, e.g., Insert, comprises a plurality of non-circuitous passageways through the solid material device, wherein each of the plurality of non-circuitous passageways has at least generally the same, at least substantially the same, at least essentially the same, essentially the same, or the same cross-sectional shape. In alternative aspects, the solid material device, e.g., removable insert, e.g., Insert (or reservoir), comprises a plurality of non-circuitous passageways through the solid material device, wherein at least one of the plurality of non-circuitous passageways has a shape which is detectably or significantly different than at least one other non-circuitous passageway.

In aspects, a passageway through a solid material device, i.e., insert or reservoir (e.g., removable insert) is a surface area increasing feature. In aspects, a passageway through a solid material device detectably or significantly increases the surface area of the material of which the device is made which is exposed to the environment. In aspects, an increase in surface area detectably or significantly increases the volume or amount of volatile compounds maintained therein which become available for delivery to a user, e.g., diffuse, from the solid material device, i.e., insert or reservoir (removable insert). In aspects, an increase in surface area detectably or significantly increases flavor delivery to a user. In certain aspects as alluded to above and as illustrated in figures provided herewith, a solid material device can comprise one or more passageways, i.e., surface area increasing features, having a shape which is characterizable as having additional shape features, such as, e.g., a flower design wherein a central passageway, e.g., a surface area increasing feature is the center of the flower design, and extensions therefrom, e.g., the petals of such a design, are surface area increasing feature channel extensions.

In aspects, the solid material device, e.g., removable insert, comprises a shape having a first end and a second end, the shape characterizable as a cylinder, triangular prism, rectangular prism (cuboid), pentagonal prism, hexagonal prism, octagonal prism, or other multi-sided prism. In aspects, the solid material device, e.g., Insert (reservoir) has an at least generally, at least substantially, at least essentially, essentially, or has a cylindrical shape. In certain aspects, insert(s) have a fully cylindrical shape, not, e.g., a shape representative of, e.g., a portion of a cylinder (e.g., a full cylinder as compared to a half or one-quarter cylinder).

In aspects, a solid material device, e.g., Insert or reservoir, is highly porous. In aspects, such device(s) have a large volume of "open" or "empty" space which, when the device is loaded with compound(s) (as is typically the case for the devices as described herein) can be used to maintain a large volume of volatile compound(s), e.g., a large volume of an oil containing volatile compound(s). In aspects, at least about 1%, ≥~5%, ≥~10%, ≥~12%, ≥~14%, ≥~16%, ≥~18%, or, e.g., ≥~20%, of a solid material device is represented by open pores, e.g., empty volume (or compound capacity).

In aspects, at least about 22%, such as, e.g., ≥~24%, ≥~26%, ≥~28%, ≥~30%, ≥~32%, ≥~34%, ≥~36%, ≥~38%, or ≥~40% of a solid material device is represented by open pores, e.g., empty volume (or compound capacity).

In aspects, at least about 42%, such as, e.g., ≥~44%, ≥~46%, ≥~48%, ≥~50%, ≥~52%, ≥~54%, ≥~56%, ≥~58%, ≥~60% of a solid material device is represented by open pores, e.g., empty volume (or compound capacity).

In aspects, at least about 62%, such as, e.g., ≥~64%, ≥~66%, ≥~68%, or, e.g., ≥~70% of a solid material device is represented by open pores, e.g., empty volume (or compound capacity).

According to certain aspects, characteristic(s) of solid material device(s), i.e., Insert(s) or reservoir(s), across a plurality of device(s) (Insert(s) or reservoir(s)) are consistent, e.g., such device(s) (Insert(s), reservoir(s)) are manufactured in a consistent manner. In aspects, solid material device(s), e.g., Insert(s) or reservoir(s), are utilized unmodified upon removal from their packaging post-manufacture. That is, in aspects, solid material device(s) are not manipulated, e.g., not shredded, prior to use. In aspects, no specific material handling or modification of solid material device(s) is required prior to their use. In aspects, solid material device(s) (Insert(s), reservoir(s)) are manufactured to optimize surface area and maximize airflow. In aspects, without modification, a plurality of solid material device(s), i.e., Insert(s) or reservoirs, provide an at least mostly consistent, at least generally consistent, at least substantially consistent, at least essentially consistent, essentially consistent, or consistent airflow through them upon the application of the same amount of vacuum (suction) pressure. In aspects, without modification, a plurality of solid material device(s), i.e., Insert(s) or reservoirs, provide an at least mostly consistent, at least generally consistent, at least substantially consistent, at least essentially consistent, essentially consistent, or consistent surface area. In aspects, without modification, a plurality of solid material device(s), i.e., Insert(s) or reservoirs, provide an at least mostly consistent, at least generally consistent, at least substantially consistent, at least essentially consistent, essentially consistent, or consistent shape. As stated above, in aspects, the shape of solid material device(s) or any other physical characteristic thereof requires no detectable or significant modification prior to use, such that the solid material device(s) (Insert(s), reservoir(s)) are ready to use, e.g., ready to insert into delivery device(s) immediately upon removal from their packaging. According to aspects, without modification, a plurality of solid material device(s), i.e., Insert(s) or reservoirs, provide an at least mostly consistent, at least generally consistent, at least substantially consistent, at least essentially consistent, essentially consistent, or consistent user experience, e.g., efficacy, in the delivery of compound(s), e.g., flavored compound(s), maintained therein.

In aspects, like delivery device(s) designed to maintain them, solid material device(s) (Insert(s), reservoir(s)) described herein can be characterized as diffusive devices(s). That is, in aspects, solid material device(s) (Insert(s), reservoir(s)) provide delivery of volatile compound(s), e.g., flavored volatile compound(s), by diffusion, by, e.g., being infused with essential oils of such compound(s). Accordingly, in aspects, solid material device(s) (Insert(s), reservoir(s)) deliver scent and flavor (e.g., flavor to the mouth of a device user) via a delivery device through the application of a sufficient amount of vacuum pressure, e.g., suction, to the delivery device by, e.g., the mouth of a user. As stated elsewhere herein, in aspects, the process is an aromatherapy-based process. In aspects, the process of compound delivery does not comprise the application of heat or the vaporization of oil(s) comprising volatile compound(s) to or from the solid material device(s) (Insert(s), reservoir(s)). In aspects, volatile compound(s) released from solid material device(s) (Insert(s), reservoir(s) are delivered by a delivery device to the mouth and olfactory tract of a delivery device user. In aspects, solid material device(s) (Insert(s), reservoir(s)) herein are not intended to deliver volatile compounds by inhalation of compound(s) into the lung(s) of a user.

According to certain embodiments, the solid material device (insert, reservoir) has a length of between about 10 mm and about 50 mm, such as, e.g., ~15 mm-~50 mm, ~20 mm-~50 mm, ~25 mm-~50 mm, or ~30 mm-~50 mm, e.g., ~10 mm-~50 mm, ~10 mm-~45 mm, ~10 mm-~40 mm, ~10 mm-~35 mm, or ~10 mm-~30 mm, such as, for example, ~15 mm-~45 mm, ~20 mm-~40 mm, ~25 mm-~35 mm, or, e.g., about 30 mm or about 35 mm.

According to certain embodiments, the solid material device (insert (Insert), reservoir) has a diameter, or widest width if non-cylindrical, of between about 2 mm and about 10 mm, such as, e.g., ~3 mm-~10 mm, ~4 mm-~10 mm, ~5 mm-~10 mm, or ~6 mm-~10 mm, e.g., ~2 mm-~9 mm, ~2 mm-~8 mm, ~2 mm-~7 mm, or ~2 mm-~6 mm, such as, for example, ~3 mm-~9 mm, ~4 mm-~8 mm, ~5 mm-~7 mm, or, e.g., about 6 mm or about 7 mm.

In certain aspects, the solid material device (insert, reservoir) has a widest diameter, (e.g., thickness) which is detectably or significantly less than the depth of a removable insert housing component (described elsewhere herein) in which it is maintained in a delivery device during operation of the delivery device with the removable insert present.

In aspects, a solid material device (Insert, reservoir) comprises a length which is detectably or significantly less than that of a delivery device in which it is designed to be utilized, such as, e.g., comprising a length which is less than about half (≤~50%) of the length of a delivery device when the delivery device is fully operational, or, e.g., ≤~48%, ≤~46%, ≤~44%, ≤~42%, ≤~40%, ≤~38%, ≤~36%, ≤~34%, ≤~32%, or ≤~30%, of the total length of a delivery device when the delivery device is fully operational. In aspects, a solid material device (Insert, reservoir) has a length equal to at least about 20%, ≥22%, ≥24%, ≥26%, ≥28%, ≥30%, ≥32%, ≥34%, ≥36%, ≥38%, ≥40%, ≥42%, ≥44%, ≥46%, or, e.g., ≥48% of the total length of a delivery device in which it is designed to be utilized.

In aspects, a solid material device (Insert, reservoir) is designed to be utilized in a multi-element (multi-part, multi-component, or multi-assembly) delivery device such as multi-part, multi-component, multi-assembly delivery devices described herein. In aspects, such as in embodiments described herein, the sum of the total length of individual part(s), component(s) or assembly(ies) is greater than the total length of the delivery device when the delivery device is in a ready to use state (e.g., one or more part(s), component(s), or assembly(ies) reside at least in part (at least detectably or significantly) within one or more other part(s), component(s), or assembly(ies) of the delivery device. In aspects, solid material device(s) maintaining, releasing, or maintaining and releasing volatile compound(s) for use in such devices are positioned within one such part, component, or assembly of a multi-element device. In aspects, a solid material device described here comprises a length which is detectably or significantly less than that of the part, component, or assembly in which it is designed to be utilized, such as, e.g., comprising a length which is less than about half (≤~50%) of the length of the part, component, or assembly, or, e.g., ≤~48%, ≤~46%, ≤~44%, ≤~42%, ≤~40%, ≤~38%, ≤~36%, ≤~34%, ≤~32%, or ≤~30%, of the total length of the part, component, or assembly in which it is positioned within a device. In aspects, a solid material device (Insert, reservoir) has a length equal to at least about 20%, ≥22%, ≥24%, 26%, ≥28%, 30%, ≥32%, ≥34%, 36%, 38%, 40%, ≥42%, ≥44%, ≥46%, or, e.g., ≥48% of the total length of a part, component, or assembly in which it is positioned during device use. In aspects, a solid material device comprises a length representing a fraction of a total length of a delivery device in which it is designed to be utilized, when the delivery device is in a ready-to-use state, that is at least generally the same as, at least substantially the same as, at least essentially the same as, which is essentially the same as, or which is the same as the fraction of the total length of the delivery device part, component, or assembly in which it is positioned during delivery device use.

According to certain aspects, the solid material device (Insert (insert), reservoir) is maintained stably in position within delivery device part, component, or assembly, during delivery device use. In aspects, such a delivery device component is a volatile compound compartment (volatiles housing), e.g., insert compartment, e.g., Body Tube, described elsewhere herein, or within a compartment comprising one or more of the characteristic(s) of a volatile compound compartment (volatiles housing), e.g., insert compartment, e.g., Body Tube described herein. In aspects, such a volatile compound compartment (volatiles housing), e.g., insert compartment, e.g., Body Tube, or, e.g., similar such housing, comprises one or more insert support(s), e.g., insert stabilizer(s), which aid in the stable maintenance of an Insert therein. In aspects, such support(s), exemplified in certain embodiments herein as, e.g., compressible positioner(s) and fixed positioner(s), detectably or significantly engage the reservoir component (solid material device, i.e., insert) such that reservoir component (solid material device, i.e., insert) is maintained in a detectably or significantly stable position when engaged with the one or more support components.

In aspects support component(s) described here engage opposing end(s) of a solid material device (reservoir, Insert). In aspects, a solid material device (reservoir, Insert/insert) is positioned within a device such that its long axis at least generally aligns with, at least substantially aligns with, at least essentially aligns with, or aligns with the long axis of the delivery device into which it is placed. Also or alternatively, in aspects, a solid material device (reservoir, Insert/insert) is positioned within a device such that its long axis is at least generally oriented in the same direction as, is at least substantially oriented in the same direction as, is at least essentially oriented in the same direction as, or is aligned or oriented in the same direction as the long axis of the delivery device into which it is placed. In aspects, insert support(s) are positioned at locations along the long axis of the solid material device, which also falls along the long axis of the delivery device, and apply sufficient support to maintain the insert in a stable position.

According to aspects, a solid material device (Insert, reservoir) is maintained in position by two or more insert support(s). In aspects, one insert support is a fixed positioner. In aspects, the fixed positioner is a portion of another component. In aspects, the fixed positioner is a portion of an airflow limiter, e.g., Body crown. In aspects, a solid material device (Insert, reservoir) interfaces with such a fixed positioner, e.g., Body Crown, such that only one portion of the interfacing surface of the solid material device (insert, reservoir) contacts the fixed positioner, e.g., Body Crown. In aspects, less than 50%, e.g., ≤~45%, ≤~40%, ≤~35%, ≤~30%, ≤~25%, ≤~20%, ≤~15%, ≤~10%, or, e.g., ≤~5% of the total surface area of a surface of the solid material device (of the surface making contact with (interfacing) with a fixed positioner (e.g., Body Crown)), actual interfaces or makes contact with the fixed positioner (e.g., Body Crown).

In aspects, once a solid material device, e.g., insert/reservoir, is inserted into a delivery device, it is sufficiently stable therein such that it cannot easily exit the device without manual removal. In aspects, such a solid material device cannot be "blown" out of a delivery device. In aspects, even if a sufficiently strong forced air were injected into an, e.g., mouthpiece of a delivery device comprising a removable insert, the removable insert would be blocked from exiting (e.g., blocked from being blown out of) the delivery device by at least a portion of at least one delivery device part, component, or assembly.

In one aspect, the solid material device (insert, reservoir) is stably maintained within a volatile compound compartment (volatiles housing), e.g., insert compartment, e.g., Body Tube, within a delivery device described herein, when the delivery device comprising the insert is dropped from a distance of between about 1" to about 10", or, e.g., when the device is dropped from a distance of between about 1" to about 20", between about 1" to about 30", between about 1" to about 40", between about 1" to about 50", between about 1" to about 60", or, e.g., when the device is dropped from a distance of 60" or more. In aspects, the solid material device (reservoir, Insert/insert) is stably maintained within a volatile compound compartment (volatiles housing), e.g., insert compartment, e.g., Body Tube, within a delivery device described herein, such that when the component maintaining the insert is exposed to the outside environment, the insert is stably maintained within the component when the component (or, e.g., delivery device) is rotated 360 degrees in any direction. In aspects, a solid material device (insert, reservoir) can be removed or dislodged from a volatile compound compartment (volatiles housing), e.g., insert compartment, e.g., Body Tube, of a delivery device using a finger access point (e.g., Finger Recess or access gap) or by tapping the device on a surface with sufficient force to dislodge the insert.

According to one aspect, the invention provides a solid material device (insert, reservoir) having a length defined by a distance between a first end of the insert and a second end of the insert, wherein the insert is capable of resisting, is designed to resist, or resists a detectable or significant bending across its length when a force of between about 10 g to about 500 g is applied to one end or, e.g., to both (e.g., opposing) ends of the insert, such as, e.g., when a force of ~20 g-~500 g, ~40 g-~500 g, ~60 g-~500 g, ~80 g-~500 g, ~100 g-~500 g, ~120 g-~500 g, ~140 g-~500 g, ~160 g-~500 g, ~180 g-~500 g, ~200 g-~500 g, ~220 g-~500 g, ~240 g-~500 g, ~260 g-~500 g, ~280 g-~500 g, or ~300 g-~500 g is applied to one or both (e.g., opposing) ends of the insert, e.g., ~10 g-~480 g, ~10 g-~460 g, ~10 g-~440 g, ~10 g-~420 g, ~10 g-~400 g, ~10 g-~380 g, ~10 g-~360 g, ~10 g-~340 g, ~10 g-~320 g, or ~10 g-~300 g, such as, for example, ~20 g-~480 g, ~40 g-~460 g, ~60 g-~440 g, ~80 g-~420 g, ~100 g-~400 g, ~120 g-~380 g, ~140 g-~360 g, ~160 g-~340 g, ~180 g-~320 g, e.g., ~200 g, ~220 g, ~240 g, ~260 g, ~280 g, ~300 g, ~320 g, ~340 g, ~350 g, or ~360 g is applied to one end, of the insert or is applied to both (e.g., opposing) ends of the insert.

In certain aspects, a solid material device (Insert, reservoir) is at least measurably compressible. In one aspect, the solid material device, e.g., removable insert, when a force of about 50 g is applied to one or both ends of the removable insert, defines a minor arc subtending an angle of no less than about 170 degrees, as in, e.g., defines a minor arc subtending an angle of no less than ~171 degrees, ~172 degrees, ~173 degrees, ~174 degrees, ~175 degrees, ~176 degrees, ~177 degrees, ~178 degrees, ~179 degrees, or, e.g., no less than about 180 degrees.

According to certain aspects, a solid material device (reservoir, insert) requires a pull force of between about −0.02 N-about −2 N, such as, e.g., ~−0.04 N to ~2N, ~−0.06 N to ~−2N, ~−0.08 N to ~−2N, ~−0.1 N to ~2N, ~−0.12 N to ~2N, ~−0.14 N to ~2N, ~−0.16 N to ~−2N, ~−0.18 N to ~−2N, or ~−0.2 N to ~2N, e.g., ~−0.02 N to ~−1.8N, ~−0.02 N to ~−1.6N, ~−0.02 N to ~−1.4N, ~−0.02 N to ~−1.2N, ~−0.02 N to ~−1N, or ~−0.02 N to ~−0.5 N, e.g., ~0.04 N to ~−1.8N, ~−0.06 N to ~−1.6N, ~−0.08 N to ~−1.4N, ~−0.1 N to ~−1.2N, or, e.g., ~−0.12 N to ~−1N, e.g., ~−0.02 N-~−0.5N to remove the insert from a volatile compound compartment (volatiles housing), e.g., insert compartment, e.g., Body Tube.

According to certain aspects, a solid material device (insert, reservoir) is at least generally, at least substantially, at least essentially, essentially, or is fully protected (encompassed by a delivery device when inserted therein and when the delivery device is in a ready to use state. In aspects, volatile compound(s) within solid material device(s) are maintained therein due to the relative lack of exposure to surrounding environment due to its at least generally, at least substantially, at least essentially, essentially, or is full protection from the environment. In aspects, the position or housing of a solid material device within a delivery device detectably or significantly reduces the volatility of compound(s) (or, e.g., oil(s) in which they are maintained) such that flavor delivery from the solid material device(s) via delivery device(s) is detectably or significantly extended compared to that provided by delivery device(s) which provide detectably or significantly less protection from the outside environment.

In aspects, solid material device(s), e.g., insert(s), e.g., removable insert(s) detectably or significantly decrease(s) in weight as volatile compound(s) of oil(s), e.g., essential oil(s), maintained therein, are released. In aspects, solid material device(s), e.g., insert(s), e.g., removable insert(s) detectably or significantly decrease(s) in weight during product use. In aspects, solid material device(s), e.g., insert(s), e.g., removable insert(s) lose a detectable or significant volume of volatile compound(s) of oil(s) over time, e.g., over the course of use. In aspects, a change in weight of solid material device(s), e.g., insert(s), e.g., removable insert(s) corresponds to the loss of oil(s) maintained therein.

In aspects, a change in weight of solid material device(s), e.g., insert(s), e.g., removable insert(s) can be, e.g., about 5 mg/hour, ~7 mg/hour, 9 mg/hour, ~11 mg/hour, ~13 mg/hour, ~15 mg/hour, ~17 mg/hour, ~19 mg/hour, ~21 mg/hour, ~23 mg/hour, ~25 mg/hour, ~27 mg/hour, ~31 mg/hour, ~33 mg/hour, ~35 mg/hour, ~37 mg/hour, ~39 mg/hour, ~41 mg/hour, ~43 mg/hour, or, e.g., ~45 mg/hour. In aspects, such a change in weight represents the loss of oil(s) maintained therein. In aspects, a starting amount (weight) of oil maintained with such solid material device(s) can be, e.g., between about 200 mg and about 500 mg, such as, e.g., ~200 mg-~450 mg, ~200 mg-~400 mg, ~200 mg-~350 mg, or, e.g., ~250 mg-~500 mg, ~300 mg-~500 mg, or ~350 mg-~500 mg, as in, e.g., ~250 mg-~450 mg, ~300 mg-~400 mg, or, e.g., ~350 mg or about 340 mg.

In aspects, a change in weight of solid material device(s), e.g., insert(s), e.g., removable insert(s) can be, e.g., at least about 5 mg/hour, such as, e.g., ≥~10 mg/hour, ≥~15 mg/hour, ≥~20 mg/hour, ≥~25 mg/hour, ≥~30 mg/hour, ≥~35 mg/hour, ≥~40 mg/hour, or, e.g., ≥~45 mg/hour. In aspects, a change in weight of solid material device(s), e.g., insert(s), e.g., removable insert(s) corresponds to the loss of oil(s) maintained therein.

In aspects, a change in weight of solid material device(s), e.g., insert(s), e.g., removable insert(s) can be, e.g., less than about 45 mg/hour, such as, e.g., ≤~40 mg/hour, ≤~35 mg/hour, ≤~30 mg/hour, ≤~25 mg/hour, ≤~20 mg/hour, ≤~15 mg/hour, ≤~10 mg/hour, or, e.g., ≤~5 mg/hour. In aspects, a change in weight of solid material device(s), e.g., insert(s), e.g., removable insert(s) corresponds to the loss of oil(s) maintained therein.

In aspects, a change in weight of solid material device(s), e.g., insert(s), e.g., removable insert(s) can be, e.g., between about 5 mg/hour and about 45 mg/hour, such as, e.g., ~5 mg/hour-~40 μl/hour, ~5 mg/hour-~35 mg/hour, ~5 mg/hour-~30 mg/hour, ~5 mg/hour-~25 mg/hour, ~5 mg/hour-~20 mg/hour, ~5 mg/hour-~15 mg/hour, or, e.g., ~5 mg/hour-~10 mg/hour. In aspects a change in weight of solid material device(s), e.g., insert(s), e.g., removable insert(s) corresponds to the loss of oil(s) maintained therein.

In aspects, a change in weight of solid material device(s), e.g., insert(s), e.g., removable insert(s) can be, e.g., between about 10 mg/hour and about 45 mg/hour, such as, e.g., ~15 mg/hour-~45 mg/hour, ~20 mg/hour-~45 mg/hour, ~25 mg/hour-~45 mg/hour, ~30 mg/hour-~45 mg/hour, ~35 mg/hour-~45 mg/hour, or, e.g., ~40 mg/hour-~45 mg/hour. In aspects, a change in weight of solid material device(s), e.g., insert(s), e.g., removable insert(s) corresponds to the loss of oil(s) maintained therein.

In aspects, a change in weight of solid material device(s), e.g., insert(s), e.g., removable insert(s) can be, e.g., between about 7 mg/hour and about 43 mg/hour, such as, e.g., ~10 mg/hour-~40 mg/hour, ~13 mg/hour-~37 mg/hour, ~15 mg/hour-~35 mg/hour, ~17 mg/hour-~33 mg/hour, ~20 mg/hour-~30 mg/hour, or, e.g., ~23 mg/hour-~27 mg/hour. In aspects, a change in weight of solid material device(s), e.g., insert(s), e.g., removable insert(s) corresponds to the loss of oil(s) maintained therein.

In aspects, the standard deviation of the change in weight of solid material device(s), e.g., insert(s), e.g., removable insert(s) over time across a population of multiple solid material device(s), e.g., insert(s), e.g., removable insert(s) comprising at least substantially the same, at least essentially the same, or, e.g., the same oil(s), e.g., at least substantially the same, at least essentially the same, or, e.g., the same volatile compound(s), is less than about 20 mg/hour, such as, e.g., ≤~18 mg/hour, ≤~16 mg/hour, ≤~14 mg/hour, ≤~12 mg/hour, ≤~10 mg/hour, ≤~8 mg/hour, ≤~6 mg/hour, ≤~4 mg/hour, or, e.g., ~2 mg/hour.

In aspects, a change in weight of solid material device(s), e.g., insert(s), e.g., removable insert(s) can represent a loss of volume of oil(s) maintained therein of, e.g., about 10 μl/hour after exposing a fully loaded (e.g., as one explicit example, loaded with between about 0.1 and about 1 mL of oil having a density of between about 0.5 and about 1.2 g/mL) solid material device(s), e.g., insert(s), e.g., removable insert(s) to the open air. In aspects herein, "fully loaded" when used in reference to solid material device(s), e.g., insert(s), e.g., removable insert(s), means the state of the solid material device(s), e.g., insert(s), e.g., removable insert(s) when fully packaged in sealed packaging after manufacture and ready for end-user use. In aspects, solid material device(s), e.g., insert(s), e.g., removable insert(s) can lose a volume of oil(s) maintained therein at a rate of about 8 μl/hour, ~10 μl/hour, 12 μl/hour, ~14 μl/hour, ~16 μl/hour, ~18 μl/hour, ~20 μl/hour, ~22 μl/hour, ~24 μl/hour, ~26 μl/hour, ~28 μl/hour, ~30 μl/hour, ~32 μl/hour, ~34 μl/hour, ~36 μl/hour, ~38 μl/hour, ~40 μl/hour, ~42 μl/hour, ~44 μl/hour, ~46 μl/hour, ~48 μl/hour, ~50 μl/hour, ~52 μl/hour, ~54 μl/hour, ~56 μl/hour, ~58 μl/hour, or, e.g., about 60 μl/hour.

In aspects, solid material device(s), e.g., insert(s), e.g., removable insert(s) can lose a volume of oil(s) maintained therein at a rate of e.g., at least about 8 μl/hour, such as, e.g., ≥~10 μl/hour, ≥~12 μl/hour, ≥~14 μl/hour, ≥~16 μl/hour, ≥~18 μl/hour, ≥~20 μl/hour, ≥~22 μl/hour, ≥~24 μl/hour, ≥~26 μl/hour, ≥~28 μl/hour, ≥~30 μl/hour, ≥~32 μl/hour, ≥~34 μl/hour, ≥~36 μl/hour, ≥~38 μl/hour, ≥~40 μl/hour, ≥~42 μl/hour, ≥~44 μl/hour, ≥~46 μl/hour, ≥~48 μl/hour, ≥~50 μl/hour, ≥~52 μl/hour, ≥~54 μl/hour, ≥~56 μl/hour, ≥~58 μl/hour, or, e.g., at least about 60 μl/hour.

In aspects, solid material device(s), e.g., insert(s), e.g., removable insert(s) can lose a volume of oil(s) maintained therein at a rate of e.g., less than about 60 μl/hour, such as, e.g., ≤~58 μl/hour, ≤~56 μl/hour, ≤~54 μl/hour, ≤~52 μl/hour, ≤~50 μl/hour, ≤~48 μl/hour, ≤~46 μl/hour, ≤~44 μl/hour, ≤~42 μl/hour, ≤~40 μl/hour, ≤~38 μl/hour, ≤~36 μl/hour, ≤~34 μl/hour, ≤~32 μl/hour, ≤~30 μl/hour, ≤~28 μl/hour, ≤~26 μl/hour, ≤~24 μl/hour, ≤~22 μl/hour, ≤~20 μl/hour, ≤~18 μl/hour, ≤~16 μl/hour, ≤~14 μl/hour, ≤~12 μl/hour, ≤~10 μl/hour, or, e.g., less than about 8 μl/hour.

In aspects, solid material device(s), e.g., insert(s), e.g., removable insert(s) can lose a volume of oil(s) maintained therein at a rate of e.g., between about 8 μl/hour and about 60 μl/hour, such as, e.g., ~12 μl/hour-~60 μl/hour, ~16 μl/hour-~60 μl/hour, ~20 μl/hour-~60 μl/hour, ~24 μl/hour-~60 μl/hour, ~28 μl/hour-~60 μl/hour, ~32 μl/hour-~60 μl/hour, ~36 μl/hour-~60 μl/hour, ~40 μl/hour-~60 μl/hour, ~44 μl/hour-~60 μl/hour, ~48 μl/hour-~60 μl/hour, ~52 μl/hour-~60 μl/hour, or, e.g., ~56 μl/hour-~60 μl/hour.

In aspects, solid material device(s), e.g., insert(s), e.g., removable insert(s) can lose a volume of oil(s) maintained therein at a rate of e.g., between about 8 μl/hour and about 58 μl/hour, such as, e.g., ~8 μl/hour-~54 μl/hour, ~8 μl/hour-~50 μl/hour, ~8 μl/hour-~46 μl/hour, ~8 μl/hour-~42 μl/hour, ~8 μl/hour-~38 μl/hour, ~8 μl/hour-~34 μl/hour, ~8 μl/hour-~30 μl/hour, ~8 μl/hour-~26 μl/hour, ~8 μl/hour-~22 μl/hour, ~8 μl/hour-~18 μl/hour, ~8 μl/hour-~14 μl/hour, or, e.g., ~8 μl/hour-~10 μl/hour.

In aspects, solid material device(s), e.g., insert(s), e.g., removable insert(s) can lose a volume of oil(s) maintained therein at a rate of e.g., between about 9 μl/hour and about 58 μl/hour, such as, e.g., ~10 μl/hour-~56 μl/hour, ~11 μl/hour-~55 μl/hour, ~13 μl/hour-~54 μl/hour, ~15 μl/hour-~53 μl/hour, ~20 μl/hour-~52 μl/hour, ~22 μl/hour-~50 μl/hour, ~24 μl/hour-~50 μl/hour, ~26 μl/hour-~48 μl/hour, ~28 μl/hour-~46 μl/hour, ~30 μl/hour-~44 μl/hour, ~32 μl/hour-~42 μl/hour, ~34 μl/hour-~40 μl/hour, or, e.g., ~36 μl/hour-~38 μl/hour, as in, e.g., between about 14 μl/hour-~36 μl/hour.

In aspects, the standard deviation of the volume of oil(s) maintained in solid material device(s), e.g., insert(s), e.g., removable insert(s) across a population of multiple solid material device(s), e.g., insert(s), e.g., removable insert(s) comprising at least substantially the same, at least essentially the same, or, e.g., the same oil(s), e.g., at least substantially the same, at least essentially the same, or, e.g., the same volatile compound(s), is less than about 20 μL/hour, such as, e.g., ≤~18 μL/hour, ≤~16 μL/hour, ≤~14 μL/hour, ≤~12 μL/hour, ≤~10 μL/hour, ≤~8 μL/hour, ≤~6 μL/hour, ≤~4 μL/hour, or, e.g., ≤~2 μL/hour.

In aspects, delivery device(s) (device(s) designed to deliver volatile compound(s), e.g., flavored volatile compound(s) to the device user, e.g., device(s) described herein) comprising solid material device(s), e.g., insert(s), e.g., removable insert(s) volatilizes between about 0.1 μL and about 10 μL of oil from the solid material device(s), e.g., insert(s), e.g., removable insert(s) upon each administration to a user, e.g., upon each "draw," or application of suction to a delivery device maintaining a solid material device, by a user. In aspects, such amount(s) represent the amount of oil(s) provided to a user upon each use (draw).

In aspects, delivery device(s) comprising solid material device(s), e.g., insert(s), e.g., removable insert(s) volatilize(s) at least about 0.1 μL per use (e.g., per draw) by a user, such as, e.g., ≥~0.2 μL, ≥~0.4 μL, ≥~0.6 μL, ≥~0.8 μL, ≥~1 μL, ≥~1.5 μL, ≥2 μL, ≥~2.5 μL, ≥~3 μL, ≥~3.5 μL, ≥~4 μL, ≥~4.5 μL, ≥~5 μL, ≥~5.5 μL, ≥~6 μL, ≥~6.5 μL, ≥~7 μL, ≥~7.5 μL, ≥~8 μL, ≥~8.5 μL, ≥~9 μL, ≥~9.5 μL, or, e.g., ≥~10 μL per use by a user, e.g., per draw by a user. In aspects, such amount(s) represent the amount of oil(s) provided to a user upon each use (draw).

In aspects, delivery device(s) comprising solid material device(s), e.g., insert(s), e.g., removable insert(s) volatilize(s) no more than, (e.g., less than) about 10 μL per use (e.g., per draw) by a user, such as, e.g., ≤~9.5 μL, ≤~9 μL, ≤~8 μL, ≤~8.5 μL, ≤~8 μL, ≤~7.5 μL, ≤~7 μL, ≤~6.5 μL, ≤~6 μL, ≤~5.5 μL, ≤~5 μL, ≤~4.5 μL, ≤~4 μL, ≤~3.5 μL, ~3 μL, ≤~2.5 μL, 9-2 μL, ≤~1.5 μL, or, e.g., ≤~1 μL per use by a user, e.g., per draw by a user. In aspects, such amount(s) represent the amount of oil(s) provided to a user upon each use (draw), such as, e.g., 9-0.9 μL, 9-0.8 μL, 9-0.7 μL, 9-0.6 μL, ≤~0.5 μL, ≤~0.4 μL, 9-0.3 μL, 9-0.2 μL, or, e.g., ≤~0.1 μL per use by a user, e.g., per draw by a user.

In aspects, delivery device(s) comprising solid material device(s), e.g., insert(s), e.g., removable insert(s) volatilize(s) between about 0.1 μL and about 9.5 μL of oil from the removable insert upon each administration to a user, e.g., upon each "draw" by a user, such as, e.g., ~0.1 μL-~9 μL, ~0.1 μL-~8.5 μL, ~0.1 μL-~8 μL, ~0.1 μL-~7.5 μL, ~0.1 μL-~7 μL, ~0.1 μL-~6.5 μL, ~0.1 μL-~6 μL, ~0.1 μL-~5.5 μL, ~0.1 μL-~5 μL, ~0.1 μL-~4.5 μL, ~0.1 μL-~4 μL, ~0.1 μL-~3.5 μL, ~0.1 μL-~3 μL, ~0.1 μL-~2.5 μL, ~0.1 μL-~2 μL, ~0.1 μL-~1.5 μL, ~0.1 μL-~1 μL, or, e.g., ~0.1 μL-~0.5 μL per use by a user, e.g., per draw by a user. In aspects, such amount(s) represent the amount/concentration of oil(s)/VC(s) provided to a user upon each use (each "draw").

In aspects, delivery device(s) comprising solid material device(s), e.g., insert(s), e.g., removable insert(s) volatilize(s) between about 0.1 μL and about 10 μL of oil from the removable insert upon each administration to a user, e.g., upon each "draw" by a user, such as, e.g., ~0.2 μL-~10 μL, ~0.4 μL-~10 μL, ~0.6 μL-~10 μL, ~0.8 μL-~10 μL, ~1 μL-~10 μL, ~1.5 μL-~10 μL, ~2 μL-~10 μL, ~2.5 μL-~10 μL, ~3 μL-~10 μL, ~3.5 L-~10 μL, ~4 μL-~10 μL, ~4.5 μL-~10 μL, ~5 μL-~10 μL, ~5.5 μL-~10 μL, ~6 μL-~10 μL, ~6.5 μL-~10 μL, ~7 μL-~10 μL, ~7.5 μL-~10 μL, ~8 μL-~10 μL, ~8.5 μL-~10 μL, ~9 μL-~10 μL, or, e.g., ~9.5 μL-~10 μL per use by a user, e.g., per draw by a user. In aspects, such amount(s) represent the amount of oil(s) provided to a user upon each use (draw).

In aspects, delivery device(s) comprising solid material device(s), e.g., insert(s), e.g., removable insert(s) volatilize(s) between about 0.1 μL and about 9 μL of oil from the removable insert upon each administration to a user, e.g., upon each "draw" by a user, such as, e.g., ~0.2 μL-~8.5 μL, ~0.3 μL-~8 μL, ~0.4 μL-~7.5 μL, ~0.5 μL-~7 μL, ~0.6 μL-~6.5 μL, ~0.7 μL-~6 μL, ~0.8 μL-~5.5 μL, or, e.g., ~0.9 μL-~5 μL, per use by a user, e.g., per draw by a user, such as, e.g., between about 0.2 μL and about 2 μL per administration, e.g., per draw. In aspects, such amount(s) represent the amount of oil(s) provided to a user upon each draw.

In aspects, an amount of essential oil exposure per use (e.g., per draw) of a product by a user is less than about 2 μL, less than about 1.5 μL, or less than about 1 μL. In aspects, the total daily exposure to essential oil(s) upon use of the product is dependent upon the number of times a delivery device comprising a solid material device, e.g., insert, e.g., removable insert, is used per day. For example, if a user were to take about 30 draws per day, in aspects, the amount of essential oil exposure would be less than about 60 μL per day, such as, e.g., ≤~58 μL per day, e.g., ≤~56 μL/day, ≤~54 μL/day, ≤~52 μL/day, ≤~50 μL/day, ≤~48 μL/day, ≤~46 μL/day, ≤~44 μL/day, ≤~42 μL/day, ≤~40 μL/day, ≤~38 μL/day, ≤~36 μL/day, ≤~34 μL/day, ≤~32 μL/day, or, e.g., ≤~30 μL/day, such as, e.g., ≤~28 μL/day, 9-26 μL/day, 9-24 μL/day, ≤~22 μL/day, or 9-20 μL/day, e.g., in aspects even 9-18 μL/day, 9-16 μL/day, 9~14 μL/day, 9-12 μL/day, or, e.g., 9-10 μL/day.

According to aspects, once solid material device(s), e.g., insert(s), e.g., removable insert(s) comprising volatile compound(s) (oil(s), e.g., essential oil(s) comprising volatile compound(s)) described herein is/are placed within delivery device(s) described herein, the solid material device(s), e.g., insert(s), e.g., removable insert(s) is/are at least generally, at least substantially, at least essentially, is essentially, or is protected from detectable or significant loss of volatile compound(s) (oil(s)), e.g., essential oil(s) comprising volatile compound(s)) therefrom.

In certain aspects, solid material device(s), e.g., insert(s), e.g., removable insert(s) can lose less than about 20%, such as, e.g., ≤~18%, ≤~16%, ≤~14%, 9-12%, ≤~10%, ≤~8%, ≤~6%, ≤~4%, or, e.g., 9-2%, of the total amount of oil(s), e.g., total amount of essential oil(s) (comprising volatile compound(s)) present in the removable insert(s) immediately upon packaging post-manufacture, after a total of about 30 uses, e.g., about 30 "draws" taken over a period of about 240 minutes (about 4 hours).

In one specific exemplary embodiment, the invention provides a passive delivery device for the delivery of one or more volatile compound(s), the delivery device comprising at least a volatile compound outlet component, a mating component, and an airflow restrictor, the volatile compound outlet component comprising a storage compartment for maintaining a removable insert, e.g., a solid material device capable of maintaining, releasing, or maintaining and releasing one or more volatile compounds. In aspects, the storage compartment is an internal compartment present as a volatile compound compartment (volatiles housing), e.g., insert compartment, e.g., Body Tube.

In this and other part, component, assembly, mechanism, function, feature, or operational aspect(s) of the invention, the invention also can be characterized as comprising a "means" for maintaining, delivering, or maintaining and delivering one or more volatile compounds. In such a respect, any known equivalents of such named volatile compound delivery components can also be, e.g., are, incorporated into devices or methods of the invention. As with other sections similarly described herein, any of the components of the invention can be, where suitable, described as means (e.g., the above-described components (e.g., devices or elements) for maintaining, delivering, or maintaining and delivering one or more volatile compounds via inhalation can be described as volatile compound delivery means or solid material device means or means for providing one or more volatile compounds to a delivery device for the delivery of the one or more volatile compounds to the delivery device user).

Volatile Compounds and VCCs

In a first aspect, the invention provides a delivery device for the delivery of volatile compound(s). In aspects, volatile compound(s) are flavored volatile compound(s). In aspects, volatile compound(s) are provided as non-combustible oil(s). In aspects, volatile compound(s) are provided as essential oil(s). In aspects, VCs are contained in VCCs in a device.

In aspects, one or more volatile compounds provided by a delivery device, a solid material device (e.g., insert, e.g., removable insert), or, e.g., both, is/are directed to a health condition, such as, e.g., are delivered for the purpose of treating one or more conditions or states of a patient. Such a condition or state can be, e.g., a state of elevated anxiety, stress, or other similar discomfort. In aspects, such a condition can be a condition related to a craving, such as a condition of craving a cigarette or other tobacco product or nicotine product. In aspects, such a condition can be a condition related to a craving to use an electronic vaping device. In other aspects, one or more volatile compounds provided by a delivery device, solid material device (e.g., insert, e.g., removable insert), or, e.g., both, is/are directed to pure enjoyment or pleasure, such as, e.g., a taste experience.

In aspects, one or more volatile compound(s) is a pharmaceutically active drug compound. In other aspects, one or more volatile compound(s) is not a pharmaceutically active drug compound. In aspects, one or more volatile compound(s) is a botanical compound. In aspects, one, more, or all volatile compound(s) are compounds not characterizable as a nicotinic compound. In aspects, one, more, or all volatile compounds are compounds not characterizable as a tobacco-related compound. In aspects, the one or more volatile compounds is a volatile compound safe for mammalian consumption, such as safe for receipt by the mouth.

In certain aspects, the one or more volatile compounds is/are volatile compounds maintained within a fluid. In aspects, the one or more volatile compound(s) are maintained within a gas. In aspects, the one or more volatile compound(s) are maintained within a liquid. In aspects, the one or more volatile compound(s) are maintained within a solution, suspension, dispersion, or other fluid. In aspects, the one or more volatile compound(s) are maintained within an oil. In aspects, the oil is maintained within a solid material device (e.g., a fibrous solid material device or, e.g., a ceramic solid material device), e.g., an insert, e.g., a removable insert, until released and becoming available for delivery.

According to certain aspects, the invention provides a solid material device, i.e., insert, e.g., removable insert, comprising one or more volatile compounds, the solid material device being designed for use within a device for delivering the one or more volatile compounds, wherein the one or more volatile compounds are derived from one or more botanicals or are provided as an oil (e.g., essential oil) comprising an extract from botanicals belonging to, e.g., the botanical family Lamiaceae, e.g., *Mentha piperita* (peppermint), *Mentha spicata* (spearmint), *Lavandula* (lavender), *Salvia rosmarinus* (rosemary), *Origanum vulgare* (oregano), *Thymus vulgaris* (thyme), etc.; the botanical family Piperaceas, e.g., *Piper nigrum* (black pepper); the botanical family Myrtaceae, e.g., *Eucalyptus radiata* (eucalyptus), *Eucalyptus globulus* (eucalyptus), *Syzygium aromaticum* (clove), *Melaleuca alternifolia* (tea tree); the botanical family Rutaceae, e.g., *Citrus limon* (lemon), *Citrus sinensis* (orange), *Aurantifolia* (lime) (or, e.g., *Citrus aurantifolia, Citrus latifolia, Citrus glauca*, and *Citrus hystrix*), *Citrus paradisi* (grapefruit), *Citrus bergamia* (bergamot orange); the botanical family Annonacea, e.g., *Cananga* adorate (ylang-ylang); the botanical family Lauraceae, e.g., *Cinnamomum verum* (cinnamon), *Ocotea quixos* (*Ocotea* or Ishpingo); the botanical family Myristicaceae, e.g., *Myristica fragrans* (nutmeg); the botanical family Pine, e.g., *Cedrus* (cedarwood), *Picea mariana* (black spruce); the botanical family Fabaceae, e.g., Genus *Copaifera* (copaiba); the botanical family Orchidaceae, e.g., *Vanilla planifolia* (vanilla); the botanical family Poaceae, e.g., *Cymbopogon* species (including, e.g., lemongrass); the botanical family Malvaceae, e.g., *Theobroma cacao* (cocoa); the botanical family Ericaceae, e.g., *Vaccinium macrocarpon* (cranberry); the botanical family Asteraceae, e.g., *Artemisia pallens* (davana); the botanical family Cupressaceae, e.g., *Juniperus communis* (juniper), *Cupressus* (cypress); the botanical family Burseraceae, e.g., Boswellia sacra (frankincense); and, e.g., the botanical family Geraniaceae, e.g., *Pelargonium graveolens* (geranium), etc.; or other such botanicals or mixes of botanicals known in the art or oils of botanicals (e.g., essential oils) known in the art, e.g., Anshen essential oil (mixture of lavender, sweet orange, sandalwood, frankincense, orange blossom, rose, and agarwood essential oil), jasmine essential oil, Hinoki cypress (*Chamaecyparis* obtuse) leaf oil, ginger essential oil, cardamom essential oil, or oils extracted from any one or more of the following plants (some of which may be repetitively provided as members of botanical families above): *Anthemis nobilis, Foeniculum vulgare, Hyssopus officinalis, Matricaria recutita, Melissa officinalis, Myrtus communis, Ocimum basilicum, Pogostemon cablin, Rosa damascena, Salvia sclarea, Santalum album*, or a combination of, e.g., 2 or more, 3 or more, 4 or more, 5 or more, 6 or more, 7 or more, 8 or more, 9 or more, or, e.g., 10 or more of thereof. In certain aspects, the one or more volatile compounds provided for inhalation which may be derived from or provided by a source listed above or otherwise known in the art is a compound which is safe for human inhalation.

Means for Performing/Accomplishing Function(s)

In aspects, devices provided by the invention comprise one or more means for performing or accomplishing one or more specific functions. In general, any element described herein as a "means" for performing a function can also, wherever suitable, serve as a "step for" performing a function in the context of methods of the invention, and vice versa. E.g., a component or mechanism described herein as a means for releasably connecting a first and second device component also simultaneously and implicitly supports a method of making such a device comprising such a component or mechanism, or, e.g., a device comprising, e.g., a means of maintaining a removable solid material insert stably in position within a delivery device implicitly and simultaneously provides a step for, e.g., a method of using the delivery device wherein a removable solid material insert is stably maintained in position within the delivery device comprising the use of such removable insert (or insert) stabilization means.

In one aspect, delivery devices provided by the invention comprise providing selectively releasable engagement, e.g., rapidly releasable engagement, of a first device component and a second device component, such means for releasable engagement providing rapid releasability of the two components ("selective releasable engagement means" or "means for selective engagement"). Support for means for selective engagement can be found in, e.g., the sections entitled (or comprising a title similar to, or, similarly in other section(s) further describing elements therein), "Selective Releasable Engagement of Elements," "Selectively Releasable Engagement Mechanism (Magnet)," and, e.g., "Engagement Mechanism Counterpart (Barrel Collar)."

In one aspect, delivery devices provided by the invention comprise facilitating the inhalation of one or more volatile compounds ("inhalation facilitation means" or "means for inhalation facilitation"). Support for means for inhalation facilitation can be found in, e.g., the section entitled (or comprising a title similar to, or, similarly in other section(s) further describing elements therein), "Volatile Compound Compartment Component (Body Tube), "Volatile Compound Delivery Facilitation Component (Mouthpiece)/User Engagement."

In one aspect, delivery devices provided by the invention comprise a component facilitating the protection of a volatile compound delivery facilitation component from undue wear ("volatile compound delivery facilitation component protection means" or "means for protecting the volatile compound delivery facilitation component"). Support for means for protecting the volatile compound delivery facilitation component can be found in, e.g., the section entitled (or comprising a title similar to, or, similarly in other section(s) further describing elements therein), "User Engagement Component for Receiving Volatile Compounds—Supplement (Mouthpiece Tube)" and, e.g., in the section entitled, "Mouthpiece Component Attachment Insert (Mouthpiece Attachment Insert)."

In one aspect, delivery devices provided by the invention comprise a component for holding, housing or otherwise stably maintaining a means for maintaining, releasing, or maintaining and releasing one or more volatile compounds, e.g., a removable insert ("removable insert housing means" or "means for housing a removable insert"). Support for means for housing a removable insert can be found in, e.g., the section entitled (or comprising a title similar to, or, similarly in other section(s) further describing elements therein), "Volatile Compound Compartment Component (Body Tube)."

In one aspect, delivery devices provided by the invention comprise a component for stably maintaining or stabilizing a means for maintaining, releasing, or maintaining and releasing one or more volatile compounds, e.g., a removable insert ("insert stabilization means," "removable insert stabilization means," or "means for stabilizing a removable insert"). Support for means for stabilizing a removable insert can be found in, e.g., the section entitled (or comprising a title similar to, or, similarly in other section(s) further describing elements therein), "Compressible Positioner (Insert spring) and Other Insert Supports" and "Airflow Control Limiter Element(s) (Body Crown)."

In one aspect, delivery devices provided by the invention comprise one or more components for controlling airflow through a delivery device ("airflow control means" or "means for airflow control"). Support for means for airflow control can be found in, e.g., the sections entitled (or comprising a title similar to the phrases, or, similarly in other section(s) further describing elements therein), "Airflow Control Limiter Element(s) (Body Crown)," "Airflow Control Second Component (Barrel Crown)," and, e.g., "Airflow Restrictor (Airflow Control Mechanism)."

In one aspect, delivery devices provided by the invention comprise a component for housing one or more delivery device components required for suitable delivery device operation or function while providing an aesthetically pleasing delivery device appearance ("outer shell means" or "means of providing an outer shell"). Support for means of providing an outer shell can be found in, e.g., the section entitled (or comprising a title similar to, or, similarly in other section(s) further describing elements therein), "Mating Component Exterior/Outer Shell (Barrel)."

In one aspect, delivery devices provided by the invention comprise a component facilitating the protection of an outer shell component from undue wear or volatile compound contamination ("outer shell protection means" or "means for protecting an outer shell"). Support for means for protecting an outer shell can be found in, e.g., the section entitled (or comprising a title similar to, or, similarly in other section(s) further describing elements therein), "Mating Component Exterior/Outer Shell Protection Mechanism (Barrel Tube)."

In one aspect, delivery devices provided by the invention comprise visual indicators indicating the spatial orientation of one or more device components or indicating the operational status of an airflow control mechanism or other operational mechanism ("visual indicator means" or "means for visual indicator(s)"). Support for means for visual indicator(s) can be found in, e.g., the section entitled (or comprising a title similar to the phrase, or, similarly in other section(s) further describing elements therein), "Visual Indicator(s)—Sight Discernable Indicators."

In one aspect, delivery devices provided by the invention comprise tactile, audible, or tactile and audible indicator(s) indicating the status of one or more operational characteristics of the delivery device, e.g., the operational status of an airflow control component ("tactile/audible indicator means" or "means for providing tactile/audible indicator(s)"). Support for means for providing tactile/audible indicator(s) can be found in, e.g., the sections entitled (or comprising a title similar to the phrases, or, similarly in other section(s) further describing elements therein), "Airflow Control Limiter Element(s) (Body Crown)," "Airflow Control Second Component (Barrel Crown)," and, e.g., "Airflow Restrictor (Airflow Control Mechanism)" and its subsection, "Tactile/Audible Indicator(s)—Associated with an Airflow Control Mechanism."

In one aspect, delivery devices provided by the invention utilize a removable component capable of maintaining, delivering, or maintaining and delivering one or more volatile compounds, e.g., flavored compound(s) for delivery, e.g., for delivery to the mouth of a user via a delivery device ("volatile compound delivery means," "flavor delivery means," "flavored compound delivery means,", "means for delivering volatile compound(s)," or "means for delivering flavored compound(s)"). Support for means for delivering volatile compound(s), e.g., flavored volatile compound(s) can be found in, e.g., the section entitled (or comprising a title similar to the phrase, or, similarly in other section(s) further describing elements therein), "Solid Material Device Maintaining/Releasing Compound(s) (Insert)."

Washability/Durability

In aspects, one or more part(s), component(s), or assembly(ies) of delivery device(s) described herein are made of sufficiently durable materials so as render the device(s) reusable, such as, e.g., the devices can be used 2 or more times, ~10 or more times, ~50 or more times, ~100 or more times, ~250 or more times, ~500 or more times, or ~1000 or more times, such as, e.g., over a period of at least about 1 day, ~1 week, ~1 month, ~1 year, ~2 years, ~3 years, ~4 years, ~5 years, or, e.g., ~10 years or longer. In aspects, delivery device(s) described herein and components thereof are made of sufficiently durable materials so as to be capable of sustaining a drop onto a hard surface from a distance of about 3 inches, ~6 inches, ~1 foot, ~18 inches, ~2 feet, ~30 inches, ~3 feet, ~4 feet, ~6 feet, ~8 feet, ~10 feet, ~12 feet, ~14 feet, ~16 feet, ~18 feet, or, e.g., ~20 feet or more without suffering damage which renders the device(s) inoperable (e.g., the device(s) remain fully operable).

According to aspects, one or more part(s), component(s), or assembly(ies) of delivery device(s) provided by the invention are made of a material which is washable. Therefore, in aspects, one benefit of the device(s) herein is the ability to maintain hygienic use of such device(s) over time. In aspects, for example, a device volatile compound outlet component can be capable of being washed. In aspects, one or more part(s), component(s), or assembly(ies) of delivery device(s) described herein can be washed with typical dishwashing detergent(s), dishwashing liquid(s), soap(s), including antibacterial soap(s), common sanitizers comprising alcohols (e.g., ethanol (ethyl alcohol) or isopropyl alcohol (isopropanol or 2-propanol)), etc. In aspects, one or more part(s), component(s), or assembly(ies) of delivery device(s) herein can tolerate exposure to or submersion in liquid(s) such as water having a temperature typical of washing materials for sanitary purposes, such as, e.g., water at a temperature of about 50 degrees Celsius (° C.) to about 200° C., such as, e.g., ~60° C.-~200° C., ~70° C.-~200° C., ~80° C.-~200° C., ~90° C.-~200° C., ~100° C.-~200° C., ~110° C.- ~200° C., ~120° C.-~200° C., such as, e.g., ~50° C.-~190° C., ~50° C.-~180° C., ~50° C.-~170° C., ~50° C.-~160° C., ~50° C.-~150° C., ~50° C.-~140° C., ~50° C.-~130° C., ~50° C.-~120° C., ~50° C.-~110° C., or, e.g., ~50° C.-~100° C., as in, for example, water having a temperature of between about ~120° C.-~180° C., which may be typical of water temperatures present in a common household dishwashing machine. Thus, in aspects, one or more part(s), component(s), or assembly(ies) of device(s) herein may be washed in a common household dishwashing machine. According to aspects, device(s) herein comprise at least one part, component, or assembly which is sufficiently durable to be dishwasher safe (e.g., can tolerate exposure to temperature(s) and moisture associated with washing in a dishwashing machine) while one or more other part(s), component(s), or assembly(ies) are not sufficiently durable to withstand the environment of a dishwashing machine (for example, such part(s), component(s), or assembly(ies) may be subject to moisture absorption or may not be capable of maintaining structural integrity when exposed to such temperature(s).

Systems

In aspects, the invention provides systems for providing one or more volatile compounds to a user, the system comprising a delivery device, such as any one or more of the above-described devices, and one or more solid material device(s) for maintaining/releasing compound(s) (Insert(s)) which is/are compatible for use within the delivery device or other device(s), such as a device support device.

In aspects, the delivery device can be any delivery device described herein, e.g., a delivery device comprising one or more characteristics of the delivery device(s) described herein, such as, e.g., a delivery device described under the broad section entitled, "Delivery Devices." In aspects, the solid material device can be any solid material device described herein capable of maintaining, releasing, or maintaining and releasing one or more volatile compounds for delivery and which is compatible with a delivery device provided therewith, such as, e.g., a solid material insert characterizable as a removable insert (e.g., an insert which can be selectively inserted into and removed from, e.g., repeatedly inserted into and removed from, a delivery device. In aspects, the solid material device is any solid material device described herein, e.g., a solid material device, e.g., removable insert comprising one or more characteristics of such component/devices described herein, such as, e.g., a solid material device for maintaining/releasing compound(s) described within the section entitled, "Solid Material Device Maintaining/Releasing Compound(s) (Insert)."

In one specific aspect, the invention provides a non-electronic, non-heating delivery device system for the delivery of one or more volatile compounds to a user, the device system comprising (a) a non-electronic, non-heating delivery device and (b) a solid material device, e.g., removable insert, designed to be removably maintained therein, wherein the non-electronic, non-heating delivery device comprises a first primary component and a second primary component releasably bound to one another by a selectively releasable force mechanism, e.g., a rapidly releasable force mechanism, e.g., a magnetic force, such that the first primary component and second primary component can be completely disengaged from one another or, alternatively, can be securely bound to one another, the delivery device further comprising an adjustable airflow control mechanism controlled by the rotation of the first primary component and the second primary component relative to one another, and the solid material device, e.g., removable insert, is designed to maintain, release, or maintain and release the one or more volatile compounds for delivery to a user.

In another specific aspect, the invention provides a non-electronic, non-heating delivery device system for the delivery of one or more volatile compounds to a user, the device system comprising a non-electronic, non-heating delivery device and a solid material device, e.g., removable insert, capable of being or designed to be inserted therein, the solid material device, e.g., removable insert, capable of maintaining, releasing, or maintaining and releasing the one or more volatile compounds for delivery, wherein, in use, (a) at least about one quarter (¼), e.g., ≥~½, ≥~¾, or, e.g., the entirety of, of the solid material device's, e.g., the removable insert's, longest dimension is engaged with a first primary component of the non-electronic, non-heating delivery device, and (b) the entirety of the solid material insert, e.g., removable insert, is positioned within a second primary component of the non-electronic, non-heating delivery device, and wherein the first and second primary components of the non-electronic, non-heating delivery device are selectively dis-engageable, e.g., rapidly releasable, from one another.

In another specific aspect, the invention provides a non-electronic, non-heating delivery device system for the delivery of one or more volatile compounds to a user, the device system comprising a non-electronic, non-heating delivery device and a solid material device, e.g., a removable insert, capable of maintaining, releasing, or maintaining and releasing one or more volatile compounds, wherein the solid material device, e.g., removable insert, comprises a first end, a second end, and at least one non-circuitous passageway passing through the solid material device from its first end to its second end.

In another specific aspect, the invention provides a non-electronic, non-heating delivery device system for the delivery of one or more volatile compounds to a user, the device system comprising a non-electronic, non-heating delivery device comprising a first primary component and a second primary component capable of rotating, designed to rotate or which rotate relative to one another and a removable solid material device capable of maintaining, releasing, or maintaining and releasing the one or more volatile compounds for delivery, wherein the non-electronic, non-heating delivery device comprises an airflow control mechanism adjustable in discrete increments by the rotation of the first primary component and the second primary component of the non-electronic, non-heating delivery device in relation to one another.

Kit

In aspects, the invention provides a kit comprising a delivery device capable of providing, designed to provide, or which provides one or more volatile compounds to a delivery device user, such a delivery device being any delivery device described herein or having characteristic(s) of delivery device(s) described herein, and one or more of the solid material device(s), e.g., removable insert(s), capable of maintaining, releasing, or maintaining and releasing one or more volatile compounds described herein. In aspects, such a kit provides two or more such solid material devices, e.g., removable inserts, such as ≥~3, ≥~4, ≥~5, ≥~6, ≥~7, ≥~8, ≥~9, or ≥~10.

In certain aspects, within a kit comprising a delivery device and two or more solid material devices, e.g., removable inserts, all solid material devices, e.g., removable inserts, of the kit comprise at least generally the same, at least substantially the same, at least essentially the same, essentially the same, or the same one or more volatile compounds. In aspects, within a kit comprising a delivery device and two or more solid material devices, e.g., removable inserts, at least one of the solid material devices, e.g., removable inserts, of the kit comprise one or more volatile compounds which is detectably or significantly different from, e.g., which is at least at least generally different than, at least substantially different than, or is different from at least one other of the solid material devices, e.g., removable inserts.

In certain aspects, the invention provides a kit comprising two or more solid material device(s), e.g., removable insert(s), capable of maintaining, releasing, or maintaining and releasing one or more volatile compounds described herein. In aspects, such a kit provides two or more such solid material devices, e.g., removable inserts, such as ≥~3, ≥~4, ≥~5, ≥~6, ≥~7, ≥~8, ≥~9, or ≥~10 such solid material devices. In aspects, a kit provides more than 10 solid material devices, e.g., removable inserts. In aspects, the kit is provided as an airtight package containing a plurality of solid material devices, e.g., removable inserts. In aspects the solid material device(s), e.g., removable insert(s), of a kit are compatible for use within a delivery device described herein, or, in aspects, e.g., having any one or more characteristics of the delivery device described herein.

In certain aspects, within a kit comprising two or more solid material devices, e.g., removable inserts, all solid material devices, e.g., removable inserts, of the kit comprise at least generally the same, at least substantially the same, at least essentially the same, essentially the same, or the same one or more volatile compounds. In aspects, within a kit comprising a delivery device and two or more solid material devices, e.g., removable inserts, at least one of the solid material devices, e.g., removable inserts, of the kit comprise one or more volatile compounds which is detectably or significantly different from, e.g., which is at least at least generally different than, at least substantially different than, or is different from at least one other of the solid material devices, e.g., removable inserts.

Accessories

In aspects, the invention is a system for providing one or more volatile compounds to a user, the system comprising a delivery device for providing volatile compounds to a user and one or more accessories, which in another respect be considered as elements of a system. In aspects, an accessory can be a device support unit. In aspects, a device support unit can be a device stand. In certain aspects, a device stand can be a storage unit or storage stand. In aspects, a device support unit, e.g., device stand, is capable of receiving and storing the delivery device when it is not in use. In aspects, a device support unit may be comprised of one or more materials, e.g., stainless steel, wood, plastic, zinc, titanium, etc. In aspects, the device support unit, e.g., device stand is made of an inexpensive metal such as zinc and finished with a powder coating of titanium.

In aspects, a device support unit, e.g., device stand, comprises a top surface component for receiving and holding a delivery device wherein the top surface component is made of a material other than stainless steel, e.g., hard plastic, veneer, wood, etc. so as to not scratch the delivery device upon placement and removal from the device stand. In aspects, the device support unit, e.g., device stand engages and supports a delivery device by way of a magnet placed within the device support unit, e.g., beneath the top surface component. In aspects, the magnet housed within the device support unit engages the delivery device at the location of the magnet of the delivery device. In aspects, the top surface component is thin enough to allow the magnet beneath its surface to engage and support a delivery device but not so thin as to prevent the user from removing the delivery device from the device stand with minimal effort, e.g., the user should be able to remove the delivery device from the device stand with a single hand and without moving the device stand from the surface it is resting on. In aspects, the device support unit, e.g., device stand weighs about 150 grams. In aspects, a device support unit, e.g., device stand, comprises a top surface component and the top surface component further comprises a domed surface.

In aspects, a device support unit, e.g., device stand, comprises a first height and a second height that form an angled top surface such that when a delivery device is engaged to the device stand, the mouthpiece opening of the delivery device will be pointed in a direction more downward and the airflow inlet portion of the delivery device will be pointed in a direction more upward. In aspects, when a delivery device is engaged to the device support unit, e.g., device stand, the delivery device is in parallel with the top surface component. In aspects, the polarity of the magnet of the delivery device and the magnet of the device support unit, e.g., device stand, are oriented such that the delivery device will always self-align to the same position when it is placed on the device stand. In aspects, the delivery device and device support unit can, together, act as a fidgeting device/element, e.g., the user can spin the device in a clock-like motion while it is engaged to the device stand. Further, in aspects, this sort of fidgeting can help to reduce anxiety and stress, as described elsewhere here.

In aspects, the device support unit is a device stand, as described above, but wherein the first height and second height are equal, therein giving the device stand a flat top surface. In aspects, a device support system does not comprise a magnet and instead, cradles the delivery device to prevent it from moving.

Methods

In aspects, the invention provides methods of using any one or more of the delivery devices or systems described herein to achieve one or more outcomes. In one aspect, practicing such method(s) results in users experiencing pleasurable sensory experiences. In aspects, practicing methods detectably or significantly reduce a habit-related craving, symptom, or in some cases habit-related activity, such as a smoking/vaping habit-related craving in an individual. Such results can be determined by self-assessment, user surveys, or an adequately powered and controlled study/trial or survey, in aspects administered or conducted by suitably trained individual(s) recognized as capable of identifying reduction in such symptoms, cravings, or related physiological factors, sensations, or behaviors (other examples of which being described elsewhere). In aspects, the delivery device is a passive delivery device. In aspects, the delivery device is a non-heating delivery device. In aspects, the delivery device is a non-electronic delivery device. In aspects, the delivery device comprises heating component(s). In aspects, the delivery device comprises electronic component(s).

In aspects, the individual is a human having previously routinely, e.g., at least once per week, ≥~2×/week, ≥~3×/week, ≥~5×/week, ≥~7×/week, ≥~2×/day, ≥~3×/day, ≥~4×/day, ≥~5×/day, ≥~6×/day, ≥~7×/day, ≥~8×/day, ≥~9×/day, ≥~10×/day, ≥~12×/day, ≥~14×/day, ≥~16×/day, ≥~18×/day, ≥~20×/day participated in an undesirable habit, e.g., a tobacco-smoking-related habit, a nicotine consumption habit, a vaping habit, an e-cigarette habit, or any combination of any or all thereof, such as, e.g., for a period of a least about 1 month, ≥~2 months, ≥~3 months, ≥~6 months, ≥~9 months, ≥~12 months, ≥~18 months, ≥~24 months, ≥~30 months, ≥~36 months or more of their life. In aspects, such an individual is characterizable as having or previously suffering from an addition to a smoking habit, e.g., a tobacco-smoking-related habit, a nicotine consumption habit, a vaping habit, an e-cigarette habit, or any combination of any or all thereof. Herein, a smoking habit can comprise a habit related to any one or more of inhalation-related or manual-manipulation-related rituals associated with, e.g., tobacco-smoking, nicotine consumption, vaping, e-cigarette smoking, or, e.g., any combination thereof. Herein a smoking-habit related craving can be, e.g., as is described elsewhere herein, an oral craving, e.g., having something in their mouth, inhaling one or more compounds, e.g., inhaling a flavored inhalant, holding an object, e.g., a device to their lips, feeling the device on or between their lips, or similar such oral-fixation-related craving. In aspects a smoking-habit related craving can be a manual manipulation-related craving, such as, e.g., holding an object, e.g. device, in their hand, e.g., between two or more fingers, playing with a device with their hand(s) or fingers(s), e.g., such play characterizable as fondling, or, e.g., fidgeting, keeping their hands and or fingers occupied with such an object or device, or similar such oral-fixation-related craving. Despite such and disclosure herein, as noted elsewhere, in many common aspects devices and systems herein are not regulated for the treatment or prevention of disease and the effects of the use of such devices are not of a sufficient efficacy to make such disease-related claims. Thus, in aspects, methods described in such terms herein provide results consistent with supporting the reduction of such symptoms, conditions, etc., such as may be associated with other health-promoting activities or substances, but below the level of efficacy associated with regulated medical devices, drugs, etc.

Method of Reducing Habit-Related Cravings

According to one aspect, the invention provides a method of reducing a habit-related craving or symptoms thereof or one or more behaviors associated therewith (e.g., a smoking habit-related craving not associated with an addiction to a drug, e.g., nicotine, such as, e.g., a craving related to the habit of holding or otherwise manually manipulating a smoking device, or, e.g., a drug addiction related habit, such as, e.g., a craving for nicotine) in an individual. In aspects, the method comprises the individual (a) holding a delivery device described herein within their hand, between their fingers, between their lips, or any combination thereof, (b) repeatedly, e.g., at least about 2 times, rotating the first primary component of the device in relation to the second primary component of the device in any direction or combination of directions, (c) repeatedly, e.g., at least about two times, separating and allowing reattachment of the first primary device component and the second primary device component relative to one another, (d) receiving one or more volatile compounds by placing the delivery device to their lips or into their mouth and receiving one or more volatile compounds available within the delivery device by drawing air through the delivery device, or (e) any combination of (a)-(e). In aspects, the method is applied for a sufficient period of time, or, e.g., is applied over a sufficient period of time, such that the individual experiences a detectable or significant decrease in the habit-related craving as assessed by the individual, a suitably trained individual recognized as capable of identifying reduction in addiction-related behavior, or both. In certain aspects, the method is provided under the guidance of a suitably trained individual recognized as capable of identifying reduction in addiction-related behavior, such that the method comprises instructing the individual on how to conduct one or more steps of the method.

In aspects, the method is applied for a sufficient period, or, e.g., is applied over a sufficient period of time, such that the individual (e.g., delivery device user) experiences a detectable or significant decrease in the habit-related craving as assessed by the individual, a suitably trained individual recognized as capable of identifying reduction in craving, symptom, behavior, etc. In certain aspects, the method is provided under the guidance of a suitably trained individual recognized as capable of identifying reduction in addiction-related behavior, such that the method comprises instructing the individual on how to conduct one or more steps of the method. However, as many aspects of methods herein are non-medical in nature, in many aspects the effectiveness of the device is measured based on user survey or based on health-related physiological or psychological metrics that are not associated with the treatment or prevention of any disease or medical condition.

In aspects, a sufficient period of time is a period of time such as, e.g. at least about 15 seconds, ~30 seconds, ~1 minute, ~2 minutes (mins), ~3 mins, ~4 mins, ~5 mins, ~10 mins, ~15 mins, ~30 mins, ~45 mins, ~1 hour, ~5 hours (hrs), ~10 hrs, ~15 hrs, ~20 hrs, or, e.g., ~24 hrs. In aspects, a sufficient period of time is a period of time greater than about 24 hours, such as, e.g., at least about 2 days, ~3 days, ~4 days, ~5 days, ~6 days, ~1 week, ~2 weeks, ~1 month, ~1.5 months, ~2 months, ~2.5 months, ~3 months, ~3.5 months, ~4 months, ~4.5 months, ~5 months, ~5.5 months, or at least about ~6 months. In aspects, a sufficient period of time is a period of time greater than about 6 months, such as, e.g., at least about 7 months, ~8 months, ~9 months, ~10 months, ~11 months, or at least about 12 months or longer. In aspects, a sufficient period of time is any amount of time required for the individual to experience a detectable or significant decrease in the smoking habit-related craving as assessed by the individual or, e.g., as assessed by a suitably trained individual recognized as capable of identifying reduction in addiction-related behavior.

In one aspect, the invention provides method(s) of detectably or significantly reducing a habit-related craving in an individual (as assessed (e.g., measured or reported) by the individual, as measured by an appropriately conducted and powered trial or survey administered or conducted by suitably trained individual(s) recognized as capable of identifying reduction in addiction-related behavior, or both) by the individual drawing via their mouth at least a partial breath through the passive delivery device such that at least a detectable amount of volatile compounds available within the delivery device (e.g., which may be provided by, e.g., a solid material device, e.g., a removable insert, therein) is delivered. In aspects, the at least partial drawing of air can be repeated for as many times as needed (e.g., about 1 or more times, ≥~2 or more times, or, e.g., ≥~4, ≥~6, ≥~8, ≥~10, ≥~12, ≥~14, ≥~16, ≥~18, ≥~20, ≥~22, ≥~24, ≥~26, ≥~28, or, e.g., ≥~30 or more times) until the individual achieves a detectably, significant, or otherwise perceived or reportable reduction in the habit-related craving. In certain specific aspects, such a number of drawings of air is completed with a confined period of time, such as, e.g., within a period of about 1 hour, ~55 min, ~50 min, ~45 min, ~40 min, ~35 min, ~30 min, ~25 min, such as, for example, within a period about 1 minute to about 20 minutes, e.g., within a period of ~1-~18 min, ~1-~16 min, ~1-~14 min, ~1-~12 min, or ~1-~10 min, e.g., ~2 min-~20 min, ~4 min-~20 min, ~6 min-~20 min, ~8 min-~20 min, ~10 min-~20 min, such as, e.g., ~2 min-~18 min, ~4 min-~16 min, ~6 min-~14 min, or, e.g., ~8 min-~12 min.

Similar to above, according to aspects, the invention provides a method of reducing one or more habit-related craving(s) in a significant number of individuals in an adequately powered population of individuals. In aspects, the method comprises providing to each individual in the population of individuals a delivery device with or containing a removable insert, or, e.g., a system comprising a delivery device and an insert. In aspects, each individual draws via their mouth at least one partial or full breath through the delivery device such that a detectable amount of volatile compounds maintained by the removable insert is delivered to each individual. In aspects, the method demonstrates a detectable or significant reduction in one or more habit-related cravings in the population of individuals with a period of at least about 1 year, such as, e.g., within a period of about 12 months, ~11 months, ~10 months, ~9 months, ~8 months, ~7 months, ~6 months, ~5 months, ~4 months, ~3 months, ~2 months, or, e.g., within ~1 month, within ~3 weeks, within ~2 weeks, or, e.g., within a period of ~1 week.

In aspects, the device is used intermittently over periods of time described here, not, e.g., continuously (such as, for example, a user using the device at least about once per day or at least about once per week, such as, e.g., daily or multiple times per day.) In aspects, a sufficient period of time is a period of time is a period of time after or upon which the individual experiences a detectable or significant decrease in the habit related craving as assessed (e.g., measured or reported) by the individual, as measured by an appropriately conducted and powered trial or survey administered or conducted by suitably trained individual(s) recognized as capable of identifying reduction in addiction-related behavior, or both. It will be noted herein that references to reduction of cravings implicitly provides support for reduction of sensations, thoughts, stress conditions, behaviors, or other symptoms of a habit-related condition or associated with breaking or reducing a habit-related condition and vice versa.

As provided elsewhere herein, in certain aspects, exemplary suitably trained individual(s) recognized as capable of identifying reduction in addiction-related behavior can be, e.g., addiction counselor(s), therapist(s), psychologist(s), medical physician(s), or other medical or non-medical personnel trained in identifying or suitably familiar with addiction related habit(s). However, as noted, in many common aspects, methods are practiced without involvement of any licensed healthcare professional, as the results of the methods are non-therapeutic or non-prophylactic in a medical/clinical sense.

Method of Providing Volatile Compound(s) to an Individual

In aspects, the invention provides a method of providing volatile compound(s) to an individual. In aspects, the method comprises providing to the individual a delivery device having any one or more of the characteristics described herein. In aspects, the individual is provided the device with one or more removable inserts having any one or more of the characteristics described herein. In aspects, the individual is provided a system comprising at least one delivery device having any one or more of the characteristics described herein and at least one removable insert having any one or more of the characteristics described herein. In aspects, the method comprises the individual drawing at least one partial or full breath through the delivery device such that a detectable amount of volatile compound(s) maintained by the removable insert is delivered to the individual.

Method of Providing an Olfactory Experience

In aspects, the invention provides a method of providing an olfactory experience to/for an individual. In aspects, the method comprises providing to the individual a delivery device having any one or more of the characteristics described herein. In aspects, the individual is provided the delivery device with one or more removable inserts having any one or more of the characteristics described herein. In aspects, the individual is provided a system comprising at least one delivery device having any one or more of the characteristics described herein and at least one removable insert having any one or more of the characteristics described herein. In aspects, the method comprises the individual drawing at least one partial or full breath through the delivery device such that a detectable amount of volatile compound(s) maintained by the removable insert is delivered to the individual. In aspects, the method is repeated for or over a sufficient period of time to provide the individual with a satisfactory olfactory experience as judged by the individual or as determined to be effective to achieve outcome(s) in studies/surveys. In aspects, such a period of time can be any period of time required to satisfactorily deliver the olfactory experience, such as, e.g., a period of time of about 30 seconds, ~1 min, ~5 min, ~10 min, ~15 min, ~20 min, ~30 min, ~45 min, or, e.g., ~1 hour. In aspects, a sufficient period of time is longer than about 1 hour, such as, e.g., ~1.5 hours, ~2 hours, ~4 hours, ~6 hours, ~8 hours, ~10 hours, ~12 hours, ~14 hours, ~16 hours, ~18 hours, ~20 hours, ~22 hours, or, e.g., ~24 hours.

Method of Controlling Airflow

In aspects, the invention provides a method of controlling airflow in a delivery device designed to deliver volatile compound(s) to a user of the delivery device. In aspects, the method comprises moving at least two airflow control components, such at least two airflow control components having any one or more of the characteristics of the airflow control mechanism and components thereof described herein, of the delivery device in relation to one another. In aspects, movement of the at least two airflow control components of the delivery device relative to one another occurs only in pre-defined increments. In aspects, each movement of the two airflow control components relative to one another in a pre-defined increment provides a pre-determined increase or pre-determined decrease in airflow through the device. In aspects, the method also or alternatively comprises moving the at least two airflow control components of the delivery device in relation to one another wherein, during normal operation of the device, at least two of the at least two airflow control components of the delivery device are, selectively, completely separable from one another. Such functionality of airflow control components and the mechanism within which they function is described in detail elsewhere herein. In further aspects, the method also or alternatively comprises moving at least two airflow control components of the delivery device in relation to one another, wherein movement of a first airflow control component relative to a second airflow control component comprises a rotational movement, and the rotational movement comprises movement capable of at an at least 360-degree rotation. Such functionality of airflow control components and the mechanism within which they function is described in detail elsewhere herein.

Method of Visually Identifying an Airflow Control Setting

In aspects, the invention provides a method of visually identifying an airflow control setting of a delivery device designed to deliver volatile compound(s) to a user of the delivery device. In aspects, the method comprises evaluating the positioning of at least one first visual indicator present on an external surface of the delivery device. In aspects, the method comprises evaluating the positioning of at least one second visual indicator present on an external surface of the delivery device. In aspects, the method comprises evaluating the positioning of at least one first visual indicator present on an external surface of the delivery device relative to at least one second visual indicator present on an external surface of the delivery device. In aspects, the relative positioning of one visual indicator to another indicates the status of the airflow control mechanism, such as, e.g., how open or how closed the airflow control mechanism of the device is (e.g., establishing an awareness for the user of the "drag" setting of the device). Such functionality of airflow control components and the mechanism within which they function, in combination with the use of visual indicators, is described in detail elsewhere herein.

Method of Determining the Spatial Positioning of an Internal Component

In aspects, the invention provides a method of determining the spatial positioning of an internal component, not externally visible, of a delivery device designed to deliver volatile compound(s) to a user of the delivery device. In aspects, the method comprises evaluating the positioning of at least one first visual indicator present on an external surface of the delivery device. In aspects, the spatial positioning of at least one visual indicator indicates the spatial positioning of an otherwise externally invisible internal component, such as, e.g., in which direction certain features of such an internal component are facing, e.g., "upward" or, e.g., "downward." In aspect, the method establishes an awareness of the user of whether the device is in a desired or suitable position for conducting one or more activities, such as, e.g., separating a first primary component and a second primary component of the device to facilitate removal of a removable insert. In aspects, knowing the orientation is helpful so as to reduce any risk of the removable insert falling out of the device upon separation of the first primary component from the second primary component. Such functionality of visual indicator(s), in combination with the spatial orientation of an internal, externally invisible device component, is described in detail elsewhere herein.

Method of Audibly or Tactilely Determining Status of an Airflow Control Mechanism In aspects, the invention provides a method of audibly determining the status of an airflow control setting of a delivery device designed to deliver volatile compound(s) to a user of the delivery device. In aspects, the invention provides a method of tactilely determining the status of an airflow control setting of a delivery device designed to deliver volatile compound(s) to a user of the delivery device. "Tactilely", as used here, means determining by receipt of a tactile indication. In aspects, the invention provides a method of audibly and tactilely determining the status of an airflow control setting of a delivery device designed to deliver volatile compound(s) to a user of the delivery device. In aspects, the method(s) comprise moving at least two airflow control components of a delivery device in relation to one another, such airflow control components being any airflow control components described herein. In aspects, movement of a first airflow control component relative to a second airflow control component is accompanied by an audible sound, a tactile indicator, or both. In aspects, an audible sound indicates to the user the status of the airflow control setting. In aspects, a tactile indicator indicates the status of the airflow control setting. In aspects, the combination of an audible indicator and a tactile indicator indicates the status of the airflow control setting. In aspects, particular audible sounds, particular tactile indications, or both provide an indication to the user of the airflow control setting. In aspects, particular airflow control settings provide a particular audible indication, a particular tactile indication, or both. Such audible and tactile indicators, relative to airflow control settings, are described in detail elsewhere herein.

In aspects, the invention provides such a method as disclosed in this section, wherein the delivery device is provided with a solid material device, either individually or together, such as, e.g., as a system. In aspects, the delivery device and a solid material device are provided as a kit. In aspects, any kit disclosed herein can be used in any method of reducing a smoking habit-related craving disclosed herein. In aspects, a delivery device comprising any one or more characteristics of delivery device(s) described herein are used in one or more of the methods described in this section. In aspects, a removable insert comprising any one or more characteristics of removable insert(s) described herein is used in one or more of the methods described in this section. In aspects, a system comprising any one or more of the characteristics of the system(s) described herein is used in one or more of the methods described in this section.

ILLUSTRATED EXEMPLARY EMBODIMENTS SHOWN IN THE DRAWINGS/FIGURES

The figures and following description of aspects of the invention provided in connection therewith are provided for the purpose of further illustrating examples of devices and related components of the invention and the operation thereof. Such embodiments provided should not be construed as limiting (e.g., figures/components may not be drawn to scale; an element may be provided primarily for illustrating operation; and several alternative embodiments are within the scope of the invention (as also described elsewhere herein).

FIGS. 1A-1D

FIGS. 1A, 1B, 1C, and 1D illustrate exemplary embodiments of components of delivery device(s) provided by the invention. FIGS. 1A, 1B, 1C, and 1D each illustrate an exemplary embodiment of delivery device(s) provided by the invention, with components of each provided in exploded view.

Figure 1A:
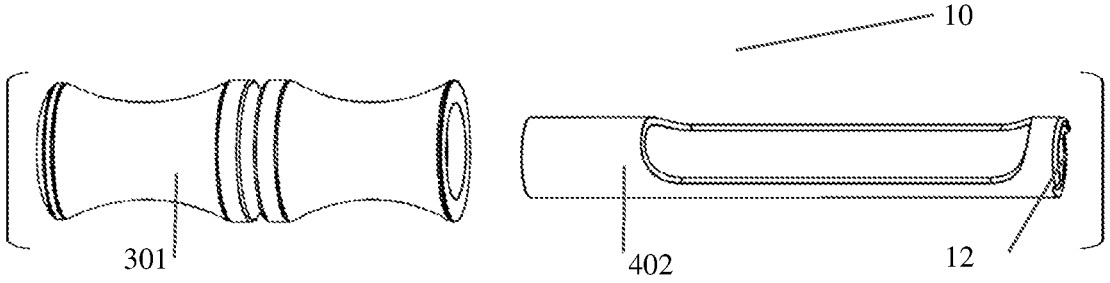

FIG. 1A provides an exemplary delivery device (10) comprising a volatile compound outlet component (301) and volatile compound compartment/volatile compound composition storage component (402) for maintaining volatile compound(s), composition(s) thereof, or solid material device(s) maintaining, releasing, maintaining and releasing, or having maintained, released, or both, volatile compound(s) therefrom, for delivery by the delivery device. FIG. 1A further illustrates the presence of airflow inlet (12).

A volatile compound outlet component (301) is sometimes referred to as a/the body, a/the body component, or, e.g., in certain aspects, a mouthpiece component where the device is designed for delivery of VCs to the mouth (which is the case of all of the devices shown in the figures and described in this section).

Volatile compound outlet component (301) is a component of a device engaged by a user to deliver volatile compounds thereto, such as, e.g., by comprising a mouthpiece. In aspects, the volatile compound outlet component (301) is/comprises a mouthpiece, or, e.g., a component of a device that includes one or more part(s) that make contact with an orifice of a device user for the delivery of volatile compound(s) for delivery thereto, e.g., to the nose (not shown) or mouth, in aspects typically the mouth, and which comprises an outlet for such compound(s) to exit the device. A volatile compound outlet component (301) can be any one or more embodiments described herein and also or alternatively can comprise any one or more feature(s) of such a component described herein or which are visible in figure(s) provided herewith.

A volatile compound compartment/volatile compound composition storage component (402) for maintaining volatile compound(s), composition(s) thereof (aka a VCCSC), or, as exemplified for maintaining a solid material or solid material device(s) maintaining, releasing, maintaining and releasing, or having maintained, released, or both, volatile compound(s) also is typically present. In aspects, as shown in the figures, a VCCSC is presented as a volatile compound outlet component extension (i.e., extension of volatile compound outlet component (301)), which also may be referred to variously in embodiments as a body tube or insert compartment (described further below).

Volatile compound compartment/volatile compound composition storage component (402) is a component suitable for maintaining, e.g., at least partially or in aspects completely storing, a means for maintaining, delivering, or maintaining and delivering (or having maintained, delivered, or both) one or more volatile compound(s); such as, in embodiments, a component suitable for the maintenance, e.g., storage, of a solid material device comprising or having comprised volatile compound(s), i.e., an insert (1800). Volatile compound compartment/volatile compound composition storage component (402) can be any one or more embodiments described herein and also or alternatively can comprise any one or more feature(s) of such a component described herein or which are visible in figure(s) provided herewith.

Volatile compound compartment/volatile compound composition storage component (402) can comprise one or more parts or features which aid in the stable maintenance of a solid material device comprising or having comprised volatile compound(s), i.e., an insert, maintained therein, such as one or more parts or features demonstrating such functionality described herein. In aspects, such a part of feature can be one or more parts/components of an insert stabilization mechanism (such as, e.g., a compressible element and a fixed element). In aspects, stabilizing component(s) can be any one or more embodiments described herein and also or alternatively can comprise any one or more feature(s) of such component(s) described herein, or which are visible in figure(s) provided herewith.

According to certain aspects, volatile compound compartment/volatile compound composition storage component (402) can also or alternatively comprise one or more parts or features which aid in airflow control through the device, such as, e.g., one or more parts/components of an airflow control mechanism. In aspects, one or more parts/components of an airflow control mechanism can be associated with volatile compound compartment (402) while one or more parts/components of an airflow control mechanism can be associated with one or more other component(s) of a delivery device, such as, e.g., associated with a mating component (1308) described elsewhere herein. In aspects, an airflow control mechanism can be any one or more embodiments thereof described herein and also or alternatively can comprise any one or more feature(s) of such component(s) described herein, or which are visible in figure(s) provided herewith.

In aspects, volatile compound compartment/volatile compound composition storage component (402) is designed to engage with, e.g., selectively engage with, one or more other component(s) of a delivery device, such as, e.g., a mating component(s). In aspects, a device is associated with a single mating component as exemplified in the figures.

In aspects, volatile compound compartment/volatile compound composition storage component (402) is designed to, at least in part, fit within or be at least partially encompassed by one or more other component(s) of a delivery device. In aspects, volatile compound compartment/volatile compound composition storage component (402) is designed to fit within, or be at least partially encompassed by, e.g., a mating component when a delivery device is in a ready-to-use state. In aspects, volatile compound compartment/volatile compound composition storage component (402) is designed to engage with, e.g., selectively engage with, a mating component and to reside within mating component at least partially when a delivery device is in a ready-to-use state. In aspects, a mating component can be any one or more embodiments thereof described herein and also or alternatively can comprise any one or more feature(s) of such component(s) described herein, or which are visible in figure(s) provided herewith.

While illustrated in FIG. 1A as being an at least partially open tubular structure, in aspects, volatile compound compartment/volatile compound composition storage component (402) can be any one or more embodiments thereof described herein and also or alternatively can comprise any one or more feature(s) of such a component described herein or which are visible in figure(s) provided herewith.

In aspects, volatile compound outlet component (301) can be a separate part from that of volatile compound compartment/volatile compound composition storage component (402). In aspects, volatile compound outlet component (301) can be selectively or permanently joined or otherwise connected to volatile compound compartment/volatile compound composition storage component (402). In aspects, volatile compound outlet component (301) can be attached via any suitable mechanism to volatile compound compartment/volatile compound composition storage component (402).

Figure 1B:
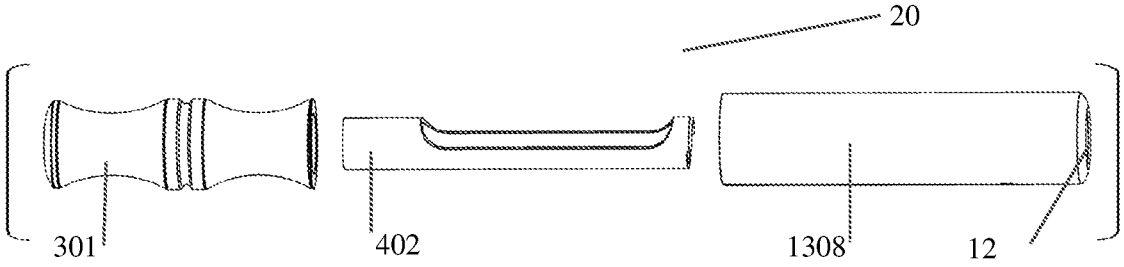
Figure 1C:
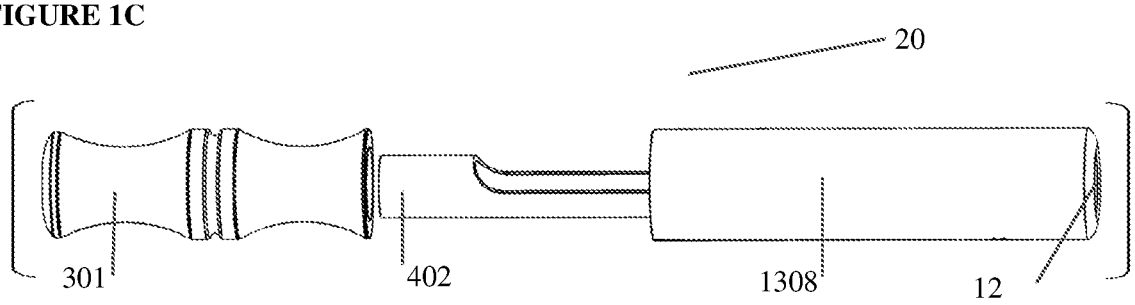

FIG. 1B provides an exemplary delivery device (20) comprising a volatile compound outlet component (301), volatile compound compartment/volatile compound composition storage component (402) for maintaining volatile compound(s), composition(s) thereof, or solid material device(s) maintaining, releasing, maintaining and releasing, or having maintained, released, or both, volatile compound(s) therefrom, for delivery by the delivery device, and a mating component (1308). FIG. 1B further illustrates the presence of airflow inlet (12). FIG. 1C provides the same exemplary device (20) as FIG. 1B, however, FIG. 1C illustrates the components thereof in closer proximity to one another, e.g., showing how mating component (1308) can interface with volatile compound compartment/volatile compound composition storage component (402), e.g., wherein volatile compound compartment (402) can at least partially or completely reside within mating component (1308). FIG. 1C illustrates mating component (1308) as being, e.g., only partially mating with other component(s) of the exemplary device; in aspects, mating component (1308) can fully encompass volatile compound compartment/volatile compound composition storage component (402) as is described elsewhere herein. FIG. 1C also illustrates the presence of airflow inlet (12).

A volatile compound outlet component (301) (i.e., body, or, e.g., in certain aspects, mouthpiece component) is a component of a device engaged by a user to deliver volatile compounds thereto, such as, e.g., by comprising a mouthpiece. See the description of this component elsewhere herein. A volatile compound compartment/volatile compound composition storage component (402) for maintaining volatile compound(s), composition(s) thereof, or solid material device(s) maintaining, releasing, maintaining and releasing, or having maintained, released, or both, volatile compound(s) (i.e., volatile compound outlet component extension (i.e., extension of volatile compound outlet component (301)), a body tube, or insert compartment) is a component suitable for maintaining, e.g., at least partially storing, a means for maintaining, delivering, or maintaining and delivering (or having maintained, delivered, or both) one or more volatile compound(s), such as, in embodiments, a device utilized for the maintenance, e.g., storage, of a solid material device accomplishing the same (i.e., an insert). See the description of this component elsewhere herein. In aspects, a volatile compound outlet component (301) and a volatile compound compartment/volatile compound composition storage component (402) can each be any one or more embodiments thereof described herein and also or alternatively can comprise any one or more feature(s) of such component(s) described herein, or which are visible in figure(s) provided herewith.

A mating component (1308) is a component of a delivery device designed to engage with, e.g., selectively engage with, one or more other device component(s). In aspects, the mating component (1308) is designed to engage with, e.g., selectively engage with, e.g., a volatile compound outlet component (301). In aspects, a mating component (1308) at least partially surrounds, protects, completes, or otherwise at least partially encompasses one or more other device components. In aspects, a mating component (1308) at least partially surrounds, protects, completes, or otherwise at least partially encompasses an extension of a volatile compound outlet component (301), such as, e.g., a volatile compound compartment/volatile compound composition storage component (402) for maintaining volatile compound(s), composition(s) thereof, or solid material device(s) maintaining, releasing, maintaining and releasing, or having maintained, released, or both, volatile compound(s) (i.e., an insert). In aspects, a mating component (1308) releasably engages with, e.g., selectively releasably engages with, a volatile compound outlet component (301) and at least partially surrounds, protects, completes, or otherwise at least partially encompasses an extension of volatile compound outlet component (301), such as, e.g., volatile compound compartment/volatile compound composition storage component (402), when mating component (1308) is engaged with volatile compound outlet component (301).

In aspects, a mating component (1308) can each be any one or more embodiments thereof described herein and also or alternatively can comprise any one or more feature(s) of such component(s) described herein, or which are visible in figure(s) provided herewith.

In aspects, mating component (1308) can comprise one or more parts or features which aid in the engagement, e.g., selective engagement of mating component (1308) to one or more other delivery device components, such as to volatile compound outlet component (301). In aspects, a mating component can comprise at least one component of a multi-component connection mechanism shared between the mating component (1308) and its selective engagement target, e.g., volatile compound outlet component (301). In one particular example, a volatile compound outlet component (301) can comprise, e.g., a magnet, and mating component (1308) can comprise a portion or part thereof which is attracted by the magnet of volatile compound outlet component (301) to form a selectively releasable connection mechanism between the two. In aspects, selective disengagement and engagement of mating component (1308) from/to one or more other component(s) of the device (e.g., volatile compound compartment/volatile compound composition storage component (402), volatile compound outlet component (301), or both) provides a sensory (i.e., fidget) experience for a device user (i.e., fidget experience). In aspects, each of a volatile compound compartment/volatile compound composition storage component (402) and a volatile compound outlet component (301) can be any one or more embodiments thereof, respectively, described herein and also or alternatively can comprise any one or more feature(s) of such component(s) described herein, or which are visible in figure(s) provided herewith.

According to some aspects, mating component (1308) can also or alternatively comprise, e.g., one or more parts or features which aid in the protection of at least a portion of mating component (1308) which is at least detectably or selectively permeable to moisture, so as to protect mating component (1308) detectably or significantly from such moisture permeation. In aspects, a mating component (1308) can comprise an outer shell made of a moisture-permeable material, and mating component (1308) can comprise an outer shell protection component capable of detectably or significantly reducing the amount of moisture which permeates the outer shell during a single use of a device by a user or over the course of the lifespan of a delivery device (e.g., over an extended number of uses by a device user. In aspects, an outer shell protection component can each be any one or more embodiments thereof described herein and also or alternatively can comprise any one or more feature(s) of such component(s) described herein, or which are visible in figure(s) provided herewith.

In certain aspects, mating component (1308) can also or alternatively comprise, e.g., one or more parts or features which aid in airflow control through the device, such as, e.g., one or more parts/components of an airflow control mechanism. In aspects, one or more parts/components of an airflow control mechanism can be associated with mating component (1308) while one or more parts/components of an airflow control mechanism can be associated with one or more other component(s) of a delivery device, such as, e.g., associated with volatile compound compartment/volatile compound composition storage component (402). In aspects, an airflow control mechanism can each be any one or more embodiments thereof described herein and also or alternatively can comprise any one or more feature(s) of such component(s) described herein, or which are visible in figure(s) provided herewith.

In aspects, mating component (1308) is capable of rotating relative to (in relation to) one or more other components of a device, such as, e.g., relative to a volatile compound compartment/volatile compound composition storage component (402), volatile compound outlet component (301), or both. In aspects, the rotation of mating component (1308) relative to one or more other component(s) of the device (e.g., volatile compound compartment/volatile compound composition storage component (402), volatile compound outlet component (301), or both) establishes an operational status of a device, such as, e.g., the amount of airflow allowed to pass through the device; that is, in aspects such rotation controls an airflow control mechanism of a device. Also, or alternatively, in aspects, mating component (1308) can comprise one or more parts or features which provides or participates in the provision of a sensory experience, (i.e., "fidget") experience provided by the device, such sensory (fidget)-related feature(s) or function(s) of a device are described elsewhere herein. In aspects, rotation of mating component (1308) relative to one or more other component(s) of the device (e.g., volatile compound compartment/volatile compound composition storage component (402), volatile compound outlet component (301), or both) provides a sensory (i.e., fidget) experience for a device user (i.e., fidget experience).

In aspects, mating component (1308) can be a separate part from that of a volatile compound outlet component (301), volatile compound compartment/volatile compound composition storage component (402), or both. In aspects, mating component (1308) can be selectively or permanently joined or otherwise connected to volatile compound outlet component (301), volatile compound compartment/volatile compound composition storage component (402), or both. In aspects, mating component (1308) can be attached via any suitable mechanism to volatile compound outlet component (301), volatile compound compartment/volatile compound composition storage component (402), or both.

Figure 1D:
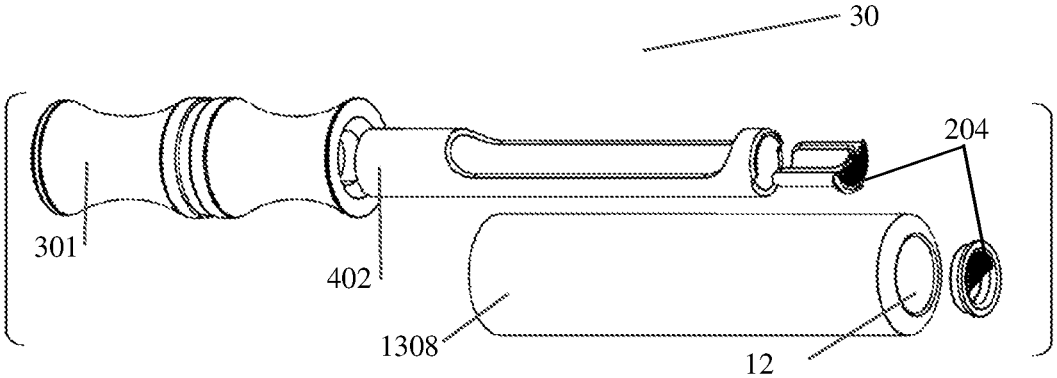

FIG. 1D provides an exemplary device (30) similar in aspects to those described above, e.g., in that the exemplary device (30) of FIG. 1D comprises a volatile compound outlet component (301) and volatile compound compartment/volatile compound composition storage component (402), and further comprises a mating component (1308), however the exemplary device (30) of FIG. 1D comprises an airflow control mechanism (204). FIG. 1D further illustrates the presence of airflow inlet (12); wherein with airflow control mechanism (204) present in the illustrated embodiment, airflow inlet (12) is provided by openings in airflow control mechanism (204) and mating component (1308).

In aspects, a volatile compound outlet component (301) of exemplary device (30) can be any one or more embodiments of a volatile compound outlet component described herein or have one or more characteristics thereof, and also or alternatively can comprise any one or more feature(s) of such component(s) described herein, or which are visible in figure(s) provided herewith. Similarly, a volatile compound compartment/volatile compound composition storage component (402) of exemplary device (30) can be any one or more embodiments of a housing component described herein or have one or more characteristics thereof, and also or alternatively can comprise any one or more feature(s) of such component(s) described herein, or which are visible in figure(s) provided herewith. Again, similarly, a mating component (1308) of exemplary device (30) can be any one or more embodiments of a mating component described herein or have one or more characteristics thereof, and also or alternatively can comprise any one or more feature(s) of such component(s) described herein, or which are visible in figure(s) provided herewith.

An airflow control mechanism (204) of exemplary device (30) can be any suitable airflow control mechanism. In aspects, an airflow control mechanism (204) is a selectively adjustable mechanism used by a delivery device user to establish an amount of airflow, e.g., a desired amount of airflow based on personal preference(s) of the user, passing through the delivery device during its use. In aspects, an airflow control mechanism (204) can be a single part or single component. In aspects, an airflow control mechanism (204) can comprise multiple parts, as is presented in the particular embodiment exemplified in FIG. 1D. In certain aspects, an airflow control mechanism (204) can comprise multiple parts which are not selectively separable during device operation. In aspects, an airflow control mechanism (204) can comprise multiple parts which are selectively separable (detachable) during device operation. According to certain aspects, an airflow control mechanism (204) comprises a plurality of parts or components which, in establishing the airflow control setting of a delivery device, detectably or significantly move in relation to (relative to) one another. In aspects, an airflow control mechanism (204) comprises a plurality of parts or components which, in establishing the airflow control setting of a delivery device, detectably or significantly rotate in relation to (relative to) one another. In aspects, an airflow control mechanism (204) comprises a plurality of parts or components wherein, during normal operation of a device, at least one part/component of the airflow control mechanism (204) is capable of moving away from one or more other part(s)/component(s) of the airflow control mechanism (204), is capable of moving closer to one or more other part(s)/component(s) of the airflow control mechanism (204), or is capable of moving both away from and closer to one or more other part(s)/component(s) of the airflow control mechanism (204) during normal operation of a delivery device. In aspects, an airflow control mechanism (204) comprises a plurality of parts or components which, in establishing the airflow control setting of a delivery device, detectably or significantly move both away from and closer to one another during any change from a first airflow control setting to a second airflow control setting. FIG. 1D illustrates such an embodiment, with description(s) of such exemplary airflow control mechanism component(s) described in additional figure(s) provided herewith and in the description herein.

According to certain aspects, an airflow control mechanism (204) can comprise a plurality of parts, as is, e.g., exemplified in FIG. 1D, wherein, in aspects, a first part is associated with a first delivery device component and a second part is associated with a second delivery device component. FIG. 1D illustrates such an embodiment, wherein a first part of airflow control mechanism (204) is associated with volatile compound compartment/volatile compound composition storage component (402), and a second part of airflow control mechanism (204) is associated with mating component (1308). In aspects, volatile compound compartment/volatile compound composition storage component (402) and mating component (1308) are selectively engageable and, accordingly, first and second airflow control mechanism parts are selectively engageable.

In aspects, an airflow control mechanism (204) can each be any one or more embodiments thereof described herein and also or alternatively can comprise any one or more feature(s) of such component(s) described herein, or which are visible in figure(s) provided herewith.

FIGS. 1A-1D exemplify embodiments of a delivery device. The figures which follow exemplify further embodiment(s) of a delivery device, comprising one or more additional part(s), component(s), feature(s), or e.g., function(s). While significant disclosure is provided in association with the following figure(s), and, e.g., more complex embodiment(s) of delivery device(s) are provided here, one or more the part(s), component(s), feature(s), or, e.g., function(s) associated with the subject(s) of such additional figures(s), can be present in one or more of the device(s) of FIGS. 1A-1D. Part(s) or component(s) described in this Illustrated Exemplary Embodiments section, both previously described and which follow, can be attached to or can also or alternatively operate cooperatively with other part(s) or component(s) of a delivery device in any suitable manner or by any suitable mechanism.

Certain part(s) and component(s) of exemplary delivery device(s) provided herein can comprising name(s)/identifier(s) associated with a particular embodiment; however, reader(s) should interpret such specific name(s)/identifier(s)

as being synonymous with their broader identifier(s) provided herein. For example, figures of a Magnet herein should be interpreted as being simply an embodiment of an engagement mechanism, as a magnet being an exemplary embodiment of an engagement mechanism is described herein. Further, a Body Assembly herein should be interpreted as being simply an embodiment of a volatile compound outlet component; and, further, part(s), component(s), or sub-assembly(ies) thereof embodied in figures should be interpreted as being exemplary embodiment(s), e.g., part(s) or component(s) shown as or described as "assembly(ies)" can, in alternative embodiments, be provided individually.

FIGS. 1E-1G

Figure 1E:
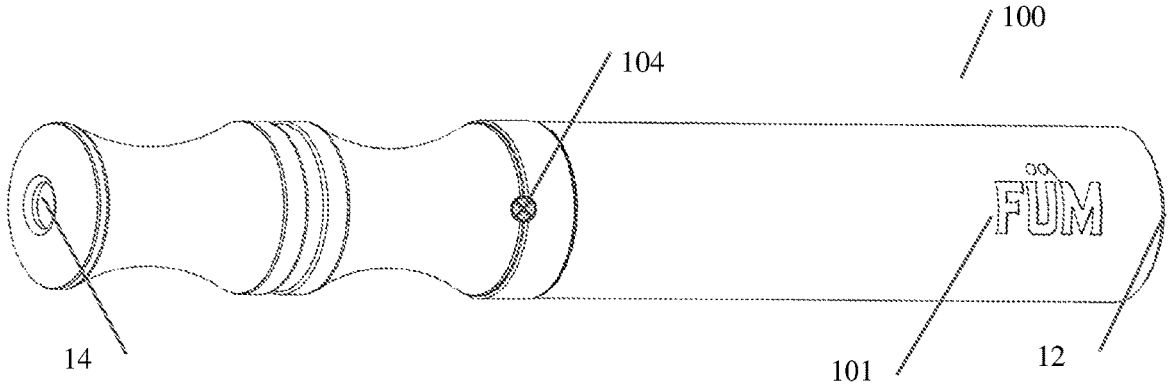
Figure 1F:
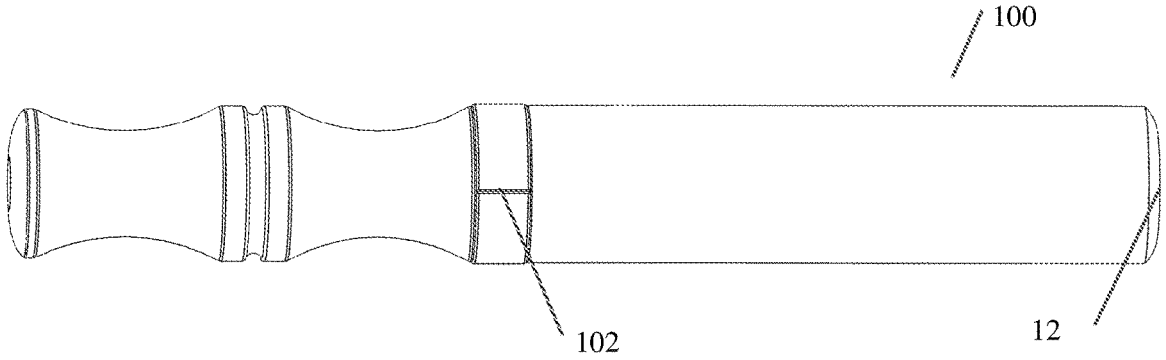
Figure 1G:
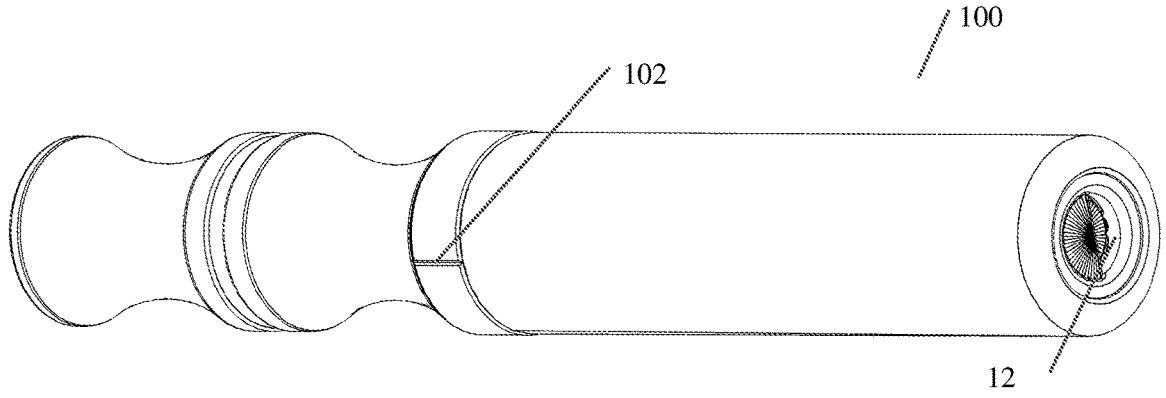

FIGS. 1E, 1F, and 1G illustrate an exemplary device (100) provided by the invention. FIGS. 1A-1C illustrate a device when all components are assembled (e.g., the device is "fully assembled"). Within the "Detailed Description of the Drawings/Figures" section of this disclosure, discussion of the device in a "fully assembled" state references the device being in a configuration wherein all illustrated/shown components of the device are assembled. However, this state of full assembly may or may not comprise an insert being in the device. In one aspect, if the state of full assembly comprises an insert, the device may be referred to as being in a "loaded ready-to-use" state. That is, in one aspect, herein, a "loaded ready-to-use" state is a state wherein the device is fully assembled and comprises an insert. In an alternative aspect, if the state of full assembly does not comprise an insert, the device may be referred to as an "unloaded ready-to-use" state, such that the device is ready for a user to insert an insert therein.

FIG. 1E illustrates the fully assembled exemplary device (100) with the device slightly rotated to the right, so as to show a perspective wherein the opening in the body assembly (see FIG. 2A) is emphasized. With this perspective, airflow inlet (12) (labeled) is not visible. FIG. 1E further illustrates a first indicator (101), here exemplified as a product logo. Such a first indicator (101) can be utilized in indicating the spatial orientation of one or more components of the device, one or more operational status(es) of the device, or both, as is described elsewhere herein. In aspects, such a first indicator (101) operates in conjunction with at least a second indicator (102) to indicate the spatial orientation of one or more components of the device, one or more operational status(es) of the device, or both, again as is described elsewhere herein. In aspects, such a first indicator (101) operates in conjunction with at least a second indicator (102) such as the second indicator (102) shown in FIG. 1F. FIG. 1E further illustrates an exemplary location for a center of gravity (104), sometimes referred to as a center of mass, or, e.g., a center of balance. Such a center of gravity (104) provides, in certain embodiments, a location near which finger placement may facilitate device balance when a user is holding an assembled exemplary device (100). In aspects, the center of gravity (104) is located at or near the magnet cover (401). In aspects, center of gravity (104) is established at least generally near, at least substantially near, essentially near, or at a location for finger placement (e.g., in aspects, an area of reduced diameter) when a user is holding an assembled exemplary device (100), such as, e.g., within a distance of a location for finger placement (e.g., in aspects, an area of reduced diameter) representing less than about 20% of the total length of a fully assembled device (100). In aspects, the location of the center of gravity (104) can be shifted further from the magnet cover (401) in either direction of the length of an exemplary device (100), to account for the weight difference of different materials an exemplary device may be constructed from (e.g., ceramic, plastic, etc.).

FIG. 1F illustrates a straight-on side view of the fully assembled exemplary device (100). In this view, airflow inlet (12) is labeled but is not clearly visible. FIG. 1F further illustrates a second indicator (102), here exemplified as a groove made in an external/visible location on a device component. Such a second indicator (102) can be utilized in indicating the spatial orientation of one or more elements of the device, one or more operational status(es) of the device, or both, as is described elsewhere herein. In aspects, such a second indicator (102) operates in conjunction with at least a first indicator to indicate the spatial orientation of one or more elements of the device, one or more operational status(es) of the device, or both, as is described elsewhere herein. In aspects, such a second indicator (102) operates in conjunction with at least a first indicator such as the first indicator (101) shown in FIG. 1E.

FIG. 1G illustrates the fully assembled exemplary device (100) with the device slightly rotated to the left, so as to show a perspective wherein the opening in the tip assembly (see FIG. 2B) is emphasized. In FIG. 1G, second indicator (102) is visible but first indicator (101) is not visible. In FIG. 1G, airflow inlet (12) is visible.

The fully assembled device of FIGS. 1E-1G illustrate that in its fully assembled state, the device is a single device with all components connected to form a single unit. Further, FIGS. 1E-1G illustrate that a plurality of indicators is visible on the external portion(s) of the fully assembled device which can, e.g., participate in establishing the spatial orientation of the device, one or more operational status(es) of the device, or both, as is described elsewhere herein.

FIGS. 2A-2C

Figure 2A:
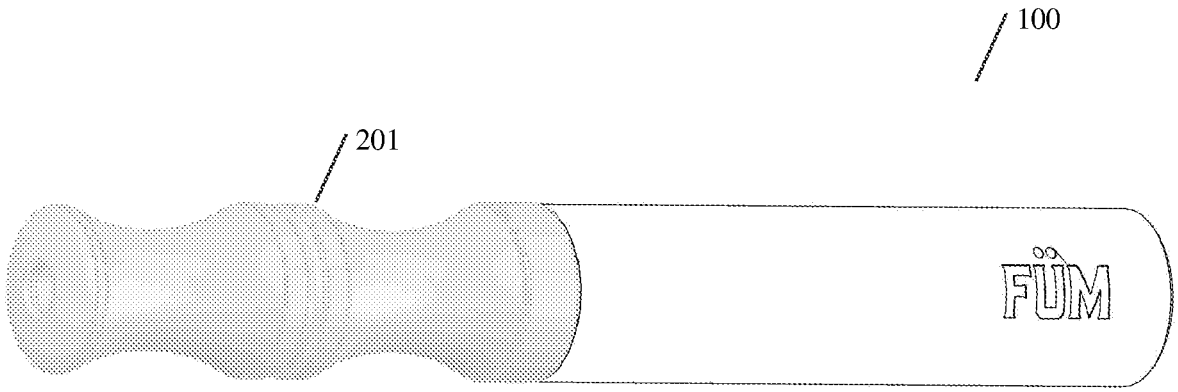
Figure 2B:
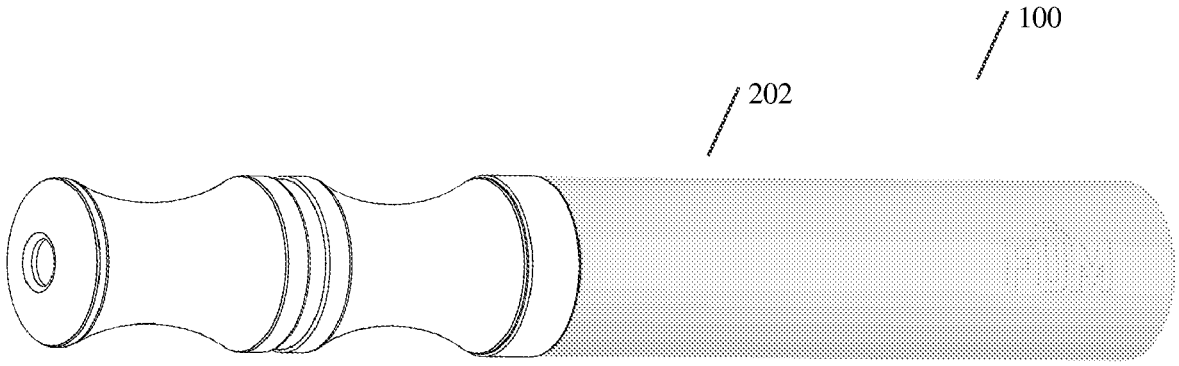
Figure 2C:
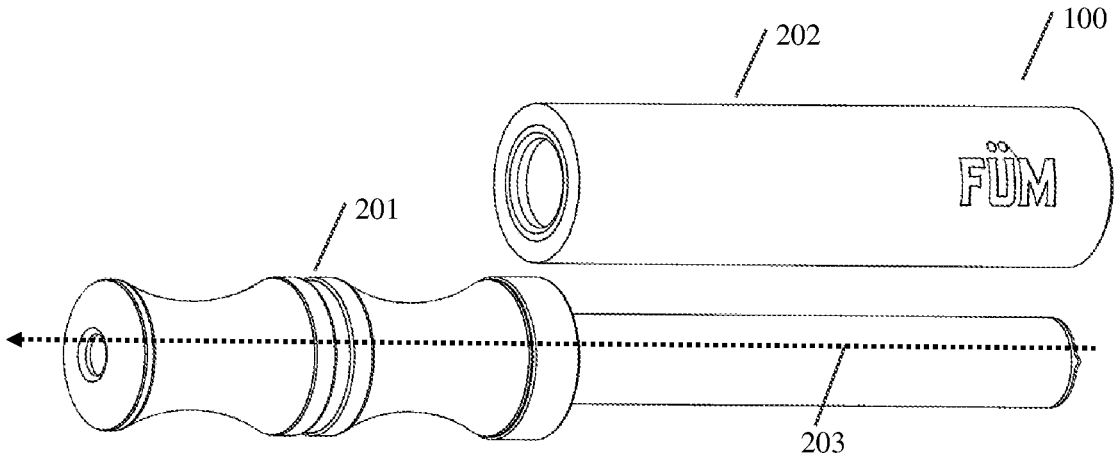

FIGS. 2A, 2B, and 2C illustrate that at its highest level, a fully assembled device (100) is comprised of a body assembly (201), shown as the shaded element in FIG. 2A, and a tip assembly (202), shown as the shaded element in FIG. 2B. In the illustrated embodiment, the body assembly (201) (herein, a body assembly is one embodiment of a volatile compound outlet component) connects with or attaches to the tip assembly (202) (herein, a tip assembly is an exemplary embodiment of a mating component) to form a fully assembled device (100). In aspects, the body assembly (201) is selectively engageable with the tip assembly (202) such that the two components can be repeatedly attached and disengaged (e.g., attached, disengaged, re-attached, disengaged, etc.) from one another. In aspects, as exemplified, the selective disengagement/re-engagement of the device provides a mechanism for providing the device with an insert (e.g., (1800)) from a position other than the end of the device. That is, in aspects, the device can receive an insert (e.g., (1800)) from a direction lateral to the device as opposed to receiving an insert (e.g., (1800)) from a direction in line with the device, such as, e.g., inserted into one end of the device. In aspects, the selective disengagement/re-engagement of the device provides a mechanism for fidgeting with the device, providing the device with the ability to operate as a fidget tool/mechanism which, when in use, provides the user with a tool to help the user stay focused, stay attentive, reduce distraction, to increase level of attention, to reduce anxiety, to improve attitude, improve performance of one or more tasks, to induce calm, achieve a more relaxed state, achieve a contemplative state, achieve a mindful state, provide stimulation, improve personal/peer interaction, be entertained, or any combination of the above, or other outcomes of fidget devices known in the art.

In FIG. 2C, the tip assembly (202) is illustrated as being completely separated from the body assembly (201). Upon the complete separation of the tip assembly (202) from the body assembly (201), previously hidden component(s) of the body assembly (201) become visible. FIG. 2C, in view of FIGS. 2B and 2A, illustrates that when the body assembly (201) and the tip assembly (202) are in the fully assembled position, at least one component of the body assembly (201) resides within the tip assembly (202). This relationship is discussed further below. Further, when the body assembly (201) and the tip assembly (202) are in the fully assembled position, the tip assembly (202) and the body assembly are capable of being rotated in relation to one another. FIG. 2C further illustrates a continuous interior airflow channel (203) across the length of the body assembly (201). In aspects, the tip assembly (202) is capable of being rotated about at least one component of the tip assembly (201). Still further, upon such rotation of the body assembly (201) and the tip assembly (202) relative to one another, one or more visual indicators on the body assembly (201) and one or more visual indicators on the tip assembly (202) can change in orientation/positional relationship to one another. As the two components (body assembly (201) and tip assembly (202)) are rotated, a position may be reached where a visual indicator (e.g., first indicator (101) of FIG. 1E) on the tip assembly can align with a visual indicator (e.g., second indicator (102) of FIG. 1F) on the body assembly. In certain aspects, such an alignment can provide an indication of the spatial orientation of one or more components of the device, an indication of one or more operational status(es) of the device, or both. As the two components are further rotated, a position may be reached where a visual indicator (e.g., first indicator (101) of FIG. 1E) on the tip assembly can be opposite or stated in another way can be 180 degrees from, a visual indicator (e.g., second indicator (102) of FIG. 1F) on the body assembly. In certain aspects, such an orientation can provide an indication of the spatial orientation of one or more components of the device, an indication of one or more operational status(es) of the device, or both. In aspects, information related to spatial orientation of one or more components of the device, one or more operational status(es) of the device, or both may be identified by any relative positioning of one or more, e.g., two or more visual indicators. In aspects, some, most, generally all, or all of the airflow within an exemplary device (100) passes through the continuous interior airflow channel (203). Airflow channel (203) can pass through multiple components present in an exemplary device (100).

FIGS. 3A-3D

Figure 3A:
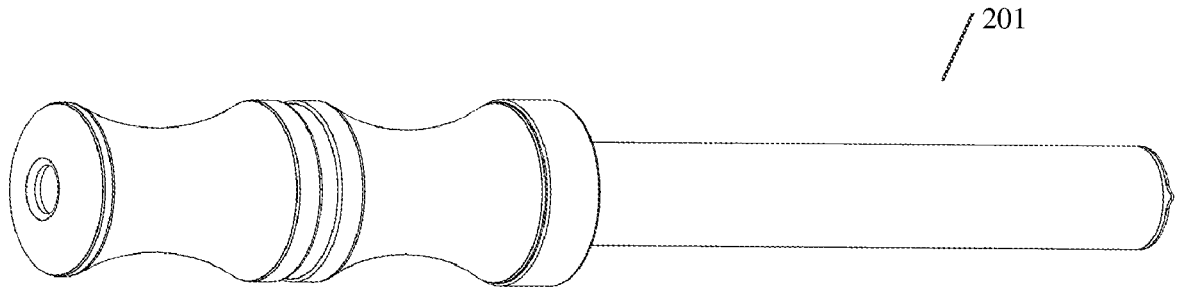
FIG. 3B depicts an exemplary embodiment of a volatile compound outlet component, embodied as a body assembly, with the mouthpiece shaded for emphasis.
FIG. 3C illustrates an exemplary embodiment of a volatile compound outlet component, embodied as a body assembly, with a volatile compound outlet component extension, embodied as a body sub-assembly, with feature(s) shaded for emphasis.
FIG. 3D illustrates an exemplary embodiment of a volatile compound outlet component extension, embodied as a body sub-assembly.

FIGS. 3A, 3B, 3C, and 3D illustrate the complete assembly of the body assembly (201). FIG. 3A illustrates a view of the complete assembly of the body assembly (201) with the tip assembly removed. Thus, FIG. 3A does not represent a fully assembled device, but only a fully assembled single component of the device (the body assembly).

Figure 3B:
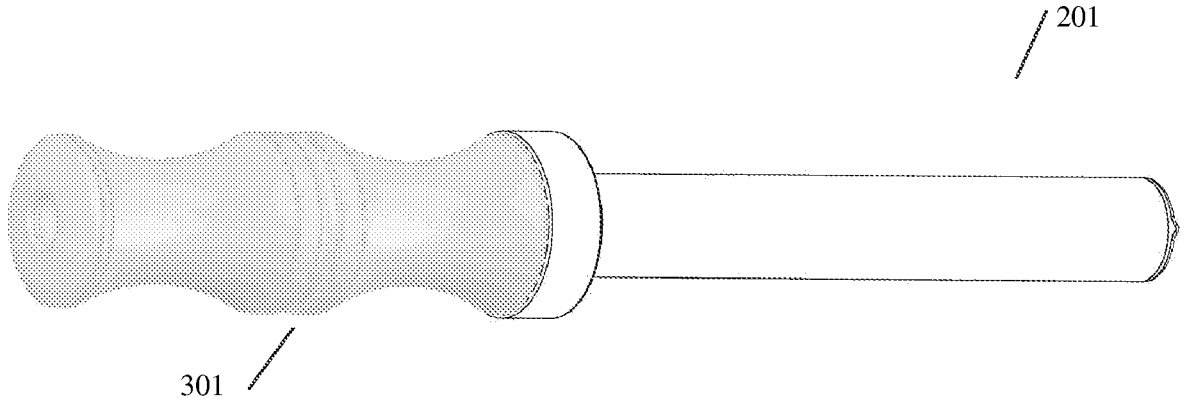
Figure 3C:
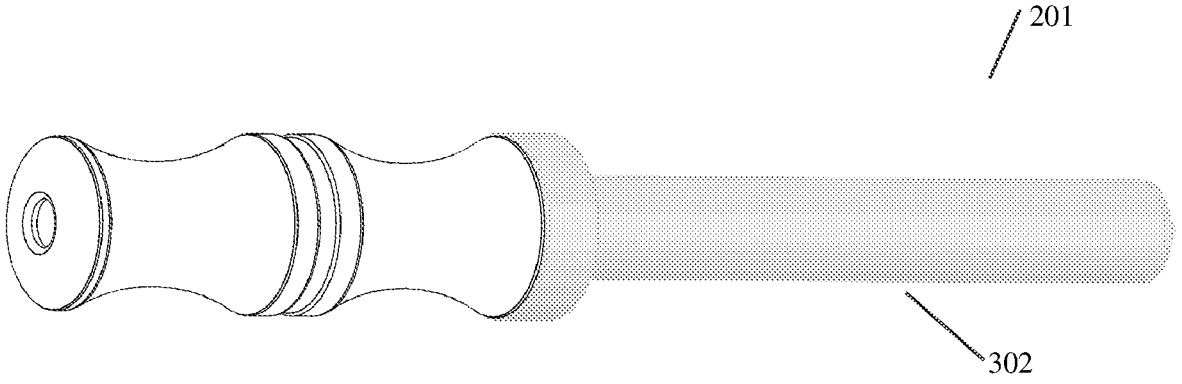
Figure 3D:
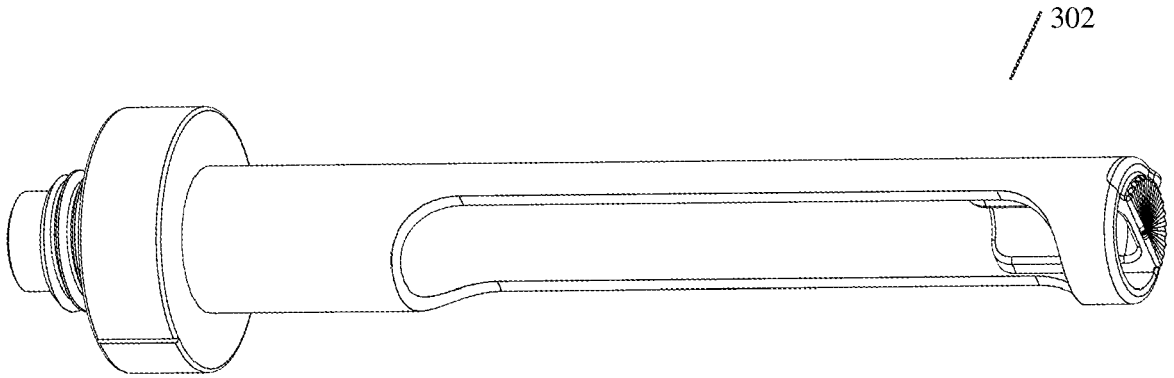

FIGS. 3A-3D illustrate that at its highest level, the body assembly (201) (see FIG. 3A) comprises at least two components; a volatile compound(s) facilitation component embodied as a mouthpiece (301), identified by shading in FIG. 3B, and a body subassembly (302) identified by shading in FIG. 3C. Herein, a body subassembly is an exemplary embodiment of a volatile compound outlet component extension. The body subassembly (302) is shown again in FIG. 3D, therein shown with the mouthpiece (301) of FIG. 2B removed, and with body subassembly (302) rotated such that other features of the body subassembly (302) are visible. Mouthpiece (301) is identified as a single component, however in alternative embodiments a volatile compound outlet component (exemplified in certain embodiments herein as a body assembly) can be a mouthpiece or, e.g., a mouthpiece can be characterized as a volatile compound outlet component. Components and features of the body assembly (201) are described in FIGS. 3B-3D, FIGS. 4A-4C, FIGS. 5A-5G, FIGS. 6A and 6B, FIG. 7, FIGS. 8A and 8B, FIGS. 9A and 9B, FIGS. 10A and 10B, FIGS. 11A and 11B, and FIGS. 12A and 12B herein. FIGS. 3A-3C illustrate that when fully assembled, the body assembly comprises a mouthpiece (301) which is attached to a body subassembly (302). In aspects, such components are not capable of being unattached by the user; that is, the body subassembly of the device in usable form is provided to the user as a single component, wherein the subcomponents of the body assembly are non dis-engageable from one another by a user or do not require disengagement in order for the user to use the device. In alternative aspects, two or more components of the body assembly, e.g., the mouthpiece (301) and the body subassembly (302) are dis-engageable from one another. This can facilitate, e.g., the exchange of a mouthpiece, such as e.g., the exchange of a mouthpiece of one material (e.g., stainless steel) to a mouthpiece of a different material (e.g., gold, platinum, titanium, plastic(s), etc.), a mouthpiece having a first color to a mouthpiece having a second color, etc. Such embodiments provide interchangeability, e.g., mouthpiece interchangeability is one aspect of the invention.

FIGS. 4A-4C

FIGS. 4A, 4B, and 4C illustrate the body assembly (201) with a specific focus on specific components of the body subassembly. FIGS. 4A-4C illustrate that body components of the body subassembly include a magnet cover (401) (herein, a magnet cover being an exemplary embodiment of an engagement component support) shown by shading in FIG. 4A; a body tube (402) (herein, a body tube is an exemplary embodiment of a volatile compound compartment) shown by shading in FIG. 4B; and a body crown (506) (herein a body crown is an exemplary embodiment of both an airflow limiter and a fixed positioner), shown by shading in FIG. 4C. FIGS. 4A-4C illustrate that when fully assembled, the body subassembly (e.g., the body subassembly (302) of FIGS. 3C and 3D) comprises a magnet cover (401), body tube (402), and body crown (506) attached to one another to form a single body subassembly unit, which is then further attached to the mouthpiece (e.g., (301) of FIG. 3B) to form the body assembly (e.g., the body assembly (201) of FIGS. 4A-4C). In aspects, components of the body subassembly (302) are attached to one another when the device is in a ready-to-use state. In aspects, components of the body subassembly (302) are not dis-engageable from one another by a user or do not require disengagement in order for the user to use the device. One or more components of body assembly (201) are not visible in FIGS. 4A-4C, such as, e.g., magnet (502), illustrated and described below.

FIGS. 5A-5G

FIGS. 5A-5G illustrate exemplary individual components of the body assembly (201). FIG. 5A shows an exploded view of the body assembly (201) wherein the relative positioning of each component of the body assembly (201) is discernable. FIG. 5A shows the exploded set of components slightly turned to the right (top) and to the left (bottom) in order to show the various components in the exploded view(s) from different angles, thus providing additional visibility into each component's characteristics. FIGS. 5B-5G identify each of the components of the body assembly (201) shown in the exploded view of FIG. 5A. Like FIG. 5A, components identified in FIGS. 5B-5G may be shown slightly turned to the right (top) and to the left (bottom) in order to show the various components in the exploded view(s) from different angles, thus providing additional visibility into each component's characteristics. FIG. 5B identifies a mouthpiece (301) (shaded) component of the body assembly (201). FIG. 5C identifies a magnet (502) (shaded) component of the body assembly (201). FIG. 5D identifies a magnet cover (401) (shaded) component of the body assembly (201). FIG. 5E identifies an insert spring (504) (shaded) component of the body assembly (201). Herein, an insert spring is an embodiment of compressible positioner. FIG. 5F identifies a body tube (402) (shaded) component of the body assembly (201). Finally, FIG. 5G identifies a body crown (506) (shaded) component of the body assembly (201). In aspects, FIG. 5 illustrates that devices provided by the invention, or, e.g., a component of a device of the invention, such as a body assembly component of a device, can comprise a mouthpiece (301), magnet (502), magnet cover (401), insert spring (504), body tube (402), and body crown. As stated previously, in aspects, one or more, two or more, three or more, four or more, five or more, or all components of the body subassembly (302) are attached to one another when the device is in a ready-to-use state. In aspects, components of the body subassembly (302) are not dis-engageable from one another by a user or do not require disengagement in order for the user to use the device.

FIGS. 2-5 (and the sub-figures thereof) provide illustrations of the body assembly, subcomponents thereof, and their positioning relative to one another. FIGS. 6-11 (and the sub-figures thereof) provide specific embodiments of each of the components described therein.

FIGS. 6A-6C

FIGS. 6A and 6B illustrate an exemplary mouthpiece (301) of a device (e.g., device (100) as shown in FIG. 1E) provided by the invention. A mouthpiece (301) is a component of the device which typically comes into contact with the user's mouth during use. Compound-laden air for delivery to the user exits the device during use via the mouthpiece (301) (e.g., upon drawing air from ("pulling" or "sucking") on the device by the user). The exemplary mouthpiece comprises lip groove (601), finger groove (602), bite groove (603), and airflow channel (604).

FIG. 6A illustrates an exemplary mouthpiece (301). As shown in FIG. 6A, features of mouthpiece (301) include lip groove (601), finger groove (602), bite groove (603), and airflow channel (604). In FIG. 6A, the thickness or outer diameter of lip groove (601) is shown as being, at its most narrow point, about 50%-about 70% of the largest outer diameter of the device. Lip groove (601) as exemplified in FIG. 6A is about half of the length of the mouthpiece (301) (e.g., without considering the bite groove (603)). Lip groove (601) receives the user's lips while the device is in use and allows the device to comfortably sit within the user's mouth. Lip groove (601) receives the user's lips while the device is in use. The shape and size of lip groove (601) can, in aspects, aid in the comfort of the user during device use and the ability of the user to maintain the device easily and comfortably in the user's mouth.

Similarly, the thickness or outer diameter of finger groove (602) illustrated in FIG. 6A is shown as being, at its most narrow point, about 50%-about 70% of the largest outer diameter of the device. Finger groove (602) as exemplified in FIG. 6A is about half of the length of the mouthpiece (301) (e.g., without considering the centrally located bite groove (603)). Finger groove (602) can be used by the user to hold the device, e.g., by placing two fingers on either side of the device within finger groove (602), much like a traditional smoking device, e.g., a cigarette, is held between two fingers of a user when smoking the cigarette. It should be understood that use of finger groove (602) is not mandatory for the device to operate. Finger groove (602) is provided to support user experience of the device and to aid some users in experiencing use of the device much like the experience of smoking a cigarette, which may in aspects be beneficial to users attempting to quit or reduce a cigarette smoking habit. Positioning of finger groove (602) within mouthpiece (301), within the length of the device (e.g., (100) as shown in, for example, FIG. 1E), or both, can participate in the user experience of the device by being placed at, e.g., about the center of gravity for the device (100). In aspects, the device can be at least generally, at least substantially, at least essentially, is essentially, or is balanced at the position of the finger groove (602). In aspects, the device at least generally, at least substantially, at least essentially, is essentially, or can be balanced on a user's finger when the user places a single finger beneath the device (100) at the position of finger groove (602).

FIG. 6A illustrates mouthpiece (301) as comprising a bite groove (603) positioned between lip groove (601) and finger groove (602). In aspects, such a bite groove (603) can be absent from the device. In aspects, such a bite groove (603) can be provided to enhance the aesthetics of the device (e.g., device (100) as shown in FIG. 1E). The bite groove (603) shown in FIG. 6A is a groove in the mouthpiece (301), encircling the full circumference of the device. In aspects, the groove (bite groove (603)) is bounded on both sides by narrow, flat surfaces (e.g., flat surface bands) which also encircle the full circumference of the device. As exemplified, bite groove (603) separates lip groove (601) from finger groove (602). As exemplified, bite groove (603) provides spacing between lip groove (601) and finger groove (602). In aspects, the size, e.g., the width of bite groove (603) can be adjusted such that the positioning of lip groove (601), finger groove (602), or both are located in desired position(s). For example, a wider or narrower bite groove (603) may provide for the shifting of the finger groove (602) to the center of gravity of the device. As described above, this may improve upon the' user's pleasurable or comfortable experience in using the device. (Notably, another mechanism for shifting the center of gravity of the device can be, e.g., lengthening or shortening the portion of mouthpiece (301) identifiable as the lip groove (601), lengthening or shortening the portion of mouthpiece (301) identifiable as finger groove (602), extending or decreasing the overall length of the device (e.g., extending or decreasing the overall length of one or more components of the device other than lip groove (601) or finger groove (602)), modifying (via either increasing or decreasing) the weight of one or more components of the device, redistributing the weight of one or more components of the device, etc., or any combination thereof.

Airflow channel (604) is shown in FIG. 6A as a circular chamber passing within the mouthpiece (301). The diameter of airflow channel (604) is shown in FIG. 6A as being greater than 50%, e.g., about 50%-about 70%, of the largest outer diameter of the device. FIG. 6B illustrates mouthpiece (301) cut in half with the upper section removed, such that the interior of mouthpiece (301) is visible. As shown in FIG. 6B, airflow channel (604) passes through (within and across) the entire length of mouthpiece (301). In some respects, airflow channel (604) has a single diameter across its length within mouthpiece (301). As exemplified in FIG. 6B, airflow channel (604) can have one or more sections or locations where the diameter is detectably or significantly different from one or more other sections or locations of the airflow channel (604). In certain aspects, when viewed alone (e.g., as a separate component, unattached to any additional component of the device), the airflow channel (604) of the mouthpiece (301) can have one or more sections or locations where the diameter is detectably or significantly different from one or more other sections or locations of the airflow channel (604); however, when the mouthpiece (301) is joined with (e.g., attached to) one or more other components of the device (e.g., device (100) of FIG. 1E)—such as, e.g., one or more other components of the body assembly (e.g., body assembly (201) shown in FIG. 5A and further exemplified in FIGS. 5B-5G)—the airflow channel (604) is at least generally, at least substantially, at least essentially, is essentially, or is uniform in its diameter across the length of the mouthpiece. That is, in aspects, the diameter of the airflow channel (604) through the mouthpiece (301) can be defined by the mouthpiece (301) alone, one or more components of the body assembly other than the mouthpiece, e.g., one or more components of the body subassembly, or both.

FIG. 6B further illustrates that the shape characteristics of each end of mouthpiece (301) can vary from one another. Lip groove (601), bite groove (603), finger groove (602), and airflow channel (604) are each shown in FIG. 6B. As exemplified therein, mouthpiece (301) can have a first end (605), such a first end being closest to lip groove (601). As shown, such a first end (605) can be rounded, e.g., such that the plane forming the end of a first end (605) of mouthpiece (301) does not form a right angle with the side (e.g., outer surface) of the mouthpiece (301). Lack of such a right angle can, in aspects, provide increased comfort for the user in using the device. In aspects, such a first end (605) of mouthpiece (301) can be the end of mouthpiece (301) placed in the mouth of the user. In aspects, such a rounded surface of the first end (605) can improve upon the mouth feel of mouthpiece (301), e.g., by lacking sharp edges which may irritate the, e.g., lips or tongue of a user. As further exemplified in FIG. 6B, mouthpiece (301) can have a second end (606), such a second end being closest to finger groove (602). As shown, such a second end (606) can be flat, e.g., such that the plane forming the end of a second end (606) of mouthpiece (301) forms a right angle with the side (e.g., outer surface) of mouthpiece (301). Such a right angle can, in aspects, provide for an ease of fit with one or more other components of the device, such as, e.g., one or more components of a body assembly (e.g., (201) as shown in Figure, e.g., 5A) or, more specifically, one or more components of a body subassembly (e.g., (302) of FIGS. 3C and 3D). In certain aspects as exemplified by the Figures, a second end (606) of a mouthpiece (301) contacts a surface of a magnet (502), a magnet cover (401), or both a magnet (502) and a magnet cover (401) when the device is assembled (see, e.g., FIGS. 5B-5D), such a flat second end (606) of the mouthpiece abutting the surface(s) of the magnet (502), magnet cover (401), or both sufficiently to form a smooth transition on the outer surface of the device between the mouthpiece (301) and component(s) of the body subassembly (302) (e.g., of FIGS. 3C and 3D).

As shown, the exemplary mouthpiece (301) can further comprise an outer surface (607) and an inner surface (609). As shown, the exemplary mouthpiece (301) can still further comprise a first reduced diameter area first end (570) and a first reduced diameter area second end (580), wherein the first reduced diameter first and second ends (570 and 580) at least substantially define the portion of an exemplary device (100) or mouthpiece (301) characterizable as a first reduced diameter area (601), also referred to herein as a lip groove. As exemplified, exemplary mouthpiece (301) can further comprise a second reduced diameter area first end (590) and a second reduced diameter area second end (600), wherein the second reduced diameter first and second ends (590 and 600) at least substantially define the portion of an exemplary device (100) or mouthpiece (301) characterizable as a second reduced diameter area (602), also referred to herein as a finger groove. FIG. 6A further illustrates the exemplary mouthpiece (301) as comprising a mouthpiece component outer surface raised edge (595).

In certain aspects, a mouthpiece can be made of a material such that the attachment of the mouthpiece to one or more other components of a device (101), such as, e.g., one or more components of a body assembly (201). In aspects for example, a mouthpiece can be made of a material such as stainless steel or a precious metal such as gold, titanium, platinum, etc. In aspects, such a material can be strong enough in nature to support the mouthpiece comprising a connection mechanism, e.g., threading, to facilitate the attachment of mouthpiece (301) to, e.g., a component of a body assembly (201) comprising corresponding threading such that the two components attach by screw fitting. In other aspects, a mouthpiece can be made of a softer material, such as, e.g., a plastic or a porous material such as ceramic or wood. In such embodiments, such a material may be insufficient for supporting the attachment of the mouthpiece to one or more other components of the device (e.g., body assembly, (201)) such that a secure, stable fit is accomplished. In certain embodiments, a mouthpiece (301) can comprise a mouthpiece fit element (608) to facilitate the attachment of mouthpiece (301) to one or more component(s) of a device herein, e.g., at least a portion of an engagement component support, e.g., a magnet holder (such as, e.g., a portion of magnet holder (401). In aspects, such an attachment feature can comprise a fit element designed to fit therein to further facilitate attachment. In aspects, mouthpiece fit element (608) is threading. In aspects, mouthpiece fit element (608) is capable of receiving a mouthpiece attachment insert (not provided) or can simply comprise mouthpiece attachment insert (not provided). In aspects, a mouthpiece attachment insert (not provided) can be made of a material having a sufficient hardness to facilitate, e.g., the attachment of the mouthpiece (301) to one or more other components of the device (101), such as, e.g., a component of a body assembly (201).

A mouthpiece (301) can comprise a mouthpiece fit element (608) capable of receiving a mouthpiece attachment insert (not provided) which aids in the attachment of the mouthpiece (301) to one or more other components of the device. In aspects, a mouthpiece (301) does not comprise a mouthpiece fit element (608). In aspects, a mouthpiece (301) that does not comprise a mouthpiece fit element (608) comprises a mouthpiece attachment insert (not provided). In aspects, a mouthpiece fit element (608) can facilitate the manufacturing of the device. In aspects, the mouthpiece fit element (608) can facilitate the mouthpiece being fitted with/to one or more other components of the device, such as, e.g., a first magnet cover connection mechanism (815). In certain aspects, the mouthpiece fit element (608) aids in the connection of mouthpiece (301) with one or more other components, e.g., a magnet cover (401), however once the mouthpiece is engaged with such another component, the connection is made permanent such that the two components are intended to remain engaged and the two components, (e.g., the mouthpiece (301) and the magnet cover (401) are not able to be disengaged by the user; or, more specifically, the mouthpiece fit element (608) is not able to be disengaged from the first magnet cover connection mechanism (815)). This can be accomplished, e.g., by the mouthpiece fit element (608) being, e.g., a threading component, first magnet cover connection mechanism (815) being a threading mechanism capable of receiving the threading component (e.g., mouthpiece fit element (608) provided with threading), and, e.g., the two being further glued together when engaged.

In alternative aspects, the presence of such a mouthpiece fit element (608) can facilitate the ability of the mouthpiece to be disengaged from one or more other elements of the device, or, e.g., the entirety of the remaining structure of the device. In aspects, the ability to remove mouthpiece (301) can provide user(s) of the device with the option to change the mouthpiece or to "swap"/exchange one mouthpiece for another. This can be helpful, e.g., if for example a mouthpiece were to become damaged, in that the remaining structure of the device could be salvaged while only requiring the replacement of the single mouthpiece component. Further, the ability to remove the mouthpiece can facilitate, e.g., the ability of the user to exchange one mouthpiece for another, such as, e.g., exchanging one mouthpiece for another having a one or more different design characteristics, one or more differences in aesthetic appearance, one or more different composition materials, etc.

Mouthpiece fit element (608) is exemplified in FIG. 6B as an element capable of operating alone, e.g., as a threading element, or, e.g., is capable of receiving a mouthpiece attachment insert (not provided) or a component/portion of a supplement (610) to a user engagement component (301), i.e., a user engagement component (301) for receiving volatile compound(s). As stated, mouthpiece fit element (608) can, in certain embodiments, be itself a threading mechanism capable of receiving a connection element of one or more other components of the device, such as, e.g., as a first magnet cover connection mechanism (815) when, e.g., provided as a compatible threading mechanism. Mouthpiece fit element (608) can comprise, when embodied as a threading mechanism, a sufficient number of threads to ensure suitable and sufficient attachment to the one or more other components of the device. As described elsewhere herein, such a connection between the mouthpiece (301) and one or more other components of the device (e.g., magnet cover (401)) can be provided in other forms, such as, e.g., a snap fit, a magnetic fit, etc. Accordingly, in aspects, mouthpiece fit element (608) can be a fit element capable of cooperating with one or more other compatible connection mechanisms of one or more other device components (e.g., a magnet cover (401)) to form a suitably secure connection, either permanent or providing releasable engagement, with such one or more other device components.

As exemplified in FIG. 6B, mouthpiece fit element (608) is provided as a feature of the body of mouthpiece (301); that is, mouthpiece fit element (608) is made of the same material as mouthpiece (301). However, in alternative embodiments (not shown), mouthpiece fit element (608) can be comprised of a material which is different from one or more other parts of the mouthpiece (301). As one example, in aspects, mouthpiece fit element (608) can be made of metal or, e.g., ceramic, e.g., provided as a metal or ceramic component, which can be, e.g., positioned within the mouthpiece (301) which can be made of, for example, wood. Further, mouthpiece fit element (608) can in aspects be capable of receiving, e.g., maintaining, one or more components of a device which is made of a material different than that of mouthpiece (301) and which is manufactured as a separate part of the device, but which is positioned in mouthpiece fit element (608) in a fully assembled device. Such a component is exemplified in FIG. 6C. According to certain embodiments, a device may not contain a mouthpiece fit element (608).

In certain aspects, a device can comprise a supplement (610) to a user engagement component (301) for receiving volatile compound(s). FIG. 6C provides an exemplary supplement (610) to a user engagement component (301) for receiving volatile compound(s). A supplement (610) to a user engagement component (301) for receiving volatile compound(s), exemplified here, is made of stainless steel or a precious metal such as gold, titanium, platinum, etc., or another impervious material. A supplement (610) to a user engagement component (301) for receiving volatile compound(s) can comprise mouthpiece attachment insert attachment elements (not shown), E.g., a supplement (610) to a user engagement component (301) for receiving volatile compound(s) can comprise a portion having a particular shape/conformation or a portion comprising attachment elements such as threading, etc. which facilitate the attachment of the volatile compound delivery facilitation component to one or more other components of the delivery device. In aspects, attachment element(s) of a supplement (610) to a user engagement component (301) for receiving volatile compound(s), can, e.g., operate as a mouthpiece attachment insert (not provided). Supplement (610) can further comprise a supplement exterior wall (614), a supplement interior wall (616), and, e.g., a supplement opening (618).

Not shown in FIG. 6C, but provided as one embodiment, mouthpiece attachment insert attachment elements (not shown) can be provided as threads/threading along a portion of the volatile compound delivery facilitation component supplement (610), allowing for the volatile compound delivery facilitation component supplement (610) to cooperatively engage with another device component comprising compatible threading, such as, e.g., an element of magnet cover (401), or, e.g., more specifically first magnet cover connection mechanism (815) of, e.g., a magnet cover (401). In aspects, the volatile compound delivery facilitation component supplement (610) is fixed in position with mouthpiece (301). That is, in aspects, the volatile compound delivery facilitation component supplement (610) is not removable from mouthpiece (301) in a fully assembled device under normal use. In certain specific embodiments, the volatile compound delivery facilitation component supplement (610) and first magnet cover connection mechanism (815) are designed to work cooperatively together, e.g., by each comprising threading compatible with the other. In aspects, the volatile compound delivery facilitation component supplement (610) and first magnet cover connection mechanism (815) are engaged with one another in a fully assembled device. In aspects, the volatile compound delivery facilitation component supplement (610) and first magnet cover connection mechanism (815) are engaged with one another in a fully assembled device such that they are not separatable from one another under conditions of normal device use. In aspects, one or more additional connection mechanisms are used to join the two components in a permanent state under normal operating conditions. In aspects, such one or more additional connection mechanisms can be, e.g., the use of a glue in addition to the, e.g., compatible/cooperative threading connective elements present in each component. In alternative aspects, the volatile compound delivery facilitation component supplement (610) and first magnet cover connection mechanism (815) are selectively engaged with one another, such that they can be selectively engaged, disengaged, and re-engaged during device operation. As described above, such selectable engagement can, in aspects, provide opportunities for a device user to remove and replace a mouthpiece at the users will and discretion. In aspects, when such selectable engagement is present, when engaged, the engagement is sufficient to provide a suitably secure and sufficient connection between the volatile compound delivery facilitation component supplement (610) and the first magnet cover connection mechanism (815) to ensure that the two components do not detectably or significantly disengage from one another during normal operation, do not detectably or significantly disengage from one another unless intentionally made to do so by the user, do not disengage to an extent which renders the device unpleasant, uncomfortable, unstable, aesthetically or tactilely displeasing (e.g., renders the device "loose" fitting with regard to the fit between components of the body assembly (201)), dysfunctional, or any combination thereof.

Further, as exemplified in FIG. 6C, the volatile compound delivery facilitation component supplement (610) comprises a supplement exterior wall (614). In aspects, the supplement exterior wall (614) is designed to have at least a portion of its shape complementary in fit to the interior of the mouthpiece, e.g., to be contoured to the shape of airflow channel (604) within mouthpiece (301). In aspects, the supplement exterior wall (614) is designed to have at least a portion of its shape complementary in fit to that of mouthpiece fit element (608). That is, in aspects, a supplement exterior wall (614) is designed to have a shape which corresponds with that of mouthpiece fit element (608) such that mouthpiece attachment insert (610) can be positioned within mouthpiece fit element (608). In certain aspects, mouthpiece fit element (608) can be a smooth, non-contoured surface defining at least part of airflow channel (604) of mouthpiece (301). In aspects, a supplement exterior wall (614) can be a smooth, non-contoured surface complementary to that of mouthpiece fit element (608), providing for the ability of the volatile compound delivery facilitation component supplement (610) to be positioned within mouthpiece fit element (608) such that a supplement exterior wall (614) suitably fits with mouthpiece fit element (608). In other aspects, as exemplified in the mouthpiece figures provided herein, mouthpiece fit element (608) can comprise one or more contours or comprise a conformation which requires a complementarily shaped component if such a component is to be positioned within mouthpiece fit element (608). In aspects, the supplement exterior wall (614) comprises contouring which complements that of mouthpiece fit element (608), e.g., comprises one or more shape elements, or comprises a conformation, which complements that of mouthpiece fit element (608). In aspects, the supplement (610) comprises a supplement exterior wall (614) that is designed to be in contact with mouthpiece fit element (608) in an assembled device. According to alternative aspects, the supplement (610) does not provide attachment mechanism feature(s). In aspects, a mouthpiece attachment insert (not provided) provides such an attachment mechanism feature to aid in or otherwise facilitate in the attachment of the mouthpiece (301) to one or more other component of device(s).

Still further, as exemplified in FIG. 6C, a supplement to a user engagement component for receiving volatile compound(s) (610) comprises a supplement interior wall (616) and a supplement opening (618). In aspects, the supplement opening (618) provides for an airflow through the supplement (610), and, further, through mouthpiece (301), to facilitate the inhalation of compound(s) provided by an insert, such as, e.g., insert (1800)). In aspects, the mouthpiece (301) is made from a brittle material such as ceramic and the volatile compound delivery facilitation component supplement (610) provides structural strength to the mouthpiece (301). In aspects, the mouthpiece (301) is made from a porous material such as ceramic and the volatile compound delivery facilitation component supplement (610) separates the mouthpiece (301) from compounds provided by an insert, such as, e.g., insert (1800) to prevent the mouthpiece (301) from absorbing the smell and/or flavor of the insert (1800).

FIG. 7

FIG. 7 illustrates an exemplary magnet (502) of a device (e.g., device (100) as shown in FIG. 1E) provided by the invention. A magnet (502) can be present in a device to provide a mechanism for connecting or otherwise maintaining reversible attachment of a body assembly (201) (see FIG. 2A) to a tip assembly (202) (see FIG. 2B). As exemplified in FIG. 5C, the magnet (502) (see FIG. 7) is a component of the body assembly (201). As exemplified, magnet (502) provides an exemplary mechanism for providing selective engage-ability (and, correspondingly, the selective disengage-ability) of the body assembly (201) and the tip assembly (202). Accordingly, magnet (502), as exemplified, participates in the ability of the device to be separated into at least two primary components (e.g., body assembly (201) and tip assembly (202)), allowing for a compound-laden insert providing one or more compounds for inhalation using the exemplary device (e.g., an insert (e.g., (1800)) to be inserted from a position lateral to the device versus in-line with the device as described in detail elsewhere herein. Further, magnet (502), as exemplified, participates in the ability of the device to provide the repeated selectively engaged/dis-engaged nature of at least two components such that the device comprises a fidgetability, e.g., providing elements of a fidget device has described herein.

The magnet (502) exemplified in FIG. 7 is a ring-shaped magnet. As exemplified, the ring-shaped magnet (502) has a magnet inner surface (701), a magnet outer surface (702), a magnet first side (703), a magnet second side (704), a magnet first inner edge (705), a corresponding magnet first outer edge (706), and a magnet second inner edge and magnet second outer edge, corresponding to the magnet first inner edge (705) and first outer edge (706) respectively but not shown. Magnet inner surface (701) is shown as running parallel to magnet outer surface (702) round the ring-shape of magnet (502). Magnet first side (703) is shown as parallel to magnet second side (704); magnet second side (704) is opposite that of magnet first side (703), facing away from the viewer. Magnet first inner edge (705) and first outer edge (706) define the inner and outer edges of magnet first side (703) as well as one edge of magnet inner surface (701) and one edge of magnet outer surface (702). Magnet second inner edge and second outer edges, not shown as they are facing away from the viewer, define the inner and outer edges of magnet second side (704), as well as one edge of magnet inner surface (701) and one edge of magnet outer surface (702).

Magnet inner surface (701) is shown in FIG. 7 as smooth, uninterrupted, and running around the inner circumference of magnet (502). Magnet inner surface (701) can contact one or more other components of the device, such as, e.g., one or more components of the body assembly (201), e.g., one or more components of the body subassembly (302), such as, e.g., specifically one or more portions of the magnet cover (401).

Magnet outer surface (702) is shown in FIG. 7 as smooth, uninterrupted, and running around the outer circumference of magnet (502). Magnet outer surface (702) is parallel to magnet inner surface (701). Magnet outer surface (702) can contact one or more other components of the device, such as, e.g., one or more components of the body assembly (201), e.g., one or more components of the body subassembly (302), such as, e.g., specifically one or more portions of the magnet cover (401).

Magnet first side (703) is shown in FIG. 7 as a flat, smooth surface. Magnet first side (703) is shown as perpendicular to both magnet inner surface (701) and magnet outer surface (702). Magnet first side (703) is parallel to magnet second side (704) (not visible to the reader). Magnet first side (703) can contact one or more other components of the device, such as, e.g., one or more components of the body assembly (201), e.g., mouthpiece (301).

Magnet second side (704) faces away from the reader in FIG. 7 but is the same as magnet first side (703) but on the opposite side of the magnet. Magnet second side (704) is perpendicular to both magnet inner surface (702) and magnet outer surface (702). Magnet second side (704) is parallel to magnet first side (703). Magnet second side (704) can contact one or more other components of the device, such as, e.g., one or more components of the body assembly, such as, e.g., one or more components of the body subassembly (302), e.g., specifically, one or more portions of magnet cover (401).

Magnet first inner edge (705) and magnet first outer edge (706) each define the interface with magnet first side (703) with magnet inner surface (701) and magnet outer surface (702), respectively. Magnet first inner edge (705) defines where magnet first side (703) meets magnet inner surface (701). Magnet first inner edge (705) can form a right angle between the two surfaces; however, as exemplified in FIG. 7, magnet first inner edge (705) can also be a surface in and of itself, such as magnet first inner edge (705) being an angled plane (relative to magnet first side (703) and magnet inner surface (701)), separating the magnet first side (703) and magnet inner surface (701) providing an angled transition between the two surfaces. Magnet first inner edge (705) in FIG. 7 is shown as a smooth surface, encircling the inner diameter of the magnet between the magnet first side (703) and magnet inner surface (701), such that the angle formed by the magnet first side (703) and magnet first inner edge (705) is about 135°, the angle formed by the magnet first inner edge (705) and magnet inner surface (701) is about 135°, or both.

Magnet first outer edge (706) defines where magnet first side (703) meets magnet outer surface (702). Magnet first outer edge (706) can form a right angle between the two surfaces; however, as exemplified in FIG. 7, magnet first outer edge (706) can also be a surface in and of itself, such as magnet first outer edge (706) being an angled plane (relative to magnet first side (703) and magnet outer surface (702)), separating the magnet first side (703) and magnet outer surface (702) providing an angled transition between the two surfaces. Magnet first outer edge (706) in FIG. 7 is shown as a smooth surface, encircling the outer diameter of the magnet between the magnet first side (703) and magnet outer surface (702), such that the angle formed by the magnet first side (703) and the magnet first outer edge (706) is about 135°, the angle formed by the magnet first outer edge (706) and magnet outer surface (702) is about 135°, or both.

As described above, a magnet second inner edge and a magnet second outer edge are also present. Magnet second inner edge (not shown) and second outer edge (not shown) are positioned similarly to magnet first inner edge (705) and magnet first outer edge (706) but are positioned on the opposite side of the magnet. That is, magnet second inner edge defines where magnet inner surface (701) meets magnet second side (704), and magnet second outer edge defines where magnet second side (704) meets magnet outer surface (702). Magnet second inner and outer edges can take on the characteristic(s) of magnet first inner and outer edges (705) and (706)).

The magnet (502) of FIG. 7, as shown in FIG. 5C, can be positioned in an assembled device at least partially within (e.g., at least partially nested within) magnet cover (401) (see FIG. 5D). Accordingly, in this embodiment, magnet (502) is not visible on the exterior of an assembled device. When fully assembled, in this embodiment, the magnet is protected from the exterior environment by magnet cover (401). In this environment, it is the magnet that serves to maintain the fully assembled device as a single unit while also providing selectable disengagement between the body assembly (201) and the tip assembly (202). Magnet (502) is exemplified here as shaped as a ring (e.g., comprising an annular shape), with the ability to provide an airflow path through the center of magnet (502) (e.g., allow air to pass through the interior of the ring formed by magnet (502). Thus magnet (502) aids in the establishment of an airflow path through the device, e.g., specifically being continuous with both the airflow path through the mouthpiece (301) and through the magnet cover (401). The magnet (502) can be attracted to one or more other components of the device. In certain aspects, the magnet (502) is attracted to only a single component of the device. In aspects, the magnet (502) is attracted to a single component of the tip assembly (202). In aspects, the only component of the device magnet (502) is attracted to is barrel collar (1302). In aspects, the magnet (502) is oriented uniformly among devices (100) such that the magnet (502) is compatible with various magnetic attachments. In aspects, the magnet (502) comprises a bearing such that the user may spin or twist the device (100) while simultaneously holding the magnet (502) in place, providing elements of a fidget device as described herein.

FIGS. 8A-8B

FIG. 8A and FIG. 8B illustrate an exemplary mechanism for (a) holding magnet (502) in place, (b) protecting magnet (502) from the external environment, or (c) both (a) and (b). As illustrated, exemplary magnet cover (401) of a device (e.g., device (100) as shown in FIG. 1E) provided by the invention provide such features. FIG. 8A and FIG. 8B each show an exemplary magnet cover (401) from a slightly different perspective such that different components of magnet cover (401) become visible. Magnet cover (401) is embodied as comprising an interior magnet cover surface (802), exterior magnet cover surface (803), magnet cover encompassing surface thickness (804), magnet cover exterior surface first edge (805), magnet cover exterior surface second edge (806), magnet cover interior wall (807), magnet cover exterior wall (808), first magnet cover extension (809), first magnet cover extension first outer surface (810), first magnet cover extension second outer surface (811), first magnet cover extension first inner surface (812), first magnet cover extension thickness (813), first magnet cover extension interior (814), first magnet cover connection mechanism (815), second magnet cover extension component (816), second magnet cover extension first portion (817), second magnet cover extension second portion (818), second magnet cover extension edge (819), second magnet cover extension thickness (820), second magnet cover extension interior surface (821), and, e.g., second magnet cover extension interior (822). Each exemplary component of magnet cover (401) is described below. Magnet cover (401) serves in this embodiment to protect magnet (502). In this embodiment, magnet cover (401) is designed to hold, e.g., in a nested fashion, magnet (502), and to maintain magnet (502) within the device when fully assembled such that magnet (502) is not exposed to the exterior environment. In this embodiment, magnet cover (401) is designed to attach body subassembly (302) (see, e.g., FIG. 3C) to mouthpiece (301) (see, e.g., FIG. 3C). Further, in aspects, magnet cover (401) provides an externally visible indicator, e.g., second indicator (102), which, either alone or in combination with one or more other visual indicators (e.g., first indicator (101)), indicates the spatial orientation of one or more components of the device, one or more operational status(es) of the device, or both.

FIG. 8A illustrates magnet cover (401) comprising an interior magnet cover surface (802). Interior magnet cover surface (802) is exemplified as a smooth surface encompassing the inner circumference of magnet cover (401). In aspects, interior magnet cover surface (802) contacts magnet outer surface (702) (see FIG. 7) when magnet (502) is positioned within magnet cover (401). In aspects, the width of the interior magnet cover surface is at least generally, at least substantially, at least essentially, essentially, or is the same width as magnet outer surface (702). As exemplified in FIG. 8A, interior magnet cover surface (802) meets the magnet cover interior wall (807) at a right angle. Exterior magnet cover surface (803) is exemplified as a smooth surface having a single interruption, the single interruption being an indicator (second indicator (102)) which is discussed further below. Interior magnet cover surface (802) is shown as running in parallel to exterior magnet cover surface (803), separated from one another by magnet cover encompassing surface thickness (804). The magnet cover encompassing surface thickness (804) defines the distance interior magnet cover surface (802) is from exterior magnet cover surface (803). The plane defining the magnet cover encompassing surface thickness (804) (e.g., the surface defined by this thickness) can meet the interior magnet cover surface (802), exterior magnet cover surface (803), both at a right angle or an angle different from 90°. As shown, the surface defined by the magnet cover encompassing surface thickness (804) meets the interior magnet cover surface (802) at a right angle. However, as shown, the surface defined by the magnet cover encompassing surface thickness (804) meets the exterior magnet cover surface (803) at an angle differing from 90°. Therein, magnet cover exterior surface first edge (805) defines the interface between the surface defined by the magnet cover encompassing surface thickness (804) and the exterior magnet cover surface (803). This magnet cover exterior surface first edge (805) is shown as forming a surface in and of itself, such as magnet cover exterior surface first edge (805) being an angled plane (relative to the surface defined by the magnet cover encompassing surface thickness (804) and exterior magnet cover surface (803)), separating the surface defined by the magnet cover encompassing surface thickness (804) and exterior magnet cover surface (803) and providing an angled transition between the two surfaces. Magnet cover exterior surface first edge (805) in FIG. 8A is shown as a smooth surface, encircling the circumference of the magnet cover (401) between the surface defined by the magnet cover encompassing surface thickness (804) and the exterior magnet cover surface (803), such that the angle formed by the surface defined by the magnet cover encompassing surface thickness (804) and the magnet cover exterior surface first edge (805) is about 135°, the angle formed by the magnet cover exterior surface first edge (805) and the exterior magnet cover surface (803) is about 135°, or both. FIG. 8B shows a magnet cover exterior surface second edge (806), which, like magnet cover exterior surface first edge (805), encircles the circumference of the magnet cover (401), and forms a similar interface between planes of the magnet cover (401), but on the opposing side of the exterior magnet cover surface (803). For sake of brevity, this specific interface is not repeated here, but should be understood by the reader to share corresponding characteristics of magnet cover exterior surface first edge (805) described above.

FIG. 8A further illustrates magnet cover (401) comprising a magnet cover interior wall (807). Magnet cover interior wall (807) forms the back side of magnet cover exterior wall (808) shown in FIG. 8B, and vice versa. Magnet cover interior wall (401) is shown as a smooth surface on the interior of magnet cover (401), forming the inner-most wall of the magnet cover (401). As exemplified, magnet cover interior wall (807) can contact magnet (502), such as, e.g., specifically magnet second side (704) (as shown in FIG. 7) when magnet (502) is held within magnet cover (401) and the exemplary device (100) is fully assembled. Accordingly, magnet cover interior wall (807) aids in maintaining magnet (502) in place within the exemplary, fully assembled device (100).

Continuing with the description of FIG. 8A, magnet cover (401) is illustrated as comprising a first magnet cover extension component (809), extending to the left from the main body of magnet cover (401) as viewed in FIG. 8A. First magnet cover extension component (809) is shown with the following exemplary characteristics: first magnet cover extension first outer surface (810), first magnet cover extension second outer surface (811), first magnet cover extension first inner surface (812), first magnet cover extension thickness (813), first magnet cover extension interior (814), and first magnet cover connection mechanism (815). First magnet cover extension first outer surface (810) is shown as a smooth surface, opposed by first magnet cover extension first inner surface (812), and separated therefrom by a thickness which is defined by the first magnet cover extension thickness (813) and the surface associated therewith. Each of first magnet cover extension first outer surface (810) and the magnet cover extension first inner surface (812) encompass first magnet cover extension interior (814). As shown, first magnet over extension first outer surface (810) forms a non-90° angle with the surface formed by the first magnet cover extension thickness (813). As exemplified, this angle is greater than 90°. As shown, first magnet cover extension first inner surface (812) also forms a non-90° angle with the surface formed by the first magnet cover extension thickness (813). As exemplified, this angle is less than 90°. In embodiments (all not shown) either such angle can be greater than, equal to, or less than 90°. First magnet cover connection mechanism (815) is exemplified as a threaded attachment mechanism such that magnet cover (401) can be attached to another component of exemplary device (100) by screwing magnet cover (401) onto/into such another component. As illustrated, such another component can be mouthpiece (301). In aspects, such another component can more specifically be a mouthpiece fit element (608) of a mouthpiece (301). Accordingly, as exemplified, elements (810), (812), (813), and at least a portion of (814) can be positioned within, in a fully assembled device, attached to, or both, a portion of mouthpiece (301). As described above relevant to the description of mouthpiece (301) and not repeated here, such an attachment/connection can, in some respects be permanent (e.g., not reversible by a user). In alternative aspects, such a connection can be reversible (e.g., the two components can be disengaged by a user). Further, first magnet cover connection mechanism (815) can, as is described elsewhere, be provided in an alternative form, such as, e.g., a snap fit, magnet, etc. First magnet cover extension second outer surface (811) can be positioned within the interior of the ring formed by a ring-shaped magnet (502) (See, e.g., FIG. 7). That is, magnet (502) can be placed over/around first magnet cover extension component (809) and ultimately positioned around first magnet cover extension second outer surface (811), with magnet cover inner surface (701) making at least partial contact with first magnet cover extension second outer surface (811), and magnet second side (704) making at least partial contact with magnet cover interior wall (807). When fully assembled, interior magnet cover surface (802), exterior magnet cover surface (803), the surface formed by magnet cover encompassing surface thickness (804), magnet cover exterior surface first edge (805), magnet cover exterior surface second edge (806), or any combination thereof can be positioned outside of mouthpiece (301).

In aspects, the positioning of a magnet (502) within a magnet cover (401) is facilitated by the use of one or more magnet fit elements (not shown). In aspects, a magnet fit element can be any element facilitating the maintenance of the magnet in position within a device (401) during manufacturing, during use, or both. In aspects, such a fit element can be a glue, e.g., an epoxy glue, one or more O-rings, or both. In aspects, one or more O-rings can reduce detectable or significant shaking of a magnet. In aspects, use of a glue, e.g., epoxy, can be used to maintain secure positioning.

FIG. 8B illustrates an alternative view of magnet cover (401), wherein additional elements of magnet cover (401) are visible. As shown in FIG. 8B, magnet cover (401) further comprises a magnet cover exterior surface second edge (806), magnet cover exterior wall (808), and a second magnet cover extension component (816), which comprises a second magnet cover extension first portion (817), a second magnet cover extension second portion (818), a second magnet cover extension edge (819), a second magnet cover extension thickness (820), a second magnet cover extension interior surface (821), and a second magnet cover extension interior (822). Also shown in FIG. 8B is an indicator, e.g., a visual indicator, exemplified as second indicator (102) of exemplary device (100), which is embodied as a groove carved within exterior magnet surface (803).

As described above, magnet cover exterior surface second edge (806) is much like that of magnet cover exterior surface first edge (805) shown in FIG. 8A, exemplified as having a smooth surface, encircling the circumference of the magnet cover (401). As shown in FIG. 8B, magnet cover exterior surface second edge (806) forms the interface between exterior magnet cover surface (803) and magnet cover exterior wall (808). As exemplified, the angle formed by the exterior magnet cover surface (803) and the magnet cover exterior surface second edge (806) is about 135°, and, similarly, the angle formed by the magnet cover exterior surface second edge (806) and magnet cover exterior wall (808) is also about 135°. Magnet cover exterior wall (808) is shown as a smooth surface opposite that of magnet cover interior wall (807) (see FIG. 8A). Magnet cover exterior wall (808) may in embodiments contact at least a portion of insert spring (504), at least a portion of body tube (402), at least a portion of barrel collar (1302), barrel tube (1304), or any combination thereof. In certain aspects, magnet over exterior wall (808) does not contact a portion of insert spring (504). In certain specific aspects, magnet cover (401), and specifically the magnet cover exterior wall (808), does not contact barrel collar (1302). In aspects, there is a detectable space or gap between magnet cover (401), and, e.g., in specific embodiments, between magnet cover exterior wall (808), and barrel collar (1302). In aspects, such a gap is present to ensure a suitable fit ("mating") between elements of body crown (506) and elements of barrel crown (1306), such that the two components can effectively cooperate to control airflow through the device as is described elsewhere herein. In aspects, such a detectable space can account for variance in manufacturing, e.g., manufacturing tolerances.

Second magnet cover extension first portion (817) can be distinct from second magnet cover extension second portion (818) in that it may form a different plane than second magnet cover extension second portion (818), e.g., forming an angle with second magnet cover extension second portion (818). In the exemplary embodiment shown in FIG. 8B, second magnet cover extension first portion (817) forms an angle with second magnet cover extension second portion (818) such that the angle provides additional strength and/or quality to the mating between, contact between, or functionality of two or more components of the system, e.g., the body tube (402) and the magnet cover (401). In aspects, magnet cover extension second portion (818) serves to connect to the body tube (402). In aspects, magnet cover extension second portion it provides a detectably or significant amount of rigidity to body tube (402) as well as a location, e.g., a surface or place, to which body tube (402) can be attached, e.g., welded (attached by welding). In aspects, one or more surfaces of a magnet cover (401) detectably or significantly holds or otherwise maintains one or more device part(s) or component, e.g., an insert spring (504). In aspects, insert spring (504) rests upon one or more surfaces of a magnet cover (401) after being inserted into the device. Second magnet cover extension second portion (818) is shown as comprising a smooth surface separating second magnet cover extension first portion (817) from second magnet cover extension edge (819). As with other edge components described above, second magnet cover extension edge (819) forms a surface in and of itself, separating second magnet cover extension second portion (818) from the surface formed by second magnet cover extension thickness (820). In the exemplary embodiment shown in FIG. 8B, the angle formed by the interface of second magnet cover extension second portion (818) and the second magnet cover extension edge (819) is similar to the angle formed by the interface of second magnet cover extension edge (819) and the surface formed by second magnet cover extension thickness (820). Such angles can be, e.g., about 135° each. In aspects, second magnet cover extension first portion (817) is present to ensure that no material inadvertently remaining from a manufacturing process interferes with the mating between, contact between, or functionality of two or more components of the system, e.g., the body tube (402) and the magnet cover (401). Second magnet cover extension first portion (817), second magnet cover extension second portion (818), second magnet cover extension edge (819), or any combination thereof can, in aspects, contact insert spring (504). In a fully assembled exemplary device (e.g., exemplary device (100)), insert spring (504) can be positioned around at least a portion second magnet cover extension component (816). In certain embodiments, in a fully assembled exemplary device (e.g., (100)) insert spring (504) can be positioned on (e.g., in contact with) second magnet cover extension second portion (818), second magnet cover extension edge (819), or both. In an exemplary fully assembled device, the surface formed by the second magnet cover extension thickness (820) can hold at least a portion of insert spring (504). Second magnet cover extension component (816) comprises an interior (822). This interior (802) establishes an airflow path through magnet cover (401). Accordingly, magnet cover (401) aids in the establishment of an airflow path through the device. Specifically, airflow through magnet cover (401) is continuous with the airflow path through magnet (502) and through body tube (402). In aspects, the opening to second magnet cover extension interior (822) can be any suitable size. In aspects, the opening to second magnet cover extension interior (822) can be any size which is not detectably or significantly smaller than the largest opening established by any stage of cooperation between body crown (506) and barrel crown (1306).

Finally with regard to FIG. 8B, indicator (102) (specifically in this illustrated embodiment, second indicator (102)) is embodied as a groove in exterior magnet cover surface (803). As described previously, indicator (e.g., second indicator) (102) can inform the user by providing an indication of the spatial orientation of one or more device components, one or more operational status(es) of the device, or both. As illustrated in the exemplary embodiment, second indicator (102) spans the entire width of exterior magnet cover surface (803), including crossing magnet cover exterior surface first and second edges (805) and (806). In certain embodiments such an indicator may be smaller and may not span the entirety of any entire single dimension of the magnet cover (401) or any other component on/in which the indicator is present. In certain embodiments, the indicator (102) may be protruded instead of recessed to act as a stopper that prevents the device (100) from rolling when placed horizontally on a table, counter, desk, or other surface.

In aspects, magnet cover (401) is made of a material which is not magnetic. That is, magnet cover (401) is made of a nonmagnetic material and not capable of being magnetized. Thus, in aspects, magnet (502) is not magnetically attracted to magnet cover (401).

FIGS. 9A-9B

FIGS. 9A and 9B illustrate an exemplary component to aid in the stable maintenance of a compound laden element present to provide one or more compounds for inhalation, e.g., an insert (e.g., (1800)). FIG. 9A exemplifies this component as an insert spring (504). As shown in FIG. 9A, insert spring (504) is exemplified as comprising two major elements: an insert spring band (901) and an insert spring flex element (902).

Elements of insert spring band (901) are illustrated in FIG. 9A (with many also shown in FIG. 9B). Insert spring band (901) is illustrated as comprising: an insert spring band interior (903); an insert spring band first interior surface (904); an insert spring band second interior surface (905); an insert spring band exterior surface (906); an insert spring band thickness (907); an insert spring band clip (908), the insert spring band clip (908) comprising an insert spring band clip angle (909) and an insert spring band clip tab (910); and an insert spring band gap (911). Insert spring band interior (903) can receive one or more other components of an exemplary device (e.g., exemplary device (100)), such as, for example, a portion of a magnet cover, e.g., second magnet cover extension component (816). In certain aspects, insert spring band interior (903) does not receive any significant portion of any other device (100) component. Insert spring band interior (903) can be bounded at least in part by inner surface(s) of insert spring band (901), such as, e.g., insert spring band first interior surface (904) and insert spring band second interior surface (905). As illustrated, a first interior surface (904) can form a flat plane. Further, a second interior surface (905) can form a rounded surface. In such a configuration, insert spring band (901) may not form an (incomplete) circular shape, but rather, form an (incomplete) circular shape with one flat section. As shown, inner surfaces (e.g., first and second insert spring band interior surfaces (904) and (905)) have an opposing insert spring band exterior surface (906). Insert spring band exterior surface (906) is shown as having a smooth surface. Insert spring band (901) is exemplified as having an insert spring band thickness (907). In aspects, insert spring (504) is held in place within a device (100) by spring tension. In aspects, insert spring (504) resides within a portion of body tube (402) in a fully assembled device. In aspects, insert spring (504) is maintained within body tube (402) by spring force, e.g., spring tension, whereby in its relaxed state (e.g., manufactured "open" state), insert spring (504) has a distance across its interior space which is greater than the diameter of body tube (402); thus, when compressed and fed or placed into the interior of body tube (402), the natural desire is for the insert spring to expand to its relaxed state, creating a spring tension which maintains the insert spring (504) in place within the body tube (402).

FIG. 9A illustrates the insert spring band clip (908) element of insert spring band (901). Therein, insert spring band clip (908) is shown as comprising a bent or angled portion (insert spring band clip angle (909)), and an insert spring band clip tab (910). The width of insert spring band clip (908) is shown as being wider than the width of the remaining portions of insert spring band (901). This difference in size is most visible in FIG. 9B, wherein dashed line A illustrates the width of insert spring band clip tab (910), and dashed line B illustrates the width of other portion(s) of insert spring band (901). In aspects, this difference in width prevents the over-flexing of the spring tab (902). Insert spring band (901) as exemplified does not form a complete ring. Insert spring band (901) as exemplified comprises a break, or a gap (911). This gap allows for insert spring band (901) to flex. The insert spring band thickness (907) also aids in the ability of insert spring band (901) to flex. Insert spring band clip (908)

Turning to FIG. 9B, elements (903), (904), (905), (906), (907), insert spring band clip (908), unlabeled; see FIG. 9A), (910), and (911) are repeated from FIG. 9A. FIG. 9A illustrates the connection of insert spring band (901) to insert spring flex element (902). This connection is illustrated as being facilitated by insert spring flex element hinge (912).

Insert spring flex element hinge (912) is illustrated as a continuous part of the insert spring band (901) and insert spring flex element (902) but provides a measurable separation between the two insert spring (504) components (insert spring band (901) and insert spring flex element (902)). Insert spring flex element hinge (912) is connected to the flat portion of the insert spring band (901) identified as insert spring band first interior surface (904). The difference in presentation of insert spring band first interior surface (904) from insert spring band second interior surface (905) facilitates the attachment of insert spring flex element hinge (912) thereto. Providing insert spring band first interior surface (904) as a flat surface as opposed to a curved surface like that of insert spring band second interior surface (905) facilitates the provision of insert spring flex element hinge (912). For example, if insert spring band first interior surface (904) were rounded, functionality of insert spring flex element hinge could, e.g., be negatively impacted. A rounding of the side of insert spring band first interior surface (904) could, in aspects, be presented as being rounded while maintaining a more flat or straight edge of insert spring band first interior surface (904) connecting to the insert spring flex element hinge (912). While more challenging to manufacture, such an embodiment is considered an element of the invention herein. Insert spring flex element hinge (912) can be made of the same material as the insert spring band (901) and insert spring flex element (902), and in such cases is structurally flexible enough to allow insert spring flex element (902) to flex closer to and further away from insert spring band (901). Insert spring flex element (902) in its natural, unencumbered state, is separated from and angled away insert spring band (901) by insert spring flex element hinge (912) as shown in FIGS. 9A and 9B. In operation, one or more components of a device, such as, e.g., an insert (e.g., (1800)), can press against insert spring flex element (902), forcing insert spring flex element (902) to move toward insert spring band (901) via the flexing of insert spring flex element hinge (912). Because this force acts against the natural positioning/configuration of insert spring flex element (902), insert spring flex element (902) can naturally exert a counter force against, e.g., the insert (e.g., (1800)), aiding in maintaining the positioning of the insert (e.g., (1800)) within the device. In this sense, to aid in the understanding of the insert spring (504), it can be thought of as operating similarly to a spring in a traditional/common battery compartment of an electronic device, where the spring provides tension and allows for the maintenance of a battery in position within a battery compartment.

Continuing with the description of FIG. 9B, are elements of insert spring flex element (902), comprising insert spring flex element interior (913), insert spring flex element first surface (914), insert spring flex element second surface (915), insert spring flex element width interior surface (916), and insert spring flex element width exterior surface (917). (913), (914), (915) (hidden but labeled), and (917) are also shown in FIG. 9A. Insert spring flex element (902) is exemplified as shaped as a disc with a hole in its center, e.g., shaped like a flat ring. Insert spring flex element interior (913) represents the interior of this ring. Insert spring flex element first surface (914) and second surface (915) form the first and second sides, respectively, of the ring portion of the insert spring flex element (902). Each is exemplified as a flat surface, separated from one another by an insert spring flex element width, the width visible as, and forming, the insert spring flex element width interior surface (916), and insert spring flex element width exterior surface (917). Insert spring flex element second surface (915) can contact one or more components of a device, such as, e.g., an insert (e.g., (1800)), when such an insert (XX) is inserted. As described above, a portion of an insert (e.g., (1800)) can make contact with insert spring flex element second surface (915) to aid in stabilizing insert (e.g., (1800)) within the exemplary device, with the thickness of the insert spring flex element (902), the thickness of the insert spring flex element hinge (912), or both the thickness of the insert sprig flex element (902) and the thickness of the insert spring flex element hinge (912) contributing to the flexibility of the insert spring flex element (902), and thus how much force it takes to flex insert spring flex element (902) (e.g., how much force it takes an insert (e.g., (1800)) to move insert spring flex element (902)), and further, how much counter force insert spring flex element exerts on, e.g., an insert (e.g., (1800)).

FIGS. 10A-10B

FIG. 10A and FIG. 10B illustrate an exemplary component of a device provided by the invention which is capable of receiving an element capable of holding (e.g., at least in one state, comprising) one or more compounds for inhalation by a user. In aspects, FIGS. 10A and 10B illustrate an exemplary component capable of receiving an element capable of holding at least one or more compounds for inhalation by a user from a position lateral to the component. As exemplified, the exemplary component is a body tube (402).

In the exemplary embodiment provided by FIGS. 10A and 10B, body tube (402) comprises a body tube first end (1002) and a body tube second end (1004). In aspects, body tube (402) can comprise one or more features which allow it to engage with one or more other components of a device. In aspects (e.g., as exemplified), an end. e.g., second end (1004) can comprise one or more distinct features which differentiate it from another end, e.g., first end (1002). In aspects, body tube (402) can comprise one or more features which allow it to engage with one or more other components of a device such that it maintains at least one or more other components of the device in a stationary position as one or more yet further components of the device move, e.g., rotate, in relation to the component. For example, as exemplified, body tube second end (1004) comprises a first portion which extends beyond that of a second portion, e.g., body tube second end extension (1006) extends beyond body tube second end recession (1008). In certain embodiments, e.g., in the exemplary embodiment, such feature(s) (e.g., body tube second end extension (1006) and body tube second end recession (1008)) provide body tube (402) with a mechanism for engaging body crown (506). In aspects, body tube (402) is capable of engaging body crown (506) and maintaining body crown (506) in place (e.g., maintaining body crown in a stationary position) while one or more other device components move, e.g., rotate, about it.

Body tube (402) of FIG. 10A is illustrated as having a body tube upper half (1010) and a body tube lower half (1012), the body tube (402) being formed by body tube wall (1013). Body tube lower half (1012) is shown alone in FIG. 10B (again, with body tube first end (1002) and body tube second end (1004) labeled. Body tube (402), as shown in both FIGS. 10A and 10B comprises a body tube exterior surface (1014) and a body tube interior surface (1016), separated by a body tube wall width (1018). Further, body tube (402) forms at least in part a body tube interior compartment (1022). As illustrated in the illustrative embodiment of FIGS. 10A and 10B, body tube upper half (1010) and body tube lower half (1012) differ from one another in that body tube upper half (1010) has a portion of its defining wall (1013) removed, forming an open portion of the body tube (1020) such that the body tube interior compartment (1022) is accessible/exposed by way of the removed area/exposure (1024). The portion of the body tube that is immediately adjacent to the removed area/exposure (1024) forms a rim (1026), which comprises a rim surface (1028), which, in aspects, has a width that corresponds to the body tube wall width (1018). In aspects, some, most, generally all, or all of the rim surface (1028) is non-flat/non-planar. In aspects, the shape of some, most, generally all, or all of the rim surface is rounded. In aspects, the roundedness of the rim surface (1028) is such that the rim surface does not scrape the inside of the tip assembly (202) when a fully assembled device (100) is formed or operated, thereby, detectably or significantly preventing or reducing wear and tear (e.g., is associated with detectably or significantly less metal shavings being generated in the process of full device assembly over a period of time, such as the life of the device or average life of an inhaler device). In aspects, the roundedness of the rim surface (1028) detectably or significantly reduces the amount of friction required to assemble or operate a full device. In aspects, the rounded edge has a radius ranging from 0.2 mm to material thickness minus 0.2 mm, that is, 0.2 mm less than the material thickness. In the provided embodiment, body tube interior compartment (1022) is capable of receiving one or more other components of a device of the invention, such as, e.g., a component capable of holding one or more compounds for inhalation, such as, e.g., an insert (e.g., (1800)). As illustrated, the design of body tube (402) provides for a component capable of comprising one or more compounds for inhalation (e.g., insert (1800)) to be inserted into the device from a position lateral to the device, e.g., into the open portion of the body tube (1020), instead of, e.g., through an end of the device.

As illustrated, body tube (402) can be in contact with one or more components of the exemplary device when the device is fully assembled. For example, body tube (402) can be in contact with one or more of, e.g., magnet cover (401), insert spring (504), body crown (506), barrel collar (1302), barrel tube (1304), or, e.g., a combination thereof. In aspects, when the exemplary device is fully assembled, at least a portion of magnet cover (401), e.g., second magnet cover extension component (816) is positioned within the interior of body tube (402).

In aspects, body tube (402) is capable of both receiving an insert (e.g., (1800)) and making such an insert (e.g., (1800)) accessible for removal. In aspects, body tube (402) is capable of, alone or in conjunction with one or more other components, such as, e.g., insert spring (504) and at least a portion of body crown (506) maintaining an insert (e.g., (1800)) stably in position while the device is in use. In aspects, in a fully assembled device, insert spring (504) and body crown (506) are positioned within body tube (402). In aspects, in a fully assembled device, body tube (402) is positioned within barrel tube (1304). In aspects, body tube (402) is not externally visible when the device is fully assembled, and only becomes visible when tip assembly (202) is separated from body assembly (201) (See FIGS. 2A and 2B). In aspects, to use the device, a user intentionally separates tip assembly (202) from body assembly (201), the two components held together by magnetic force provided by magnet (502), to expose body tube (402). Upon exposure of body tube (402), user can insert an insert (e.g., (1800)) laden with compound(s) for inhalation. Upon the secure placement of insert (e.g., (1800)) within body tube (402), the user can reunite the tip assembly (202) with the body assembly (201), placing the device in a state ready for use. In aspects a similar process can be repeated for the removal or replacement of an insert (e.g., (1800)).

FIGS. 11A-11B

FIGS. 11A and 11B illustrate an exemplary device with certain elements removed (1100) such that the internal space within body tube (402) is visible. On a first end of the interior of body tube (402), insert spring (504) is visible. On a second end of the interior of body tube (402), body crown (506) is visible. As provided, when an insert (1800) is inserted into body tube (402), maintained within body tube (402), or both, a first end of insert (1800) contacts insert spring (504). Upon inserting an insert (1800) into body tube (402), a first end of insert (1800) can, e.g., be pressed up against insert spring (504) such that the insert spring is made to flex. Upon flexion of the insert spring, the second end of insert (1800) can be lowered into body tube (402) such that the second end of insert (1800) contacts the end of body crown (506). Upon placement, insert spring (504) places pressure on the first end of insert (1800), applying a force which attempts to push insert (1800) in the opposite direction, toward body crown (506). However, the second end of insert (1800) contacts the end of body crown (506), preventing movement of insert (1800) in such direction. Because the end of insert (1800) stops at the edge of body crown (506), a gap is formed between the end of body crown (506) and the end of the opening to body tube (402). Such a gap is identified in FIGS. 11A and 11B as access gap (1102) (also referred to herein as, e.g., a finger recess). In FIG. 11B, dashed line (A) illustrates where the second end of an inserted insert (1800) would be positioned, as it rests up against the end of body crown (506). As shown, access gap (1102) is the distance between the end of insert (1800) and the opening within body tube (402). Because the opening in body tube (402) is such that a wall of body tube (402) is lower than or recessed from the height of an insert (1800), an access gap (1102) is created within which a user can insert their finger or other removal instrument into such an access gap (1102). Such an ability to insert, e.g., a finger, into access gap (1102) facilitates the removal of insert (1800) when such a need arises (e.g., to facilitate replacement of an insert (1800)).

FIG. 11A further illustrates insert compartment diameter (1023), body tube airflow channel (1024), insert compartment first end (1025), insert compartment second end (1027), and insert compartment central area (1030).

Upon inserting an insert (1800) into body tube (402), a first end of the space within which the insert is positioned is an insert compartment first end (1025) and a second end of the space within which the insert is positioned is an insert compartment second end (1027). The insert compartment first end (1025) and insert compartment second end (1027) create a middle space between them, an insert compartment central area (1030). The widest, e.g., broadest width of the insert compartment interior (1022); shown in FIG. 10B) is identified as the insert compartment diameter (1023). Upon insertion, insert (1800) fits within the insert compartment diameter (1023). Body tube airflow channel (1024) illustrates the airflow passing through the insert compartment interior (1022; shown in FIG. 10B). When an insert (1800) is present, in certain embodiments, air of an airflow passing through the device can pass, at least in part, through body tube airflow channel (1024) via an opening in an insert (1800) in the area where the insert sits.

FIGS. 12A-12C

FIGS. 12A, 12B, and 12C provide an exemplary embodiment of at least a portion of an airflow control unit (an airflow limiter). In aspects, devices provided by the invention comprise an airflow control unit comprising a first component and a second component that coordinate/interface to control airflow, e.g., control drag, during device use. As provided in the exemplary embodiment(s) of the device shown in the Figures, an airflow control unit can comprise a first component, e.g., a body crown (506), and a second component, e.g., a barrel crown (1306). In this exemplary embodiment, body crown (506) and barrel crown (1306) work together to control airflow when the two components are rotated and positioned in various positions relative to one another. The operation of the device relative to these two components is described in detail elsewhere herein.

FIGS. 12A, 12B, and 12C provide an exemplary embodiment of a body crown (506). Body crown (506) comprises two primary features: a body crown body (1202) and a body crown fan (1204). Starting with body crown body (1202), body crown body (1202) is illustrated in FIG. 12A as comprising a body crown body exterior surface (1206), a body crown body interior surface (1208), and a body crown body wall thickness (1210) separating body crown body exterior surface (1206) from body crown body interior surfaces (1208). As exemplified, the surface defined by body crown body wall thickness (1210) can comprise an edge, e.g., body crown body interior wall edge (1212), which in and of itself forms a surface. Like other edge features described above, this surface can form a non-right angle with an interior surface. That is, as exemplified, body crown body interior wall edge (1212) meets body crown body interior surface (1208) at an angle which is not 90 degrees. Similarly, as exemplified, body crown interior wall edge (1212) meets the surface formed by body crown body wall thickness (1210) at an angle which is not 90 degrees. In aspects, such an edge, as defined in this position of this particular component or an edge positioned in this particular component or another component (either shown or not specifically illustrated) can aid in the fit of one or more components with one or more other components of a device, can aid in facilitating suitable operation of the device, can aid in facilitating the assembly of the device, or any combination thereof.

In aspects, in a fully assembled exemplary device, body crown body (1202) is positioned within body tube (402). In aspects, in a fully assembled device, body crown body exterior surface (1206) contacts body tube interior surface (1016). As shown in FIG. 12A, the wall of body crown (506) (comprising body crown exterior surface (1206), body crown body interior surface (1208), body crown body wall thickness (1210), and body crown body interior wall edge (1212)) define a body crown body interior (1214). As shown in FIG. 12A, the wall of body crown (506) (comprising body crown exterior surface (1206), body crown body interior surface (1208), body crown body wall thickness (1210), and body crown body interior wall edge (1212)) can comprise a shape feature (1216), or, e.g., one or more, e.g., two such shape features (1216). For example, FIG. 12A exemplifies body crown body (506) comprising two such body crown body shape features (1216). In aspects, such a feature or features aid in the positioning, alignment, fit, or any combination thereof of the body crown (506) with one or more other components of an exemplary device, or, e.g., aid in facilitating suitable operation of the device, aid in facilitating the assembly of the device, or any combination thereof. In aspects, one or both of body crown shape features (1216) allow for the ease of positioning or placement body crown (506) into or with one or more other components of the device during assembly. For example, in aspects, body crown shape features (1216) facilitate the fitting of body crown (503) into body tube (402). In aspects, the rounded shape of one or more body crown shape features (1216) allows for the body crown (506) to be "slid" or easily guided into place within body tube (402), such that it can, in aspects, slide, fall, or follow contour(s) of body tube (402) into place with limited guidance required. In aspects, one or more of body crown shape features (1216) provide for limiting detectable or significant damage to an insert (1800). In aspects, one or more of body crown shape features (1216) provide for limiting detectable or significant damage to an insert (1800) when such an insert (1800) is made of a fragile material, e.g., a material capable of being caught on, or, e.g., scratched by, or, e.g., capable of experiencing flaking when, contacted by a suitably shaped or sharp surface. For example, an insert (1800) can be, e.g., made of a ceramic material which, if contacted by a suitably shaped or sharp surface, such as, e.g., one or more body crown shape features (1216) which is in the form of, e.g., a 90 degree angle, can be scratched such that at least a portion of the insert is worn or, e.g., powderized (scratched to an extent to which at least a portion of the ceramic insert is turned into a powder). In aspects, one or more body crown shape features (1216), such as rounded features as exemplified in FIG. 12A, prevents detectable or significant wear on an insert (1800). In one aspect, an insert may be a polyester insert, wherein the shape of one or more body crown shape features (1216) prevents detectable or significant catching, fraying, or both of the polyester insert. In aspects, any one or more component(s), features of component(s) (e.g., elements of component(s)), or combination thereof of the device provided by the invention can comprise a shape which prevents the detectable or significant wear of any one or more other component(s), features of component(s) (e.g., elements of component(s)) or combination thereof of the device (including, e.g., an insert for use in the device). In aspects, the result of such forethought with regard to component design, e.g., shape, size, fit, or combination thereof, is an element of the invention.

Exemplary body crown (506), as shown in FIG. 12A and in more detail in FIG. 12B, can comprise a body crown fan (1204). Body crown fan (1204) comprises a semi-circle (or, e.g., half disk) shape. The size and shape of body crown fan (1204) is sufficient to fill approximately half of the body tube. This size and shape feature of body crown fan (1204) is, in certain aspects, an important feature of body crown fan (1204) in that it aids in defining the interaction between body crown fan (1204) and barrel crown fan (1604) and, together, the mechanism by which the two components together operate as an air control component of an exemplary device. This is discussed further in the description of barrel crown fan (1604) elsewhere herein.

Body crown fan (1204) can comprise a body crown fan fit feature (1218), a body crown fan ridge set (1220), and a body crown fan protrusion (1226). The function of body crown fan protrusion (1226) is discussed in more detail in conjunction with the discussion of barrel crown fan protrusion (1614) of FIG. 16. As shown in FIG. 12B, body crown fan fit feature (1218) is a feature having a dimension wider than body crown body (1202). In the exemplified embodiment of the device, this allows for body crown body (1202) to be positioned within body tube (402), while the body crown fan (1204) remains outside of body tube (402). Such differences in dimension of body crown (506) can aid in the positioning, alignment, fit, or any combination thereof of body crown (506) with one or more other components of an exemplary device, or, e.g., aid in facilitating suitable operation of the device, aid in facilitating the assembly of the device, or any combination thereof. As shown, body crown fan fit feature (1218) can have a plurality of surfaces, e.g., one or more surfaces at a variety of angles relative to one another, having a variety of surfaces (e.g., planar surface, rounded surface, etc.), or both. Such a plurality of surfaces is shown as features (1218-A)-(1218-F) (e.g., 1218-A, 1218-B, 1218-C, 1218-D, 1218-E, and 1218-F) in FIG. 12B. Such differences in shape/surfaces of body crown fan fit feature (1218) (e.g., (1218-A)-(1218-F)) can aid in the positioning, alignment, fit, or any combination thereof of body crown (506) with one or more other components of an exemplary device, or, e.g., aid in facilitating suitable operation of the device, aid in facilitating the assembly of the device, or any combination thereof. In aspects, in a fully assembled device, body crown fan fit feature (1218) and its associated surface(s) contacts one or more fit features of barrel crown (1306) (e.g., one or more of barrel crown fan fit features A-C ((1606)-(1610)). In aspects, as exemplified, the outward face of body crown (1204) (e.g., the face of body crown (1204) presented in FIG. 12B) interfaces with, interacts with, or otherwise contacts the inward face of the barrel crown (1306) (e.g., the face of barrel crown (1306) presented in FIG. 16).

Further shown in FIG. 12B are particular exemplary features of body crown fan (1204), in particular exemplary features of body crown fan ridge set (1220). Body crown fan ridge set (1220) is exemplified as comprising a series of ridges formed by alternating body crown fan ridge recession(s) (1222) and body crown fan ridge peak(s) (1224). A plurality of alternating body crown fan ridge recession(s) (1222) and body crown fan ridge peak(s) (1224) can be present in a body crown fan ridge set (1220). About 15 recessions (1222) and 16 peaks (1224) are exemplified in FIG. 12B. As shown, each recession is between about 11 degrees and about 13 degrees apart, such as each recession being about 12 degrees apart. The number of body crown fan ridge recessions (1220) and peaks (1224) present in a body crown fan ridge set (1220) can, in aspects, contribute to the specificity with which airflow through the device can be controlled. For example, an increased number of such features (recessions (1220) and peaks (1224) of a body crown fan ridge set (1220)) can increase the level of fine tuning a user can accomplish to control airflow (e.g., drag) when using the device, while a decreased number of such features can decrease the level of fine tuning a user can accomplish to control airflow during device use.

Further shown in FIG. 12C are additional particularly exemplary features of the body crown body, in particular body crown body is exemplified as comprising a body crown body end wall (1211). Body crown body end wall (1211) provides the only contact point between the body crown (506) and insert (1800). In exemplary embodiments, the insert (1800) is inserted into the body tube (402) so that the insert is pressed between insert spring (504) and body crown body end wall (1211). This orientation allows for a space to remain between insert (1800) and body crown (506) that allows a user to fit his finger in the space to easily remove insert (1800), this space being embodied by the body crown body interior (1214).

In aspects, in a fully assembled device, a body crown fan ridge set (1220) can contact one or more other components of the device. In aspects, in a fully assembled device, a body crown fan ridge set (1220) can contact one or more features of a barrel crown (1306), e.g., a portion or all of a barrel crown fan ridge set (1612). In one exemplary embodiment provided by the Figures, body crown fan ridge set (1220) can contact a portion or all of a barrel crown fan ridge set (1612), the two components together operating as an airflow control mechanism for the device. The degree of contact, e.g., the amount of overlap of or interface between the two components establishes the drag provided by the device upon inhalation: the more overlap, e.g., the more interface (e.g., the higher the degree of contact, e.g., overlap) between the body crown fan ridge set (1220) and the barrel crown fan ridge set (1612), the less drag provided by the device, while the less interface (e.g., the lower the degree of contact, e.g., overlap) between the body crown fan ridge set (1220) and the barrel crown fan ridge set (1612), the higher the drag provided by the device. In such an exemplary operation, complete overlap, e.g., complete interface, of body crown fan ridge set (1220) and barrel crown fan ridge set (1612), establishes the device in a "maximally open" position, such that the device is in a configuration providing the lowest amount of drag and the highest level of possible airflow. Further, a lack of any overlap, e.g., a lack of significant interface, of body crown fan ridge set (1220) and barrel crown fan ridge set (1612), establishes the device in a "maximally closed" position, such that the device is in a configuration providing the highest amount of drag. Any overlap of the two components between these two extreme positions modulates the airflow (and, e.g., drag), accordingly. In certain aspects, a sufficient amount of air can still be drawn through the device upon inhalation by a user to render the device still operable when the device is in such a maximally closed position. That is, in certain aspects, even with the device is in a maximally closed position, establishing the device in the position providing the highest amount of drag, some users of the device may still receive an amount of one or more compounds upon inhalation which the user considers effective, pleasurable, or both. In certain aspects, a device in such a setting may consider the amount of air capable of being drawn through the device is insufficient to provide an amount of one or more compounds upon inhalation which is considered by the user to be effective, pleasurable, or both. This is also true of the device in a maximally open position; some users may consider the amount of one or more compounds received upon inhalation when the device is in a maximally open position to be undesirable, while other users may find such a setting suitable or, e.g., preferred. Thus, in aspects, a benefit of the airflow control mechanism of the device is to provide a mechanism for customizing the airflow through the device according to the preference of the device user. In aspects, such airflow customization provides for a user to modify the amount of one or more compounds received upon inhalation. In aspects, over the course of use of a single insert, as the amount of compound(s) available from the insert decreases, the airflow control mechanism provided by the body crown (506) and the barrel crown (1306) can be adjusted. In aspects, such adjustment can provide for an at least generally consistent amount of compound being delivered over at least a majority of the lifespan of the insert if the insert is disposable (one-time use) or e.g., over the course of a single charge with or fill of compound(s) of an insert if such an insert is reusable.

The degree of interface between body crown fan ridge set (1220) and barrel crown fan ridge set (1612) is established by the rotation of tip assembly relative to the body assembly. The specific interaction of these two components during such rotation is described below as part of the description of the tip assembly which follows.

As stated previously, an exemplary device provided by the invention can be comprised of two main parts which during one or more stages of operation of the device, can be separated from one another: the body assembly (201), components of which have been described above and are exemplified in detail in FIGS. 3-12, and the tip assembly (202) which is described here.

FIGS. 13A-13E

FIG. 13, encompassing FIGS. 13A-13E, illustrates the individual components of the tip assembly (202), shown in FIG. 2B. As stated above, a tip assembly is one embodiment of a mating component. FIG. 13A shows an exploded view of the tip assembly (202) wherein the relative positioning of each component of the tip assembly (202) is discernable. FIG. 13A shows the exploded set of components slightly turned to the left. FIGS. 13B-13E identify each of the components of the tip assembly (202) shown in the exploded view of FIG. 13A. Notably, as shown in the embodiment of the device illustrated in FIG. 13A, in an assembled device, certain features of barrel crown (1306) (an embodiment of an airflow limiter), specifically barrel crown fan protrusion (1614) (described in detail below), is aligned with a first indicator (101), exemplified here as a logo, on barrel (1308). This feature is relevant to the determination by a user of the spatial orientation of one or more components of the device, one or more operational status(es) of the device, or both, as is described elsewhere herein. In aspects, this alignment provides a mechanism for indicating to the device user that the device is in a maximally closed position (device is in a setting allowing for the lowest level of airflow through the device (highest drag setting)), and when in such position is accompanied by the user receiving an enhanced tactile indication (larger "snap" or "click"); however, if the tip assembly (202) were rotated relative to body assembly (201) by the user such that the first indicator (101) is then positioned 180 degrees from where the enhanced tactile indication (larger "click") was received, the device would then be in in a maximally open position (device would be in a setting allowing for the highest level of airflow through the device (lowest drag setting)). In such orientation, the first and second indicators ((101) and (102), respectively) are positioned on opposite sides of the delivery device. In aspects, the alignment of barrel crown fan protrusion (1614) with a first indicator (101) is established during manufacturing of the device.

FIG. 13B identifies a barrel collar (1302) (shaded) component of the tip assembly (202). Herein, a barrel collar is an embodiment of an engagement mechanism counterpart. FIG. 13C identifies a barrel tube (1304) (shaded) component of the tip assembly (202). Herein, a barrel tube is an embodiment of a mating component exterior or outer shell supplement. FIG. 13D identifies a barrel crown (1306) (shaded) component of the tip assembly (202). FIG. 13E identifies a barrel (1308) (shaded) component of the tip assembly (202). Herein, a barrel is an embodiment of a mating component exterior or outer shell. In aspects, FIG. 13 illustrates that devices provided by the invention, or, e.g., a component of a device of the invention, such as a tip assembly (202) component of a device, can comprise a barrel collar (1302), a barrel tube (1304), a barrel crown (1306), and a barrel (1308). As stated previously, in aspects, one or more, two or more, three or more, or all components of the tip assembly are attached to one another when the device is in a ready-to-use state. In aspects, components of the tip assembly are not dis-engageable from one another by a user or do not require disengagement in order for the user to use the device.

FIGS. 14-17 provide illustrations of each specifically exemplified tip assembly component.

FIG. 14

FIG. 14 illustrates an exemplary embodiment of a mechanism for tip assembly (202) to attach to body assembly (201). As previously described, in the exemplified embodiment of a device provided by the invention, body assembly (201) (e.g., specifically body subassembly (302) comprises a magnet (502). In the provided embodiment of FIG. 14, barrel collar (1302) provides an attractive target element for the magnet (502), providing a mechanism for body assembly (201) to releasably connect to, binding with, or otherwise be maintained in contact with tip assembly (202) through magnetic attraction. In the exemplified embodiment, barrel collar (1302) is attracted by the magnet (502).

As shown in FIG. 14, barrel collar (1302) can be a ring-shaped component. Barrel collar (1302) is exemplified as comprising a barrel collar exterior surface (1402), a barrel collar interior surface (1404), a barrel collar first edge surface (1406), a barrel collar second edge surface (1408), a barrel collar opposing first edge surface (1410) (e.g., along the opposing edge of barrel collar exterior surface (1402)), a barrel collar third edge surface (1412), and a barrel collar interior (1414). In aspects, the thickness of the ring formed by barrel collar (1302) is defined by the thickness of the wall formed by the depth of the wall formed by the barrel collar exterior surface (1402), barrel collar interior surface (1404), barrel collar first edge surface (1406), barrel collar second edge surface (1408), and the barrel collar third edge surface (1412).

Specific note to the reader: thickness of walls of component(s) described herein should, when described by reference to a specifically defined surface, be understood to be inclusive of consideration of any surface defined by an angled edge having its own defined surface. That is, for example:

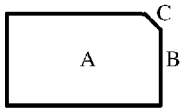

a wall (A) has a thickness which takes into consideration surface (B) as well as depth provided in part by surface (C). Where the thickness of a wall of component(s) herein is described as the thickness represented by the surface (B), it should be understood that such a thickness should take into consideration any edge component (C) which may optionally be present.

Barrel collar exterior surface (1402) is exemplified as a smooth surface encompassing the outer circumference of barrel collar (1302). Similarly, barrel collar interior surface (1404) is exemplified as a smooth surface encircling barrel collar interior (1414), e.g., establishing the inner circumference of barrel collar (1302). Finally, barrel collar (1302) comprises an interior, (1414). In an exemplary embodiment, barrel collar interior surface (1404) can, in an assembled device, contacts the exterior surface of barrel tube (1304) (specifically, (1502)). That is, in embodiments, e.g., as exemplified, in a fully assembled device, barrel collar (1302) is positioned around barrel tube (1304) (such that barrel tube (1304) resides within barrel collar interior (1414)), barrel tube (1304) is positioned over/around body tube (402), and body tube (402) is positioned around second magnet cover extension component (816). Further, in the embodiment exemplified, an edge of each of body tube (402), barrel collar (1302), and barrel tube (1304) each make contact in a fully assembled device with magnet cover exterior wall (808). In certain aspects, one or both of the barrel collar (1302) or barrel tube (1304) do not contact magnet cover (401) or any element of magnet cover (401). In aspects, such lack of contact is established to ensure that within all manufacturing tolerances there is an accompanying tactile indication of a change in the airflow control setting when rotating the body assembly (201) and tip assembly (202) relative to one another. In aspects where such a tactile feature is not embodied, in certain aspects one or both of the barrel collar (1302) or barrel tube (1304) could potentially contact magnet cover (401).

In aspects, barrel collar (1302) is made of a magnetic material. That is, in aspects, barrel collar (1302) is made of a material which is capable of being magnetized. Thus, in aspects, magnet (502) is magnetically attracted to barrel collar (1302). In certain aspects, barrel collar (1302) is the only component of the device which is capable of being detectably or significantly attracted by magnet (502). In aspects, it is the magnetic attraction between magnet (502) and barrel collar (1302) which facilitates the engagement of the body assembly (201) and the tip assembly (202).

FIG. 15

FIG. 15 illustrates an exemplary component suitable for protecting barrel (1308), which may, in aspects, be made of detectably or significantly moisture-sensitive material, from heat and moisture created during device use. In aspects, such a component prevents a significant amount of one or more volatile compounds present in or provided by an insert (1800), when present in the device, to get into the material of barrel (1308). That is, in aspects, barrel (1308) can be made of (e.g., composed of or comprise at least in part) a porous material such as, e.g., wood, and thus when exposed to one or more volatile compounds, such one or more volatile compounds can seep into or enter and be maintained by barrel (1308). When such volatile compounds are flavored or scented, such compounds can provide a scent or flavor which is not desired. As an example, if an insert (1800) is provided comprising a peppermint essential oil, one or more volatile compounds related to the peppermint scent/flavor may seep into or enter and be maintained by barrel (1308). If a user then changes insert (1800) to an insert comprising, e.g., a cinnamon scent/flavor, the user may experience lingering peppermint scent/flavor which interferes with the experience of the cinnamon. In aspects, the presence of such a protection component prevents the seeping, leaking, entering, and/or undesirable maintenance of such compounds into/within the material of barrel (1308). FIG. 15 illustrates such an exemplary component in the form of barrel tube (1304). Barrel tube (1304) is illustrated as a cylinder. As illustrated, exemplary barrel tube (1304) comprises a barrel tube exterior surface (1502), barrel tube interior surface (1504), and a barrel tube wall thickness (1506), which together surround at least in part a barrel tube interior (1508) and barrel component channel (1713). Barrel tube exterior surface (1502) is embodied as a smooth surface. Barrel tube interior surface (1504) is embodied as a smooth surface. Barrel tube thickness is embodied as separating barrel tube exterior surface (1502) and barrel tube interior surface (1504). Barrel tube (1304) is illustrated as an uninterrupted, hollow cylinder, unlike, for example, body tube (402) which comprises an open section (e.g., a section cut out of its cylindrical wall), exemplified as open portion of body tube (1020) in FIG. 10A. Barrel component channel (1713) is embodied as the channel which passes through the barrel tube (1304). In aspects, there is no barrel tube (1304), and the barrel component channel (1713) is embodied as the channel which passes through the barrel (1308), further illustrated in FIG. 17A. In aspects, within a fully assembled device, barrel tube (1304) can be at least partially surrounded by barrel collar (1302), with barrel tube (1304) and barrel collar (1302) positioned within barrel (1308). Further, in the embodiment exemplified, an edge of barrel tube (1304) can be in contact in a fully assembled device with magnet cover exterior wall (808). In certain aspects, barrel tube (1304) does not contact magnet cover (401) or any component thereof, such as, e.g., magnet cover exterior wall (808).

In certain aspects, barrel tube (1304) is made of a material which is not magnetic. That is, barrel tube (1304) is made of a nonmagnetic material and not capable of being magnetized. Thus, in aspects, magnet (502) is not magnetically attracted to barrel tube (1304).

As described in the discussion of FIGS. 12A and 12B (describing body crown (506)), in aspects, devices provided by the invention comprise an airflow control unit comprising a first component and a second component that coordinate/interface to control airflow, e.g., control drag, during device use. As described, an airflow control unit can comprise a first component, e.g., a body crown (506), exemplified in FIGS. 12A and 12B, and a second component, e.g., a barrel crown (1306). In one exemplary embodiment, one or more elements of body crown (506) and one or more elements of barrel crown (1306) work together to control airflow when the two components are rotated and positioned in various positions relative to one another.

FIG. 16

Exemplary barrel crown (1306), as shown in FIG. 16, can comprise a barrel crown cap (1602) and a barrel crown fan (1604). Barrel crown fan (1604) can comprise barrel crown fan fit features (1606), (1608), and (1610), a barrel crown fan ridge set (1612), and a barrel crown fan protrusion (1614), exemplified as a double protrusion.

Barrel crown cap (1602) of barrel crown (1306) can comprise a barrel crown cap outer lip (1616) comprising a barrel crown cap outer lip first surface (1620), a barrel crown cap outer lip second surface (not shown; opposite that of barrel crown cap outer lip first surface (1620)), wherein the first and second barrel crown cap outer lip surfaces separated by barrel crown cap outer lip thickness (1618), and further comprising a barrel crown cap exterior surface (1622), a barrel crown cap interior surface (1624), and a barrel crown interior (1626).

In aspects, the barrel crown cap (1602) can operate as a fit feature which allows suitable positioning of barrel crown (1306) within an exemplary device. For example, a portion of barrel crown cap (1602) can be positioned, in a fully assembled device, within barrel tube (1304) while a portion of barrel crown cap (1602), e.g., barrel crown cap outer lip (1616) can be positioned outside of barrel tube (1304). FIG. 16 illustrates barrel crown cap outer lip (1616), comprising barrel crown cap outer lip exterior edge (1618) and barrel crown cap outer lip first surface (1620) extending beyond, e.g., having a width which is wider than, the width of remaining components of barrel crown (1306). In aspects, in a fully assembled exemplary device, barrel crown cap exterior surface (1622) contacts barrel tube interior surface (1504). In aspects, barrel crown cap outer lip first surface (1620) contacts an end of barrel tube (1304).

As exemplified in FIG. 16, barrel crown (1306) further comprises a barrel crown fan (1604). Barrel crown fan (1604) comprises fit features embodied as barrel crown fan fit feature A (1606), barrel crown fan fit feature B (1608), and barrel crown fan fit feature C (1610). Barrel crown fan fit features A-C ((1606)-(1610)) are illustrated as a series of surfaces at non-90° angles relative to one another. Such surfaces of barrel crown (1306) can aid in the positioning, alignment, fit, or any combination thereof of barrel crown (1306) with one or more other components of an exemplary device, or, e.g., aid in facilitating suitable operation of the device, aid in facilitating the assembly of the device, or any combination thereof. For example, one or more of such barrel crown fit features A-C ((1606)-(1610)) can interface with one or more of body crown fan fit features (1218-A)-(1218-F) (e.g., (1218-A), (1218-B), (1218-C), (1218-D), (1218-E), or (1218-F)) shown in FIG. 12B. In aspects, in a fully assembled device, one or more barrel crown fan fit features (1606)-(1610) contact a portion of body crown (506).

Further shown in FIG. 16 are particular exemplary features of barrel crown fan (1604). Barrel crown fan (1604) comprises a semi-circle (or, e.g., half disk) shape. The size and shape of barrel crown fan (1604) is sufficient to fill approximately half of the barrel tube. This size and shape feature of barrel crown fan (1604) is, in certain aspects, an important feature of barrel crown fan (1604) in that it aids in defining the interaction between barrel crown fan (1604) and body crown fan (1204) and, together, the mechanism by which the two components together operate as an air control component of an exemplary device. This is discussed in detail below. FIG. 16 illustrates barrel crown fan ridge set (1612). Barrel crown fan ridge set (1612) is exemplified as comprising a series of ridges formed by alternating barrel crown fan ridge recession(s) (1628) and barrel crown fan ridge peak(s) (1630). A plurality of alternating barrel crown fan ridge recession(s) (1628) and barrel crown fan ridge peak(s) (1630) can be present in a barrel crown fan ridge set (1612). About 16 sets of such recessions (1628) and peaks (1630) are exemplified in FIG. 16. The number of barrel crown fan ridge recessions (1628) and peaks (1630) present in a barrel crown fan ridge set (1612) can, in aspects, contribute to the specificity with which airflow through the device can be controlled. For example, an increased number of such features (recessions (1628) and peaks (1630) of a barrel crown fan ridge set (1612)) can increase the level of fine tuning a user can accomplish to control airflow (e.g., drag) when using the device, while a decreased number of such features can decrease the level of fine tuning a user can accomplish to control airflow during device use.

In aspects, in a fully assembled device, a barrel crown fan ridge set (1612) can contact one or more other components of the device. In aspects, in a fully assembled device, a barrel crown fan ridge set (1612) can contact one or more features of a body crown (506), e.g., a portion or all of a body crown fan ridge set (1220). In one exemplary embodiment provided by the Figures, barrel crown fan ridge set (1612) can contact a portion or all of a body crown fan ridge set (1220), the two components together operating as an airflow control mechanism for the device. As previously stated, both the body crown fan (1204) and the barrel crown fan (1604) are shaped as semi-circles or half-disks, each residing within cylindrical components such that each is capable of taking up, or blocking, one-half of an available airflow pathway. The degree of contact, e.g., the amount of overlap of or interface between) the two components establish the amount of an airflow pathway is available for airflow. That is, the degree of contact, e.g., the amount of overlap of or interface between) the two components establish the drag provided by the device upon inhalation. As exemplified, the more overlaps, e.g., the more interface (e.g., the higher the degree of contact, e.g., overlap) between the barrel crown fan ridge set (1612) and the body crown fan ridge set (1220), the less drag provided by the device. That is, when the two semi-circular components completely overlap, one-half of the cylindrical airflow space is open and available for airflow. In such an exemplary operation, complete overlap, e.g., complete interface, of barrel crown fan ridge set (1612) and barrel crown fan ridge set (1220), establishes the device in a "maximally open" position, such that the device is in a configuration providing the lowest amount of drag and the highest level of possible airflow. Alternatively, the less interface (e.g., the lower the degree of contact, e.g., overlap) between the barrel crown fan ridge set (1612) and the body crown fan ridge set (1220), the higher the drag provided by the device. That is, when the two semi-circular components overlap to a lesser extent, a reduced area of the cylindrical airflow space is available for airflow. When the two semi-circular components do not overlap at all, each of the two semi-circular shaped components block a respective half of the cylindrical airflow path available for airflow, and thus airflow is blocked. Specifically, a lack of any overlap, e.g., a lack of significant interface, of barrel crown fan ridge set (1612) and body crown fan ridge set (1220), establishes the device in a "maximally closed" position, such that the device is in a configuration providing the highest amount of drag, e.g., rendering the device functionally inoperable by preventing sufficient airflow through the device to provide the user with an ability to inhale air through the device in an amount sufficient to deliver an effective or pleasurable amount of one or more compounds. Any overlap of the two components between these two extreme positions modulates the airflow (and, e.g., drag), accordingly.

The degree of interface between barrel crown fan ridge set (1612) and body crown fan ridge set (1220) is established by the rotation of the body assembly (201), comprising the body crown (506) which comprises the body crown fan (1204) and associated ridge set (1220), relative to the tip assembly (202), comprising the barrel crown (1306) which comprises the barrel crown fan (1604) and associated barrel crown fan ridge set (1612). Keeping in mind that tip assembly (202) and body assembly (201) are held together in the provided embodiment of the exemplary device by magnetic force, it can be appreciated that in a fully assembled exemplary device, body crown fan ridge set (1220) is drawn to barrel crown fan ridge set (1612) by virtue of the fact that the components of the device in which each reside are drawn together by magnetic force. When body crown fan ridge set (1220) is rotated in relation to barrel crown fan ridge set (1612), there are positions in which one or more body crown fan ridge recession(s) (1222) are positioned around or on one or more barrel crown fan ridge peak(s) (1630), providing a fit between the two components wherein the two components are as physically close to one another as they can be. However, there are positions during such rotation in which one or more body crown fan ridge recession(s) (1222) are positioned in line with one or more barrel crown fan ridge recession(s) (1228), one or more body crown fan ridge peak(s) (1224) are positioned in line with one or more barrel crown fan ridge peak(s) (1630), or both. In such position(s), there is a poor fit between the two components and the two components are not as physically close to one another as they could be. In such a position, the device is somewhat unstable, and the magnetic force drawing body assembly (201) and tip assembly (202) together acts upon the two separated components. The force acts to pull the two components together such that the crown fan ridge peak(s) of one fit within the crown fan ridge recession(s) of the other, and vice versa. Accordingly, when a user rotates tip assembly (202) in relation to body assembly (201), the two components slightly separate from one another as the components of the body crown fan ridge set (1220) and the components of the barrel crown fan ridge set (1612) mis-align, and then "snap" back together (e.g., are pulled back together by the magnetic force of the device) as the rotation continues and the components of the body crown fan ridge set (1220) and the components of the barrel crown fan ridge set (1612) align/re-align (e.g., ridge peaks of one align with ridge recessions of the other). Thus, rotation of tip assembly (202) relative to body assembly (101) can provide an audible clicking sound and, e.g., a tactile indication of the movement as the ridges and recessions of the two crown fan ridge sets ride over and about each other. Further, rotation of tip assembly (202) relative to body assembly (101) provides a "fidget" nature to the device, such that there is a playfulness of the rotation, e.g., as provided by both the clicking sound and the tactilely detectable tension and magnetic attraction caused by the repeated separation of the two components and the reunification of the two components during rotation.

The audible clicking caused by the interface of the body crown fan ridge set (1220) and the barrel crown fan ridge set (1612) provides an audible indication of the changing airflow condition(s) within the device. Further, returning to the illustrated embodiment of the barrel crown (1306) in FIG. 12, barrel crown (1306) comprises a barrel crown fan protrusion (1614). Barrel crown fan protrusion (1614) in aspects, e.g., as embodied, can be a part of barrel crown fan component (1604). As exemplified, barrel crown fan protrusion (1614) comprises a double protrusion (e.g., two distinct rounded protrusions). Notably, barrel crown fan protrusion (1614) is positioned on the opposite side of barrel crown (1306) from the barrel crown fan ridge set (1612). Further, barrel crown fan protrusion (1614) extends significantly further away from the barrel crown (1306) than any individual barrel crown fan ridge peak(s) (1630). Returning to the illustration of body crown (1204) in FIG. 12B, body crown fan protrusion (1226), embodied as a single protrusion, is positioned directly adjacent to body crown fan ridge set (1220). Further, body crown fan protrusion (1226) extends significantly further away from the body crown (506) than any individual body crown fan ridge peak(s) (1224). Upon the rotation of barrel crown fan (1604) relative to body crown fan (1204), it can be appreciated that once in every full 360° rotation, the barrel crown fan protrusion (1614) will contact body crown fan protrusion (1226). While small audible clicks, and small, tactilely sensible "snaps" are detectably during most of a 360° rotation of one component relative to the other, when the two protrusions (body crown fan protrusion (1226) and barrel crown fan protrusion (1614) meet at the single point in the rotation, there is a detectably larger forced separation of the two device components by virtue of the size of the respective protrusion elements. Thus, when the two components come back together (e.g., when body crown fan protrusion (1226) is positioned between the two bumps of the barrel crown fan protrusion (1614) and, further when body crown fan protrusion (1226) is positioned immediately after the second of the two bumps of the barrel crown fan protrusion (1614) in the direction of rotation), there is an audibly louder or bigger "snap", "click", or otherwise audible indication, in addition to an enhanced (e.g., bigger) tactile indication/sensation of such a snap/click. Further, when the body crown fan protrusion (1226) and the barrel crown fan protrusion (1614) meet or encounter one another during or upon the rotation of the tip assembly (202) and body assembly (101) relative to one another, the rotation becomes detectably or significantly more difficult. That is, when the body crown fan protrusion (1226) and the barrel crown fan protrusion (1614) encounter one another, more force is required to continue to rotate the tip assembly (202) and body assembly (101) relative to one another. This is due to the fact that the protrusions (body crown fan protrusion (1226) and the barrel crown fan protrusion (1614)) are larger than the peaks of the body crown (506) ((body crown fan ridge peaks (1224)) and barrel crown (1306) (barrel crown fan ridge peaks (1630)) which encounter one other during all other degrees of rotation. During all other degrees of rotation of the tip assembly (202) and body assembly (101) relative to one another, the body crown fan protrusion (1226) and the barrel crown fan protrusion (1614) do not contact one another. Upon encountering one another, their increased size, and the detectably or significantly increased amount of frictional force between them due to their increased size, an increased amount of force or energy is required to allow for the respective protrusions to interface or pass one another during the rotation of the tip assembly (202) and body assembly (101) relative to one another than if the protrusions were smaller (e.g., the size of body crown fan ridge peaks (1224) or barrel crown fan ridge peaks (1630)).

When the two crown fan protrusion components (1226) and (1614) align, e.g., body crown fan protrusion (1226) is position between the two bumps of barrel crown fan protrusion (1614), body crown fan ridge set (1220) and barrel crown fan ridge set (1612) do not overlap, and the device is in its maximally closed position as described above. This is one mechanism for determining the airflow control status of the device. In some respects, body crown fan protrusion (1226) is positioned between the two bumps of barrel crown fan protrusion (1614), body crown fan ridge set (1220) and barrel crown fan ridge set (1612) minimally overlap, and the device is in its maximally closed position as described above.

Returning briefly to Figures, e.g., 1E and 1F, the relevance of first indicator (101), exemplified as a product logo, and second indicator (102) (exemplified as a groove on magnet cover (401)) can now be further appreciated. As described above, the audible and tactile indicators present upon rotation of tip assembly (202) relative to body assembly (201) provide an indication of the airflow status of the exemplary device, wherein a detectably different (e.g., larger) audible indication, tactile indication, or both indicate that the device is in a maximally closed state. With regard to the indicators shown in FIGS. 1E and 1F, when first indicator (101), present on tip assembly (202), is aligned with second indicator (102), present on body assembly (201), this provides a visual indication that the device is in a maximally open position. Further, when second indicator (102) is facing in an upward direction, this is an indication that body tube (402) is in a position wherein the open portion of body tube (1020) is facing upward. Thus, in this position, if tip assembly (202) is removed, there is little risk of an insert (e.g., (1800)), if present in body tube (402) inadvertently falling out of body tube (402), as the open portion of body tube (1020) is facing upward and body tube (402) can continue to safely hold (e.g., by tight fit or, e.g., by cradling) an insert (e.g., (1800)). Finally, one further mechanism is available for determining the air control status of the device. In a fully assembled state, a user can view the device from the tip-assembly or barrel end of the device (opposite the mouthpiece) and see the state of overlap between the body crown fan ridge set (1220) and the barrel crown fan ridge set (1612).

FIGS. 17A-17B

FIGS. 17A and 17B illustrate an exemplary outer cover or shell of tip assembly (202), visible to the user upon use. As illustrated, this component is embodied in FIGS. 17A and 17B as a barrel (1308). Barrel (1308) is embodied as a cylindrical component capable of housing within it one or more other components of an exemplary device when fully assembled, such as one or more of a barrel collar (1302), barrel tube (1304), and barrel crown (1306). In certain aspects as described above, in a fully assembled exemplary device, barrel collar (1302) can be positioned around barrel tube (1304), with both barrel tube (1304) and barrel collar (1302) positioned within barrel (1308). In such embodiments, barrel tube (1304) can, in aspects, serve as a lining of the interior of barrel (1308). In aspects, barrel (1308) is the exterior device component which the user contacts to remove the tip assembly (202) from the body assembly (201) when the user wishes to access the interior of body assembly (201) so as to insert or remove a component comprising (or having comprised) compounds for inhalation, such as, e.g., an insert (e.g., (1800)).

As illustrated in FIG. 17A, barrel (1308) can comprise a barrel first end (1702), a barrel second end (1704), a barrel exterior surface (1706), a barrel interior surface (1708), a barrel wall thickness (1710), a barrel interior (1712), and a barrel component channel (1713). Barrel first end (1702) can, in a fully assembled device, contact magnet cover (401). Barrel second end (1704) as shown is on the opposite end of barrel (1308) from barrel first end (1702), and effectively marks the end of the device. As barrel (1308) is provided as an open-ended cylinder, a user may peer into barrel second end (1704) when a device is fully assembled and can, in some respects, see the status of the airflow control mechanism of the device, e.g., discerning the amount of airflow being allowed or restricted (e.g., determine the drag setting/status) of the device. Thus, in aspects, one or more portions of body crown fan ridge set (1220), one or more portions of barrel crown fan ridge set (1612), or both, can be visible via the opening in barrel second end (1704).

The shape of barrel first end (1702) can, in aspects, differ from the shape of barrel second end (1704). For example, as shown in FIG. 17A, barrel first end (1702) can be flat, such that the first end of barrel (1308) ends at a 90° angle. In aspects, this can facilitate a fit with one or more components of the device in fully assembled form, such as, e.g., the close fit of barrel (1308) with magnet cover (401). Barrel first end (1702) may, in a fully assembled device, contact magnet cover exterior wall (808). Further, as shown in FIG. 17A, barrel second end (1704) can be rounded (e.g., not ending at a 90° angle). Such rounding can, in aspects, aid in providing a pleasing aesthetic nature of the device, reduce or eliminate sharp edges on the exterior of the device, or both, making the device pleasing to look at, hold, or use.

FIG. 17A further illustrates barrel (1308) as comprising a barrel exterior surface (1706). Barrel exterior surface (1706) is provided as a smooth surface. Barrel exterior surface (1706) can comprise one or more visual indicators (not shown in FIG. 17A) visible to the user when using the device. For example, barrel exterior surface (1706) can comprise a first indicator (101) as visible in FIG. 1E (embodied as a product logo). As previously described, such an indicator can participate in establishing the spatial orientation of the device, one or more operational status(es) of the device, or both. Barrel (1308) further comprises a barrel interior surface (1708). Barrel interior surface (1708) can be a smooth surface which receives or, e.g., contacts one or more other components of an exemplary device when a device is fully assembled, such as, e.g., barrel tube (1304). In certain aspects, barrel tube exterior surface (1502) contacts barrel interior surface (1708) in a fully assembled device. In certain aspects, barrel collar exterior surface (1402) contacts barrel interior surface (1708) in a fully assembled device. In aspects, both barrel tube exterior surface (1502) and barrel collar exterior surface (1402) contact barrel interior surface (1708) in a fully assembled device. Barrel (1308) has a barrel wall thickness (1710). As barrel (1308) is provided as a cylinder, barrel (1308) comprises an interior (1712). Barrel interior (1712) can receive one or more other components of an exemplary device in fully assembled form as is described above. Barrel component channel (1713) is a channel passing through the barrel. In aspects, if a barrel tube (1304) is present, barrel component channel (1713) passes through the barrel tube (1304), e.g., passes through barrel (1308) via barrel tube (1304).

FIG. 17B illustrates the relationship of body assembly (201) with tip assembly (202), with the exterior of tip assembly being barrel (1308). Thus, as shown, barrel (1308) serves as the contact point for the user to remove tip assembly (202) from body assembly (201) when the user requires access to body tube (402) of body assembly (201) (see FIGS. 10A and 10B and related discussion herein). FIG. 17B illustrates that one or more components are visible via barrel second end (1704), such as one or more components of the airflow control mechanism being visible (1714). FIG. 17B further illustrates barrel component engagement end opening (1703) (not visible) and barrel component inlet end opening (1705). In aspects, barrel component engagement end opening (1703) is an opening wherein the body assembly (201) engages the tip assembly (202). In aspects, a barrel component inlet end opening (1705) is an opening wherein air first enters an exemplary device while in use (e.g., is the starting point of an airflow path through a device).

FIGS. 18A-18C

FIGS. 18A, 18B, and 18C provide an illustration of an exemplary component, embodied as insert (1800), provided by the invention capable of being used in a delivery device for the delivery of one or more volatile compounds for inhalation. FIGS. 18A and 18B illustrate exemplary insert (1800) from different angles to illustrate an air passage (1808) as being continuous through insert (1800) and maintaining the same shape through the insert. FIG. 18C provides an end-view of insert (1800). Insert (1800) is illustrated in each of FIGS. 18A, 18B, and 18C as having a cylindrical shape. Exemplary cylindrical insert (1800) is illustrated as comprising the air passage (1808). In the illustrated embodiment, insert (1800) is made of either (a) a sufficiently hard or dense material such that the positioning of the insert (1800) can be facilitated by use of the insert spring (504) and body crown (506) to "squeeze" the insert (1800) to hold it in place (as described elsewhere herein) or (b) a hard material, e.g., a ceramic material, such that insert (1800) is at least generally, at least substantially, at least essentially, is essentially, or is, inflexible, yet is capable of maintaining a suitable volume of volatile-compound-containing material to facilitate inhalation of such compounds by the user when insert (1800) is present within an exemplary device (and, clearly, when insert (1800) is charged with such a material, recognizing that over time such an insert will lose its volatile compound content to an extent at which insert (1800) will require recharging with such a material/compound(s) or replacement). Having an at least substantially, at least essentially, essentially, or completely inflexible nature, insert (1800) is embodied as being capable of being inserted into body tube (402) much like a common battery is placed into a standard battery compartment of an electronic device. Insert (1800), as shown in FIGS. 18A and 18B, comprises an insert first end (1802) and an insert second end (1804). Accordingly, one end, e.g., insert first end (1802) can be inserted at an angle into body tube (402) and pressed or pushed against insert spring (504), pushing against insert spring flex element (902), e.g., pushing against insert spring flex element second surface (915) and causing insert spring flex element hinge (912) to flex. Once the insert spring (504) is sufficiently flexed, the insert second end (1804) can be placed into body tube (402). Once within the body tube (402), insert (1800) is maintained in place by the insert spring flex element (902) pushing against insert first end (1802) forcing insert second end (1804) to push against body crown (506), or, e.g., specifically, one end of body crown (506), e.g., the end of body crown (506) closest to shape features (1216). Upon placement of the second end (1804) of the insert into the body tube, body crown (506) shape features (1216) can, e.g., prevent scratching, catching, or other interference with the structural integrity of the insert (1800)—e.g., such a body crown shape feature (1216), as shown in FIG. 12A, can be a rounding of the body crown to facilitate the placement of the insert (1800) into body tube (402) without causing significant damage to the insert (1800).

The resulting squeezing of insert (1800), e.g., between insert spring (504) and body crown (506), and, e.g., the force(s) being applied to each end of insert (1800) within body tube (402), maintain(s) insert (402) in place. Such placement is exemplified in FIG. 19 and is discussed below.

Insert (1800) further comprises an exterior surface (1806) as shown in FIGS. 18A and 18B. Insert exterior surface (1806) is exemplified as being a visually smooth surface. It should be appreciated that because insert (1800) is present for the maintenance of one or more volatile compounds until such compounds are release, e.g., by inhalation during device use, the actual material forming insert exterior surface (1806) may be detectably or significantly porous.

FIGS. 19-21

The exemplified embodiment of insert (1800) shown in FIGS. 18A-18C further comprises an insert air passage (1808). Insert air passage (1808) is embodied as comprising one or more insert air passage shape feature(s) (1810). As illustrated, insert air passage (1808) has a "flower" shape. The flower-shaped air passage (1808) increased the surface area of air passage (1808) over that which would be present if a similarly sized air passage were present as a single, circle-shaped passage. Such an alternative embodiment of a single, e.g., circular shaped air-passage (1830) is provided in FIG. 19, illustrating an alternative embodiment of an insert (1820) as viewed from one end. FIG. 20 provides another alternative embodiment of an insert (1840) comprising a smaller single air passage (1850) as viewed from one end of an insert. FIG. 21 provides a still further alternative embodiment of an insert (1860) viewed from one end, the insert (1860) comprising a plurality of air passages (1870) (e.g., exemplified as comprising 6 individual airflow passages). The reader can appreciate that many further alternative embodiments of a mechanism for air passage through an insert exist, either providing a single airflow passage of various sizes and shapes, each with or without one or more shape features, or providing multiple airflow passages, each being similar, the same, or different in size, shape, or both, and each comprising or not comprising one or more shape features, etc. The design of airflow passage through an insert can be selected, at least in part, according to the amount of restriction or lack thereof of airflow through the insert is desired/desirable, the amount of drag desired to be provided by the device, the volume of volatile compound(s) suitable or desirable for delivery to the user by inhalation, or any combination of any or all thereof.

FIGS. 22A-22B

FIG. 22, encompassing FIGS. 22A and 22B, illustrates the device with a partially inserted exemplary insert (FIG. 22A), and completely inserted exemplary insert (FIG. 22B). In FIG. 22A, body assembly (201) is shown with tip assembly (202) removed. Exemplary insert (1800) is shown as being inserted into body tube (402). The insert spring flex element (902) is visible. FIG. 22A illustrates that a volatile compound composition (1880A) comprising volatile compounds may be provided within a solid material device such as, e.g., an insert (1800). FIG. 22A further illustrates that a volatile compound composition (1880B) may be provided within a fluid (e.g., within a gas or a liquid), wherein the presence of a solid material device such as an insert (1800) is not required. In FIG. 22B, body assembly (201) is again shown with tip assembly (202) removed. Exemplary insert (1800) is shown as being completed inserted into body assembly (201). Tip assembly (202) is ready to be united with body assembly (201) to place the exemplary device in a ready to use state.

FIGS. 23-24

FIGS. 23 and 24 are described in the Examples provided below.

FIGS. 25A-25C

FIGS. 25A, 25B, and 25C provide a visual description of the magnetic orientation of the magnet (502) in one embodiment of a fully assembled device (100). In exemplary embodiments, a connection mechanism, exemplified as magnet (502), is oriented uniformly among a plurality of devices (100) (2 shown). FIG. 25A illustrates that when two exemplary devices (100) are positioned next to each other and oriented in opposite directions, magnets (502) of devices (100) attract with the respective magnet(s) of each device positioned in full alignment with one another indicating that the poles of magnets (502) of each device are oriented within each device in the same direction. This demonstrates that when the magnets (502), provided within the devices (100), are placed next to each other in opposite orientations, they attract. Conversely, as exemplified in FIG.

25B, when two exemplary devices (100) are positioned next to one another and oriented in the same and in completely alignment with one another, magnets (502) repel, as magnet(s) (502) within each device (100) share the same polar orientation and thus are not attracted to one another. To further exemplify the uniformity of magnet orientation across devices, FIG. 25C illustrates that when two exemplary devices (100) are positioned next to one another and oriented in the same direction but offset from one another such that the devices are not in complete alignment, the devices attract, with the magnet(s) of each device slightly offset from one other such that a pole of one magnet aligns with the opposing pole of the other magnet. In exemplary embodiments, the orientation of magnet (502) within, e.g., exemplary devices (100) is uniform among some, most, generally all, or all exemplary devices (100) and such uniformity provides consistent compatibility with various magnetic accessories or attachments suitable for use with exemplary device(s) (100), such as, e.g., device support unit(s), e.g., device stand(s), or, e.g., storage unit(s) provided herein.

FIGS. 26A-26D

FIGS. 26A-26D provide exemplary embodiments of a device support unit, exemplified as an exemplary device stand (1900). FIG. 26A provides a first, e.g., side or lateral, perspective view of an exemplary device stand (1900). FIG. 26B provides a second, e.g., front, perspective view of an exemplary device stand (1900). FIG. 26C provides a third, e.g., top, perspective view of an exemplary device stand (1900). FIG. 26D provides a fourth, e.g., bottom, perspective view of an exemplary device stand (1900). In aspects, a device support unit, e.g., an exemplary device stand (1900), provides a means for supporting an exemplary device (100) that is not in use. In aspects, an exemplary device (100) may be rested on a device receiving component of a device support unit, e.g., a top/upper surface of a device stand when not being used by an individual. In aspects, when an exemplary device (100) is rested on top of an exemplary device stand (1900), it will be held or maintained in place until the user intentionally removes the device from the device stand. In aspects, one or more components within a device support unit, e.g., within a device stand (1900) cooperates with one or more components of a device which it stores (100) to maintain the device (100) at least generally in place, at least substantially in place, at least essentially in place, essentially in place, or stably in place during storage until intentionally removed. In aspects, one or more component(s) within a device support unit, e.g., within a device stand (1900), such as, e.g., a magnet, cooperates with one or more component(s) of a device which it maintains (e.g., stores) (100), e.g., a magnet, to orient any device (100) which the device support unit stores in the same direction. That is, in certain embodiments, upon placement of a device (100) on a device support unit, e.g., device stand (1900), the device will, if needed, orient itself to a predictable spatial orientation upon the device support unit due to the coordination between component(s) of a connection mechanism within the device (100) and the device support unit, e.g., device stand (1900), such as, for example, a magnetic connection mechanism comprising a magnet in each of device (100) and the device support unit, e.g., device stand (1900). In aspects, a device stand (1900) is constructed from one or more materials, such as, plastic, stainless steel, wood, zinc, titanium, etc. In an exemplary embodiment, a device stand (1900) is constructed from zinc or comprises one or more part(s), component(s), or feature(s) comprising zinc. In the same or other exemplary embodiment, the device stand (1900) further comprises (or, e.g., one or more part(s), component(s), or feature(s) comprise) a powder coating of titanium.

FIGS. 27A-27B

FIGS. 27A and 27B provide exploded views of an exemplary embodiment of a device support unit, exemplified as an exemplary device stand (1900), viewed from a first perspective and second perspective, respectively. FIG. 27A and FIG. 27B illustrate exploded views of an exemplary device stand (1900) from different angles to illustrate various exemplary parts of an exemplary device stand (1900) and feature(s) thereof. As provided in FIGS. 27A and 27B, an exemplary device stand (1900) comprises a device stand device reception component (1910), device support unit-device connection component (exemplified as a magnet) (1950), device stand connector component (2070), device stand base (1970), and device stand protection component (device stand pad) (2050). In embodiments, a device stand device reception component (1910) is designed to receive, maintain, or otherwise hold a device (100) when a device is placed on a device support unit, e.g., device stand (1900). As exemplified in this embodiment, a device support unit-device connection component (1950), e.g., a magnet, is present to aid in the maintenance of a device (100) on or by a device support unit, e.g., device stand (1900), such as aiding in the maintenance of a device (100) on or by a device reception component (1910) of a device support unit/device stand (1900). In embodiments, a device stand connector component (2070) serves to connect two or more components of a device support unit, such as, e.g., a device stand device reception component (1910) to a body of a device support unit, e.g., a device stand base (1970). In certain aspects, a device stand base (1970) can comprise a device stand protection component (device stand pad, (2050)) to protect a surface upon which a device support unit, e.g., device stand (1900) is placed (e.g., from scratching such a surface, slipping or unintentionally moving or sliding, etc.).

In aspects, a device stand base (1970) is configured to receive at least one, such as, e.g., two or more component(s), such as, e.g., a device support unit-device reception component (1910), a device support unit-device connection component (1950), a device stand connector component (2070) a device stand protection component (e.g., device stand pad) (2050), or combination(s) of any or all thereof. Further, as exemplified in FIGS. 27A and 27B, in embodiments a device support unit-device connection component (1950) housed in a device stand base (1970) is at least partially secured by way of attaching a device stand reception component (1910) to a device stand base (1970). A device stand reception component (1910) can be secured to a device stand base (1970) by means of a device stand connector component (2070). In aspects, a device stand connector component (2070) can be a threaded screw (as exemplified in FIGS. 27A and 27B), received through an access feature, e.g., an opening or hole (2042) within the device stand base (1970), such as, e.g., at the bottom of the device stand base (1970) as exemplified. In aspects, a device stand protection component (2050) is a component of a device stand base (1970) and covers access feature (opening or hole) (2042) when the device support unit, e.g., device stand base (1900) is fully assembled. In aspects, once a device stand reception component (1910) is secured to a device stand base (1970) by means of a device stand connector component (2070), a device stand protection component (2050) may be attached to a device stand base (1970) such that it covers an access feature (opening or hole) (2042) present to facilitate use of or otherwise for receiving the device stand connector component (2070). In aspects, the device stand protection component (2050) is attached to the device stand base (1970) by means of snapping or gluing into place. In aspects, during use of a fully assembled device support unit, e.g., exemplary device stand (1900), an exemplary device (100) can be placed at least generally, at least mostly, at least substantially, at least essentially, essentially, or completely horizontally on a device stand device reception component (1910). In aspects, a device support unit-device connection component (1950) is a magnetic connection component (magnet) and is oriented such that the polarity of the magnet will be in attraction with a coordination connection component of a device (100), e.g., magnet (502). In aspects, a device (100) can be placed on a device stand device reception component (1910) and remain attached to the device stand (1900) by way of magnetic attraction between the magnet (502) and device support unit-device connection component (1950). In aspects, due to one or more features of a device support unit-device reception component (1910), such as its shape, contour, orientation angle, etc., and, further, e.g., due to the orientation of a connection component (e.g., magnet) (1950) within the device support unit (1900) in relation to the orientation of a coordination connection component (e.g., magnet) (502) of a device (100), placement of a device (100) upon a device support unit (1900), e.g., upon a device support unit-device reception component (1910) results in the device (100) orienting itself into a predictable special orientation. This is described further elsewhere herein.

FIGS. 28A-28B

FIGS. 28A and 28B provide exploded views of an exemplary embodiment of a delivery device support unit viewed from a first and second perspective, respectively, exemplified as an exemplary device stand (1900), with components close to the position they can occupy when the device stand is fully assembled. FIG. 28A illustrates a first perspective view of a device stand (1900) wherein the device stand connector component (2070) has been inserted into the device stand base (1970). FIG. 28A further illustrates device stand device reception component (1910) at or near the area of the device stand base (1970) where it may be received and device stand connector component (2070) at or near the area of the device stand base (1970) where it may be inserted. FIG. 28B illustrates a second perspective view of a device stand (1900) wherein device stand protection component (2050) has been attached to the bottom portion of device stand base (1970), thereby covering the access feature (opening or hole) (2042).

FIGS. 29A-29B

FIGS. 29A and 29B provide exemplary embodiments of a device stand device reception component (1910) viewed from a first and second perspective, respectively. FIG. 29A illustrates an angle view of a first side of an exemplary device stand device reception component (1910) comprising a device stand device reception component depth (1916), a device stand device reception component lid (1918), and a device stand device reception component outer surface (1928). Device stand device reception component lid (1918) further comprises a device stand device reception component external surface (1912), a device stand device reception component lid first surface (1920), a device stand device reception component lid second surface (1922) (e.g., "edge"), and a device stand device reception component lid third surface (1924) (e.g., "under edge") (shown in FIG. 29B). FIG. 29B illustrates an angle view of a second side of a device stand device reception component (1910) which provides an alternate perspective view of a device stand device reception component lid first surface (1920), a device stand device reception component lid second surface (1922), and a device stand device reception component outer surface (1928). An exemplary device stand device reception component (1910) further comprises a device stand device reception component internal surface (1914), a device stand device reception component insert component (1926), and a device stand device reception component connection component (1934). Device stand device reception component insert component (1926) further comprises device stand device reception component outer surface (1928), device stand device reception component thickness (1930), and device stand device reception component inner surface (1932). Device stand device reception component connection component (1934) further comprises device stand device reception component connection component outer surface (1936), device stand device reception component connection component inner surface (1938), and device stand device reception component wall thickness.

In aspects, the device stand device reception component (1910) is configured to be received by a device stand base (1970). In aspects, the device stand device reception component inner component (1926) is configured so that its diameter is small enough to allow the device stand device reception component (1910) to fit within the device stand base (1970) but not so small as to allow for visible gaps of space between the device stand base (1970) and the device stand device reception component outer surface (1928). In aspects, the device stand device reception component (1910) is secured to the device stand base (1970) by way of inserting the device stand connector component into the device stand device reception component connection component (1934). In aspects, the device stand device reception component (1910) is made from one or more materials, e.g., wood, plastic, stainless steel, veneer, etc. In aspects, to prevent from scratching either a delivery device (100) or device stand device reception component external surface (1912), or both, device stand device reception component external surface (1912) is made from a non-metal material, e.g., hard plastic. In aspects, in a fully assembled device stand (1900), device stand device reception component external surface (1912) is thin enough so that the magnetic field of the device support unit-device connection component (1950) is able to mate the device stand (1900) with the magnet (502) of a fully assembled delivery device (100). Further, in aspects, device stand device reception component external surface (1912) is thick enough so the strength of attraction between device support unit-device connection component (1950) and magnet (502) is not so strong as to prevent the user from disengaging the delivery device (100) from the device stand (1900) without the stand being lifted from the surface it is rested on, e.g., desk or table. For example, the user should be able to disengage the delivery device (100) from the device stand (1900) with a single hand, without excessive force and without having to remove the device stand from the surface it is rested on.

FIG. 30

FIG. 30 provides an exploded view of an exemplary embodiment of a device support unit, exemplified as an exemplary device stand (1900), identifying an exemplary location of an exemplary device support unit-device connection component (1950), shown as a magnet. In aspects, a device support unit-device connection component (1950) is a magnet and is placed within the device stand base (1970) at or near the location shown in FIG. 30. In aspects, the magnet is placed within the device stand base (1970) prior to the device stand device reception component (1910) being placed on top of the device stand base. In aspects, the magnet is placed within the device stand base (1970) in an orientation such that the top facing side of the magnet (the visible portion of the magnet in FIG. 30) is in polar attraction with the magnet (502) of an exemplary device (100). In aspects, the orientation of the magnet within a device stand base (1970) is uniform among exemplary device stands (1900) to provide consistent compatibility among various exemplary devices (100).

FIGS. 31A-31C

FIGS. 31A-31C provide exemplary embodiments of a device support unit-device connection component (1950), exemplified as a magnet. FIG. 31A provides a first perspective view of a device support unit-device connection component (1950). FIG. 31B provides a second, e.g., side, perspective view of a device support unit-device connection component (1950). FIG. 31C provides a third, e.g., top, perspective view of a device support unit-device connection component. Device support unit-device connection component (1950), as exemplified, comprises device support unit-device connection component portion A (1952) and device support unit-device connection component portion B (1960). Device support unit-device connection component portion A (1952) further comprises device support unit-device connection component portion An upper surface (1954), device support unit-device connection component portion A first surface (a first "edge" surface) (1956), and device support unit-device connection component portion A edge surface (1958). Device support unit-device connection component portion B (1960) further comprises device support unit-device connection component portion B edge surface (1962) and device support unit-device connection component portion B first surface (a first "edge" surface) (1964). Not shown is device support unit-device connection component portion A lower surface; adjacent to device stand magnet portion B upper surface, also not shown. Device support unit-device connection component B lower surface not shown as well.

In aspects, device support unit-device connection component (1950) is a magnet. Further, in aspects, the magnet comprises a device support unit-device connection component portion A (1952) and a device support unit-device connection component portion B (1960), wherein portion A (1952) and portion B (1960) are opposite in magnetic polarity and will therefore be in attraction with each other. Further in aspects, portion A (1952) and magnet (502) are opposite in magnetic polarity and will therefore be in attraction with each other. Even further in aspects, portion B (1960) and magnet (502) are of the same magnetic polarity and will therefore repel each other. In aspects, the device support unit-device connection component (1950), exemplified as a magnet, centralizes the location of attraction between an exemplary device (100) and an exemplary device stand (1900). The magnet (502) of an exemplary device will only mate with the device stand (1900) at the location of the device stand device reception component where the device support unit-device connection component (1950) lays beneath.

FIGS. 32A-32C

FIGS. 32A-32C provide exemplary embodiments of a device stand base (1970). FIG. 32A provides a first, e.g., side, view of a device stand base (1970). FIG. 32B provides a second, e.g., upper perspective, view of a device stand base (1970). FIG. 32C provides a third, e.g., lower perspective, view of a device stand base (1970). FIGS. 32A-32C illustrate a device stand base first surface (e.g., first "edge" surface, e.g., at top) (1972), a device stand base outer surface (1972), a device stand base second surface (e.g., a second "edge" surface, e.g., at bottom) (1974), and a device stand base indicia (1978). FIGS. 32A and 32C further illustrate a device stand base second surface (1976). FIG. 32B further illustrates device stand base functional component (1980) and device stand base reception component (2024). Device stand base functional component (1980) may further comprise a device stand base-device connector receptor component (device support unit-device connection component (magnet) holder) (1982), a device stand base connection component (2002), a device stand base opening (2012), a device stand base functional component height (2014), and a device stand base functional component outer surface (2022). Device stand base-device connector receptor component (device support unit-device connection component (magnet) holder) (1982) may further comprise a device stand base-device connector receptor component (device support unit-device connection component (magnet) holder) portion A (1984) and a device stand base-device connector receptor component (device support unit-device connection component (magnet) holder) portion B (1992). Device stand base-device connector receptor component portion A (1984) may further comprise a device stand base-device connector receptor component (device support unit-device connection component (magnet) holder) portion A first surface (1986), a device stand base-device connector receptor component (device support unit-device connection component (magnet) holder) portion A second surface (1988), and a device stand base-device connector receptor component (device support unit-device connection component (magnet) holder) portion A third surface (1990). Device stand base-device connector receptor component portion B (1992) may further comprise a device stand base-device connector receptor component (device support unit-device connection component (magnet) holder) portion B first surface (1994), a device stand base-device connector receptor component (device support unit-device connection component (magnet) holder) portion B second surface (1996), a device stand base-device connector receptor component (device support unit-device connection component (magnet) holder) portion B third surface (1998), and a device stand base-device connector receptor component (device support unit-device connection component (magnet) holder) bottom (or "floor") surface (2000). Device stand base connection component (2002) may further comprise a device stand base connection component first surface (2004), a device stand base connection component second surface (2006), a device stand base connection component third surface (2008), and a device stand base connection component fourth surface (2010). Device stand base functional component height (2014) may further comprise a device stand base recessed component first surface (2016), a device stand base recessed component second surface (2018), and a device stand base recessed component third surface (2020). Device stand base reception component (2024) may further comprise a device stand base reception component first (lower) surface (2026), a device stand base reception component second surface (2028), a device stand base reception component third surface (2030), and a device stand base reception component fourth surface (2032). FIG. 32C further illustrates a device stand base connector access component (2040), exemplified here as a hole. Device stand base connector access component (2040) may further comprise device stand base connector access component wall(s) (2042).

In aspects, the device stand base functional component (1980) can be recessed. In aspects, a device stand base opening (2012) is limited in size to allow for the passage of a portion of a device stand connector component (2070). Further, in aspects, a device stand connector component (2070) is a threaded screw. Even further, in aspects, the device stand base opening (2012) is limited in size to allow for the passage of the threaded portion of the screw but not the screw head. In aspects, a device stand base reception component (2024) is configured to receive at least a portion of one other component. Further, in aspects, the one other component is a portion of a device stand device reception component (1910). In aspects, a device stand base reception component first surface (2026), second surface (2028), third surface (2030), and fourth surface (2032) can be grouped together as a threaded surface. Further, in aspects, the threaded surface is configured to receive a device stand device reception component (1910). In aspects, device stand base connector access component (2040) can be a hole in the bottom of the device stand base (1970). Further, in aspects, the interior of the device stand base (1970) can be hollow, or a tube can be present, wherein the tube connects the device stand base connector access component (2040) and the device stand base connection component (2002).

FIG. 33

FIG. 33 illustrates an exemplary embodiment of a device stand protection component (2050), exemplified as a device stand pad. A device stand protection component (2050) further comprises a device stand protection first surface (2052) (e.g., inner side), a device stand protection component second surface (2054) (e.g., outer side), and a device stand protection component edge surface (2056). In aspects, a device stand protection component edge surface represents the thickness of a device stand protection component (2050). In aspects, the device stand protection component (2050) attaches to the device stand base (1970) by snapping into place at the bottom surface of the device stand base. In aspects, an adhesive material, e.g., glue, may be used to mate the device stand protection component (20505) to the device stand base (1970). In aspects, the device stand protection component (2050) conceals the device stand base connector access component (2040) to prevent foreign objects and debris from entering the device stand base (1970) through the access component.

FIG. 34

FIG. 34 provides an exploded view of an exemplary embodiment of a device support unit, exemplified as a device stand (1900), identifying the placement of an exemplary device support unit (e.g., a device stand) connector component (2070), shown as a screw. In aspects, a device support unit connector component is a threaded screw. Further, in aspects, the threaded screw is housed in the device stand (1900) by way of inserting the screw through the device stand base connector access component. Further, in aspects, the diameter of the device stand base connection component (2002) large is enough to allow the threaded portion of the screw to pass through but not so large as to allow the screw head to pass through. In aspects, when the screw is housed within the device stand (1900), at least a portion of the threaded portion of the screw extends past the device stand base connection component (2002) to allow the screw to mate with the device stand device reception component (1910). Further, in aspects, the threaded portion of the screw mates with the device stand device reception component (1910) by way of threading or pressing the screw into the device stand device reception component connection component (1934).

FIGS. 35A-35D

FIGS. 35A-35D provide exemplary embodiments of a device stand connector component (2070), exemplified as a threaded screw. FIG. 35A provides an exemplary embodiment of a device stand connector component (2070), according to a first view. FIG. 35B provides an exemplary embodiment of a device stand connector component (2070), according to a second view. FIG. 35C provides an exemplary embodiment of a device stand connector component (2070), according to a third view. FIG. 35D provides an exemplary embodiment of a device stand connector component (2070), according to a fourth view. A device stand connector component (2070) may comprise a device stand connector component first portion (2072), a device stand connector component recession (2074), a device stand connector component recession wall (2076), a device stand component first portion first surface (2078), a device stand component first portion second surface (2080), a device stand component first portion third surface (2082), a device stand component first portion lateral surface (2084), a device stand component first portion bottom surface (2086), a device stand component second portion (2090), and a device stand component second portion end (2092).

FIGS. 36-38

FIGS. 36-38 are described in the Examples provided below.

FIGS. 39-41

FIGS. 39-41 exemplify the various ways in which materials can be used within, and, also or alternatively, across delivery devices provided herein.

FIGS. 39-41 simplify an exemplary device and present such a device as having 2 exemplary parts, components, or assembly(ies), referred to here for ease of reference simply as a "left component," which in embodiments can be a volatile compound outlet component, and a "right component," which in embodiments can be a mating component. "Left component" and "right component" refer to the position on the drawing sheet of each exemplary device component image (figure) as viewed by the reader.

In one embodiment, the same material can be used for all components of a device. FIG. 39 provides an example of uniform material use in an exemplary device of the invention. Single material "A" is shown as being used for both the left and right components of the exemplary delivery device.

In an alternative embodiment, the same material can be used for one component of a device while a different material can be used in a different component of a device. FIG. 40 provides an example of non-uniform material use. In the first two exemplified devices of FIG. 40, a first material, material "A," is used for both of the right components, while different materials, material "B" and material "C" are used for each of the two left components. Similarly, in the third and fourth exemplified devices of FIG. 40, a first material, material "A," is used for both of the left components, while different materials, material "B" and material "C" are used for each of the two the right components, respectively.

In still further embodiments, materials can vary across components and across devices. FIG. 41 provides an example of three exemplary devices wherein each component of all devices is made of a different material (material "A," material "B," material "C," material "D," material "E," and material "F." As shown, material "A" is used for the left component of the first exemplary device, while material "B" is used for the right component; material "C" is used for the left component of the second exemplary device while material "D" is used for the right component; and material "B" is used for the left component of the third exemplary device while material "F" is used for the right component.

EXAMPLES

The following detailed Examples of certain aspects of the invention are provided to assist readers in further understanding aspects of the invention or principles related to practicing aspects of the invention. Any particular materials, methods, steps, and conditions employed/described in the following Examples, and any results thereof, are intended to further illustrate aspects of the invention. These Examples reflect exemplary embodiments of the invention, and the specific methods, findings, principles of such Examples, and the general implications thereof, can be combined with any other aspect of the invention. However, readers should understand that the invention is not limited by or to any part of the Examples.

Example 1 (Airflow Control Test)

An airflow control test was performed to assess the average airflow through the device in liters per minute at a variety of device airflow control settings of an exemplary device provided by the invention.

A test apparatus was established comprising:

a. a connection mechanism ("adapter") for connecting a flow meter to the device;
b. a high precision, medical grade, Sensirion SFM-3000 flow meter ("flow meter") capable of connecting to the adapter and thus associating the flow meter with the device;
c. a user interface comprising a mouthpiece for the user to use to breathe through the device; and
d. a data collection computer interface.

With no device attached to the adapter of the test apparatus, a test subject was asked to place their mouth on the apparatus mouthpiece and to breath normally through the test apparatus.

The flow meter captured the airflow through the device. FIG. 23 illustrates the average flow rate of air in standard liters per minute (SLPM) through the test apparatus with no device attached. Four breaths of the user are provided (each breath measured once). The graph provided in FIG. 23 validates the use of the apparatus as a reliable mechanism for assessing flow rate, as it (a) demonstrates the relative consistency of the airflow rate across breaths of the test subject (e.g., peak airflow rate ranges between about 15 SLPM and about 27 SLPM across the 4 breaths and, specifically, between about 15 and about 20 SLPM across the final 3 breaths of the test subject) and, (b) establishes that the flow meter is capable of detecting changes in flow rate across a spectrum ranging from 0 SLPM to at least about 27 SLPM.

A device comprising an airflow control mechanism comprising a first airflow control component illustrated in FIGS. 12A and 12B and a second airflow control component illustrated in FIG. 16, and operating according to the descriptions provided therein thereof, was obtained and attached to the adapter of the test apparatus. The device comprised an insert according to the embodiment exemplified in FIG. 18C, made of ceramic.

The airflow control mechanism of the device, established by the barrel crown and the body crown as described herein ("airflow control mechanism"), which, when in various configurations, establish positions ranging from a "maximally open" position (maximally open aperture; wherein about ½ of a circular airflow path through the device is open to airflow) to a "maximally closed" position (no opening/closed aperture), was set to its maximally open position.

The test subject was again asked to place their mouth on the apparatus mouthpiece and to breathe through the mouthpiece. After each breath, the aperture was adjusted by a single "click". As described elsewhere herein, a single "click" represented the interface of body crown peaks/recessions being adjusted relative to the barrel crown fan peaks/recession by a single peak/recession. Each "click" represented an adjustment to the size of the aperture. In the device utilized, each "click" represented an adjustment of the aperture by about 12 degrees. The test was performed over a span of 180 degrees of rotation of the body assembly and tip assembly relative to one another, as, in the test device, 0 degrees (starting position) represented a maximally open aperture (the device being in a maximally open position, providing the least amount of drag and highest level of airflow) and 180 degrees (final position) represented a maximally closed device or closed aperture (the device providing the highest amount of drag and the lowest level of airflow). Flow rates at each aperture setting were captured from the starting, maximally open position up to and including the point at which the aperture was maximally closed. This established a first set of test results.

Upon completion of the first test and the collection of the first set of test results, the device was returned to its starting configuration of the aperture being in a maximally open position.

The test was then repeated using the same test subject. This established a second set of test results.

Upon completion of the second test and the collection of the second set of test results, the device was again returned to its starting configuration of the aperture being in a maximally open position.

The test was then repeated a third time using the same test subject. This established a third and final set of test results.

The three sets of test results were then combined and averaged. The average flow rates at each of the aperture settings are provided in Table 1 below. Again, the aperture angle of zero (0) degrees represented the device being in a maximally open position and the aperture angle of 180 degrees represented the device being in a maximally closed position. FIG. 24 provides a graph of the averaged data provided in Table 1 below.

TABLE 1

Average Device Flow Rate During Inhalation at Various Aperture Positions

| Click position | Aperture angle (degrees) | Average flow (SLPM) | Average change in flow from previous aperture setting (SLPM) | Average change in flow from previous aperture setting (%) |
|---|---|---|---|---|
| 1 | 0 | 3.8 | — | — |
| 2 | 12 | 3.6 | −0.2 | 5% |
| 3 | 24 | 3.25 | −0.35 | 10% |
| 4 | 36 | 2.8 | −0.45 | 14% |
| 5 | 48 | 2.7 | −0.1 | 4% |
| 6 | 60 | 2.2 | −0.5 | 19% |
| 7 | 72 | 2 | −0.2 | 9% |
| 8 | 84 | 2 | 0 | 0% |
| 9 | 96 | 1.9 | −0.1 | 5% |
| 10 | 108 | 1.8 | −0.1 | 5% |
| 11 | 120 | 1.5 | −0.3 | 17% |
| 12 | 132 | 1.1 | −0.4 | 27% |
| 13 | 144 | 1 | −0.1 | 9% |
| 14 | 156 | 0.95 | −0.05 | 5% |
| 15 | 168 | 0.7 | −0.25 | 26% |
| 16 | 180 | 0.6 | −0.1 | 14% |
| | | Average: | −0.21 | 11% |
| | | STDEV: | 0.16 | 0.08 |

As shown in the graph of FIG. 24, the various aperture settings are capable of incrementally modifying, e.g., achieve the incremental adjustment of the flow rate of air through the device in a very consistent manner. On average, each setting decreased the airflow by about 11%, with a standard deviation of about 0.08. Further, each setting decreased the airflow by about 0.21 SLPM, with a standard deviation of about 0.16. The airflow control mechanism is capable of decreasing the airflow from a maximum of almost 4 SLPM to less than 1 SLPM, e.g., to at least about 0.6 SLPM. Specifically, the airflow control mechanism decreased the airflow through the device via pre-determined, selectable, and distinct airflow settings by about 84%. The airflow test conducted here demonstrates the flexibility and customizability of the device(s) provided by the invention in/of airflow (drag) control.

This experiment was conducted utilizing a device comprising a ceramic insert as described above. It can be noted that the profile of the average flow rate across device aperture settings is expected to be at least substantially the same for the device regardless of whether or not the device comprises an insert, regardless of use of inserts made of a different material, regardless of use of inserts having a different design, or any combination thereof. In such circumstances, the actual airflow rates at each setting may vary, however they are expected to vary similarly across the various aperture angles and thus only the airflow rate magnitude is expected to change, while the profile of the airflow rate across the aperture angle settings of 0 degrees to 180 degrees is expected to remain at least substantially the same.

The data provided in Example 1 describes the relative changes in airflow between and across airflow control settings (aperture settings) and, thus, reflects the impact of the airflow control system. Example 1 demonstrates that the incrementally adjusted airflow control system herein provides a highly consistent decrease (or, e.g., correspondingly, a highly consistent increase) of airflow through the device as the airflow control mechanism is incrementally adjusted. Variation in breath strength, e.g., differences between delivery device users, could, in theory, change the raw results in terms of flow rate (SLPM). Flow rate data (SLPM) demonstrated here could be different if tested in a population of users from which average flow rates at each control setting is/are obtained. However, it is expected that a pattern which is at least generally the same as, at least substantially the same as, at least substantially similar to, similar to, or e.g., which is the same as that demonstrated here will be obtained in such varied circumstances. That is, it is expected that the airflow control mechanism demonstrated here will demonstrate a highly consistent decrease (or, e.g., correspondingly, a highly consistent increase) of airflow through the device as the airflow control mechanism is incrementally adjusted as has been demonstrated in this Example.

Example 2

This Example describes a pilot study conducted to demonstrate that change in weight over time of solid volatile compound maintaining/releasing devices (e.g., "inserts" or "reservoirs" as described herein), provided loaded with volatile essential oil(s), could be discerned. Further the pilot study was designed to determine if the change in weight of such devices over time correlated with loss of essential oil from such the essential oil-loaded device(s). In this Example, the volatile compound maintaining/releasing devices are referenced as "removable insert(s)."

Four (4) removable inserts, comprising no essential oil, were collected.

At time zero (time (min)=0), three of the four removable inserts (removable insert 1, removable insert 2, and removable insert 3) were infused with 0.38 mL of peppermint essential oil having a density of 0.898 g/mL. The final (fourth) removable insert had no essential oil added, serving as a control. Each insert was immediately weighed, and the weight was recorded.

After initial weighing at time zero, each of the four removable inserts were allowed to sit undisturbed on a laboratory bench, in open air. Each removable insert was weighed at 30, 60, 90, and 120 minutes (time (min)=30, 60, 90, and 120 min). The weight of each removable insert at each time point was recorded.

Results for removable insert 1 are shown in the graph of FIG. 36, titled, "Mint 1." Results for removable insert 2 are shown in the graph of FIG. 37, titled, "Mint 2." Results for removable insert 3 are shown in the graph of FIG. 38, titled, "Mint 3."

No graph is provided for removable insert 4 as, (as is described below), no change in weight over time was observed.

As shown in the graphs of FIGS. 36-38, the peppermint oil-infused removable inserts decreased in weight in a linear fashion over the course of at least 120 minutes. No change in weight was detected in the control removable insert (not shown).

Data demonstrate that the loss of weight of removable insert 1 ("Mint 1," FIG. 36) over the time period observed was approximately 28 mg/hour. As the peppermint essential oil had a density of approximately 0.898 g/mL, this represents a rate of loss of peppermint oil from the removable insert of approximately 36 μL/hour.

Data demonstrate that the loss of weight of removable insert 2 ("Mint 2," FIG. 37) over the time period observed was approximately 15 mg/hour. As the peppermint essential oil had a density of approximately 0.898 g/mL, this represents a rate of loss of peppermint oil from the removable insert of approximately 16 μL/hour.

Data demonstrate that the loss of weight of removable insert 3 ("Mint 3," FIG. 38) over the time period observed was approximately 13 mg/hour. As the peppermint essential oil had a density of approximately 0.898 g/mL, this represents a rate of loss of peppermint oil from the removable insert of approximately 14 μL/hour.

Compiling data from the three removable inserts, Example 2 demonstrates that the loss of weight of a removable insert infused with approximately 0.38 mL of peppermint essential oil can range from between about 13 mg/hour to about 28 mg/hour, with an average of about 18.7 mg/hour. The rate of loss of peppermint essential oil from a removable insert infused with approximately 0.38 mL of peppermint essential oil can range between about 14 μL/hour and about 31 μL/hour, with an average of about 20.3 μL/hour. This represents standard deviation(s) of about 8.1 mg/hour and about 9.3 μL/hour, respectively.

These data demonstrate that volatilization of essential oil from removable insert(s)/volatile compound maintaining/releasing device(s) can be detected, and further that such volatilization can be quantified by measuring the decrease in weight of the essential oil-infused removable insert(s)/volatile compound maintaining/releasing device(s) over time.

Example 3

A study was performed to investigate, under simulated conditions, the human exposure level to essential oil(s) delivered by device(s) described herein.

Packages of "white cranberry"-flavored removable inserts and "crisp mint"-flavored removable inserts were collected as provided by the manufacturer. five (5) white cranberry-flavored removable inserts and five (5) crisp mint-flavored removable inserts were removed from freshly opened packaging, for a total of ten (10) volatile-infused removable inserts. Each removable insert was immediately weighed, and their respective weight recorded as time zero (time (min)=0).

Immediately after weighing, each removable insert was placed into a delivery device described herein. Each delivery device comprised a stainless-steel body assembly. To simulate product use, the delivery device was set to the fully open airflow configuration. A bulb pipette was utilized to introduce air into the delivery device through the open end of the device (opposite the mouthpiece). Each period of air introduction is referenced here as a "flush." Five (5) full squeezes of the pipette bulb, each squeeze lasting about 1 second) were completed at each time point, including time zero, with the tip of the pipette in contact with the open end of the delivery device to ensure a suitable amount of air entered the delivery device. Each squeeze of the five (5) full squeezes represented 1 flush. A flush was intended to mimic a single product use in which volatilized essential oil from the removable insert within the delivery device would be drawn into the mouth of the delivery device user. The study was designed to create an exaggerated air flow condition(s) compared to a typical "draw" of the product. This lends itself to the assessment of an upper threshold of essential oil exposure from product use. Thus, in this study, five (5) consecutive air flushes were conducted at each time point to model five exaggerated "draws" of the product.

At time 0, after the initial weighing and insertion of each removable insert into a delivery device, five (5) consecutive air flushes were conducted. Upon completing the air flushes, the removable inserts were removed from their respective delivery devices, weighed again, and immediately returned to their original delivery device(s) until the next time period.

At 14, 30, 60, 120, and 240 minutes, removable inserts were removed from each respective delivery device. Each removable insert was weighed (with their weight recorded) and reinserted into the respective delivery devices. Immediately upon reinsertion, five (5) flushes were performed on each delivery device. Upon completion of the air flushing, each removable insert was again removed, weighed (with their weight recorded), and returned to the respective delivery device(s) until the next time period. The airflow control setting of each of the ten (10) delivery devices remained in the fully open position throughout the study. The delivery devices containing the removable inserts were allowed to sit undisturbed on a laboratory bench between each time period at which the weight of the removable insert was collected.

Summarized results are presented in Table 2, below.

TABLE 2

Summary data: Average essential oil loss from removable inserts following air purging (5 purges) at time points between 0 min and 240 min.

| Time (min) | White Cranberry Essential Oil Volatilization (μL) | Crisp Mint Essential Oil Volatilization (μL) |
|---|---|---|
| 0 | 3.7 ± 0.6 | 3.4 ± 1.4 |
| 15 | 2.8 ± 0.4 | 2.3 ± 0.7 |
| 30 | 2.4 ± 0.4 | 1.9 ± 0.6 |
| 60 | 2.4 ± 0.4 | 1.9 ± 0.8 |
| 120 | 2.2 ± 0.5 | 2.0 ± 0.5 |
| 240 | 2.9 ± 0.4 | 2.4 ± 0.7 |
| Average | 2.7 ± 0.5 | 2.3 ± 0.8 |

Following air flushing (5 flushes) measured and averaged at each time point, an average of 2.7±0.5 μL and 2.3±0.8 μL of essential oil was volatilized from the white cranberry and crips mint removable inserts, respectively (Table 2, above). To arrive at the summarized values above, a density of 0.898 g/mL was utilized for both the white cranberry and crisp mint products even though white cranberry is a mix of multiple, different essential oils. Each oil is presumed to have a density of less than 1 g/mL.

Essential oil loss following flushing trended higher at the first time point (time=0 min) for both the white cranberry and crisp mint products but was similar at subsequent time points (time=15, 30, 60, 120, and 240 min.). Some essential oil loss was observed between time points while the removable inserts was housed in the delivery devices. The loss was similar between 15 to 30 minutes and between 120 to 240 minutes, suggesting that the removable inserts were largely protected from volatilization while housed in the delivery devices.

Over the course of the 240-minute (4 hour) experiment, the total loss of essential oil (including by flushing and housing between time points) was 29.7±2.2 μL and 23.7±5.3 μL for the white cranberry and crisp mint products, respectively. As each removable insert was originally infused with 0.38 mL (380 μL) of total essential oil, the total loss represented approximately 6-8% of the total essential oil in the removable insert. This includes loss of oil in the removable insert from a total of 30 air purges (5 purges at each time point) and loss while the removable insert was housed in the delivery device between time points.

The primary goal of the laboratory study of Example 2 was to provide insight(s) into human exposure to volatilized essential oils from use of delivery device(s) described herein under simulated conditions. Following five air purges, between about 1 μL and about 5 μL of essential oil were volatilized from the two tested removable insert products (white cranberry and crisp mint) at each time point. This represents an average loss of between about 0.2 μL and about 1 μL of loss for each purge, with a purge simulating a single use/engagement with (or "draw" from) a delivery device by a user. Therefore, the results of this study suggest that the essential oil exposure per draw of product described herein is likely to be less than about 1 μL. The total daily exposure would be dependent on the number of draws per day by an individual. For example, 30 draws per day of the product would result in a maximum exposure of, e.g., about 30 μL of oil.

There are recognized limitations to this study. First, it is possible that handling and/or transfer of the removable insert(s) into and out of the delivery device, required for weighing them at each time point, resulted in an additional loss of oil beyond air purging. Therefore, measured values could be an overestimation of the true exposure. Nonetheless, the results may provide a useful estimation of exposure or illustrate other principles relevant to the practice or understanding of the invention.

One or more follow up studies which utilize draft chamber(s) with thermal desorption tubes to capture air sample(s) (with volatilized oil) would allow for captured air samples in such a study to be immediately followed by GC-MS analysis. This type of study can further constrain the likely exposure value.

In addition, the air purging model utilized in this study is likely to result in higher volatilization of oils than a typical, single, human application of suction (or draw) from the delivery device. The study experiment was intended to create "exaggerated conditions"; however, it has not been clearly established how much volatilization occurs from a typical human draw of the product. Accordingly, the maximum exposure per draw on/from a delivery device could be detectably or significantly less than that indicated by this study. Again, nonetheless, the results may provide a useful estimate of exposure or illustrate other principles relevant to the practice or understanding of the invention.

Finally, the results of this study suggest that a small percentage (e.g., between about 6% and about 8%) of the 0.38 mL of essential oil within the removable insert(s) was volatilized after 4 hours (and 30 air purges). Therefore, even if the same removable insert was used for multiple days, much of the essential oil may remain in the insert. Accordingly, a detectably or significantly reduced amount of essential oil could be placed in the removable insert without an appreciable or significant drop in product experience. Such a decreased amount of, e.g., essential oil, is contemplated as being utilized in device(s) and system(s) herein.

What is claimed is:

1. An unpowered, handheld device for delivering one or more volatile flavored compounds to the mouth of an individual comprising:

(1) an airflow inlet that permits air to flow into the device, (2) a volatile compound outlet component that comprises a mouthpiece comprising an airflow outlet that allows air containing one or more volatile compounds released from the device to be delivered to the mouth of the individual, (3) a volatile compound composition storage component that, when a volatile compound composition comprising the one or more volatile flavored compounds is inserted into the device, stores the volatile compound composition until the volatile compound composition is removed from the device, (4) an enclosed airflow pathway positioned within the interior of the device that permits air to flow from the airflow inlet, through the volatile compound composition storage component, through the volatile compound outlet component comprising the mouthpiece, and out of the airflow outlet of the mouthpiece, wherein the enclosed airflow pathway prevents the release of more than 10% of the one or more volatile flavored compounds from the device before reaching the airflow outlet while a user applies oral suction to the device, and (5) a selectable airflow restriction component, wherein when the individual selects an airflow restriction component setting, such selection reduces or increases airflow through the airflow inlet, out of the airflow outlet, within the enclosed airflow pathway positioned within the interior of the device, or such selection reduces or increases airflow through the airflow inlet, out of the airflow outlet, and within the enclosed airflow pathway positioned within the interior of the device.

2. The device of claim 1, wherein the volatile compound storage component is at least partially composed of a material that is impervious to the volatile compound composition.

3. The device of claim 2, wherein the airflow restriction component is positioned at or downstream of the airflow inlet and upstream of the volatile compound composition storage component.

4. The device of claim 3, wherein the airflow restriction component is placed at the airflow inlet and controls the amount of air entering the device.

5. The device of claim 4, wherein the selectable airflow restriction component is a controllable airflow restriction component by which the individual can control the amount of airflow restriction applied by the airflow restriction component.

6. The device of claim 5, wherein adjustment of the controllable airflow restriction component is associated with a tactile position indicator, an auditory motion indicator, a visual position indicator, or a combination of any or all thereof.

7. The device of claim 1, wherein the airflow restriction component is positioned at or downstream of the airflow inlet and upstream of the volatile compound composition storage component.

8. The device of claim 1, wherein the airflow restriction component is placed at the airflow inlet and controls the amount of air entering the device.

9. The device of claim 1, wherein the selectable airflow restriction component is a controllable airflow restriction component by which the individual can control the amount of airflow restriction applied by the airflow restriction component.

10. A system or device for delivering one or more volatile flavored compounds to the mouth of an individual, the system or device comprising:

(1) an unpowered, handheld volatile compound delivery device that comprises (a) an airflow inlet that permits air to flow into the unpowered, handheld volatile compound delivery device, (b) a volatile compound outlet component that comprises a mouthpiece comprising an airflow outlet that allows air containing one or more volatile flavored compounds released from the unpowered, handheld volatile compound delivery device to be delivered to the mouth of the individual, (c) a volatile compound composition storage component that, when a volatile compound composition comprising the one or more volatile flavored compounds is inserted into the unpowered, handheld volatile compound delivery device, stores the volatile compound composition until the volatile compound composition is removed from the unpowered, handheld volatile compound delivery device, and (d) an enclosed airflow pathway positioned within the interior of the unpowered, handheld volatile compound delivery device that permits air to flow from the airflow inlet, through the volatile compound composition storage component, through the volatile compound outlet component comprising the mouthpiece, and out of the airflow outlet of the mouthpiece, wherein the enclosed airflow pathway prevents the release of more than 10% of the one or more volatile flavored compounds from the unpowered, handheld volatile compound delivery device before reaching the airflow outlet while a user applies oral suction to the unpowered, handheld volatile compound delivery device, and (2) one or more movable fidget elements, wherein at least one of the one or more movable fidget elements is (a) a component of the unpowered, handheld volatile compound delivery device, (b) an unpowered, handheld volatile compound delivery device or component of an unpowered, handheld volatile compound delivery device in a system comprising two or more devices wherein the unpowered, handheld volatile compound delivery device is one of the two or more devices in the system, or (c) a component of the unpowered, handheld volatile compound delivery device and is an unpowered, handheld volatile compound delivery device in a system comprising two or more devices wherein the unpowered, handheld volatile compound delivery device is one of the two or more devices in the system, wherein, in each applicable case, at least one of the one or more movable fidget elements is positioned in an initial resting position prior to the user using the unpowered, handheld volatile compound delivery device or the system, and wherein the movement of the at least one of the one or more movable fidget elements is initiated when the user applies a minimum initiation force of at least 0.2-3 Newtons to the at least one of the one or more movable fidget elements, thereby causing the at least one of the one or more movable fidget elements to move to a detectibly different position than the initial resting position, at least temporarily, within a period of less than 10 seconds.

11. The system or device of claim 10, wherein the movement of at least one of the one or more movable fidget elements is a rotating motion, a spinning motion, a swinging motion, or a push/pull motion.

12. The system or device of claim 11, wherein at least one of the one or more movable fidget elements releasably engages the volatile compound outlet component.

13. The system or device of claim 12, wherein at least one of the one or more movable fidget elements releasably engages the volatile compound outlet component by a magnetic attraction.

14. The system or device of claim 13, wherein at least one of the one or more movable fidget elements also encloses a part of the volatile compound composition storage component when at rest and engaged with the volatile compound outlet component.

15. The system or device of claim 14, wherein the system or device is a system that comprises a support device that releasably engages the unpowered, handheld volatile compound delivery device, wherein the unpowered, handheld volatile compound delivery device serves as one of the at least one or more movable fidget elements, the unpowered, handheld volatile compound delivery device moving when the user applies the initiation force to the unpowered, handheld volatile compound delivery device while it is engaged with the support device.

16. The system or device of claim 10, wherein at least one of the one or more movable fidget elements releasably engages the volatile compound outlet component.

17. The system or device of claim 10, wherein at least one of the one or more movable fidget elements is adapted to come to rest in a position that is the same as or about the same as the initial resting position in at least one dimension.

18. The system or device of claim 10, wherein at least one of the one or more movable fidget elements, once set in motion by the minimum initiation force, automatically continues movement for a period of about 3.5 seconds or less.

19. The system or device of claim 10, at least one of the one or more movable fidget elements comprises a releasable engagement mechanism composed of two components, wherein the user must reengage the components to re-set the releasable engagement mechanism prior to repeating the movement of the at least one of the one or more movable fidget elements, and wherein the minimum force required to reengage the components is about the same or less than the minimum initiation force.

20. The system or device of claim 10, wherein the system or device comprises at least two movable fidget elements.

21. The system or device of claim 10, wherein the system or device is a system that comprises a support device that releasably engages the volatile compound delivery device, wherein the volatile compound delivery device serves as one of the at least one or more movable fidget elements, the unpowered, handheld volatile compound delivery device moving when the user applies the initiation force to the volatile compound delivery device while it is engaged with the support device.

22. An unpowered, handheld device for delivering one or more volatile flavored compounds to the mouth of an individual comprising:

(1) an airflow inlet that permits air to flow into the device, (2) a volatile compound outlet element that comprises a mouthpiece comprising an airflow outlet that allows air containing one or more volatile flavored compounds released from the device to be delivered to the mouth of the individual, wherein at least most of the volatile compound outlet element is composed of a first material that is impervious to one or more volatile compound compositions, (3) a volatile compound composition storage element that, when a volatile compound composition comprising one or more of the one or more volatile flavored compounds is inserted into the device, stores the volatile compound composition until the volatile compound composition is removed from the device, wherein at least most of the volatile compound composition storage element is composed of the first material or a second material that is impervious to the one or more volatile flavored compounds, (4) an enclosed airflow pathway positioned within the interior of the device that permits air to flow from the airflow inlet, through the volatile compound composition storage element, through the volatile compound outlet element comprising the mouthpiece, and out of the airflow outlet of the mouthpiece, and (5) a mating element participating in the formation of the enclosed airflow pathway such that no more than 10% of the volatile flavored compounds are released from the device before reaching the airflow outlet when the user applies an oral suction force to the airflow inlet of the device, wherein the mating element releasably engages the volatile compound outlet element, wherein the mating element is composed of a third material that is different from the first material and the second material, if applicable, wherein the third material is either at least 50% less dense than the first material, is associated with a detectably different tactile physiological response than the first material, or both.

23. The device of claim 22, wherein the first material is dishwasher safe.

24. The device of claim 23, wherein the first material is metallic, and the third material is wood.

25. The device of claim 24, wherein the user can manually rotate the mating element relative to the volatile compound output element while the volatile compound output element and mating element remain in contact.

26. The device of claim 25, wherein the device comprises a single body component in which the volatile compound storage element is securely attached to the volatile compound outlet element, wherein the volatile compound storage element is an insert compartment comprising an insert opening that is adapted to receive, and the insert compartment is adapted to support, an insert made of a porous material that absorbs one or more volatile compound compositions.

27. The device of claim 26, wherein the center of balance of the device is located within about +/−15% of the length of the device from where the volatile compound outlet element engages the mating element.

28. A system comprising (1) the device of claim 27 and (2) a removable insert that (a) is sized to fit within the insert compartment, (b) comprises the volatile flavored compound composition comprising one or more of the one or more flavored volatile compounds, and (c) comprises one or more structural features that increase the surface area of the insert as compared to a uniform solid insert of substantially the same shape and size.

29. The system of claim 28, wherein the insert compartment comprises an insert support element that promotes the insert remaining in position within the insert compartment when the insert is received by the insert compartment.

30. The system of claim 29, wherein a section of the enclosed airflow pathway is positioned between the insert compartment and the airflow outlet and comprises a reduced inner diameter compared to the inner diameter in at least one location of the insert compartment, the inner diameter in at least one location of the airflow channel upstream of the insert compartment, or the inner diameter in at least one location of each of the insert compartment and the airflow channel upstream of the insert compartment.

* * * * *